US012453432B2

(12) United States Patent
Pacella et al.

(10) Patent No.: US 12,453,432 B2
(45) Date of Patent: Oct. 28, 2025

(54) TOPPER ACCESSORIES FOR A PLAYARD

(71) Applicant: Wonderland Switzerland AG, Steinhausen (CH)

(72) Inventors: Jonathan M. Pacella, Gap, PA (US); Nathanael Saint, Morgantown, PA (US); Lance J. Clemmer, Mohnton, PA (US); Patrick JG Bowers, West Chester, PA (US)

(73) Assignee: Wonderland Swizterland AG, Steinhausen (CH)

( * ) Notice: Subject to any disclaimer, the term of this patent is extended or adjusted under 35 U.S.C. 154(b) by 262 days.

(21) Appl. No.: 17/922,875

(22) PCT Filed: May 10, 2021

(86) PCT No.: PCT/US2021/031634

§ 371 (c)(1),
(2) Date: Nov. 2, 2022

(87) PCT Pub. No.: WO2021/226598

PCT Pub. Date: Nov. 11, 2021

(65) Prior Publication Data

US 2023/0329451 A1 Oct. 19, 2023

Related U.S. Application Data

(60) Provisional application No. 63/022,009, filed on May 8, 2020, provisional application No. 63/021,966, filed
(Continued)

(51) Int. Cl.

| | |
|---|---|
| ***A47D 13/06*** | (2006.01) |
| ***A47D 5/00*** | (2006.01) |
| ***A47D 9/00*** | (2006.01) |

(52) U.S. Cl.
CPC ..... *A47D 13/063* (2013.01); *A47D 5/006* (2013.01); *A47D 9/005* (2013.01); *A47D 9/016* (2022.08)

(58) Field of Classification Search
CPC ..... A47D 13/063; A47D 9/005; A47D 9/016; A47D 5/00; A47D 13/06; A47D 15/00;
(Continued)

(56) References Cited

U.S. PATENT DOCUMENTS

| | | | |
|---|---|---|---|
| 2,243,984 | A | 6/1941 | Singewald |
| 4,651,367 | A | 3/1987 | Osher et al. |

(Continued)

FOREIGN PATENT DOCUMENTS

| | | | |
|---|---|---|---|
| CN | 2549837 | Y | 5/2003 |
| CN | 108294553 | A | 7/2018 |

(Continued)

OTHER PUBLICATIONS

Extended European Search Report issued in corresponding Application No. 21799526.5 dated Apr. 3, 2024.

(Continued)

*Primary Examiner* — Madison Emanski
(74) *Attorney, Agent, or Firm* — Volpe Koenig

(57) ABSTRACT

A frame for a foldable playard includes multiple leg support assemblies rotatably coupled to multiple X-frame assemblies. Each leg support assembly includes a corner. The corners include a topper mount socket and the X-frame assemblies include one or more topper supports. The topper mount sockets and the topper supports provide multiple locations along the top periphery of the frame to securely couple and support one or more toppers. For example, the frame may support a topper that provides a changing table and an organizer. The changing table or the organizer is rotatable to provide the caregiver more storage space or the
(Continued)

ability to deploy and/or store the changing table while the topper remains installed. In another example, the frame may support a freestanding and collapsible bassinet topper via a bassinet accessory. The bassinet topper provides a support platform without any additional structural support from the frame or the bassinet accessory.

17 Claims, 227 Drawing Sheets

Related U.S. Application Data on May 8, 2020, provisional application No. 63/021, 950, filed on May 8, 2020.

(58) Field of Classification Search

CPC .... A47D 5/006; A47D 11/007; A47D 15/001; A47D 7/007; A47D 11/00; A47D 13/068; A47D 7/002; A47D 13/066; A47D 13/061; A47C 7/666; A47C 29/003

USPC ..... 5/99.1, 93.1, 655, 93.2, 98.1, 11, 2.1, 5/507.1, 634, 97

See application file for complete search history.

(56) References Cited

U.S. PATENT DOCUMENTS

| | | | | |
|---|---|---|---|---|
| 6,915,545 | B2 | 7/2005 | Chen | |
| 9,345,339 | B2 | 5/2016 | Wang et al. | |
| 2006/0253980 | A1 | 11/2006 | Paesang et al. | |
| 2007/0277709 | A1 | 12/2007 | Carter | |
| 2008/0098530 | A1* | 5/2008 | Chen | A47D 13/063 5/655 |
| 2010/0162484 | A1* | 7/2010 | Thomas | A47D 9/016 5/93.1 |
| 2010/0229301 | A1 | 9/2010 | Arnold, IV et al. | |
| 2012/0110730 | A1 | 5/2012 | Sousa et al. | |
| 2013/0326808 | A1* | 12/2013 | Saint | A47D 9/016 5/93.1 |
| 2014/0165288 | A1 | 6/2014 | Wang et al. | |
| 2014/0359938 | A1* | 12/2014 | Burns | A47D 13/061 5/93.1 |
| 2015/0021453 | A1 | 1/2015 | Brassard et al. | |
| 2017/0196373 | A1* | 7/2017 | Sclare | A47D 13/063 |
| 2018/0192786 | A1 | 7/2018 | Horst et al. | |

FOREIGN PATENT DOCUMENTS

| | | | | |
|---|---|---|---|---|
| CN | 207679216 | U | 8/2018 | |
| JP | 2009538708 | A | 11/2009 | |
| TW | 100215805 | | 4/2012 | |
| WO | 1999020160 | A1 | 4/1999 | |
| WO | WO-9920160 | A1 * | 4/1999 | A47D 13/063 |

OTHER PUBLICATIONS

International Search Report and Written Opinion for Application No. PCT/US2021/031634 dated Oct. 14, 2021.

Office Action issued in corresponding Taiwanese Application No. 112149694 dated Apr. 22, 2024.

First Office Action for corresponding Taiwan Application No. 114109920 dated May 26, 2025, 4 pages long.

Notice of Reasons for Rejection for Japanese Application No. 2022-567652 dated Aug. 5, 2025, 4 pages.

* cited by examiner

TOPPER ACCESSORIES FOR A PLAYARD

CROSS-REFERENCE TO RELATED APPLICATIONS

This application is a National Stage 371 Entry of International Patent Application No. PCT/US2021/031634, filed on May 10, 2021, which claims a priority benefit to U.S. Provisional Application No. 63/021,966, filed on May 8, 2020, entitled, "FREE STANDING PORTABLE BASSINET," U.S. Provisional Application No. 63/022,009, filed on May 8, 2020, entitled, "PLAY YARD TOPPER RELEASE AND STORAGE," and U.S. Provisional Application No. 63/021,950, filed on May 8, 2020, entitled, "X-FRAME PLAYARD WITH TOPPERS." Each of the aforementioned applications is incorporated by reference herein in its entirety.

BACKGROUND

A playard (also referred to herein as a "playpen" or a "game bed") is a framed enclosure that provides a safe and comfortable space for a young child (e.g., an infant, a toddler) to sleep and play without significant supervision from a caregiver. The playard typically includes a support structure (e.g., a frame) that outlines an interior space of the playard; the playard also includes soft padding (also referred to herein as "soft goods") placed within the interior space to provide a partially enclosed cushioned space to contain the child. Playards are generally foldable and/or collapsible to improve portability. For example, the caregiver may fold the playard for storage and/or transport and unfold the playard for use. Various types of playards have been manufactured and commercialized over the years with designs that have evolved, in part, depending on whether the playard is used primarily in outdoor settings or indoor settings.

FIG. 1A shows one example of a conventional outdoor playard 10*a* in an unfolded configuration. As shown, the playard 10*a* includes a frame 46 with multiple X-frame assemblies 20*a* that outline an interior space 11. Each X-frame assembly 20*a* includes X-frame tubes 22*a* and 22*b* that form a crossing pattern. In this example, the X-frame assemblies 20*a* are pivot-only X-frame assemblies where the X-frame tubes 22*a* and 22*b* are only rotatably coupled to each other and to other X-frame tubes to such that the frame 46 is foldable. As shown in the exploded-view inset in FIG. 1A, the playard 10*a* is provided with a latch 16 that attaches to the X-frame tubes 22*a* and 22*b* to lock the X-frame assemblies 20*a* in place when unfolded. Soft goods 12 are attached to the X-frame assemblies 20*a* and disposed along the sides and the floor of the interior space 11 for providing a partially enclosed space 13 for the child that is shaped and/or dimensioned to be similar to or smaller than the interior space 11 of the frame 46. As shown, the soft goods 12 includes webbing 14 along a top edge of the partially enclosed space 13 that functions as a top rail to increase the mechanical rigidity and stability of the playard 10*a* when the playard 10*a* is deployed. FIG. 1A also shows the playard 10*a* includes a canopy cover 40 disposed above the partially enclosed space 13 and mounted to the X-frame assemblies 20*a* to provide shade for a child.

FIG. 1B shows another example of a conventional outdoor playard 10*b*. As shown, the playard 10*b* includes a frame 46 with multiple pivot and slidable X-frame assemblies 20*b* coupled to adjoining leg support assemblies 24. Each leg support assembly 24 includes a leg tube 25, a corner (hidden beneath the soft goods 12) at the top of the leg tube 25, and a slider 26*a* or 26*b* that slides along the leg tube 25. The X-frame tubes 22*a* and 22*b* of each X-frame assembly 20*a* are coupled to respective sliders 26*a* and/or 26*b* and corners of the leg support assemblies 24. Thus, when the playard 10*b* is being folded or unfolded, the X-frame tubes 22*a* and 22*b* undergo both rotation and displacement along the leg tubes 25 via the sliders 26*a* and/or 26*b*. Compared to the pivot-only X-frame assemblies 20*a* of the playard 10*a*, the pivot and slidable X-frame assemblies 20*b* of the playard 10*b* enable the playard 10*b* to be folded more compactly thus occupying less space in a folded configuration; additionally, the pivot and slidable X-frame assemblies 20*b* allow the frame 46 to provide a larger interior space 11 and, hence, a larger partially enclosed space 13 for a child when the playard 10*b* is in an unfolded configuration.

As before, the soft goods 12 may be attached to the leg support assemblies 24 and/or the X-frame assemblies 20*b*. The playard 10*b* also includes a pair of latches 16*a* and 16*b* respectively mounted to sliders 26*b* on leg support assemblies 24 disposed on opposing sides of the playard 10*b*. As shown in the inset of FIG. 1B, the sliders 26*b* are different from the sliders 26*a* due to including features to lock the latches 16*a* and 16*b*. The playard 10*b* also includes a canopy cover 40 disposed above the partially enclosed space 13 and mounted to the corners of the leg support assemblies 24.

FIG. 1C shows an example of a conventional indoor playard 10*c*. As shown, the playard 10*c* includes a frame 46 formed from multiple legs 30 and rigid top rails 32 to provide a rigid frame supporting soft goods 12. The frame 46 also includes a bottom support structure 34 so that the floor of the partially enclosed space 13 defined by the soft goods 12 is suspended off the ground. Compared to the outdoor playards 10*a* and 10*b*, the indoor playard 10*c* does not include X-frame assemblies to facilitate folding and/or unfolding. Instead, the top rails 32 are coupled to a hinge 36, which allows the playard 10*c* to be collapsed into a smaller form as shown in FIG. 1D. Additionally, the bottom support structure 34 is also foldable. Thus, to fold the playard 10*c*, the caregiver needs to first remove some of the soft goods 12, pull up a bottom hub to fold the bottom support structure 34 (step 'A' in FIG. 1D), and then unlock and fold the top rails 32 (step 'B' in FIG. 1D). The caregiver needs to perform these steps in reverse to setup the playard 10*c*.

FIG. 1C also shows the playard 10*c* includes a bassinet accessory 60 disposed within the partially enclosed space 13 to provide an elevated surface above the ground to support the child. The elevated surface may reduce the physical strain experienced by a caregiver when placing their child into the playard 10*c* and/or when taking their child out of the playard 10*c* by providing a more accessible and easier to reach space compared to the bottom of the playard 10*c*. The elevated surface of the bassinet accessory 60 also allows the caregiver to more easily monitor their child as well. Conventional bassinet accessories are typically configured to support infants and/or children weighing less than 15 lbs.

SUMMARY

The Inventors have recognized and appreciated that a foldable playard provides a caregiver a convenient and safe space for their child to play and/or sleep once the playard is setup, which alleviates the caregiver from having to continuously monitor their child. However, the Inventors have also recognized that conventional playards in some instances may be cumbersome to setup and/or stow away due, in part, to complicated mechanisms for folding, unfolding, latching and/or unlatching the playard (and correspondingly protracted procedures that the caregiver needs to perform while generally caring for their child). The complexity of conventional playards also results in a bulkier product, which is more difficult to handle and more expensive to manufacture and purchase as a consumer.

First, the Inventors have observed that conventional playards typically include various support structures, in addition to their frames, to provide more rigid boundaries outlining the interior space, so as to better contain the child and/or to increase the mechanical rigidity and stability of the frame. In many instances, one or more additional support structures are added to the frame of a conventional playard to ensure the playard meets various consumer safety standards related to the mechanical properties of the frame (e.g., American Society for Testing and Materials (ASTM) F406-19 entitled, "Standard Consumer Safety Specification for Non-Full-Size Baby Cribs/Play Yards").

With reference again to FIG. 1A and FIG. 1B, as noted above the respective frames 46 of the playards 10*a* and 10*b* include X-frame assemblies 20*a* and 20*b* to facilitate folding and/or unfolding of the frames 46. When unfolded, the X-frame assemblies 20*a* and 20*b* are disposed along the respective sides of the frames 46, thus providing a mechanically rigid and stable structure.

However, FIG. 1A shows the X-frame tubes 22*a* and 22*b* of the X-frame assembly 20*a* in the playard 10*a*, when unfolded, span the sides of the frame 46; this results in a top portion 47 of the interior space 11 above the X-frame assembly 20*a* that is not mechanically supported by the frame 46. If flexible, compliant soft goods 12 are placed over the frame 46 as shown in FIG. 1A, a child could potentially climb out of the playard 10*a* through the top portion 47 by folding and/or collapsing the soft goods. In view of the foregoing, as an additional support structure, the soft goods 12 includes an integrated webbing 14 that is pulled taut when the frame 46 is unfolded such that the webbing 14 mechanically functions as a top rail. In this manner, the webbing 14 provides a more rigid boundary spanning the top portions 47 of the interior space 11 to support the soft goods and to better keep the child within the playard 10*a*.

FIG. 1B similarly shows that the X-frame tubes 22*a* and 22*b* of the X-frame assembly 20*b* in the playard 10*b*, when unfolded, do not mechanically support the top portions 47 of the interior space 11 above the X-frame tubes 22*a* and 22*b*. Thus, similar to the playard 10*a*, the playard 10*b* includes webbing 14 that is directly coupled to the leg support assemblies 24 as an additional support structure. When the frame 46 of the playard 10*b* is unfolded, the webbing 14 is once again pulled taut to form a top rail and thereby provide a more rigid boundary spanning the top portions 47 of the interior space. It should be appreciated that without the webbing 14, the playards 10*a* and 10*b* are unlikely to comply with various consumer safety standards, such as ASTM F406-19.

As noted above in connection with FIG. 1C, the playard 10*c* includes rigid top rails 32 that connect adjacent legs 30. In this manner, the frame 46 of the playard 10*c* provides mechanical support structures that span the top and side boundaries of the interior space 11. However, a frame that only has vertical or nearly vertical legs and top rails is often prone to mechanical instability. For example, the frame may tilt to one side due to the bottom portion of the legs being mechanically unconstrained and/or due to backlash or slop between the joints connecting the rails and the legs together. This mechanical instability may be further exacerbated if the legs and the rails are configured to move relative to one another, e.g., to facilitate folding of the playard. Given this mechanical instability, to reinforce the frame 46 the playard 10*c* includes an additional bottom support structure 34 that connects the legs 30 located at opposing corners of the frame 46.

The various support structures added to conventional playards as discussed above, and the various modifications made to the playards to accommodate these support structures, increase the complexity, number of parts, and cost of these playards.

For instance, the webbing 14 for the playards 10*a* and 10*b* needs to be sewn directly into the soft goods 12 or the X-frame assemblies 20*a* and 20*b*, and/or the leg support assemblies 24 need to incorporate additional structural features to directly attach to the soft webbing 14—both of which increase design complexity resulting in higher manufacturing costs. For the playard 10*c*, the rigid top rails 32 and the bottom support structure 34 need to include additional mechanisms (e.g., the hinge 36, hinges connecting the various members of the bottom support structure 34) to facilitate tear down and folding of the playard 10*c*, which increase the number of parts for manufacture and assembly. As shown in FIG. 1D, these additional mechanisms also make it more difficult for the caregiver to setup and tear down the playard 10*c* by adding additional steps (e.g., steps 'A' and 'B'). In particular, the playard 10*c* is especially difficult to unfold since the playard 10*c* tends to tip over and/or partially collapse when partially unfolded.

The Inventors have also recognized that conventional playards often include frames with folding mechanisms tailored to improve the ease of folding and/or unfolding the frame at the expense of creating potential new safety hazards for the child.

For example, the playards 10*a* and 10*b* include X-frame assemblies 20*a* and 20*b*, respectively, which makes folding and/or unfolding the respective frames 46 appreciably easier for the caregiver. However, the X-frame tubes 22*a* and 22*b* and/or the leg tubes 25 form V-shaped and/or diamond-shaped openings, which can change in shape and/or size when the X-frame tubes 22*a* and 22*b* and the leg tubes 25 move relative to one another, thus creating a scissoring, shearing, and/or pinching hazard that can result in the entrapment of the child's neck.

Conventional playards with X-frame assemblies typically address potential entrapment hazards using two approaches depending, in part, on whether the frame is folded or unfolded. In the unfolded configuration, the openings in the frame may be sufficiently large to allow a child to insert their head through one of the openings of the frame. To reduce the risk of neck entrapment, the openings formed by the rigid components of the frame may be positioned towards the top of the playard to make the openings less accessible to the child. Additionally, the rigid components may be arranged to have sufficient clearances that also reduce the likelihood of the child's neck getting pinched. For example, the respective bottom portions of the X-frame tubes 22*a* and 22*b* in the playard 10*b* may each form a V-shaped opening with the leg tube 25. When the frame 46 is unfolded, the X-frame tubes 22*a* and 22*b* are disposed in the upper half of the frame 46 and oriented with respect to the leg tubes 25 to form a relatively wide V-shaped opening.

In the folded configuration, the openings in the frame may be positioned lower towards the ground due to the displacement of the rigid components of the frame. However, the openings are typically reduced in size to such an extent that a child is unable to insert their head through an opening in the frame, which in turn reduces the risk of neck entrapment.

Returning to the example of the V-shaped openings formed between the leg tube 25 and the respective X-frame tubes 22*a* and 22*b* in the playard 10*b*, the width of the V-shaped opening may be appreciably smaller than the average size of a child's head when the frame 46 is folded, thus preventing a child from inserting their head through an opening in the frame 46.

Although these two approaches are effective in reducing the risks of neck entrapment, the Inventors have recognized conventional playard frames typically benefit from these two approaches only when the frame is fully folded or fully unfolded. In other words, neck entrapment hazards may still exist when the playard is transitioning from the unfolded configuration to the folded configuration (or vice-versa). This may occur when a child playing outside the playard has access to the playard frame in a partially folded or partially unfolded state. This may also occur when the child is contained within the playard where the child may accidentally unlock and fold the frame from within the playard. For example, a child may be able to insert their head through the V-shaped openings in the playard 10*b* when the frame is at or near the unfolded configuration. If the frame were to fold thereafter, the size of the V-shaped openings decrease, which can result in the child's neck becoming pinched between the leg tube 25 and the X-frame tubes 22*a* or 22*b*.

FIGS. 1H and 1I show another conventional playard 10*d* with pivot and slidable X-frame assemblies 20*b* in a partially folded state (i.e., neither fully unfolded for use nor fully folded for storage). Similar to the playard 10*b*, the frame 46 of the playard 10*d* includes multiple X-frame assemblies 20*b* that each include X-frame tubes 22*a* and 22*b* and multiple leg support assemblies 24 that each include a leg tube 25, a corner (hidden beneath the soft goods 12), and a slider 26*a* or 26*b*. The playard 10*d* also includes a pair of latches disposed on opposing sides of the frame 46 and integrated, in part, in the sliders 26*b*.

As shown in FIG. 1H, the sliders 26*a* and 26*b* move downwards along the respective leg tubes 25 as the playard 10*d* is folded, which causes the X-frame tubes 22*a* and 22*b* to rotate. FIG. 1I shows that as the playard 10*d* is folded, the gap between one X-frame tube 22*b* and one leg tube 25 decreases to such an extent that a probe 70 initially inserted between the X-frame tube 22*b* and the leg tube 25 becomes clamped between the X-frame tube 22*b* and the leg tube 25. For reference, the probe 70 is used to evaluate head and neck clearances in accordance with various consumer safety standards (e.g., ASTM F406-19 and/or F1004-09). Specifically, the probe 70 is shaped as rectangular prism with dimensions of 1.5 inches (W) by 1.5 inches (H) by 3.0 inches (L).

The risks of entrapment posed by the X-frame assemblies 20*a* and 20*b* may be further exacerbated by the manner in which the playards are folded. For example, the playard 10*a* is folded when a downward force is applied to the X-frame tubes 22*a* and 22*b*. Similarly, the playards 10*b* and 10*d* are folded when a downward force is applied to the X-frame tubes 22*a* and 22*b* or the sliders 26*a* and 26*b*. If the playards 10*a*, 10*b*, and 10*d* are left in a partially folded state, the weight of a child's head may be sufficient to fold the playard, which can result in entrapment. The risks for entrapment may be further increased when the soft goods 12 are partially or fully removed when, for example, washing the soft goods 12 as the child may have greater access to the openings and/or gaps between the rigid components of the frame 46.

The Inventors have further recognized the folding mechanisms implemented in conventional playards may also have detrimental effects on other aspects related to the practical use of the playard.

For example, the X-frame assemblies 20*a* and 20*b* both span an appreciable portion (if not all) of the sides of the respective frames 46 as described above, which may interfere with the visibility of a child in the partially enclosed space 13 and thereby impede or obstruct a caregiver's ability to easily see the child in the playard.

More specifically, with reference again to FIG. 1A, the soft goods 12 in the playard 10*a* includes see-through portions along the sides of the partially enclosed space 13, which are intended to allow the caregiver to see their child. However, the X-frame tubes 22*a* and 22*b* in the pivot-only X-frame assemblies 20*a* span the entire sides of the partially enclosed space 13, thus obstructing the see-through portions of the soft goods 12 and, hence, limiting a caregiver's ability to visually check on their child in the partially enclosed space 13. For the playard 10*b*, the pivot and slidable X-frame assemblies 20*b* do not span the entire sides of the partially enclosed space 13. However, FIG. 1B shows the combination of the X-frame assemblies 20*b* and the soft goods 12 instead covers nearly the top half of the partially enclosed space 13, thus limiting the areas in which the caregiver can see into the partially enclosed space 13.

In another example, the frame 46 of the playard 10*c* allows the caregiver to readily see into the partially enclosed space 13 at the expense of using a more complicated folding/unfolding mechanism as described above. Indoor playards are also typically designed to be aesthetically pleasing for indoor settings (e.g., the indoor playard should match other indoor furniture), which can often lead to compromises in other areas such as ease of use. For instance, X-frame assemblies are often only used for outdoor playards because the appearance of X-frame tubes clashes with most indoor furniture.

The Inventors further have also observed that conventional playards often include complex latches that are expensive to manufacture and difficult for consumers to use. For example, conventional playard frames that utilize pivot and slidable X-frame assemblies, such as the playards 10*b* or 10*d* shown in FIGS. 1B, 1H, and 1I, often include multiple latches disposed on opposing sides of the playard to prevent any one side of the playard frame from sagging downwards when locked in the unfolded configuration. In particular, as noted above FIG. 1B shows the playard 10*b* includes a pair of latches 16*a* and 16*b* disposed on opposing sides of the playard 10*b*. To lock or unlock the playard 10*b*, the caregiver needs to manually actuate each latch 16 one at a time, on different sides of the playard, which is inconvenient and cumbersome. In another example, the conventional indoor playard 10*c* shown in FIG. 1C includes separate latches for each hinge 36. As described above, the caregiver needs to first lock each latch for each hinge 36 before unfolding the bottom support structure 34, during which the playard 10*c* may tip over and/or partially collapse if not held up properly by the caregiver.

The inclusion of multiple latches increases the number of parts and, hence, the cost for manufacture. This drawback may be further exacerbated based on the placement and complexity of a given latch. For example, the latches 16*a* and 16*b* in the playard 10*b* are mounted to the sliders of the leg support assemblies 24; as a result, the playard 10*b* needs to include different types of sliders, i.e., the sliders 26*b* forming part of the latches 16*a* and 16*b*, and the different sliders 26*a* for the remainder of the leg support assemblies 24. Accordingly, this playard design increases the number of unique parts that need to be manufactured, which in turn increases manufacturing cost.

Additionally, the Inventors have observed conventional playards typically do not include a latch to lock the playard in the folded configuration, which may increase the risk of the child being exposed to a playard in a partially unfolded or folded state. For example, if a child is left alone with the playards 10*a*, 10*b*, and 10*d*, the child may pull on the X-frame tubes 22*a* and 22*b* or, in the case of the playards 10*b* and 10*d*, pull on the leg tubes 25 or the sliders 26*a* and 26*b* in a manner that causes the frame 46 to unfold and/or fold. Thus, an entrapment hazard may be created if the child unfolds the playard to such an extent that they are able to insert their head through an opening in the frame 46.

The Inventors have also observed that conventional playards also include various accessories to augment the functionality of the playard and/or the environment for the child.

For example, FIG. 1J shows another conventional indoor playard 10*e* supporting multiple toppers 80 (also referred to herein as "accessory items"), such as a bassinet topper 80*a* to support a sleeping infant, a changing table 80*b* to support a child during a diaper change, and an organizer 80*c* to store various care items (e.g., diapers, baby powder). However, the Inventors have recognized and appreciated conventional playards with toppers generally include a rigid top rail, such as the top rail 32 in the playard 10*c*, to support the toppers. The Inventors have further recognized conventional playards that do not have a rigid top rail, such as the playard 10*b* with the X-frame assemblies 20*b*, are generally unable to support toppers due, in part, to the lack of a rigid support structure along the top periphery of the playard frame.

The playard 10*e*, for instance, includes a frame 46 with multiple legs 30, a bottom support structure 34, and rigid top rails 32 with respective hinges 36 similar to the playard 10*c*. The frame 46 may be further covered by soft goods 12. As shown, the top rails 32 span the top periphery of the frame 46. The toppers 80*a* and 80*b* include locking mechanisms 82*a* and 82*b*, respectively, that attach directly to the top rails 32 such that the toppers 80*a* and 80*b* are disposed on top of the soft goods 12 covering the top rails 32. FIG. 1J also shows the organizer 80*c* includes a pair of hooks 84 that hang directly from the top rail 32. Thus, the top rails 32 in the playard 10*e* mechanically support the toppers 80*a*, 80*b*, and 80*c*.

The Inventors have also recognized conventional toppers are typically static fixtures when installed on the playard (e.g., the position and/or placement of the topper cannot be changed after installation). Although static toppers may be suitable for a variety of applications, they may also create new challenges for the caregiver. First, the caregiver may have to install and uninstall a topper each time the topper is used. For example, the changing table 80*b* in the playard 10*e* may be used several times throughout the day requiring the caregiver to install the changing table 80*b* each time it is used. Afterwards, the caregiver should remove the changing table 80*b* before placing the child back into the playard. Second, the storage space provided by conventional toppers, such as the organizer 80*c*, is typically proportional to the lateral dimensions of the topper since the storage space is generally accessible only from one side (e.g., the top side). In other words, a tradeoff exists where an increase in the storage space may result in an undesirable increase in the overall length of the playard, which may make the playard occupy more space within the caregiver's home. Third, gaps may form between the topper and the playard frame when the topper is installed. The gaps may pose an entrapment hazard for the child particularly if the playard and/or topper are not properly used (e.g., the child is left unattended near or within the playard with access to the topper).

The Inventors have also recognized and appreciated it is desirable for some toppers, such as a bassinet topper, to be usable together with a playard or as a freestanding apparatus (e.g., a bassinet topper placed on the ground to support a child) and/or to be foldable to improve portability. However, the Inventors have also recognized conventional toppers that provide these features are often complicated in their construction, resulting in higher manufacturing costs and greater difficulty for the caregiver to setup and/or tear down (e.g., the caregiver should actuate several components and/or assemble several parts to setup the topper).

In another example, the playard 10*c* shown in FIG. 1C includes a bassinet accessory 60 to provide an elevated surface above the ground to support the child for their first several months of life. The Inventors have recognized and appreciated that a bassinet accessory provides caregivers a more convenient and accessible platform to place their child into the playard and/or to take their child out of the playard compared to the interior space of the playard (i.e., when the playard 10*c* does not include the bassinet accessory 60). The Inventors have also recognized a removable bassinet accessory effectively extends the lifetime use of the foldable playard from birth up until the child is typically able to climb out of the playard or weighs more than 30 lbs. However, the Inventors have also recognized that conventional bassinet accessories for playards often have to compromise between the accessibility of the elevated surface (e.g., how far the caregiver should reach into the playard to place their child into the bassinet accessory), ease of use (e.g., the procedure to fold and/or unfold the bassinet accessory and the foldable playard), and the overall size of the foldable playard and the bassinet accessory particularly when folded.

Bassinet accessories typically include a support structure to provide a flat surface for the child to sleep upon in order to meet various compliance standards (e.g., ASTM F2194 entitled, "Standard Consumer Safety Specification for Bassinets and Cradles"). For many conventional bassinet accessories, the support structure is a rigid structure that is not foldable (or unfoldable) with the playard frame. Thus, the bassinet accessory should be removed before folding the playard and/or installed when unfolding the playard, which adds additional steps for the caregiver to setup and/or tear down the playard. Additionally, the removal of the bassinet accessory requires the caregiver to provide extra space to store and/or transport the foldable playard and the bassinet accessory as separate items and may also increase the likelihood of the caregiver forgetting or losing the bassinet accessory especially when transporting the playard from one location to another location.

Bassinet accessories that fold and unfold together with the playard frame have been previously demonstrated to address, in part, the limitations associated with the rigid bassinet accessories described above. However, the Inventors have recognized conventional foldable bassinet accessories often achieve foldability with the playard by compromising other aspects of the bassinet accessory.

For example, the bassinet accessory 60 provides the playard 10*c* with a relatively shallower elevated space to support the child (e.g., the top surface of the mattress is offset from the top rail 32 of the playard 10*c* by a distance less than or equal to about 10 inches). This is achieved, in part, by utilizing a more complex folding mechanism that requires the user to assemble and disassemble part of the bassinet accessory 60 to facilitate unfolding and folding. For instance, FIG. 1E shows the bassinet accessory 60 for the playard 10*c* includes bassinet soft goods 62 and two support tube assemblies 64 forming a support structure to support a mattress. As shown, each support tube assembly 64 includes support tubes 64*a*, 64*b*, and 64*c* mounted to a bottom portion of the bassinet soft goods 62.

To setup the bassinet accessory 60, the caregiver should manually connect the support tube 64*a* to the support tube 64*b*, and connect the support tube 64*c* to the support tube 64*b*, to form a rigid support tube assembly 64 spanning the length of the bassinet accessory 60. To tear down the bassinet accessory 60, the caregiver should manually disconnect the support tubes 64*a*-64*c* from one another. These additional steps not only make the bassinet accessory 60 more difficult to fold and/or unfold, but may also increase the likelihood of lost parts (e.g., the caregiver misplaces one of the support tubes separately from the mattress) and/or an improper setup especially if the caregiver does not properly connect the support tubes 64*a*-64*c* together.

In some conventional foldable bassinet accessories, simpler folding mechanisms (e.g., a mechanism that does not require assembly of two or more components for deployment or disassembly for storage) have been used to simplify setup and/or tear down. However, these simpler folding mechanisms often result in an increase to the overall size of the playard in the folded configuration (e.g., a portion of the bassinet accessory extends appreciably beyond the envelope of the playard when folded) or results in a relatively deeper bassinet accessory (e.g., the top surface of the mattress is offset from the top rail 32 of the playard 10*c* by a distance appreciably greater than 10 inches) to ensure the folding mechanism remains within the envelope of the folded playard. For the latter case, a deeper bassinet accessory results in the caregiver having to bend over further to place their child into the bassinet accessory and/or to take their child out of the bassinet accessory resulting in greater physical strain.

In another example, the playards 10*a* and 10*b* shown in FIG. 1A and FIG. 1B both include a canopy cover 40 to provide shade for a child when the playard is deployed in outdoor settings. However, the Inventors have recognized and appreciated that in some instances various accessories, and in particular canopy covers, often are prone to misuse and premature detachment from the playard, and/or may compromise the safety of the child.

Generally, conventional canopy covers are supported by a separate canopy cover frame that directly mounts onto a top portion of the playard (e.g., the corners), which is already covered with soft goods. The presence of the soft goods can make it difficult for a caregiver to determine the proper location(s) on the playard where the canopy cover should be mounted, which can often result in incorrect canopy cover installations. Additionally, conventional canopy covers often are not attached securely to the playard due, in part, to the stack of multiple fabric layers in the soft goods. As a result, conventional canopy covers for outdoor playards are often prone to premature detachment due, for example, to a gust of wind.

Conventional canopy covers are also prone to being detached by a child placed within the partially enclosed space of the playard. For example, FIG. 1F shows the playard 10*a* of FIG. 1A with the canopy cover 40 pulled off a corner 28 by a child in the playard. As shown, a canopy bow 44 supports the canopy cover 40 over the playard 10*a*. The canopy bow 44 is attached to a canopy clip 42, which in turn should attach to the corner 28 covered by the soft goods 12. However, the combination of the canopy clip 42 not being securely attached to the corner 28 and the child's accessibility to the canopy clip 42 can lead to the removal of the canopy cover 40 by the child as shown in FIG. 1F. FIG. 1G shows another example where the child can further pull the canopy cover 40 into the partially enclosed space 13 of the playard 10*a* by pulling on the canopy bow 44 and/or the canopy clip 42.

In view of the foregoing observations by the Inventors, the present disclosure is thus directed to various inventive implementations of a foldable playard that is easier to operate (e.g., fold, unfold, latch and/or unlatch) compared to conventional playards, structurally simpler with fewer parts for manufacture, provides desired clearances between the rigid components of the playard, and nonetheless remains sufficiently stable and rigid in structure so as to readily comply with various consumer safety standards (e.g., ASTM F406-19, referenced above). The present disclosure is also directed to various inventive implementations of accessories, such as a topper, a bassinet accessory, and/or a canopy cover, that are easier to install and/or uninstall from the playard frame, structurally simpler with fewer parts for manufacture while remaining mechanically stable and rigid especially when mounted onto the playard, and, in some instances, reconfigurable and/or collapsible to provide additional functionality to the playard.

In various inventive implementations, a foldable playard may generally include a frame that defines an interior space when unfolded, and soft goods that are mounted to the frame and partially disposed within the interior space to define a partially enclosed space for a child. In some implementations, a foldable playard includes an improved canopy cover assembly to cover the partially enclosed space (e.g., when the playard is deployed in an outdoor setting).

In one example of a frame for a foldable playard according to the present disclosure, the frame may be a closed frame that includes multiple leg support assemblies and X-frame assemblies arranged such that each leg support assembly is disposed along a side edge of the interior space, with the X-frame assemblies disposed between adjacent leg support assemblies along a side face of the interior space. The leg support assemblies enable the foldable playard to stand on the ground and the X-frame assemblies provide the structural support for the leg support assemblies as well as the mechanism to facilitate folding and/or unfolding of the playard. In some implementations, the leg support assemblies and the X-frame assemblies may define an interior space having a cross-section in the plane parallel to the ground that is polygonal in shape (e.g., a square, a rectangle, a hexagon).

Each leg support assembly of the frame of a foldable playard may include a leg tube, a corner mounted to a top end of the leg tube, a foot mounted to a bottom end of the leg tube, and a slider that slides between the corner and the foot. The top and bottom ends of the leg tube may align with top and bottom vertices of the interior space, respectively. Each X-frame assembly may include at least one pair of X-frame tubes (also referred to as a "X-tube") where each X-frame tube is rotatably coupled to at least another X-frame tube, the corner, and/or the slider. By coupling at least one of the X-frame tubes to the slider, the X-frame assembly becomes a pivot and slidable X-frame assembly in which the X-frame tubes are rotationally and translationally displaced when folding and/or unfolding the playard. In this manner, the combination of the X-frame assemblies and the leg support assemblies allows for a playard that folds into a smaller form occupying less volume and/or unfolds to provide a larger interior space and, hence, a larger partially enclosed space for the child as compared to conventional playards.

In one aspect, the X-frame assemblies of the frame of the foldable playard may be positioned sufficiently near a top portion of the interior space when the playard is deployed in an unfolded configuration such that each X-frame assembly effectively functions as a rigid top rail that mechanically connects adjacent leg support assemblies in the frame. Said in another way, the respective X-frame tubes of each X-frame assembly form a top perimeter structure that spans the top of the playard frame, thus outlining a top opening of the interior space. For example, each pair of X-frame tubes in each X-frame assembly may form a sufficiently shallow X-frame structure such that the X-frame tubes are mechanically similar to the rigid top rails in previous playards (e.g., the top rail 32 in the playard 10*c*).

However, unlike previous playards, the frames of the foldable playards disclosed herein are sufficiently rigid and stable with only X-frame assemblies coupling the leg support assemblies together. In other words, in example implementations, the frames of the foldable playards disclosed herein do not include a separate top rail (e.g., the webbing 14 of the playards 10*a* and 10*b* shown in FIG. 1A and FIG. 1B, or the top rail 32 of the playard 10*c* shown in FIG. 1C) or a bottom support structure (e.g., the bottom structure 34 of the playard 10*c* shown in FIG. 1C). Accordingly, the innovative frames described herein result in a more refined playard with sound mechanical stability using fewer parts.

In one aspect, the foldable playard frames disclosed in various examples herein achieve mechanical stability using fewer parts by reducing the length of the leg tubes as compared to conventional playards so as to make the frames less prone to being tilted and/or rotated (e.g., the resultant torque applied to a frame for a given force is reduced due to a shorter moment arm). As explained in greater detail below, in some implementations the length of a leg tube may be dimensioned based only on the portions of the foot and the corner that overlap with the leg tube and the distance the slider travels to sufficiently fold and/or unfold the frame.

In another aspect, the foldable playard frame may provide clearances in accordance with various consumer safety standards (e.g., ASTM F406-19 and/or F1004-09). For example, each X-frame tube may be separated from a leg tube by a gap greater than or equal to 1.5 inches, which corresponds to the width of a partially bounded opening (e.g., a V-shaped opening, a diamond-shaped opening) below which the risk of neck entrapment is considered unacceptable as set forth in ASTM F406-19 and ASTM F1004-09. The partially bounded opening is considered to be an opening that is sufficiently large enough to fit a child's head in at least one configuration of the foldable playard (e.g., the unfolded configuration). In another example, each pair of X-frame tubes may be laterally offset from one another by a distance that is sufficiently small such that a child is unable to insert their head laterally between the X-frame tubes. For example, each pair of X-frame tubes may be laterally offset by a gap less than 1.5 inches.

In some implementations, the frame may be structurally designed to maintain the desired clearances when the foldable playard is in the deployed unfolded configuration, the compact folded configuration, and between the unfolded and folded configurations (e.g., while the foldable playard is being folded or unfolded). In some implementations, the frame may include various safety features, such as a mechanical stop, to reduce the likelihood or, in some instances, prevent the clearances from falling outside the desired range. For example, a Valco snap button disposed on the leg tube below the slider in the unfolded configuration may act as a mechanical stop to prevent the frame from being accidentally folded to such an extent that the desired gap between the X-frame tube and the leg tube falls below the desired range.

For example, each leg support assembly may be coupled to a X-frame assembly such that no portion of a X-frame tube is separated from a leg tube by a gap less than 1.5 inches. This may be accomplished, in part, by utilizing sliders and corners with arms (also referred to herein as "extended portions") that extend along the side faces of the interior space and rotatably couple to the respective X-frame tubes of the X-frame assemblies. The respective arms of each slider and corner may be shaped and/or dimensioned to position the X-frame tubes at a set distance from the leg tubes independent of the position of the slider along the leg tube. For instance, the respective arms of each slider may have a length, $l_{sr}$, defined as the distance from a base of the slider to a pin joint where the X-frame tube is coupled to the slider, greater than or equal to 1.5 inches. In other words, the portion of the X-frame tube coupled to the arm of the slider, which is located closest to the leg tube and, hence, forms the narrowest portion of a V-shaped opening, may be separated from the leg tube by a distance greater than or equal to 1.5 inches. The respective arms of each corner may also have a length, $l_{cr}$, defined as the distance from a base of the corner to a pin joint where the X-frame tube is coupled to the corner, that is also greater than or equal to 1.5 inches.

In some implementations, the respective sliders and corners in a pair of leg support assemblies disposed on adjacent side edges of the interior space (i.e., side edges that share a single side face) may each have an arm that extends along the same side face. The respective arms of the sliders in the pair of leg support assemblies may be in colinear alignment with one another and, similarly, the respective arms of the corners may be in colinear alignment with one another. Said in another way, the respective arms of the slider and corner of one leg support assembly may each have an end that is aligned to the respective ends of the corresponding slider and corner of the other leg support assembly. In some implementations, the respective ends of the slider arms may be disposed proximate to one another or, in some instances, may physically contact one another when the playard is folded. Similarly, the respective ends of the corner arms may also be disposed proximate to one another or may physically contact one another in the folded configuration.

For foldable playards that include sliders and corners with colinearly aligned arms, the dimensions of the playard in the folded configuration are directly proportional to the sum of the respective lengths of the slider and corner arms disposed along the same side face. In particular, the side dimensions of the playard may be greater than or equal to two times the length of the respective arms of the sliders and corners in each pair of leg support assemblies disposed on adjacent side edges of the interior space. Thus, an increase in the length of the arms of the sliders and/or corners of the foldable playard, for example, to provide a playard frame with desired clearances results in a proportional increase to the overall size of the playard in the folded configuration.

In some implementations, the foldable playard frame may include sliders and corners with arms that are offset in position in order to allow for longer arms while maintaining a compact size, particularly in the folded configuration. Specifically, the respective arms of the sliders and corners may be offset from the respective side faces such that the arms of the slider and the corner in one leg support assembly at least partially overlap the corresponding arms of the slider and the corner in another adjacent leg support assembly along the same side face in the folded configuration. Said in another way, the end of the arms in the slider or the corner of one leg support assembly may be disposed proximate to or, in some instances, may physically contact the corresponding base of the slider or the corner of the other leg support assembly in the folded configuration. In this manner, the respective lengths of the sliders and the corners may be dimensioned to provide the desired clearances (e.g., a length greater than or equal to 1.5 inches) while maintaining a compact folded size of the playard where the dimensions of the frame in the folded configuration are directly proportional to the length of the corner and the slider of only one leg support assembly.

The respective sliders and corners in the leg support assemblies may each have two arms that couple to respective X-frame assemblies disposed along adjacent side faces of the interior space (i.e., a pair of side faces sharing the same side edge). In some implementations, the respective arms of the sliders and corners may be offset in an asymmetric manner. For example, the first arm of a slider or corner may be offset away from the interior space and the second arm of the slider or corner may be offset towards the interior space. In this manner, the first arm of the slider or the corner of one leg support assembly may at least partially overlap the second arm of the slider or the corner of the other leg support assembly in the folded configuration. In some implementations, the same sliders and corners with asymmetrically offset arms may be used in each leg support assembly, thus simplifying manufacture and assembly of the playard frame.

However, it should be appreciated that, in some implementations, the respective arms of the sliders and corners may be offset in a symmetric manner. For example, the first and second arms of the slider or the corner of a first leg support assembly may both be offset away from the interior space or offset towards the interior space. The first and second arms of the slider or the corner of a second leg support assembly adjacent to the first leg support assembly may be offset in the opposite direction from the slider and the corner of the first leg support assembly. Said in another way, the direction the first and second arms of the slider or the corner are offset relative to the interior space may alternate for each successive leg support assembly disposed at each corner of the playard frame. In this manner, the first arm of the slider or the corner of the first leg support assembly may at least partially overlap the second arm of the slider or the corner of the second leg support assembly in the folded configuration.

The offset in the respective arms of the sliders and the corners may also simplify the shape of the X-frame tubes for each X-frame assembly. For example, the first arm of the slider in a first leg support assembly and the second arm of the corner in a second leg support assembly adjacent to the first leg support assembly may be offset together in a first direction (e.g., towards the interior space or away from the interior space) while the first arm of the corner in the first leg support assembly and the second arm of the slider in the second leg support assembly are off together in a second direction opposite the first direction. This arrangement allows for X-frame tubes that are straight tubes (i.e., a tube with no bends) with a constant cross section to couple the slider of the first leg support assembly to the corner of the second leg support assembly and, similarly, the corner of the first leg support assembly to the slider of the second leg support assembly. In some implementations, the X-frame tubes of each X-frame assembly may be laterally offset by a gap, $w_x$, defined as the distance between the respective centerline's of the X-frame tubes. The gap $w_x$ may be chosen to provide sufficient spacing for the respective arms of the sliders and corners to overlap one another while being sufficiently small to prevent the child from inserting their head laterally between the X-frame tubes. For example, the gap $w_x$ may range between 0.625 inches and 1.5 inches to provide sufficient spacing for the respective arms of the sliders and corners to overlap one another.

Additionally, the dimensions and/or materials of the X-frame tubes employed in foldable playard frames disclosed in various examples herein may be chosen to provide sufficient mechanical rigidity to the frame. For example, the X-frame tubes may be formed from steel tubing with an exterior diameter of about 0.625 inches and a total length of about 24.5 inches. However, it should be appreciated the X-frame tubes may be formed from other materials (e.g., aluminum, carbon fiber) having different dimensions depending, in part, on the mechanical properties of the material and the desired dimensions of the interior space provided by the frame. In some implementations, as noted above, a frame comprising only leg support assemblies and X-frame assemblies as disclosed herein, without additional support structures, may satisfy the various mechanical rigidity, stability, and/or strength requirements set forth in various consumer safety standards (e.g., ASTM F406-19, 7.3.3, 7.11).

It should be appreciated that soft goods may be coupled at various points along the frame so that the partially enclosed space formed by the soft goods opens properly when the playard is unfolded. However, the soft goods may generally be a compliant, flexible component that remains loose instead of being pulled taut and, hence, does not appreciably improve the mechanical rigidity and/or stability of the frame.

Additionally, by placing the X-frame assemblies of the frame near the top portion of the interior space, the sides of the frame are more exposed to provide a larger window for the caregiver to see their child when the child is placed within the interior space. Furthermore, soft goods attached to the frame may more readily cover the X-frame assemblies using less material. In some implementations, the soft goods may partially cover the X-frame assemblies to provide access to a latch (described in more detail below), while in other implementations the soft goods may completely cover the X-frame assemblies such that no portion of the X-frame assemblies are observable when the playard is unfolded (which may improve, in part, the aesthetic appearance of the playard for both outdoor and indoor settings).

As discussed in greater detail below, the "top portion" of foldable playard frame in a given example implementation may generally refer to the portion of the frame proximate to the top ends of the leg tubes and/or the corners of each leg support assembly. The leg tubes of the respective leg support assemblies may generally have substantially identical lengths. In some implementations, the top portion of the frame may be defined as having: 1) a top horizontal plane that intersects the top ends of the leg tubes and/or the corners; and 2) a bottom horizontal plane that is offset vertically from the top horizontal plane such that the X-frame tubes are located entirely within the top and bottom horizontal planes when the X-frame assembly is unfolded. In some implementations, the bottom horizontal plane may be offset from the top horizontal plane by a distance less than or equal to 30% of the total length of the leg tubes and, more preferably, less than or equal to 20% of the total length of the leg tubes.

As noted above, in some implementations a foldable playard frame may include one or more X-frame assemblies forming a single X-frame structure with one pair of X-frame tubes. Each X-frame tube in the pair of X-frame tubes may be rotatably coupled to a corner of one leg support assembly, a slider of another leg support assembly, and the other X-frame tube in the pair of X-frame tubes. In other example implementations, a foldable playard frame may include one or more X-frame assemblies forming a double X-frame structure with two pairs of X-frame tubes. In examples employing this double X-frame structure, each X-frame tube is coupled to either a slider or a corner of one leg support, the X-frame tube within the same pair of X-frame tubes, and another X-frame tube from another pair of X-frame tubes. In this manner, the frame may provide an interior space having a horizontal cross section in which the sides have different dimensions (e.g., an interior space with a rectangular shape).

In another aspect, a foldable playard frame according to the present disclosure may include a latch to maintain the frame in an unfolded configuration. In some implementations, the frame may only include a single latch to maintain the frame in the unfolded configuration. In some implementations, the single latch is configured such that, as a caregiver unfolds the frame (e.g., by moving the slider in one leg support assembly towards the corner), the single latch is automatically actuated to lock the frame in the unfolded configuration. In this manner, the process of unfolding and locking the playard may be readily accomplished with the caregiver positioned at one side and/or one corner of the playard (i.e., the caregiver does not have to move around the playard to actuate multiple latches). Furthermore, the caregiver may unfold and lock the playard using a single hand. For example, the single latch may automatically lock when the slider is displaced a sufficient distance along the leg tube.

In some implementations, the latch may be preferably disposed in the top portion of the frame as defined above. For example, the latch may include a latch member having a first end coupled to the corner of one leg support assembly and a second end that couples to a X-frame tube of one X-frame assembly or the slider. In this manner, the latch may be partially covered or, in some instances, fully covered by the soft goods.

The latch may also be coupled to various components of the frame including, but not limited to, an X-frame tube, a leg tube, a slider, and a corner. In some implementations, the latch may be coupled to the components of the X-frame assembly and/or the leg support assembly without having to modify the respective components of the X-frame assembly and the leg support assembly. For example, the latch may include a latch member that is rotatably coupled to the corner of one leg support assembly via a pin joint that also serves to rotatably couple an X-frame tube to the corner. In this manner, the playard may include a smaller number of unique parts for manufacture. In some implementations, the playard may include identical corners and/or identical sliders for the multiple leg support assemblies.

In some implementations, the latch may be a tool-less mechanism that is actuated in one or two steps by the caregiver. In one example, the latch member may couple respective components of the X-frame assembly and/or the leg support assembly to maintain an unfolded configuration via various attachment mechanisms including, but not limited to, a snap-fit connection, a spring-loaded pin, and a spring-loaded rotational lock off mechanism.

In some implementations, the latch may be a double-action latch that includes a latch member (e.g., mounted to the corner of one leg support assembly) and a latch boss (e.g., mounted to a X-frame tube of one X-frame assembly). The latch boss may include an undercut portion and the latch member may include a latch opening to receive the latch boss with a tab disposed within the latch opening to engage the undercut portion. In some implementations, the tab may include a slot and the undercut portion may include a rib to align the latch member and the latch boss when locking the latch. The undercut portion and the tab may be shaped such that the caregiver is unable to unlock the latch by pulling the latch member without applying an excessive amount of force (e.g., greater than 10 lbs of force). Instead, the caregiver may first squeeze the respective X-frame tubes of the X-frame assembly to displace the latch boss within the latch opening of the latch member to disengage the tab from the undercut portion. While squeezing the X-frame tubes together, the caregiver may then pull the latch member off the latch boss, thus unlocking the latch.

In yet another aspect, the foldable playard frame according to the present disclosure may include a storage latch to lock the frame in the folded configuration. The storage latch may thus provide an additional safety feature that further reduces the likelihood of a child being exposed to a frame that is partially folded and/or unfolded (i.e., the sliders of the leg support assemblies are readily movable along the leg tube). In some implementations, the frame may only include a single storage latch to maintain the frame in the folded configuration. Similar to the latch described above, the storage latch may be configured to automatically engage when the caregiver folds the frame (e.g., by moving the slider in one leg support assembly towards the foot). Thus, the process of folding and locking the playard in the folded configuration may be readily accomplished using a single hand in a tool-less manner.

In some implementations, the storage latch may be disposed near a bottom end of the leg tube proximate to or, in some instances, abutting the foot of the leg support assembly. For example, the storage latch may be rigidly mounted to the leg tube and configured to physically contact a top surface of the slider in order to prevent the slider from moving towards the top end of the leg tube, hence, preventing the frame from unfolding. In some implementations, the storage latch may be installed onto a leg support assembly without modifications to the slider. Said in another way, the same slider may be used in each leg support assembly independent of whether the leg support assembly includes the storage latch or not.

In some implementations, the storage latch may include a push button partially disposed with a cavity of the leg tube and a spring element disposed in the cavity to impart a spring force that displaces the push button outwards from the leg tube. The push button may include a restraining surface (e.g., a bottom surface) that contacts the top surface of the slider to maintain the playard in the folded configuration. When the caregiver presses the push button, the push button may be inserted into the cavity of the leg tube, thus allowing the caregiver to pull the slider up and past the push button in order to unfold the frame. The push button or the slider may further include a ramped surface shaped such that the slider presses the push button into the cavity of the leg tube when folding the frame (e.g., when the slider moves downwards along the leg tube). Once the slider moves past the push button, the spring element forces the push button outwards, thus automatically locking the frame in the folded configuration.

In some implementations, the storage latch may include a latch member rigidly coupled to the leg tube. In some implementations, the latch member may be integrally formed together with the foot of the leg support assembly. The latch member may be a mechanically compliant component that includes a hook disposed at its end to contact the top surface of the slider and, hence, maintain the playard in the folded configuration. When the caregiver pulls the latch member outwards, the latch member may bend such that the hook is physically decoupled from the slider, thus allowing the caregiver to move the slider upwards along the leg tube to unfold the frame. The hook may further include a ramped surface shaped such that the slider automatically bends the latch member in an outwards direction when the slider moves downwards along the leg tube to fold the frame, thus allowing the slider to move past the hook of the latch member. The latch member may have sufficient mechanical rigidity such that the internal restoring force generated when the latch member is bent returns the latch member to its original unbent form, thus automatically locking the frame in the folded configuration.

In yet another aspect, the foldable playard may include soft goods to define the partially enclosed space in which the child may play and/or sleep. Generally, the soft goods may cover a portion of the frame (e.g., the corners of the leg support assembly, a portion of the X-frame assemblies). In some implementations, the soft goods may be coupled directly to the frame (e.g., a corner) via one or more snap-fit connections. The soft goods may further include a semi-rigid tab disposed near the top edge of the soft goods to support a snap-fit connector to ensure the soft goods remain flush against the frame when attached (i.e., the top edge of the soft goods does not flip upwards to expose an interior portion of the soft goods). The soft goods may further include a floor portion that directly rests on the ground, as well as side portions, where the floor and side portions define the bottom and sides of the partially enclosed space. In some implementations, the side portions may be transparent and/or see-through (e.g., a mesh) to allow the caregiver to readily see their child in the playard.

In yet another aspect, a foldable playard according to the present disclosure may include a bassinet accessory, disposed within the interior space of the frame and the partially enclosed space of the playard soft goods, to provide an elevated surface to support the child. The bassinet accessory may generally include a support structure that defines a relatively smaller partially enclosed space affiliated with the bassinet accessory to contain the child when the bassinet accessory is unfolded (e.g., the relatively smaller partially enclosed space of the bassinet accessory may be disposed within the partially enclosed space of the playard soft goods).

The support structure of the bassinet accessory may include bassinet soft goods with side surfaces and a bottom surface that at least partially define and surround the relatively smaller partially enclosed space of the bassinet accessory. The support structure may further include a hub and multiple support tubes that together form a rigid structure in the deployed unfolded configuration. Each support tube may be rotatably (e.g., pivotably) coupled to the hub to facilitate folding and unfolding of the bassinet accessory. The bassinet accessory may also include a mattress disposed on the hub and the support tubes in the deployed unfolded configuration to provide a cushioned surface for the child to rest upon. The mattress may be removable and foldable.

The bassinet accessory and, in particular, the support structure may fold and unfold together with the frame and the soft goods when installed on the foldable playard. The bassinet accessory may provide a relatively shallow partially enclosed space to improve accessibility for the caregiver. For example, the distance from the top surface of the mattress to the top side of the foldable playard may range between 7.5 inches and about 10 inches. More generally, the height of the bassinet accessory when installed on the playard, $h_{t,1}$, which is defined as the distance between respective bottom corner portions of the bassinet soft goods and the top of the foldable playard (e.g., a top horizontal plane defined by the playard), may range between 7.5 inches and about 12 inches.

The bassinet accessory may also include a folding mechanism that does not require assembly and/or disassembly when folding and unfolding the bassinet accessory together with the foldable playard. Instead, the hub and the support tubes may form a foldable structure with integrated mechanical stops and/or a locking mechanism (e.g., a hub latch) to maintain the hub and the support tubes in the desired unfolded configuration. In this manner, the procedure for folding and unfolding the foldable playard together with the installed bassinet accessory may be simplified compared to conventional bassinet accessories (e.g., the bassinet accessory 60 for the playard 10*c*).

In one example, the hub may be disposed at the center of the bottom surface of the bassinet soft goods and the support tubes may be disposed and oriented along the diagonal segments of the bottom surface. Said in another way, the support tubes may extend radially from the hub to the respective corner portions of the bottom surface of the bassinet soft goods. The support tubes may be further attached to the bassinet soft goods via one or more attachment mechanisms (e.g., a screw fastener, a strap) such that the bassinet soft goods and the support tubes move together. When folding or unfolding the bassinet accessory, the caregiver may pull up or push down on the hub, thus causing the support tubes and the bassinet soft goods to fold or unfold.

Additionally, the bassinet accessory may be disposed substantially within the interior space of the playard frame in both the unfolded and folded configurations such that the overall size of the foldable playard with the bassinet accessory remains substantially similar or the same as the foldable playard without the bassinet accessory. In this manner, the compact shape of the playard in the folded configuration is maintained for ease of storage and/or transport.

The bassinet accessory exhibiting the features described above (e.g., a relatively shallow height, a simple folding mechanism, and a compact size) may be accomplished in multiple ways. In one example, the support tubes may change in length between the folded and unfolded configurations. For instance, the hub may move in an upwards direction when folding the bassinet accessory and, conversely, in a downwards direction when unfolding the bassinet accessory. To ensure the hub does not extend appreciably outside the interior space of the playard as the playard is folded up, particularly given the relatively shallow height of the bassinet accessory, each support tube may be telescoping (e.g., each support tube may include a first support tube and a second support tube telescopically coupled to the first support tube).

When the bassinet accessory is unfolded, the extended support tube may have an overall length, $L_{t,1}$, greater than the height, $h_{t,1}$, of the bassinet accessory. However, when the bassinet accessory is folded, the first support tube may telescopically move towards the second support tube. Thus, the overall length of the support tube changes from $L_t$, to a length, $L_{t,2}$, in the folded configuration, where $L_{t,2}$ is less than $L_{t,1}$. In various examples discussed in greater detail below, the length $L_{t,2}$ may be approximately less than or equal to the height $h_{t,1}$ of the bassinet accessory. It should be appreciated that the height of the bassinet accessory, $h_{t,1}$, may in some circumstances change somewhat when folding and unfolding the bassinet accessory (e.g., the bottom of the bassinet soft goods may fold and bunch up). However, in other circumstances, respective bottom corners of the bassinet accessory soft goods do not undergo significant vertical displacement between the folded and unfolded configurations. In any event, the above constraints imposed on the length of the support tube and height of the bassinet accessory in the respective folded and unfolded configurations may still be satisfied so as to mitigate substantial protrusion of the hub above a top of the playard in the folded configuration.

For this example, the bassinet accessory may not include a separate locking mechanism (e.g., a hub latch) to maintain the unfolded configuration. Instead, a combination of the integrated mechanical stops and the weight of the hub, the support tubes, the mattress, and/or the child may ensure the bassinet accessory remains in the deployed unfolded configuration. In this manner, the number of parts and the cost for manufacture of the bassinet accessory may be reduced.

In another example, an interior space of the playard below the bassinet accessory in the unfolded configuration may be utilized to contain the hub and/or the support tubes of the bassinet accessory when folding up the playard for storage and/or transport in the folded configuration. This may be accomplished, in part, given the shallow height of the bassinet accessory, which results in a larger portion of the interior space of the playard frame being disposed directly below the bassinet accessory. For instance, the height, $h_b$, corresponding to the distance from the ground to the bottom surface of the bassinet soft goods may be greater than or equal to about 18 inches. For this example, the hub may move in a downwards direction when folding the bassinet accessory and, conversely, in an upwards direction when unfolding the bassinet accessory. To ensure the hub and/or the support tubes remain contained within the interior space of the playard, the length of the support tube, $L_t$, may be approximately equal to or less than the height, $h_b$.

For this example, the integrated mechanical stops may limit further upward movement of the hub once the hub and the support tubes are in the desired unfolded configuration (e.g., the hub and the support tubes form a substantially flat platform supporting the mattress). The hub may further include a hub latch that, when actuated, prevents the hub from moving downwards. Thus, the combination of the mechanical stops and the hub latch may maintain the bassinet accessory in the deployed unfolded configuration.

In yet another aspect, a foldable playard according to the present disclosure may support one or more toppers including, but not limited to, a bassinet topper, a changing table, and an organizer. The topper may generally be positioned near the top portion of the foldable playard (e.g., the topper is located closer to a top horizontal plane of the playard than a ground surface supporting the playard). In some implementations, the topper may be partially disposed within the interior space of the playard. For example, the topper may have a topper frame disposed above a portion of the interior space and supporting topper soft goods and/or a support platform that extends below the top horizontal plane of the playard. In some implementations, the topper may be partially disposed outside the playard (e.g., along the exterior side of the X-frame assemblies). In some implementations, the topper may be shaped and/or dimensioned to cover only a portion of the interior space so that multiple toppers may be mounted to the playard at the same time. For example, the playard may support a bassinet topper and a changing table arranged side by side and the respective toppers may be dimensioned to cover or substantially cover the interior space.

In some implementations, the topper may be securely coupled to the playard frame via an attachment mechanism. For example, at least one of corners of the leg support assemblies may include a topper mount socket and the topper may include a corner assembly with a corner tube inserted into the topper mount socket. The corner assembly may further include a latch lever with a latch head that securely couples the corner tube of the topper to the topper mount socket of the corner. The latch lever may also include a latch button, which may be actuated to release the corner tube from the topper mount socket, thus allowing the caregiver to remove the topper from the playard. In some implementations, the latch button and the latch head may be disposed on opposing sides of the corner tube. The latch button may also be disposed above the corner facing away from the interior space of the playard for greater ease of access and visibility. For example, the caregiver does not have to bend over as much to reach the latch button or reach their hand into a tight space.

As described above, the X-frame assemblies in the foldable playard may effectively function as rigid top rails due to their proximity to the top portion of the interior space when the playard is unfolded. However, the X-frame tubes may still be disposed below the top horizontal plane of the playard even in the unfolded configuration because the X-frame tubes may be oriented at a shallow angle with respect to the top horizontal plane. The X-frame assemblies, however, may still provide support for a topper in the same manner as a rigid top rail in a conventional indoor playard (e.g., the playard 10*e*) by including a topper support mounted to one of the X-frame tubes of at least one X-frame assembly. The topper support may have a bottom portion that abuts the X-frame tube and a topper support portion that is aligned or substantially aligned with the top horizontal plane of the playard. In this manner, the topper support may emulate a rigid top rail, thus enabling the installation of toppers onto playards with X-frame assemblies. In some implementations, the topper support may also prop up a top portion of the playard soft goods such that the top portion of the soft goods is substantially flat (e.g., the soft goods do not sag downwards due to the shape of the X-frame assemblies).

In some implementations, the playard may include multiple topper mount sockets and/or multiple topper supports arranged to support a topper at multiple locations that, when projected onto the top horizontal plane, are not colinear. This arrangement may ensure the topper is not supported by the playard in a cantilevered manner, which may reduce or, in some instances, prevent the topper from sagging downwards into the interior space.

It should also be appreciated that, in some implementations, the topper may not be directly attached to the foldable playard or another accessory mounted to the playard (e.g., a bassinet accessory). For example, the foldable playard may include a bassinet accessory that provides an elevated support surface within the interior space of the playard. A bassinet topper may then be placed on the elevated surface of the bassinet accessory without being affixed to the playard frame. Said in another way, the caregiver may lift the bassinet topper off from the elevated surface (e.g., via a carrying handle) when removing the bassinet topper from the foldable playard without actuating any lock or latch mechanism.

The toppers described herein may also be reconfigurable after being mounted to the playard (i.e., the topper is not a static fixture). For example, a topper may include both a changing table section and an organizer section. Specifically, the topper may include a topper frame with a first frame portion supporting topper soft goods and a support platform for a changing table and a second frame portion supporting multiple storage compartments to store various care items. The changing table section may partially cover the interior space and the organizer section may extend outwards from the playard away from the interior space when deployed. Additionally, the changing table section may be rotatably coupled to the organizer section via a hub assembly. The hub assembly may couple the topper to the playard frame.

In some implementations, the organizer section may be rigidly coupled to the playard frame and the changing table section may be rotatable with respect to the organizer section and, hence, the playard frame. The changing table section may be rotatable between a deployed configuration and a storage configuration. In the deployed configuration, the changing table section may be positioned over the interior space of the playard and oriented to support a child. In the storage configuration, the changing table section is positioned such that it no longer covers the interior space. In this manner, the caregiver may rotate the changing table section in or out the interior space of the playard as needed instead of installing and uninstalling the topper each time it is used. The changing table section may also be shaped and/or dimensioned to block access to the storage compartments of the organizer section in the storage configuration (e.g., the child is unable to access the various care items).

In some implementations, the changing table section may instead be rigidly coupled to the playard frame and the organizer section may be rotatable with respect to the changing table section and, hence, the playard frame. This enables the caregiver to rotate the organizer section between a first configuration to access a first set of storage compartments disposed on a top side of the organizer section and a second configuration to access a second set of storage compartments disposed on a bottom side of the organizer section. In this manner, the organizer section may provide the caregiver additional storage space without increasing or appreciably increasing the overall length of the playard. In the second configuration, the organizer section may cover the changing table section and, hence, may also partially cover the interior space.

The hub assembly may also provide a breakaway feature where the changing table section rotates downward towards the ground from the first configuration in the event a sufficiently large force and/or torque is applied to the topper (e.g., a caregiver leans on the changing table section, a child hangs from the changing table section). In some implementations, the threshold force and/or torque may be chosen to be lower than the force and/or torque that causes the foldable playard to tip over. For example, the changing table section may be configured to rotate when a 30 lbf is applied tangentially with respect to rotation axis defined by the hub assembly to a portion of the changing table section located furthest from the rotation axis (e.g., the free end of the topper frame forming the changing table section). The changing table section may be reset thereafter without any damage to its components. In this manner, the breakaway feature may prevent the playard from tipping over and/or the topper breaking.

The toppers described herein may also be used with the playard frame or as a freestanding apparatus and may further be collapsible for storage and/or to improve portability. For example, a bassinet topper may provide the caregiver a portable platform to move a child around the caregiver's home. In this manner, the caregiver does not have to move the foldable playard, which may be bulkier and heavier than the bassinet topper. The caregiver, however, may still utilize the playard as a platform to support the bassinet topper at an elevated position where it is easier to reach the child and/or to view the child. Additionally, the bassinet topper may be collapsed for storage during transit (e.g., the caregiver is moving the child between different locations). In this manner, the bassinet topper can be used in a variety of settings.

In some implementations, the bassinet topper may include a bassinet topper frame that supports bassinet topper soft goods and a support platform for the child. The bassinet topper may also include a carry handle and a canopy cover to provide shade for the child. The bassinet topper frame may include one or more legs to support the bassinet topper, one or more housings with a collapsing mechanism to fold or collapse the bassinet topper, and one or more top rails supporting the bassinet topper soft goods. Compared to conventional bassinet toppers, which often include three or more latch mechanisms to support the bassinet topper in a setup configuration, the bassinet toppers described herein may only include two latch mechanisms (one latch mechanism per leg or side), thus simplifying assembly and reducing the number of steps to setup the bassinet topper.

In some implementations, each top rail may have a main body with a connector end that is bent at a right angle (i.e., 90 degrees) or approximately a right angle with respect to the main body. The connector end may be inserted into corresponding top rail sockets in the housing. The orientation of the connector end of each top rail may improve the structural rigidity of the assembled bassinet topper, thus reducing or, in some instances, eliminating racking (e.g., slop, lash, or shakiness due to excessive head-to-toe or side-to-side movement of the bassinet topper).

In some implementations, the collapsing mechanism of the housing may include a pivot joint that allows the legs to rotate with respect to the housing. When the legs are deployed, a rotational stop mounted to the legs may impart a pre-load to the legs to increase the structural rigidity of the bassinet topper frame. The support platform may further include latches to lock the legs in the deployed orientation. In some implementations, the housing mechanism may include a top housing supporting the top rails and a bottom housing supporting the legs. The collapsing mechanism may be a folding mechanism that allows the bottom housing to fold with respect to the top housing. In some implementations, the collapsing mechanism may allow the bottom housing to be removed from the top housing to facilitate disassembly of the bassinet topper for storage.

In yet another aspect, a foldable playard according to the present disclosure may also include a canopy cover assembly, disposed on top of the playard frame and soft goods, to provide shade for the child within the playard. The canopy cover assembly may generally include multiple canopy support assemblies that provide a canopy cover frame or support structure. Each canopy support assembly may generally include a canopy bow that supports the canopy cover and a canopy clip to mount the canopy support assembly to the frame. In some implementations, different types of canopies (e.g., a half canopy, a full canopy) may be mounted onto the playard depending on the coverage desired by the caregiver.

In some implementations, the canopy clip may include snap-in features to directly couple the canopy clip to the leg tube of one leg support assembly. In this manner, the canopy clip may be more securely attached to the frame (i.e., the canopy clip does not attach to a portion of the frame covered by soft goods), thereby reducing the likelihood the canopy cover assembly is accidentally detached from the frame. Each canopy clip may be further disposed outside the interior space along an exterior portion of one leg support assembly (e.g., proximate to the corner and/or the slider when the playard is unfolded). Additionally, the canopy bow may couple to the canopy clip such that a portion of the canopy bow is also disposed outside the interior space near the corner and/or the slider of the leg support assembly. The particular placement of the canopy clip and the portion of the canopy bow that overlaps the exterior portion of the frame may further limit the child's access to the various components of the canopy cover assembly, thus reducing the likelihood the child can detach and pull the canopy cover into the playard.

In one example, a frame for a foldable playard has a compact folded configuration for storage of the frame and a deployed unfolded configuration to support the foldable playard in an upright position on a ground surface to contain a child in an interior space of the foldable playard. The frame includes a plurality of leg support assemblies extending upward from the ground surface when the frame is in the deployed unfolded configuration where each leg support assembly of the plurality of leg support assemblies includes a bottom end supported by the ground surface and a top portion opposite to the bottom end. The frame further includes a plurality of X-frame assemblies coupled to the plurality of leg support assemblies where each X-frame assembly of the plurality of X-frame assemblies is coupled to respective top portions of adjacent leg support assemblies of the plurality of leg support assemblies when the frame is in the deployed unfolded configuration such that, in the deployed unfolded configuration of the frame, the plurality of X-frame assemblies forms a top perimeter structure of the frame outlining the interior space of the foldable playard and the plurality of X-frame assemblies does not significantly impede visibility of the child when the child is in the interior space of the foldable playard. The plurality of X-frame assemblies constitutes the only interconnection in the frame between respective pairs of leg support assemblies of the plurality of leg support assemblies. Each leg support assembly may include a leg tube with an oval-shaped cross-section.

In another example, a foldable playard defining an interior space when in an unfolded configuration includes a plurality of leg support assemblies where each leg support assembly includes a leg tube disposed along a side edge of the interior space having a top end disposed at a top vertex of the interior space, a corner coupled to the top end of the leg tube, and a slider slidably coupled to the leg tube such that the slider is disposed proximate to the corner when the foldable playard is in the unfolded configuration. The foldable playard further includes a plurality of X-frame assemblies positioned at respective side faces of the interior space between adjacent leg support assemblies where each X-frame assembly of the plurality of X-frame assemblies forms a top rail between adjacent leg support assemblies. Additionally, the sliders in the plurality of leg support assemblies are identical, the corners in the plurality of leg support assemblies are identical, and respective pairs of leg support assemblies are only coupled together via at least one X-frame assembly of the plurality of X-frame assemblies. The leg tube may also have an oval-shaped cross-section.

In another example, a foldable playard defining an interior space when in an unfolded configuration includes a plurality of leg support assemblies where each leg support assembly includes a leg tube disposed along a side edge of the interior space having a top end disposed at a top vertex of the interior space, a corner coupled to the top end of the leg tube, and a slider slidably coupled to the leg tube such that the slider is disposed proximate to the corner when the foldable playard is in the unfolded configuration. The foldable playard further includes a plurality of X-frame assemblies positioned at respective side faces of the interior space between adjacent leg support assemblies of the plurality of leg support assemblies where each X-frame assembly of the plurality of X-frame assemblies forms a top rail between the adjacent leg support assemblies. The foldable playard further includes a single latch coupled to one leg support assembly of the plurality of leg support assemblies to maintain the foldable playard in the unfolded configuration when the latch is in a locked configuration. Additionally, respective pairs of adjacent leg support assemblies are only coupled together via one X-frame assembly of the plurality of X-frame assemblies. The leg tube may also have an oval-shaped cross-section.

In another example, a foldable playard defining an interior space when in an unfolded configuration includes a plurality of leg support assemblies where each leg support assembly includes a leg tube disposed along a side edge of the interior space having a top end disposed at a top vertex of the interior space, a corner disposed on the top end of the leg tube, and a slider slidably coupled to the leg tube such that the slider is disposed proximate to the corner when the foldable playard is in the unfolded configuration. The foldable playard further includes a plurality of X-frame assemblies positioned at respective side faces of the interior space where each X-frame assembly of the plurality of X-frame assemblies is coupled to adjacent leg support assemblies of the plurality of leg support assemblies. The foldable playard further includes a latch that directly couples together the corner of one leg support assembly of the plurality of leg support assemblies and a X-frame tube of one X-frame assembly of the plurality of X-frame assemblies when the latch is in a locked configuration where the latch provides the only mechanism to maintain the foldable playard in the unfolded configuration. Additionally, respective pairs of leg support assemblies are only coupled together via at least one X-frame assembly of the plurality of X-frame assemblies. The leg tube may also have an oval-shaped cross-section.

In another example, a foldable playard defining an interior space when in an unfolded configuration includes a plurality of leg support assemblies where each leg support assembly includes a leg tube disposed along a side edge of the interior space having a top end disposed at a top vertex of the interior space, a corner coupled to the top end of the leg tube, and a slider slidably coupled to the leg tube such that the slider is disposed proximate to the corner when the foldable playard is in the unfolded configuration. The foldable playard further includes a plurality of X-frame assemblies positioned at respective side faces of the interior space where each X-frame assembly of the plurality of X-frame assemblies is coupled to adjacent leg support assemblies. The foldable playard further includes a plurality of canopy support assemblies disposed, in part, above the interior space where each canopy support assembly includes a canopy bow disposed, in part, above the interior space and a canopy clip disposed outside the interior space proximate to a first leg support assembly of the plurality of leg support assemblies. The canopy clip includes one or more snap features directly coupled to the leg tube of the first leg support assembly and a canopy bow opening to receive a portion of the canopy bow to couple the canopy bow to the canopy clip. The foldable playard also includes a canopy cover supported by respective canopy bows of the plurality of canopy support assemblies to cover at least a portion of the interior space.

In another example, a foldable playard includes a leg support assembly. The leg support includes a leg tube having a top end, a corner disposed on the top end of the leg tube, and a slider slidably coupled to the leg tube. The foldable playard further includes a X-frame assembly coupled to the leg support assembly where the X-frame assembly includes a first X-frame tube rotatably coupled to the corner of the leg support assembly and a second X-frame tube rotatably coupled to the slider of the leg support assembly and the first X-frame tube. The foldable playard further includes a latch coupled to the leg support assembly and the X-frame assembly to maintain the foldable playard in an unfolded configuration when in a locked configuration where the latch includes a latch boss coupled to the second X-frame tube and disposed proximate to the slider of the leg support assembly having an undercut portion and a latch member coupled to the corner of the leg support assembly having a latch opening and a tab disposed within the latch opening. The undercut portion of the latch boss retains the tab of the latch member when the latch is engaged thereby maintaining the foldable playard in the unfolded configuration.

In yet another example, a foldable playard defining an interior space with a cross-sectional shape, in a plane parallel to a ground, forming a regular hexagon when in an unfolded configuration, includes six leg support assemblies. Each leg support assembly includes a leg tube arranged such that a longitudinal axis associated with the leg tube intersects a respective corner of the regular hexagon and further has a top end and a bottom end, a foot coupled to the bottom end of the leg tube to contact a ground to support the foldable playard, a corner coupled to the top end of the leg tube, and a slider slidably coupled to the leg tube and positioned between the foot and the corner where the slider is disposed proximate to the corner when the foldable playard is in the unfolded configuration and disposed proximate to the foot when the foldable playard is in a folded configuration. The foldable playard further includes six X-frame assemblies arranged such that each X-frame assembly is positioned along a side of the regular hexagon. Each X-frame assembly of the six X-frame assemblies forms a top rail between adjacent leg support assemblies. The six X-frame assemblies includes a first X-frame assembly disposed between and coupled to a first leg support assembly and a second leg support assembly of the six leg support assemblies where the first X-frame assembly includes a first X-frame tube having a first end rotatably coupled to the corner of the first leg support assembly and a second end rotatably coupled to the slider of the second leg support assembly and a second X-frame tube having a first end rotatably coupled to the corner of the second leg support assembly and a second end rotatably coupled to the slider of the first leg support assembly. The second X-frame tube is rotatably coupled to the first X-frame tube. The foldable playard further includes a latch coupled to only the first leg support assembly and only the first X-frame assembly to maintain the foldable playard in the unfolded configuration when in a locked configuration where the latch includes a latch boss coupled to one of the second X-frame tube and disposed proximate to the slider of the first leg support assembly having an undercut portion and a latch member having a first end coupled to the corner of the first leg support assembly, a latch opening disposed proximate to a pulling tab, and a tab disposed within the latch opening. The latch is changed to the locked configuration by moving the slider of the first leg support assembly towards the corner of the first leg support assembly until the latch member snaps onto the latch boss such that the tab of the latch member contacts the undercut portion of the latch boss and the central rib is disposed within the central slot. The latch is changed to an unlocked configuration by squeezing the first and second X-frame tubes together to release the tab of the latch member from the undercut portion of the latch boss and, while squeezing the first and second X-frame tubes together, pulling the latch member away from the latch boss. Additionally, respective pairs of leg support assemblies are only coupled together via at least one X-frame assembly of the plurality of X-frame assemblies, the sliders in the six leg support assemblies are identical, and the corners in the six leg support assemblies are identical.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

The skilled artisan will understand that the drawings primarily are for illustrative purposes and are not intended to limit the scope of the inventive subject matter described herein. The drawings are not necessarily to scale; in some instances, various aspects of the inventive subject matter disclosed herein may be shown exaggerated or enlarged in the drawings to facilitate an understanding of different features. In the drawings, like reference characters generally refer to like features (e.g., functionally similar and/or structurally similar elements).

FIG. 34A shows a side perspective view of the playard of FIG. 33A in a folded configuration.

FIG. 34B shows a magnified view of a bottom portion of the playard of FIG. 34A.

FIG. 34C shows a top perspective view of the playard of FIG. 34A.

FIG. 34D shows a top view of the playard of FIG. 34A.

FIG. 35A shows a side perspective view of the playard of FIG. 33A where the playard is partially unfolded. The playard may also be viewed as being partially folded.

FIG. 35B shows a magnified view of the playard of FIG. 35A where a test probe is placed onto a slider.

FIG. 36A shows a perspective view of another exemplary playard forming a hexagonal-shaped interior space with elongated sliders and corners where the respective arms of the sliders and corners are symmetrically offset. The playard is shown in a folded configuration.

FIG. 36B shows a magnified perspective view of a top portion of the playard of FIG. 36A.

FIG. 36C shows a magnified perspective view of a bottom portion of the playard of FIG. 36A.

FIG. 37A shows an exemplary storage latch with a push button disposed on a leg tube of a leg support assembly in the playard of FIG. 40A.

FIG. 37B shows a cross-sectional view of the storage latch of FIG. 37A where the push button is engaged to a slider of the leg support assembly. The cross-section plane bisects the storage latch.

FIG. 37C shows a cross-sectional view of the storage latch of FIG. 37A where the storage latch is separated from the playard frame. The cross-section plane bisects the storage latch.

Figure 33A:
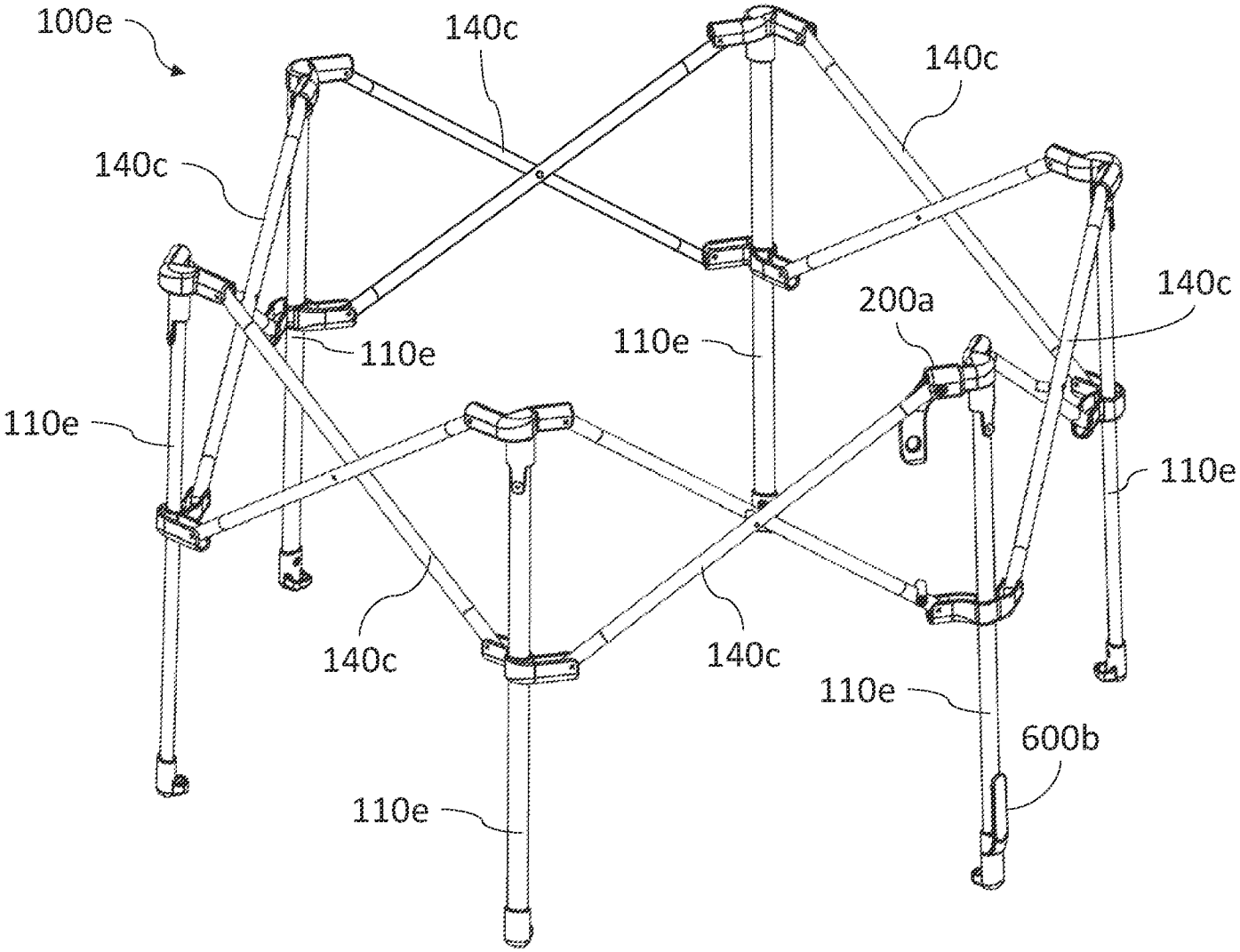
FIG. 33A shows a top perspective view of another exemplary playard forming a hexagonal-shaped interior space with elongated sliders and corners where the respective arms of the sliders and corners are asymmetrically offset. The playard is shown in a partially unfolded configuration (i.e., neither fully unfolded for use nor fully folded for storage). The playard may also be viewed as being partially folded.
Figure 38A:
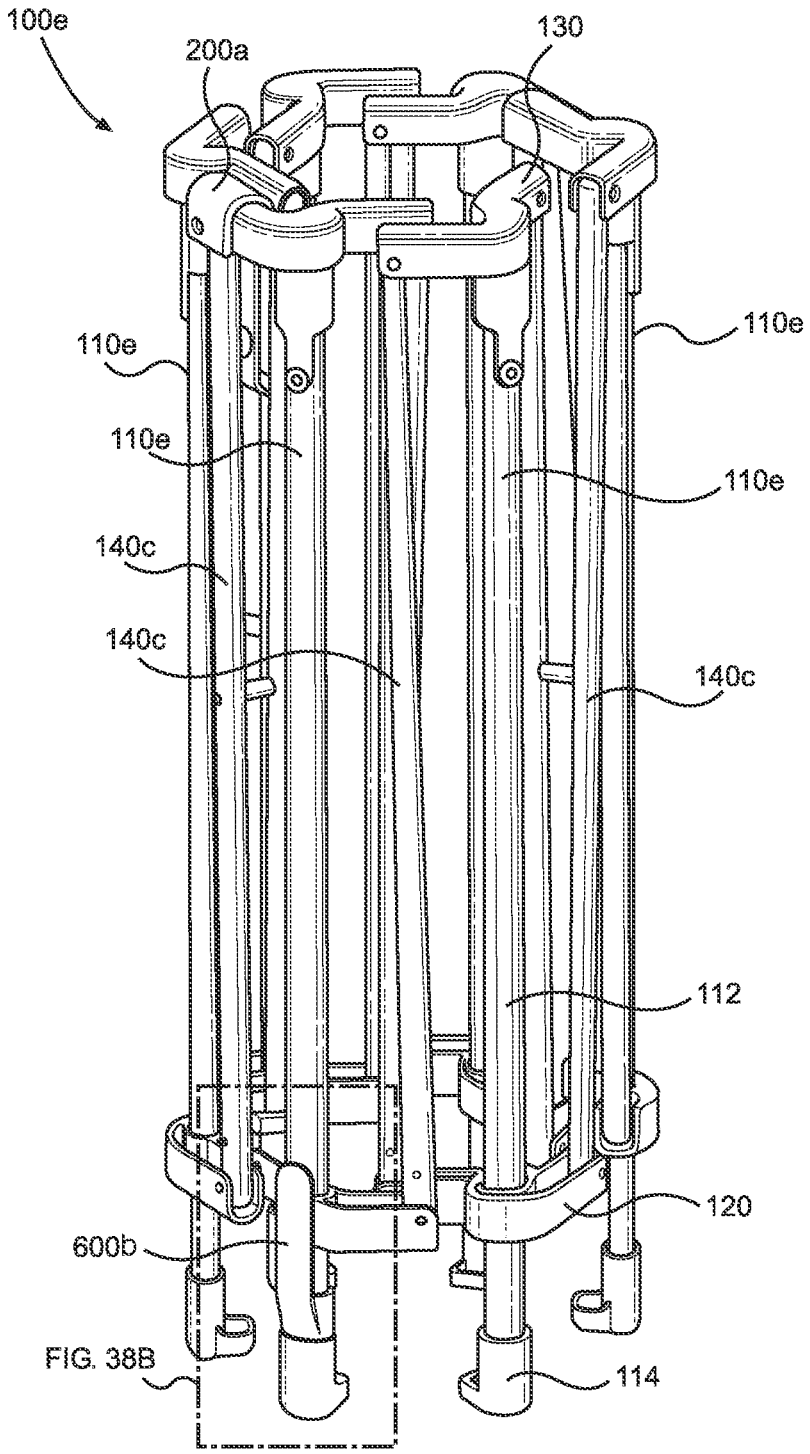

FIG. 38A shows a perspective view of another exemplary storage latch with a compliant latch member separate from a foot of a leg support assembly in the playard of FIG. 33A.

Figure 38B:
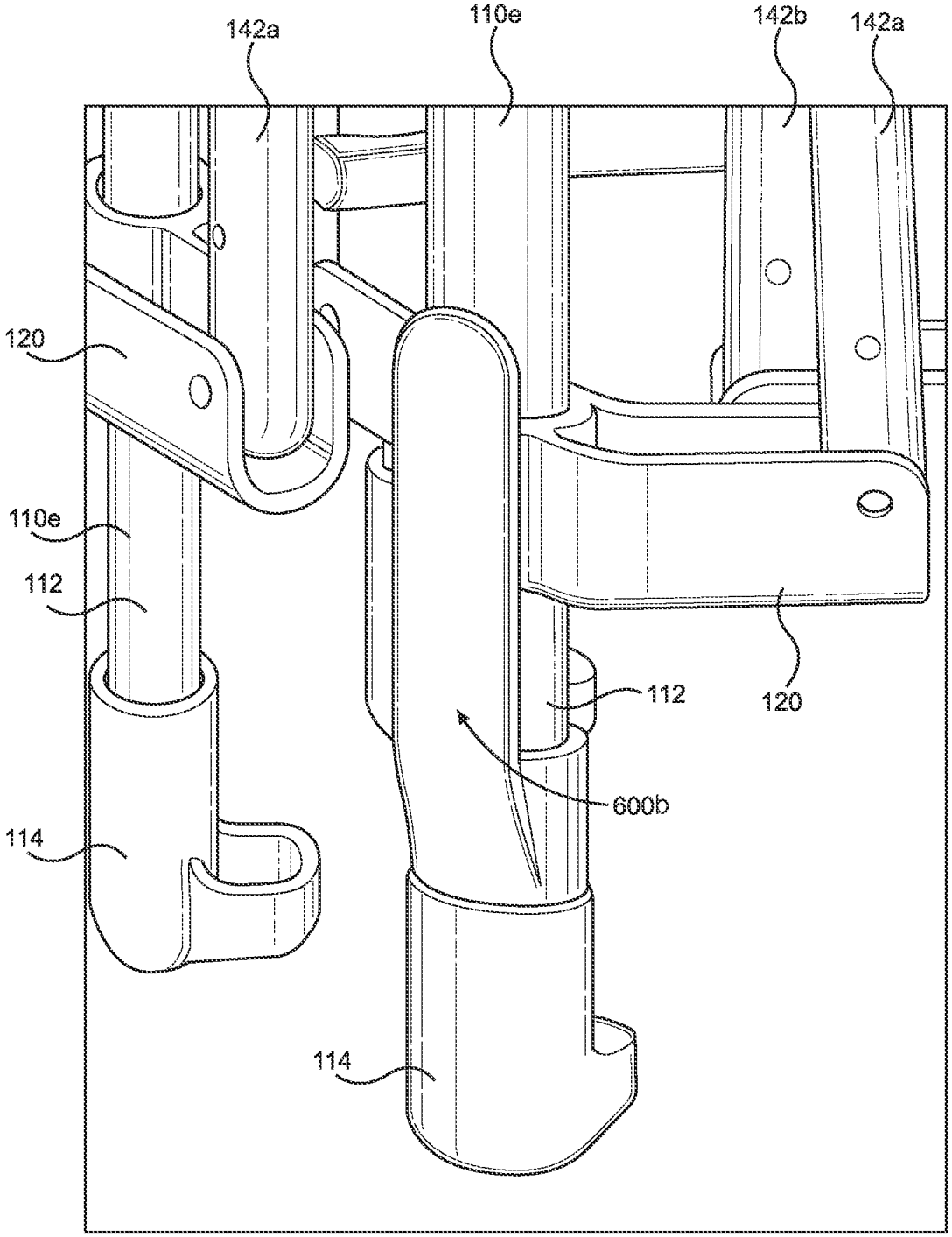

FIG. 38B shows a magnified view of the storage latch of FIG. 38A.

Figure 38C:
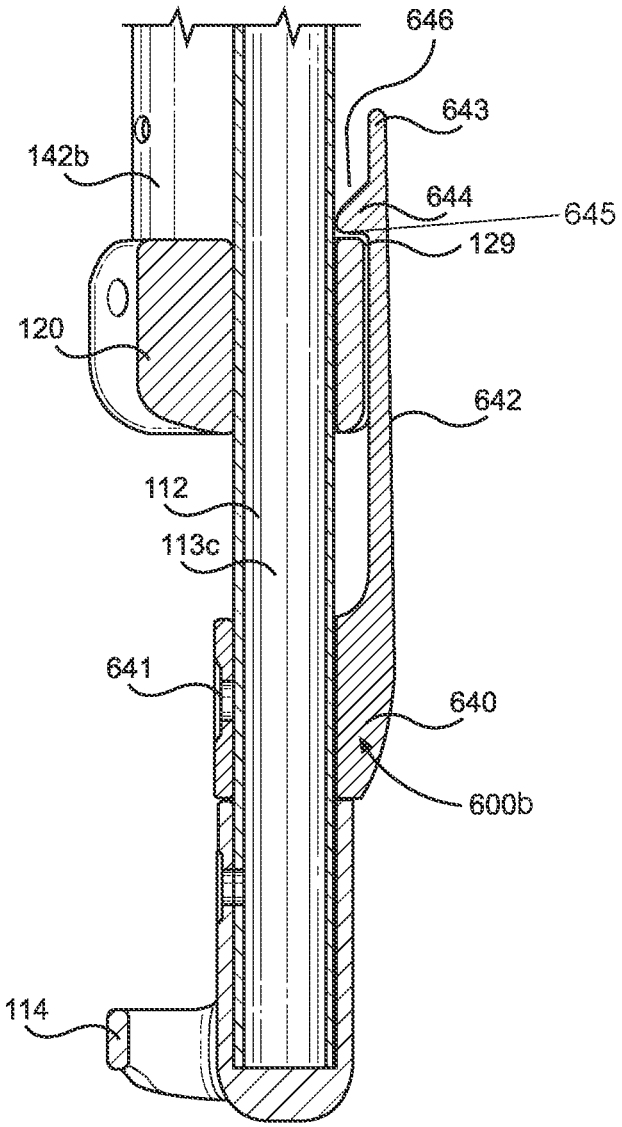

FIG. 38C shows a cross-sectional view of the storage latch of FIG. 38A where the latch member is engaged to a slider of the leg support assembly. The cross-section plane bisects the storage latch.

Figure 39A:
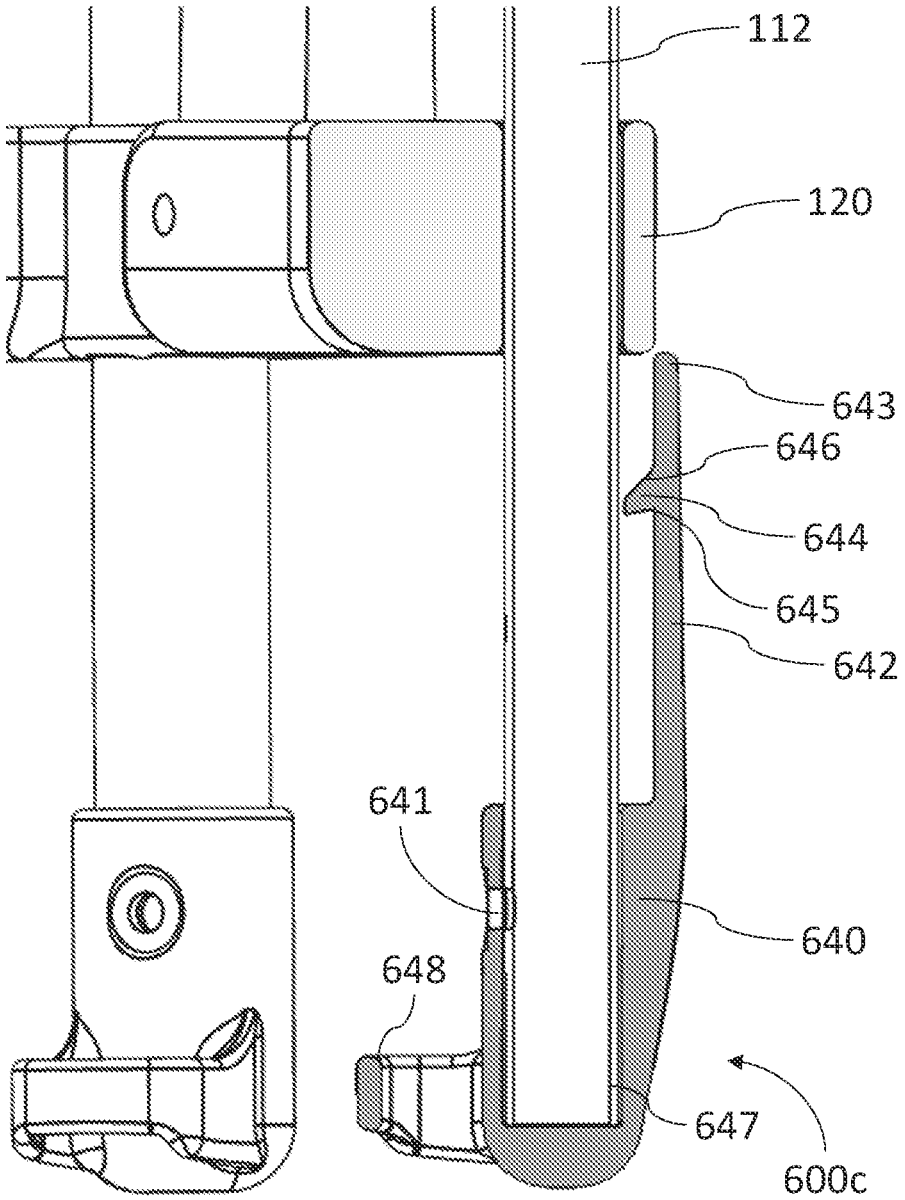

FIG. 39A shows a cross-sectional view of another exemplary storage latch with a compliant latch member integrally formed together with a foot of a leg support assembly in the playard of FIG. 33A. The cross-section plane bisects the storage latch.

Figure 39B:
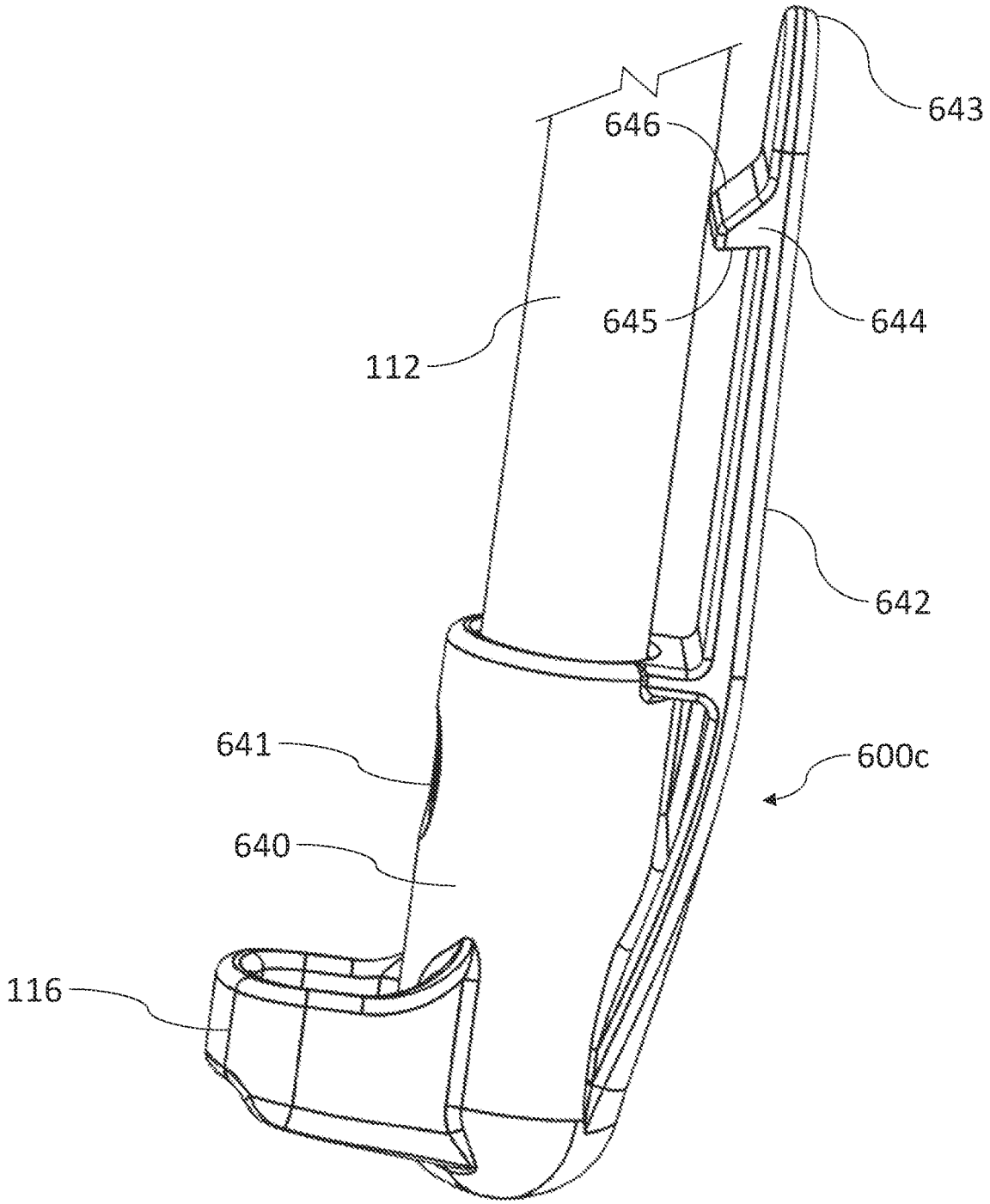

FIG. 39B shows a perspective view of the storage latch of FIG. 39A.

Figure 40A:
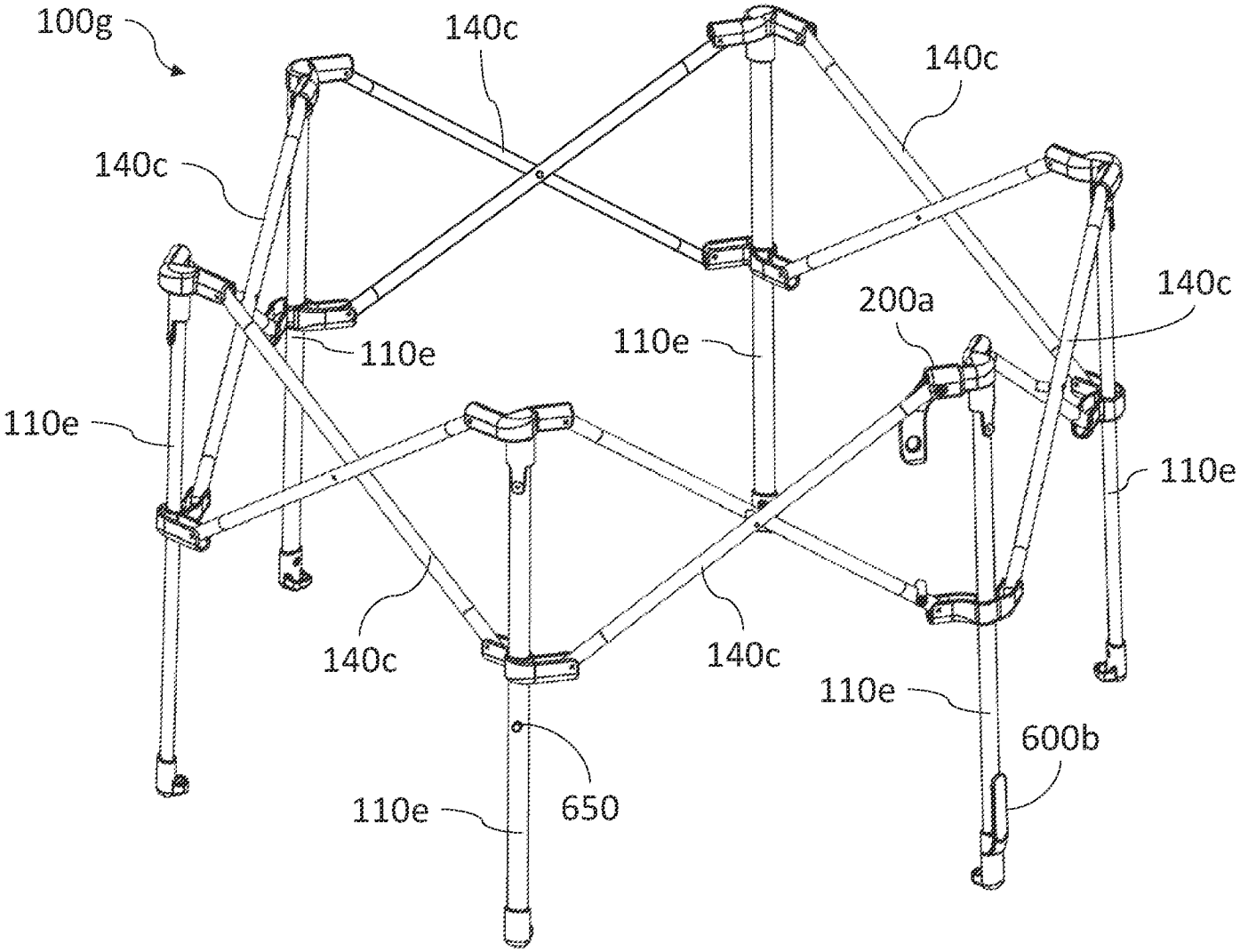

FIG. 40A shows a top perspective view of another exemplary playard with a secondary latch. The playard is shown in a partially unfolded configuration. The playard may also be viewed as being partially folded.

Figure 40B:
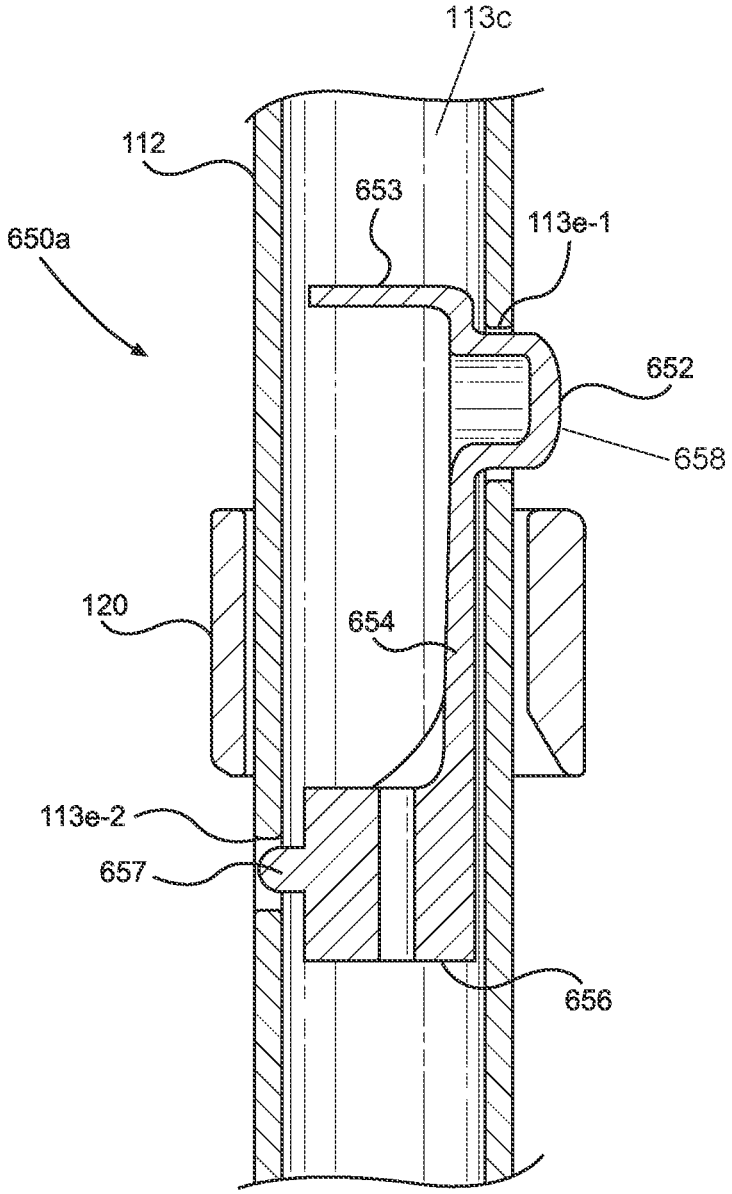

FIG. 40B shows a cross-sectional view of an exemplary secondary latch with a push button mechanism. The cross-section plane bisects the storage latch.

Figure 40C:
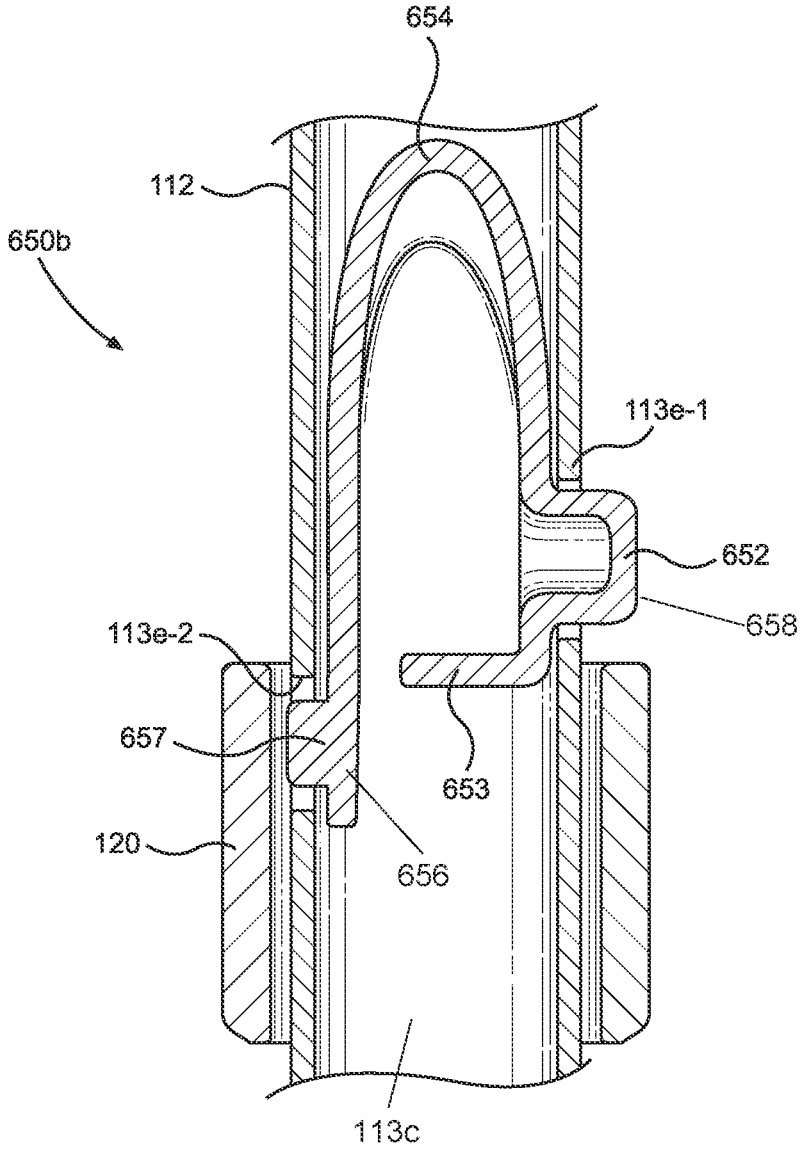

FIG. 40C shows a cross-sectional view of another exemplary secondary latch with a push button mechanism. The cross-section plane bisects the storage latch.

Figure 40D:
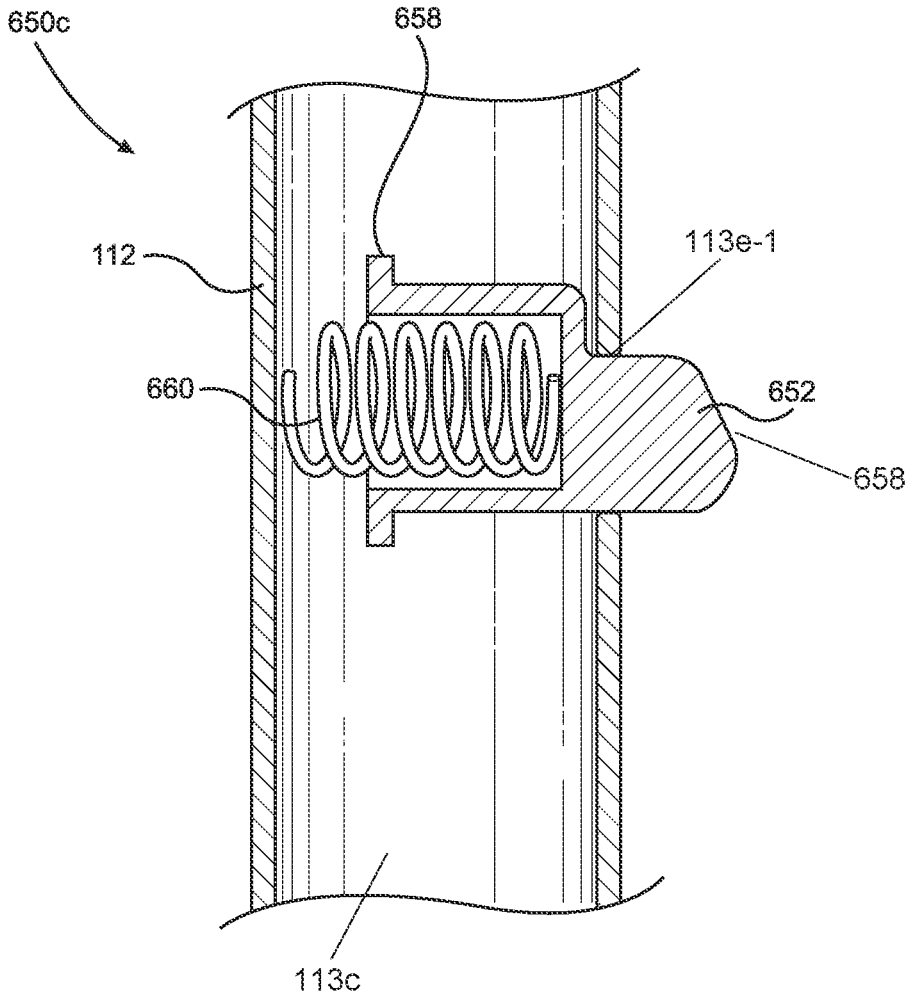

FIG. 40D shows a cross-sectional view of an exemplary secondary latch with a push button mechanism and a compression spring. The cross-section plane bisects the storage latch.

Figure 2A:
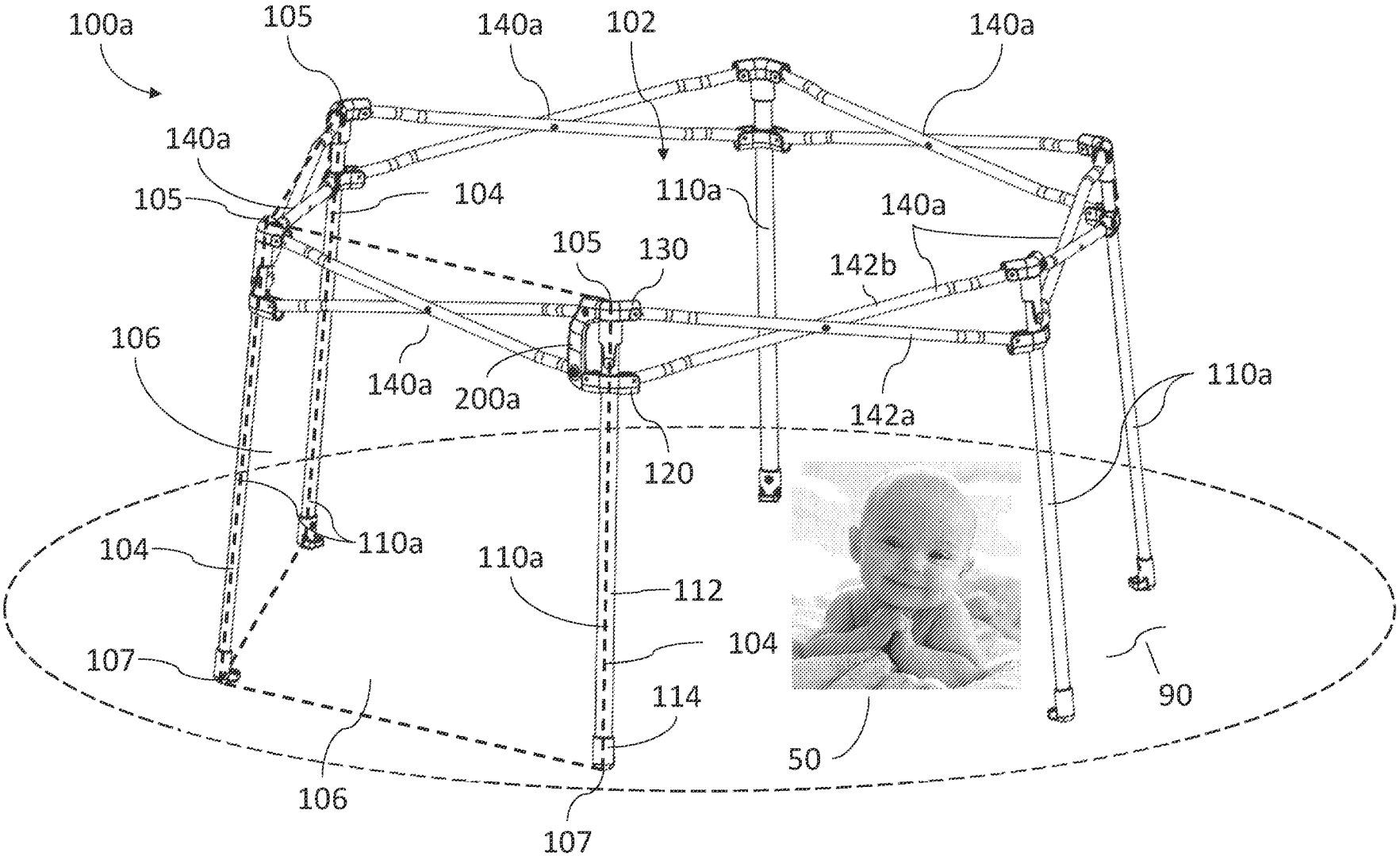
FIG. 2A shows a top perspective view of an exemplary playard forming a hexagonal-shaped interior space. The playard is in an unfolded configuration.
Figure 41A:
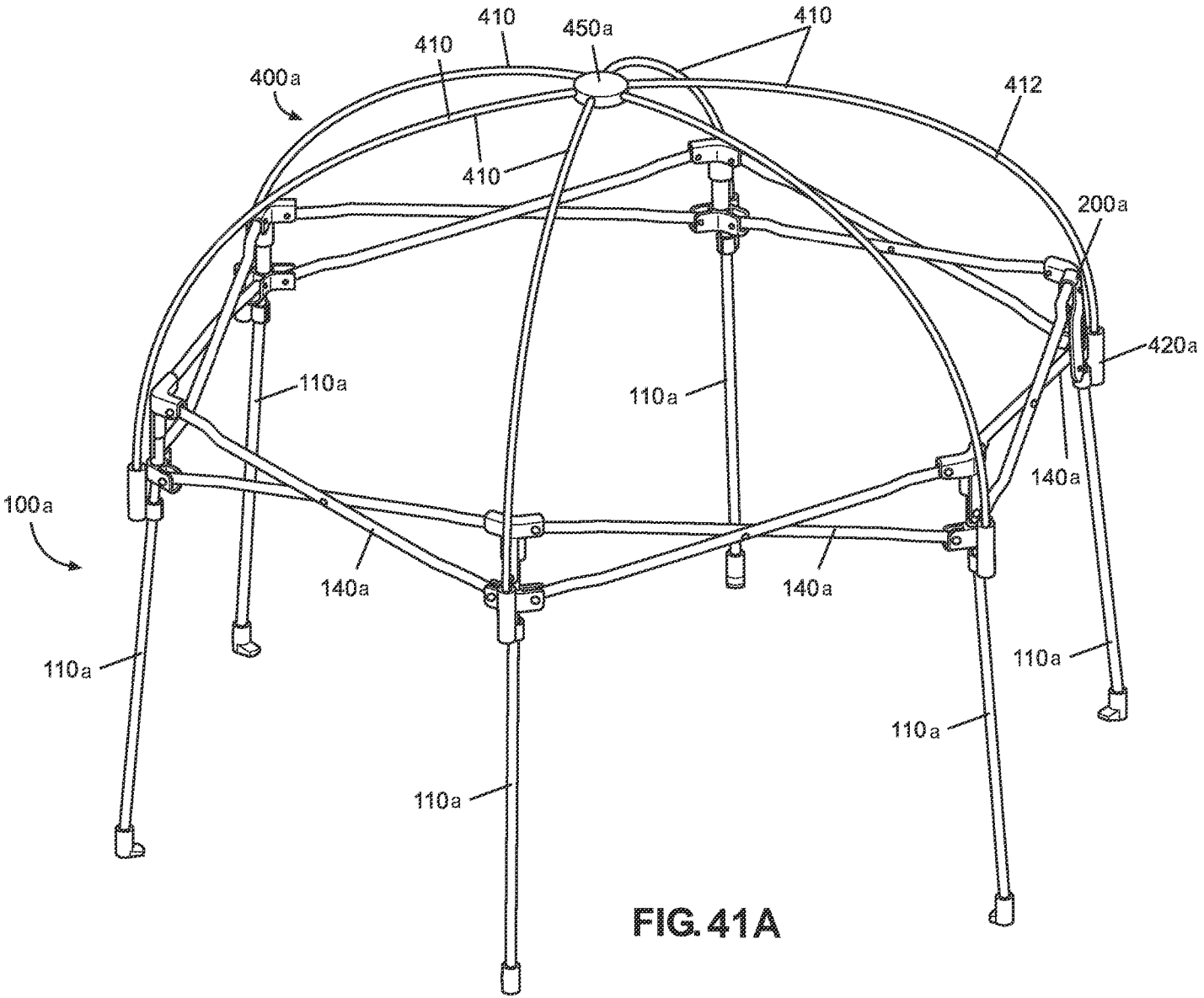

FIG. 41A shows a top perspective view of the playard of FIG. 2A with an exemplary canopy cover assembly that covers the entire interior space of the playard. The canopy cover is not shown.

Figure 41B:
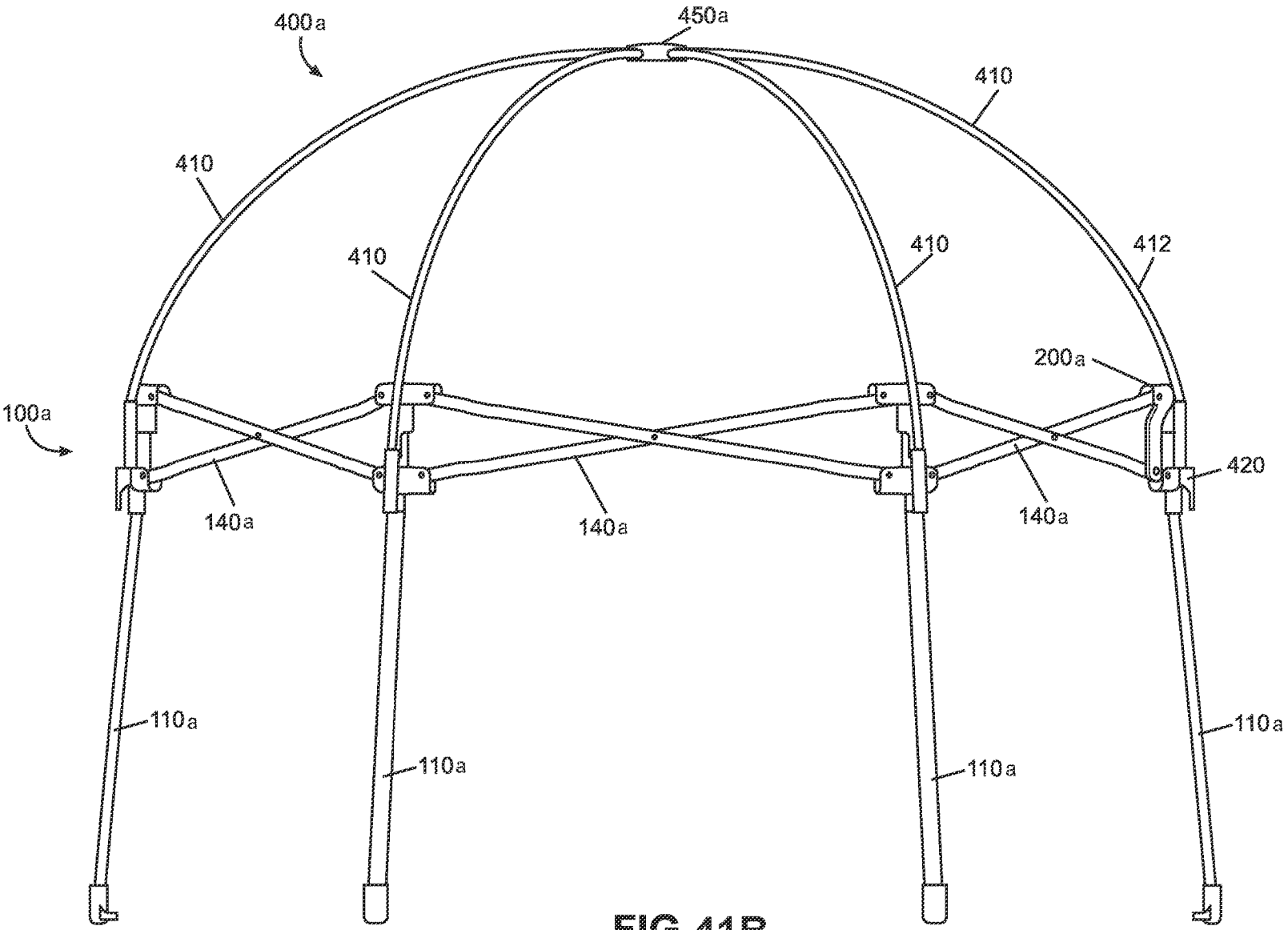

FIG. 41B shows a front view of the playard and the canopy cover assembly of FIG. 41A.

Figure 41C:
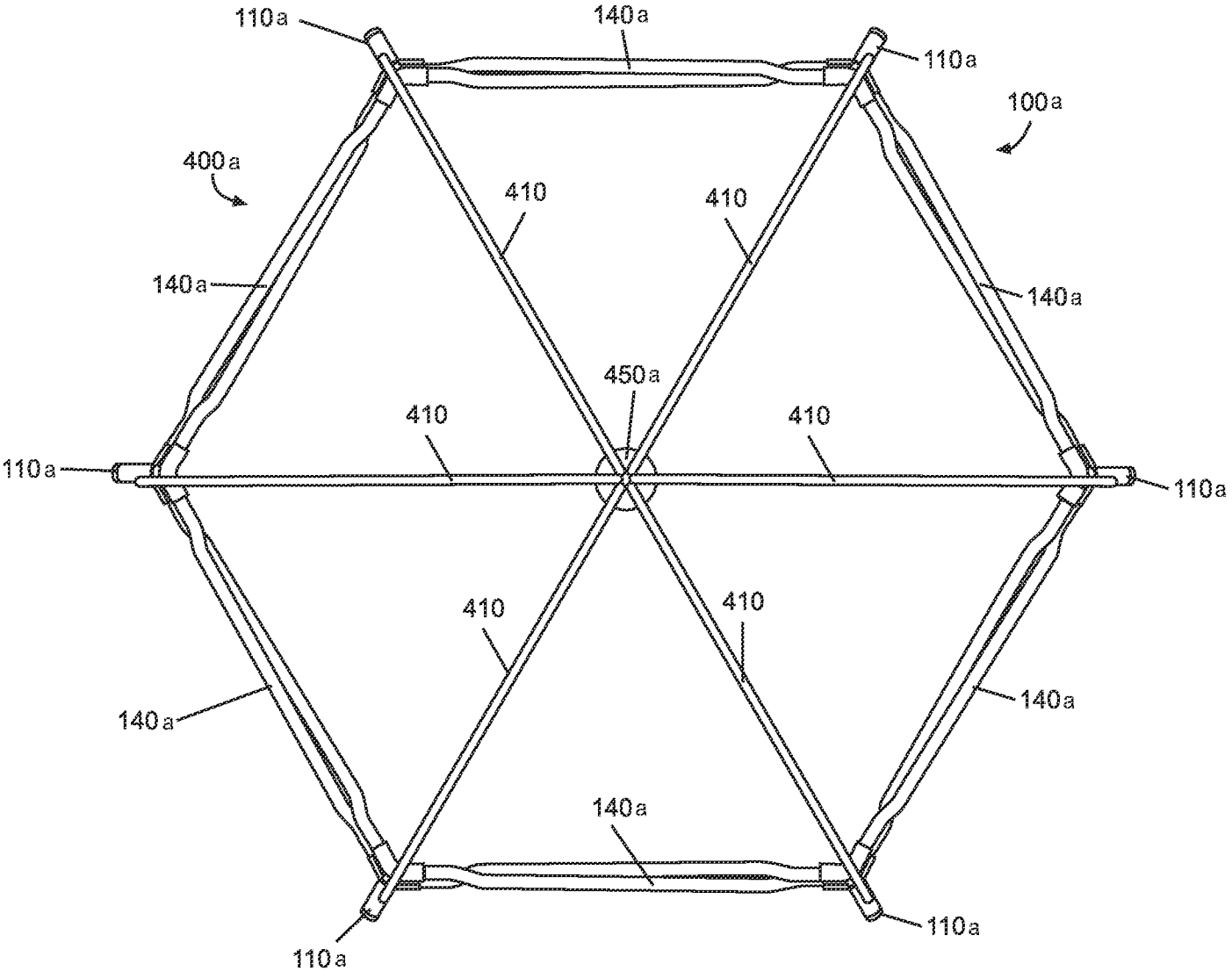

FIG. 41C shows a top view of the playard and the canopy cover assembly of FIG. 41A.

Figure 41D:
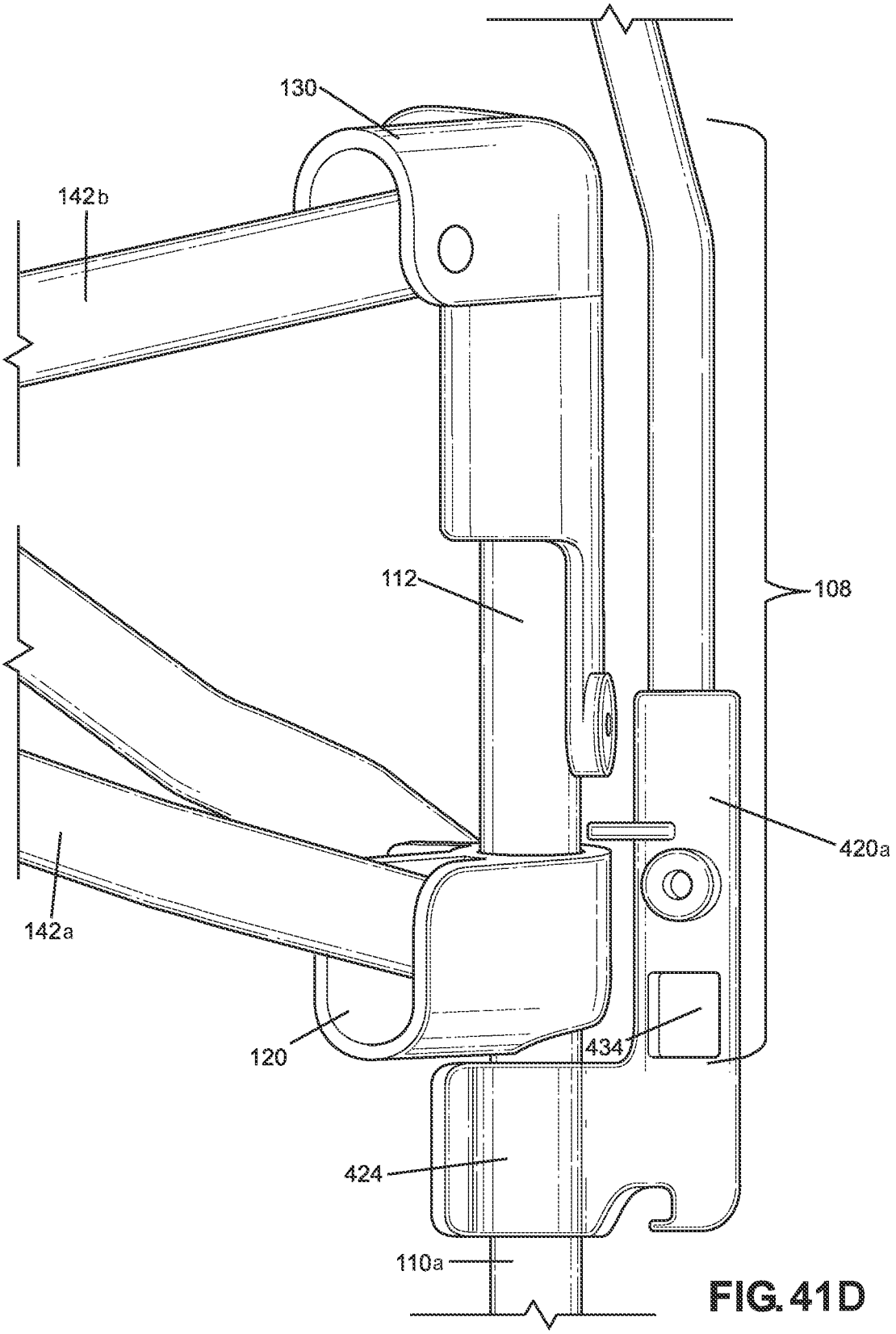

FIG. 41D shows a magnified view of a canopy clip of a canopy support assembly in the canopy cover assembly of FIG. 41A coupled to the leg support assembly of the playard.

Figure 41E:
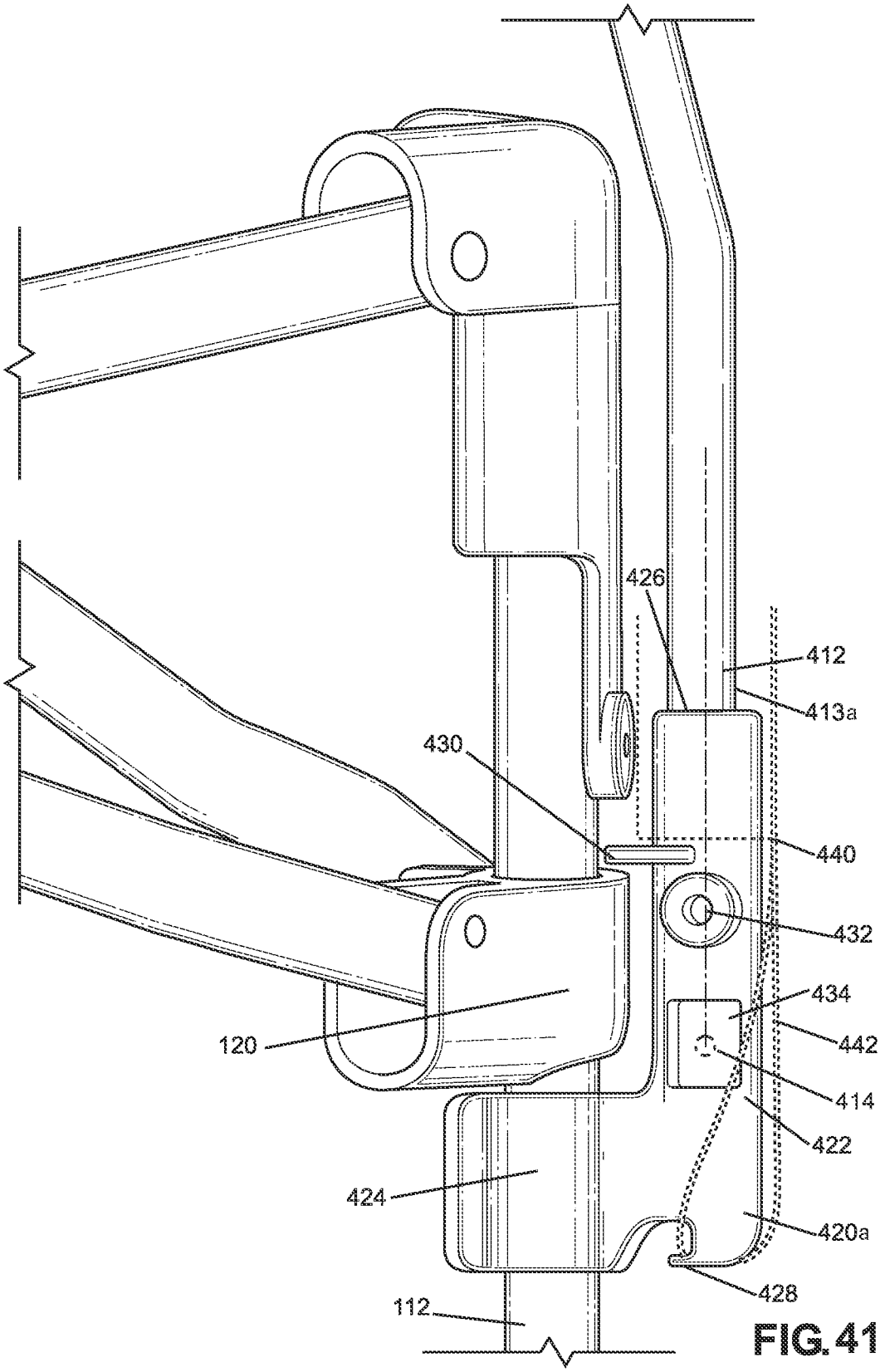

FIG. 41E shows a magnified view of the canopy clip of FIG. 41D.

Figure 41F:
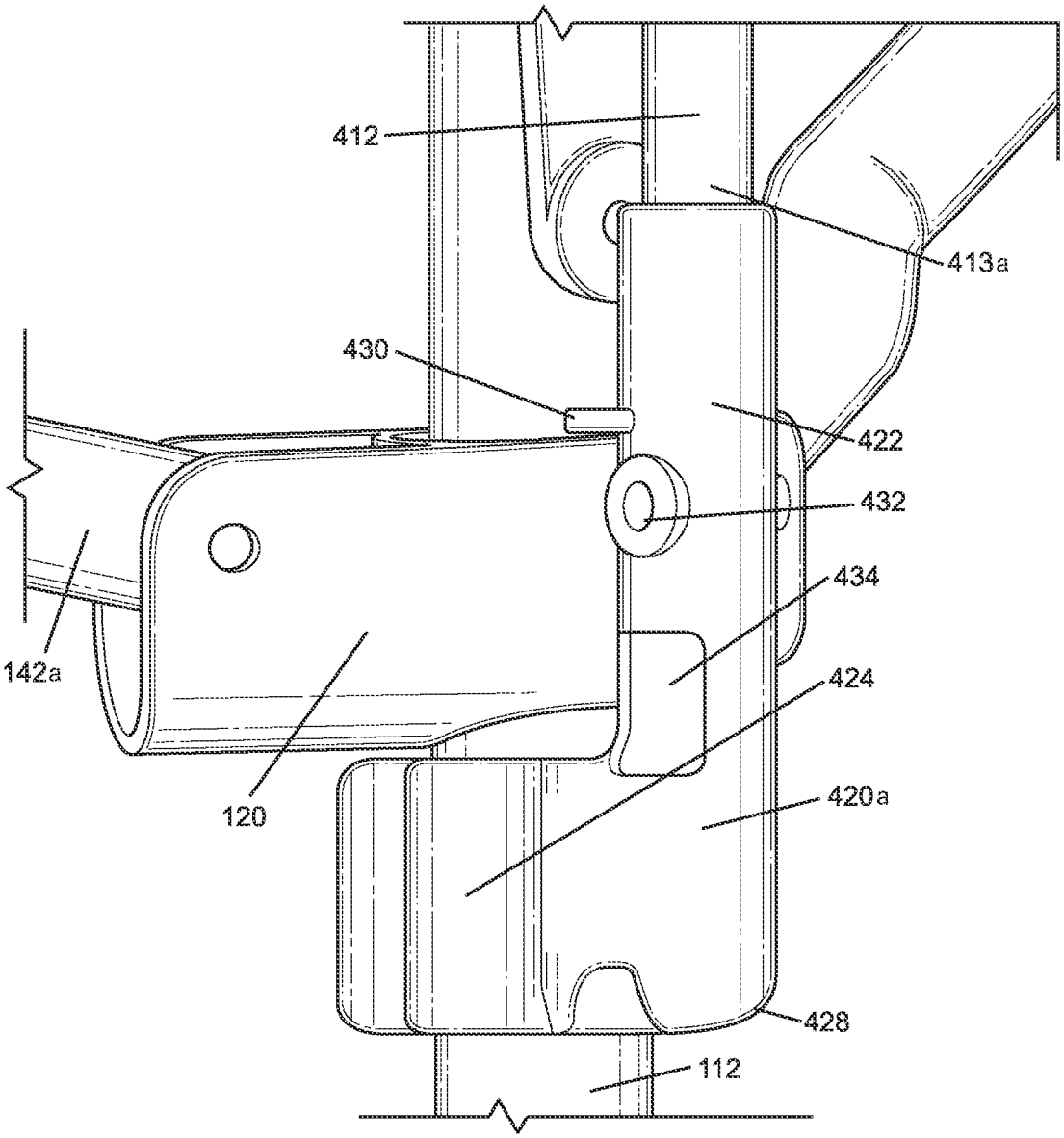

FIG. 41F shows a perspective view of the canopy clip of FIG. 41D.

Figure 42B:
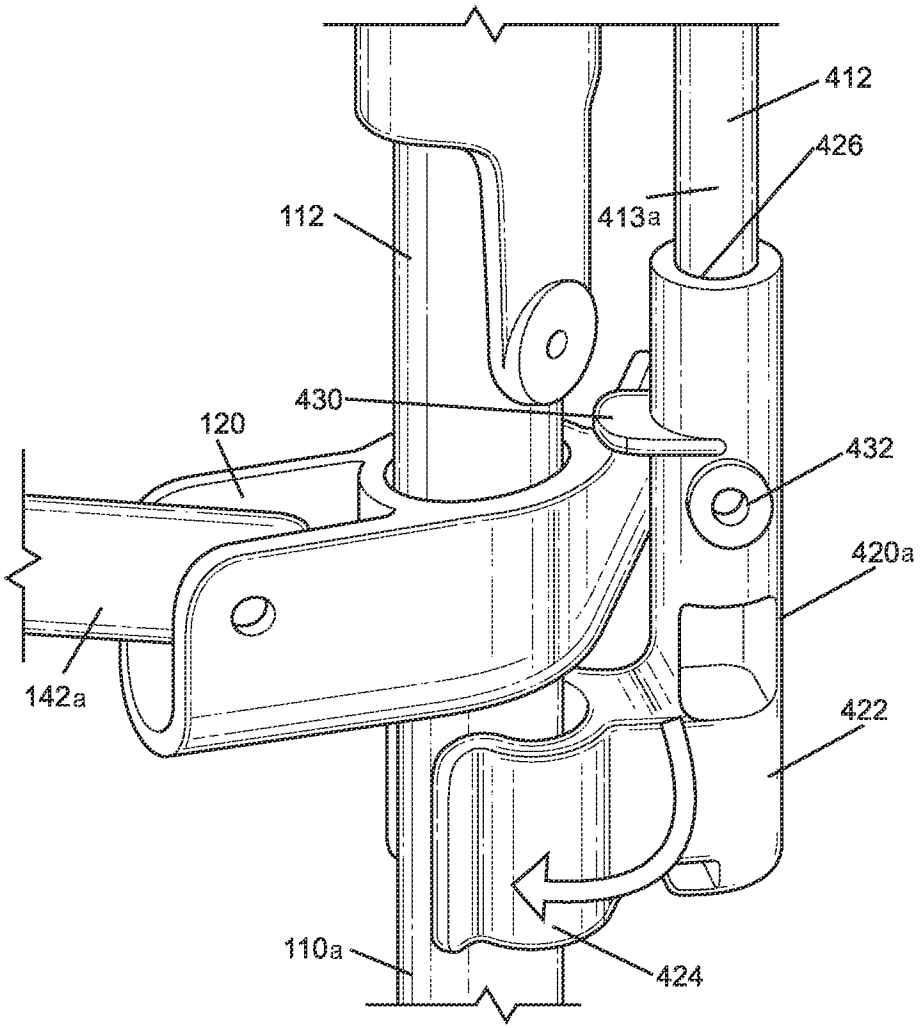
Figure 42A:
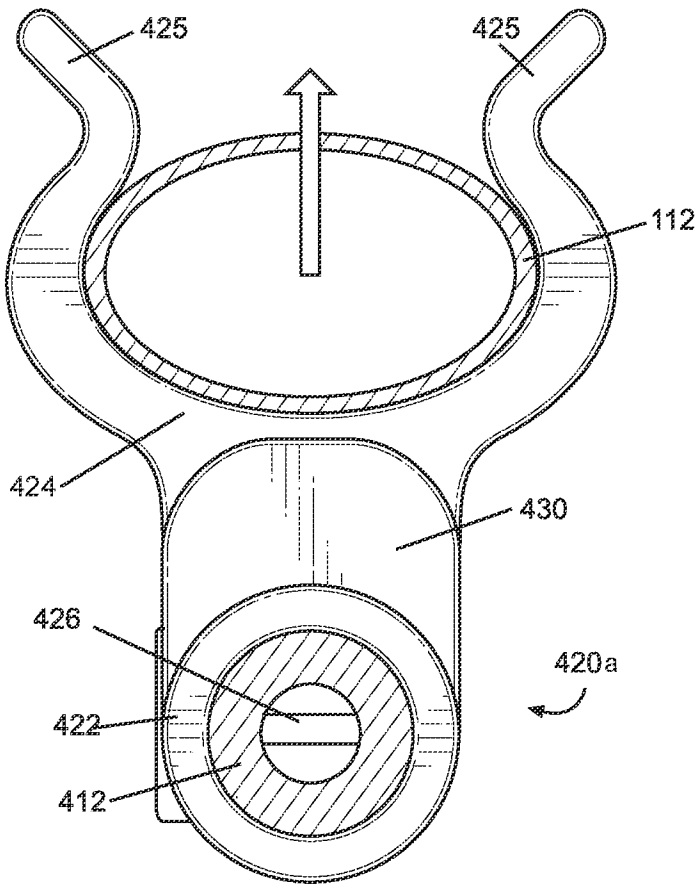

FIG. 42A shows a top view of the canopy clip of FIG. 41D being pressed onto the leg tube.

FIG. 42B shows a perspective view of the canopy clip of FIG. 41D where one lead-in feature is hooked onto the leg tube first and the canopy clip is rotated such that the other lead-in feature contacts the leg tube.

Figure 43A:
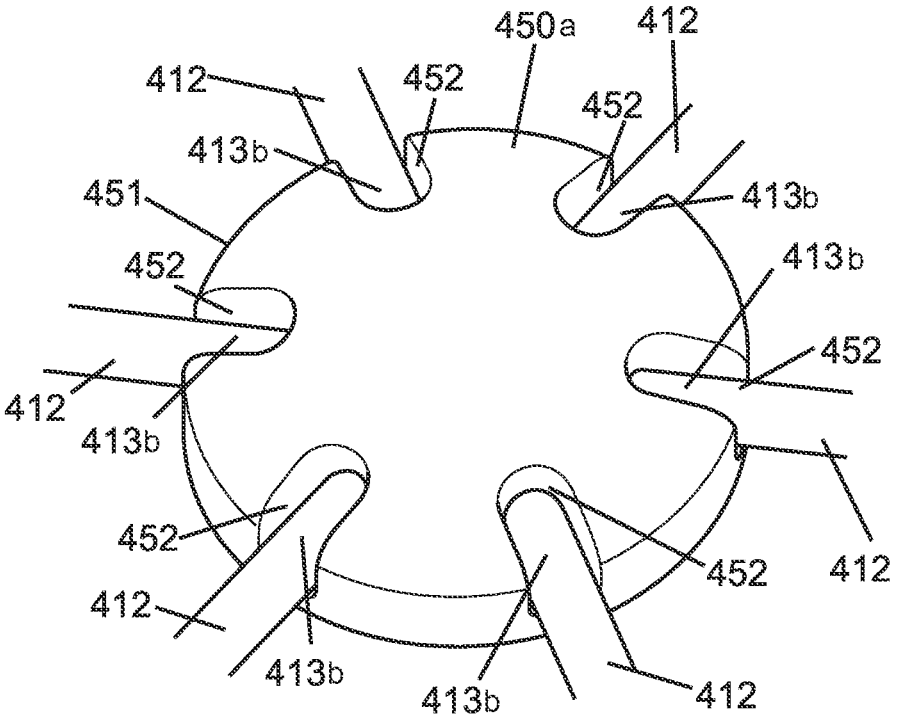

FIG. 43A shows a top perspective view of a hub in the canopy cover assembly of FIG. 41A.

Figure 43B:
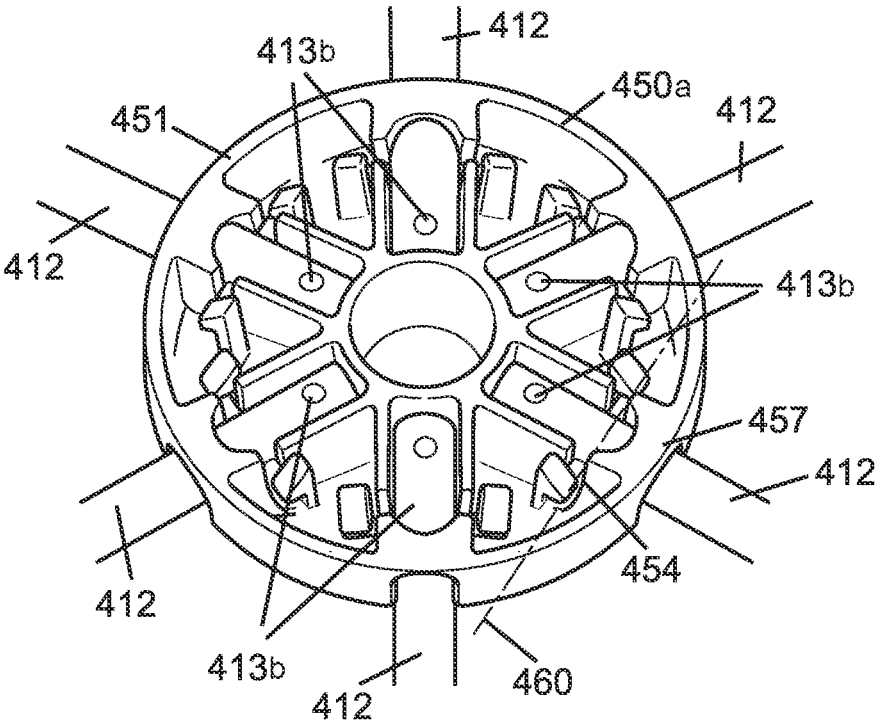

FIG. 43B shows a bottom perspective view of the hub of FIG. 43A.

Figure 44A:
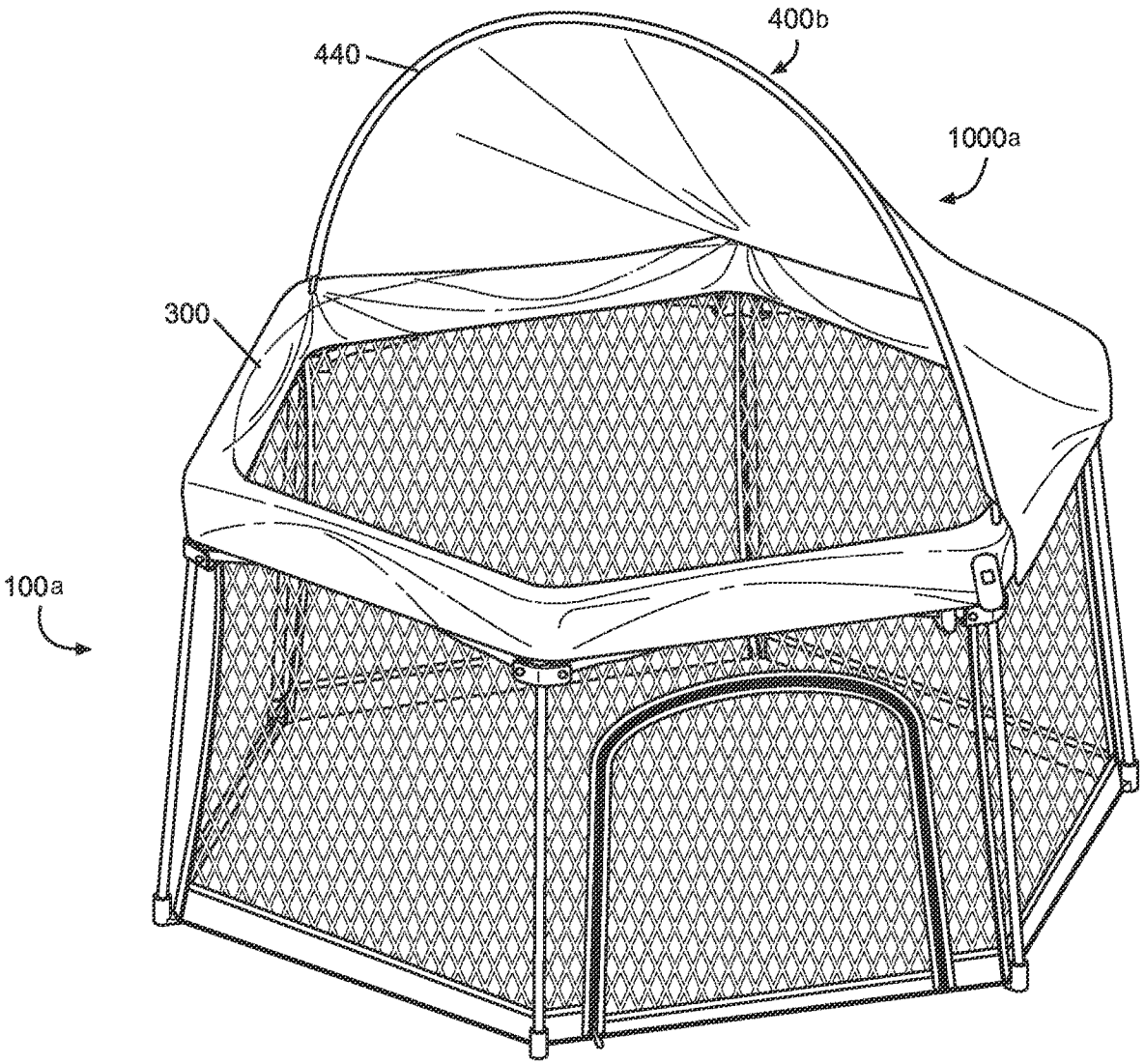

FIG. 44A shows a top, front perspective view of the playard of FIG. 2A with an exemplary canopy cover assembly that covers half the interior space of the playard and does not include a hub.

Figure 44B:
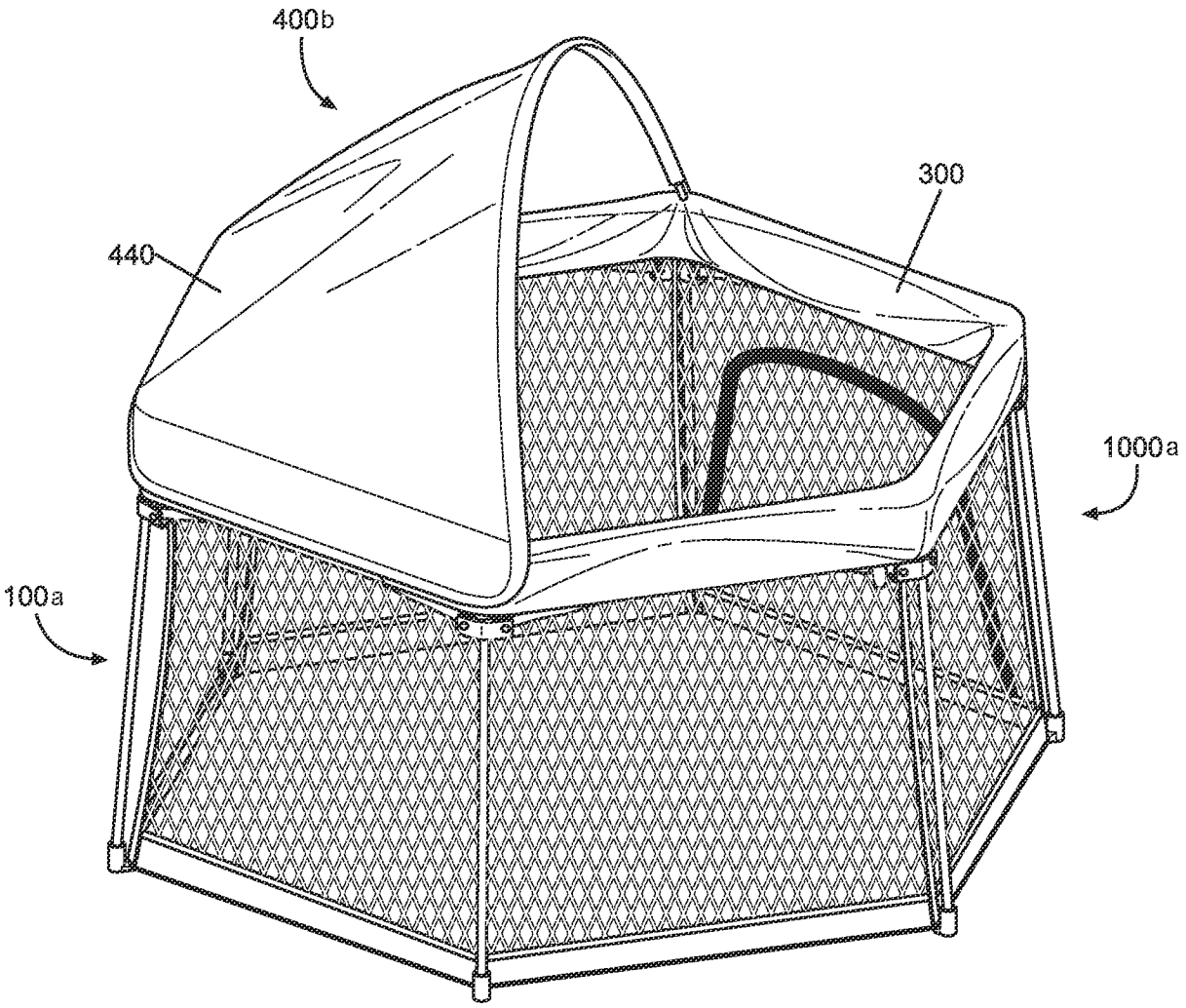

FIG. 44B shows a top, side perspective view of the playard and the canopy cover assembly of FIG. 44A.

Figure 45A:
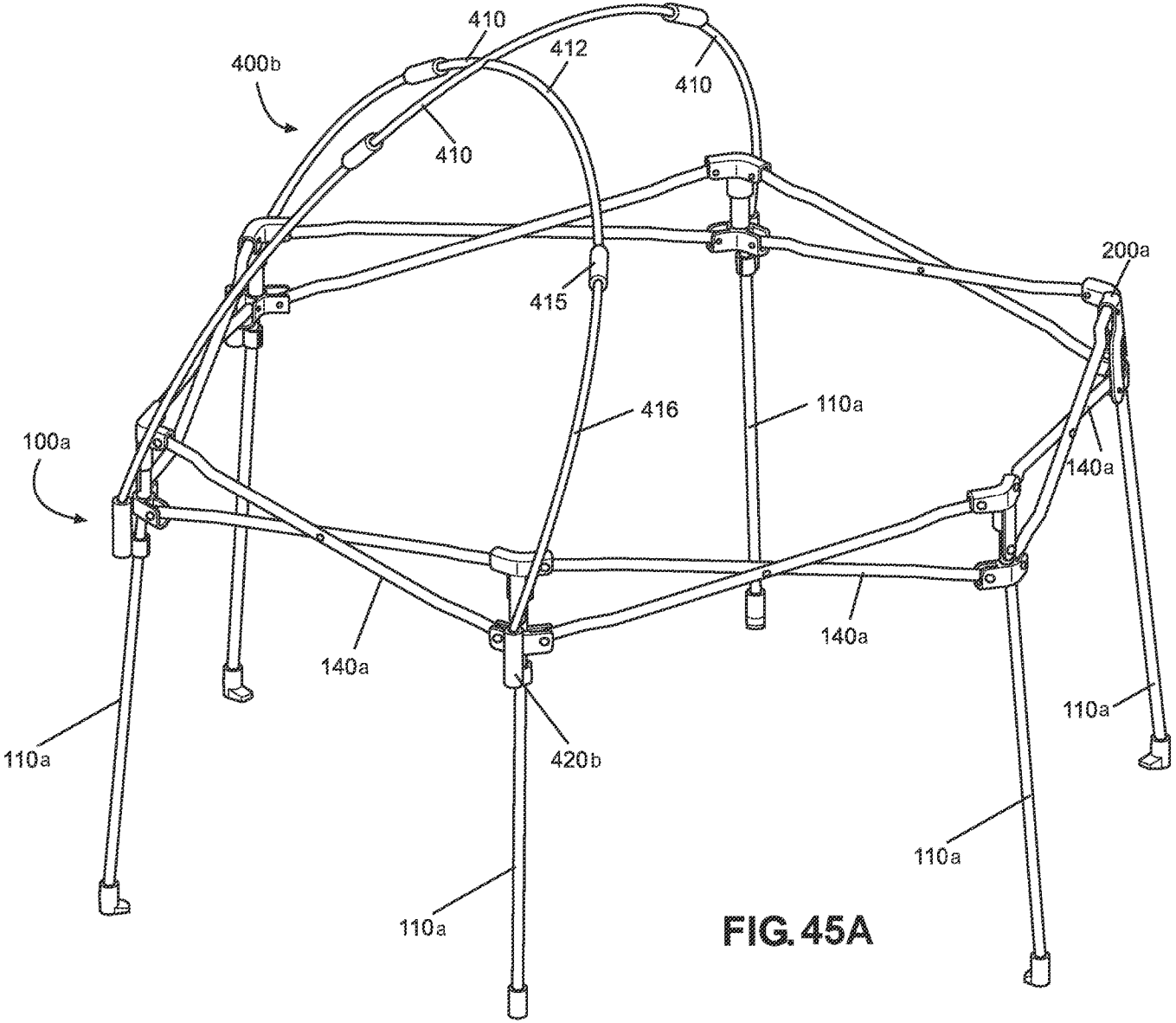

FIG. 45A shows a top perspective view of the playard and the canopy cover assembly of FIG. 44A with the canopy cover removed.

Figure 45B:
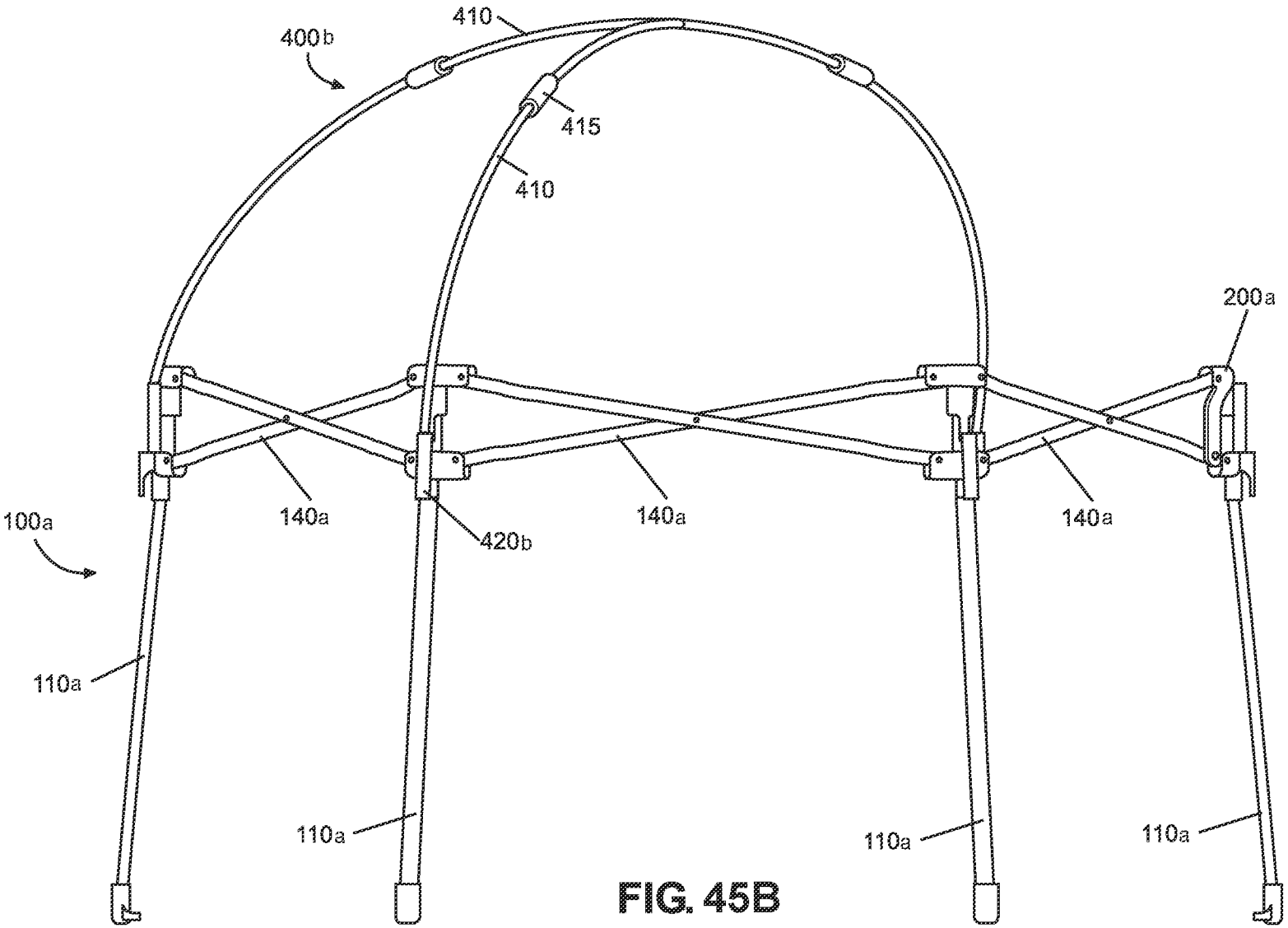

FIG. 45B shows a front view of the playard and the canopy cover assembly of FIG. 45A.

Figure 45C:
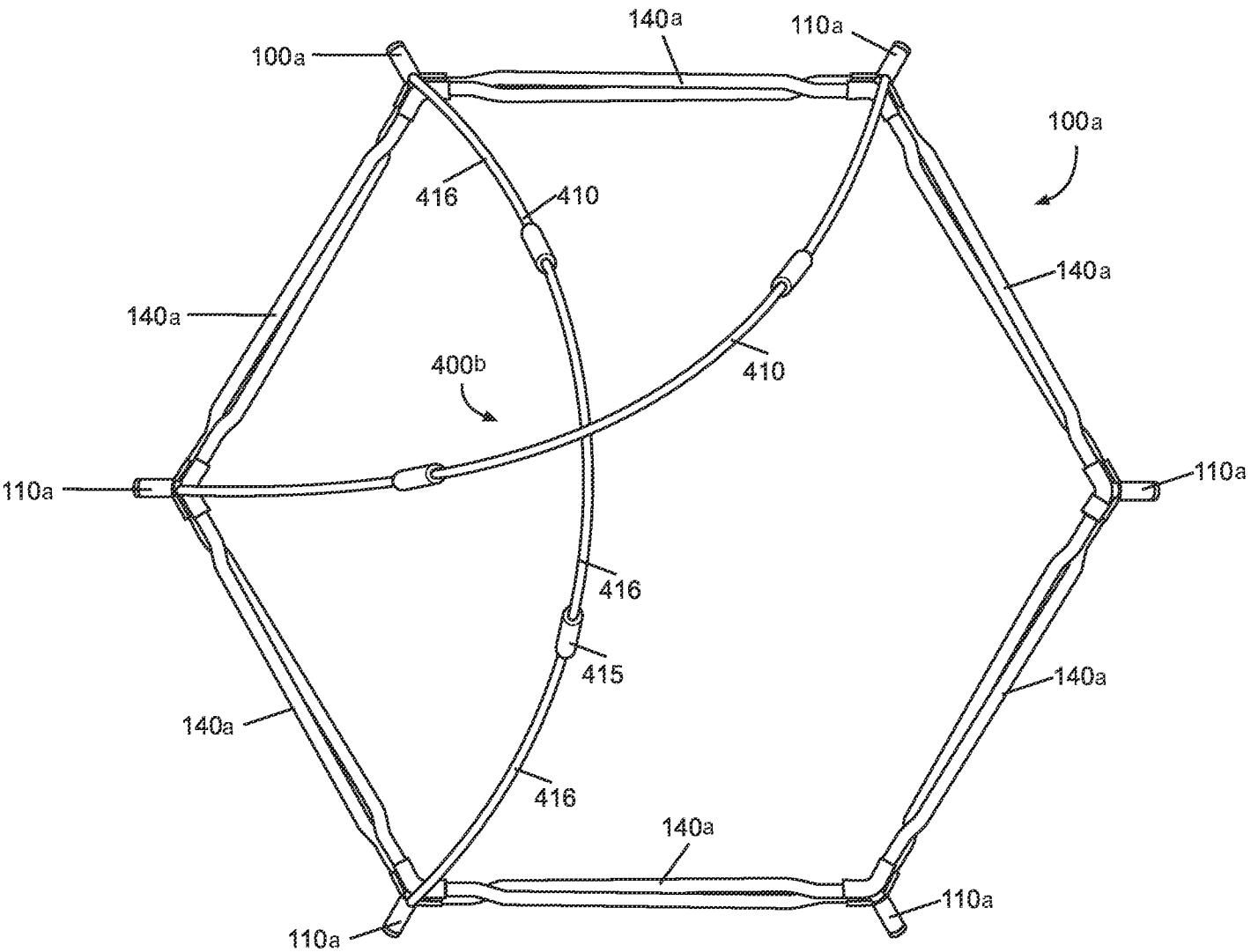

FIG. 45C shows a top view of the playard and the canopy cover assembly of FIG. 45A.

Figure 45D:
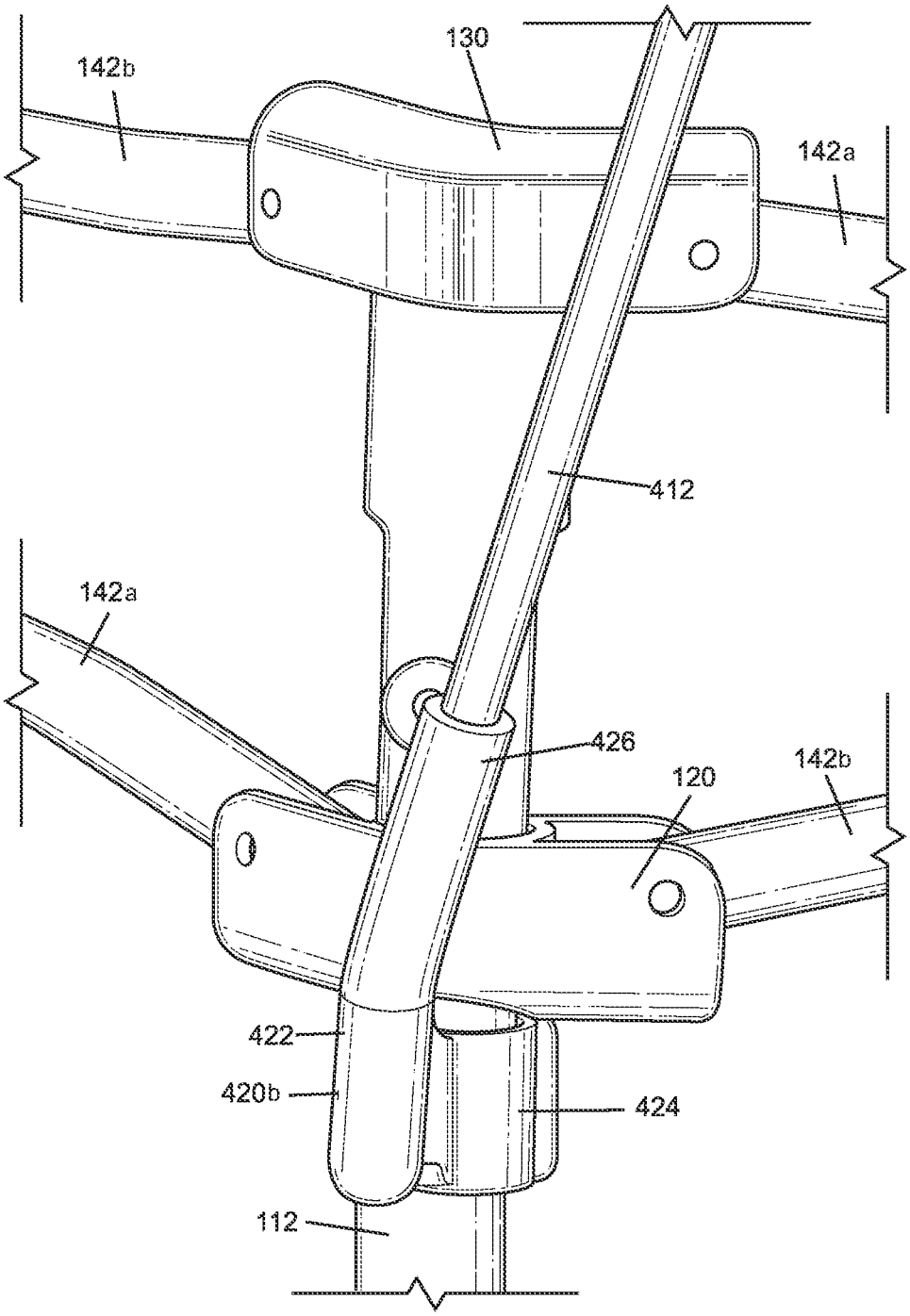

FIG. 45D shows a perspective view of the canopy clip of the canopy support assembly in the canopy cover assembly of FIG. 45A.

Figure 45E:
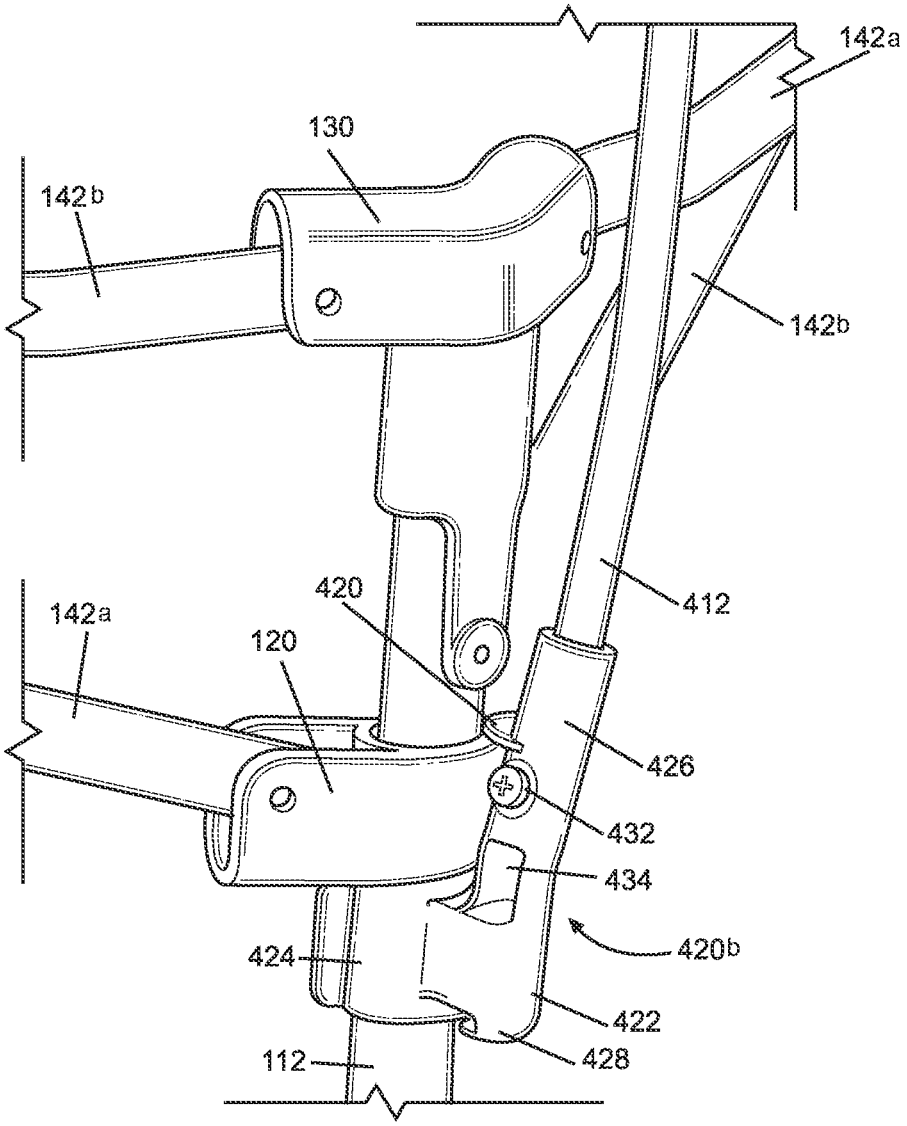

FIG. 45E shows another perspective view of the canopy clip of FIG. 45D.

Figure 46A:
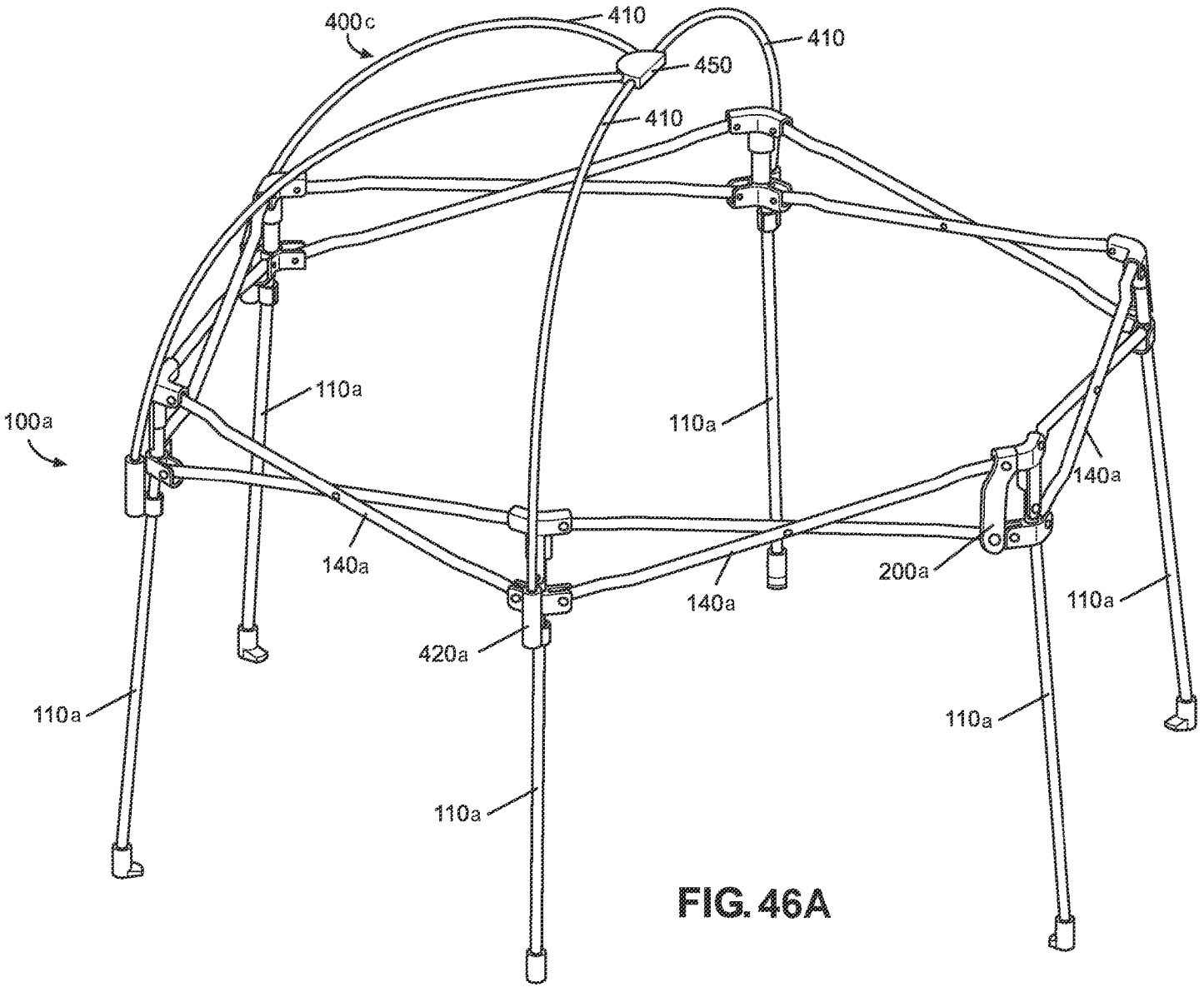

FIG. 46A shows a top, front perspective view of the playard of FIG. 2A with an exemplary canopy cover assembly that covers half interior space of the playard and includes a hub.

Figure 46B:
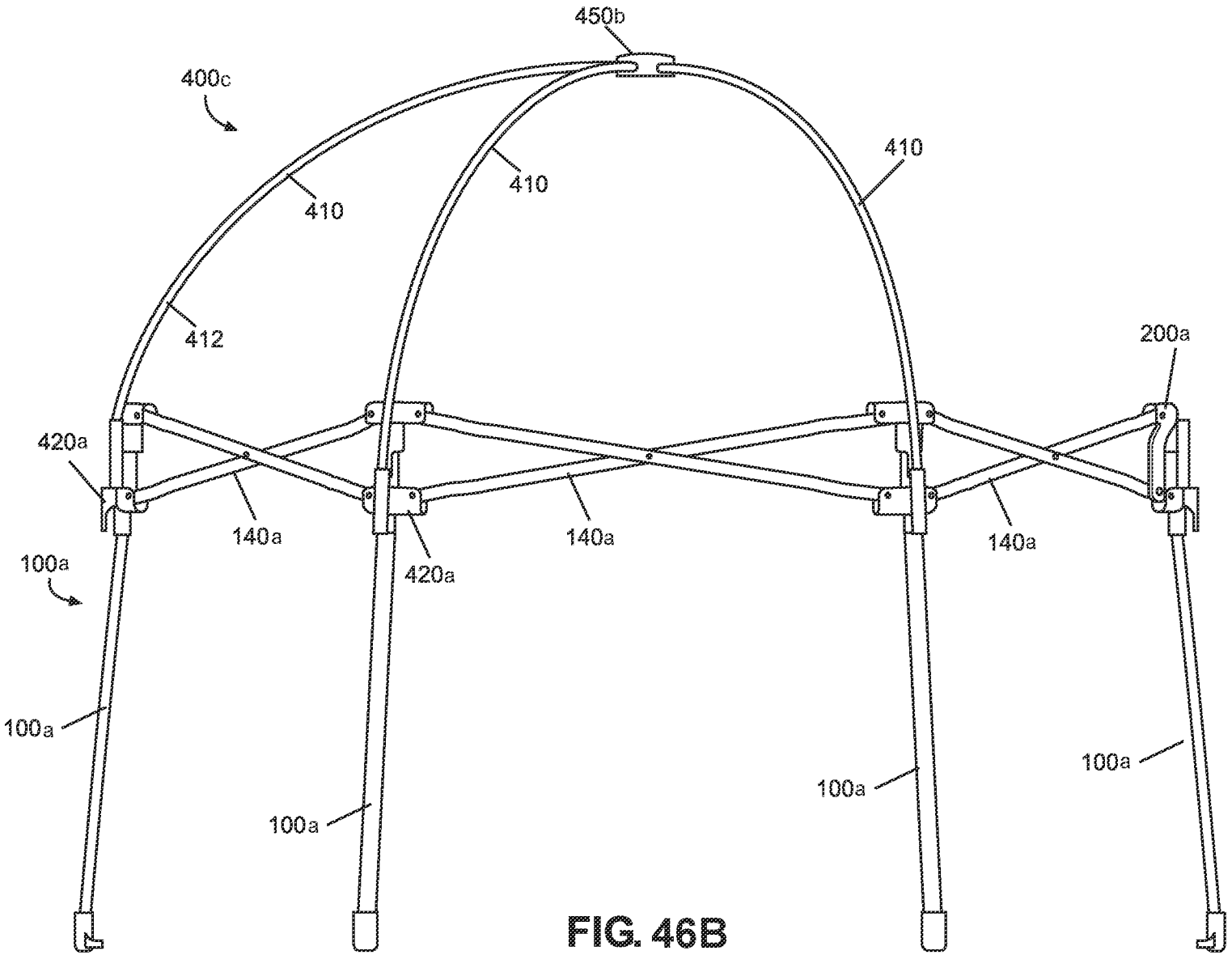

FIG. 46B shows a front view of the playard and the canopy cover assembly of FIG. 46A.

Figure 46C:
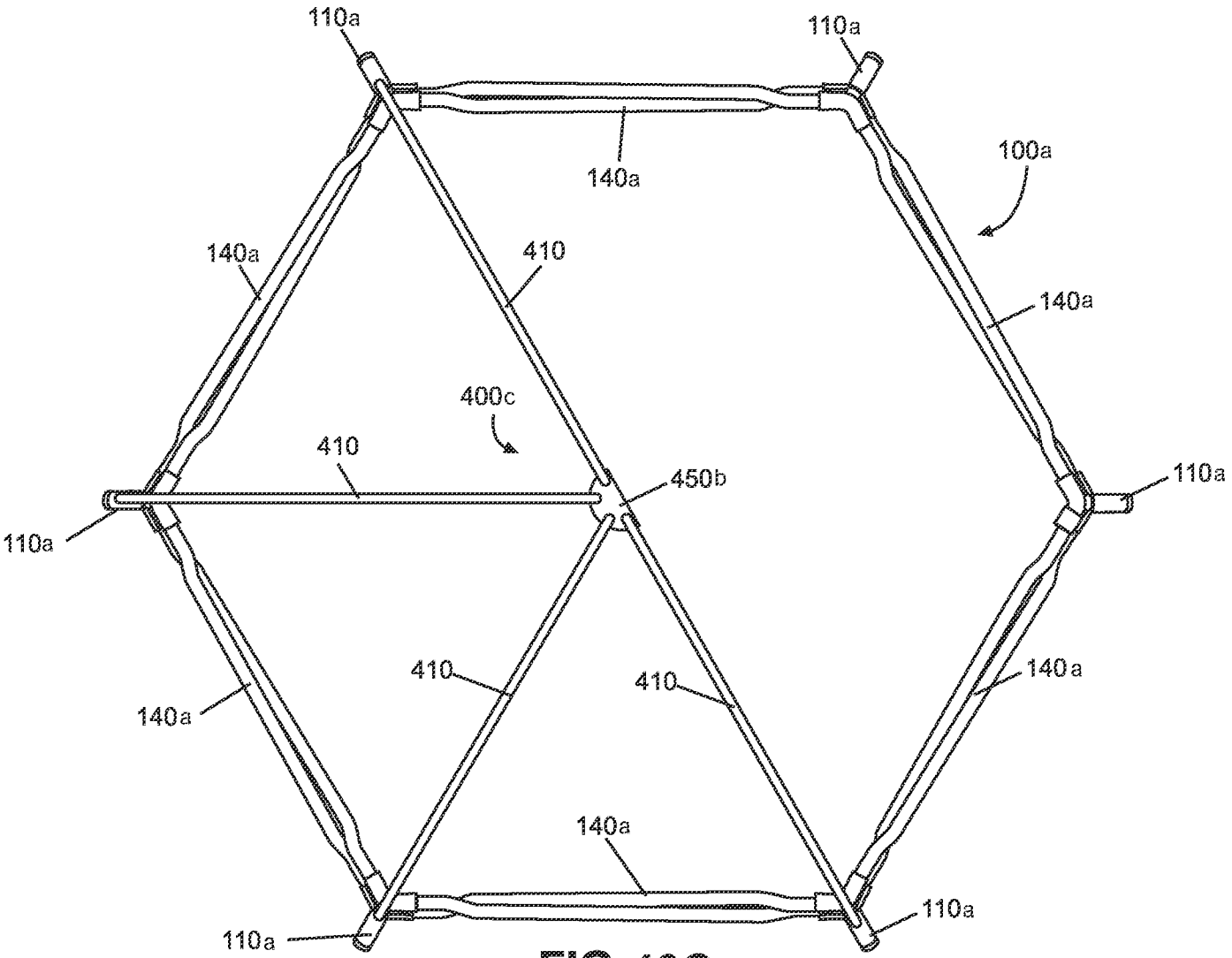

FIG. 46C shows a top view of the playard and the canopy cover assembly of FIG. 46A.

Figure 47A:
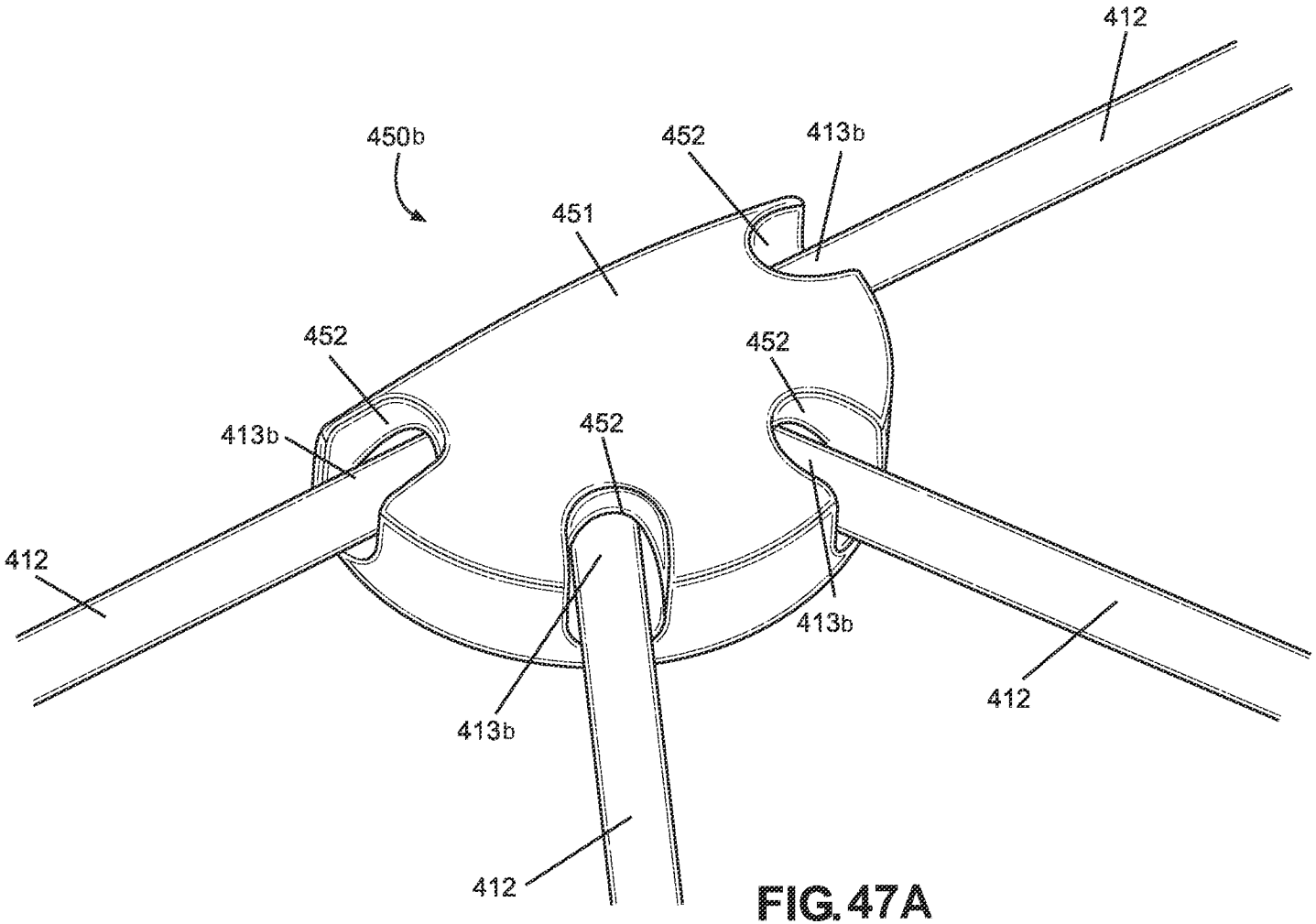

FIG. 47A shows a top perspective view of the hub of FIG. 46A.

Figure 47B:
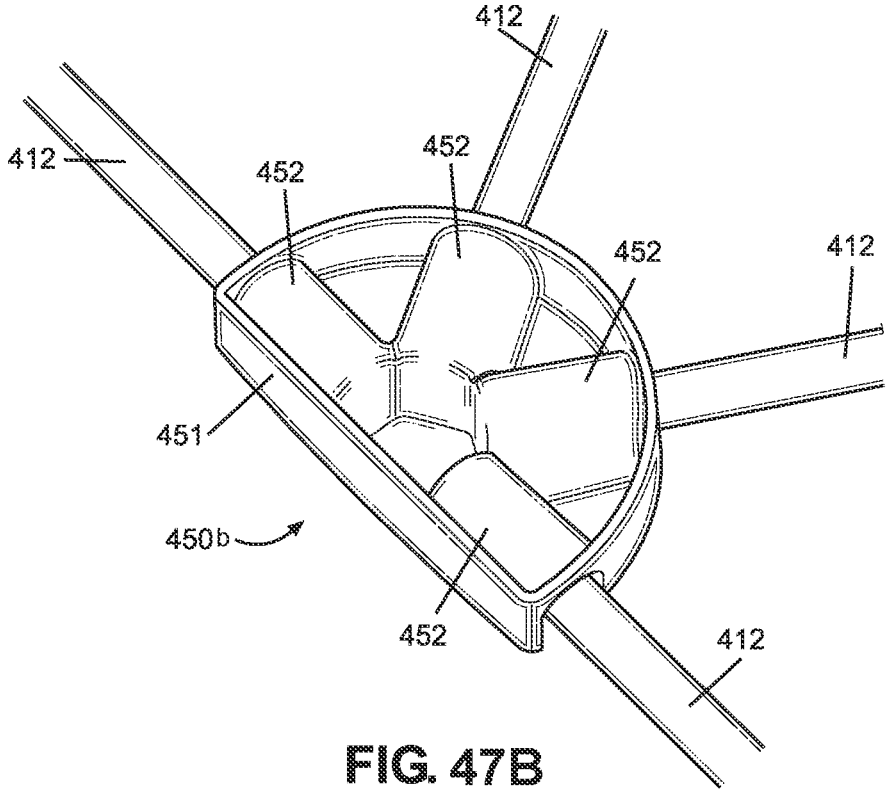

FIG. 47B shows a bottom perspective view of the hub of FIG. 47A.

Figure 48A:
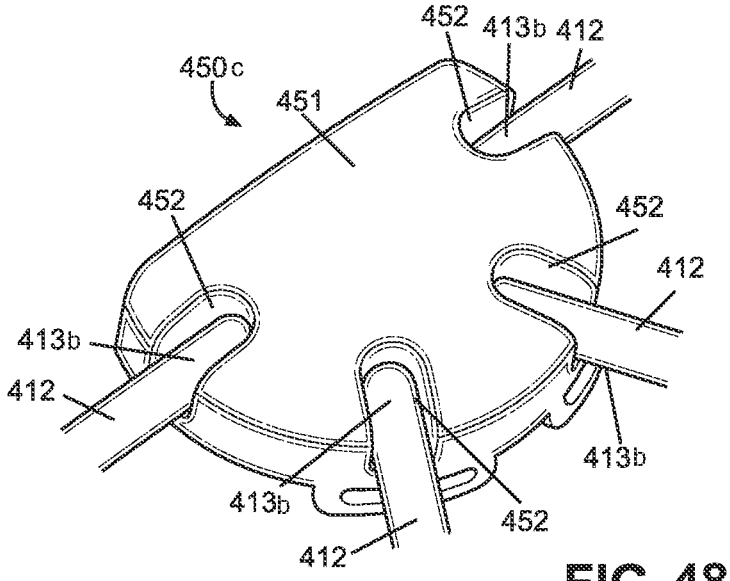

FIG. 48A shows a top perspective view of another hub that allows each canopy bow to pivot about a horizontal axis relative to the hub.

Figure 48B:
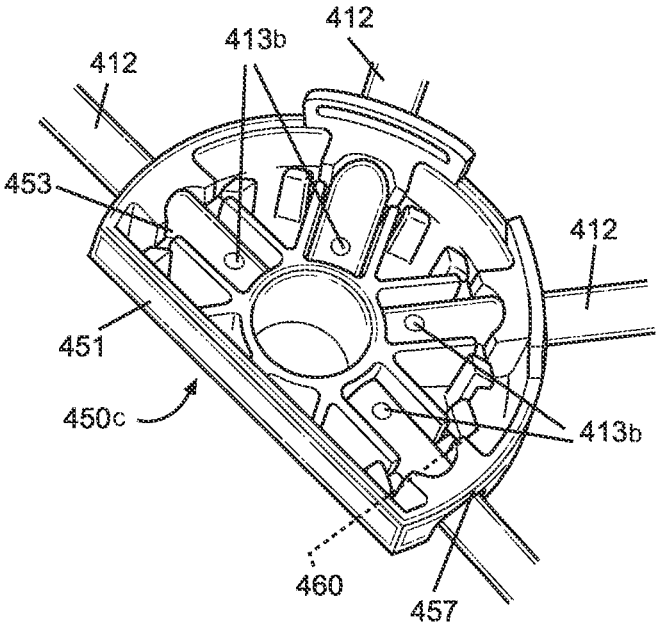

FIG. 48B shows a bottom perspective view of the hub of FIG. 48A.

Figure 49A:
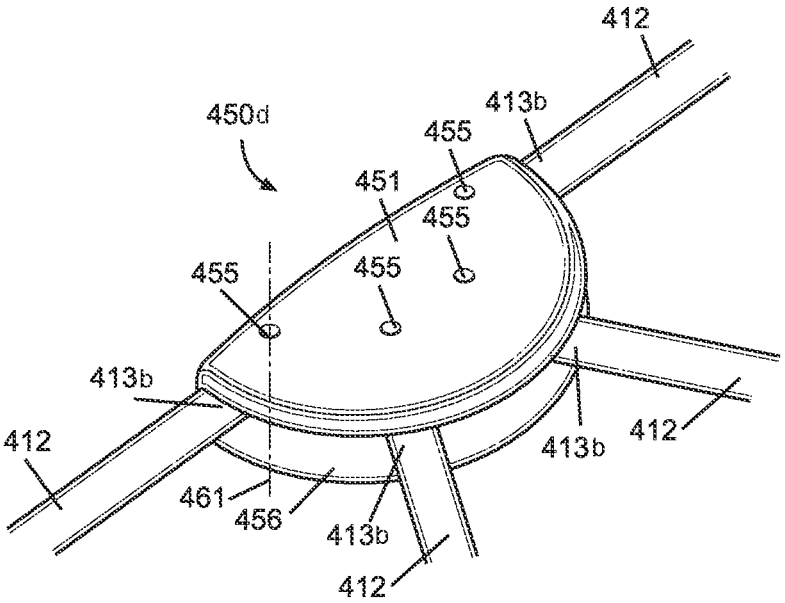

FIG. 49A shows a top perspective view of another hub that allows each canopy bow to pivot about a vertical axis relative to the hub.

Figure 49B:
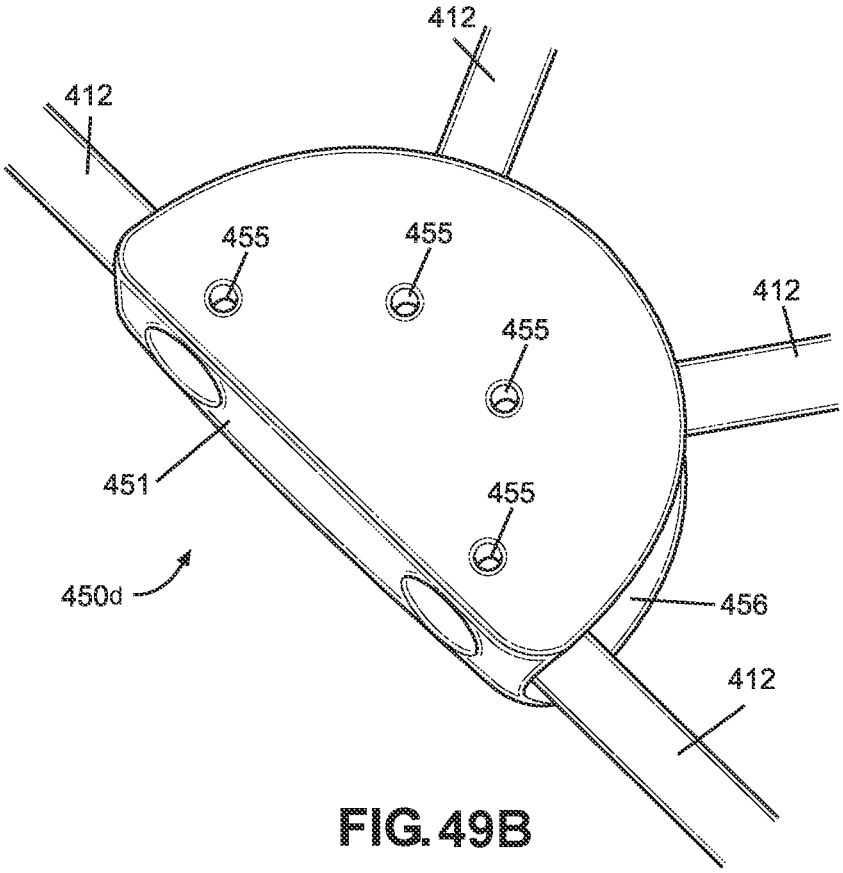

FIG. 49B shows a bottom perspective view of the hub of FIG. 49A.

Figure 17A:
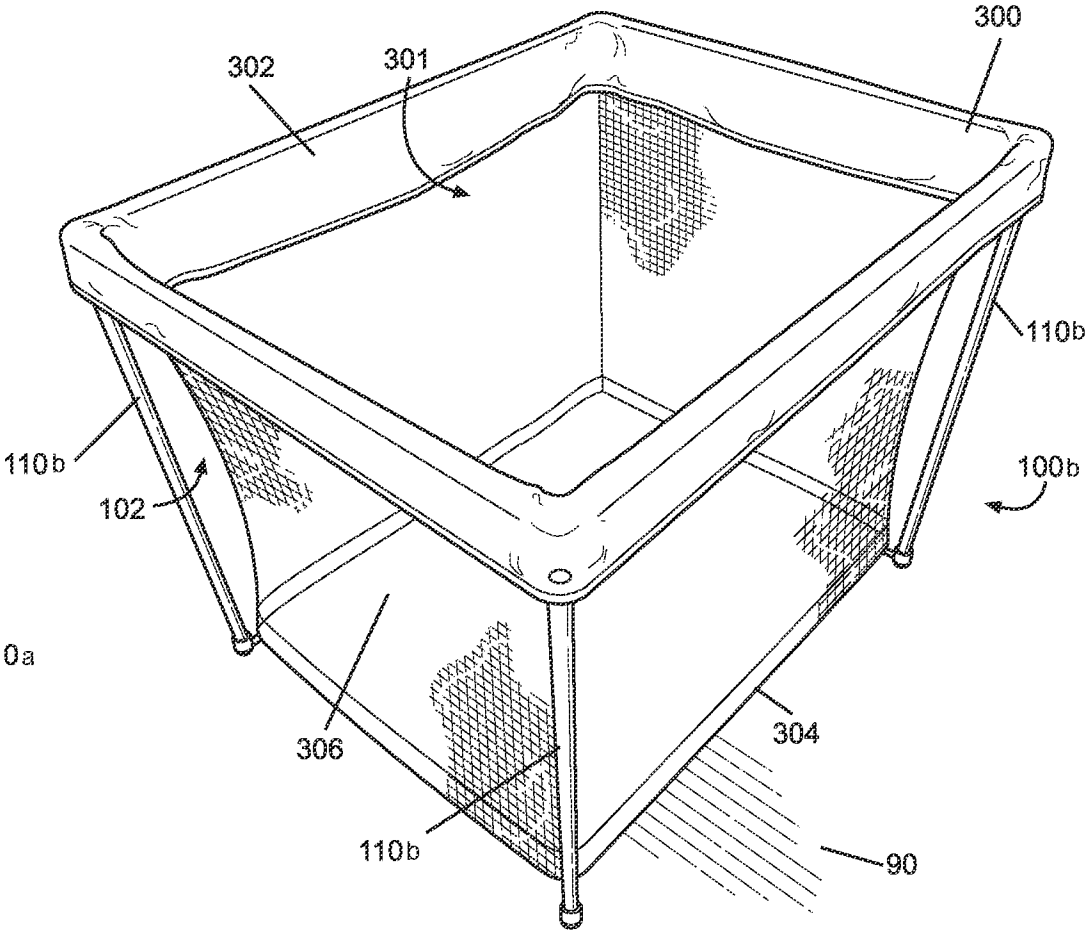
FIG. 17A shows a top perspective view of an exemplary playard forming a rectangular-shaped interior space with soft goods. The playard is in an unfolded configuration.
Figure 50A:
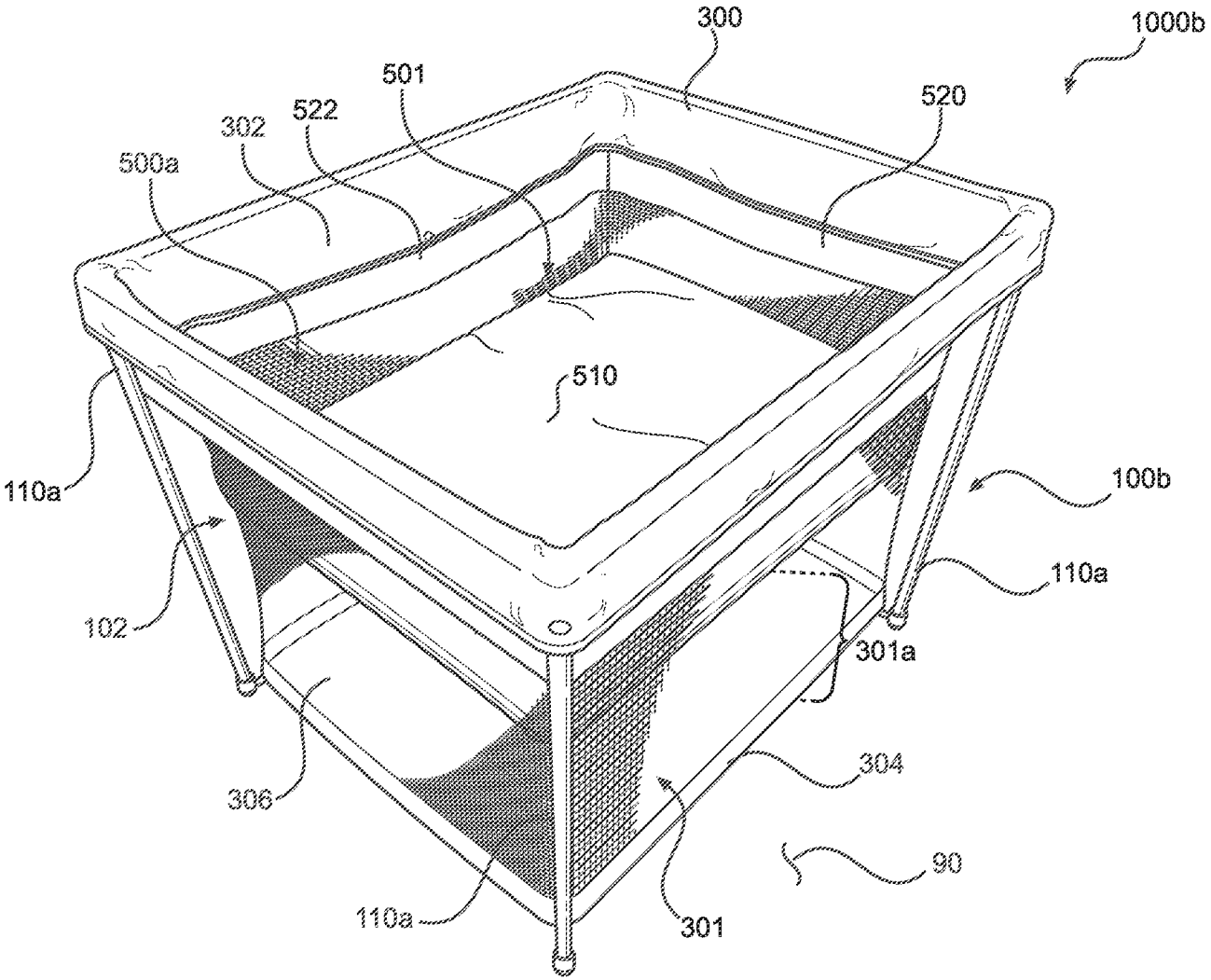

FIG. 50A shows a top perspective view of the playard of FIG. 17A and an exemplary bassinet accessory installed on the playard with a hub that moves downwards when folding the playard and the bassinet accessory. The playard and the bassinet accessory are shown in an unfolded configuration.

Figure 50B:
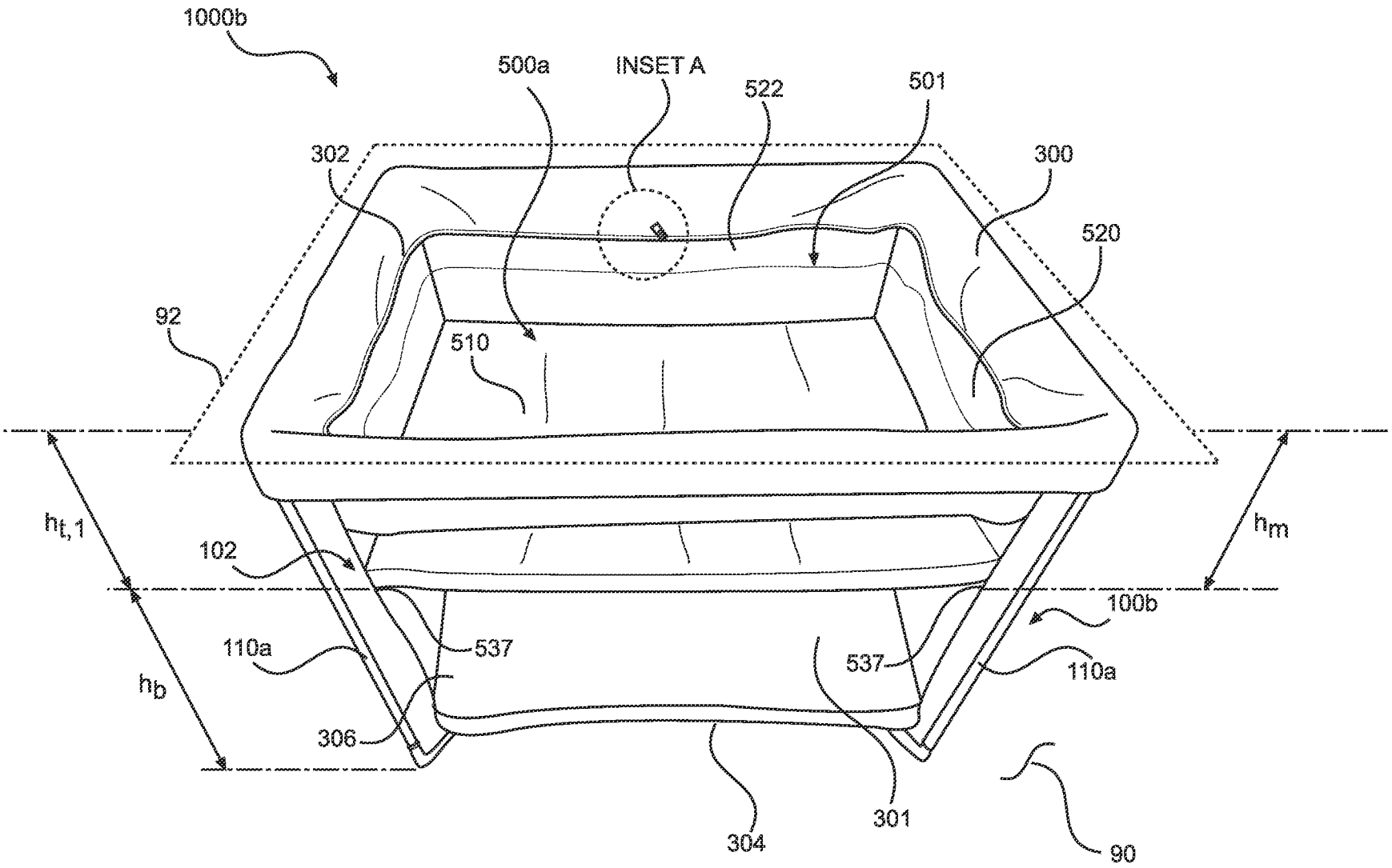

FIG. 50B shows another top perspective view of the playard and the bassinet accessory of FIG. 50A in the unfolded configuration.

Figure 23A:
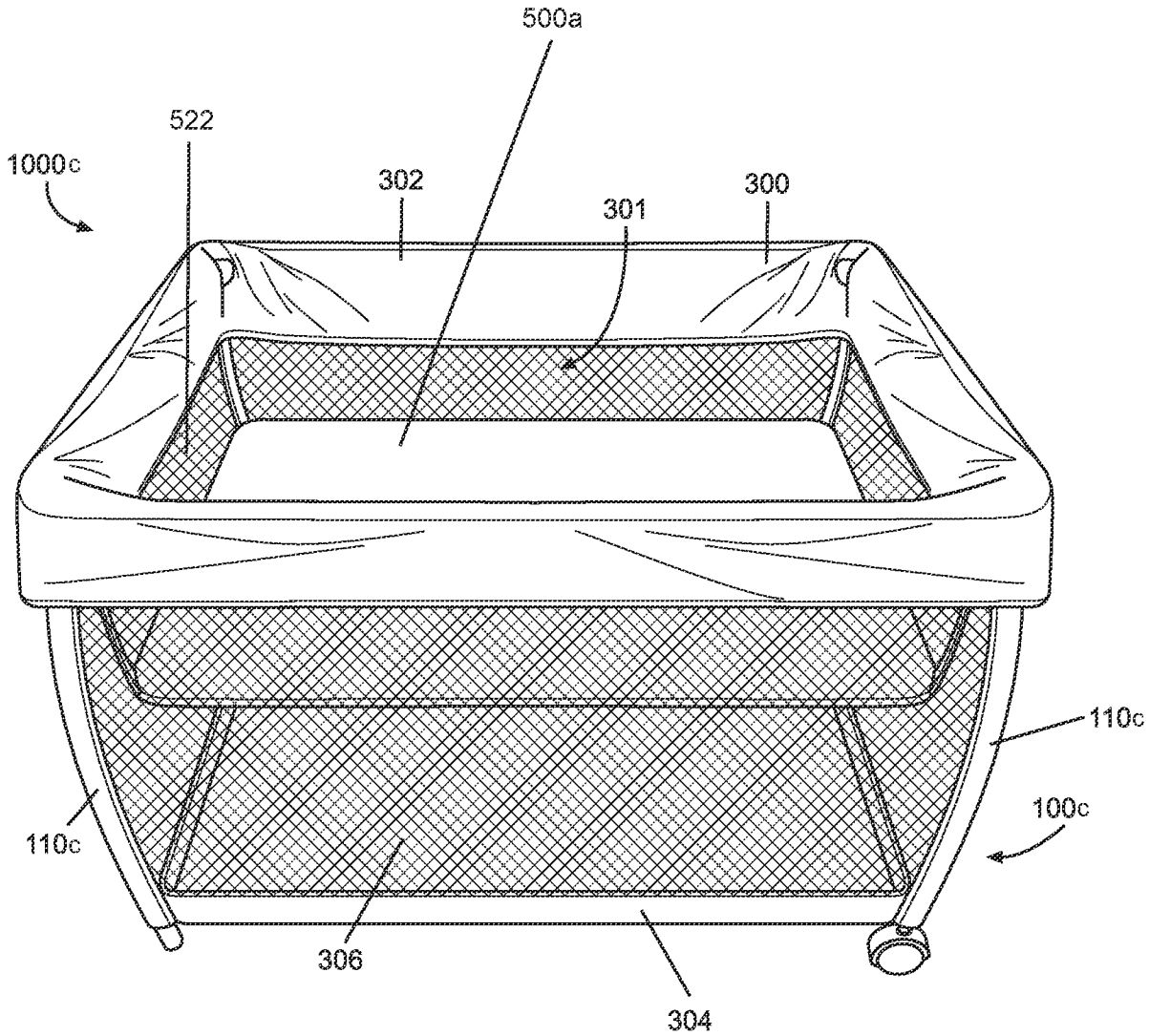
FIG. 23A shows a top, front perspective view of another exemplary playard forming a rectangular, convex-shaped interior space with soft goods. The rectangular playard is also shown with the bassinet accessory of FIG. 50A. The playard is in an unfolded configuration.
Figure 50C:
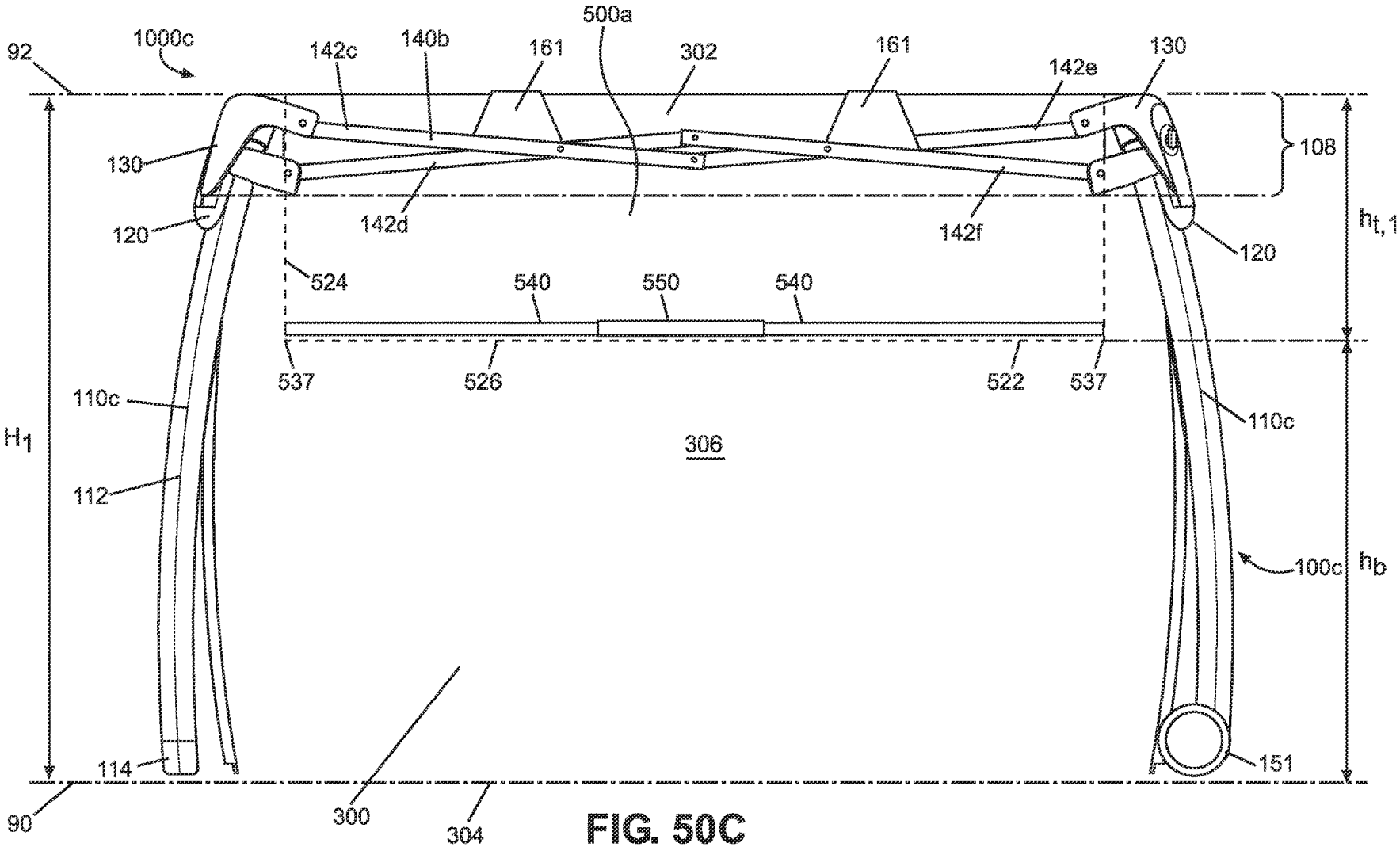

FIG. 50C shows a front side view of the playard of FIG. 23A with the bassinet accessory of FIG. 50A.

Figure 51A:
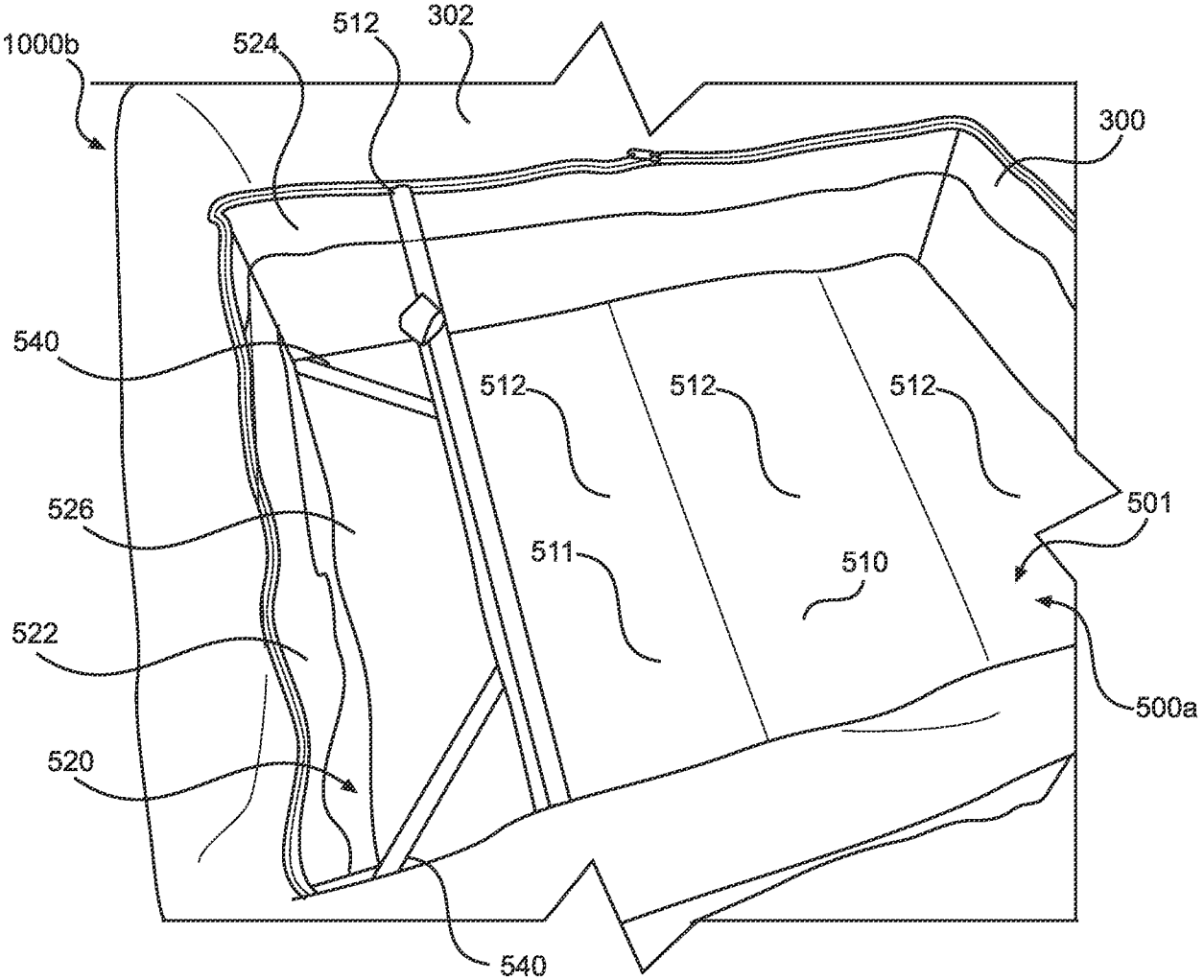

FIG. 51A shows a top perspective view of a mattress in the bassinet accessory of FIG. 50A that is partially folded and disposed in a partially enclosed space of the bassinet accessory.

Figure 51B:
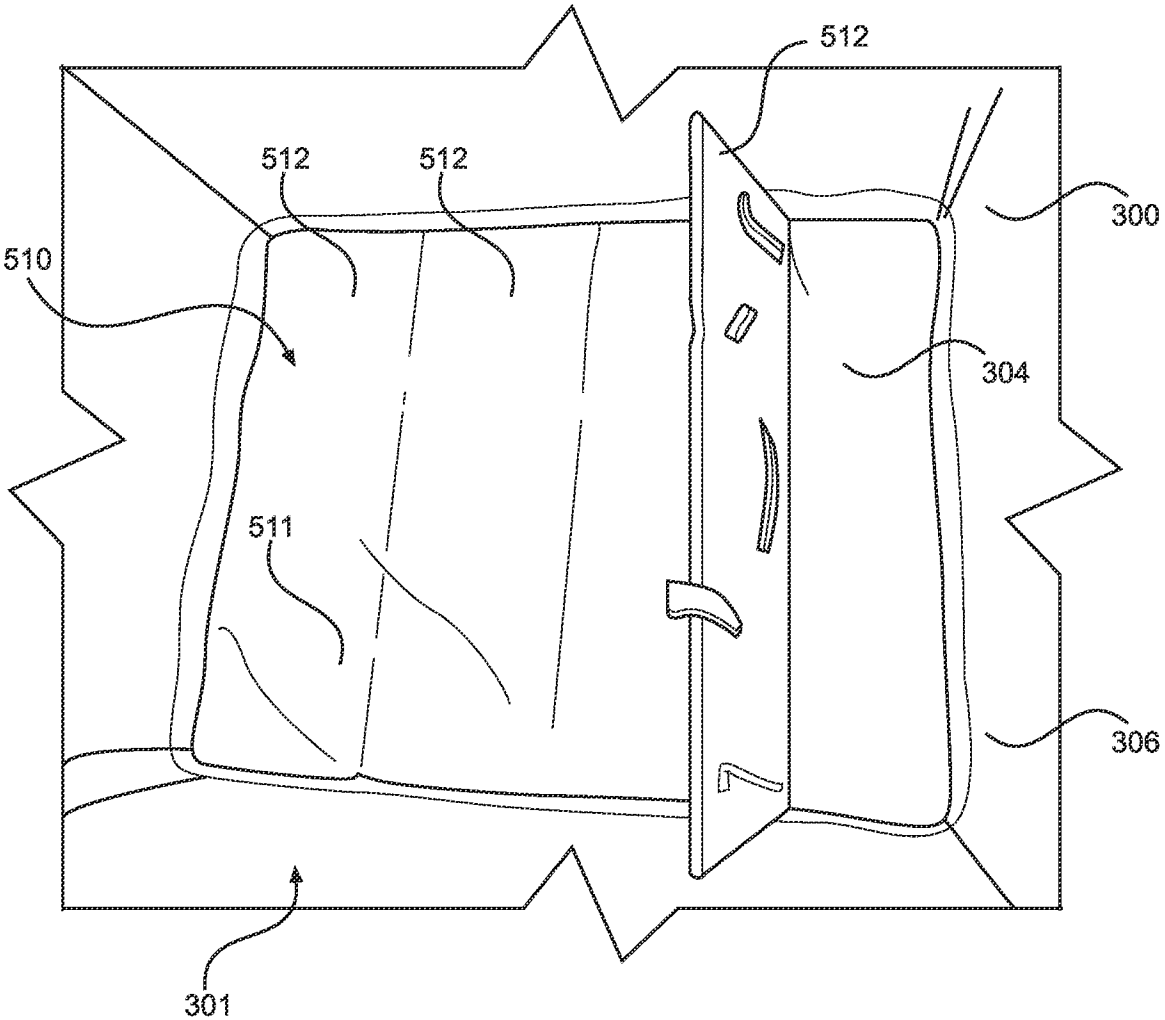

FIG. 51B shows a top perspective view of the playard of FIG. 50A with the bassinet accessory removed and the mattress of FIG. 51A partially folded and disposed in a partially enclosed space defined by soft goods of the playard.

Figure 52:
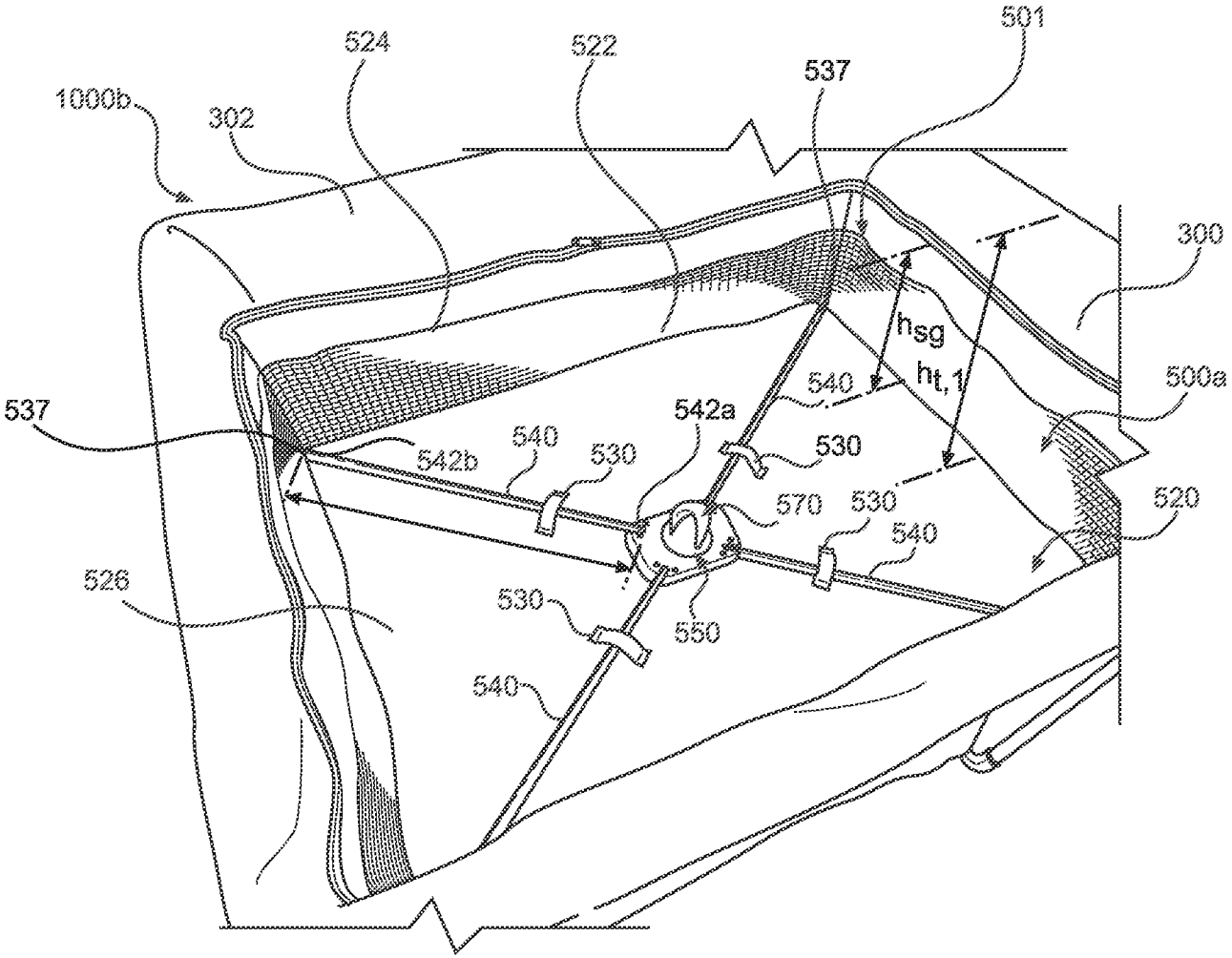

FIG. 52 shows a top perspective view of the playard and the bassinet accessory of FIG. 50A without the mattress revealing a hub and multiple support tubes of the bassinet accessory. The playard and the bassinet accessory are shown in the unfolded configuration.

Figure 53A:
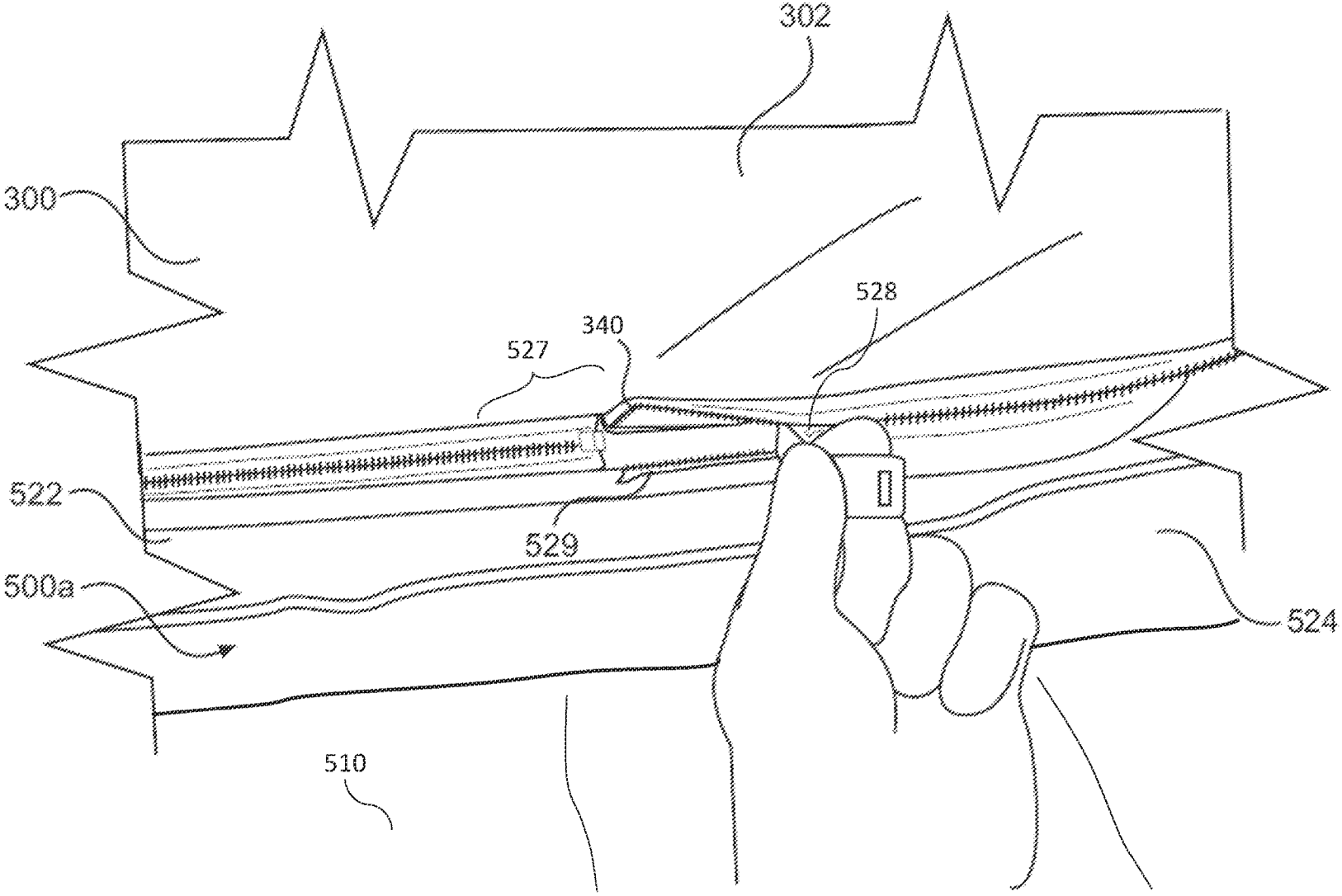

FIG. 53A shows a magnified view of bassinet soft goods in the bassinet accessory corresponding to Inset A of FIG. 50B where the bassinet soft goods are coupled to soft goods in the playard via a zipper mechanism.

Figure 53B:
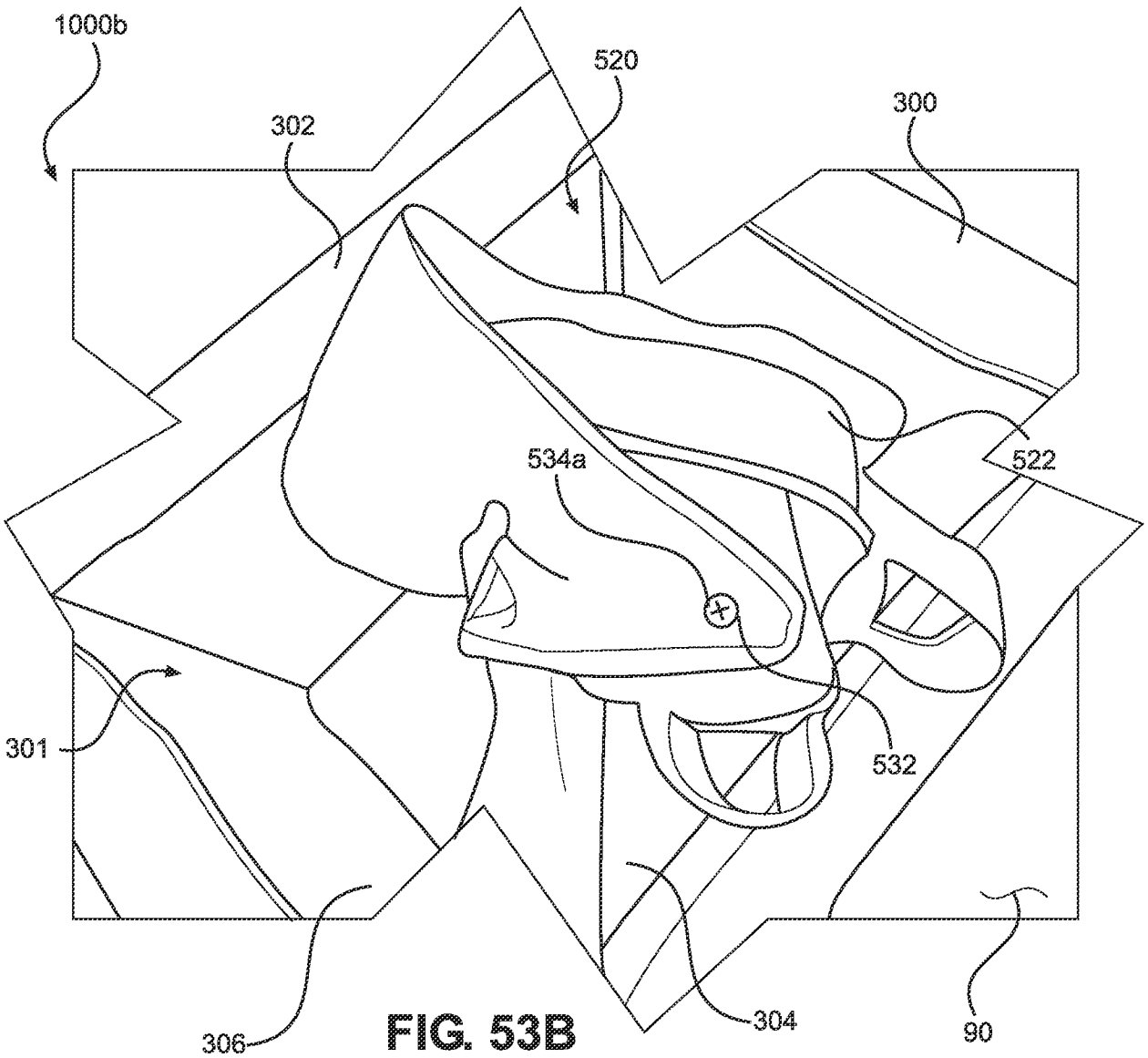

FIG. 53B shows a top perspective view of the bassinet accessory of FIG. 50A removed from the playard of FIG. 50A.

Figure 54A:
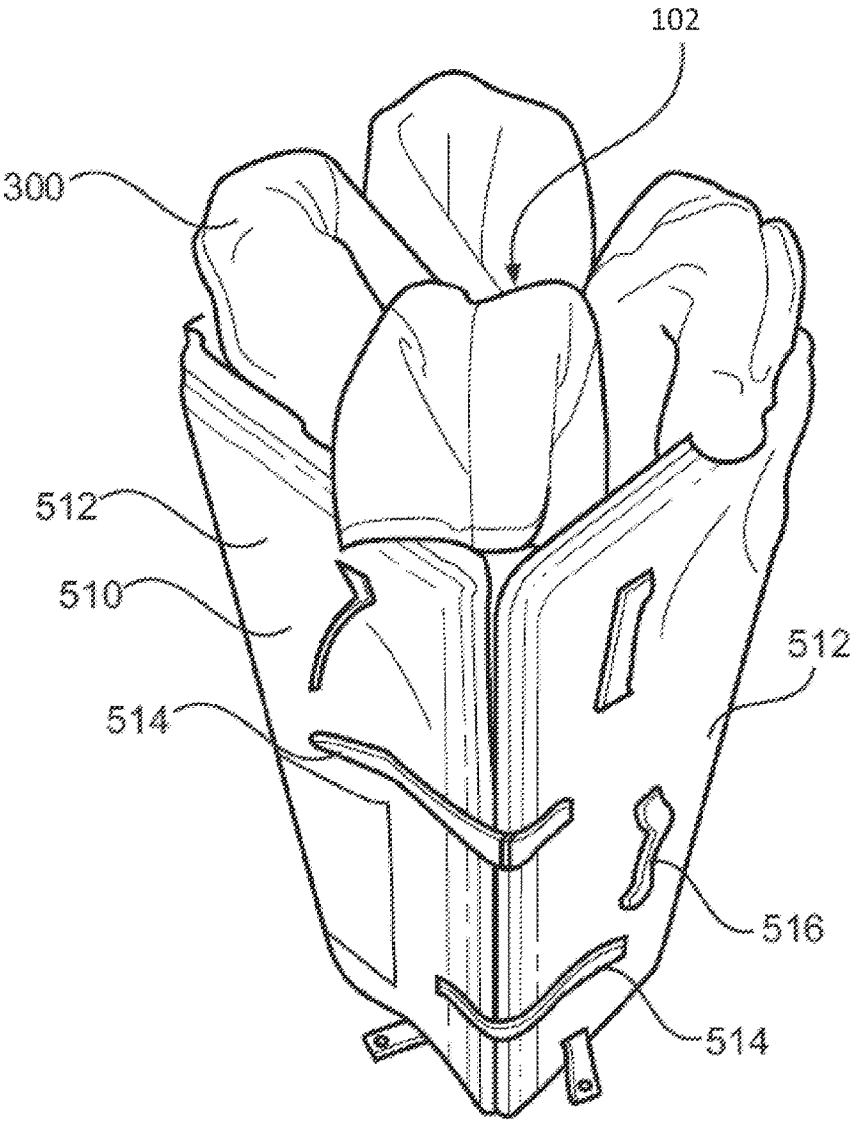

FIG. 54A shows a top perspective view of the playard and the bassinet accessory of FIG. 52 where the playard and the bassinet accessory are in the folded configuration.

Figure 54B:
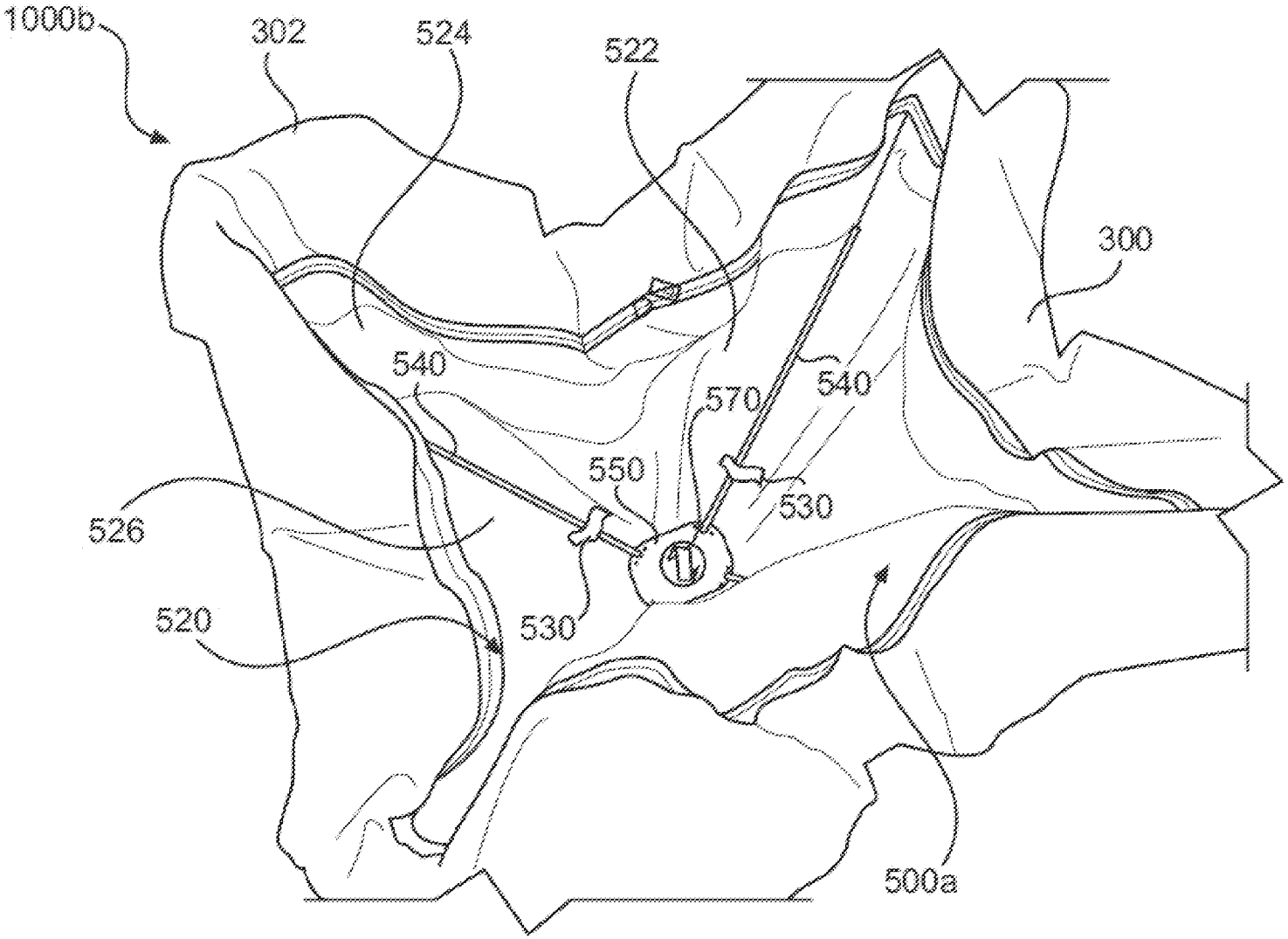

FIG. 54B shows a top perspective view of the playard and the bassinet accessory of FIG. 52 where the playard and the bassinet accessory are partially unfolded and beginning to transition from the folded configuration to the unfolded configuration. The playard and the bassinet accessory may also be viewed as being partially folded and approaching the folded configuration.

Figure 54C:
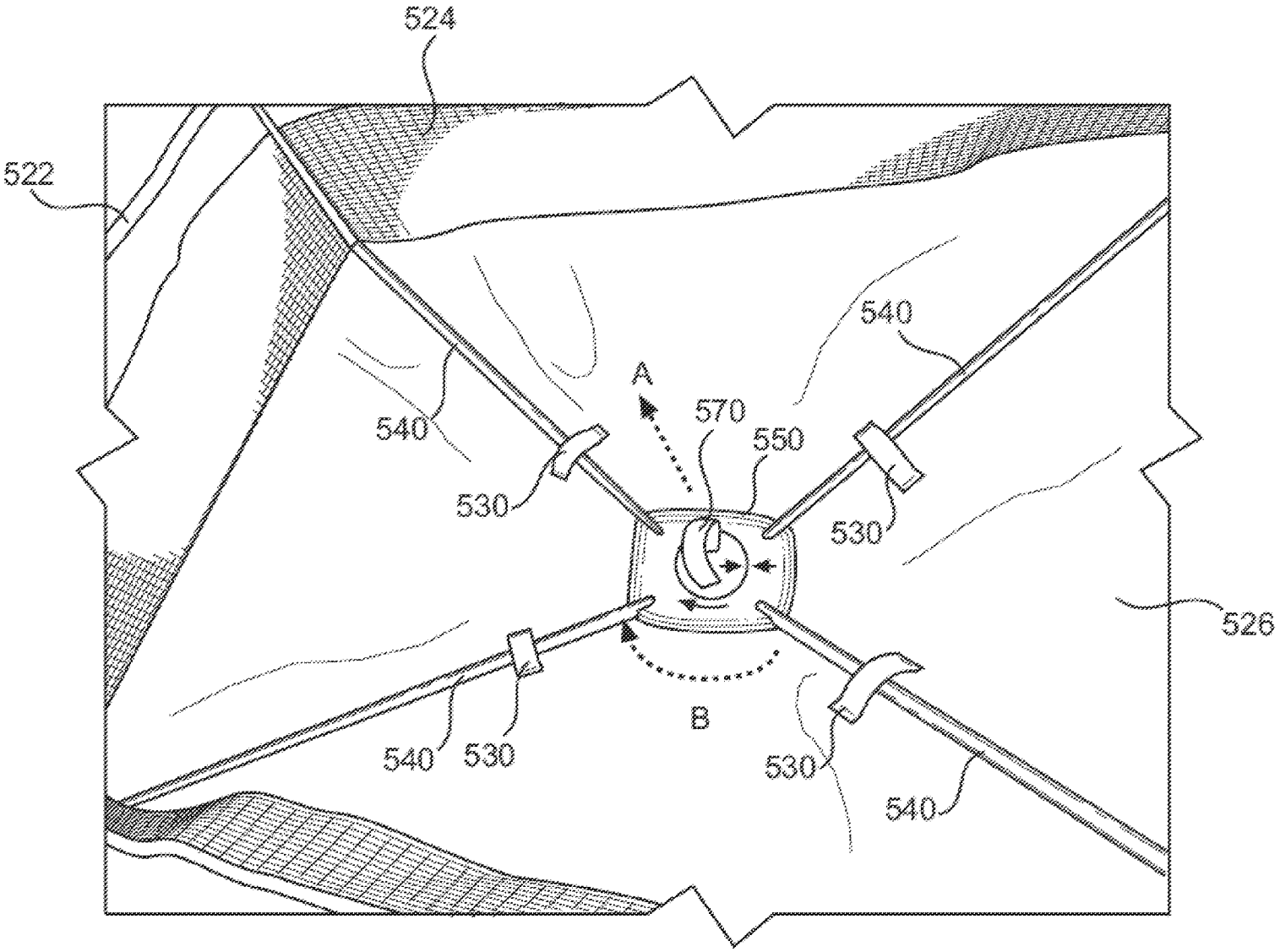

FIG. 54C shows a top perspective view of the playard and the bassinet accessory of FIG. 52 where the playard and the bassinet accessory are partially unfolded and approaching the unfolded configuration. The playard and the bassinet accessory may also be viewed as being partially folded and beginning to transition to the folded configuration.

Figure 55A:
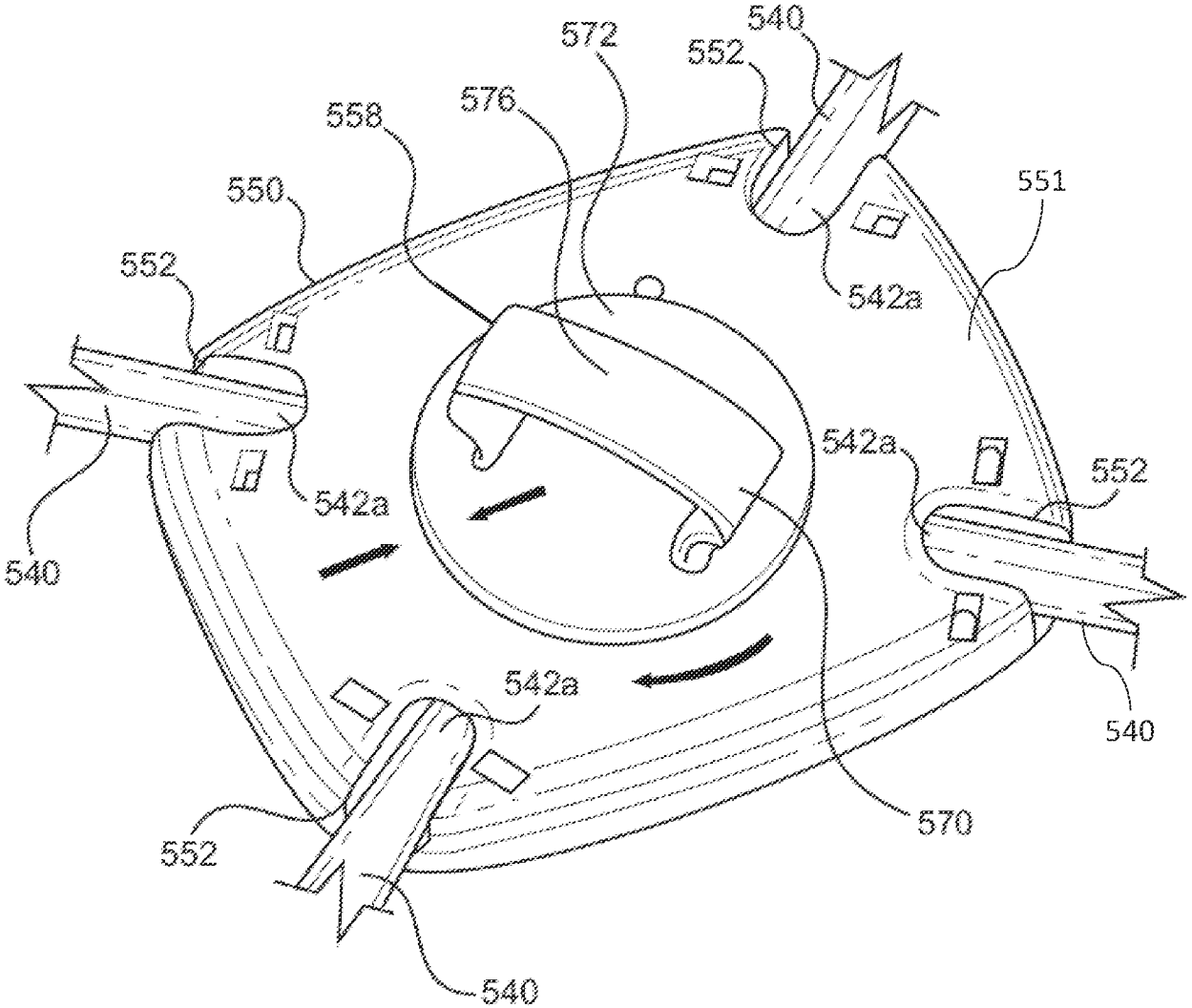

FIG. 55A shows a top perspective view of the hub with the hub latch and the support tubes of FIG. 52. The hub latch is shown in a locked state where rotational movement of the support tubes relative to the hub latch is constrained.

Figure 55B:
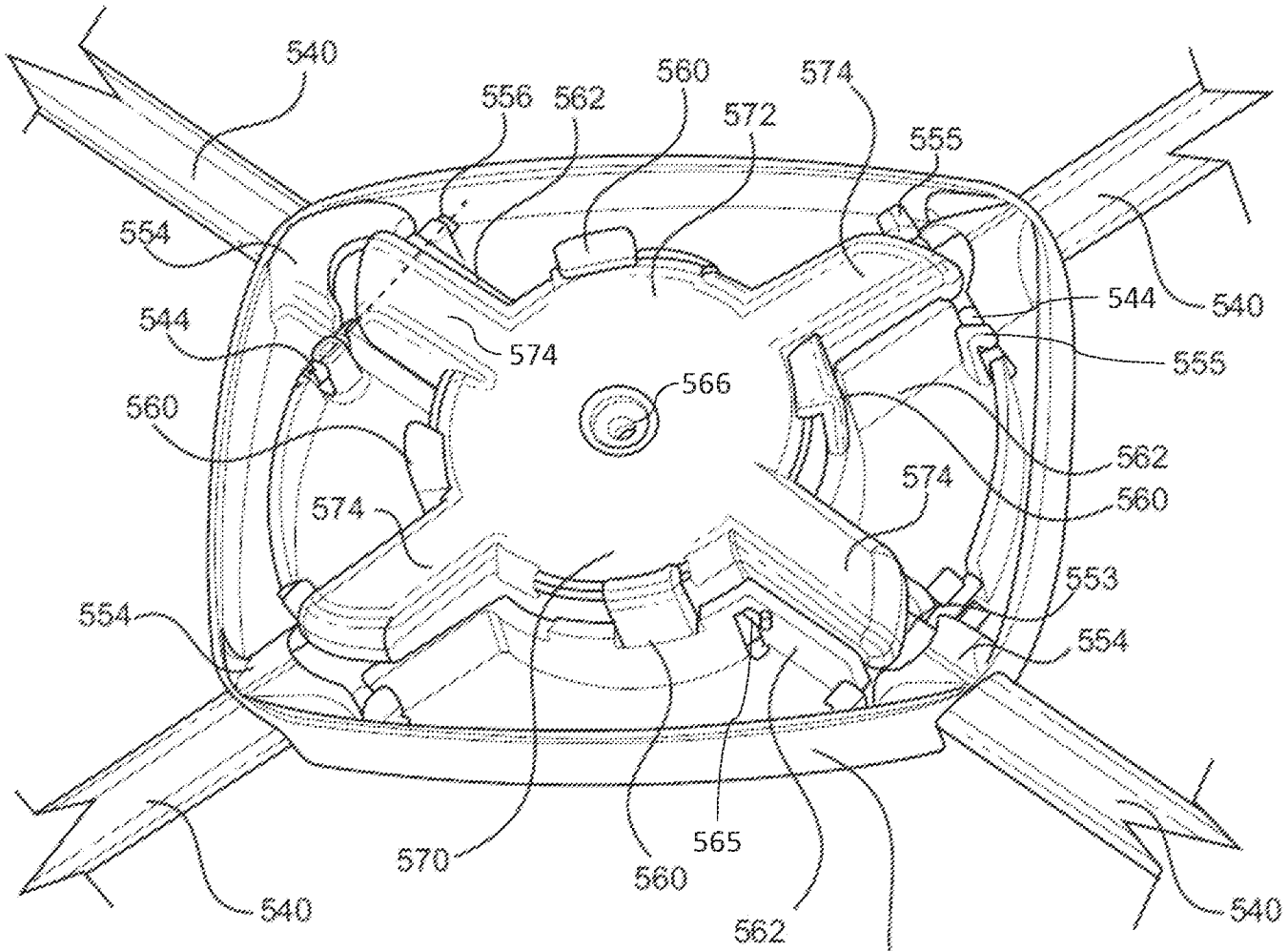

FIG. 55B shows a bottom perspective view of the hub, the hub latch, and the support tubes of FIG. 55A.

Figure 56A:
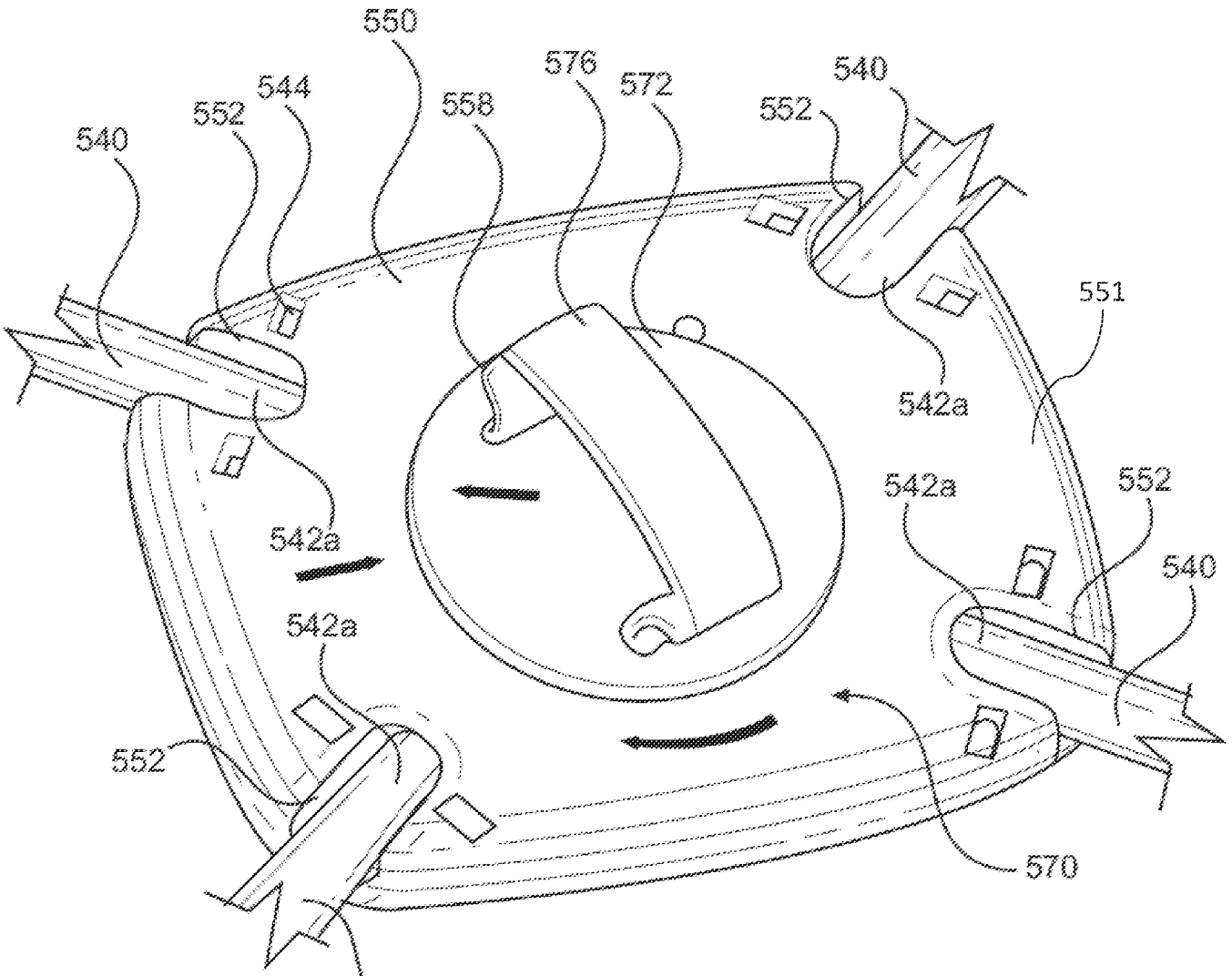

FIG. 56A shows a top perspective view of the hub with the hub latch and the support tubes of FIG. 52. The hub latch is shown in an unlocked state where rotational movement of the support tubes relative to the hub latch is permitted.

Figure 56B:
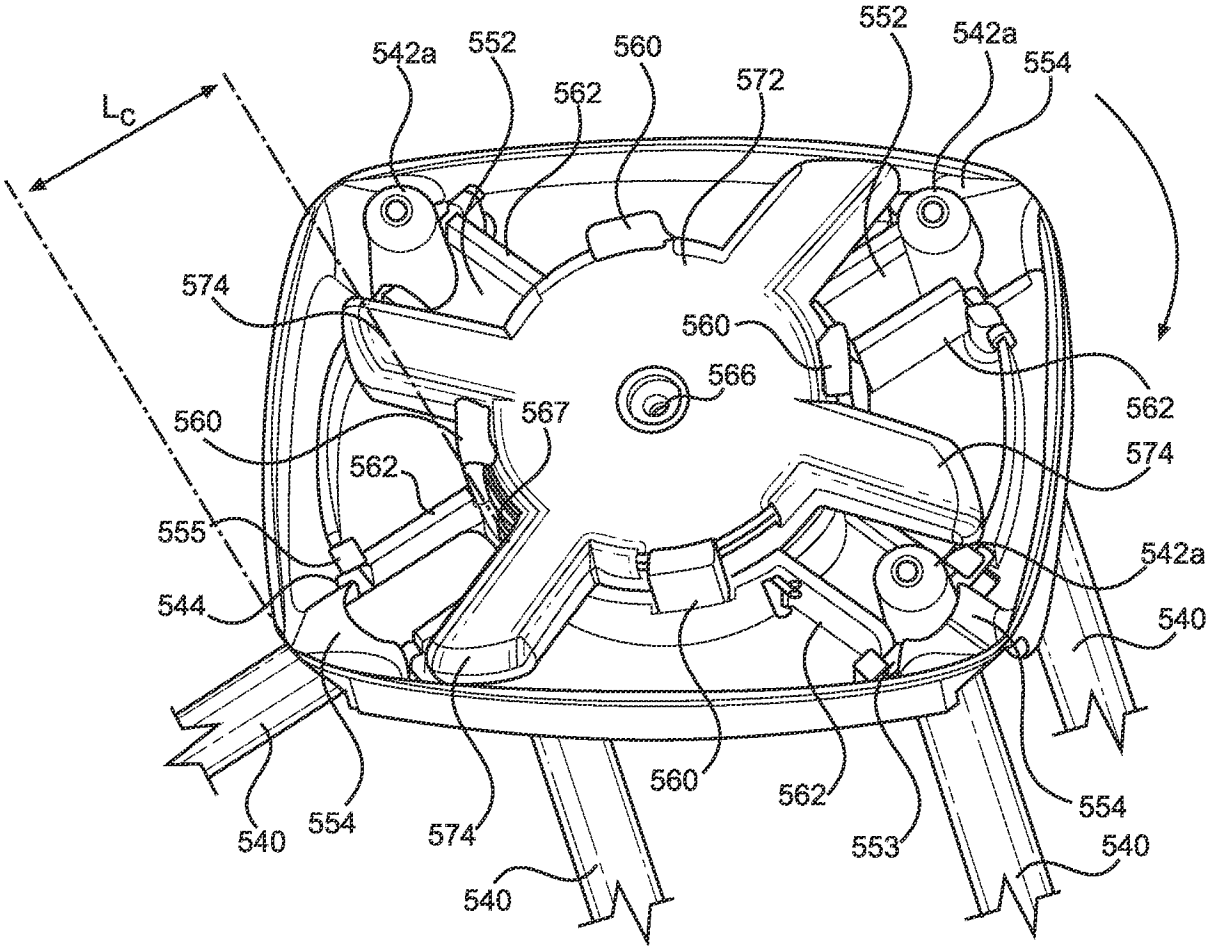

FIG. 56B shows a bottom perspective view of the hub, the hub latch, and the support tubes of FIG. 56A. Several support tubes are rotated to the folded configuration.

Figure 57:
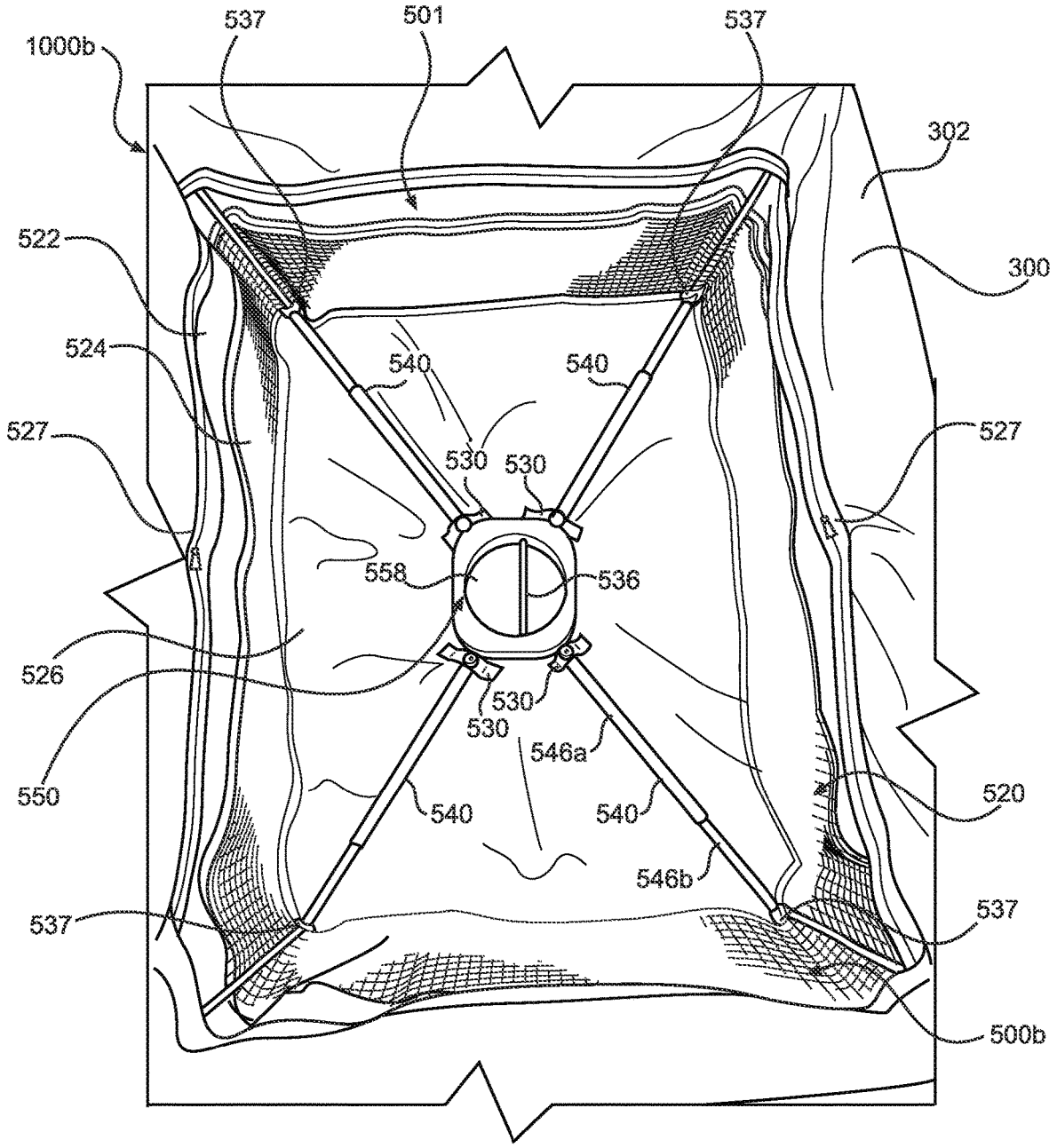

FIG. 57 shows a top perspective view of the playard of FIG. 17A and another exemplary bassinet accessory installed on the playard with a hub that moves upwards when folding the playard and the bassinet accessory. The playard and the bassinet accessory are shown in an unfolded configuration.

Figure 58A:
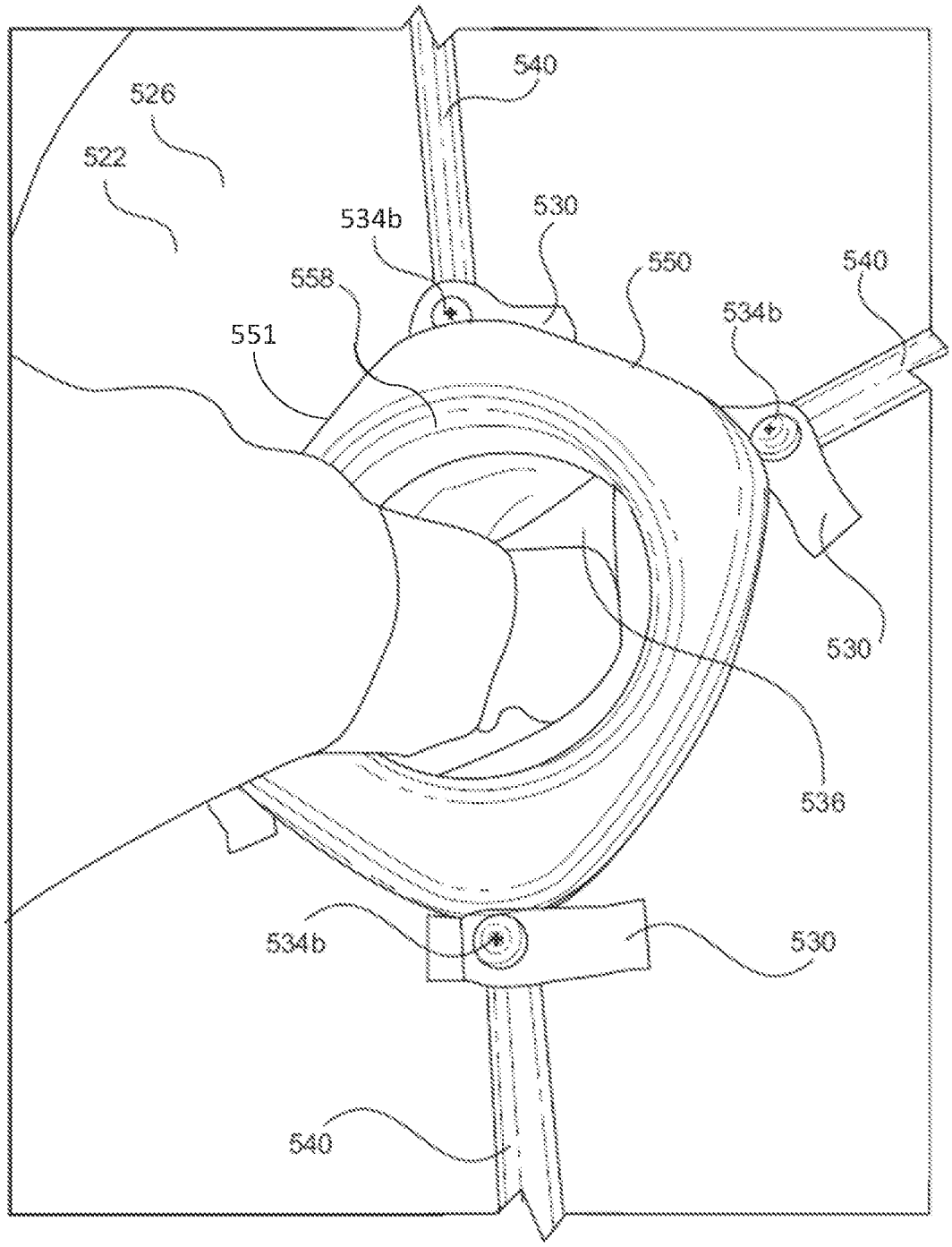

FIG. 58A shows a top perspective view of a user's hand reaching through respective openings of a hub and bassinet soft goods in the bassinet accessory of FIG. 57 to access a bottom portion of playard disposed below the bassinet accessory.

Figure 58B:
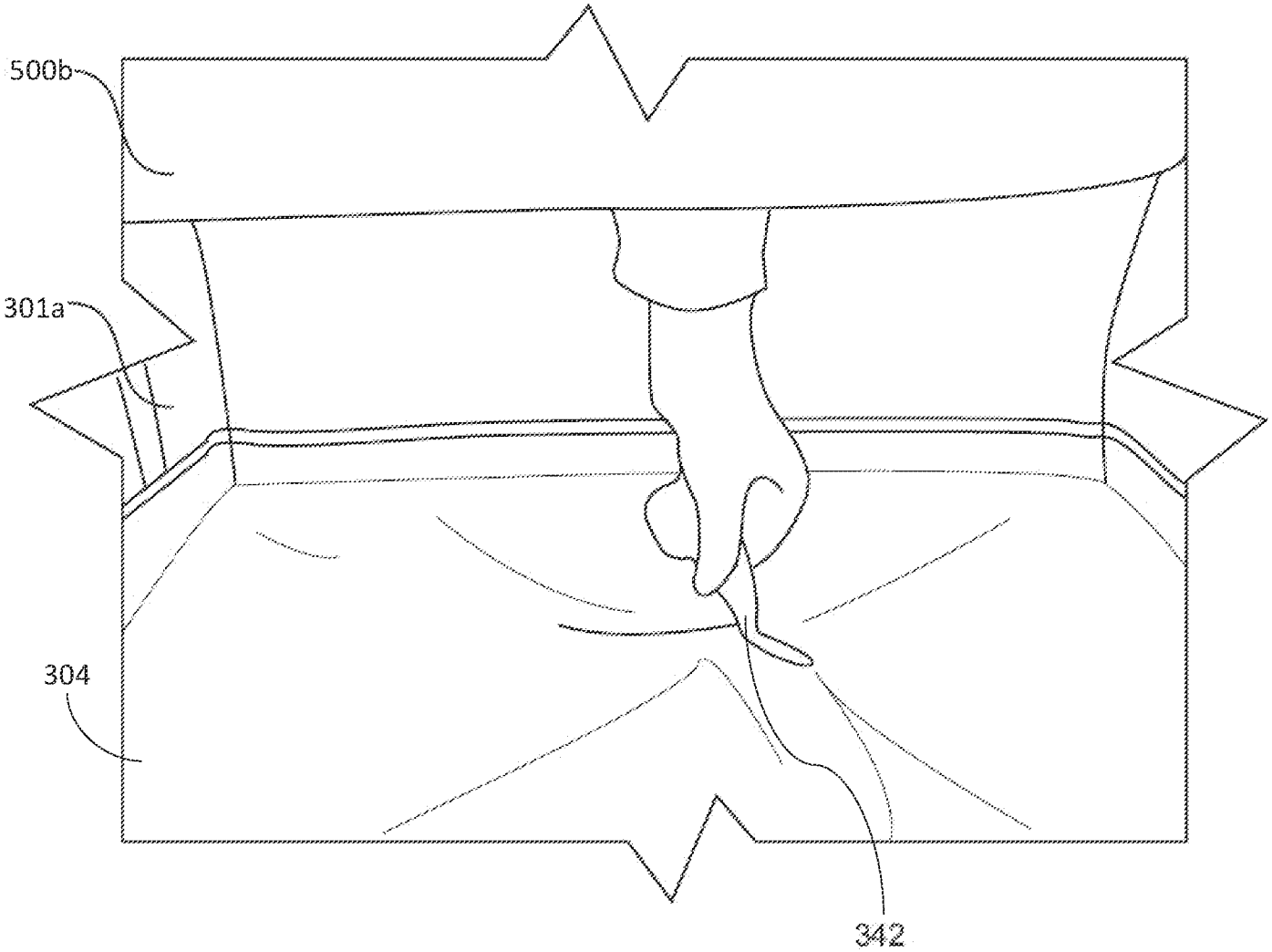

FIG. 58B shows a side view of the user's hand grasping a strap disposed on a bottom portion of soft goods in the playard of FIG. 57 to initiate folding of the playard and the bassinet accessory.

Figure 58C:
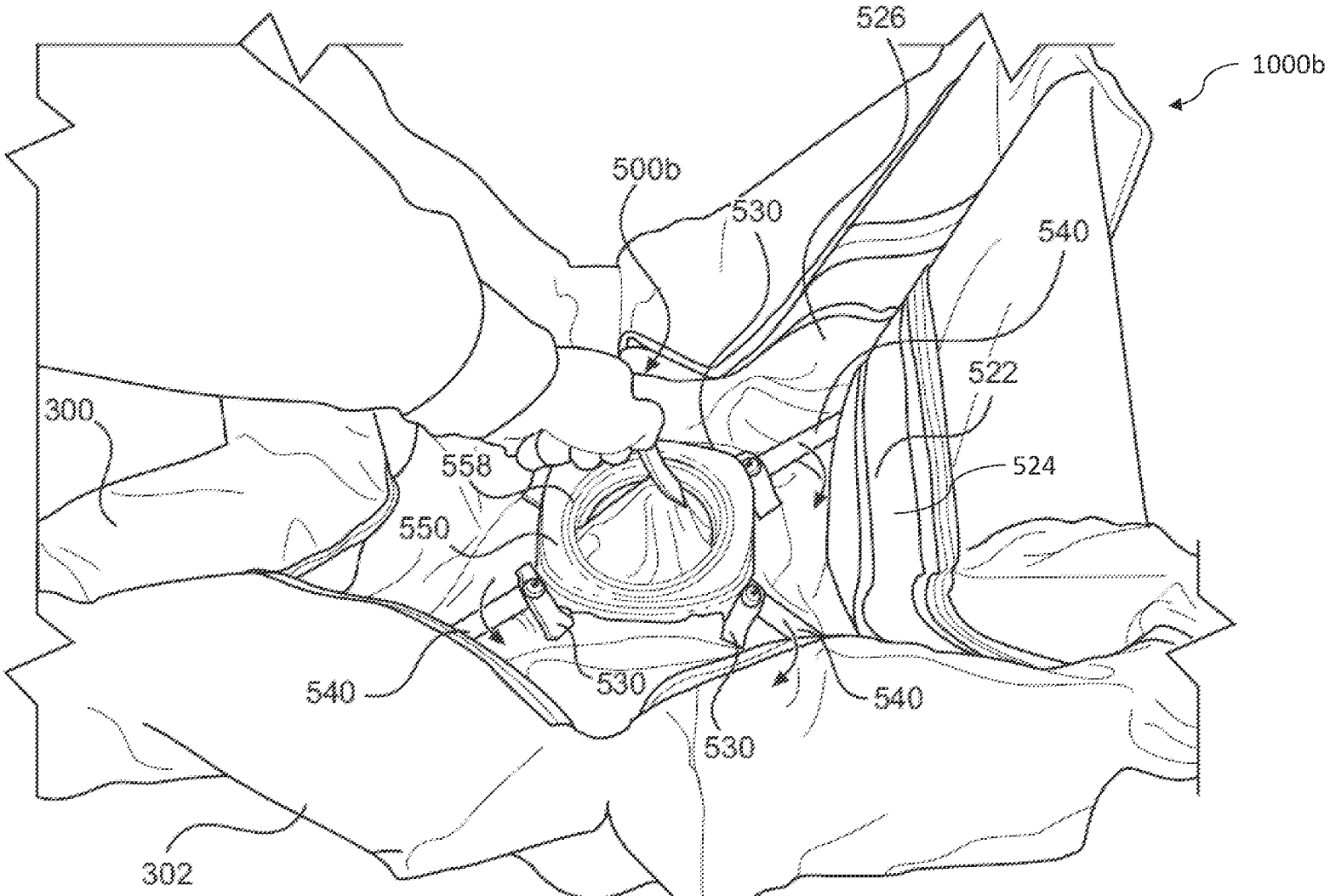

FIG. 58C shows a top perspective view of the user pulling the strap of FIG. 58B up and through the respective openings of the hub and the bassinet soft goods to fold the playard and the bassinet accessory.

Figure 58D:
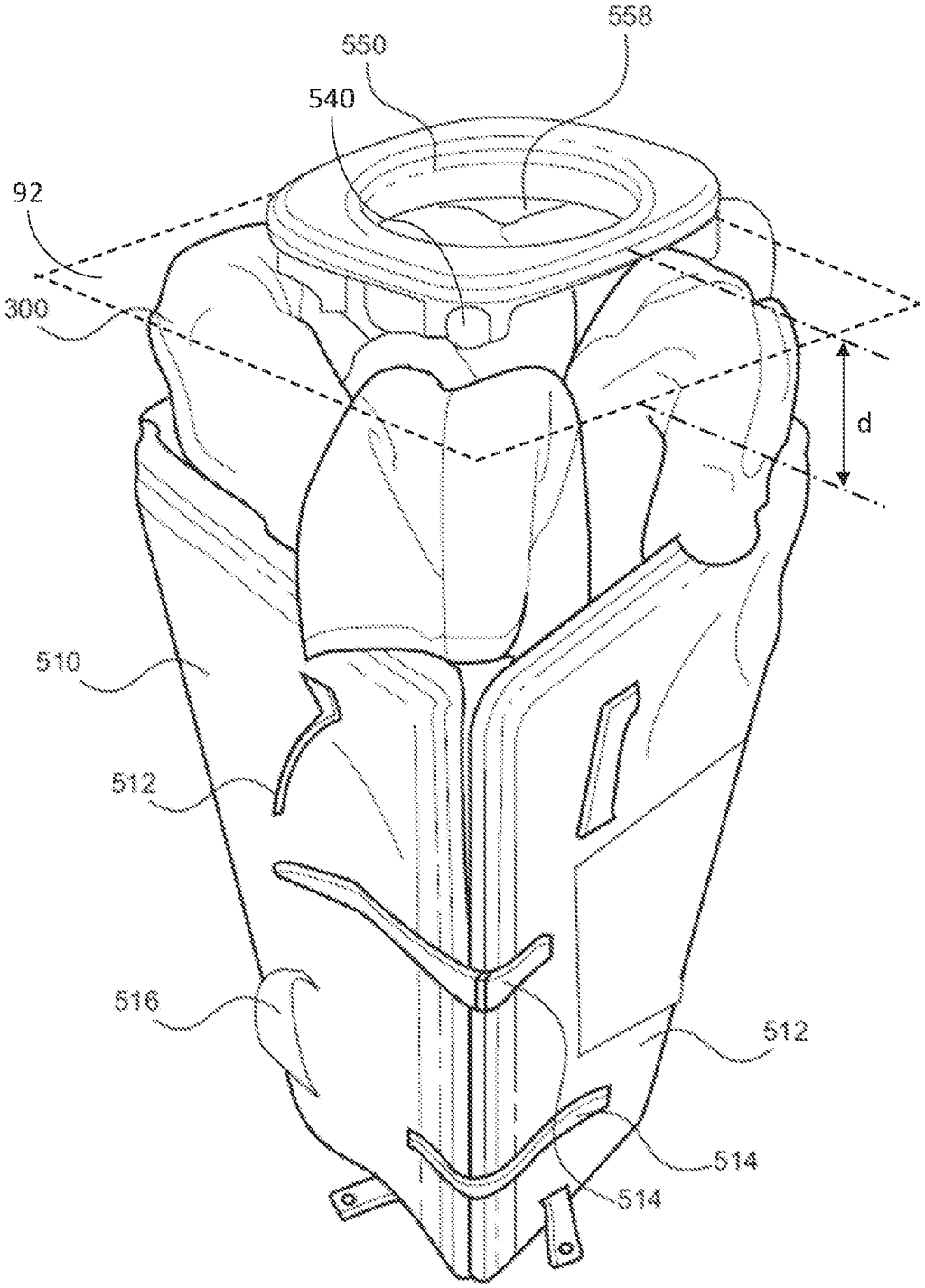

FIG. 58D shows a top perspective view of the playard and the bassinet accessory of FIG. 58C where the playard and the bassinet accessory are in a folded configuration.

Figure 59A:
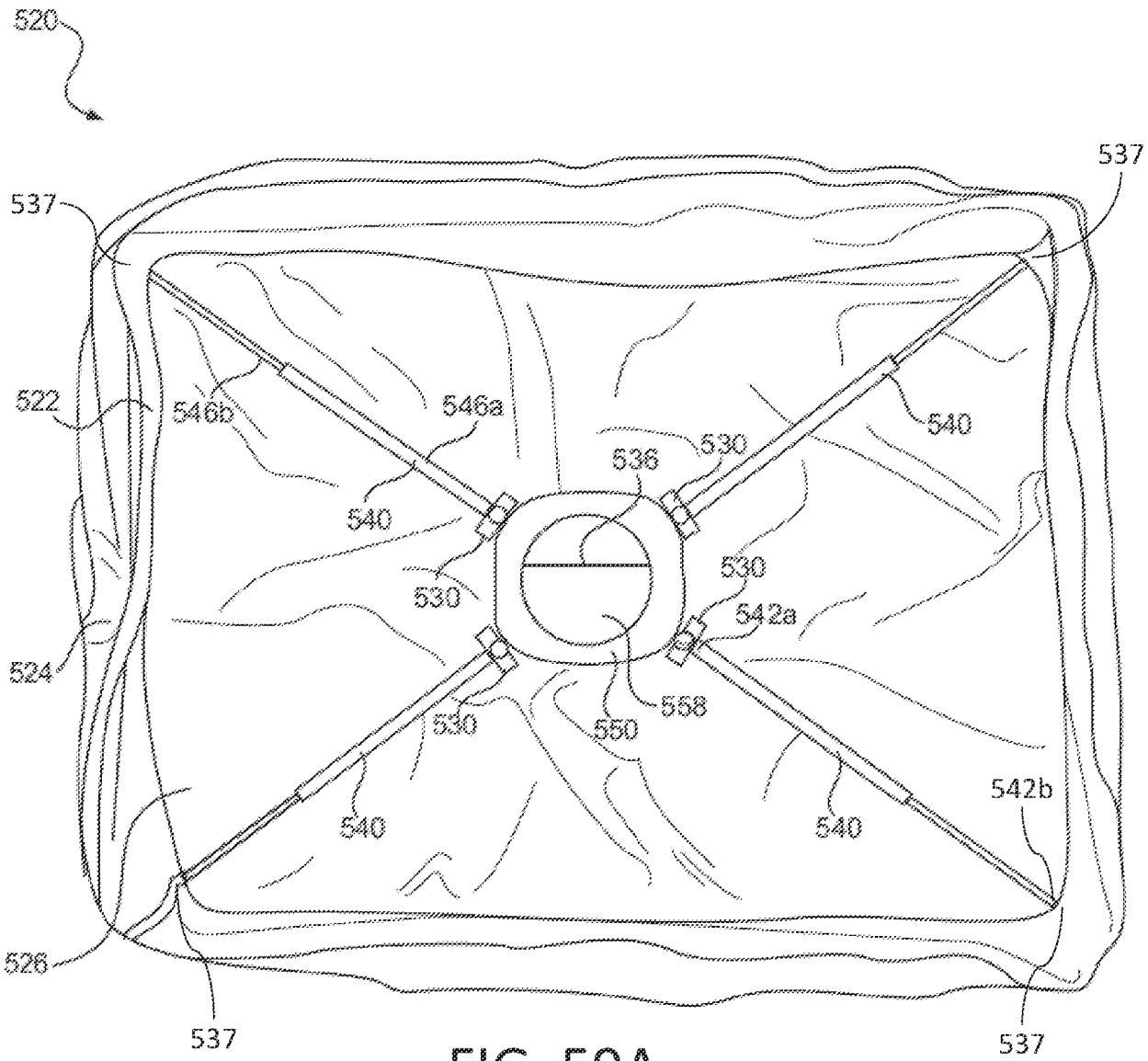

FIG. 59A shows a top view of the bassinet accessory of FIG. 57 in the unfolded configuration.

Figure 59B:
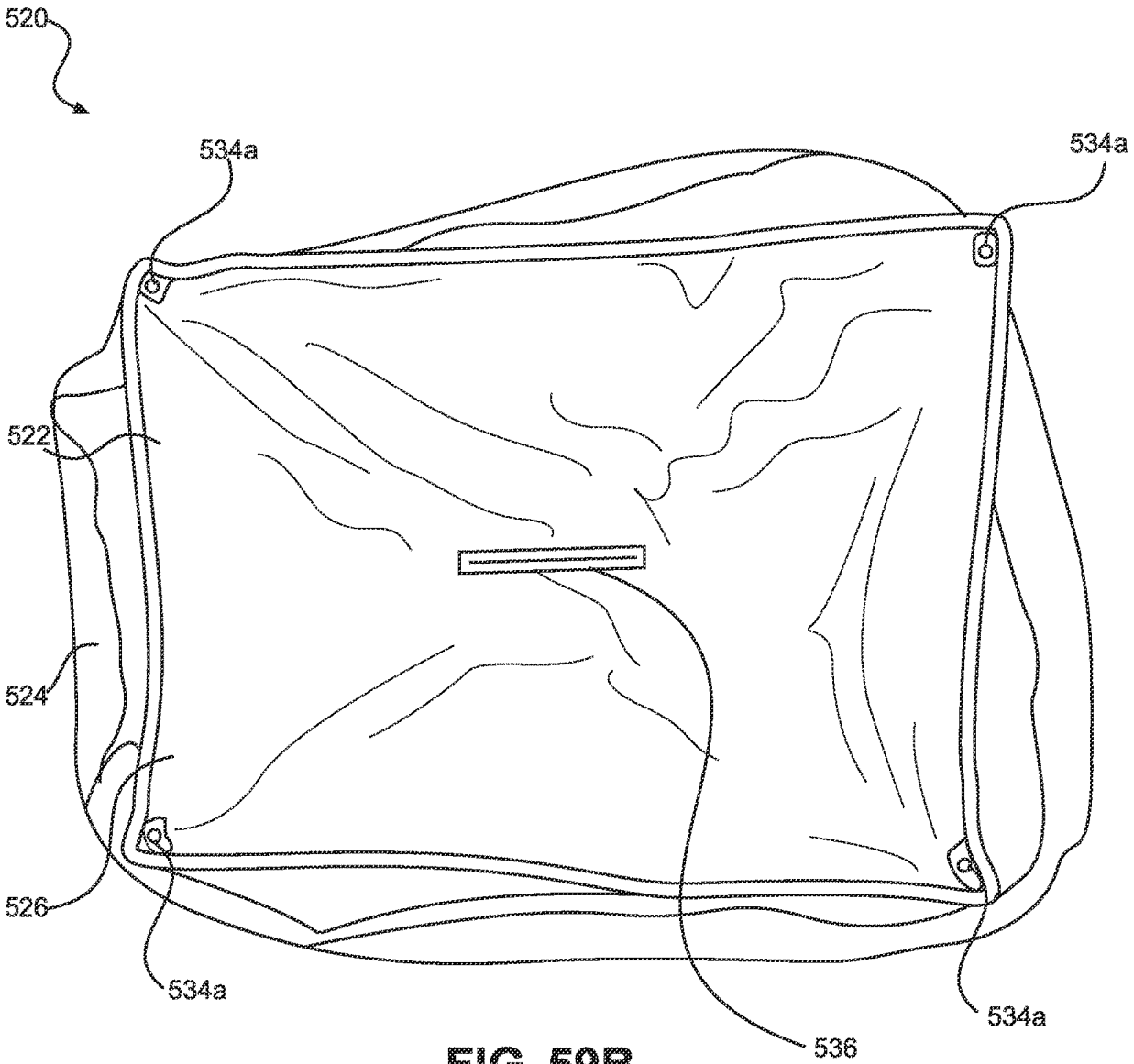

FIG. 59B shows a bottom view of the bassinet accessory of FIG. 59A in the unfolded configuration.

Figure 59C:
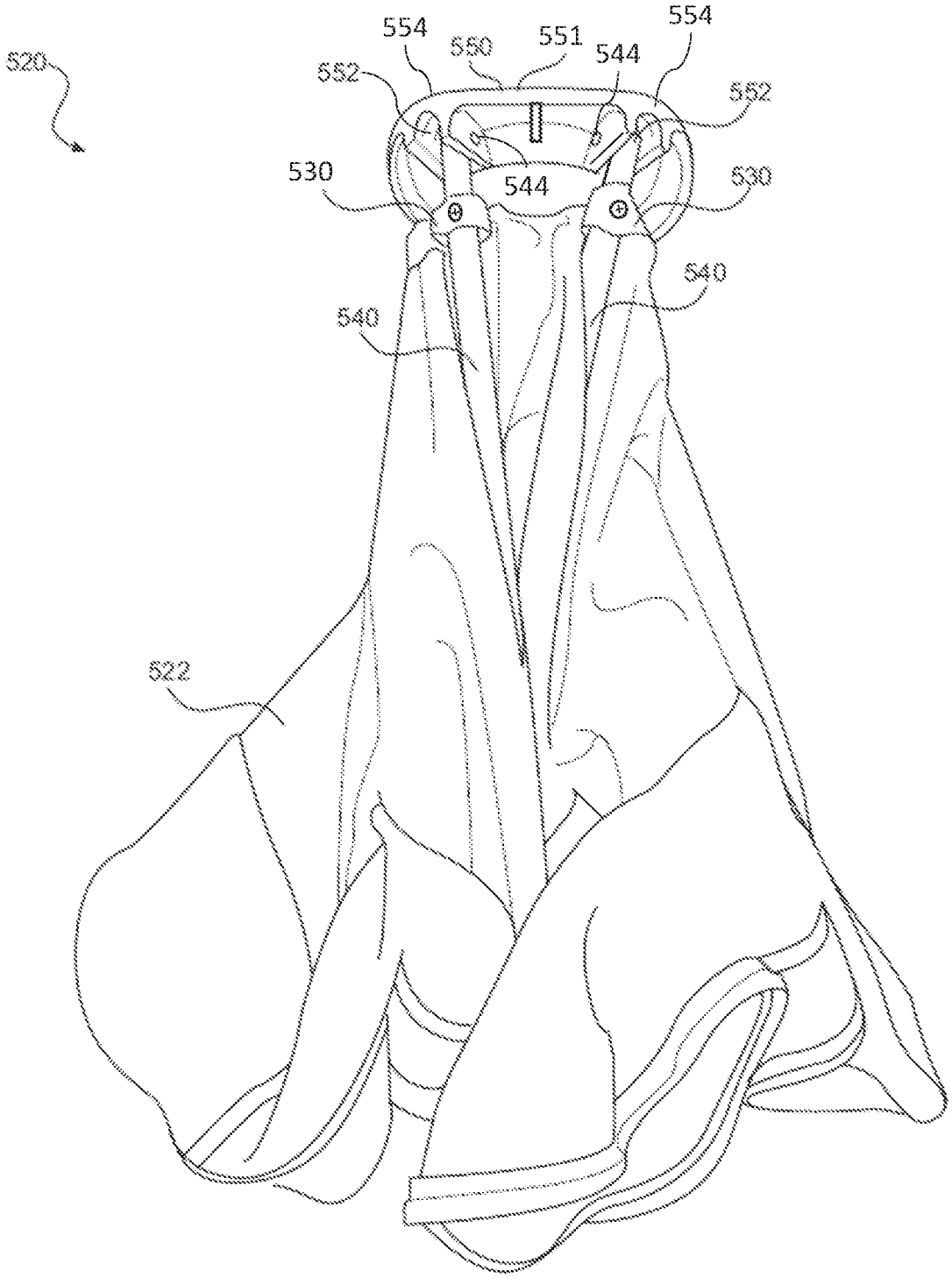

FIG. 59C shows a side view of the bassinet accessory of FIG. 59A in the folded configuration.

Figure 60A:
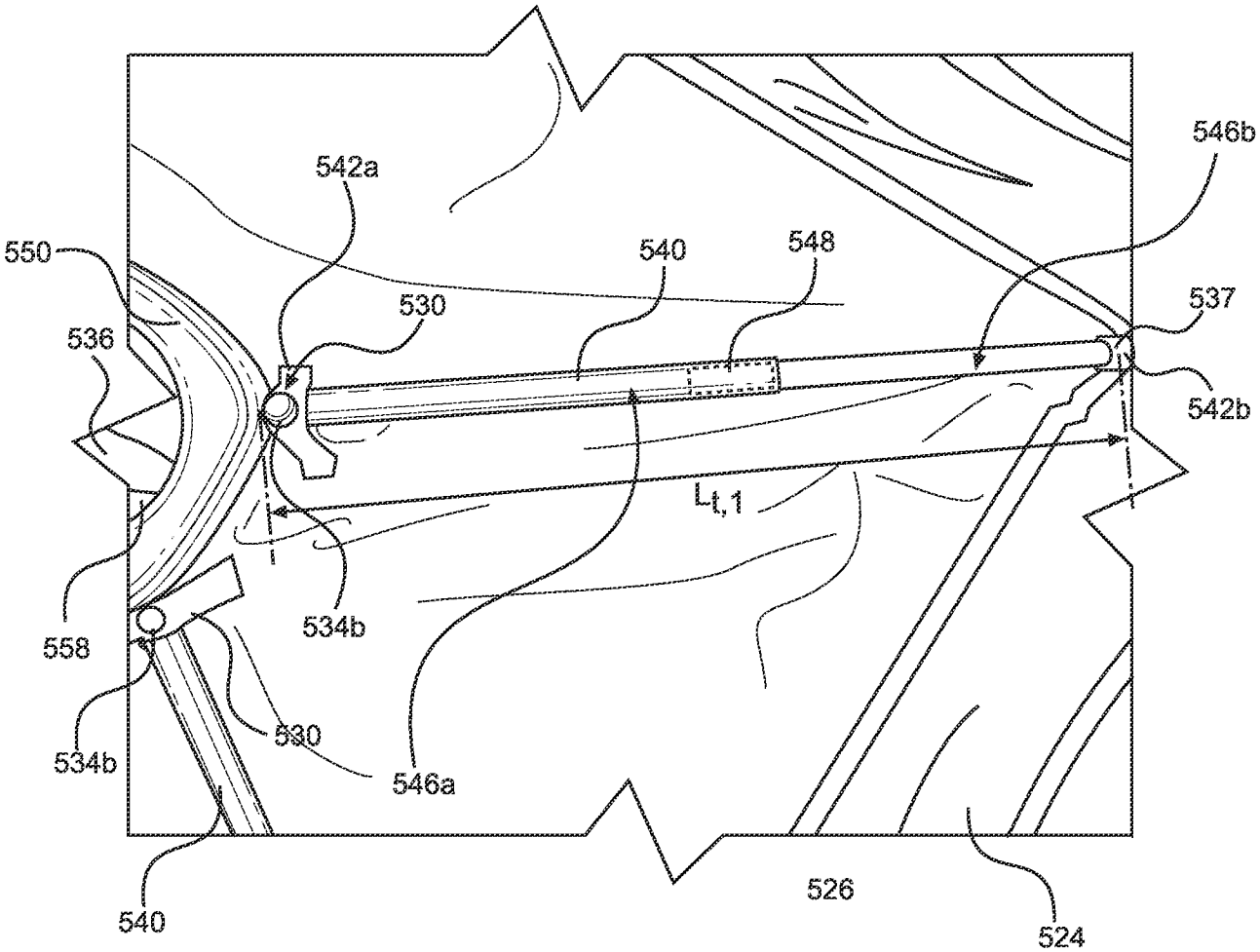

FIG. 60A shows a top view of a telescoping support tube in the bassinet accessory of FIG. 57 coupled to the hub and the bassinet soft goods where the support tube is in an extended state in the unfolded configuration.

Figure 60B:
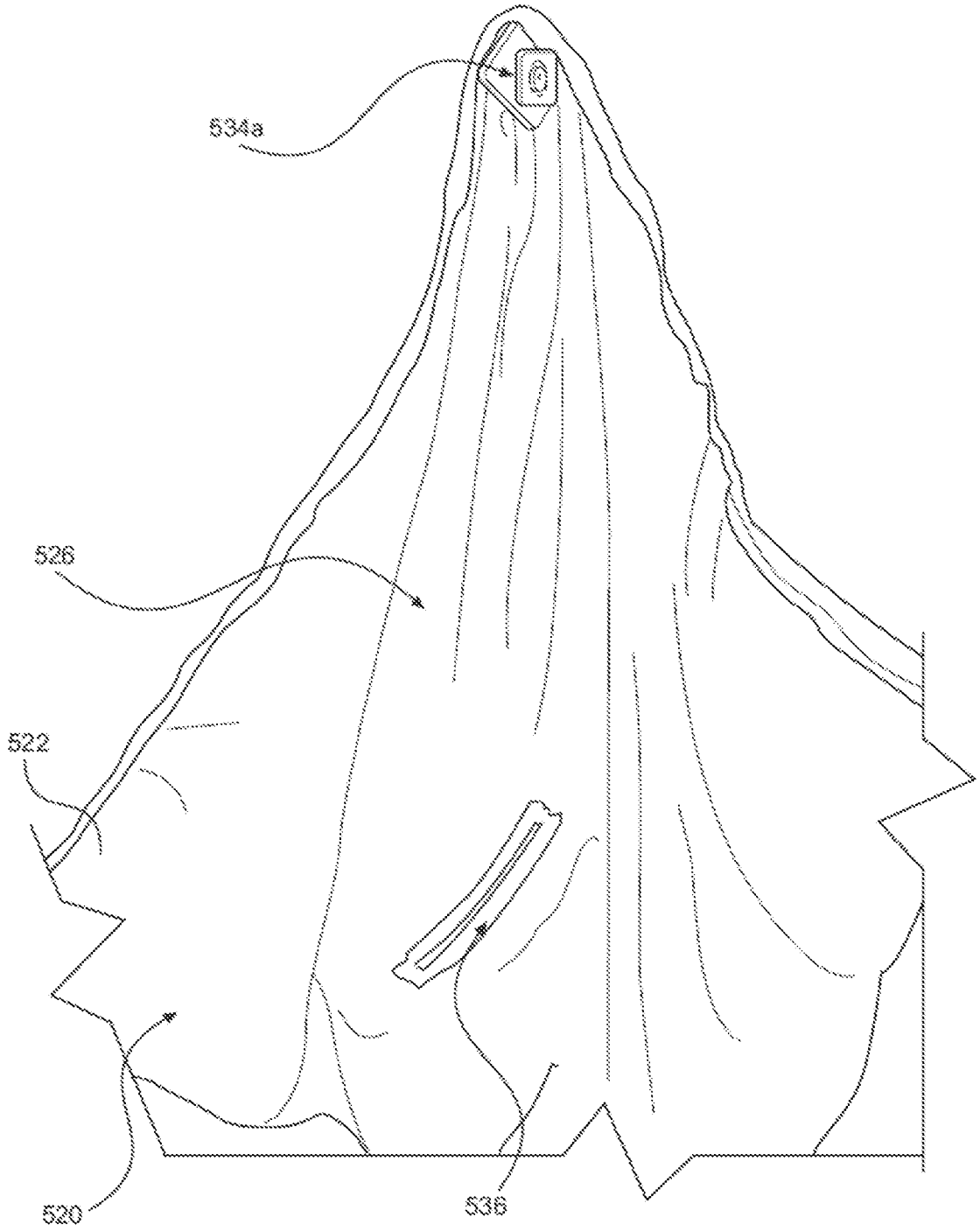

FIG. 60B shows a bottom view of the bassinet soft goods of FIG. 60A with the support tubes attached to the bassinet soft goods.

Figure 61:
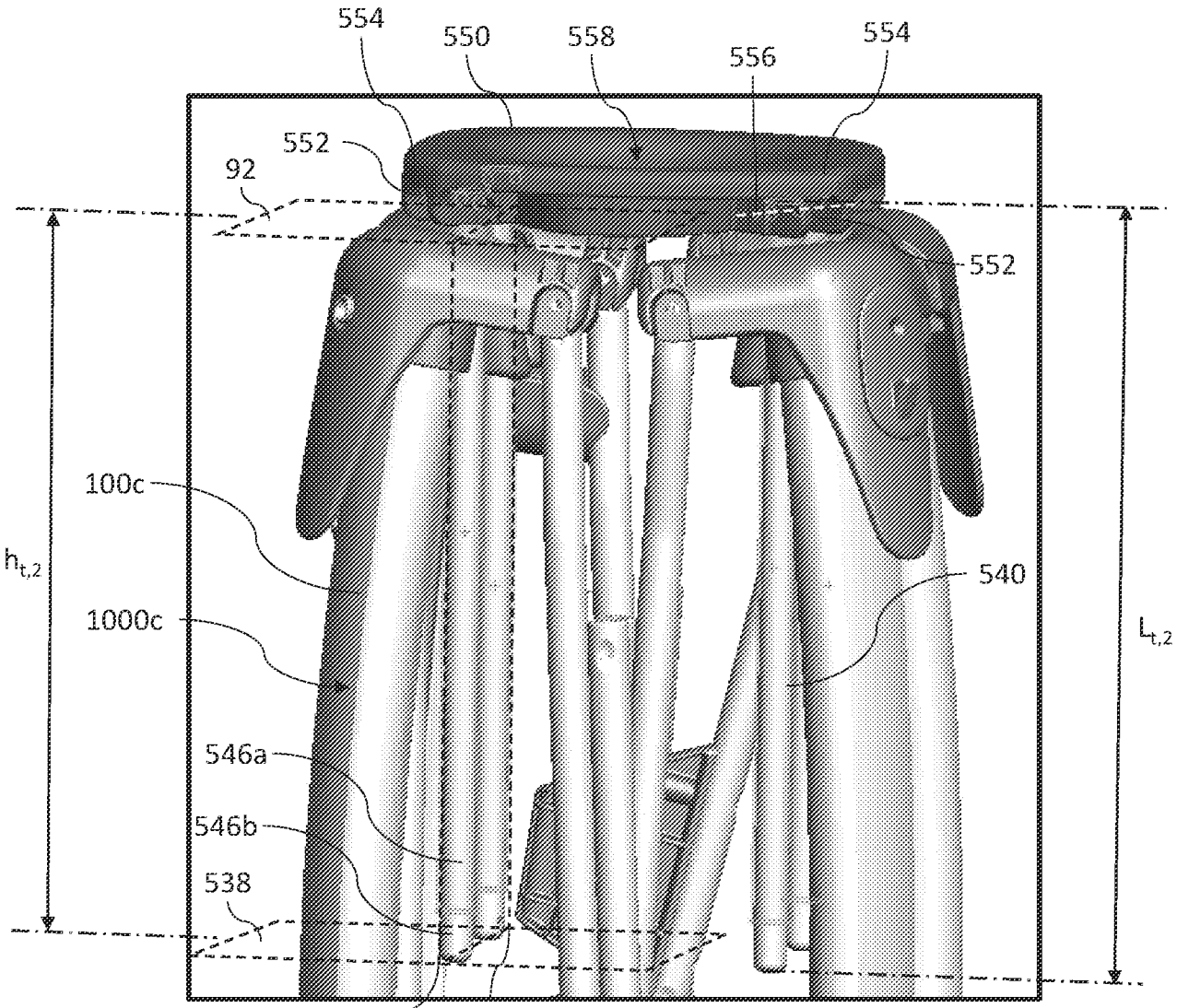

FIG. 61 shows a perspective view of the hub and the support tubes of FIG. 57 installed on the playard of FIG. 23A. The playard is shown in the folded configuration and the support tubes are in a contracted state.

Figure 62A:
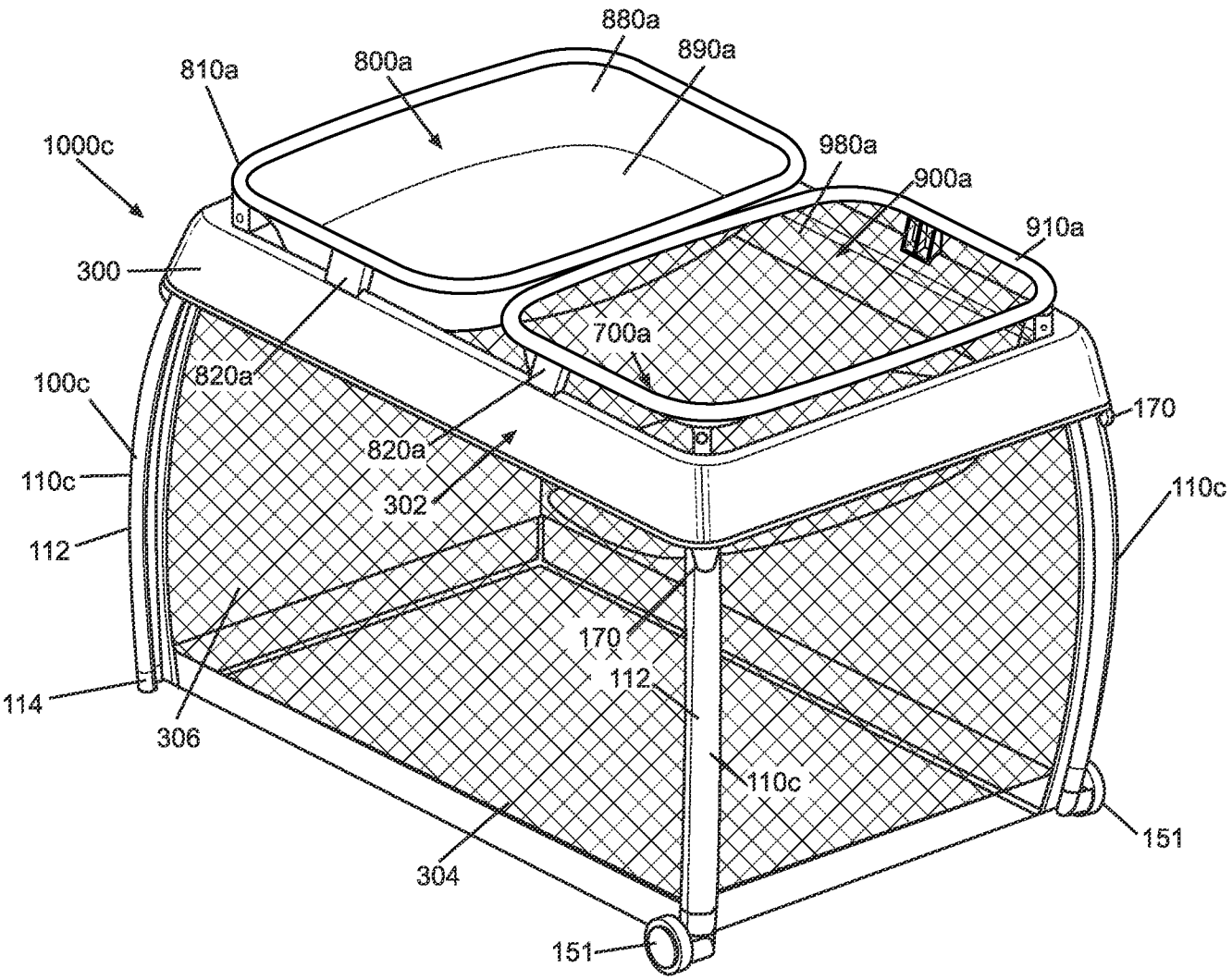

FIG. 62A shows a top, front, right perspective view of the playard of FIG. 23A without the bassinet accessory of FIG. 50A where the playard is in the unfolded configuration. The playard includes an exemplary changing table topper and an exemplary bassinet topper without a canopy installed on the playard frame.

Figure 62B:
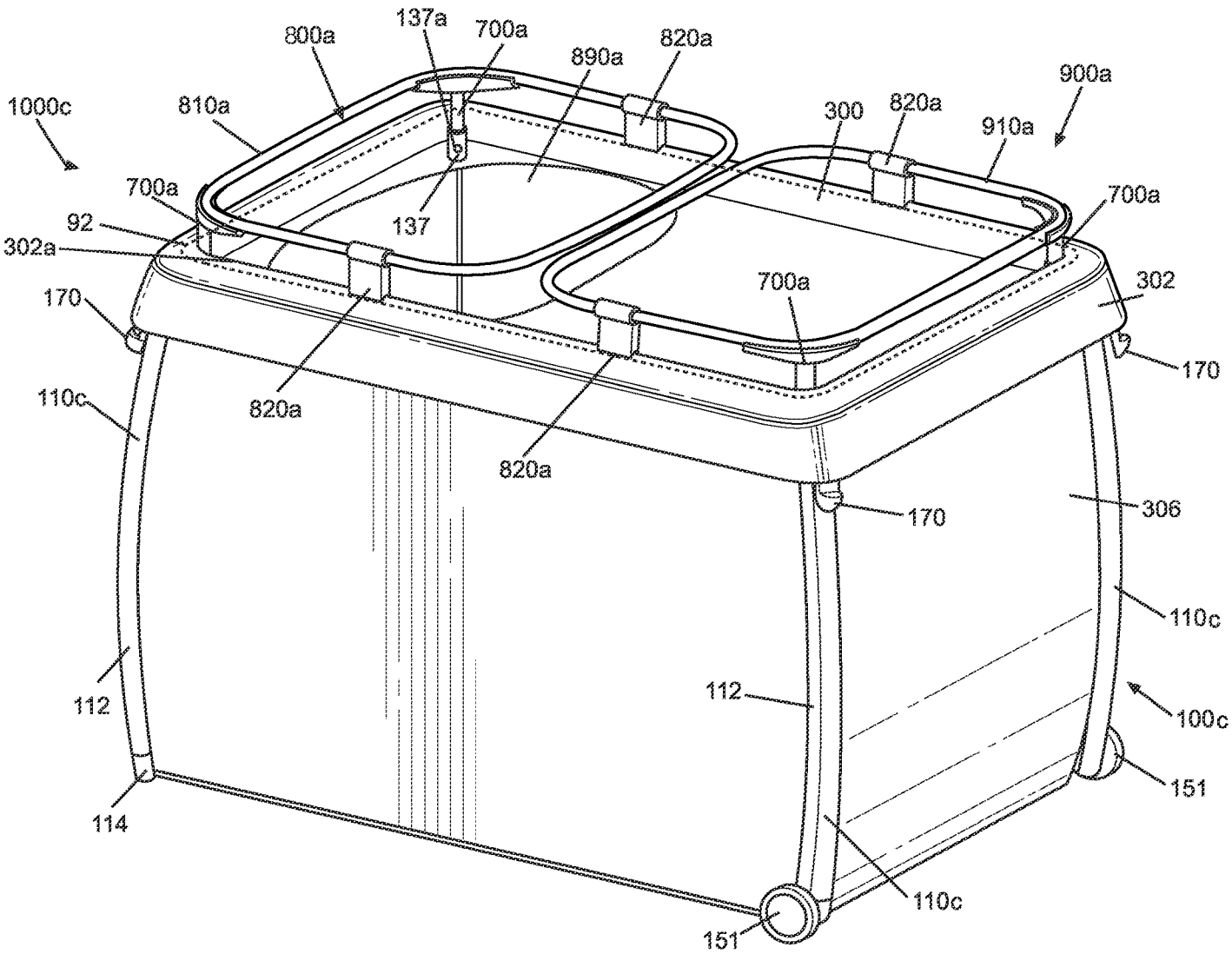

FIG. 62B shows another top, front, right perspective view of the playard of FIG. 62A where the soft goods of the changing table topper and the bassinet topper are removed to show the respective topper frames.

Figure 62C:
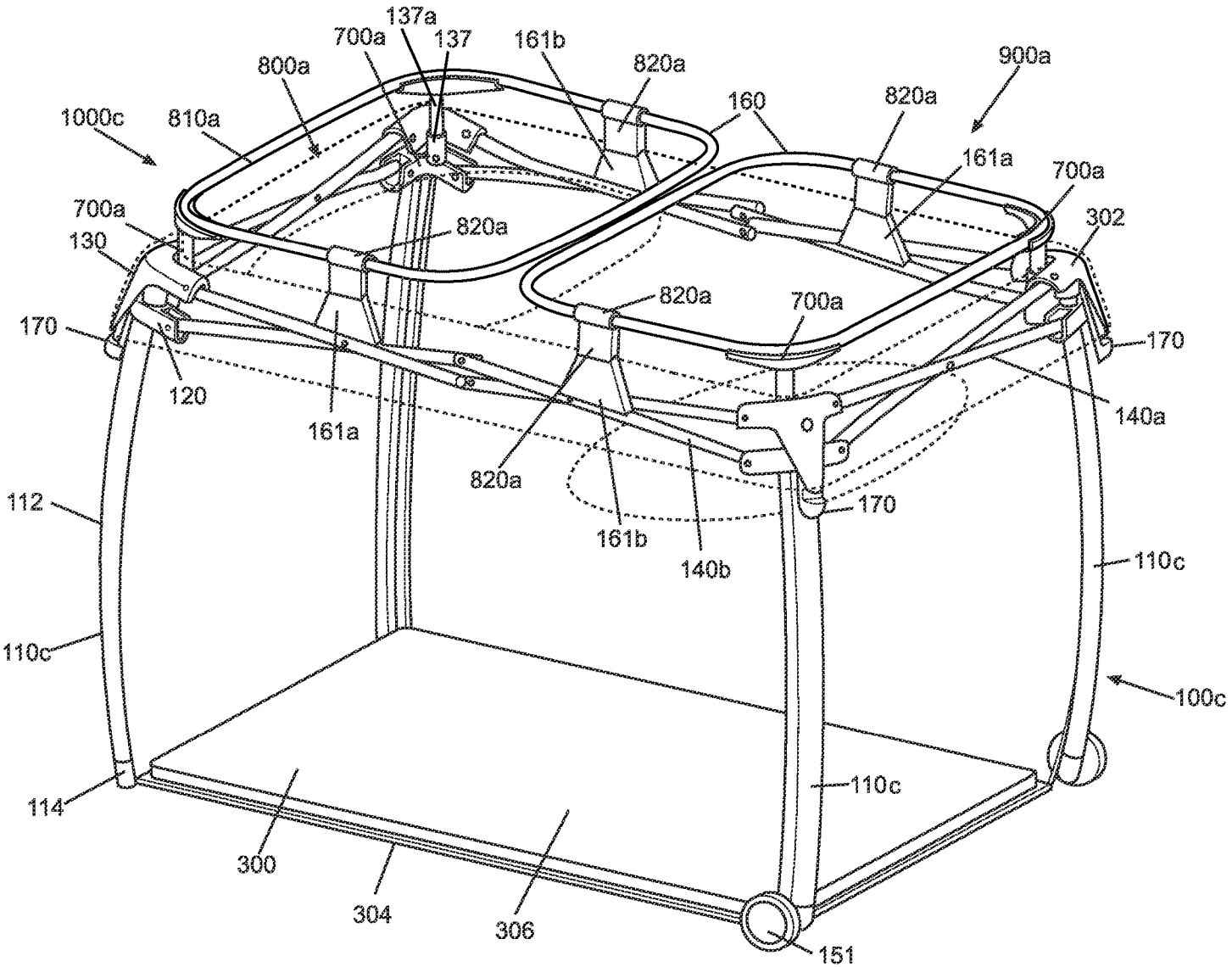

FIG. 62C shows another top, front, right perspective view of the playard of FIG. 62B where the soft goods of the playard is transparent to show the playard frame coupled to the respective topper frames.

Figure 62D:
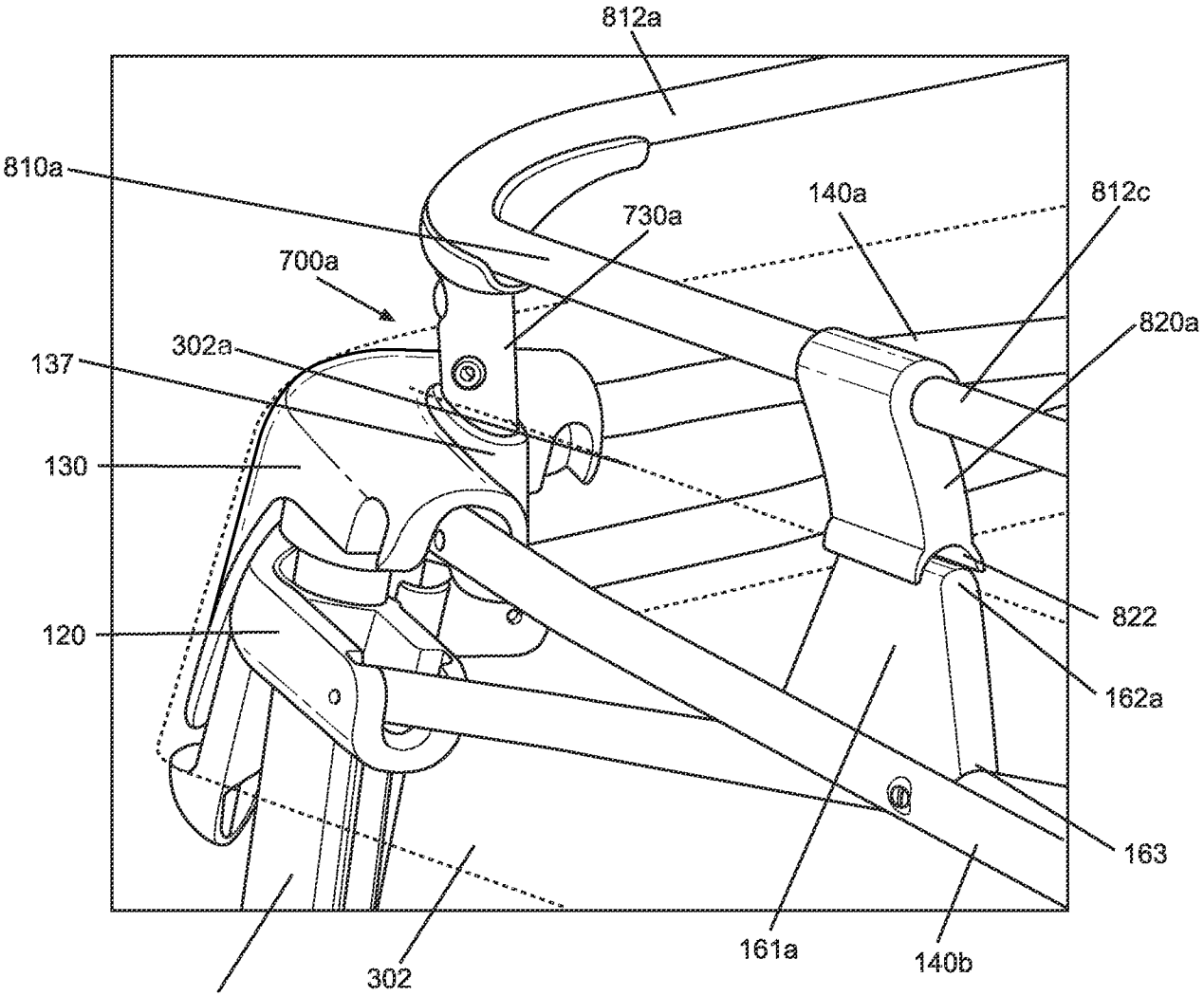

FIG. 62D shows a magnified top, front, right perspective view of a corner assembly of one topper in FIG. 62A to couple the topper to the playard frame.

Figure 62E:
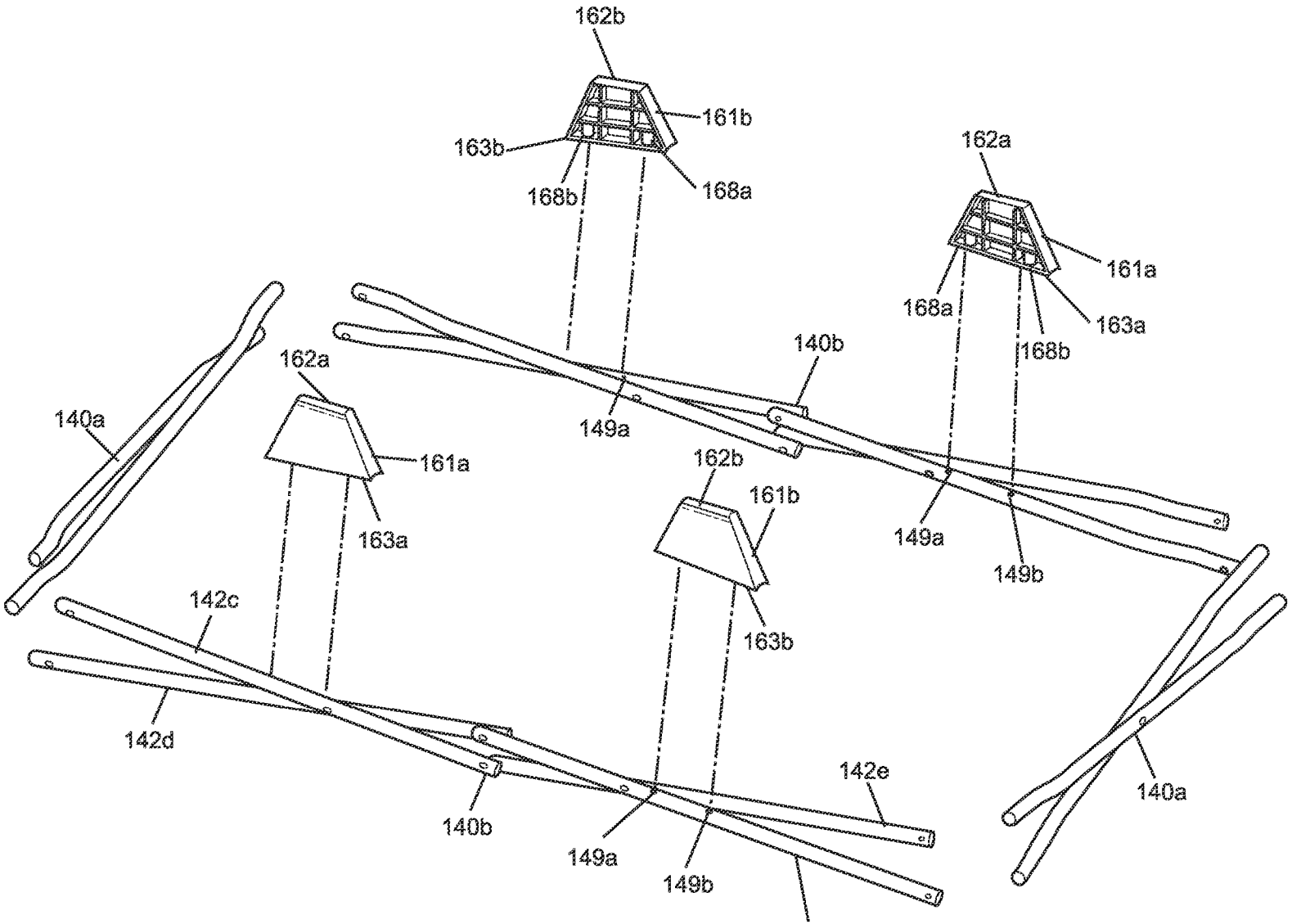

FIG. 62E shows an exploded view of the X-frame assemblies and topper supports in the playard of FIG. 62A.

Figure 62F:
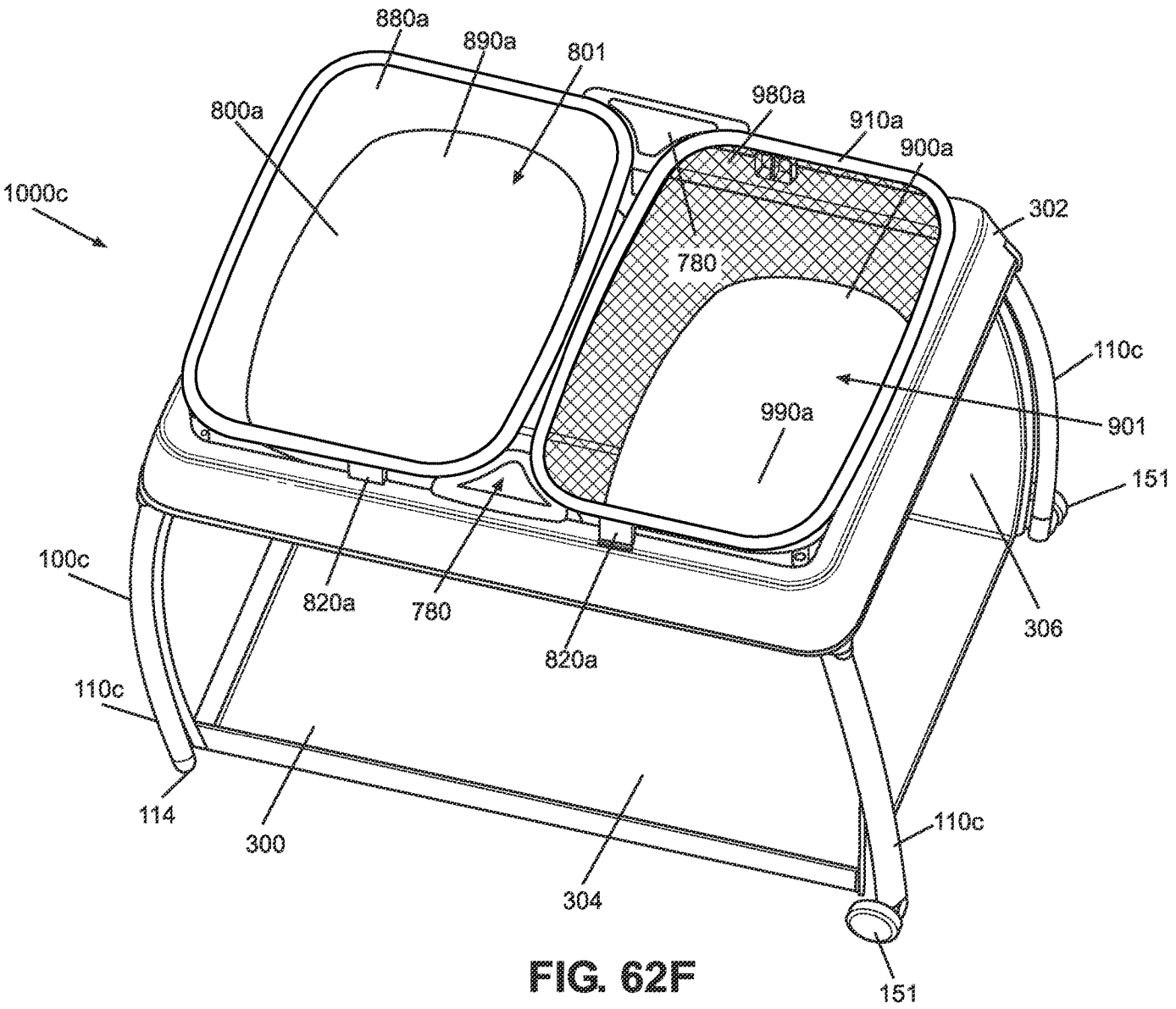

FIG. 62F shows a top, front, right perspective view of the playard of FIG. 62A with exemplary storage pockets installed between the toppers.

Figure 63A:
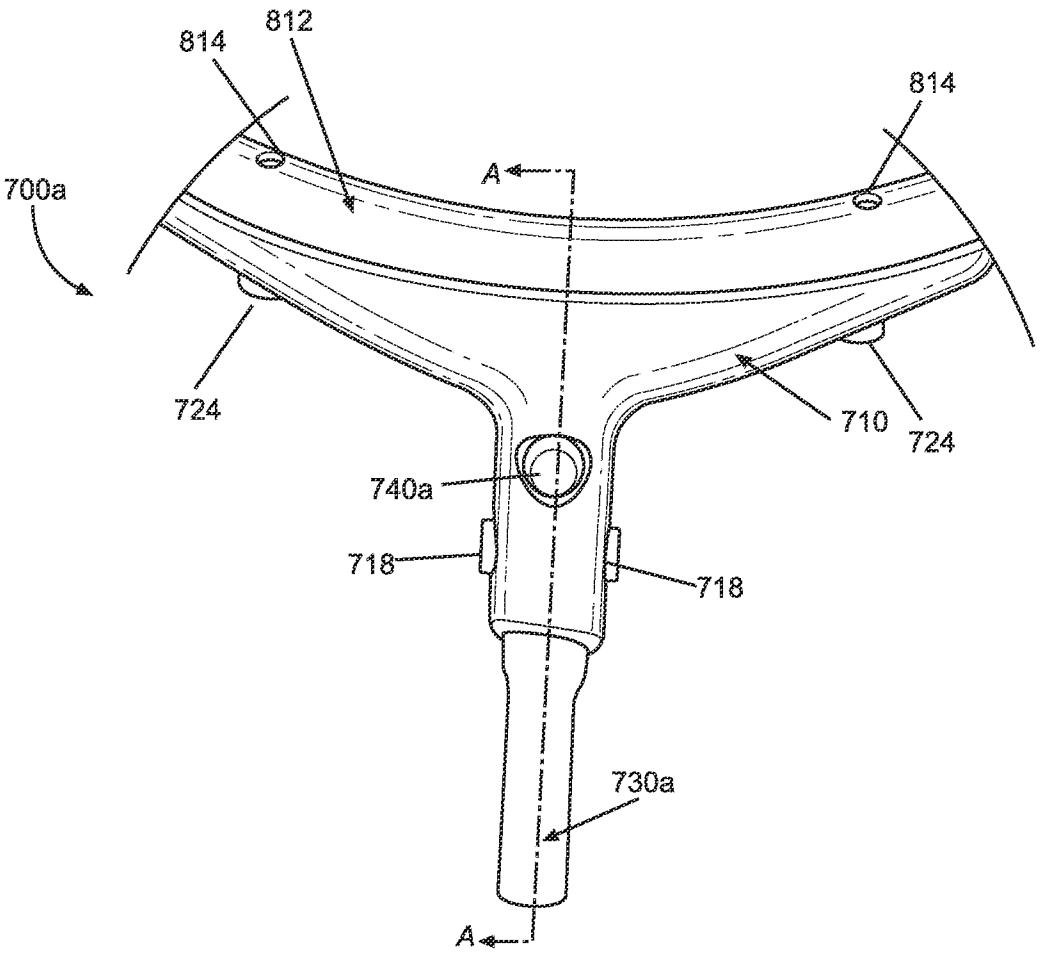

FIG. 63A shows a top, front, left perspective view of the corner assembly of FIG. 62D with a flexible finger.

Figure 63B:
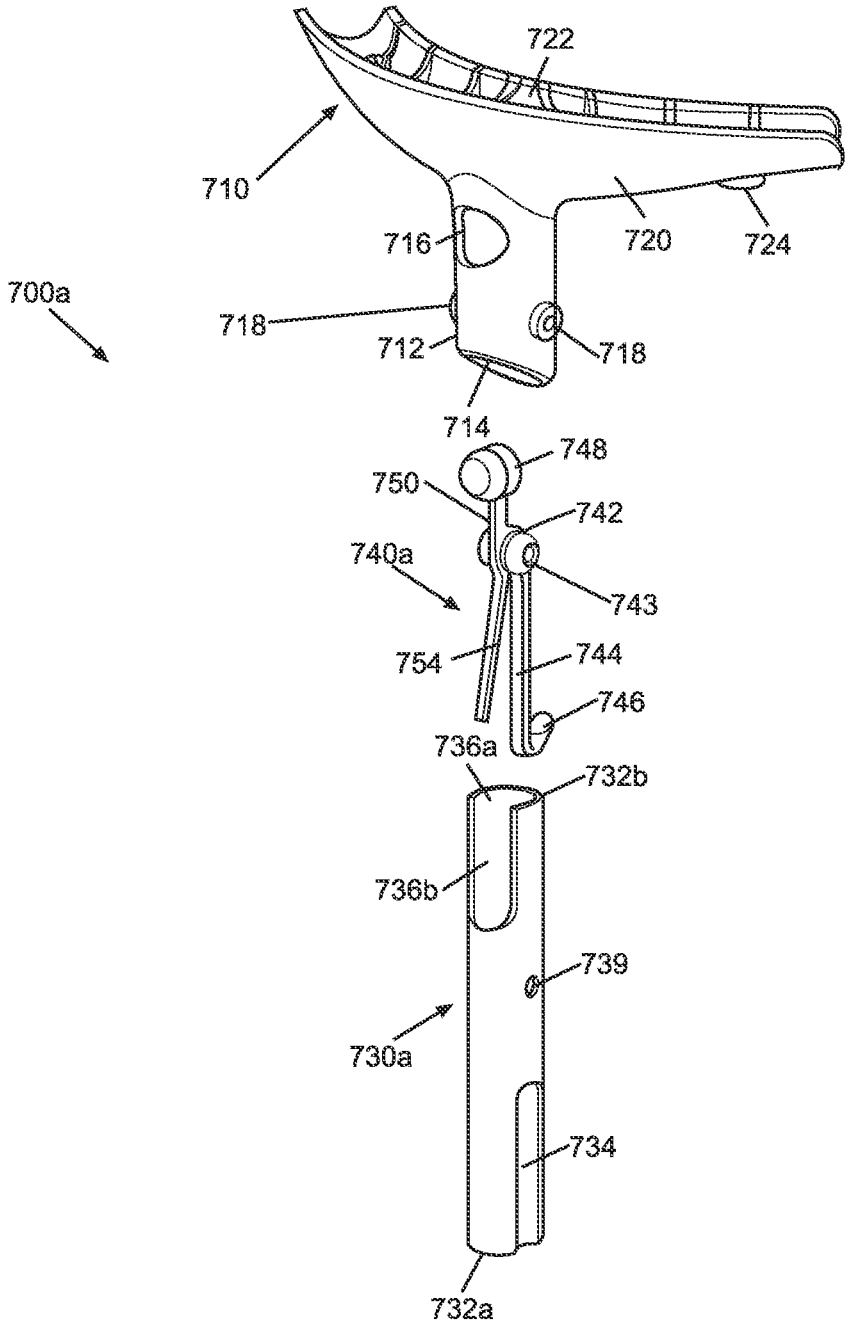

FIG. 63B shows an exploded top, front, left perspective view of the corner assembly of FIG. 63A.

Figure 63C:
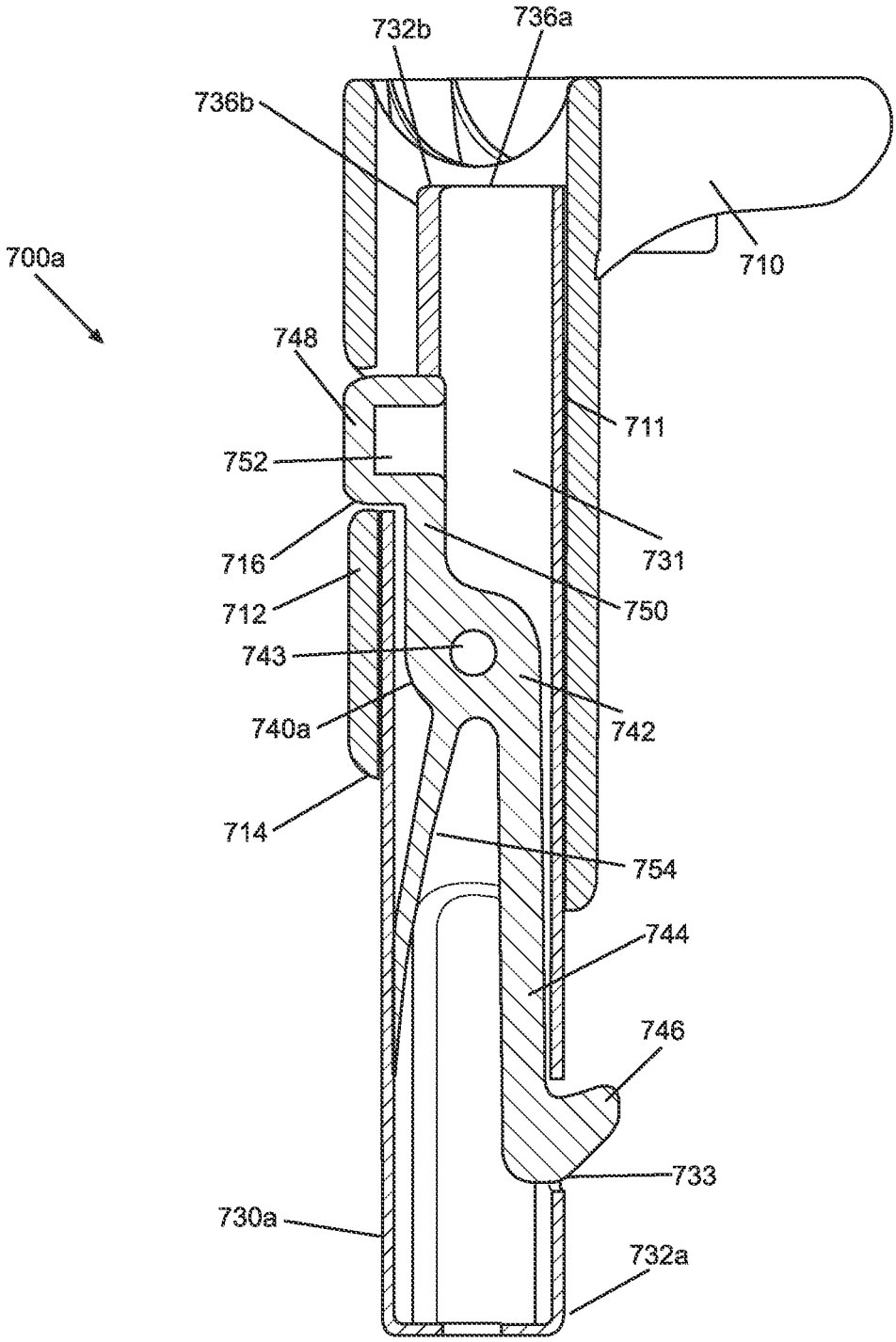

FIG. 63C shows a cross-sectional view of the corner assembly corresponding to the plane A-A of FIG. 63A.

Figure 63D:
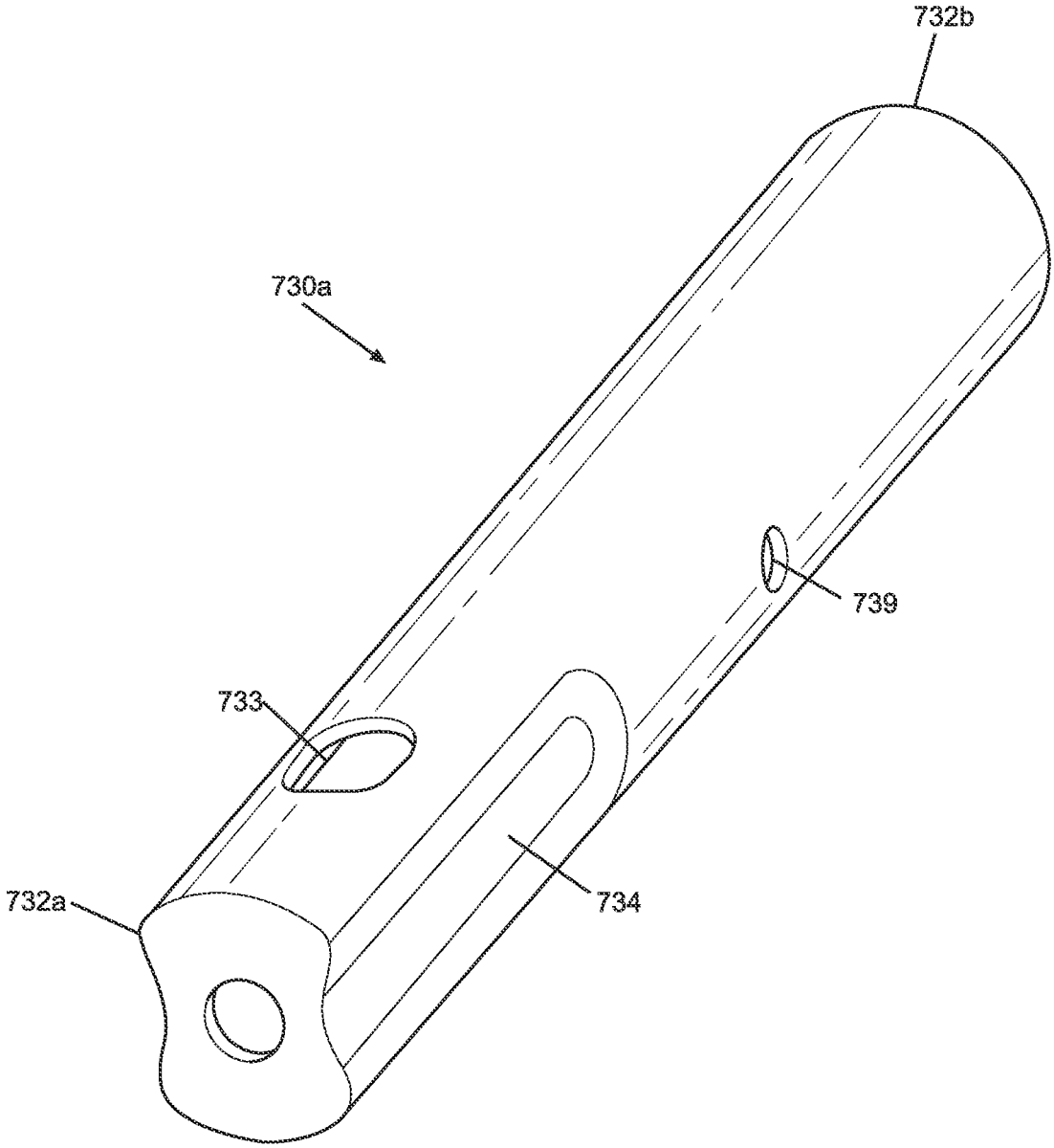

FIG. 63D shows a perspective view of a corner tube in the corner assembly of FIG. 63A.

Figure 64:
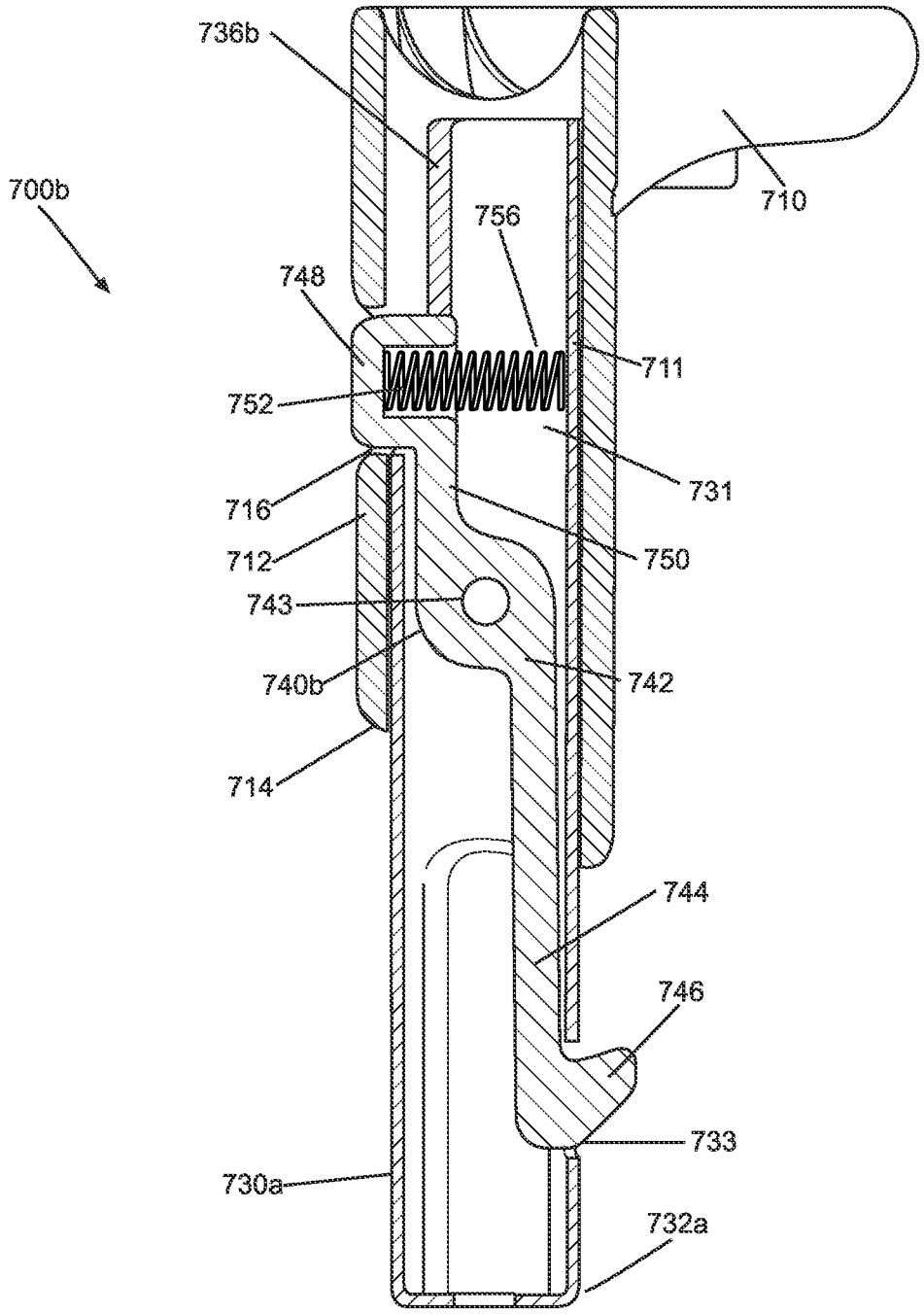

FIG. 64 shows a cross-sectional view of another exemplary corner assembly with a spring.

Figure 65:
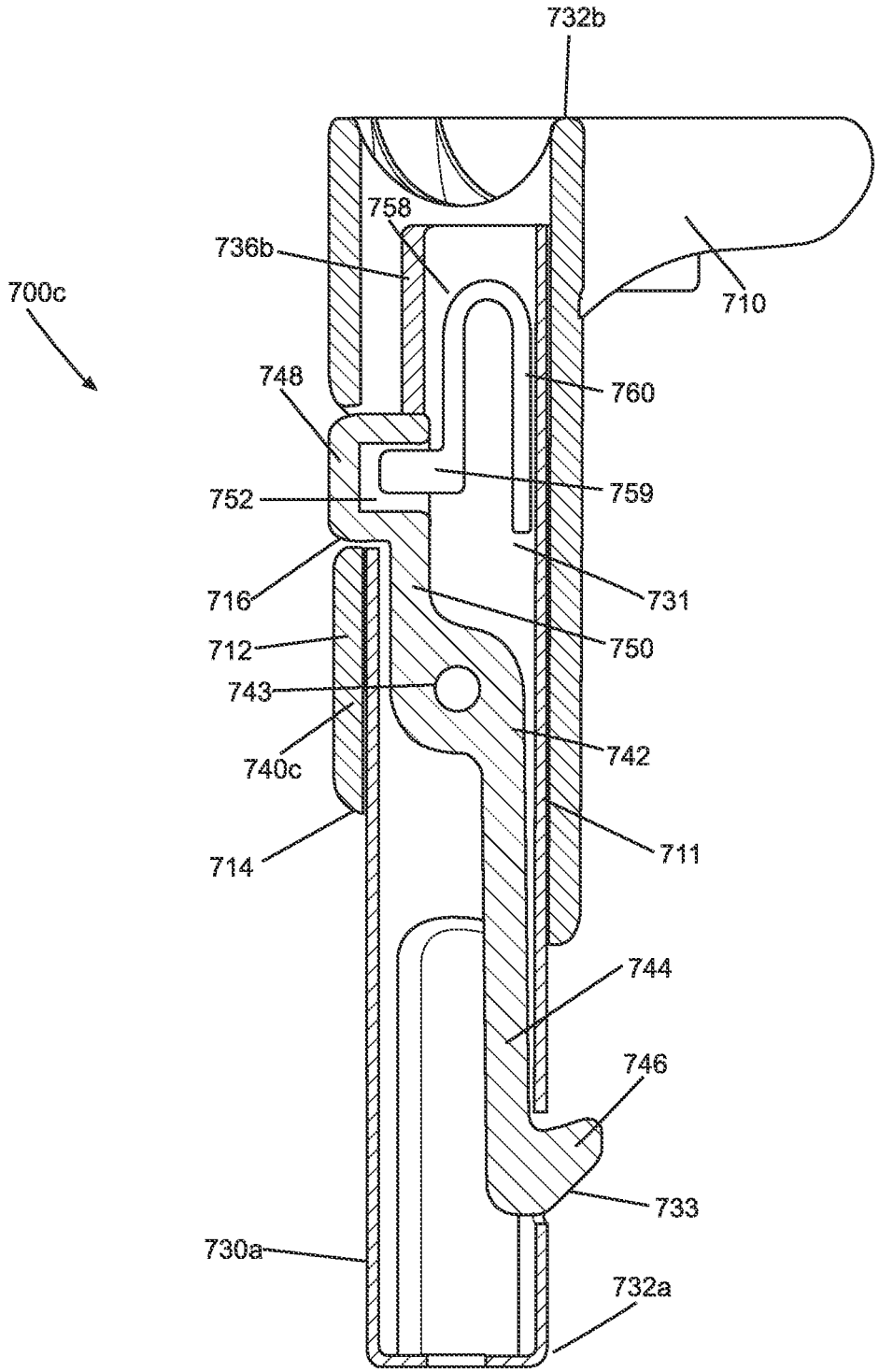

FIG. 65 shows a cross-sectional view of another exemplary corner assembly with a snap button.

Figure 66:
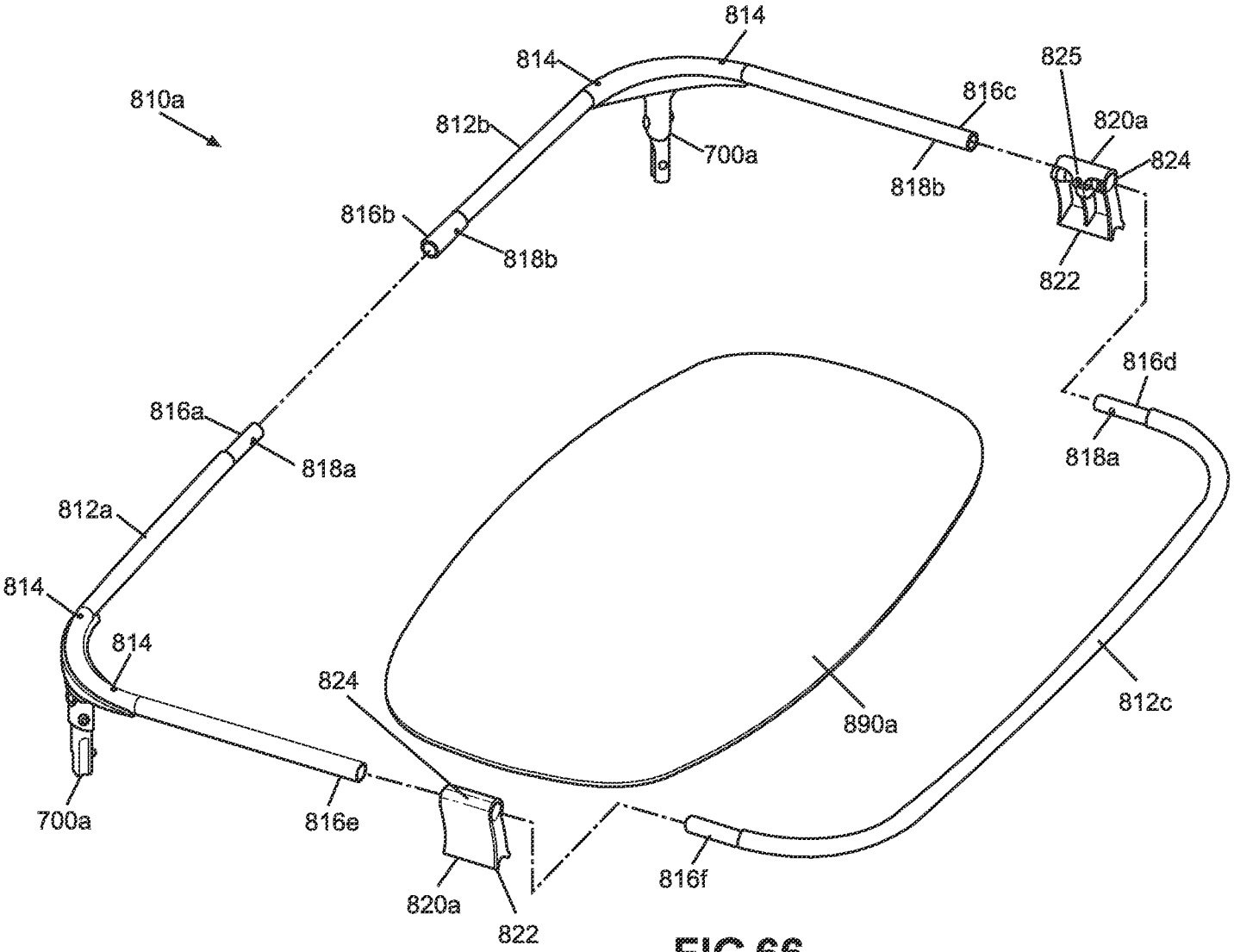

FIG. 66 shows an exploded top, front, right perspective view of a frame for the changing table topper of FIG. 62A.

Figure 67:
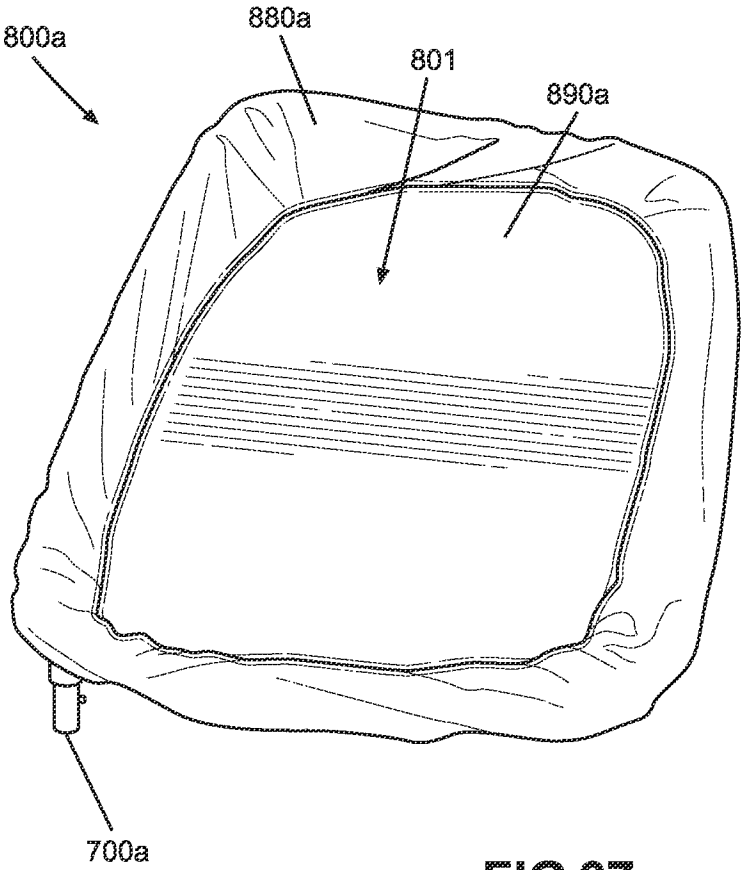

FIG. 67 shows a perspective view of the changing table topper of FIG. 62A.

Figure 68:
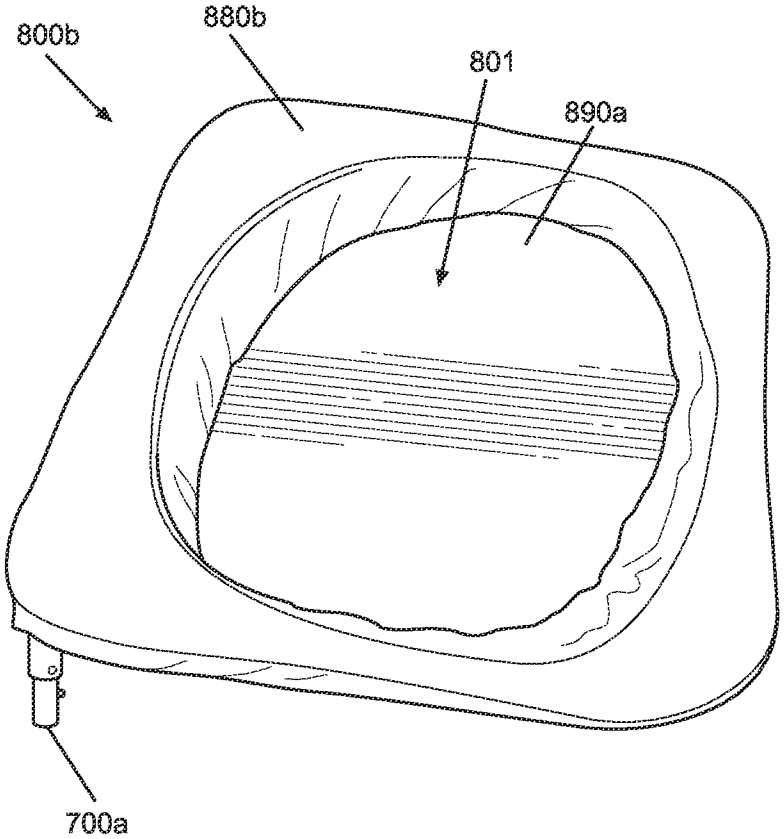

FIG. 68 shows a perspective view of another exemplary changing table topper with a smaller support platform than the topper of FIG. 67.

Figure 69:
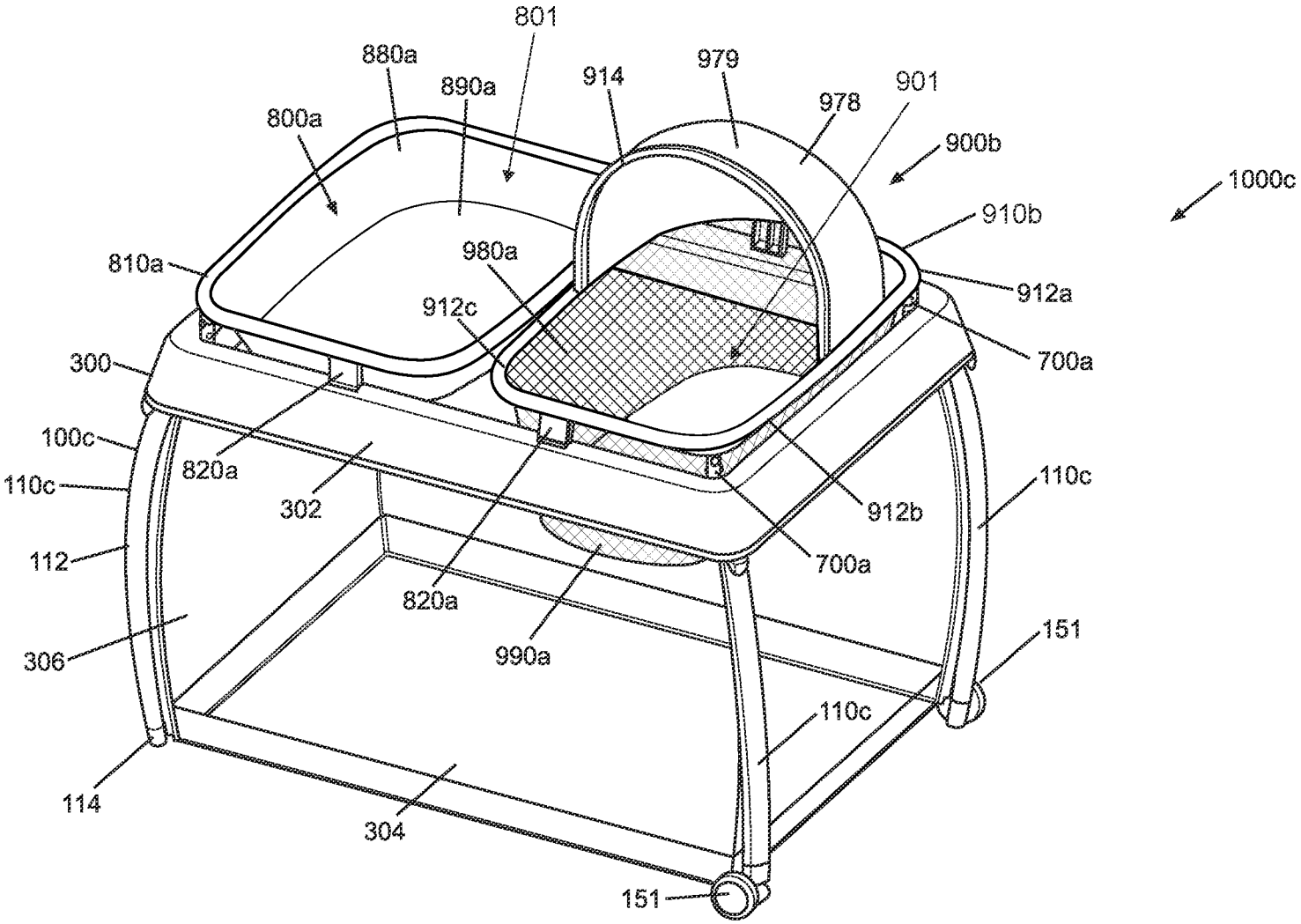

FIG. 69 shows a top, front, right perspective view of the playard of FIG. 23A without the bassinet accessory where the playard is in the unfolded configuration. The playard includes an exemplary changing table topper and an exemplary bassinet topper with a canopy mounted to the playard frame.

Figure 70:
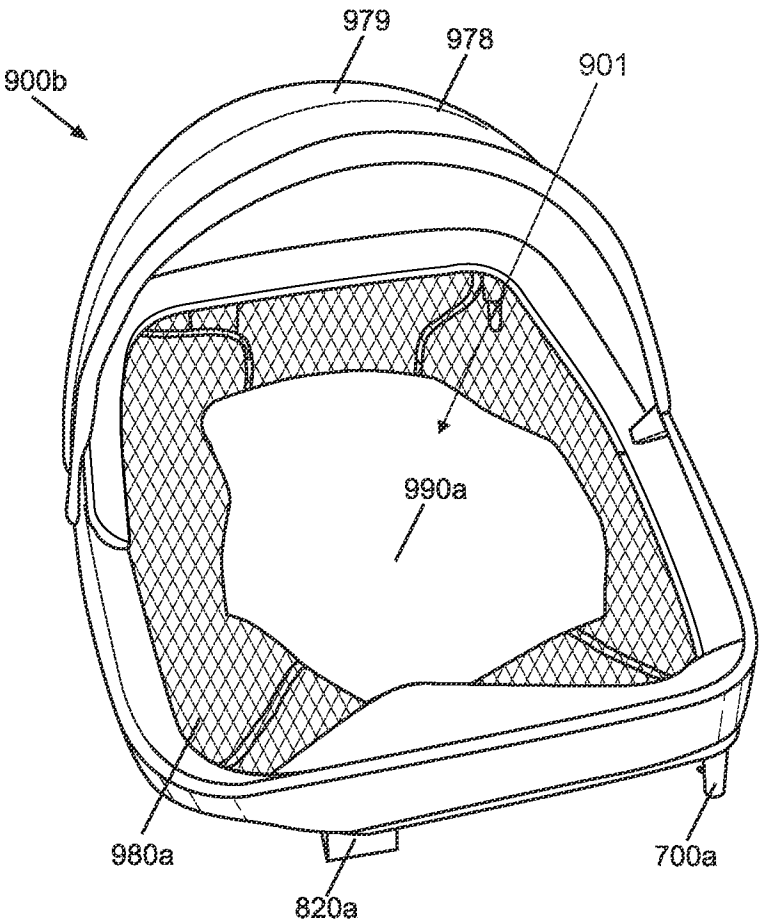

FIG. 70 shows a perspective view of the bassinet topper of FIG. 69.

Figure 71:
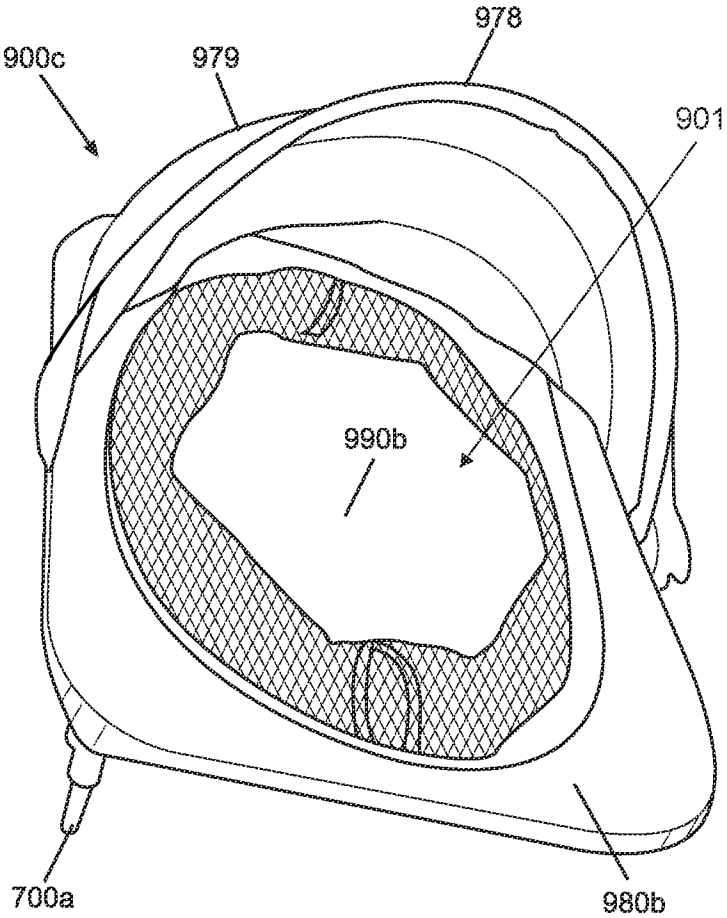

FIG. 71 shows a perspective view of another exemplary bassinet topper with a canopy where the support platform is smaller than the topper of FIG. 70.

Figure 72A:
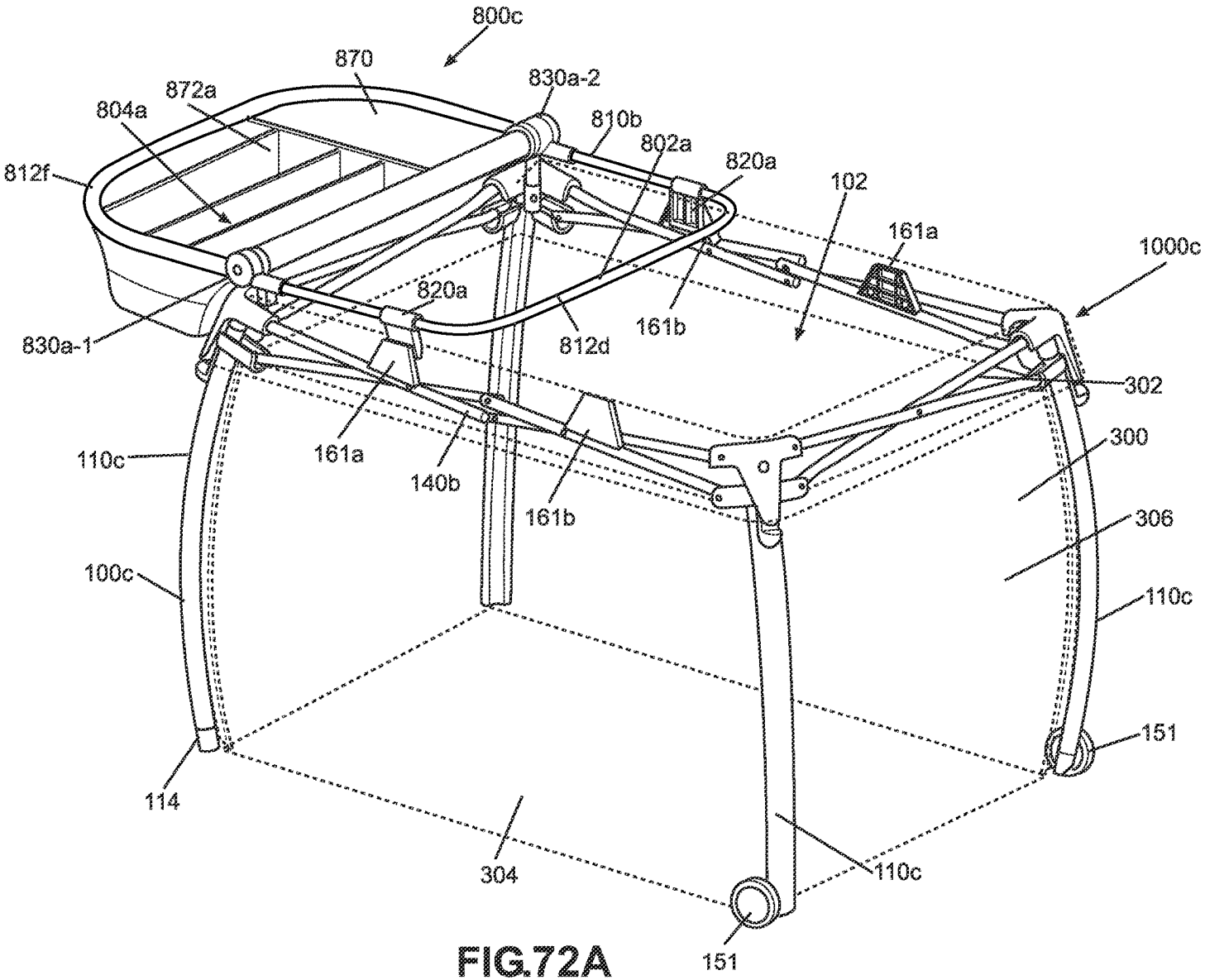

FIG. 72A shows a top, front, right perspective view of the playard of FIG. 23A without the bassinet accessory of FIG. 50A where the playard is in the unfolded configuration. The playard includes an exemplary topper mounted to the playard frame with a stationary changing table section and a rotatable organizer section. The topper is shown in a first configuration.

Figure 72B:
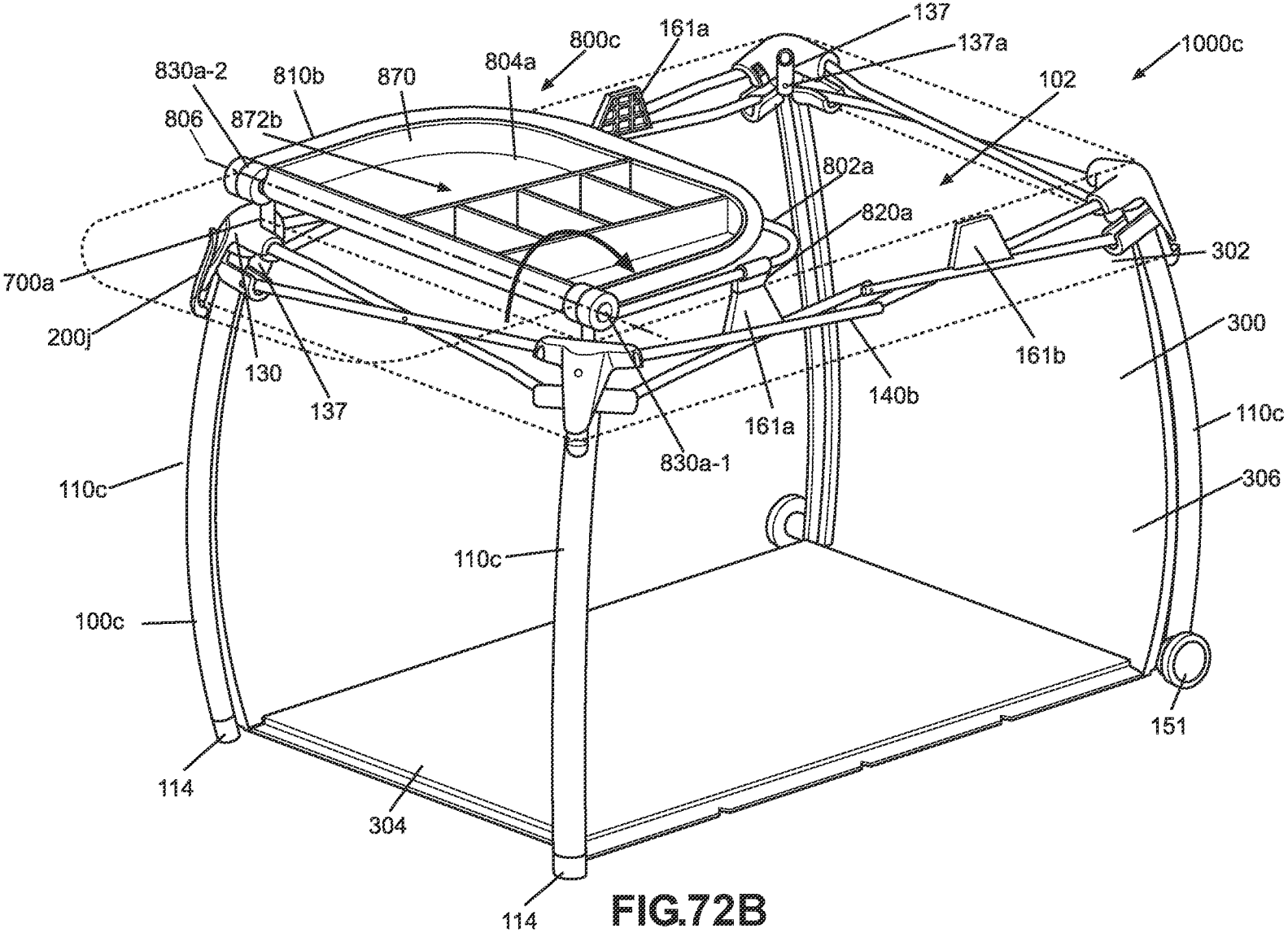

FIG. 72B shows a top, front, left perspective view of the playard of FIG. 72A where the topper is shown in a second configuration with the organizer section rotated to cover the changing table section.

Figure 72C:
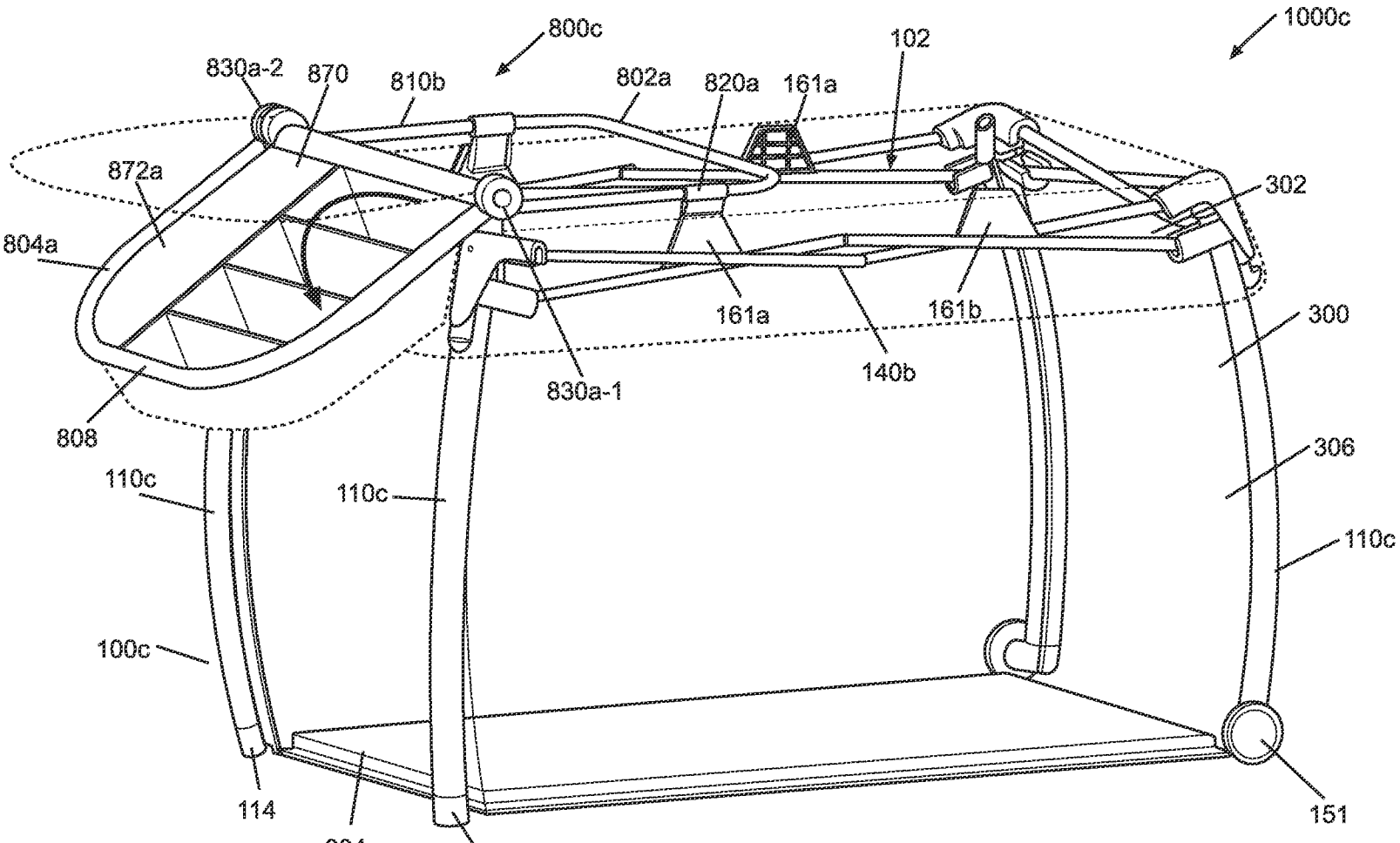

FIG. 72C shows a top, front, left perspective view of the playard of FIG. 72A where the topper is shown in a breakaway configuration with the organizer section rotated downwards towards the floor of the playard.

Figure 73A:
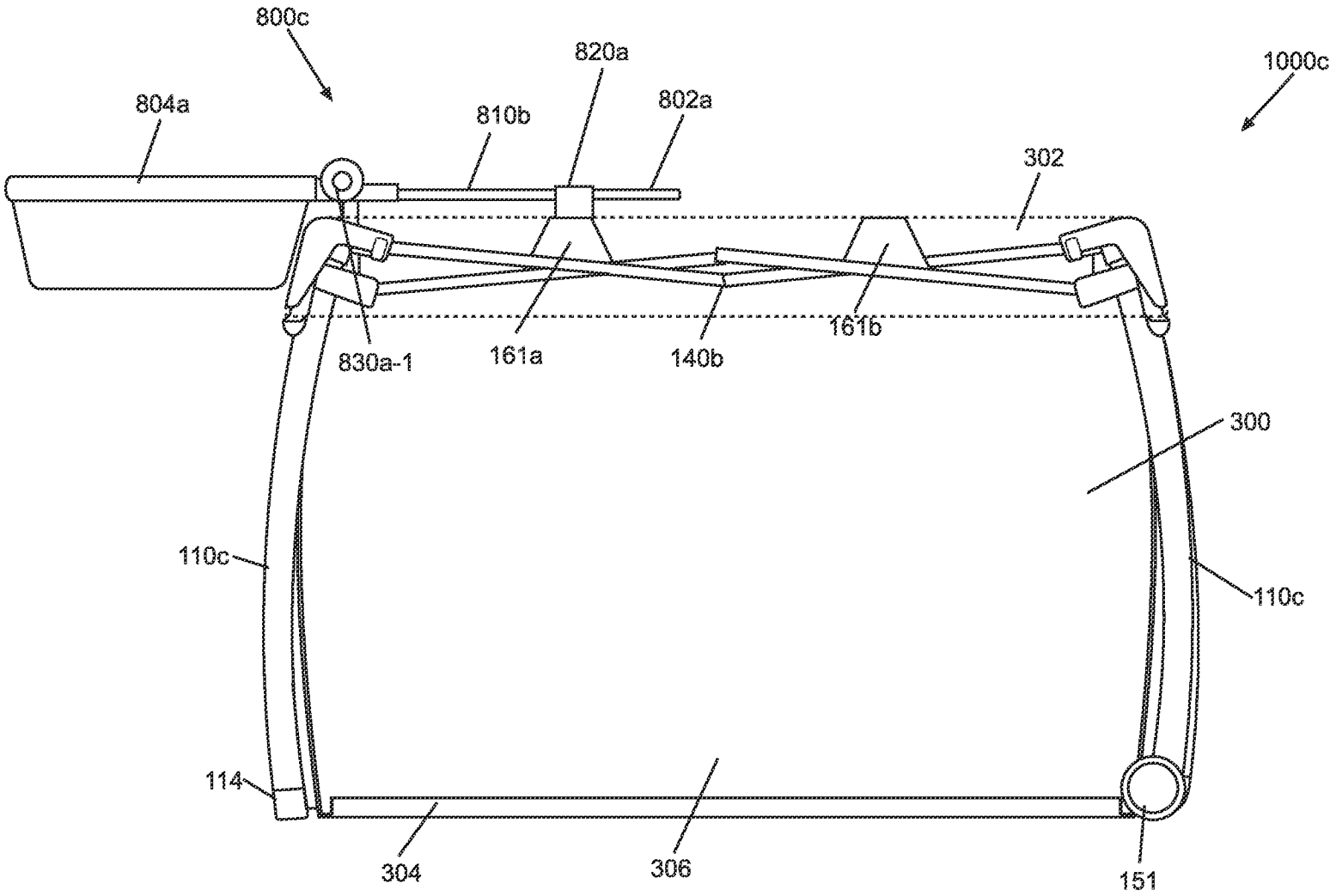

FIG. 73A shows a front view of the playard of FIG. 72A in the setup configuration.

Figure 73B:
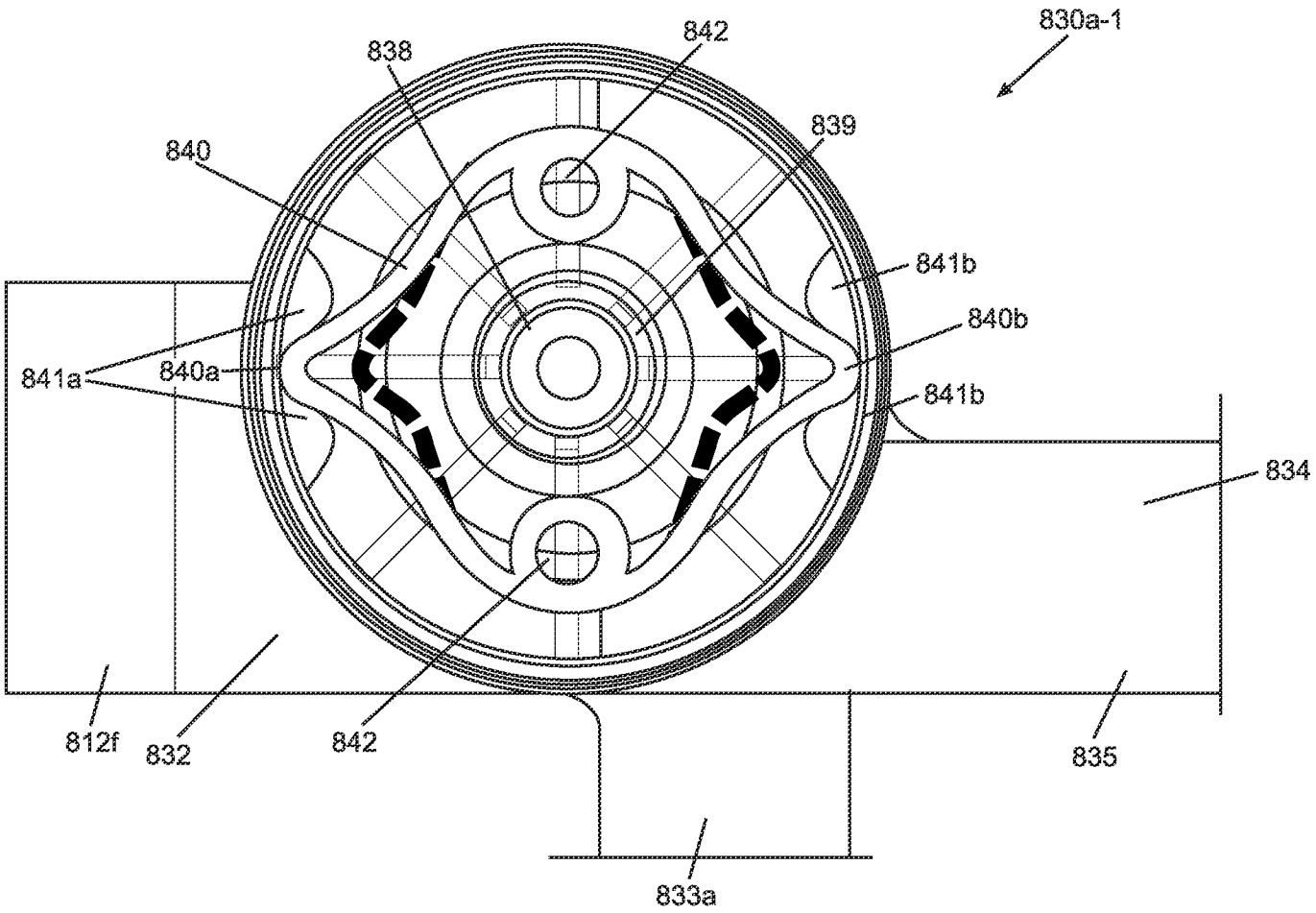

FIG. 73B shows a magnified view of a hub assembly in the topper of FIG. 73A in the setup configuration.

Figure 73C:
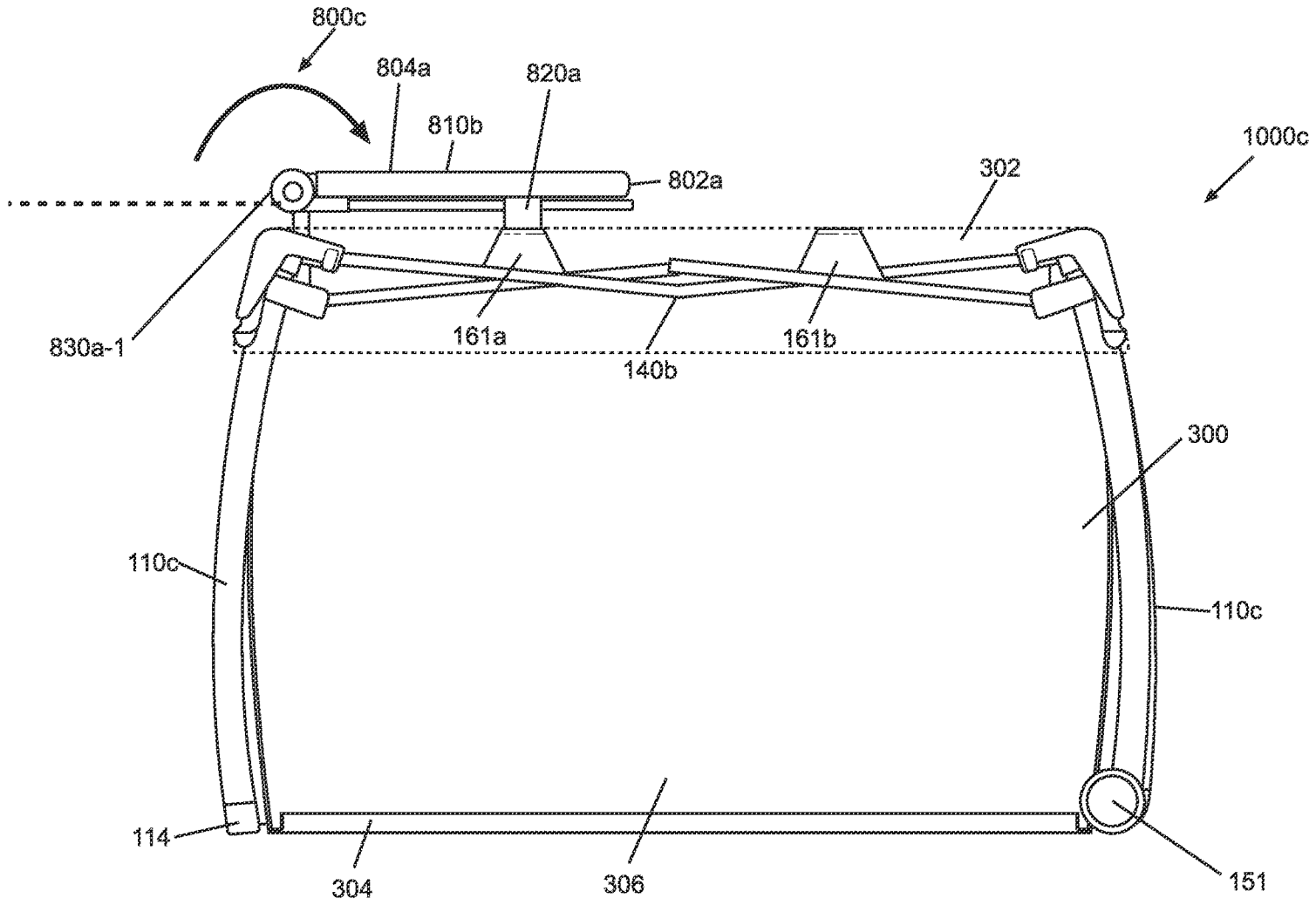

FIG. 73C shows a front view of the playard of FIG. 72A in the storage configuration.

Figure 73D:
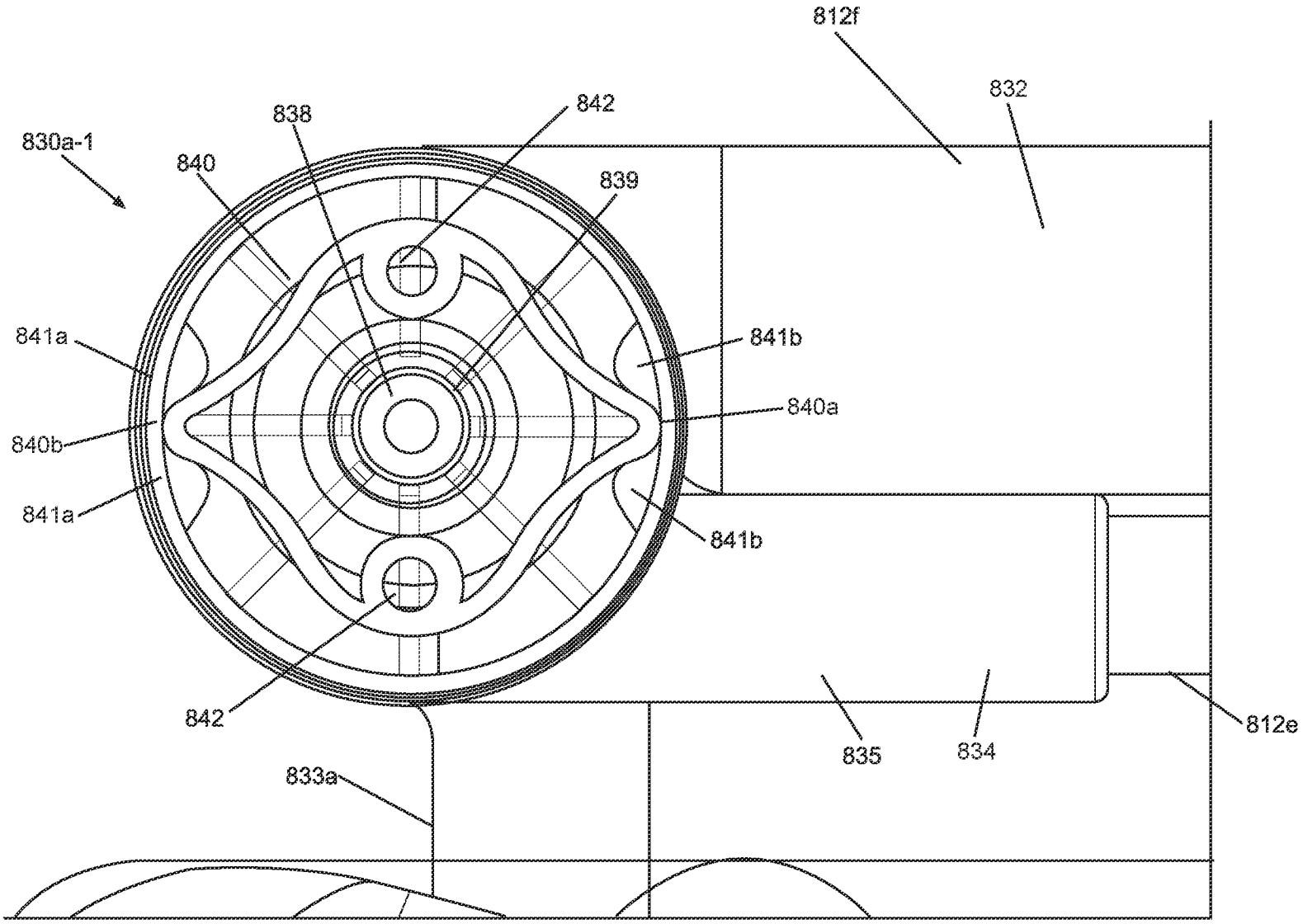

FIG. 73D shows a magnified view of a hub assembly in the topper of FIG. 73C in the storage configuration.

Figure 73E:
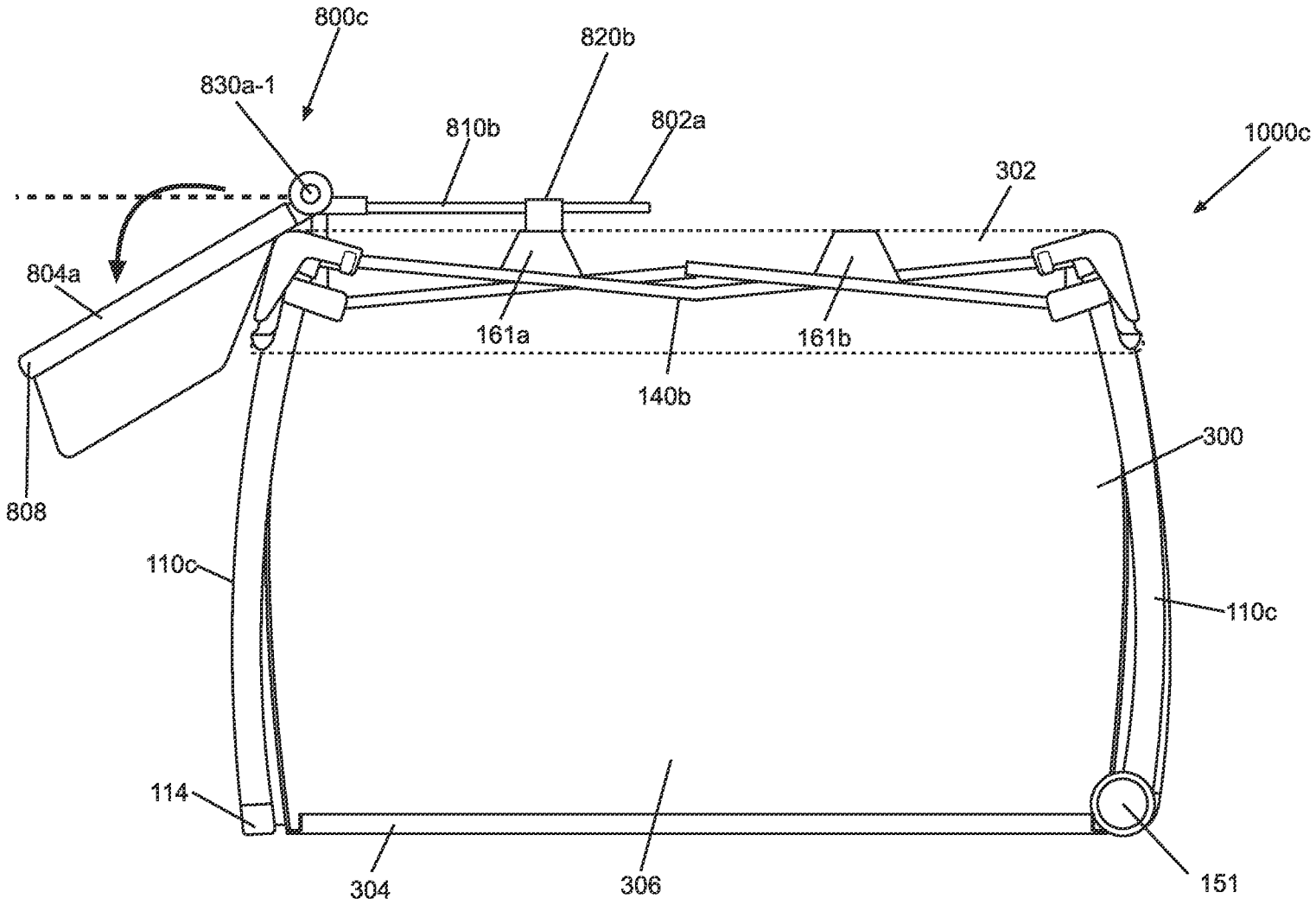

FIG. 73E shows a front view of the playard of FIG. 72A in the breakaway configuration.

Figure 73F:
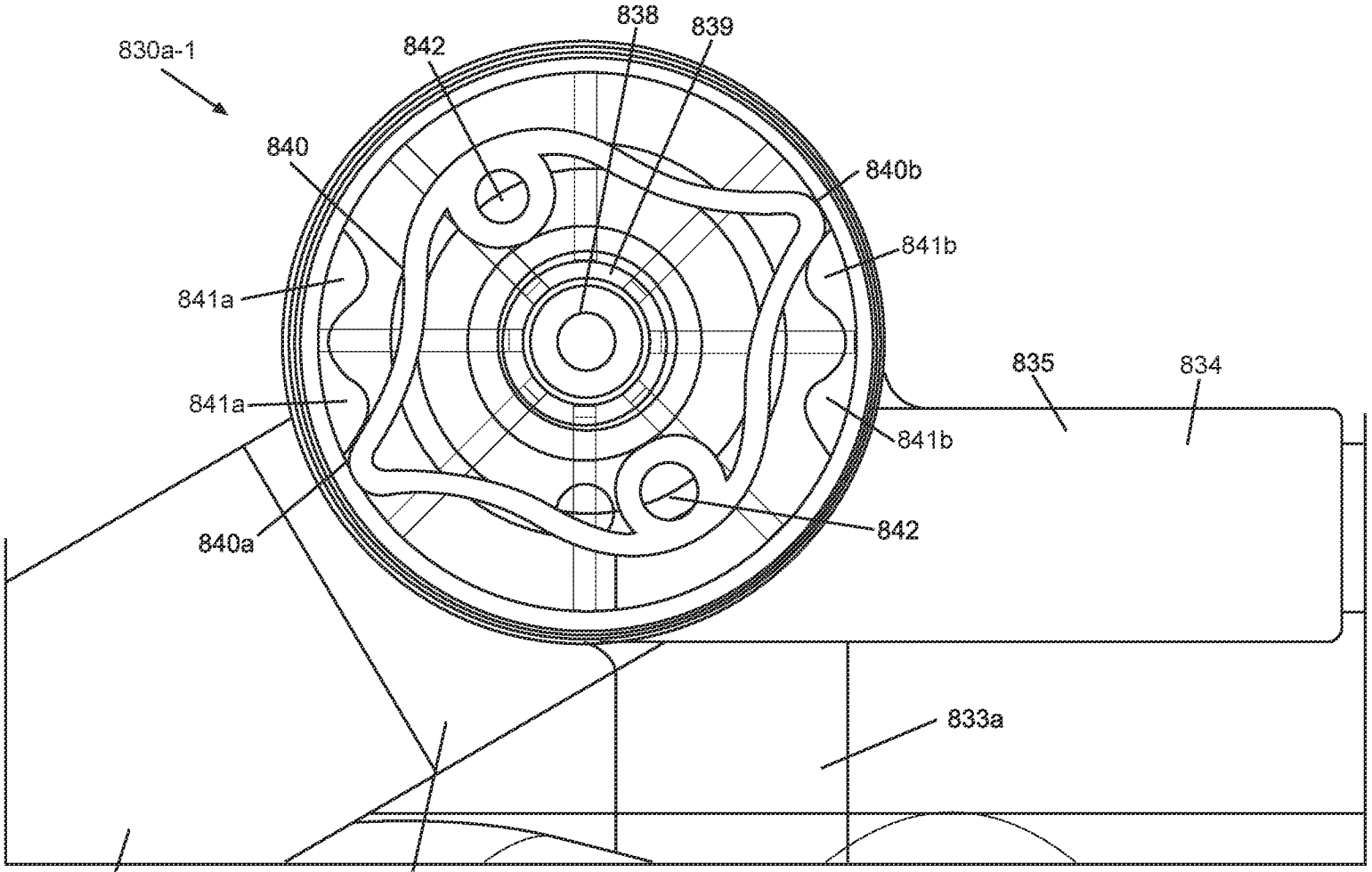

FIG. 73F shows a magnified view of a hub assembly in the topper of FIG. 73E in the breakaway configuration.

Figure 74A:
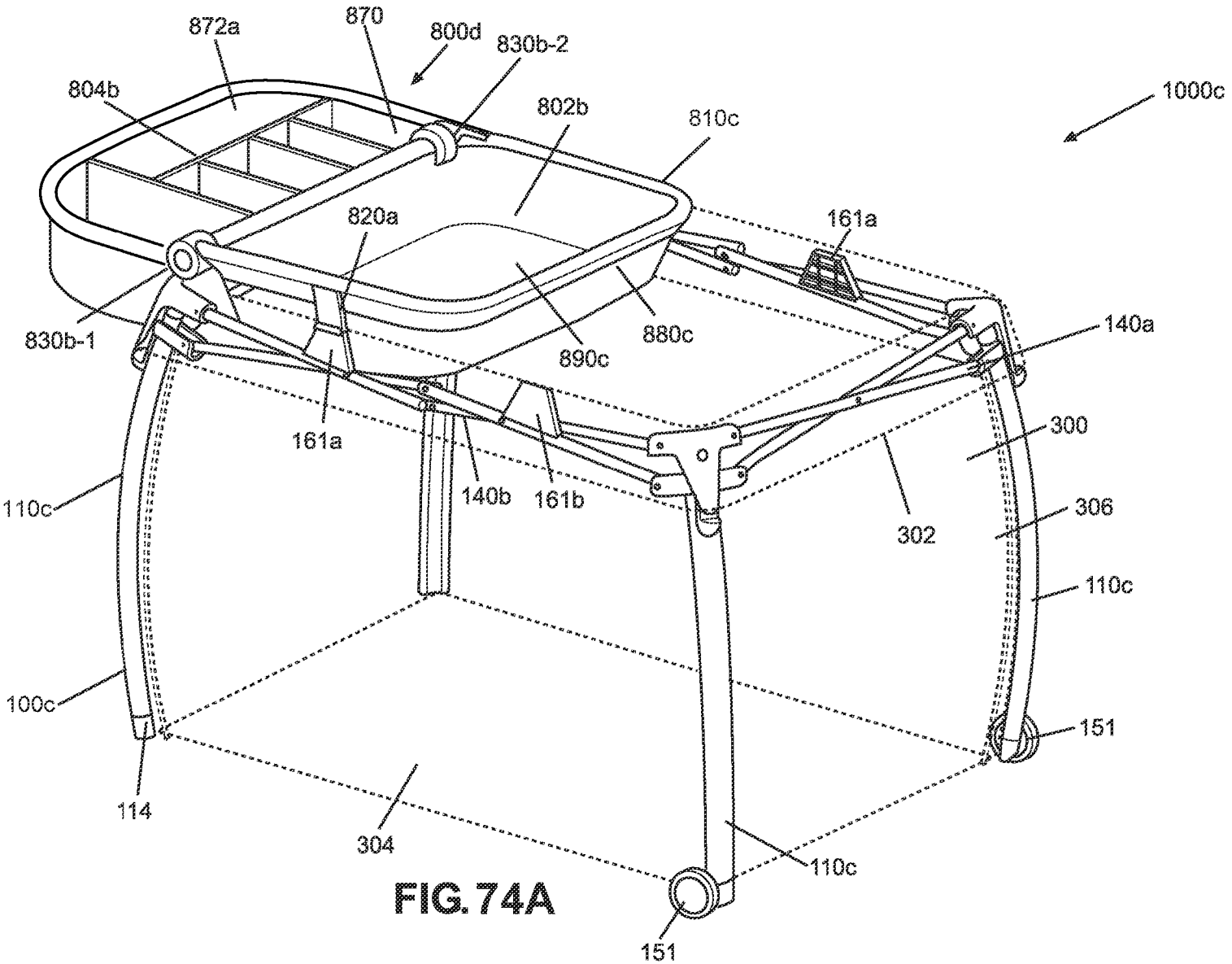

FIG. 74A shows a top, front, right perspective view of the playard of FIG. 23A without the bassinet accessory of FIG. 50A where the playard is in the unfolded configuration. The playard includes another exemplary topper mounted to the playard frame where the topper includes a rotatable changing table section and a stationary organizer section. The topper is shown in a setup configuration.

Figure 74B:
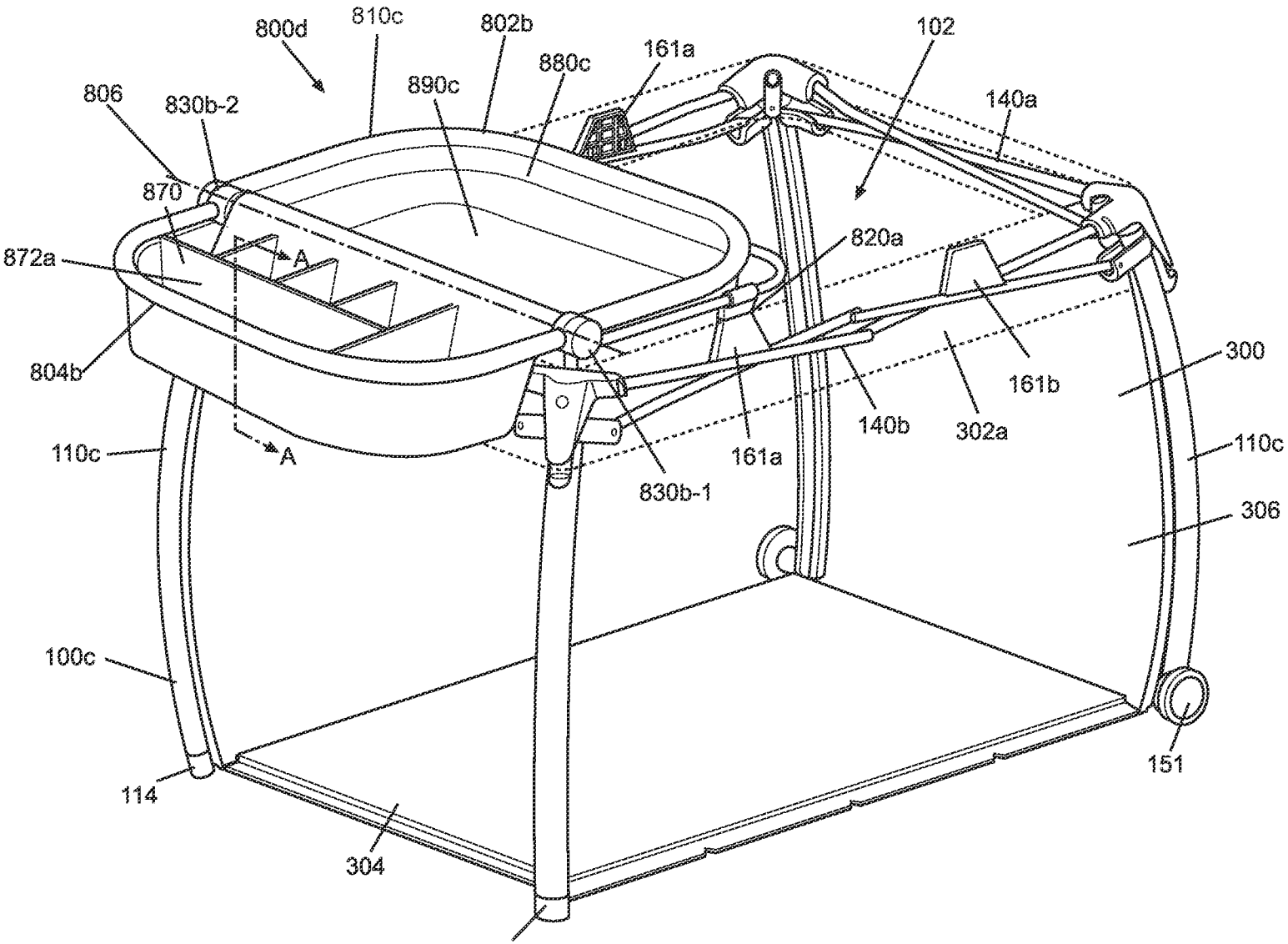

FIG. 74B shows a top, front, left perspective view of the playard of FIG. 74A.

Figure 74C:
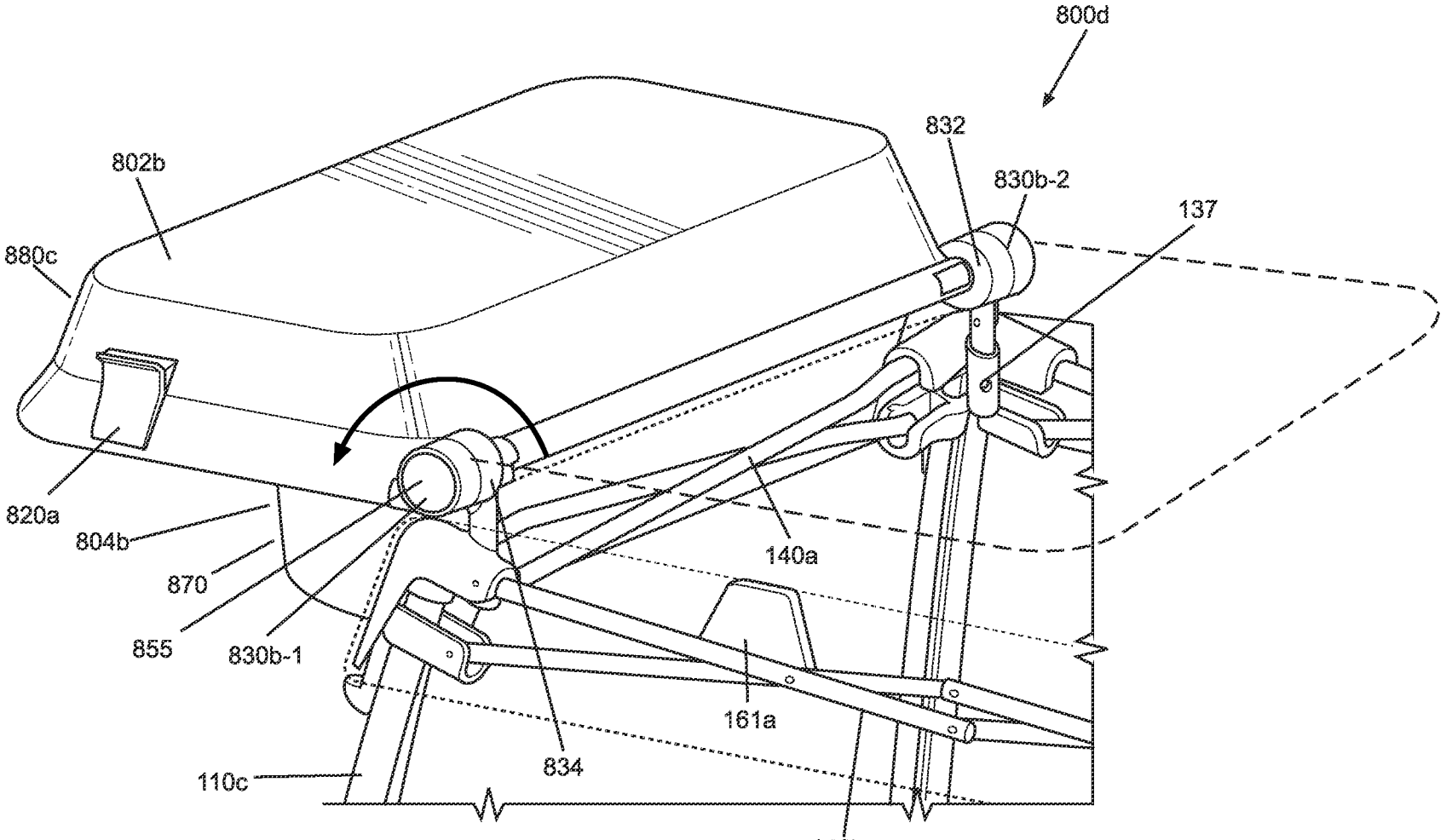

FIG. 74C shows a magnified top, front, right perspective view of the playard of FIG. 74A where the topper is in a storage configuration with the changing table section rotated to cover the organizer section.

Figure 74D:
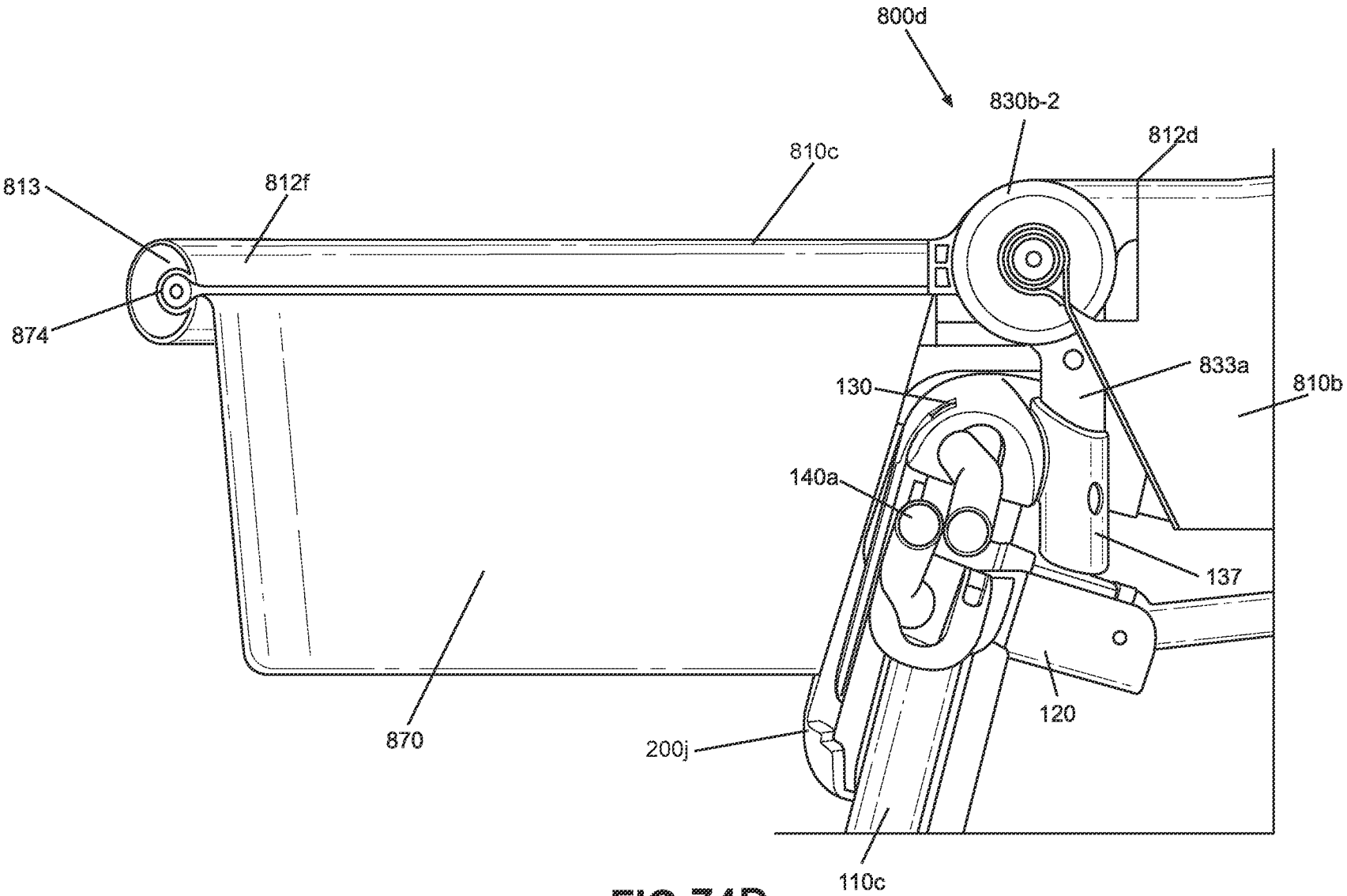

FIG. 74D shows cross-sectional view of the organizer section corresponding to the plane A-A of FIG. 74B.

Figure 75A:
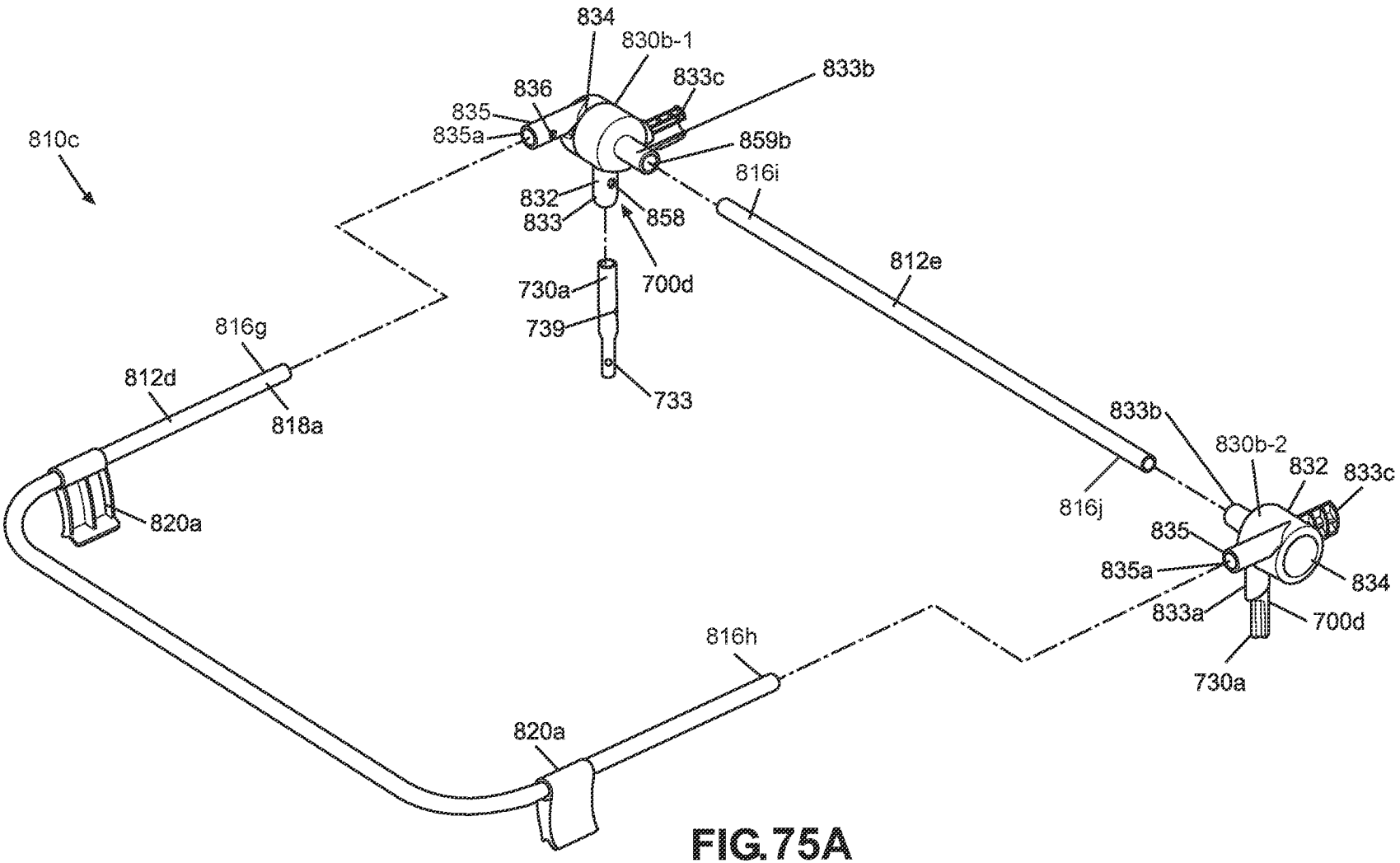

FIG. 75A shows an exploded top, rear, right perspective view of a portion of a frame in the topper of FIG. 74A defining the changing table section.

Figure 75B:
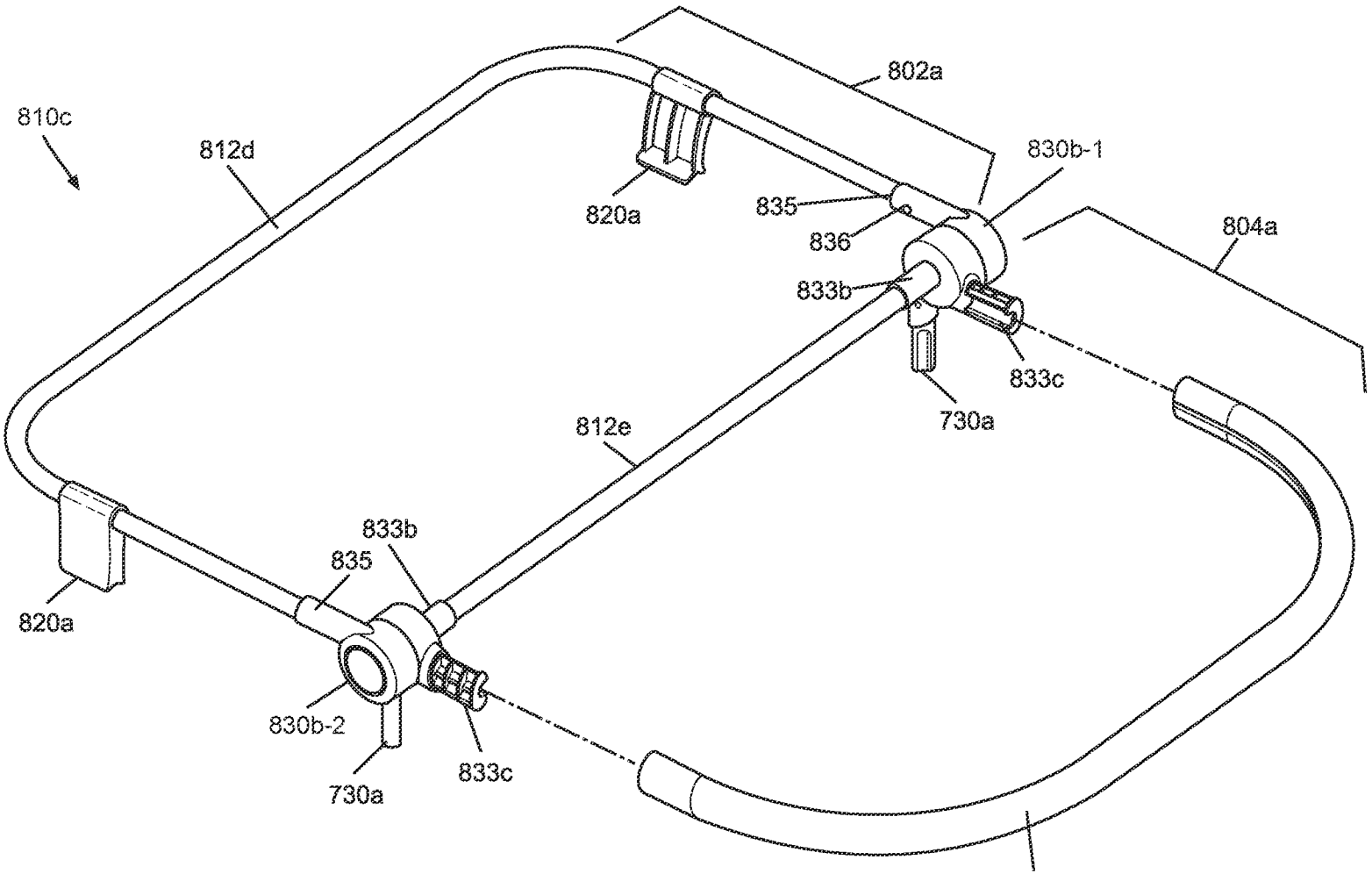

FIG. 75B shows an exploded top, rear, right perspective view of the portion of the frame of FIG. 75A connected to a top rail defining the organizer section.

Figure 75C:
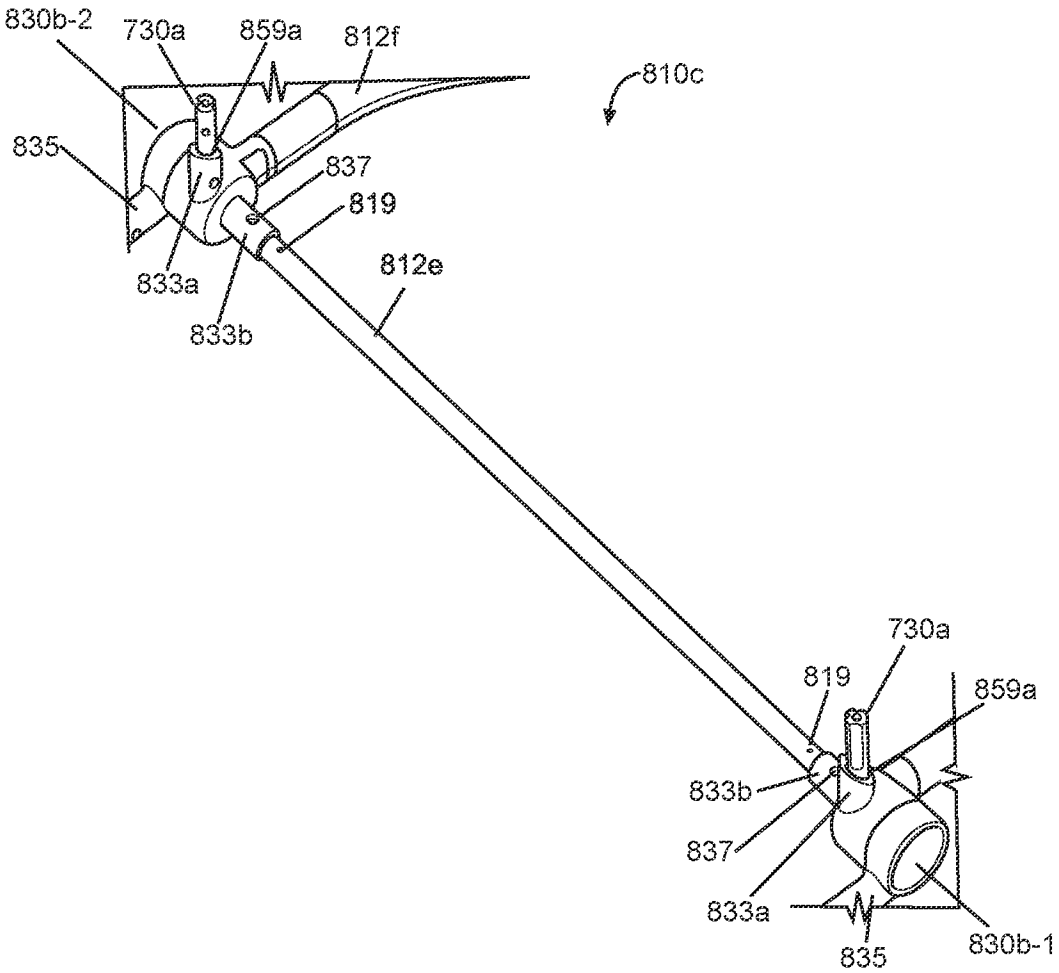

FIG. 75C shows a bottom, front, right perspective view of hub assemblies in the frame of FIG. 75A.

Figure 76A:
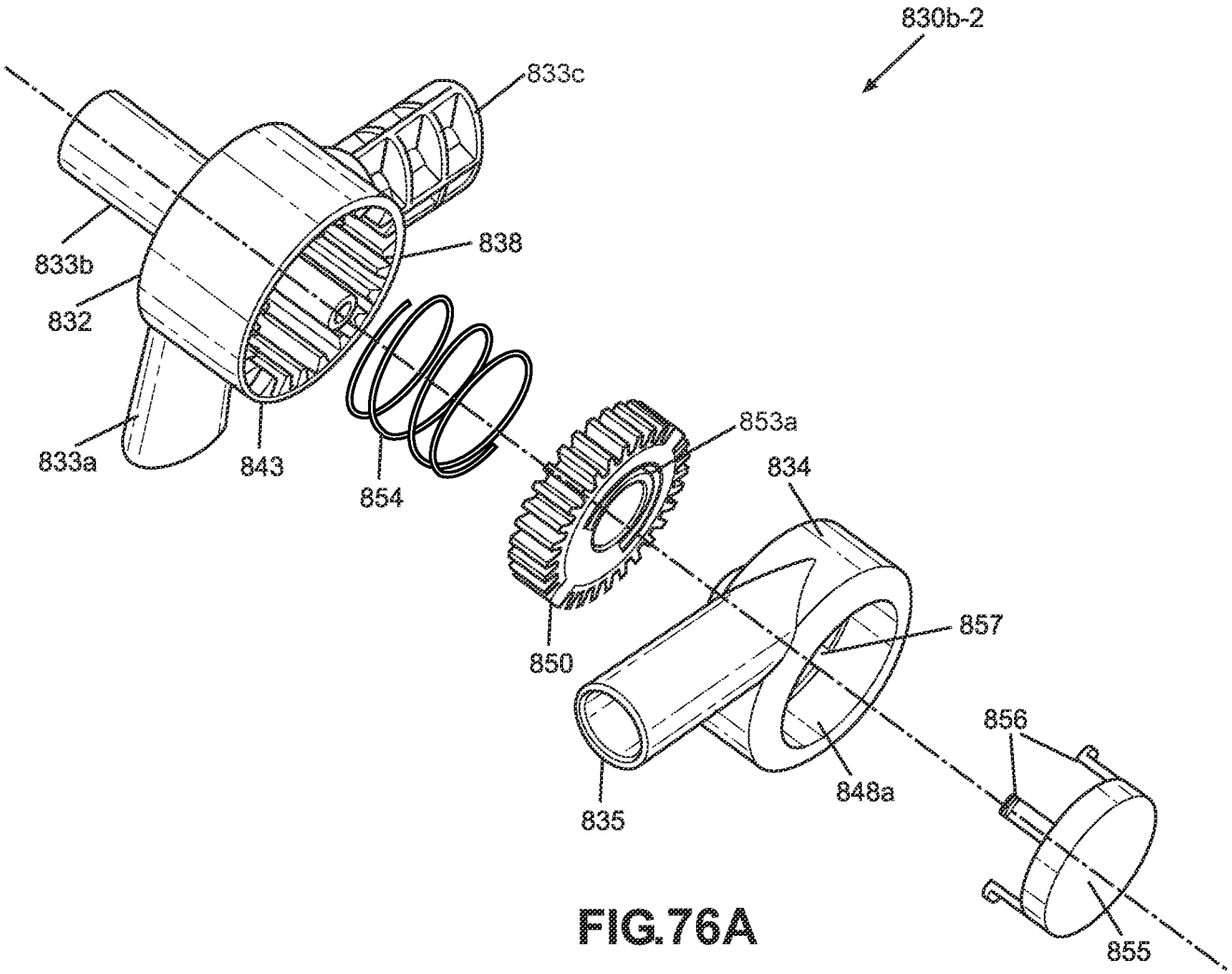

FIG. 76A shows an exploded view of one hub assembly in the frame of FIG. 75A.

Figure 76C:
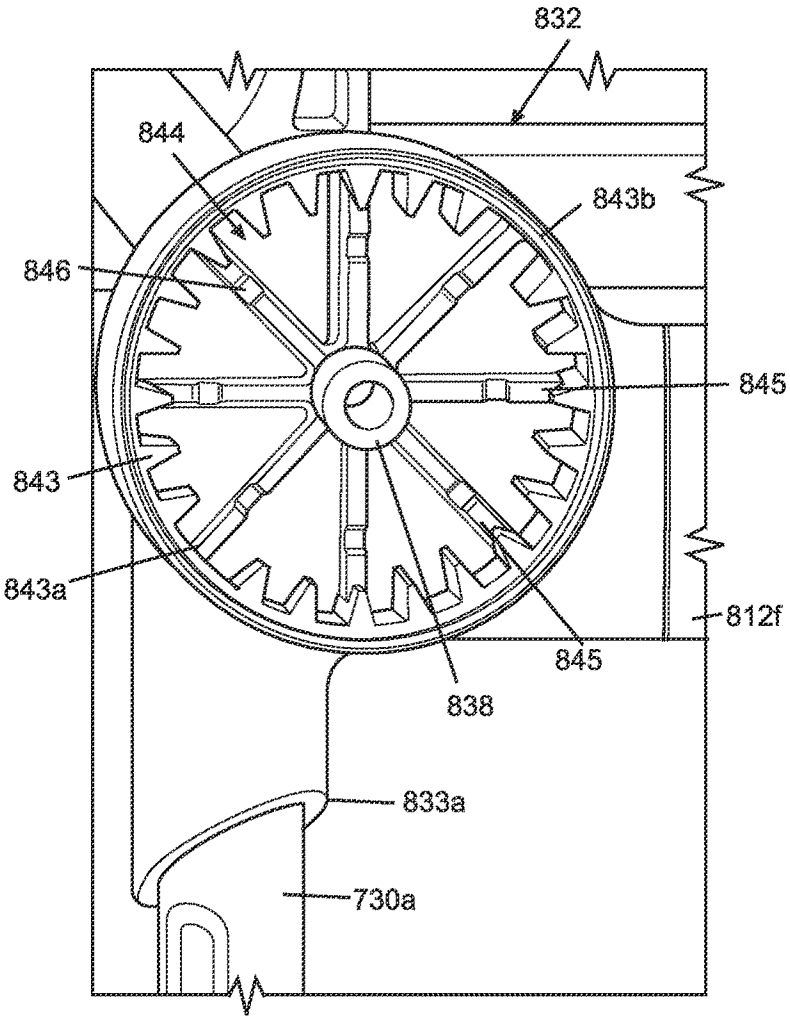
Figure 76B:
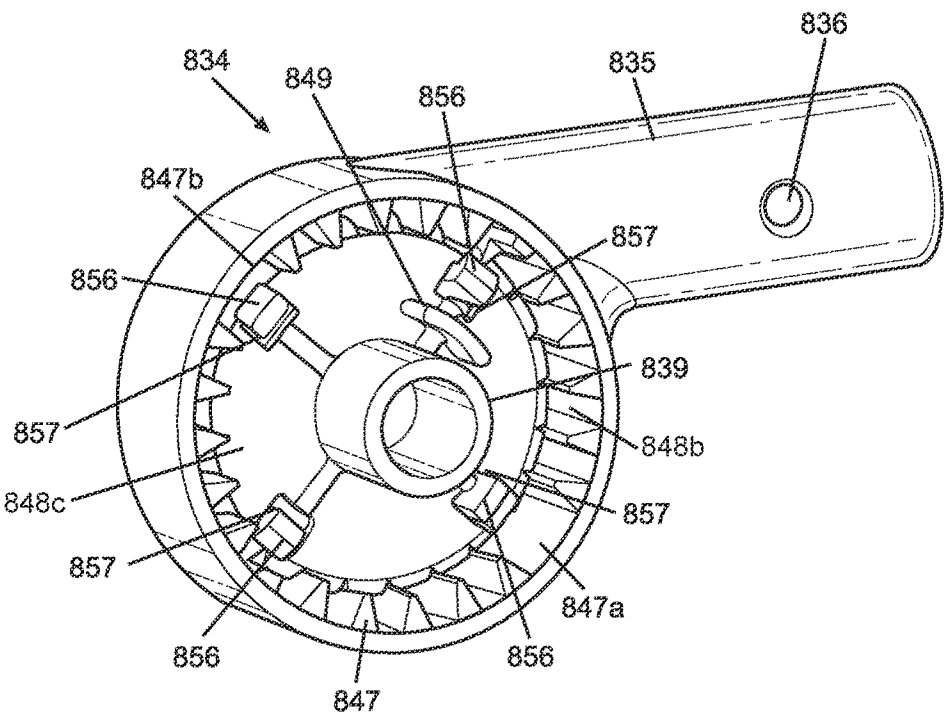

FIG. 76B shows a perspective view of a changing table mount in the hub assembly of FIG. 76A.

FIG. 76C shows a perspective view of an organizer mount in the hub assembly of FIG. 76A.

Figure 76D:
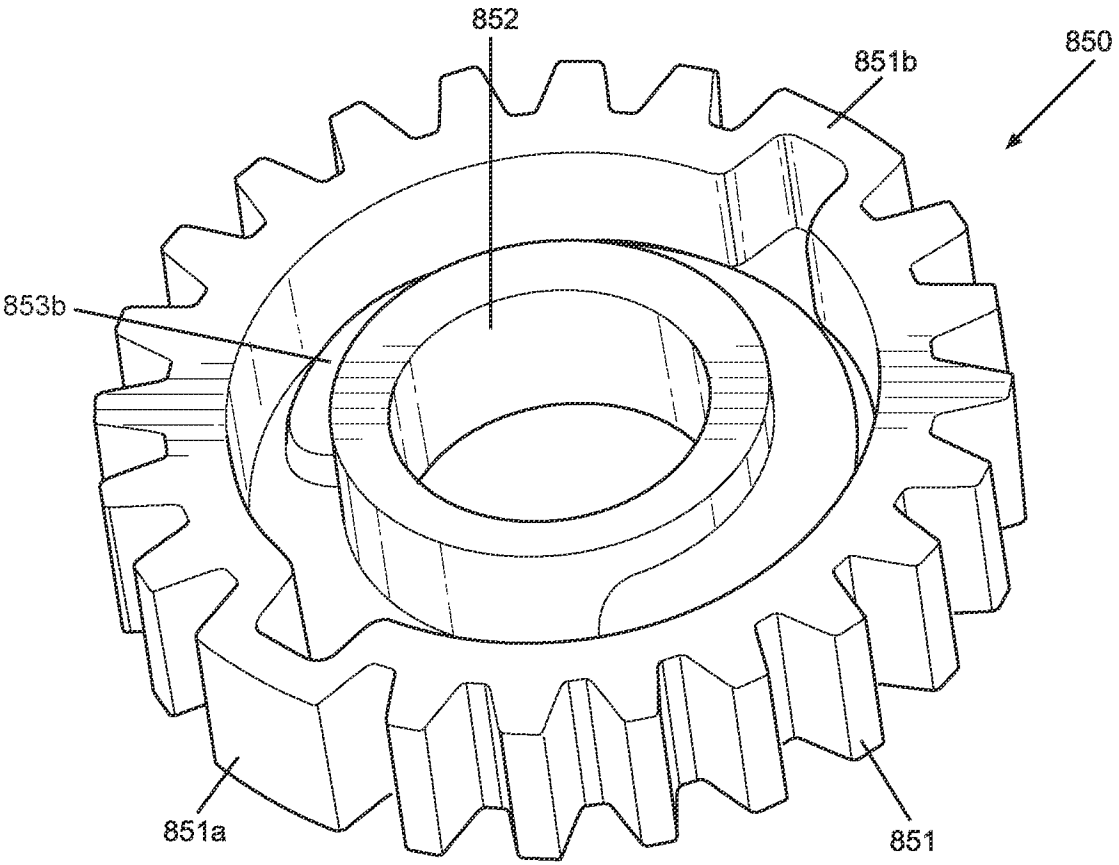

FIG. 76D shows a perspective view of a gear in the hub assembly of FIG. 76A.

Figure 77A:
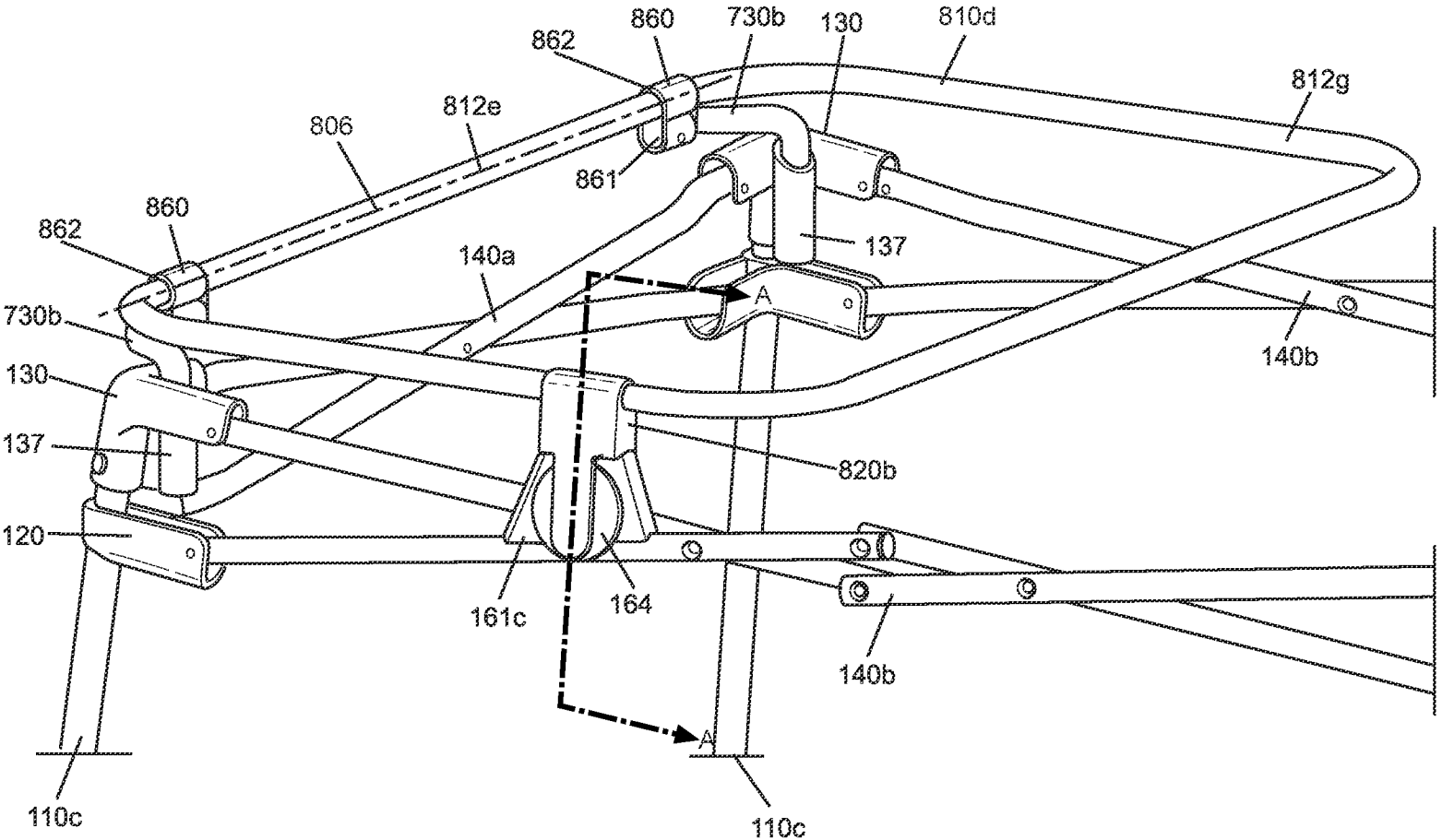

FIG. 77A shows a magnified top, front, right perspective view of the playard of FIG. 23A without the bassinet accessory where the playard is in the unfolded configuration. The playard includes a rotatable changing table topper where the topper includes a support foot that latches to a topper support of the playard frame to maintain the topper in a setup configuration.

Figure 77B:
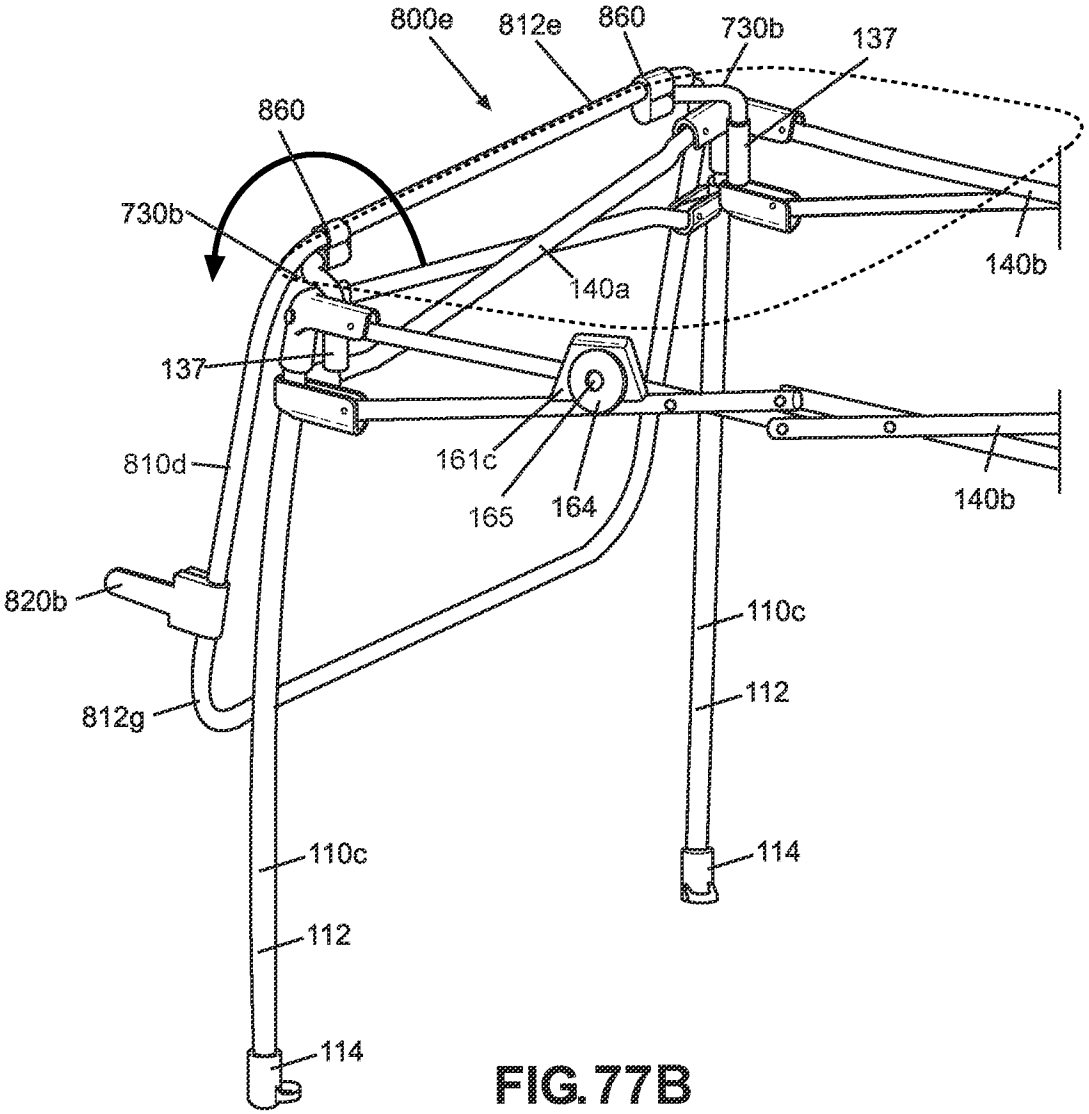

FIG. 77B shows a magnified top, front, right perspective view of the playard of FIG. 77A where the topper is in a storage configuration with the changing table topper rotated to a side of the playard frame.

Figure 77C:
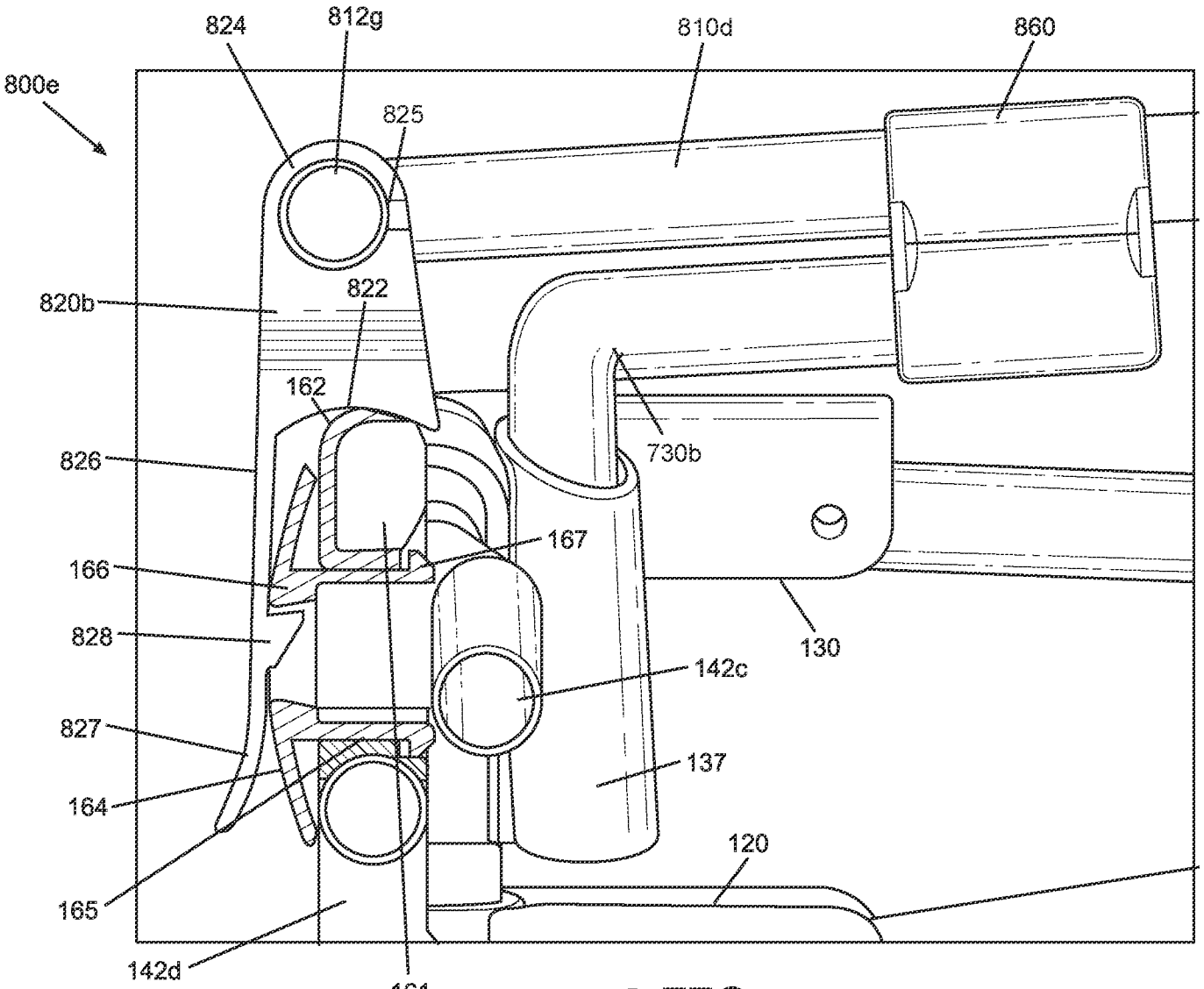

FIG. 77C shows a cross-sectional view of the support and the topper support of FIG. 77A corresponding to the plane A-A of FIG. 77A.

Figure 78:
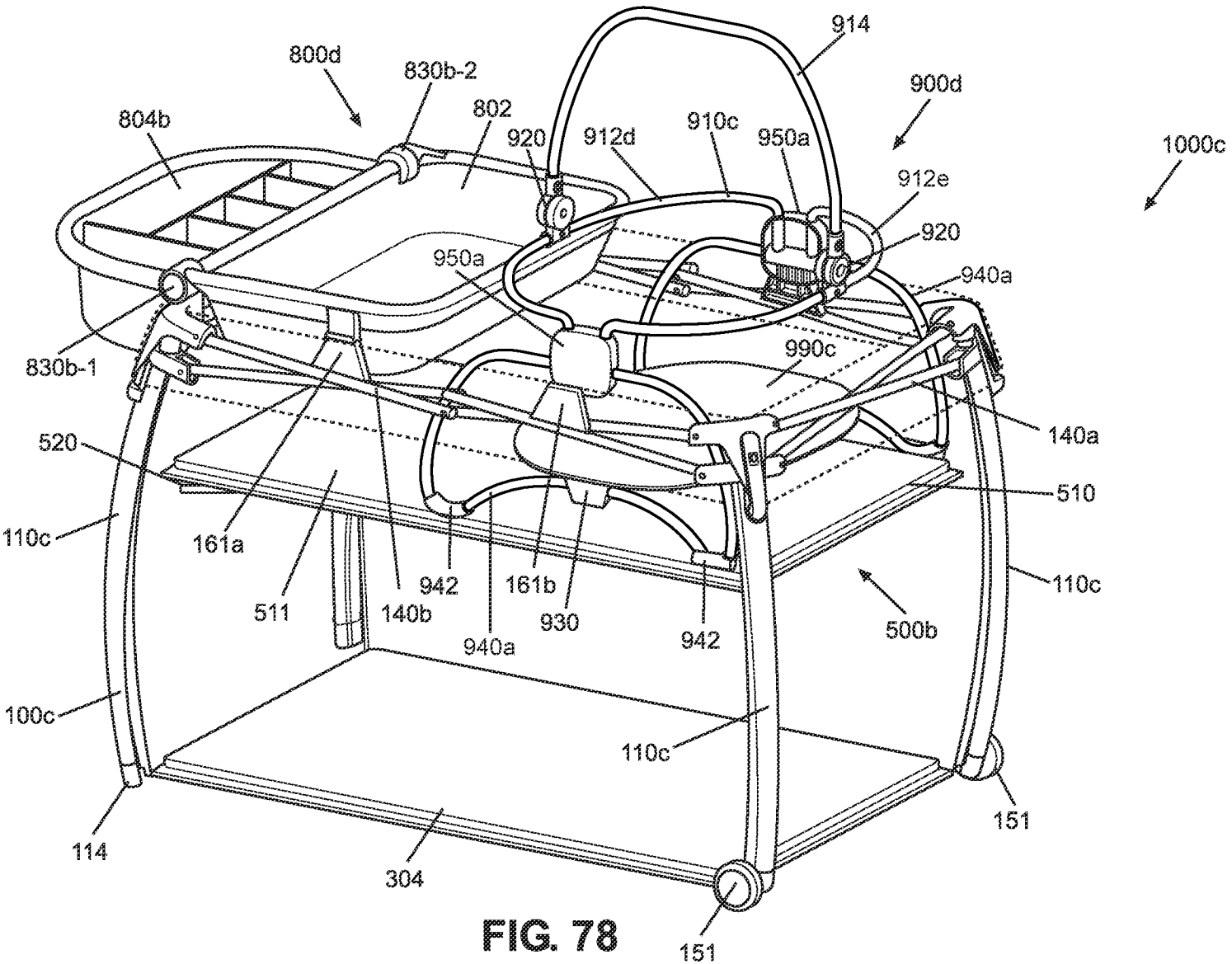

FIG. 78 shows a top, front, right perspective view of the playard of FIG. 23A in the unfolded configuration. The playard includes the topper of FIG. 72A and an exemplary collapsible bassinet topper.

Figure 79A:
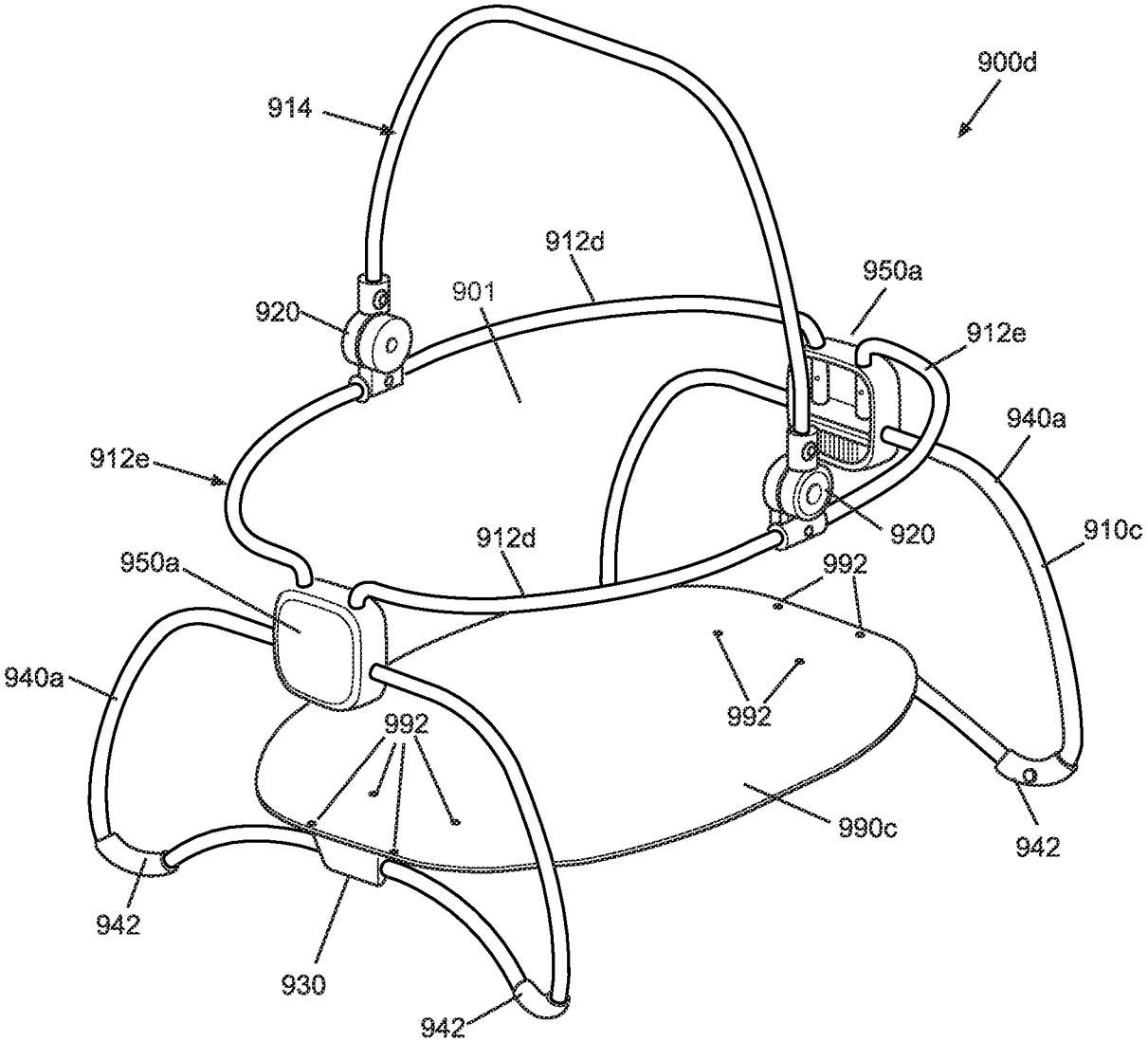

FIG. 79A shows a top, front, right perspective view of the bassinet topper of FIG. 78 in a setup configuration. The bassinet topper includes a support platform with latches to maintain the bassinet topper in the setup configuration and rotatable legs to facilitate collapse of the bassinet topper for storage.

Figure 79B:
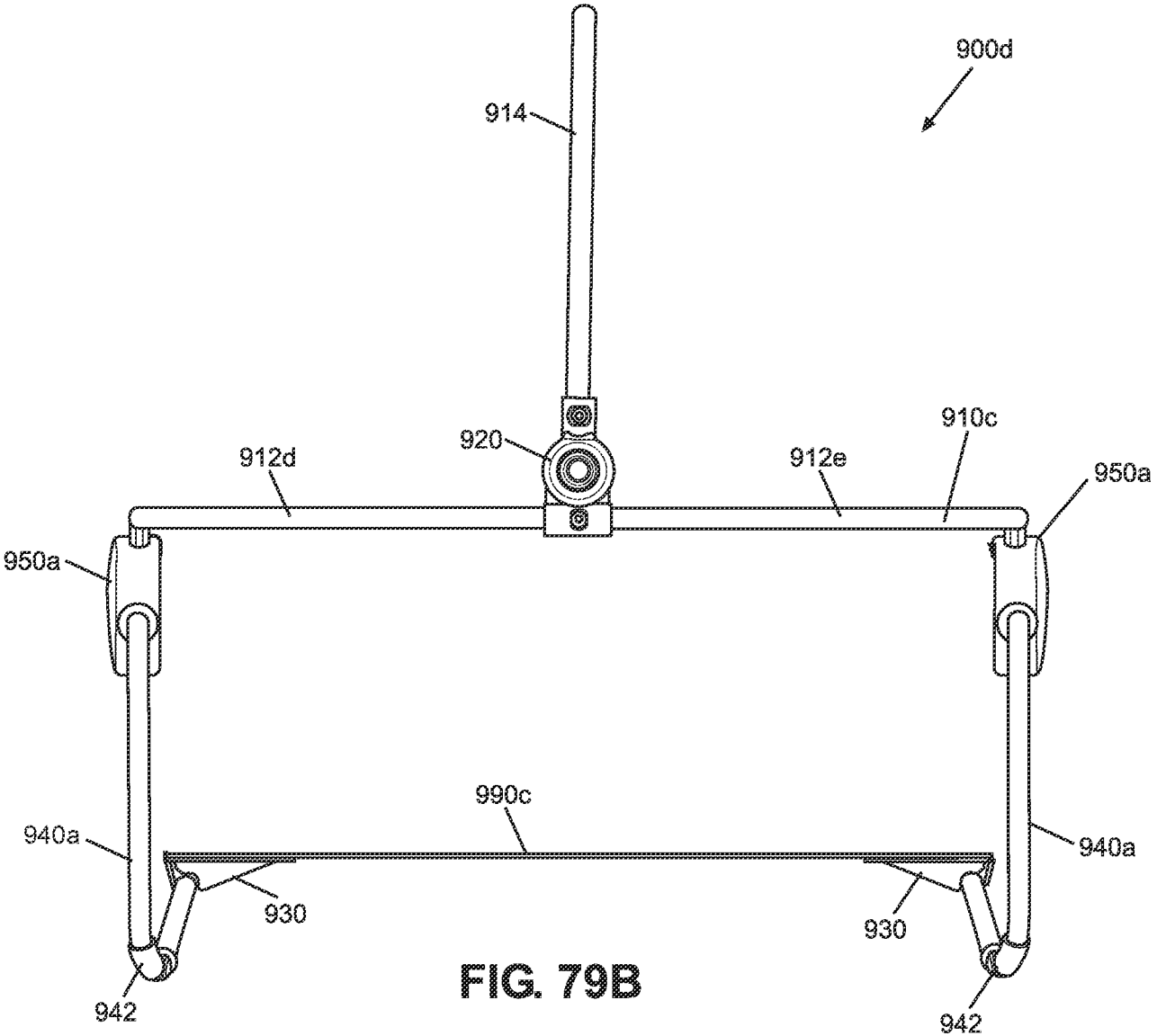

FIG. 79B shows a right-side view of the bassinet topper of FIG. 79A.

Figure 79C:
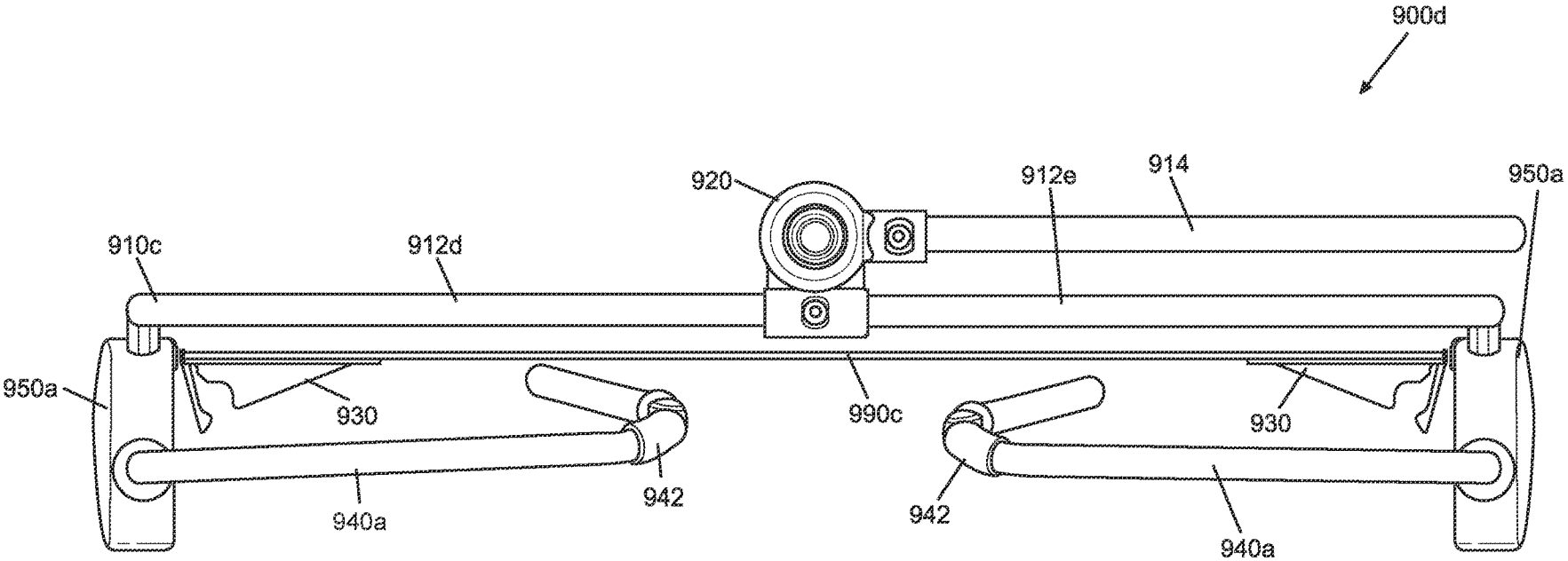

FIG. 79C shows a right-side view of the bassinet topper of FIG. 79A in a storage configuration.

Figure 80:
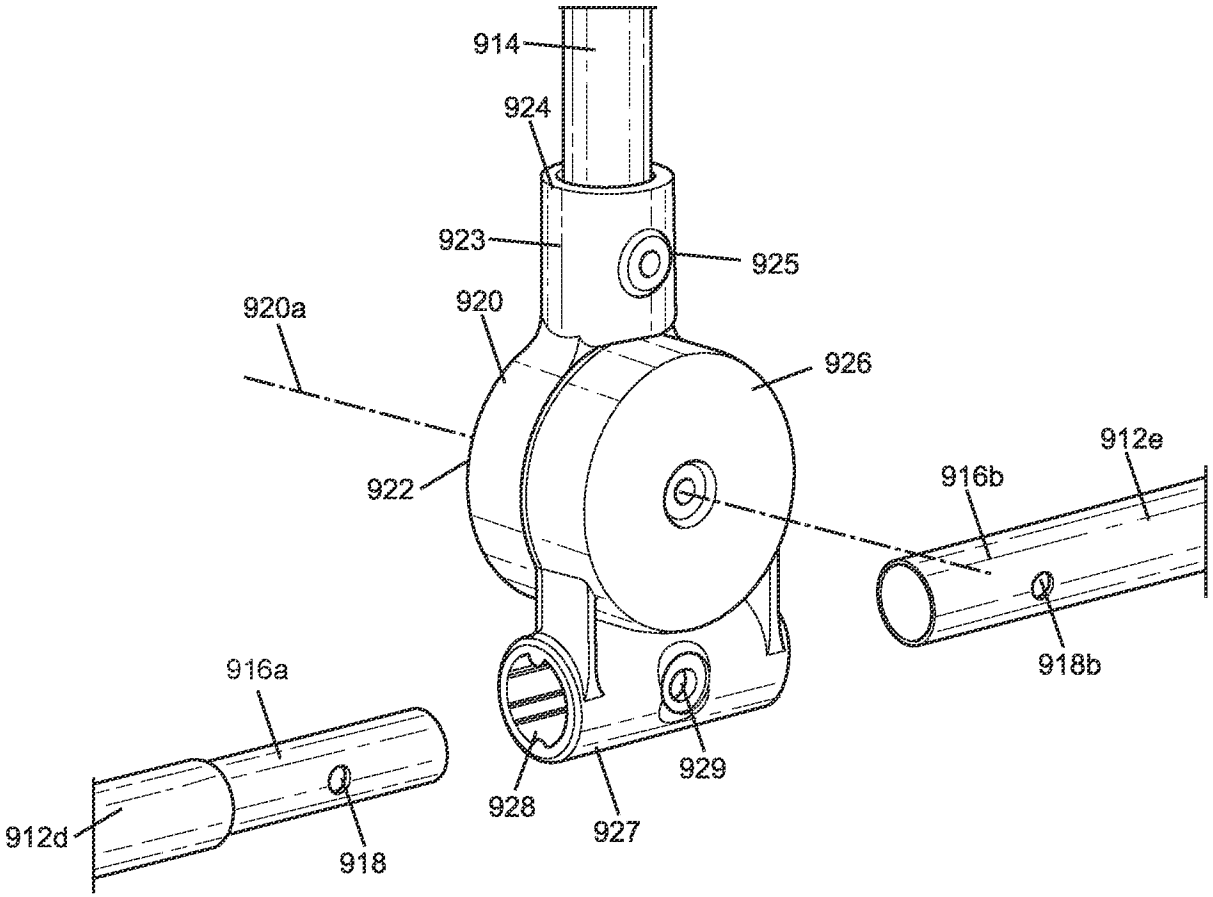

FIG. 80 shows an exploded top, front, right perspective view of a pair of top rails and a handle pivot assembly in the bassinet topper of FIG. 79A.

Figure 81A:
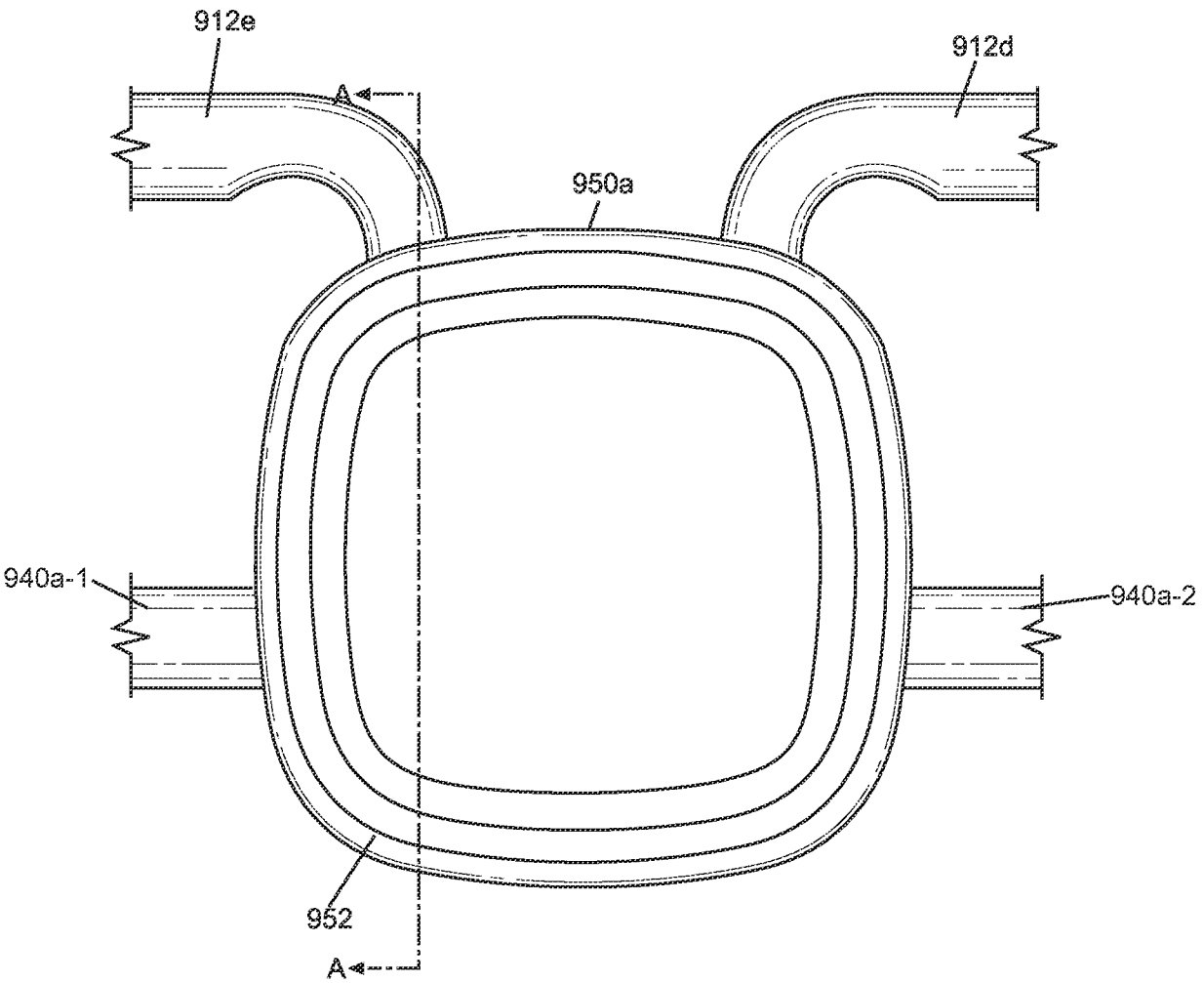

FIG. 81A shows a magnified front view of a housing coupled to a pair of top rails and a pair of legs in the bassinet topper of FIG. 79A.

Figure 81B:
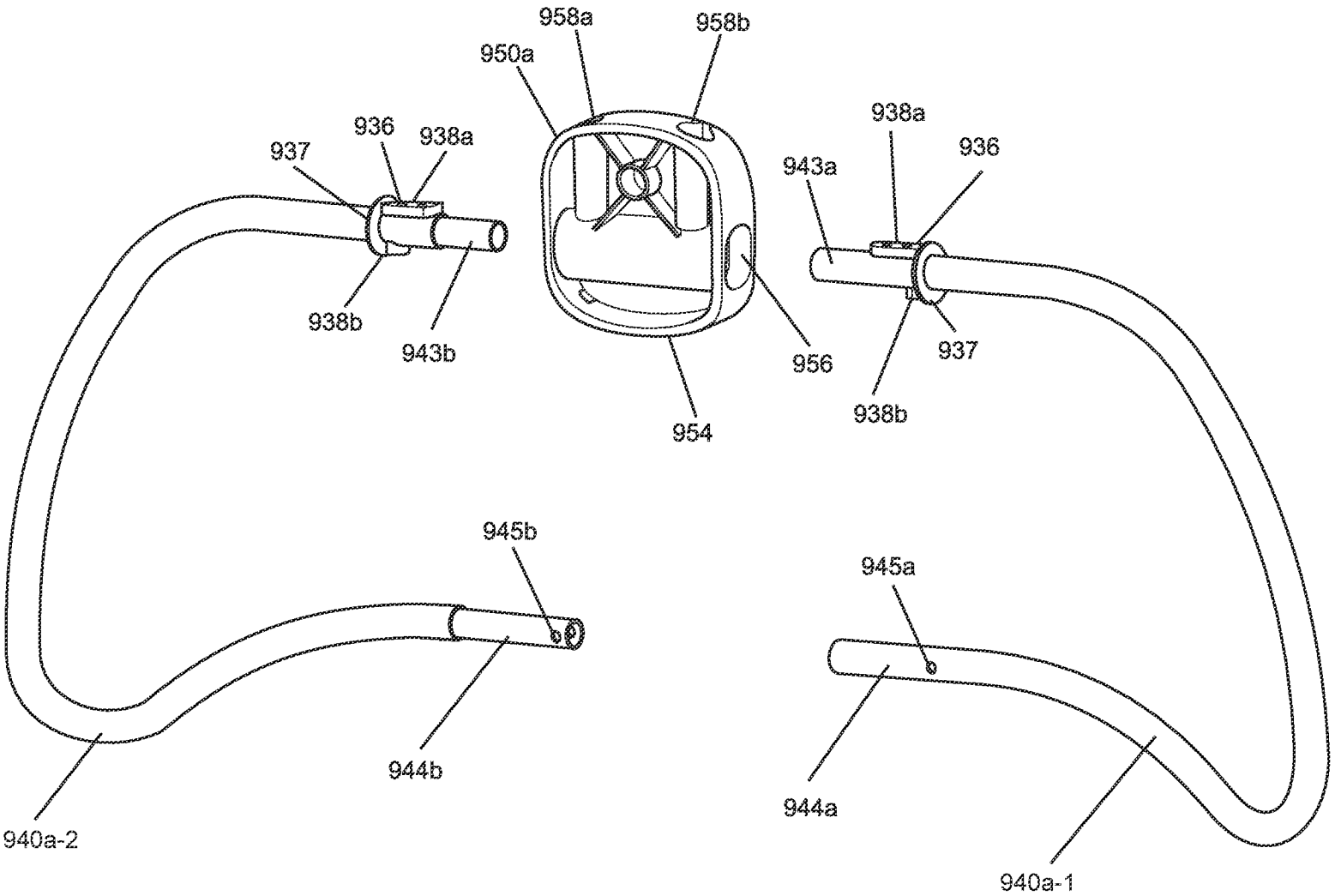

FIG. 81B shows an exploded top, rear, left perspective view of the housing and the pair of legs of FIG. 81A.

Figure 81C:
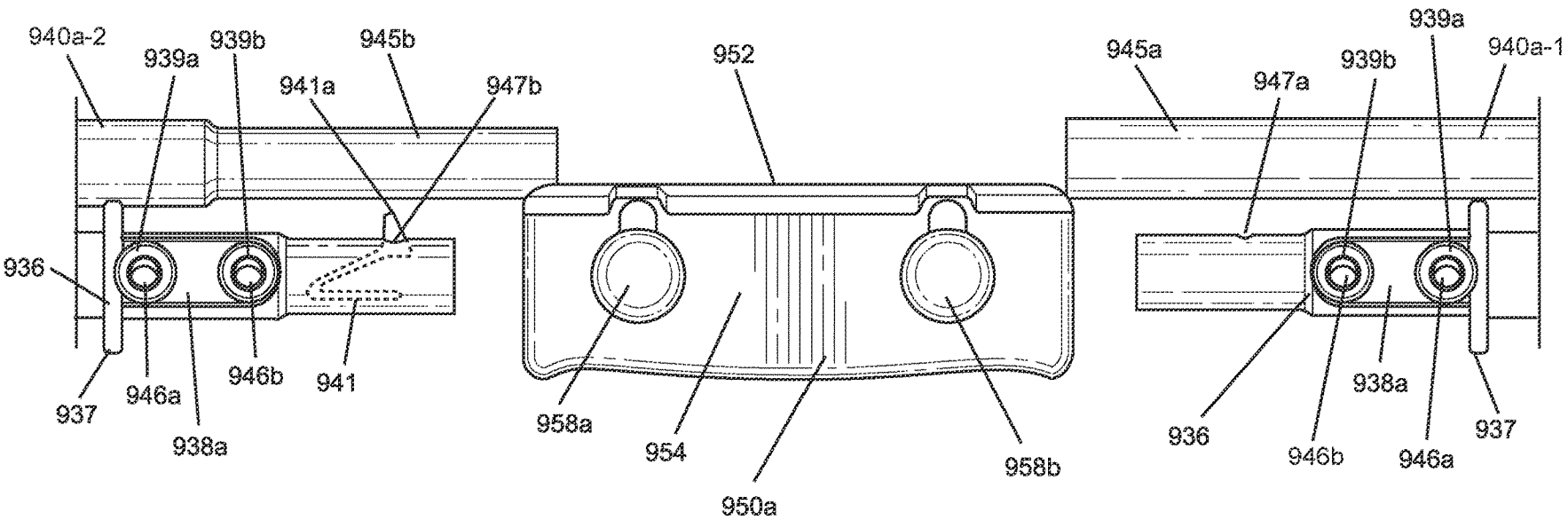

FIG. 81C shows an exploded top view of the housing and the pair of legs of FIG. 81B.

Figure 81D:
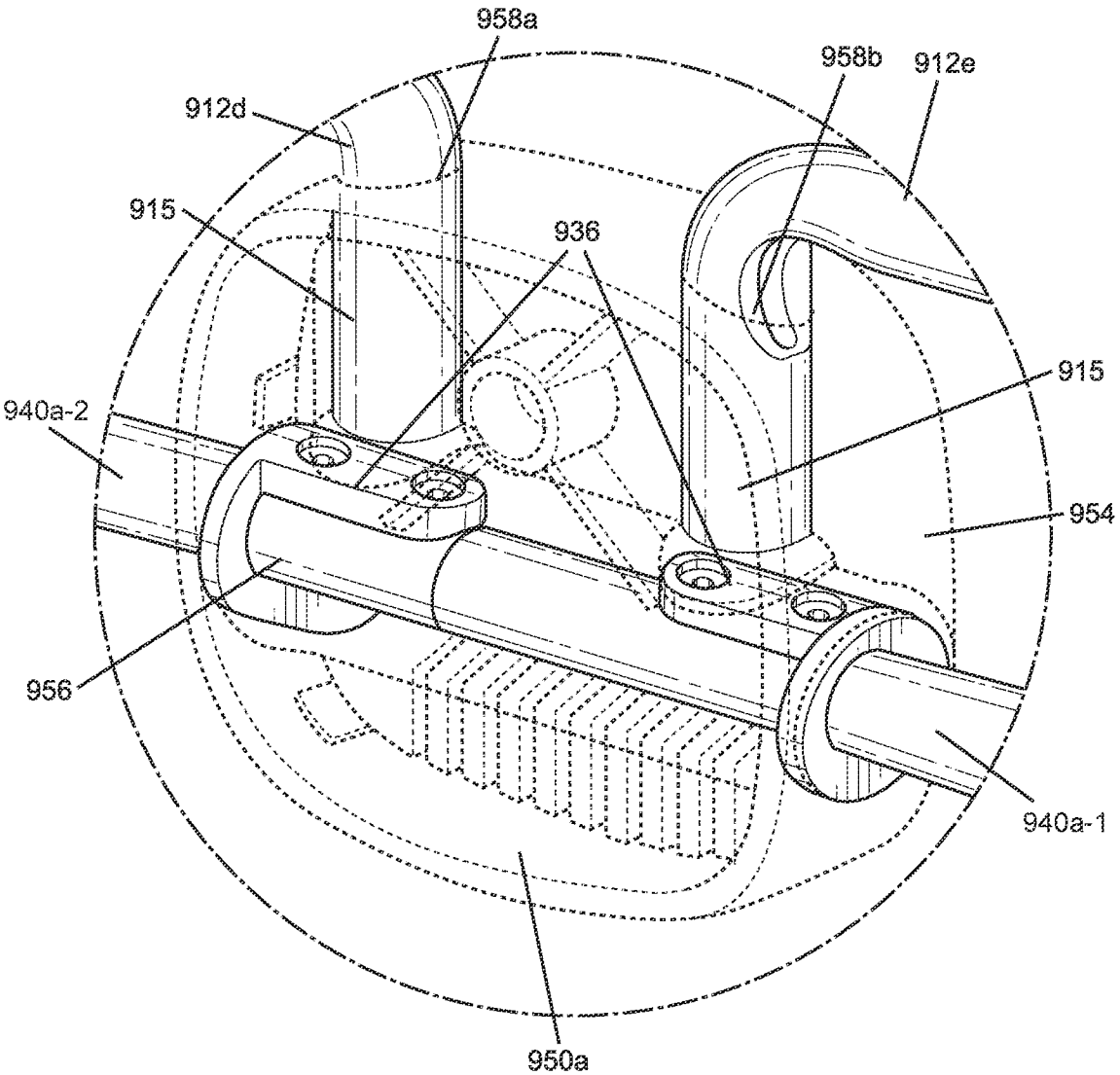
Figure 81F:
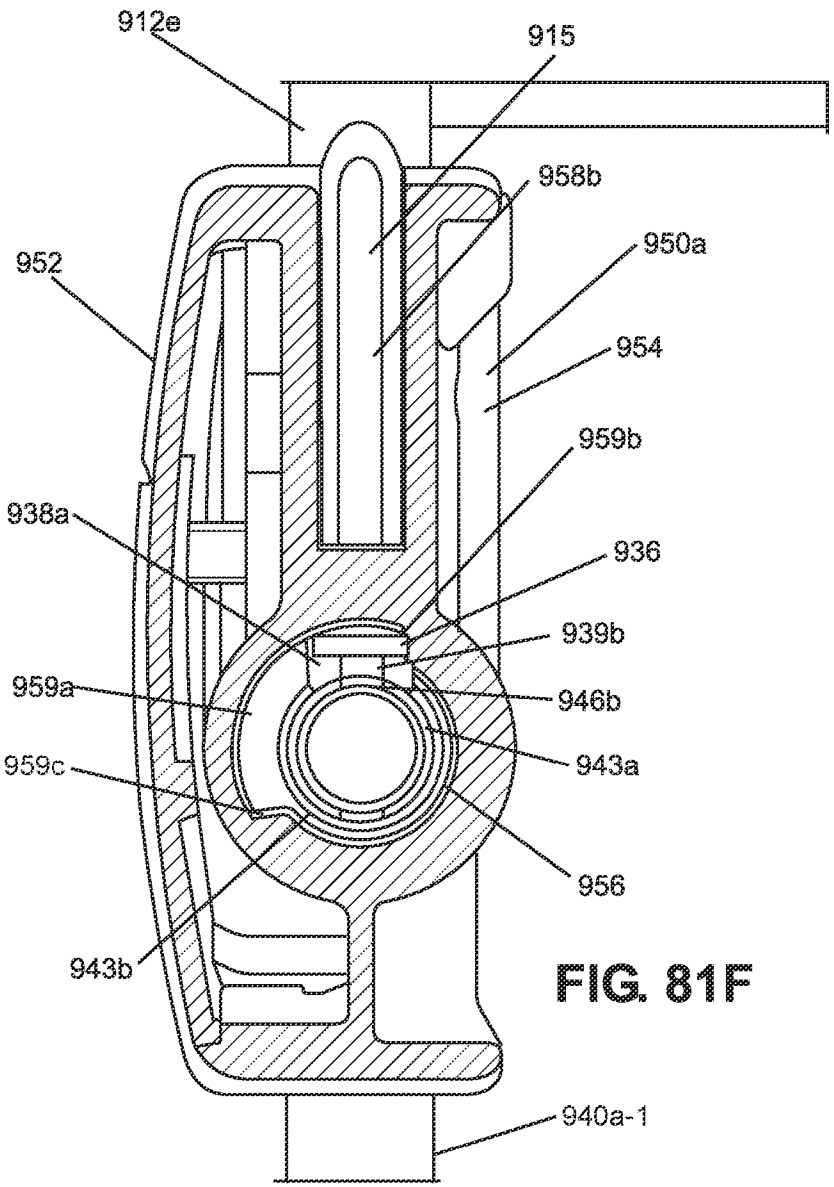

FIG. 81D shows a magnified top, rear, left perspective view of the housing, the pair of legs, and the pair of top rails of FIG. 81A where the housing is transparent to show the connection between the housing and the top rails and legs.

FIG. 81E shows a cross-sectional view of the housing, the pair of legs, and the pair of top rails corresponding to the plane A-A of FIG. 81A.

Figure 82A:
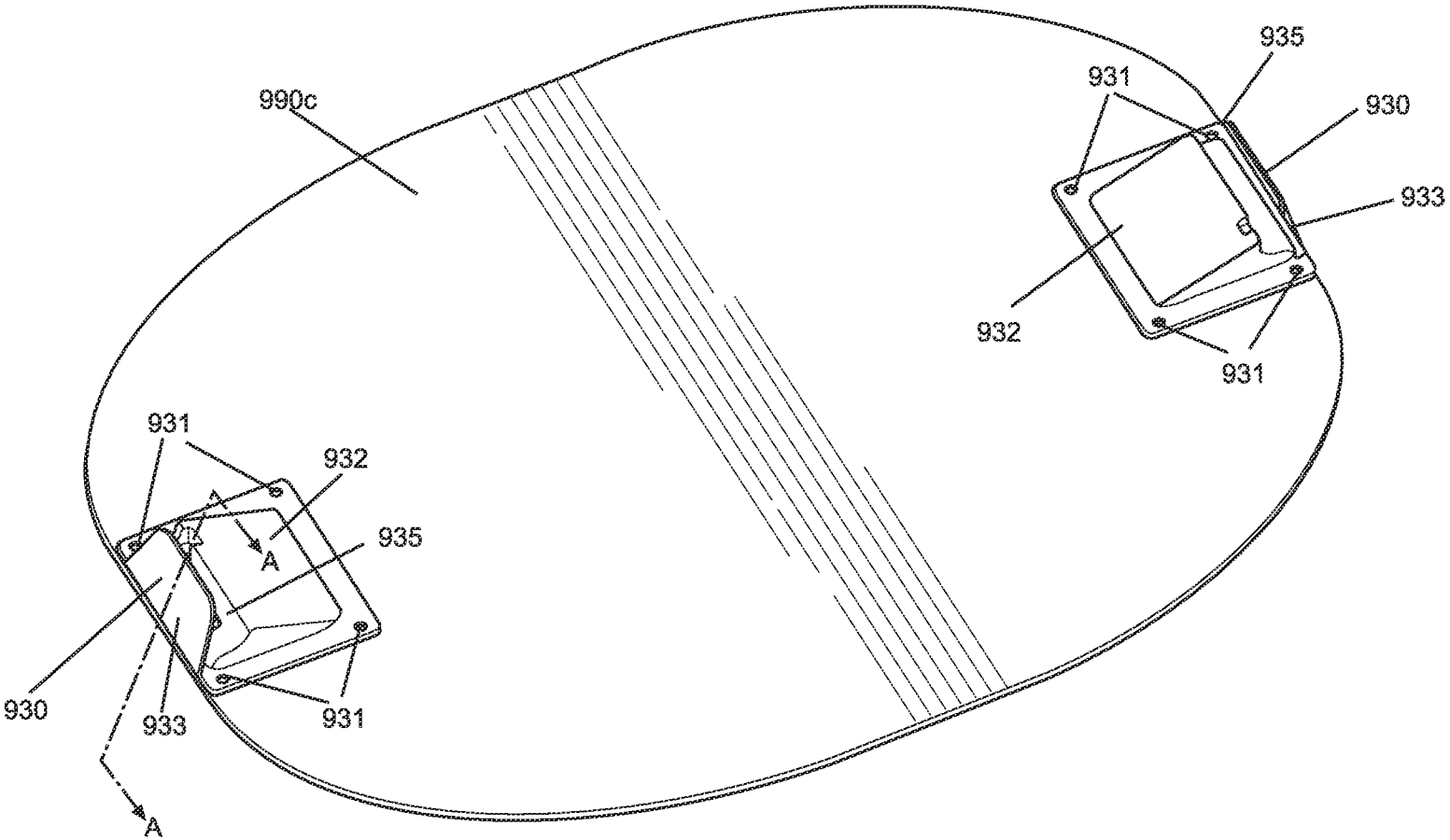

FIG. 82A shows a bottom perspective view of a support platform in the bassinet topper of FIG. 79A.

Figure 82B:
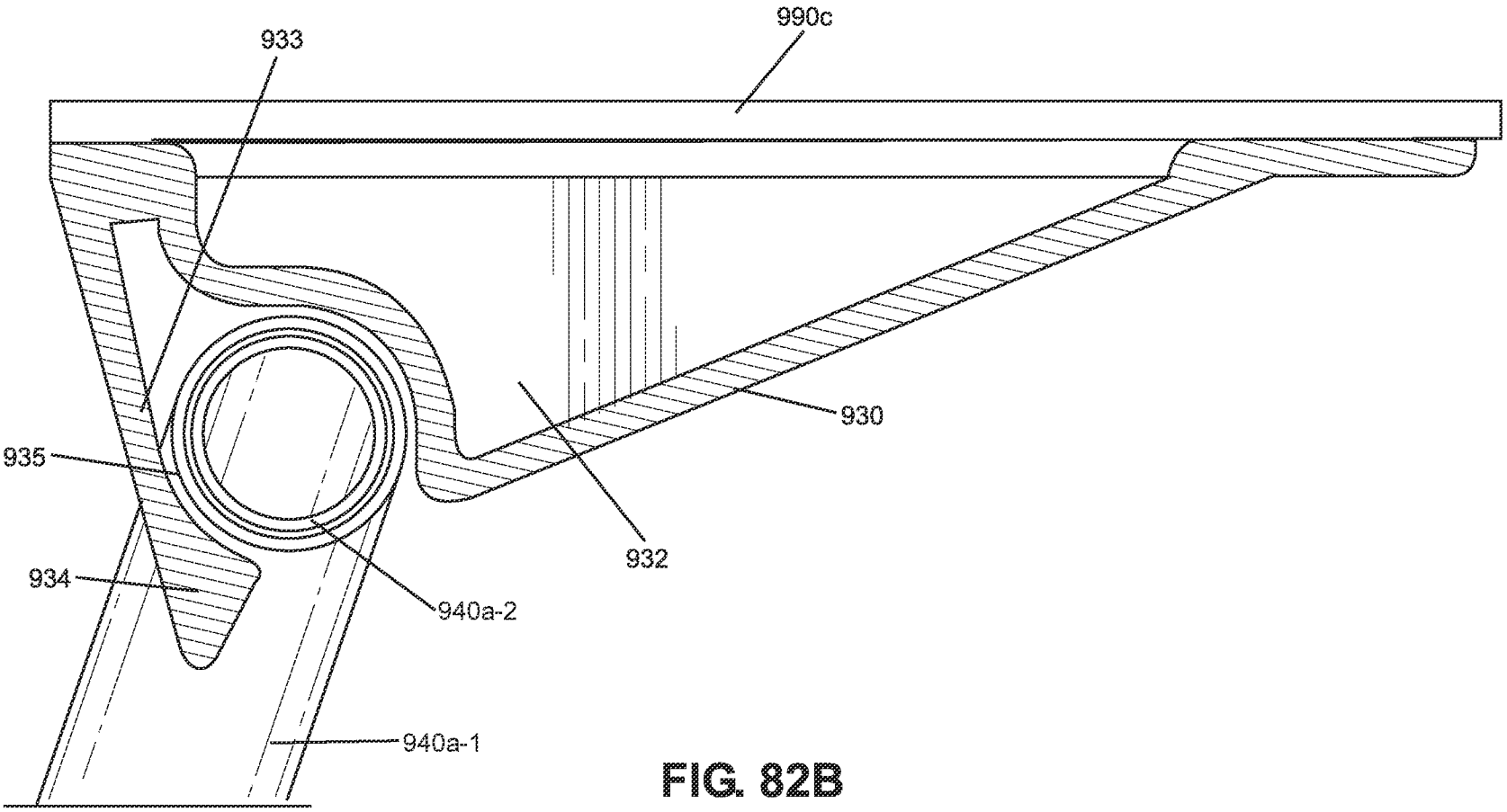

FIG. 82B shows a cross-sectional view of the support platform corresponding to the plane A-A of FIG. 82A.

Figure 83A:
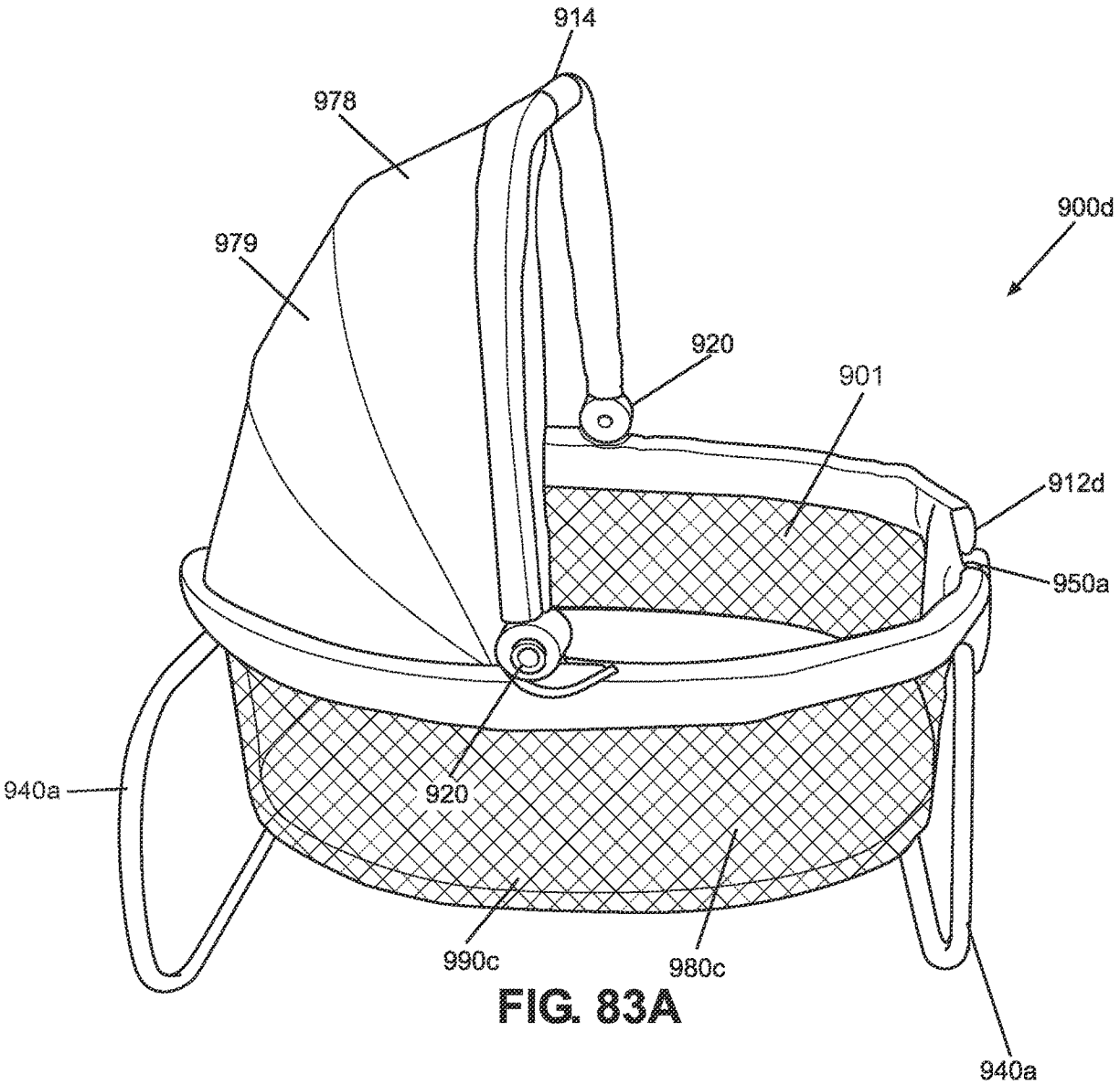

FIG. 83A shows a top, left perspective view of the bassinet topper of FIG. 79A with soft goods placed on the ground.

Figure 83B:
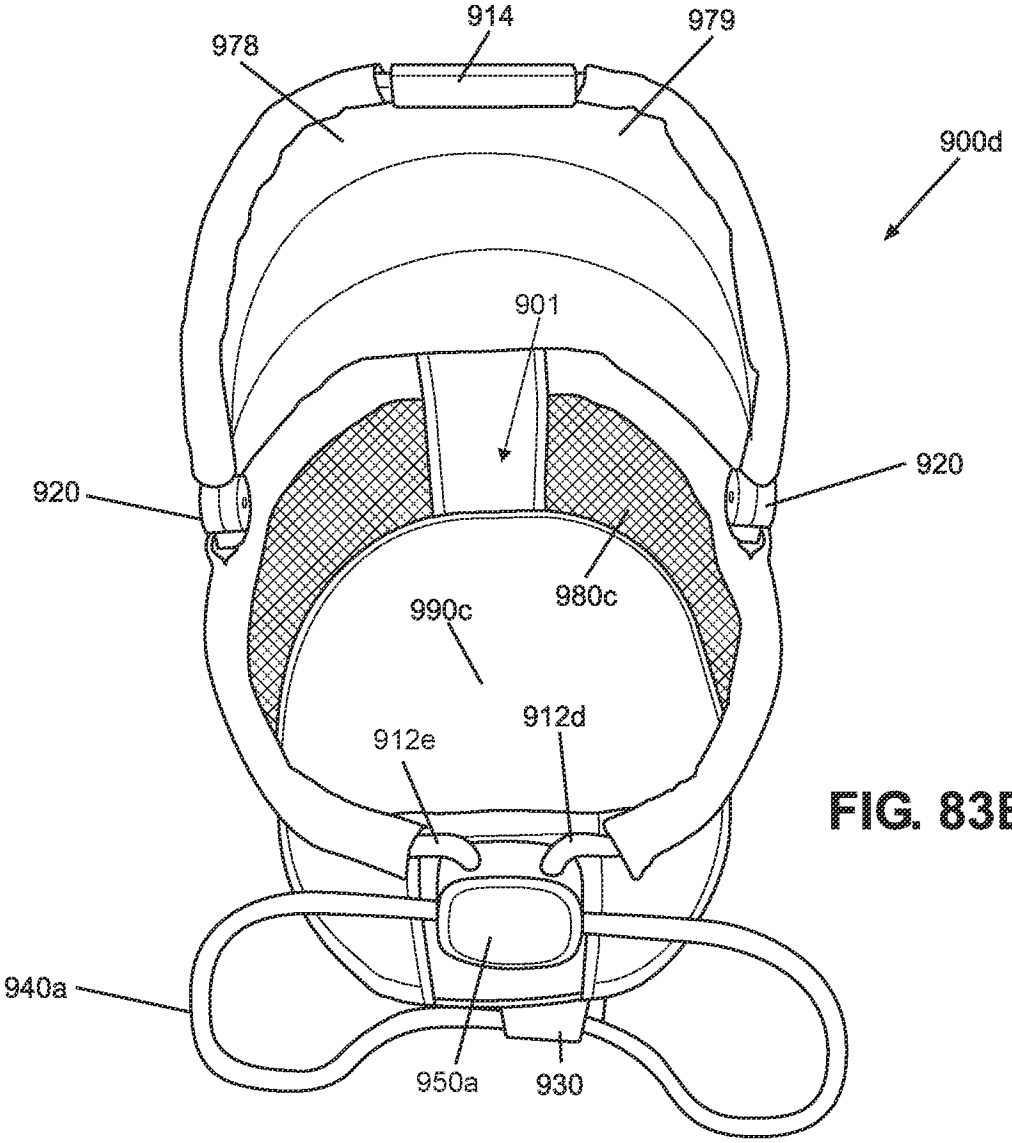

FIG. 83B shows a top, front perspective view of the bassinet topper of FIG. 83A.

Figure 84A:
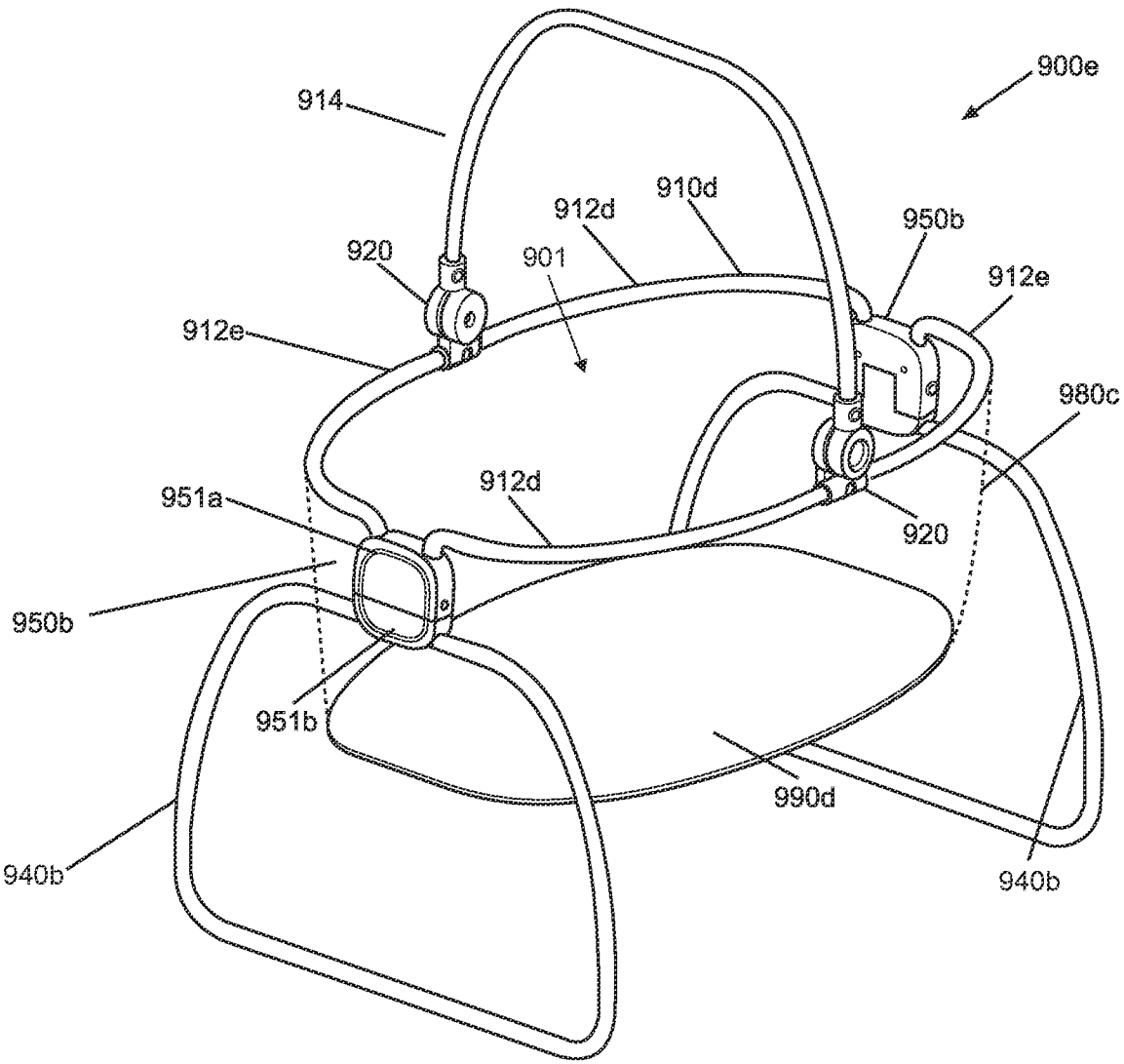

FIG. 84A shows a top, front, right perspective view of another exemplary collapsible bassinet topper. The bassinet topper includes a support platform supported by soft goods and a housing with an integral folding and locking mechanism. The bassinet topper is shown in a setup configuration.

Figure 84B:
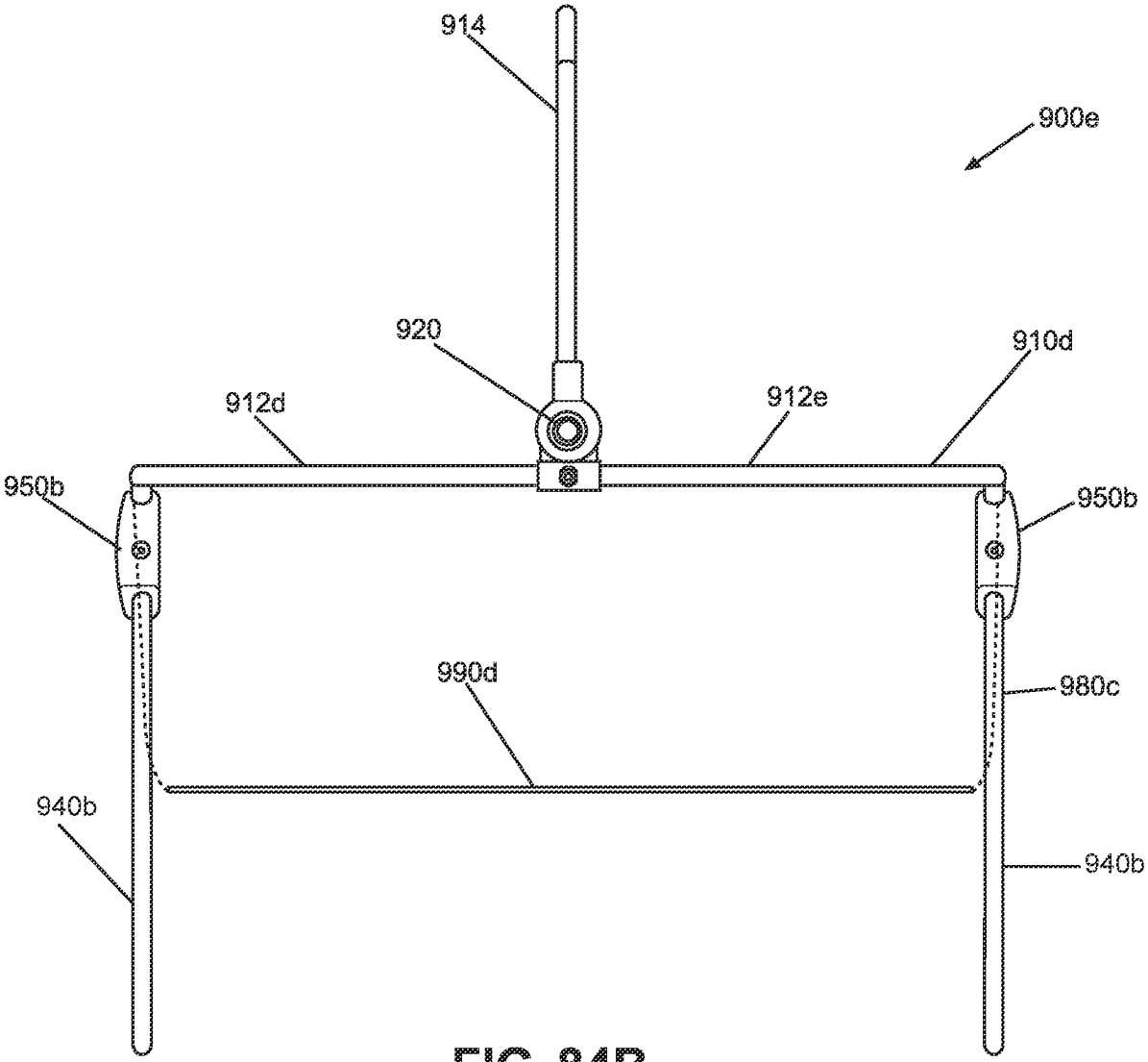

FIG. 84B shows a right-side view of the bassinet topper of FIG. 84A.

Figure 84C:
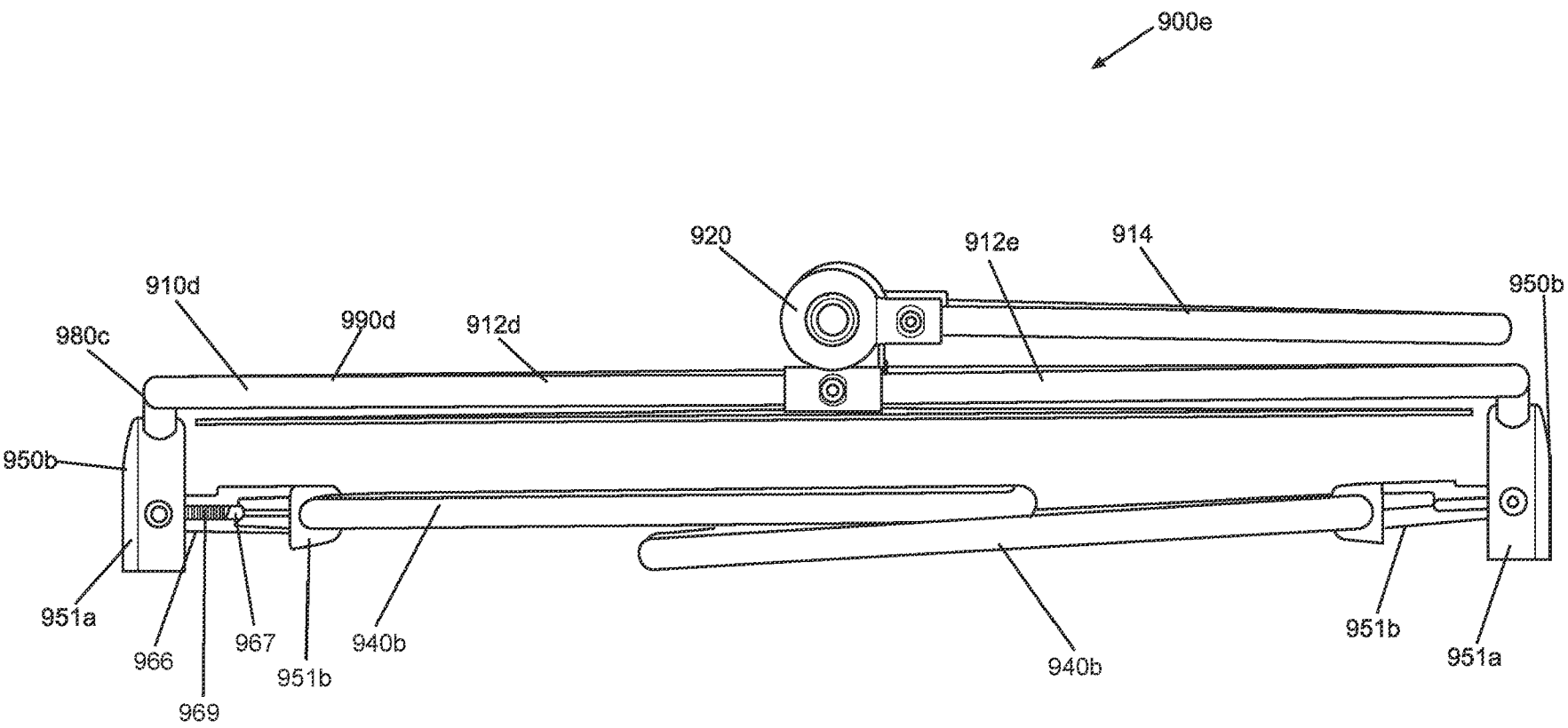

FIG. 84C shows a right-side view of the bassinet topper of FIG. 84A in a storage configuration.

Figure 85:
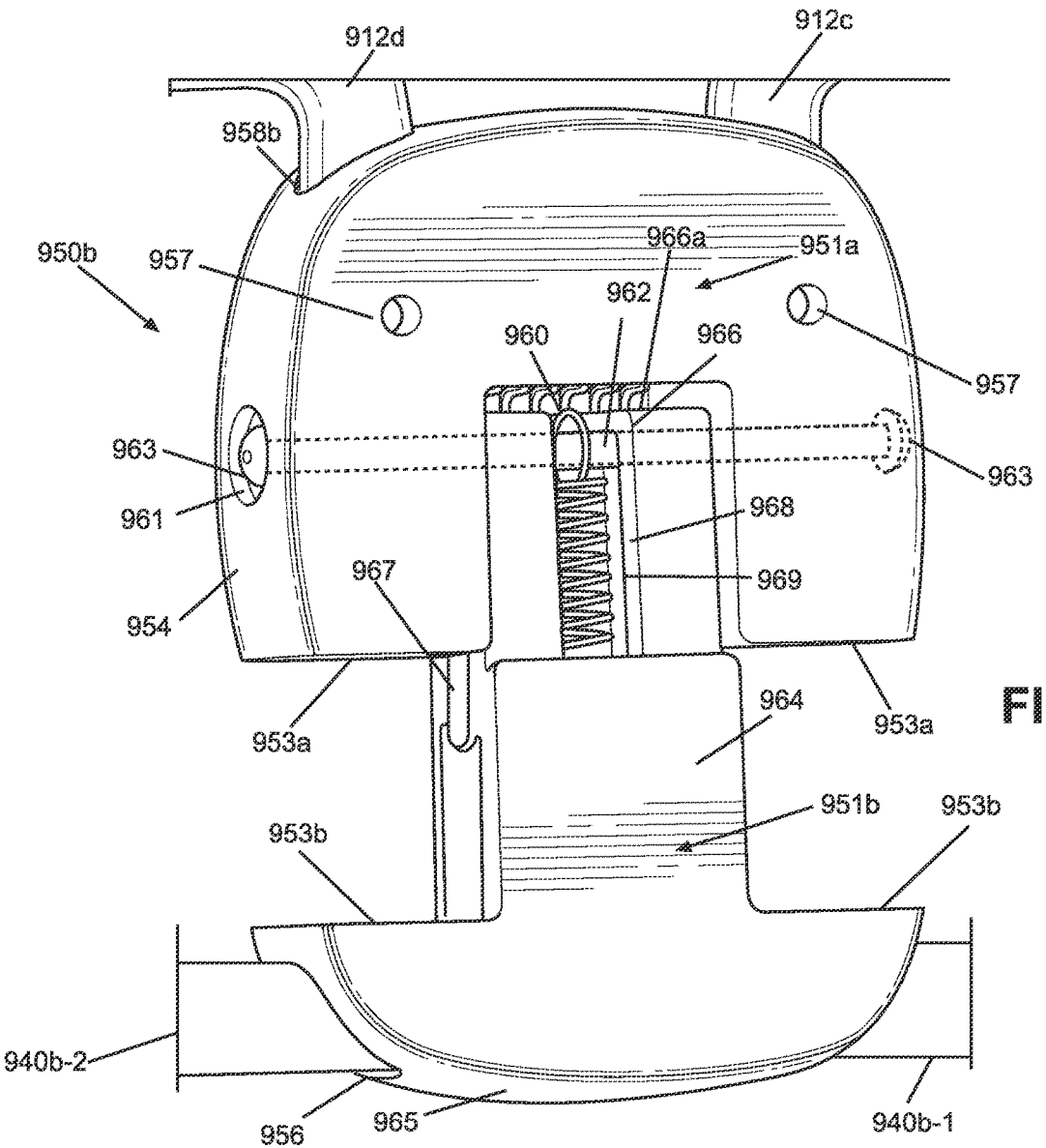

FIG. 85 shows a magnified rear, right perspective view of the housing of FIG. 84A where the housing is partially unfolded. The housing may also be viewed as being partially folded.

Figure 86A:
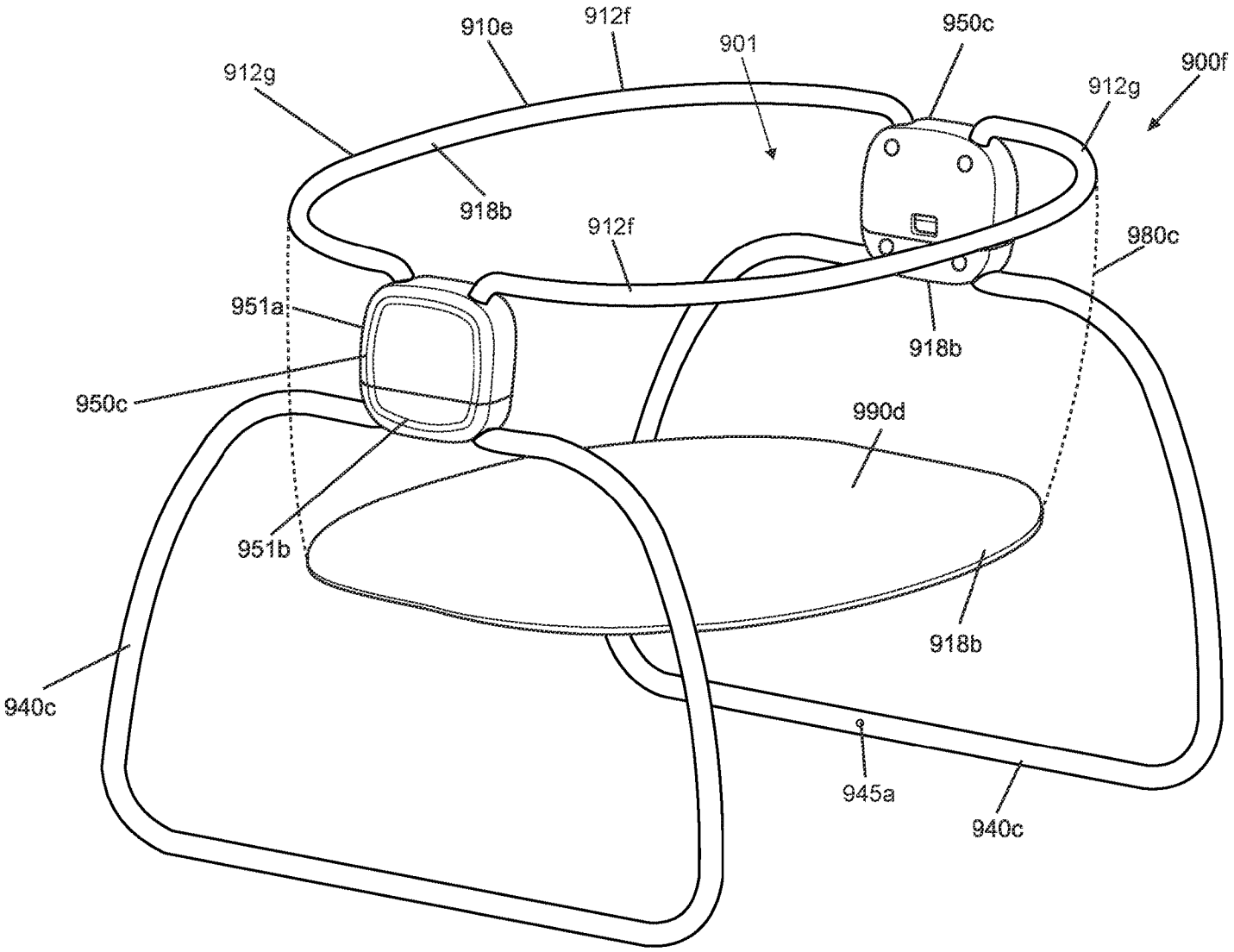

FIG. 86A shows a top, front, right perspective view of another exemplary collapsible bassinet topper. The bassinet topper includes a support platform supported by soft goods and a housing with a snap-fit mechanism to facilitate assembly for a setup configuration or disassembly for a storage configuration. The bassinet topper is shown in the setup configuration.

Figure 86B:
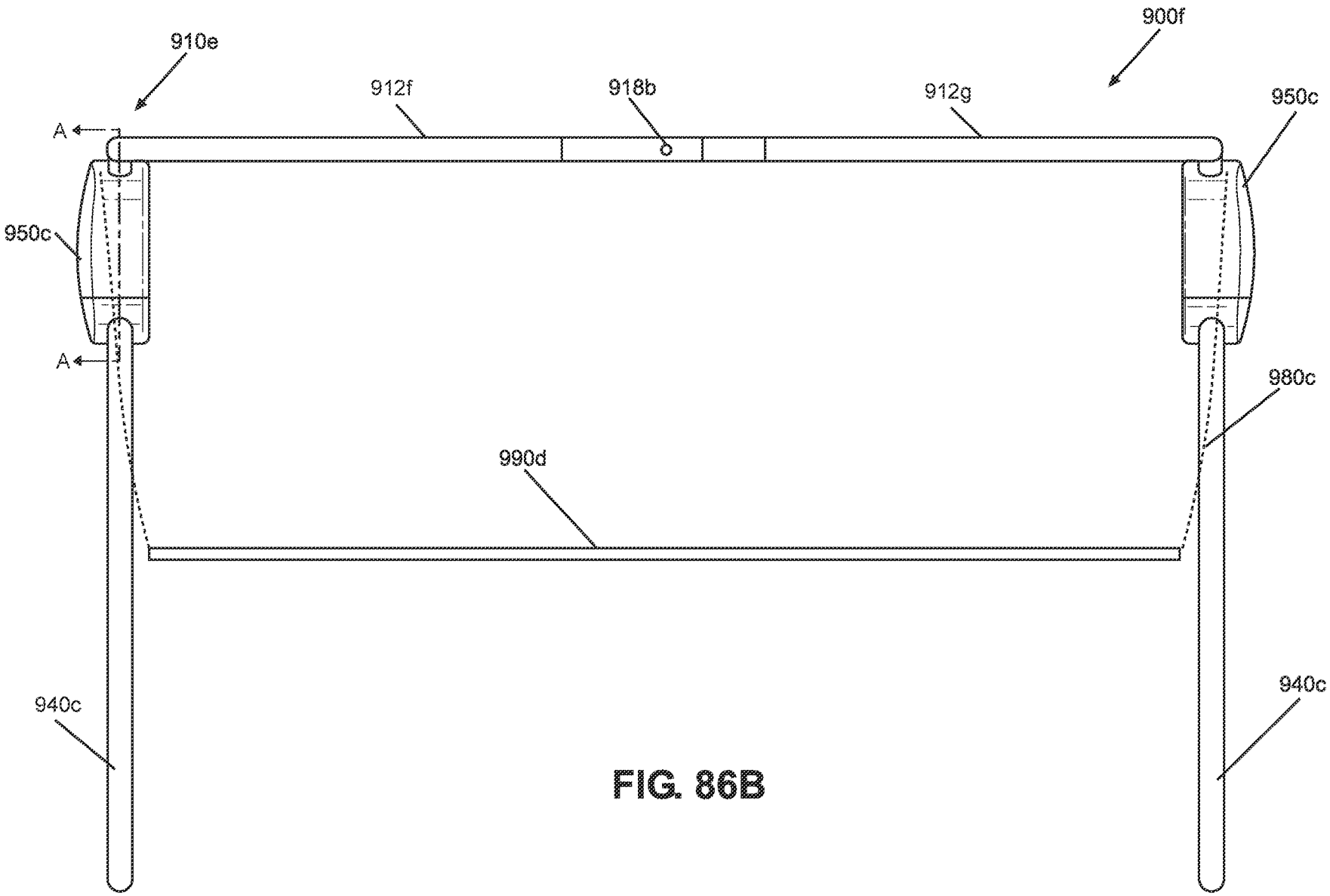

FIG. 86B shows a right-side view of the bassinet topper of FIG. 86A.

Figure 86C:
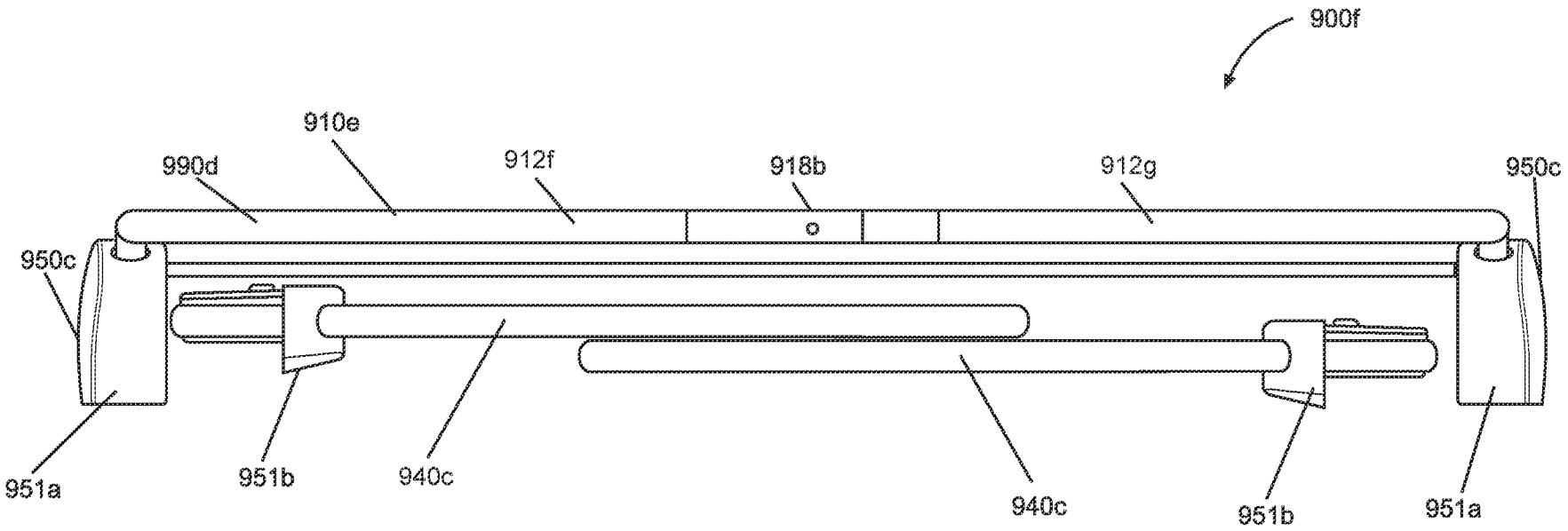

FIG. 86C shows a right-side view of the bassinet topper of FIG. 86A in the storage configuration.

Figure 87A:
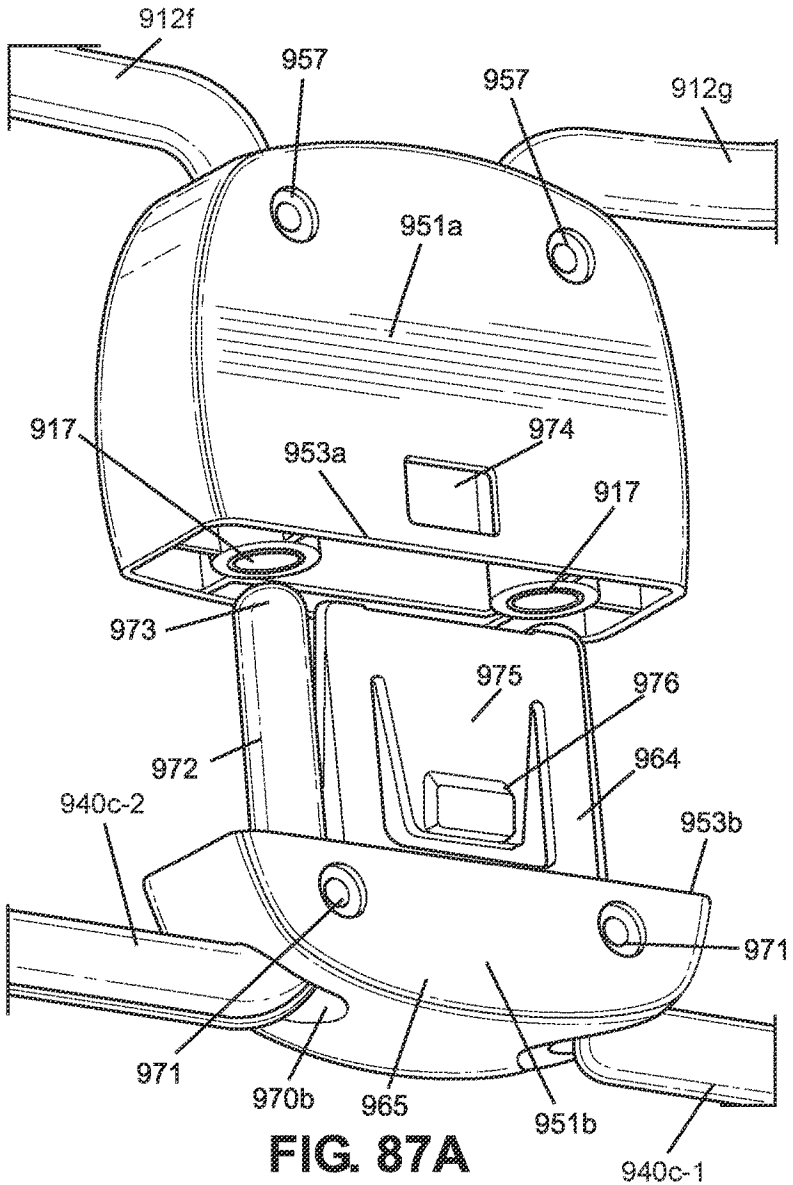

FIG. 87A shows a magnified rear, right perspective view of the housing of FIG. 86A with a top housing separated from a bottom housing.

Figure 87B:
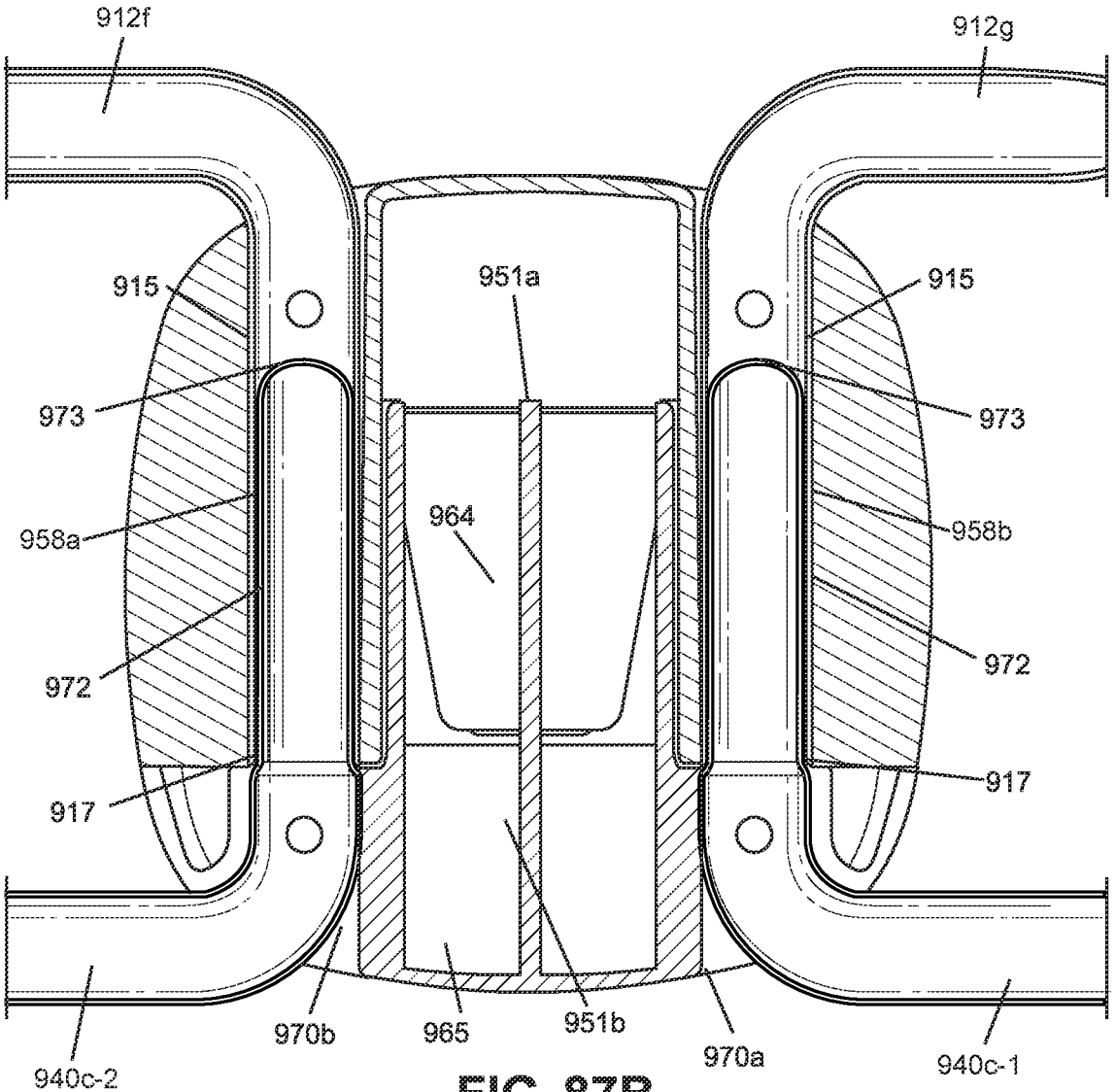

FIG. 87B shows a cross-sectional view of the housing, top rails, and legs corresponding to the plane A-A of FIG. 86B.

DETAILED DESCRIPTION

Following below are more detailed descriptions of various concepts related to, and implementations of, foldable playards that include; 1) a mechanically-sound rigid frame with a simpler construction compared to conventional playards that is easier to operate and provides desired clearances in accordance to various consumer safety standards; 2) soft goods attached to the frame to provide a partially enclosed space for the child; optionally 3) a canopy cover assembly mounted to the frame to provide shade for the child; optionally 4) a bassinet accessory coupled to the frame and/or the soft goods to provide an elevated surface to support the child; optionally 5) a topper coupled to the frame and/or the soft goods to provide a changing table and an organizer for a care station for the child; and optionally (6) a bassinet topper disposed on the playard frame, soft goods, and/or the bassinet accessory, that is collapsible and/or freestanding. It should be appreciated that various concepts introduced above and discussed in greater detail below may be implemented in multiple ways. Examples of specific implementations and applications are provided primarily for illustrative purposes so as to enable those skilled in the art to practice the implementations and alternatives apparent to those skilled in the art.

The figures and example implementations described below are not meant to limit the scope of the present implementations to a single embodiment. Other implementations are possible by way of interchange of some or all of the described or illustrated elements. Moreover, where certain elements of the disclosed example implementations may be partially or fully implemented using known components, in some instances only those portions of such known components that are necessary for an understanding of the present implementations are described, and detailed descriptions of other portions of such known components are omitted so as not to obscure the present implementations.

In the discussion below, various examples of inventive foldable playards and accompanying accessories are provided, wherein a given example or set of examples showcases one or more particular features of a frame, a X-frame assembly, a leg support assembly, a latch, soft goods, a canopy cover assembly, a bassinet accessory, an attachment mechanism for a topper, a reconfigurable topper with a changing table and an organizer, and a bassinet topper. It should be appreciated that one or more features discussed in connection with a given example of a foldable playard and/or an accessory may be employed in other examples of foldable playards and accessories according to the present disclosure, such that the various features disclosed herein may be readily combined in a given foldable playard and/or accessory according to the present disclosure (provided that respective features are not mutually inconsistent).

Certain dimensions and features of the foldable playard and the accessories are described herein using the terms "approximately," "about," "substantially," and/or "similar." As used herein, the terms "approximately," "about," "substantially," and/or "similar" indicates that each of the described dimensions or features is not a strict boundary or parameter and does not exclude functionally similar variations therefrom. Unless context or the description indicates otherwise, the use of the terms "approximately," "about," "substantially," and/or "similar" in connection with a numerical parameter indicates that the numerical parameter includes variations that, using mathematical and industrial principles accepted in the art (e.g., rounding, measurement or other systematic errors, manufacturing tolerances, etc.), would not vary the least significant digit.

An Exemplary Foldable Playard with X-Frame Assemblies

Figure 2B:
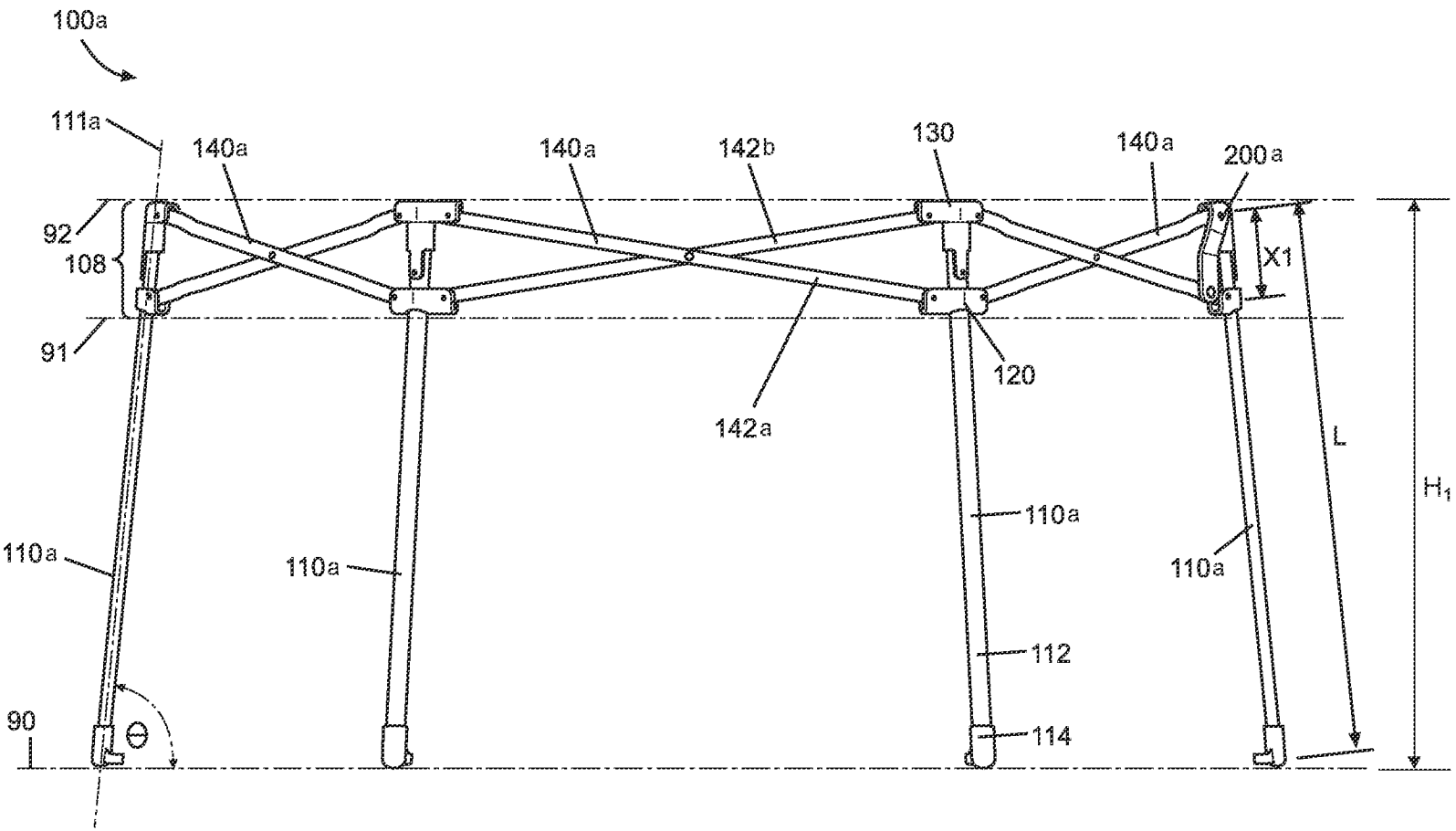
FIG. 2B shows a front view of the playard of FIG. 2A.
Figure 2C:
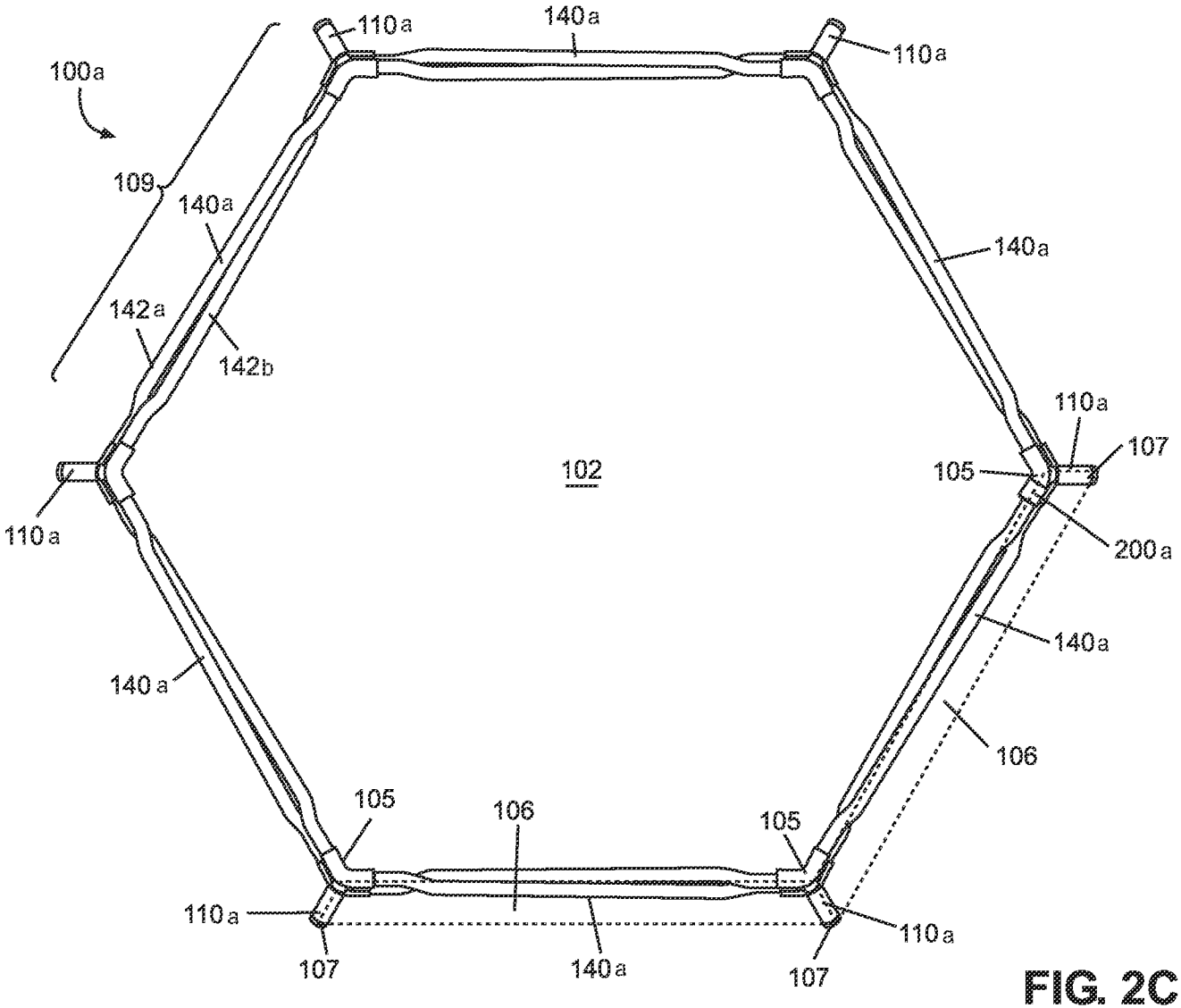
FIG. 2C shows a top view of the playard of FIG. 2A.
Figure 2D:
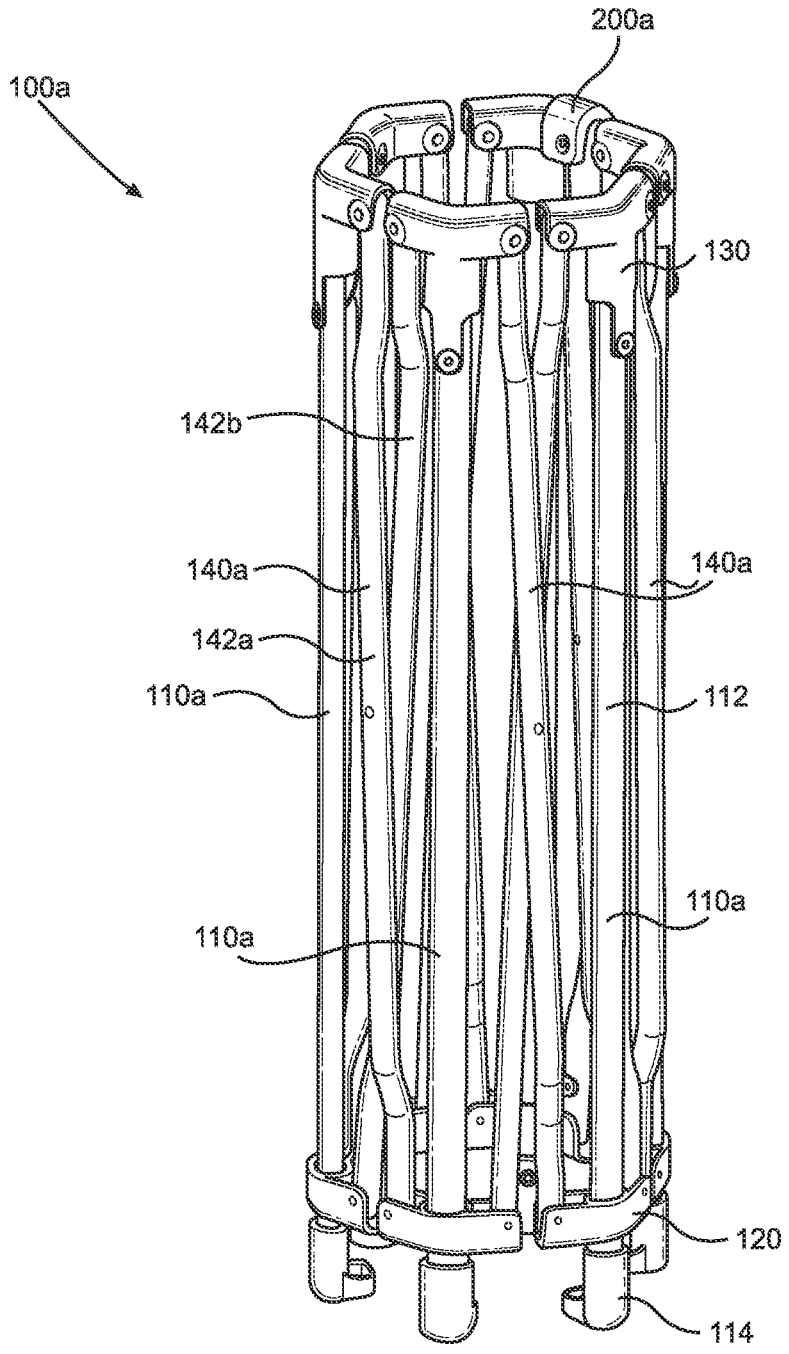
FIG. 2D shows a top perspective view of the playard of FIG. 2A in a folded configuration.

FIGS. 2A-2C show an exemplary frame 100*a* for a foldable playard in an unfolded configuration. As shown, the frame 100*a* may include multiple leg support assemblies 110*a* and multiple X-frame assemblies 140*a* that are arranged to outline and define an interior space 102. In particular, each leg support assembly 110*a* may be coupled to another adjacent leg support assembly 110*a* via a X-frame assembly 140*a* to form a closed frame structure (e.g., a frame that surrounds and separates the interior space 102 from the surrounding environment). As discussed further below in connection with FIG. 5A, in addition to the frame 100*a*, a foldable playard 1000*a* also includes soft goods 300 that are partially disposed within the interior space 102 to provide a padded, partially enclosed space 301 to contain a child 50. The soft goods 300 will be described in more detail below.

With reference again to FIG. 2A, the leg support assemblies 110*a* of the frame 100*a* may provide vertical or nearly vertical support stands that define the spatial extent of the interior space 102 in the unfolded configuration. In other words, the leg support assemblies 110*a* may define and/or otherwise be disposed along side edges 104 of the interior space 102. The X-frame assemblies 140*a* may provide the structural support to position and orient the leg support assemblies 110*a* as desired, as well as provide a mechanism to facilitate folding and/or unfolding of the frame 100*a*. As shown in FIG. 2A, each X-frame assembly 140*a* may define and/or otherwise be disposed on a side face 106 of the interior space 102 between adjacent side edges 104.

For the frame 100*a* shown in FIGS. 2A-2C, the interior space 102 has a horizontal cross-section (i.e., a cross-section in a plane parallel to a ground 90 supporting the frame 100*a*) shaped as a regular hexagon. However, it should be appreciated that in other implementations disclosed herein and discussed in further detail below, the number of leg support assemblies 110*a* and/or X-frame assemblies 140*a* may be adjusted to form interior spaces 102 with different horizontal cross-sectional shapes including, but not limited to a square, a rectangle, a pentagon, a hexagon, an octagon, a regular polygon, and an irregular polygon (i.e., the sides have different dimensions).

In some implementations, the interior space 102 may further form a three-dimensional volume shaped as a right prism. Said in another way, the leg support assemblies 110*a* may be vertically oriented such that the horizontal cross-section of the interior space 102 is identical or substantially identical in shape and dimensions at any vertical position along the length of the leg support assemblies 110*a*. In other implementations, the interior space 102 may form a three-dimensional volume shaped as a truncated pyramid where a bottom portion of the interior space 102 near the ground 90 is larger than a top portion of the interior space 102. Said in another way, the leg support assemblies 110*a* may be tilted when the frame 100*a* is deployed such that the top portions of the leg support assemblies 110*a* are positioned closer together than a bottom portion of the leg support assemblies 110*a* so that the area of the horizontal cross-section of the interior space 102 decreases from the bottom portion to the top portion of the leg support assemblies 110*a* if the leg support assemblies 110*a* are substantially straight in shape. In one aspect, a frame 100*a* forming a truncated pyramidal interior space 102 may be preferable for enhancing mechanical stability. The manner in which this geometry is achieved will be discussed in more detail below.

Figure 4A:
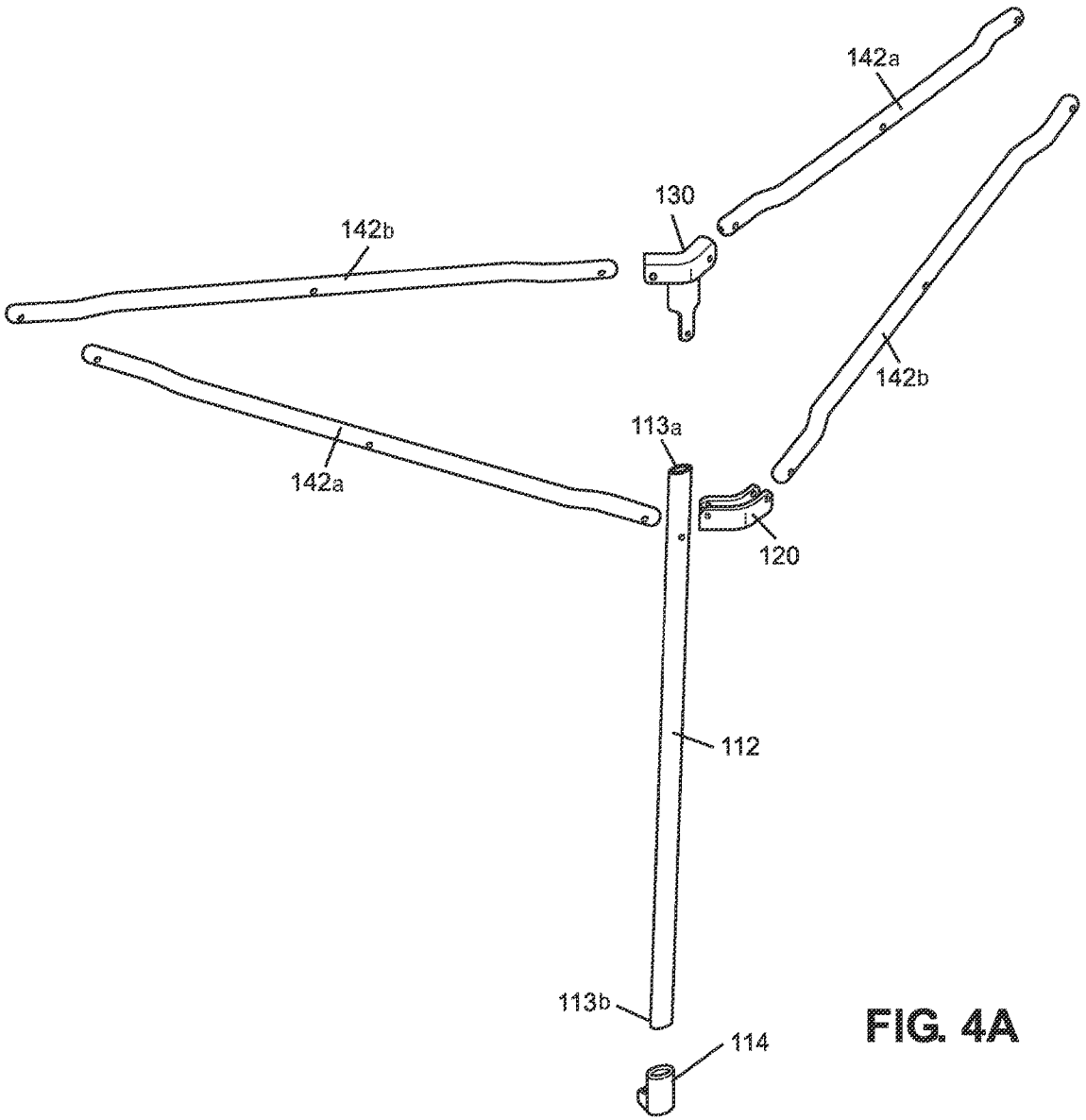
FIG. 4A shows an exploded top perspective view of the X-frame assembly of FIG. 3A and the leg support assembly of FIG. 3C.

In the frame 100*a* shown in FIG. 2A, each leg support assembly 110*a* may include a leg tube 112 having a top end 113*a* and a bottom end 113*b* (see, for example, FIG. 4A), a foot 114 coupled to the bottom end 113*b* to support the frame 100*a* on the ground 90, a corner 130 coupled to the top end 113*a* of the leg tube 112, and a slider 120 that is slidably coupled to the leg tube 112 and positioned between the foot 114 and the corner 130. The top end 113*a* of the leg tube 112 and/or the corner 130 may coincide with a top vertex 105 of the interior space 102 and the bottom end 113*b* of the leg tube 112 and/or the foot 114 may coincide with a bottom vertex 107 of the interior space 102.

In this implementation, each X-frame assembly 140*a* may include a pair of X-frame tubes 142*a* and 142*b* (also referred to as X-tubes 142*a* and 142*b*) that are arranged to cross one another to form a single X-shaped structure. It should be appreciated the term X-frame tube refers to a tube that forms part of the X-frame assembly and is not intended to limit the tube to a particular geometry or shape. The X-frame tubes 142*a* and 142*b* may be rotatably coupled to each other and to respective corners 130 and sliders 120 of adjacent leg support assemblies 110*a*. Thus, the X-frame assemblies 140*a* are pivot and slidable X-frame assemblies where the X-frame tubes 142*a* and 142*b* rotate relative to each other and the leg support assemblies 110*a* and translate relative to the leg tubes 112 via movement of the sliders 120. This enables the frame 100*a* to be folded into a more compact structure that occupies less volume and/or allows for a larger interior space 102 compared to, for example, conventional playards with pivot-only X-frame assemblies.

In some implementations, the manner in which the multiple X-frame assemblies 140*a* and the leg support assemblies 110*a* are coupled to each other may enable a caregiver to fold and/or unfold the frame 100*a* in a single step. For example, the caregiver may unfold the frame 100*a* by moving the slider 120 in one leg support assembly 110*a* towards the corner 130. The motion of the slider 120, in turn, causes the adjoining X-frame assemblies 140*a* to rotate and translate. The motion of the adjoining X-frame assemblies 140*a*, in turn, causes the sliders 120 in the adjacent leg support assemblies 110*a* to move in a similar manner. This process may occur simultaneously for all X-frame assemblies 140*a* and all sliders 120 resulting in the frame 100*a* being unfolded as the caregiver moves the slider 120 for the one leg support assembly 110*a*. Once the frame 100*a* is unfolded, a latch 200*a*, which will be described in more detail below, may be actuated to lock the frame 100*a* in the unfolded configuration (e.g., the latch 200*a* prevents the sliders 120 from sliding back down the respective leg tubes 112 towards the feet 114).

In some implementations, the frame 100*a* may be folded and/or unfolded with the feet 114 of the leg support assemblies 110*a* remaining in contact with the ground 90. The leg tubes 112 may also remain vertically upright or nearly vertically upright (e.g., leg tubes 112 may intentionally be tilted when the frame 100*a* is unfolded to improve stability) as the frame 100*a* is folded and/or unfolded. In this manner, the process of folding and/or unfolding the frame 100*a* may be made easier for the caregiver. For example, the caregiver would not have to balance the frame 100*a* from tipping over while setting up and/or tearing down the playard 1000*a*.

With reference to FIG. 2B, in some implementations, the X-frame tubes 142*a* and 142*b* of each X-frame assembly 140*a* may be positioned within a top portion 108 of the frame 100*a* and/or the interior space 102 when the frame 100*a* is unfolded. Said in another way, the X-frame assemblies 140*a* may form a perimeter structure around the top portion 108 of the frame 100*a* that outlines the horizontal cross section of the top opening of the interior space 102. For example, FIG. 2C shows the X-frame assemblies 140*a* form a top perimeter structure 109 that outlines a regular hexagon corresponding to the shape of the interior space 102.

Positioning the X-frame tubes 142*a* and 142*b* in the top portion 108 of the frame when the frame is in the unfolded configuration provides several benefits to the frame 100*a* and, in turn, to a foldable playard comprising the frame 100*a*.

First, each X-frame assembly 140*a* in the frame 100*a* may function as a top rail that couples together two adjacent leg support assemblies 110*a* and provides mechanical rigidity and stability to the frame 100*a*. Said in another way, the X-frame assembly 140*a* may be unfolded to such an extent that the X-frame tubes 142*a* and 142*b* form a shallow X-frame structure in the top portion 108 of the frame that effectively functions as a rigid top rail. For example, in the limit where the respective sliders 120 are positioned proximate to the respective corners 130 in adjacent leg support assemblies 110*a*, the X-frame tubes 142*a* and 142*b* may be in near parallel alignment with one another when viewing the frame 100*a* from the side or the front. Thus, each X-frame tube 142*a* and 142*b* may separately function as a top rail.

Figure 1A:
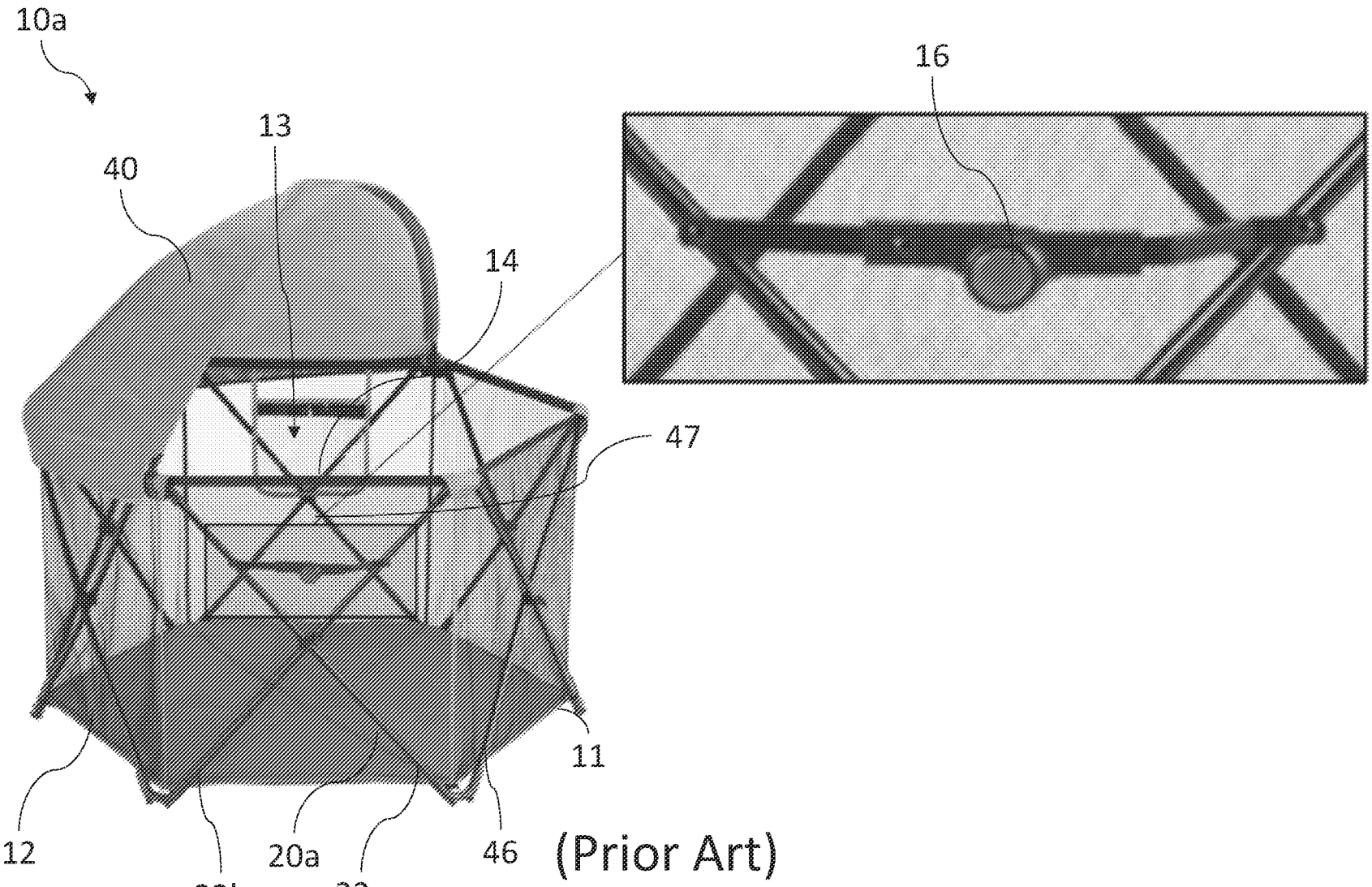
(Prior Art) FIG. 1A
FIG. 1A shows a conventional outdoor playard with a pivot-only X-frame assembly and a canopy cover.
Figure 1B:
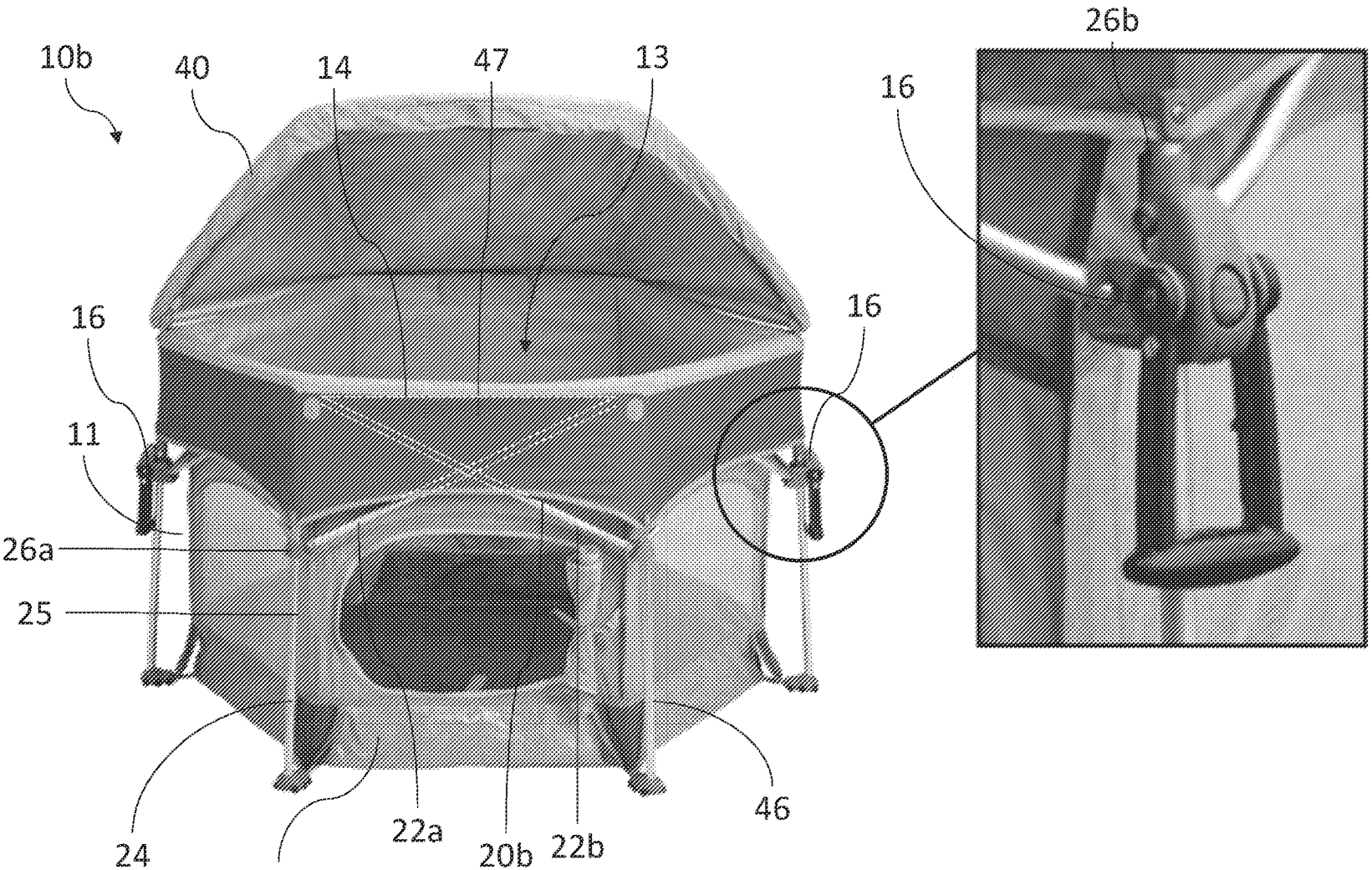
(Prior Art) FIG. 1B
FIG. 1B shows another conventional outdoor playard with a pivot and slidable X-frame assembly.
Figure 1C:
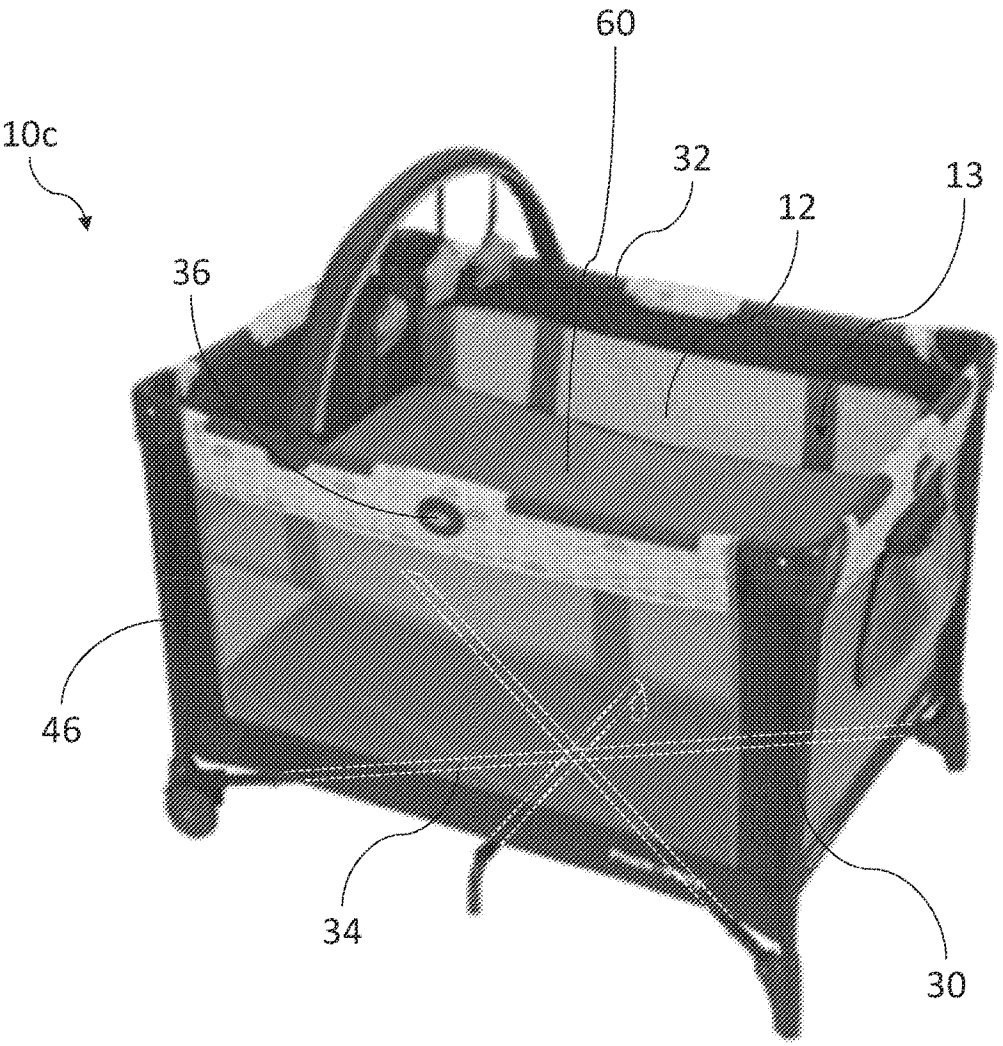
(Prior Art) FIG. 1C
FIG. 1C shows a conventional indoor playard.
Figure 1D:
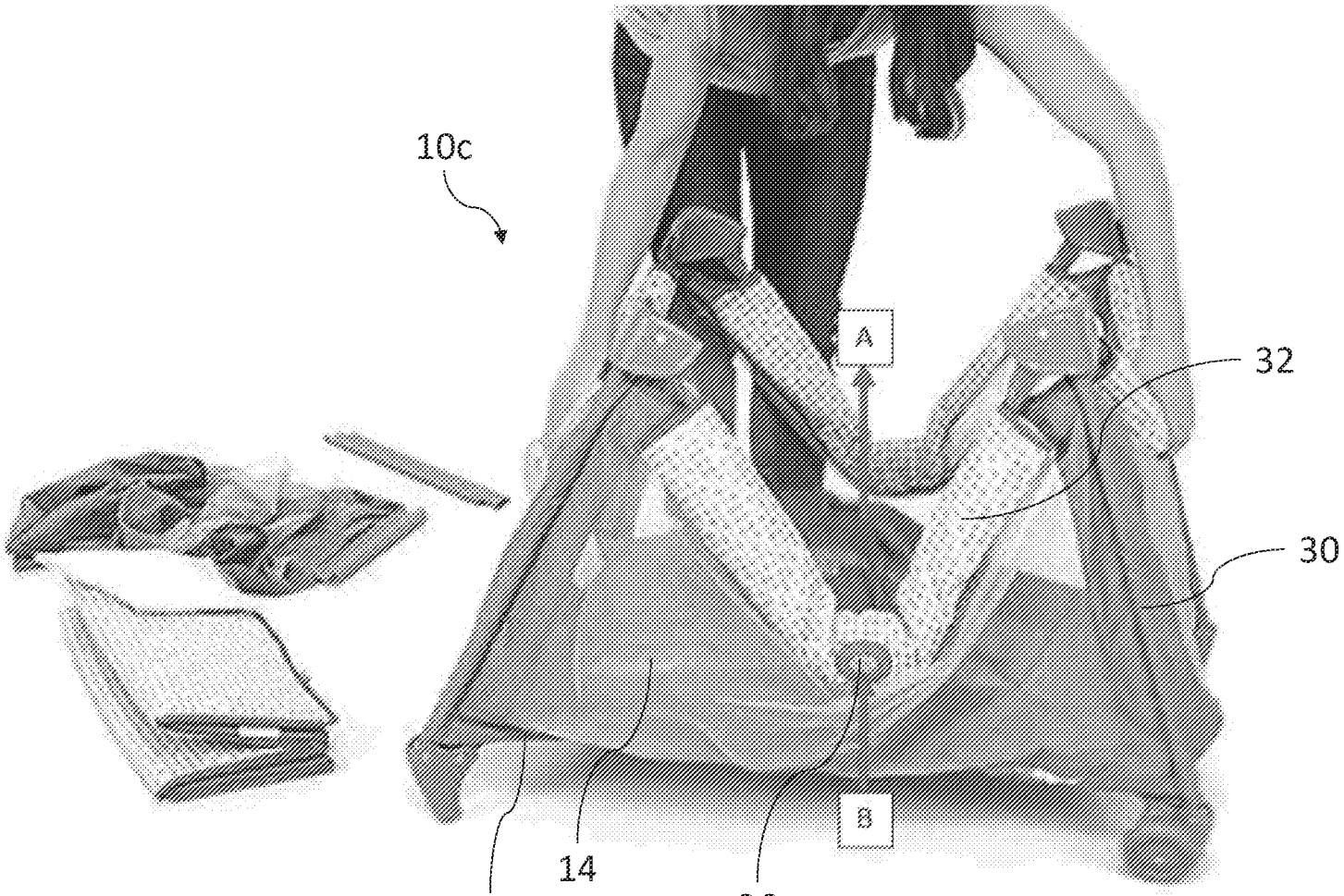
(Prior Art) FIG. 1D
FIG. 1D shows the indoor playard of FIG. 1C being folded for storage or transport.
Figure 1E:
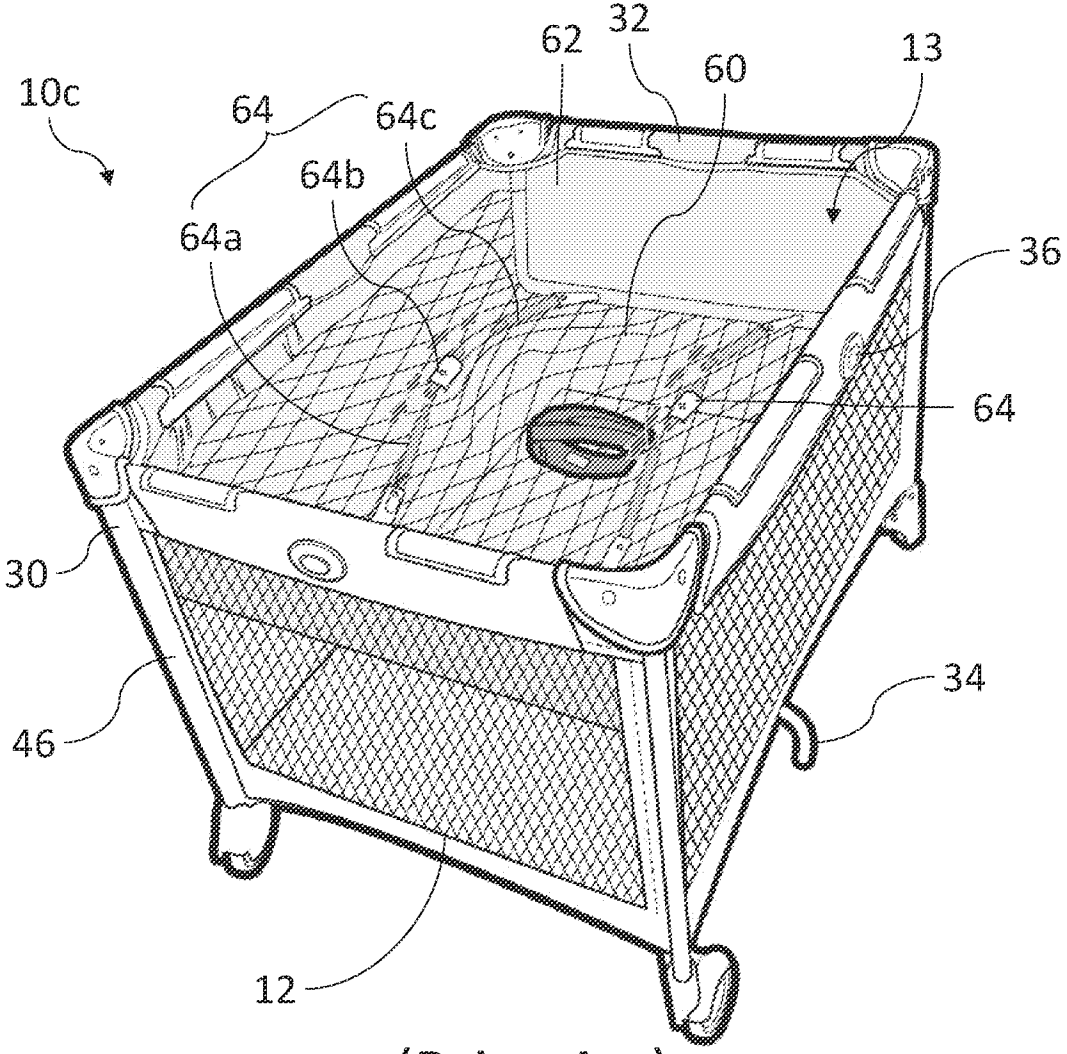
(Prior Art) FIG. 1E
FIG. 1E shows the assembly of a bassinet accessory for the indoor playard of FIG. 1C.
Figure 1F:
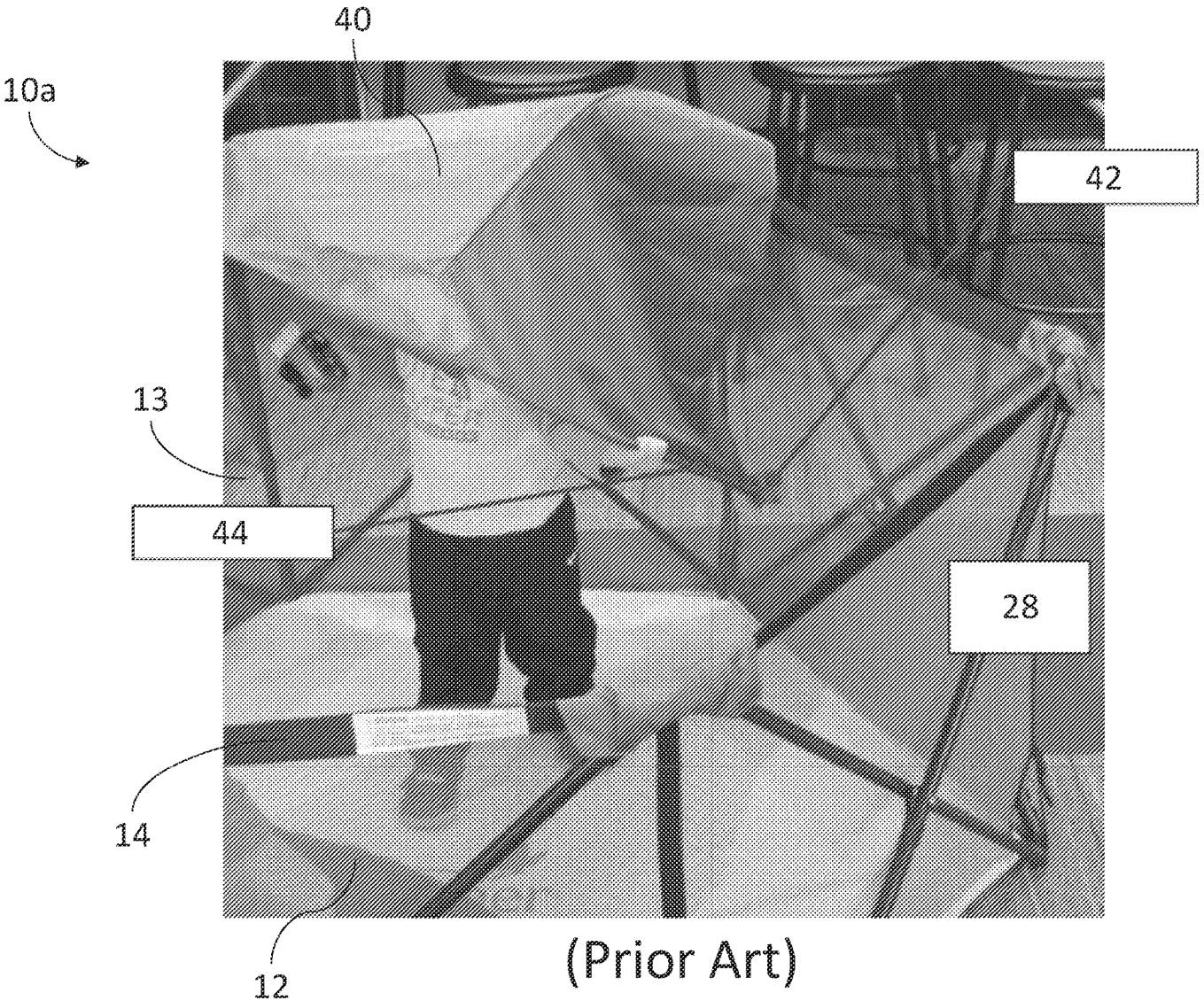
(Prior Art) FIG. 1F
FIG. 1F shows a conventional outdoor playard with a canopy cover assembly where the canopy cover is pulled off the corner of the X-frame assembly by a child located within the playard.
Figure 1G:
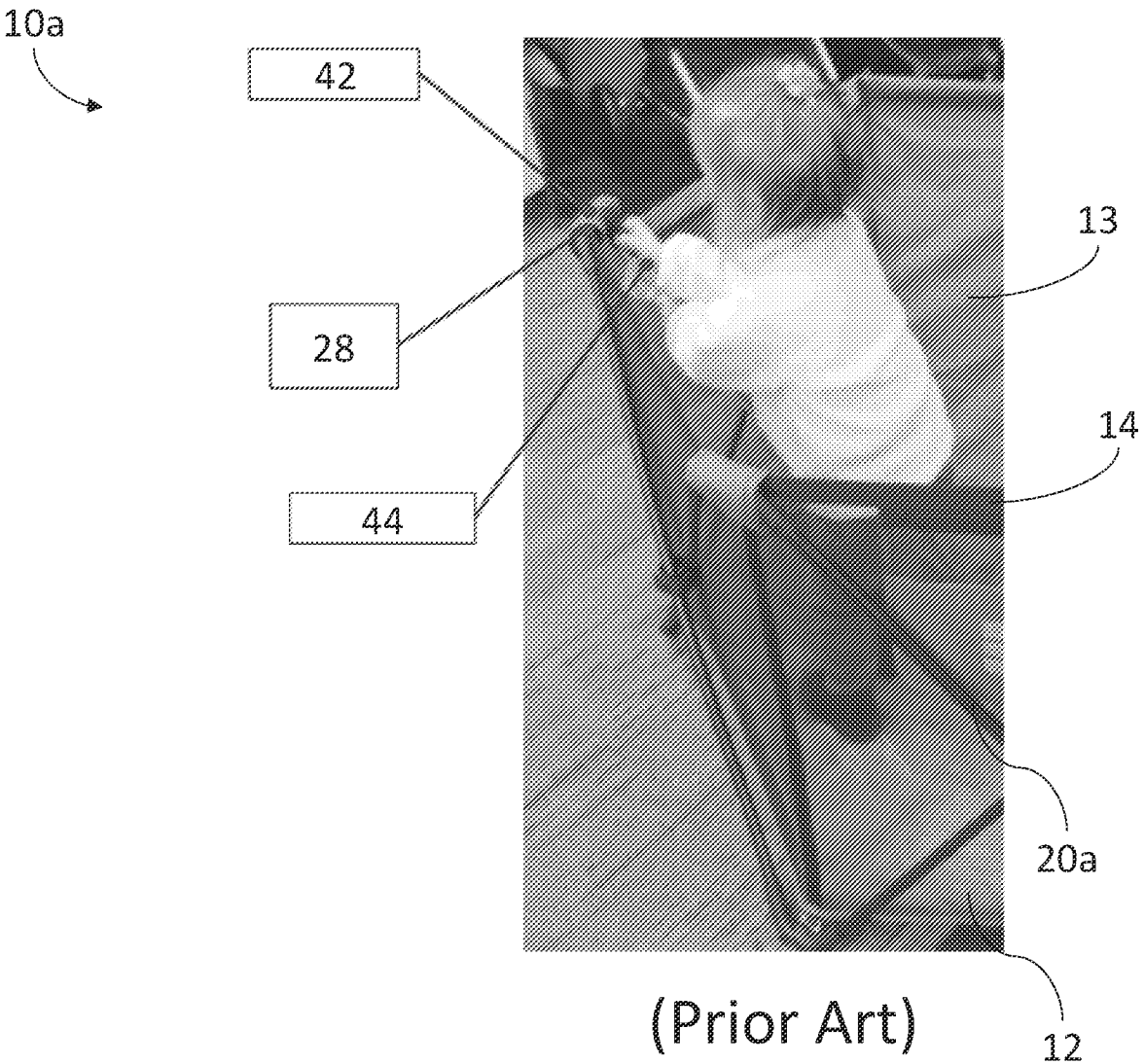
(Prior Art) FIG. 1G
FIG. 1G shows another conventional outdoor playard with a canopy cover assembly where the canopy cover is pulled inside the interior space of the playard by a child located within the playard.
Figure 1H:
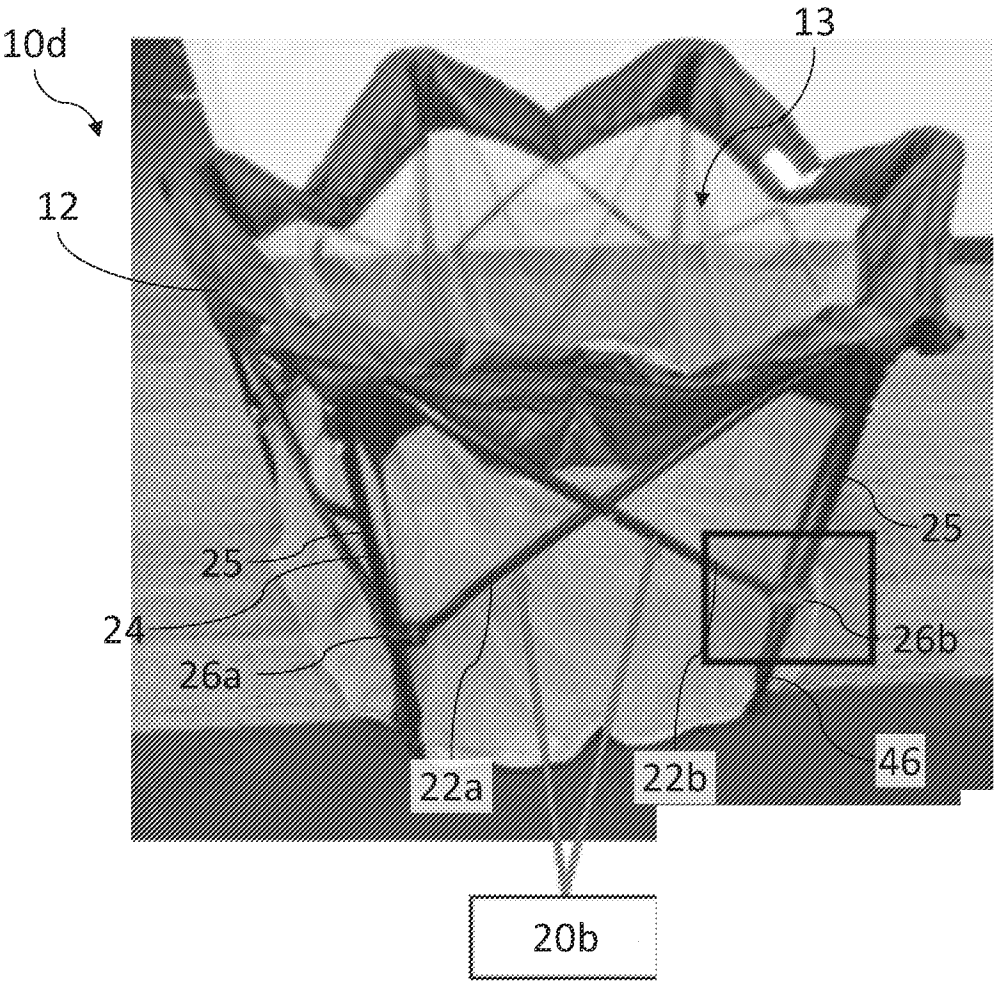
(Prior Art) FIG. 1H
FIG. 1H shows another conventional playard with a pivot and slidable X-frame assembly in a partially folded configuration.
Figure 1I:
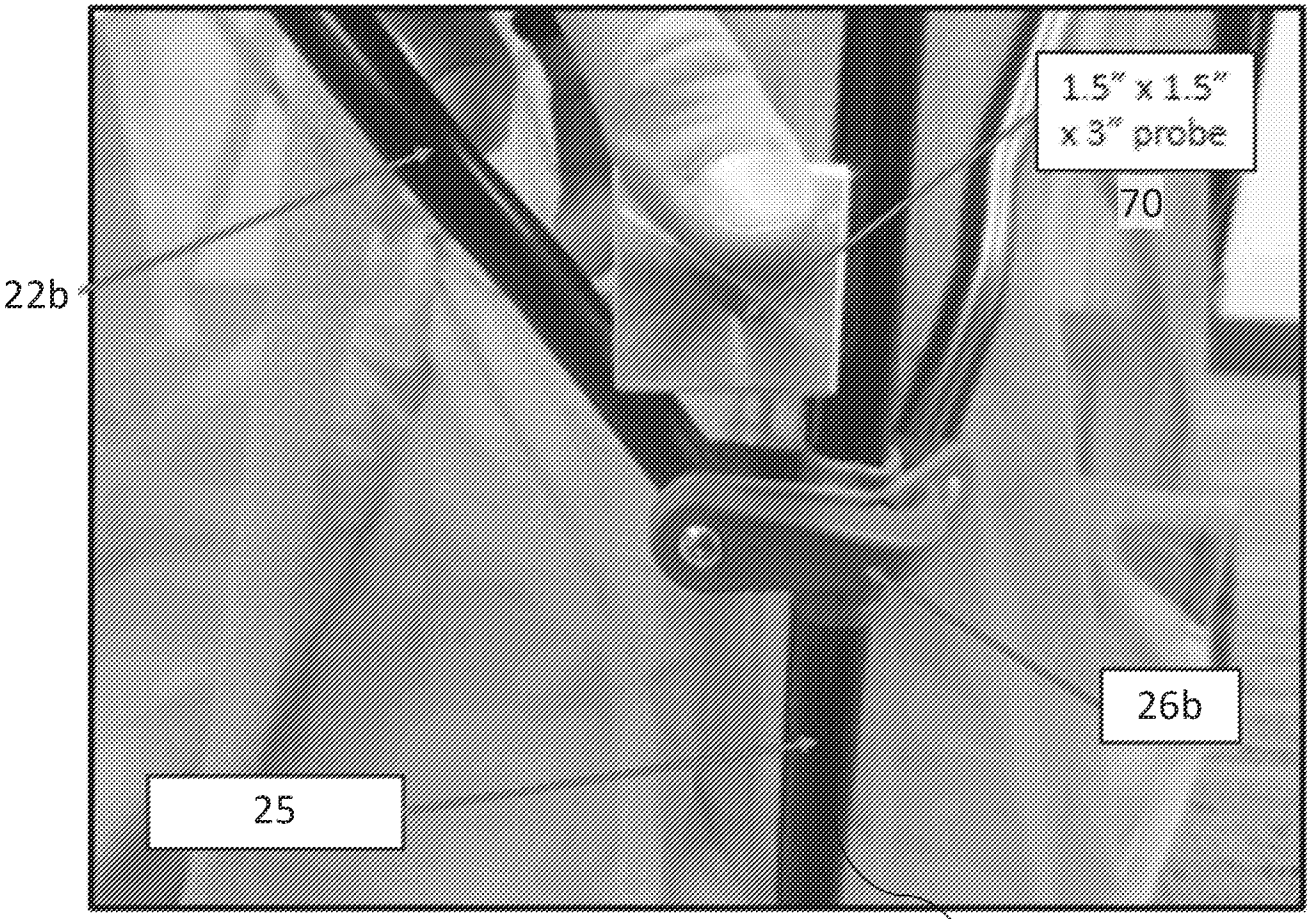
(Prior Art) FIG. 1I
FIG. 1I shows a magnified view of a test probe placed near the slider and between the X-frame tube and the leg tube in the playard of FIG. 1H.
Figure 1J:
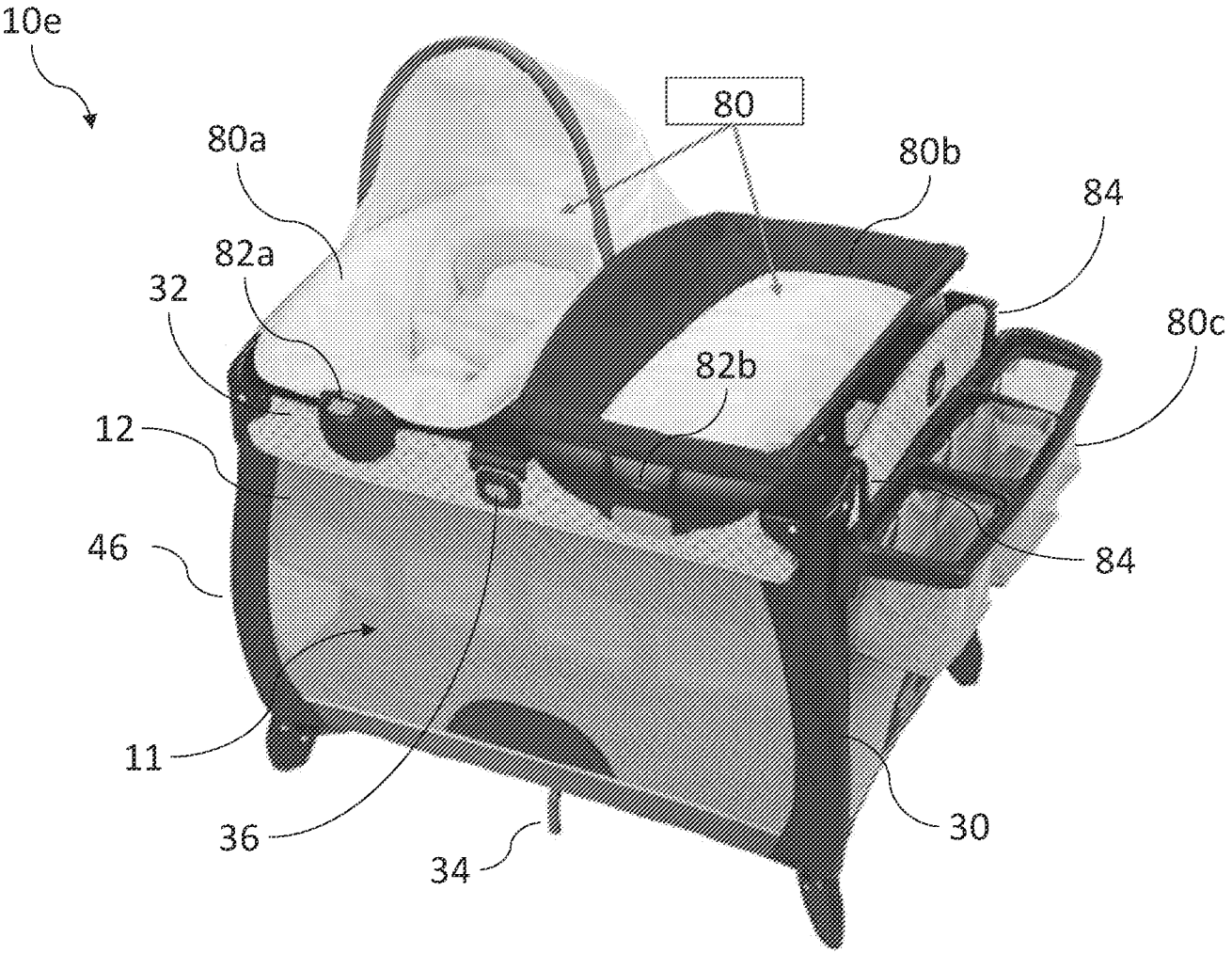
(Prior Art) FIG. 1J
FIG. 1J shows another conventional indoor playard with multiple toppers.

In some implementations, the leg support assemblies 110*a* may only be coupled to one another via the X-frame assemblies 140*a*. In other words, the frame 100*a* may exclude other support structures, such as a separate compliant and/or rigid top rail (e.g., the webbing 14 of the playards 10*a* and 10*b* shown in FIG. 1A and FIG. 1B, the rigid top rails 32 of the playard 10*c* shown in FIG. 1C) or a bottom support structure (e.g., the bottom support structure 34 of the playard 10*c* shown in FIG. 1C), which may appreciably reduce the number of parts for manufacture and assembly. For example, as shown in FIGS. 2A-2C, the portion of the leg tubes 112 located between the bottom end 113*b* and the slider 120 when the frame 100*a* is unfolded may not be coupled to another portion of the frame 100*a* (e.g., the bottom portions of the leg tubes 112 are mechanically unconstrained).

Figure 7A:
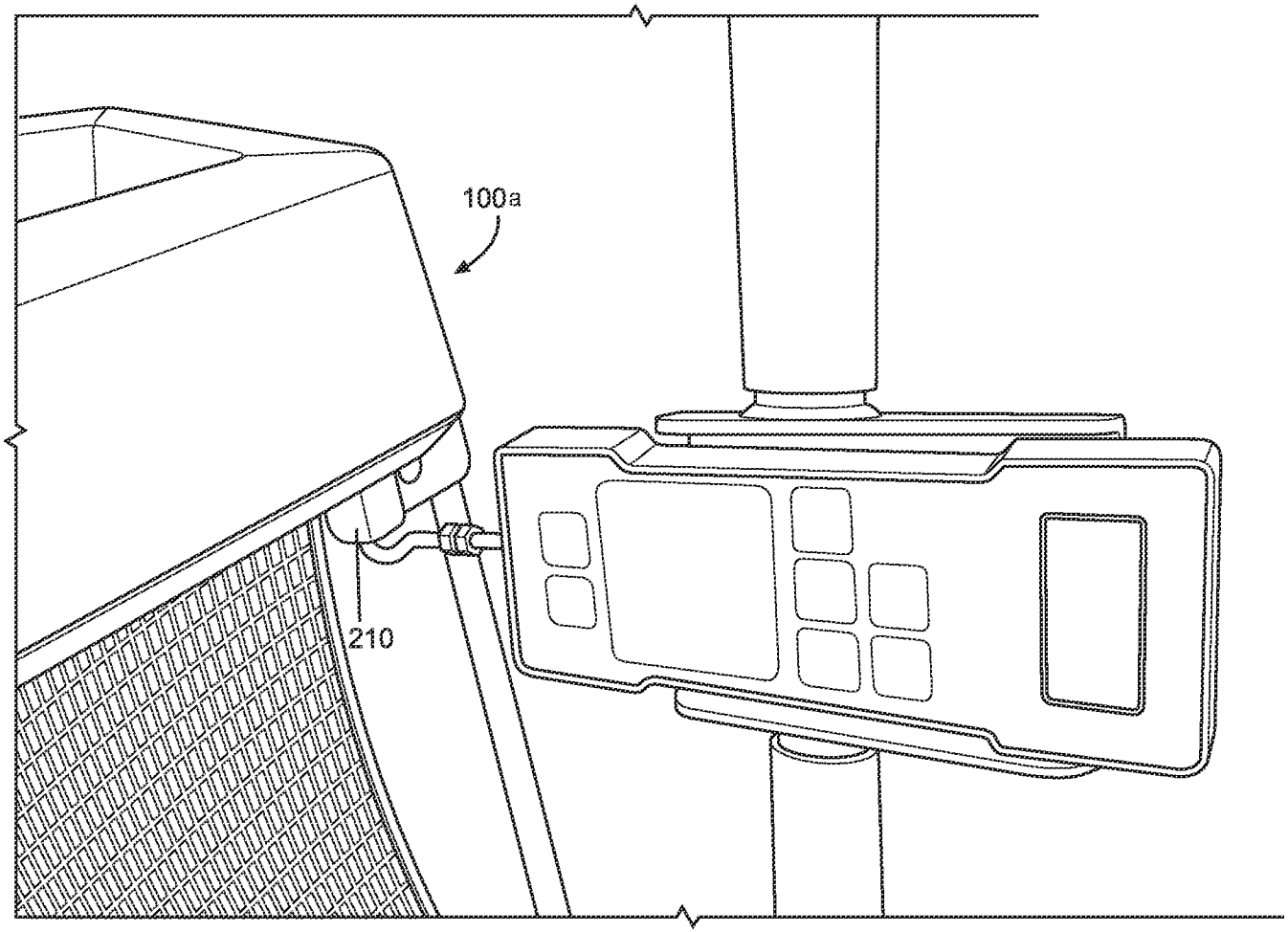
FIG. 7A shows a test being performed on the playard of FIG. 2A to evaluate the restraining force of the latch of FIG. 6A.
Figure 7B:
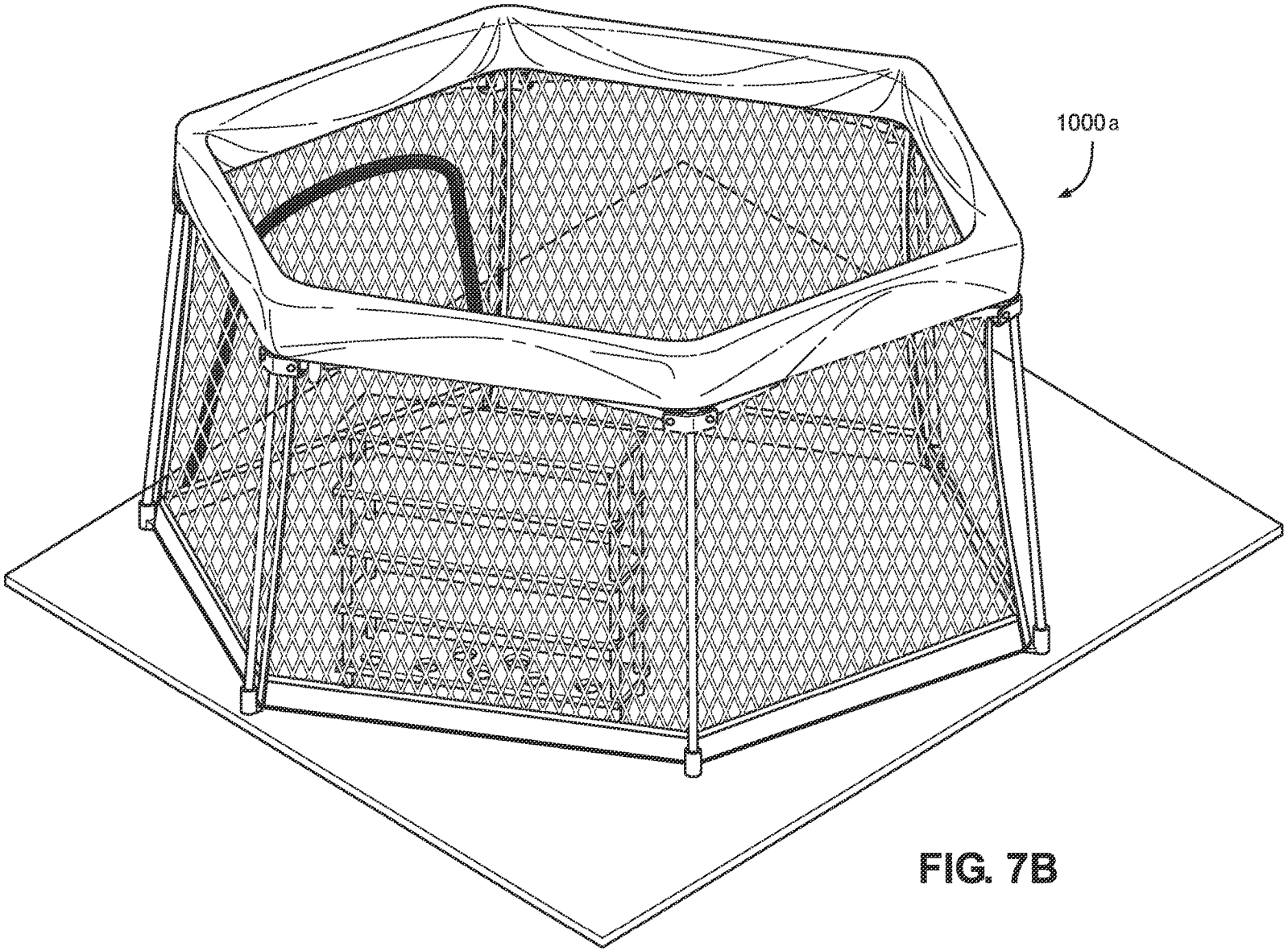
FIG. 7B shows a stability test being performed on the playard of FIG. 2A.

In some implementations, the frame 100*a*, comprising only leg support assemblies 110*a* and X-frame assemblies 140*a* to couple the leg support assemblies 110*a* together, may have sufficient mechanical rigidity, stability, and/or strength to meet the requirements set forth in various consumer safety standards (e.g., ASTM F406-19, 7.3.3, 7.11). For example, FIG. 7B shows the playard 1000*a* with the frame 100*a* unfolded and with soft goods 300 installed undergoing a stability test (e.g., ASTM F406-19, 5.12, 8.17). For this test, the playard 1000*a* was placed onto a flat piece of plywood and tilted at varying angles with a test weight disposed within the playard 1000*a* leaning against one side of the frame 100*a*. Based on this test, it was found the playard 1000*a* did not tip even when tilted at an angle of 20 degrees with at least three feet 114 remaining in contact with the plywood base. This result exceeds the requirements set forth in ASTM F406-19, 8.17, which require the playard to maintain three contact points with the plywood base when tilted to an angle of 10 degrees.

This may be accomplished, in part, by tailoring the materials and/or dimensions of the X-frame tubes 142*a* and 142*b* to provide the mechanical properties that ensure the frame 100*a* is mechanically rigid and stable when deployed. For example, the X-frame tubes 142*a* and 142*b* may be formed from steel tubing with an outer diameter of about 0.625 inches (⅝ inches) and a total length of about 24.5 inches. The term "about," when used to describe the dimensions of the X-frame tubes 142*a* and 142*b*, are intended to cover manufacturing tolerances. For example, "about 0.625 inches" may correspond to the following dimensional ranges: 0.61875 to 0.63125 inches (+/−1% tolerance), 0.62 to 0.63 inches (+/−0.8% tolerance), 0.62125 to 0.62875 inches (+/−0.6% tolerance), 0.6225 to 0.6275 inches (+/−0.4% tolerance), 0.62375 to 0.62625 inches (+/−0.2% tolerance). Similar tolerances may be applied to describe the total length of the X-frame tubes 142*a* and 142*b*.

It should also be appreciated the X-frame tubes 142*a* and 142*b* may be formed from other materials including, but not limited to, aluminum and carbon fiber. The X-frame tubes 142*a* and 142*b* may also have different dimensions depending, in part, on the desired size of the frame 100*a* and/or the interior space 102 and the mechanical properties of the materials used to form the X-frame tubes 142*a* and 142*b*. In some implementations, the X-frame assemblies 140*a* may all have substantially identical or identical dimensions and/or shapes resulting in an interior space 102 with a horizontal cross-section shaped as a regular polygon. In some implementations, the frame 100*a* may include X-frame assemblies 140*a* having different dimensions and/or shapes resulting in an interior space 102 that is skewed in shape.

Additionally, with reference to FIG. 2B, the length L of the leg tubes 112, defined as the distance between the top end 113*a* and the bottom end 113*b*, may generally be kept relatively small where possible in order to reduce the likelihood of the frame 100*a* being tilted especially when a force is applied along the top portion 108 of the frame 100*a*. For example, the length L may be chosen to ensure certain constraints on the frame 100*a* are satisfied. These constraints include: (1) providing a desired height for the interior space 102; (2) providing sufficient overlap with the foot 114 and the corner 130 to couple the foot 114 and corner 130 to leg tube 112; and/or (3) providing sufficient room for the slider 120 to move between the foot 114 and the corner 130 to fold and/or unfold the frame 100*a*. It should be appreciated that the lateral and vertical dimensions of the interior space 102 are coupled due, in part, to the rotational and translational motion of the X-frame assemblies 140*a* (e.g., an increase in the lateral dimensions of the interior space 102 results in a corresponding increase in the vertical dimensions to ensure the X-frame assemblies 140*a* have sufficient room to slide vertically along the leg tubes and hence fold).

In some implementations, the length L of the leg tubes 112 may be about 26 inches. Similar to the dimensions of the X-frame tubes 142*a* and 142*b*, the term "about," when used to describe the dimensions of the leg tube 112, are intended to cover manufacturing tolerances. The tolerance values may be the same as the X-frame tubes 142*a* and 142*b*. In some implementations, the leg tubes 112 in the leg support assemblies 110*a* may be substantially identical or identical. In some implementations, the leg tubes 112 may have different shapes and/or dimensions (e.g., some leg tubes 112 may be vertically oriented while other leg tubes 112 may be tilted when the frame 100*a* is unfolded).

Second, another benefit provided by positioning the X-frame tubes 142*a* and 142*b* in the top portion 108 of the frame when the frame is in the unfolded configuration is that the X-frame assemblies 140*a* occupy a smaller portion of the side faces 106 of the interior space 102 as compared to conventional playards with X-frame assemblies. When the soft goods 300 includes transparent and/or see-through side portions, the placement of the X-frame assemblies 140*a* in the top portion 108 of the frame allows for greater visibility of the partially enclosed space 301 when the soft goods 300 are coupled to the frame 100*a*. Said in another way, the X-frame assemblies 140*a* do not appreciable visually obstruct and/or impede the caregiver from seeing their child when the child 50 is in the playard 1000*a*.

Additionally, the soft goods 300 may use less material to cover the X-frame assemblies 140*a*. In some implementations, the soft goods 300 may cover the corners 130 of the leg support assemblies 110*a* and partially cover the X-frame assemblies 140*a* such that the latch 200*a*, when disposed in the top portion 108 of the frame 100*a*, remains accessible to the caregiver. In some implementations, the soft goods 300 may fully cover the X-frame assemblies 140*a* as well as the corners 130 and the sliders 120 of the leg support assemblies 110*a* such that an observer may only see the leg tubes 112 and/or the feet 114 of the leg support assemblies 110*a*. In this manner, the foldable playard 1000*a* may be presented with a cleaner, more aesthetically desirable appearance to a consumer, in both indoor and outdoor settings.

As discussed above in connection with FIG. 2B, the top portion 108 may generally correspond to the portion of the frame 100*a* proximate to the top ends 113*a* of the leg tubes 112 and/or the corners 130 of each leg support assembly 110*a*. More specifically, the top portion 108 may be defined as the portion of the frame 100*a* located between a top horizontal plane 92 that intersects the top ends 113*a* of the leg tubes 112 and/or the corners 130, and a bottom horizontal plane 91 that is offset from the top horizontal plane 92 by an offset distance, $x_1$, along the length of the respective leg tubes 112. When the frame 100*a* is unfolded, the X-frame tubes 142*a* and 142*b*, the sliders 120, and the corners 130 are disposed within the top portion 108. The offset distance, $x_1$, may be defined as a fraction of the total length L of the leg tube 112 assuming the leg tubes 112 in the frame 100*a* have identical lengths. In some implementations, the offset distance, $x_1$, may be less than or equal to 30% of the total length, L, of the leg tubes 112 and, more preferably, less than or equal to 20% of the total length of the leg tubes 112.

Figure 2E:
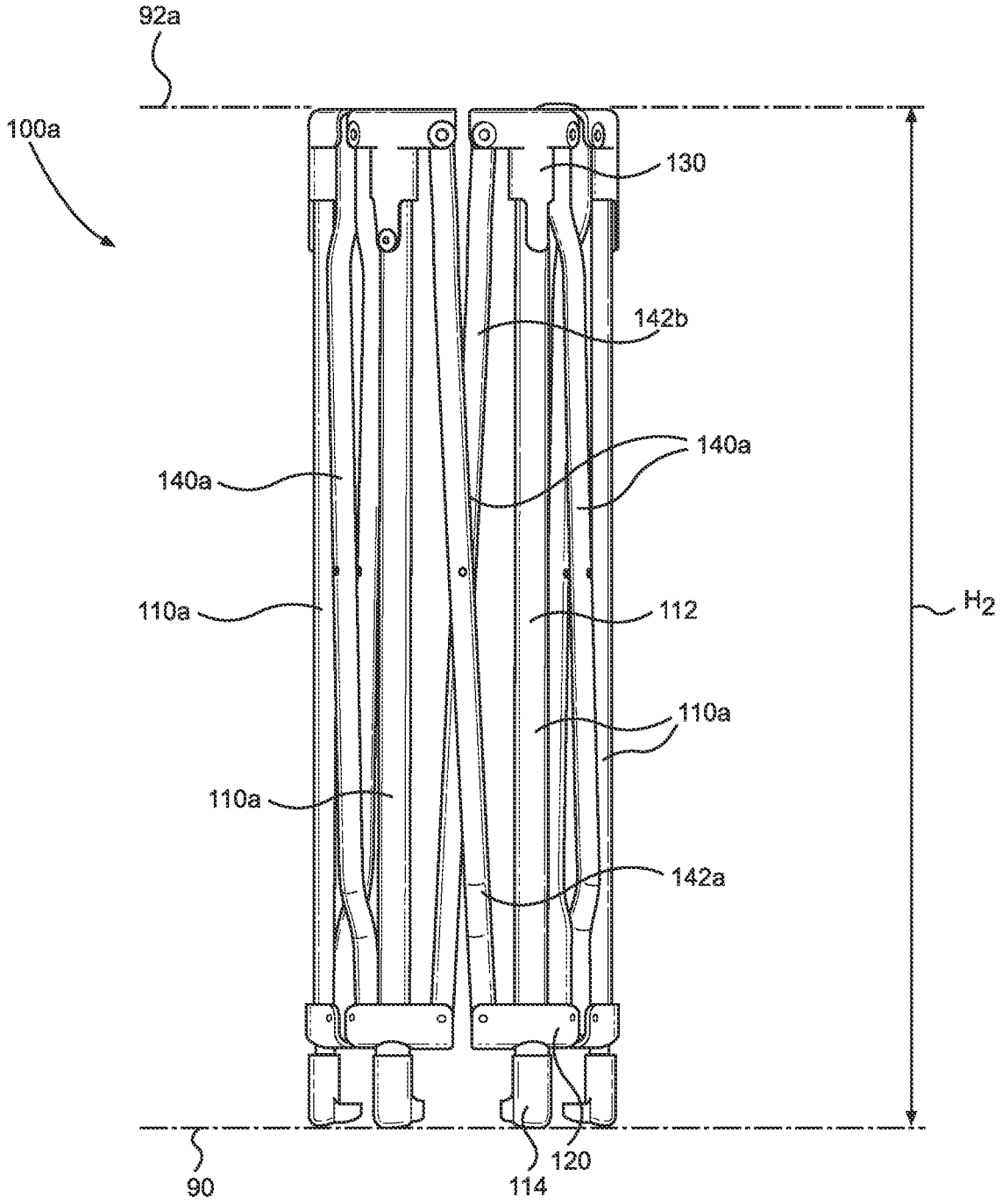
FIG. 2E shows a front view of the playard of FIG. 2D.
Figure 2F:
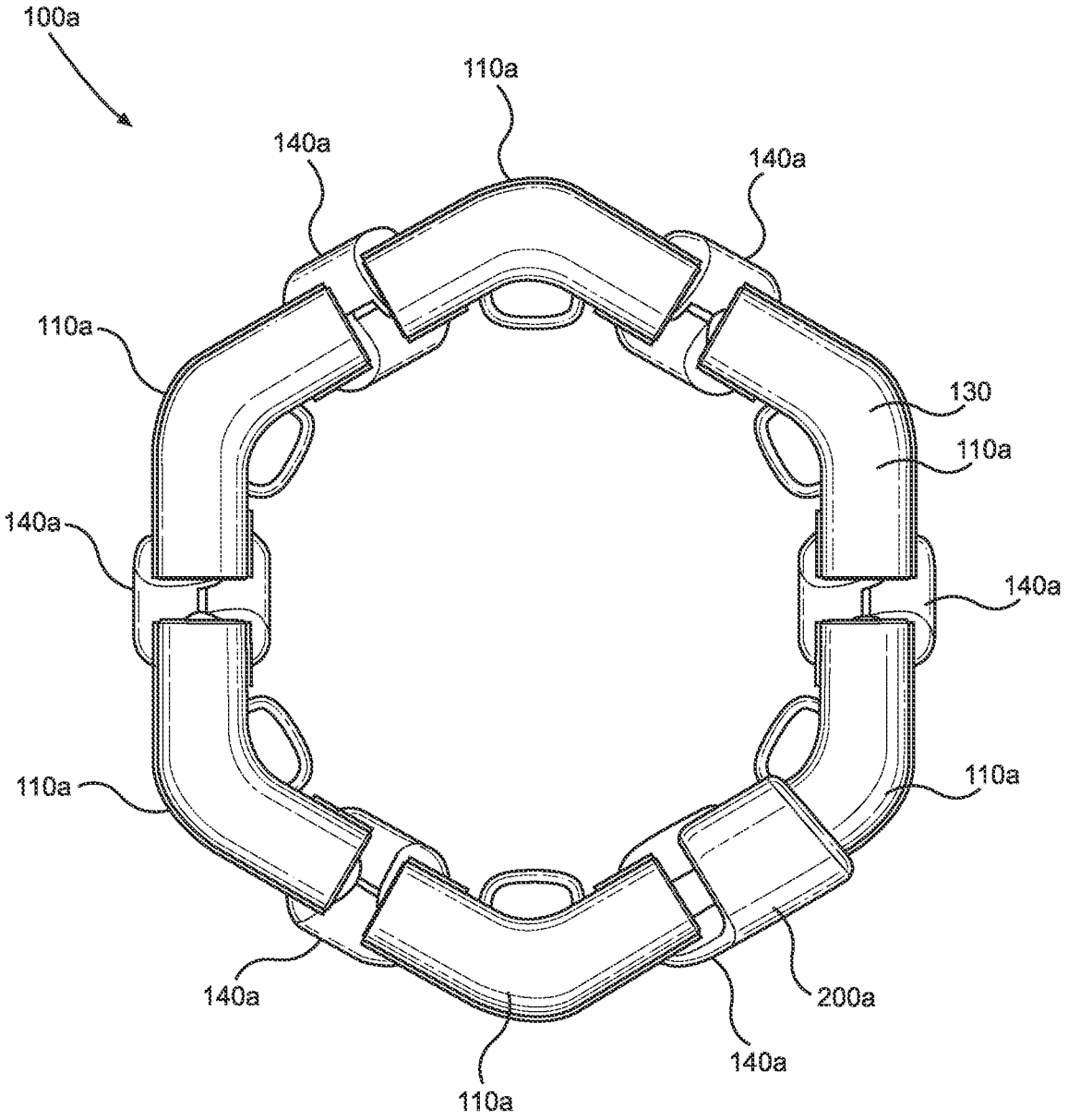
FIG. 2F shows a top view of the playard of FIG. 2D.

FIG. 2B also shows the frame 100*a* may have an overall vertical height, $H_1$, defined as the distance from the ground 90 to the top horizontal plane 92 along a vertical axis (i.e., normal to the ground) in the unfolded configuration. FIG. 2E similarly shows the frame 100*a* may have an overall vertical height, $H_2$, defined as the distance from the ground 90 to a top horizontal plane 92A in the folded configuration. In some implementations, the height of the frame 100*a* may remain substantially constant or constant between the folded and unfolded configurations of the frame. In other words, the heights $H_1$ and $H_2$ may be equal or substantially similar and the planes 92 and 92A are coplanar or substantially coplanar. In some implementations, however, the height of the frame 100*a* may vary due, for example, to the leg support assemblies 110*a* flaring outwards when the frame 100*a* is unfolded as discussed in greater detail below. If the frame 100*a* flares outwards in the unfolded configuration, the height $H_2$ may be somewhat greater than the height $H_1$ (i.e., the plane 92A in the folded configuration may be disposed somewhat above the plane 92 in the unfolded configuration).

Figure 3A:
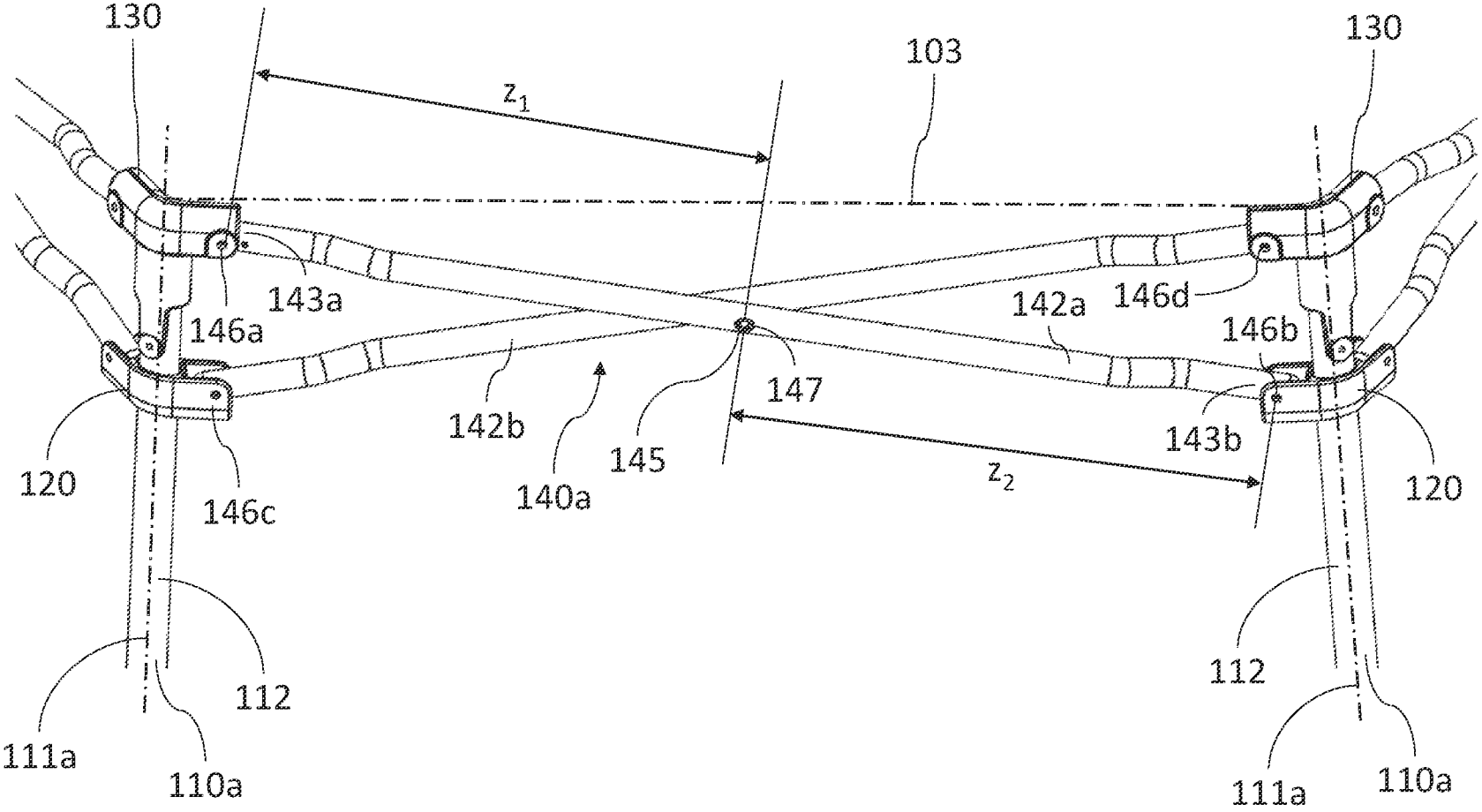
FIG. 3A shows a top perspective view of a X-frame assembly in the playard of FIG. 2A.
Figure 3B:
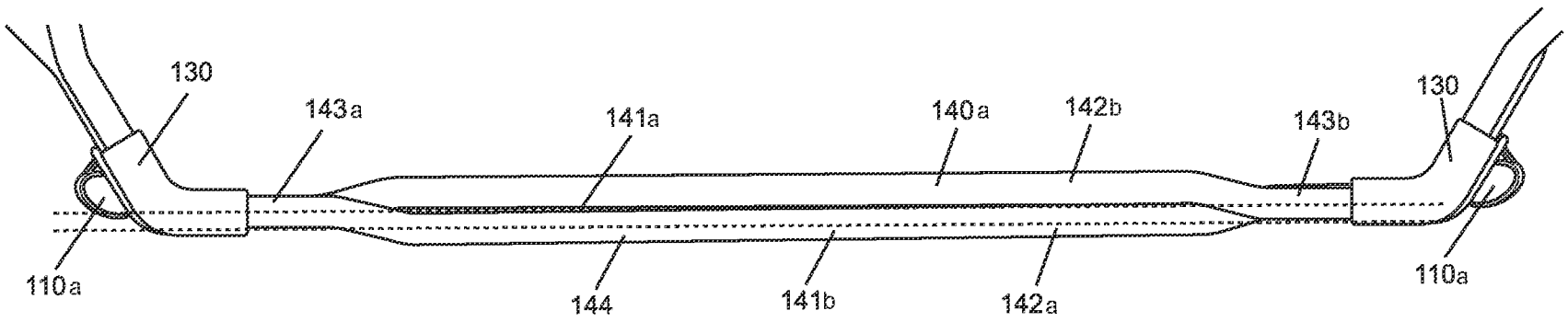
FIG. 3B shows a top view of the X-frame assembly of FIG. 3A.

FIGS. 3A and 3B show additional views of the X-frame assembly 140*a* in the frame 100*a*. As shown, the X-frame tubes 142*a* and 142*b* may be rotatably coupled to each other via a pin joint 145. The X-frame tube 142*a* may have a first end 143*a* rotatably coupled to the corner 130 of one leg support assembly 110*a* via a pin joint 146*a* and a second end 143*b* rotatably coupled to the slider 120 of another leg support assembly 110*a* via a pin joint 146*b*. Similarly, the X-frame tube 142*b* may be rotatably coupled to the corner 130 of one leg support assembly 110*a* via a pin joint 146*d* and rotatably coupled to the slider 120 of another leg support assembly 110*a* via a pin joint 146*c*.

Figure 4B:
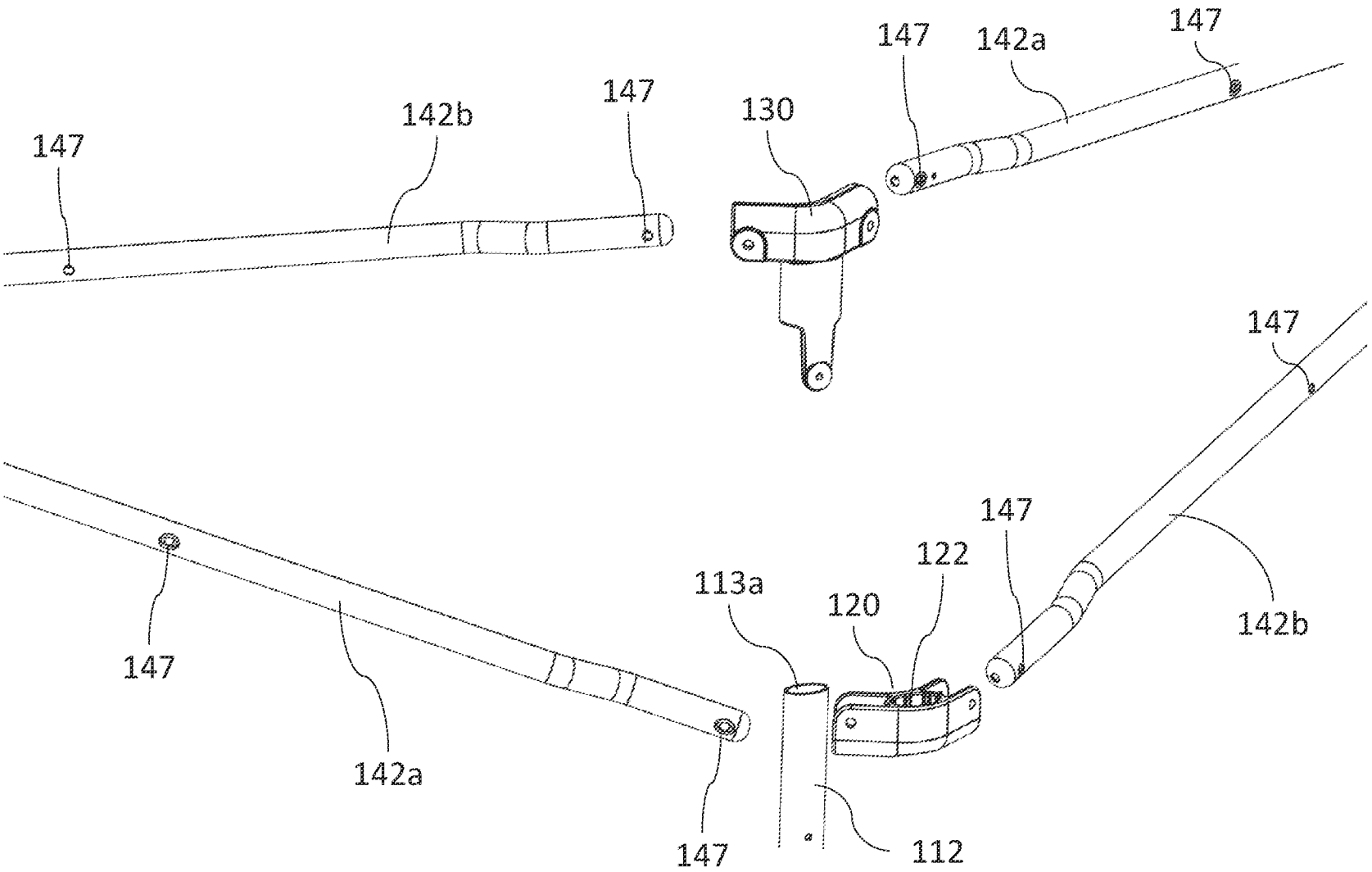
FIG. 4B shows a magnified top perspective view of the corner and the slider in the leg support assembly and the X-frame tubes in the X-frame assembly of FIG. 4A.

The pin joints 145 and 146*a*-146*d* may generally include a fastener (not shown) with a shaft inserted through openings 147 (see FIG. 4B) on the X-frame tubes 142*a* and 142*b* to allow rotational motion between the X-frame tubes 142*a* and 142*b*, the sliders 120, and the corners 130. The fastener may be various types of captive fasteners including, but not limited to, a rivet with a cap (e.g., a rolled rivet) and a bolt fastener with a nut.

Generally, the nominal dimensions and tolerances of the openings 147 and the shaft of the fastener affects the tightness or looseness of the pin joints 145 and 146*a*-146*d*. If the opening 147 is dimensioned to interfere with the fastener (e.g., the size of the opening 147 is smaller than the size of the shaft of the fastener), the caregiver may have to apply a greater force to rotate the X-frame tubes 142*a* and 142*b*. In some instances, the pin joints 145 and 146*a*-146*d* may be too tight such that the respective feet 114 of each leg support assembly 110*a* do not contact the ground 90 when the frame 100*a* is unfolded. For example, the caregiver may move the slider 120 of one leg support assembly 110*a* towards the corresponding corner 130, but the opposing sides of the frame 100*a* may only be partially unfolded. In contrast, if the size of the opening 147 is appreciably larger than the fastener shaft, the pin joints 145 and 146*a*-146*d* may allow the X-frame tubes 142*a* and 142*b* to rotate and/or translate along other unwanted axes of motion (e.g., the frame 100*a* may wobble), which may compromise the mechanical stability of the frame 100*a*. Thus, in some implementations, the nominal dimensions and tolerances of the opening 147 and the shaft of the fastener are particularly chosen to be sufficiently loose to ensure the feet 114 of the leg support assemblies 110*a* contact the ground 90 while still being sufficiently tight to limit unwanted rotational and/or translation motion between the X-frame tubes 142*a* and 142*b* and/or the sliders 120 or corners 130. For example, the tolerance (or clearance) between the shaft of the fastener and the edge of the opening 147 may greater than or equal to about 0.010 inches and, more preferably, greater than or equal to about 0.015 inches.

As shown in FIG. 3A, the pin joint 145 may generally be located along the length of the respective X-frame tubes 142*a* and 142*b*. For example, the pin joint 145 may be positioned at an offset distance, $z_1$, from the first end 143*a* and an offset distance, $z_2$, from the second end 143*b*. In some implementations, the offset distances $z_1$ and $z_2$ may be equal, which causes the respective first and second ends 143*a* and 143*b* of the X-frame tubes 142*a* and 142*b* to follow the same circular path when the X-frame tubes 142*a* and 142*b* are rotated. This, in turn, causes the orientation of the leg support assemblies 110*a* to remain unchanged when the frame 100*a* is being folded and/or unfolded. For example, the leg tubes 112 of each leg support assembly 110*a* may remain vertically oriented for both folded and unfolded configurations.

In other implementations, however, the offset distances $z_1$ and $z_2$ may not be equal. For example, the offset distance $z_2$ may be larger than the offset distance $z_1$ causing the first end 143*a* of the X-frame tube 142*a* to follow a smaller circular path and the second end 143*b* to follow larger circular path when the X-frame tube 142*a* is rotated. The respective first and second ends 143*a* and 143*b* of the X-frame tube 142*b* may similarly follow smaller and larger circular paths, respectively. This, in turn, may cause the leg support assemblies 110*a* and, in particular, the leg tubes 112 to flare outwards when the frame 100*a* is unfolded. In other words, the leg tubes 112 of the leg support assemblies 110*a* may be tilted due to the rotational motion of the X-frame tubes 142*a* and 142*b* in the X-frame assemblies 140*a* such that the top ends 113*a* constitute the vertices of a smaller horizontal cross-section (parallel to the ground) than the bottom ends 113*b* (i.e., the top ends 113*a* are positioned closer to one another than the bottom ends 113*b*). In this manner, the frame 100*a* may define an interior space 102 with a truncated pyramidal interior shape as described above, which may be beneficial in improving the mechanical stability of the frame 100*a* (e.g., the frame 100*a* is less likely to be tilted over). With reference again to FIG. 2B, in some implementations the leg support assemblies 110*a* may be flared outwards such that respective longitudinal axes 111*a* associated with the leg tubes 112 are tilted at an angle, Θ, relative to the ground 90, wherein the angle ranges between 80 degrees and 88 degrees and, more preferably, between 83 degrees and 85 degrees.

Turning now to FIG. 3B, in some implementations the X-frame tubes 142*a* and 142*b* may also be bent in shape. For example, the first and second ends 143*a* and 143*b* of the X-frame tube 142*a* may be aligned along a first axis 141*a* while a central portion 144 of the X-frame tube 142*a* is aligned along a second axis 141*b* that is parallel to and offset from the axis 141*a*. The X-frame tube 142*b* may have a similar bent shape as the X-frame tube 142*a*. In some implementations, the offset between the first and second axes 141*a* and 141*b* may be chosen to provide sufficient clearance between the X-frame tubes 142*a* and 142*b* such that the respective first and second ends 143*a* and 143*b* of the X-frame tubes 142*a* and 142*b* lie on the same plane (e.g., the side face 106 of the interior space 102) as shown in FIG. 3B. This, in turn, allows the portions of the corners 130 and the sliders 120 to also lie on the same plane with the first and second ends 143*a* and 143*b* of the X-frame tubes 142*a* and 142*b*. In some implementations, aligning the corners 130 and sliders 120 in this manner may allow the frame 100*a* to fold more compactly.

Figure 3C:
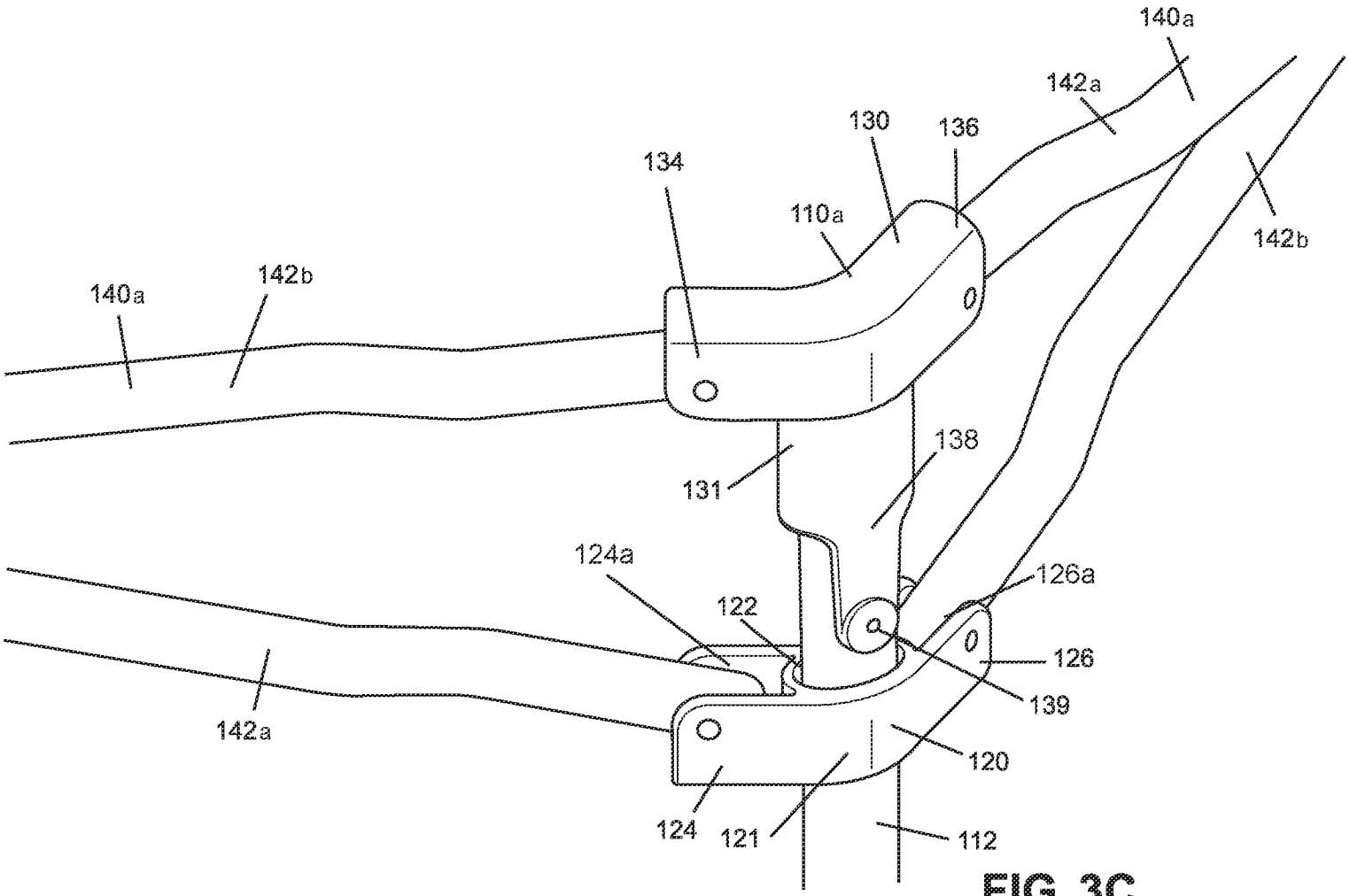
FIG. 3C shows a top perspective view of a corner and a slider of a leg support assembly in the playard of FIG. 2A.
Figure 3D:
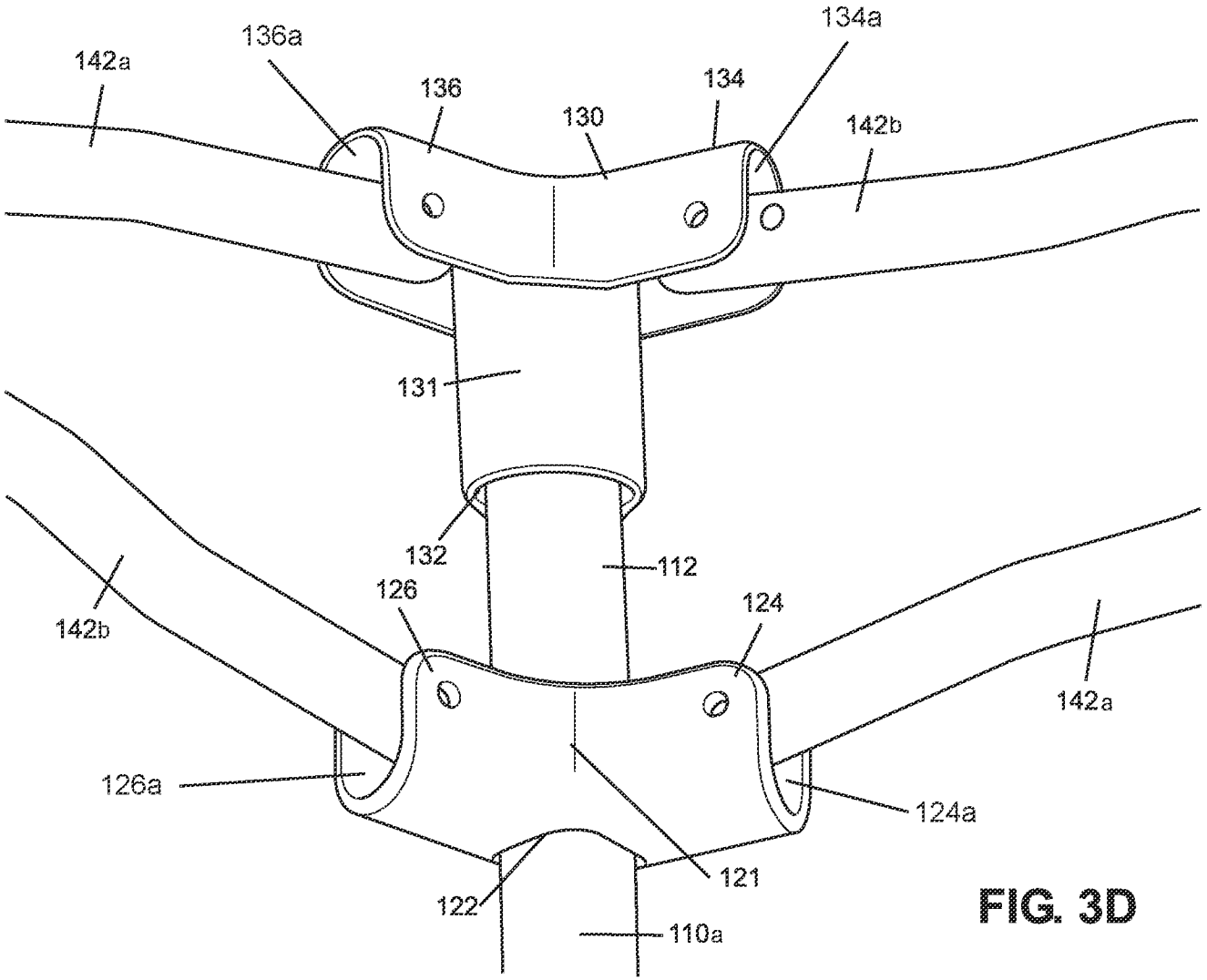
FIG. 3D shows a bottom perspective view of the corner and the slider of FIG. 3C.
Figure 3E:
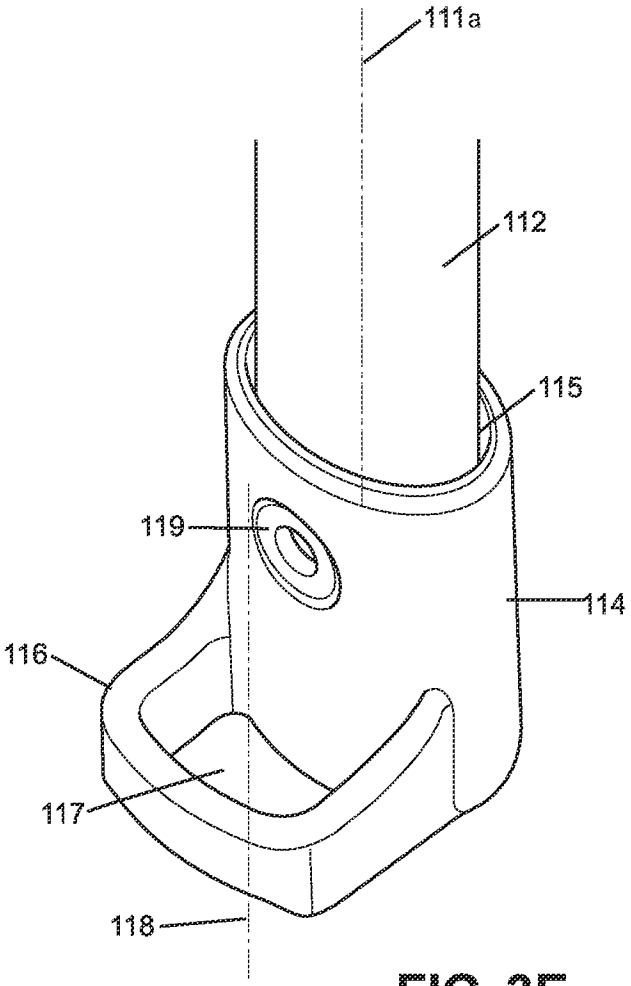
FIG. 3E shows a top perspective view of a leg tube and a foot in the leg support assembly of FIG. 3C.

FIGS. 3C-3E show additional views of the leg support assemblies 110*a* in the frame 100*a*. As shown, the leg tube 112 may be a substantially elongated, hollow tube that defines that path along which the slider 120 travels when the frame 100*a* is being folded and/or unfolded. In some implementations, the leg tube 112 may be substantially straight such that the slider 120 follows a straight path along the longitudinal axis 111*a* (see FIGS. 2A-2C). In some implementations, the longitudinal axis 111*a* may correspond to the centerline axis of the leg tube 112 (i.e., an axis that intersects the center point of the leg tube 112). However, it should be appreciated the leg tube 112 may also be curved in other implementations to define a correspondingly curved path for the slider 120 to follow. Examples of curved leg tubes 112 will be discussed in further detail below. In some implementations, the leg tube 112 may have a cross-section that remains constant along the length, L, of the leg tube 112. In some implementations, the leg tube 112 may have various cross-sectional shapes including, but not limited to a circle, an oval, and an oblong shape. The leg tube 112 may also be formed from various materials including, but not limited to steel, aluminum, and carbon fiber.

The slider 120 may include a base 121 that defines a through hole opening 122 shaped and/or dimensioned to surround the leg tube 112, thus enabling the slider 120 to slidably move along the leg tube 112. In some implementations, the shape of the opening 122 may conform with the cross-sectional shape of the leg tube 112. The slider 120 may further include an extended portion 124 (also referred to herein as an arm 124) coupled to one side of the base 121 to couple the X-frame tube 142*a* of one X-frame assembly 140*a* to the slider 120 via a fastener inserted through an opening on the extended portion 124 aligned to the opening 147 of the X-frame tube 142*a* (see, for example, the exploded views of FIGS. 4A and 4B). The extended portion 124 may also include a recessed opening 124*a* to receive the end of the X-frame tube 142*a* that is coupled to the slider 120. The slider 120 may also include an extended portion 126 (also referred to herein as an arm 126) similar to the extended portion 124 that is disposed opposite from the extended portion 124 to couple the X-frame tube 142*b* of another X-frame assembly 140*a* to the slider 120 via another fastener inserted through an opening on the extended portion 126 aligned to the opening 147 of the X-frame tube 142*b*.

The extended portions 124 and 126 may generally be oriented at an angle relative to each other to align the respective X-frame tubes 142*a* and 142*b* from adjoining X-frame assemblies 140*a* along the desired geometry of the interior space 102. For example, the extended portions 124 and 126 may be rotated relative to one another by an obtuse angle of approximately 120 degrees corresponding to the angles between adjoining sides of a hexagon. In some implementations, the extended portions 124 and 126 may lie on the same horizontal plane. In some implementations, the extended portions 124 and 126 may be offset vertically from one another if the respective X-frame tubes 142*a* and 142*b* coupled to the slider 120 are not identical. In some implementations, the sliders 120 of the leg support assemblies 110*a* may be identical with one another, thus reducing the number of unique parts for manufacture.

The corner 130 may include a base 131 that defines an opening 132 to receive the top end 113*a* of the leg tube 112. In some implementations, the shape of the opening 132 may conform with the cross-sectional shape of the leg tube 112. Similar to the slider 120, the corner 130 may include extended portions 134 and 136 (also referred to herein as an arm 134 and an arm 136) disposed on opposing sides of the base 131 to couple the X-frame tube 142*b* of one X-frame assembly 140*a* and the X-frame tube 142*a* of another X-frame assembly 140*a* to the corner 130 using a similar attachment mechanism as the slider 120, e.g., a fastener inserted through an opening aligned to the openings 147 of the X-frame tubes 142*a* and 142*b* (see, for example, the exploded views of FIGS. 4A and 4B). The extended portions 134 and 136 may each have recessed openings 134*a* and 136*a*, respectively, to receive respective ends of the X-frame tubes 142*a* and 142*b*.

The extended portions 134 and 136 may also be oriented at an angle relative to each other to align the respective X-frame tubes 142*a* and 142*b* from adjoining X-frame assemblies 140*a* along the desired geometry of the interior space 102. The extended portions 134 and 136 may also lie on the same horizontal plane and/or offset vertically from one another if the respective X-frame tubes 142*a* and 142*b* coupled to the corner 130 are not identical. In some implementations, the corners 130 of the leg support assemblies 110*a* may be identical with one another, thus reducing the number of unique parts for manufacture.

FIG. 3C further shows the corner 130 may include a tab portion 138 that extends downwards along the leg tube 112 to support a snap-fit connector 139 to attach the soft goods 300 to the frame 100*a*. In some implementations, the tab portion 138 may be shaped and/or dimensioned to position the snap-fit connector 139 at a desired location along the leg tube 112. For example, the snap-fit connector 139 may be offset from the top end 113*a* to ensure the soft goods 300 overlaps and wraps around the top portion 108 of the frame 100*a*. In some implementations, an opening formed in the tab portion 138 to attach the snap-fit connector 139 to the corner 130 may also be used to securely couple the corner 130 to the leg tube 112 using the same fastener.

Figure 4C:
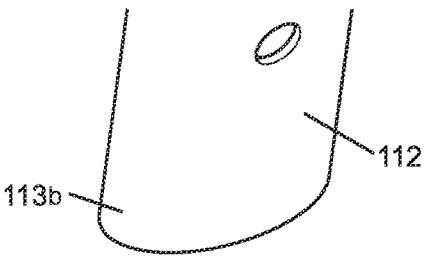
FIG. 4C shows a magnified top perspective view of the leg tube and the foot in the leg support assembly of FIG. 4A.
Figure 4C:
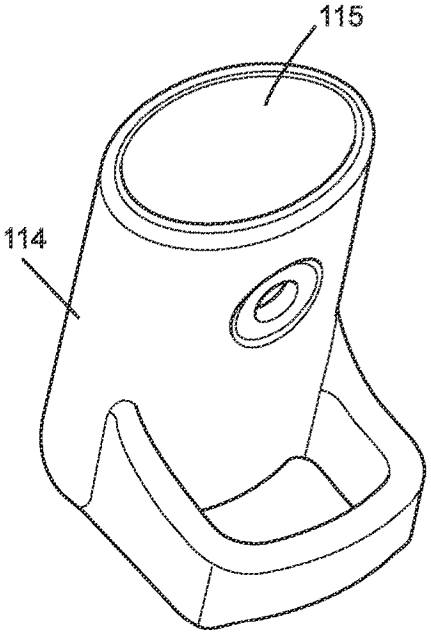

FIG. 3E shows a magnified view of the foot 114 of the leg support assembly 110*a*. As described above, the foot 114 supports the frame 100*a* and the foldable playard 1000*a* on the ground 90. As shown, the foot 114 may define an opening 115 to receive the bottom end 113*b* of the leg tube 112. In some implementations, the shape of the opening 115 may conform with the cross-sectional shape of the leg tube 112. The foot 114 may further include an opening 119 to securely couple the foot 114 to the leg tube 112 using, for example, a fastener (see, for example, FIG. 4C).

In some implementations, the foot 114 may also include a looped or ringed structure that extends from the base of the foot 114 to provide another attachment point to couple the soft goods 300 to the frame 100*a*. For example, FIG. 3E shows the foot 114 may include a D-ring 116 defining a D-shaped opening 117. The soft goods 300 may include a strap or a tether that is inserted through the D-shaped opening 117 and tied to the foot 114 to mechanically attach a bottom portion of the soft goods 300 to the frame 100*a*. As shown, the D-shaped opening 117 may be aligned such that a centerline axis 118 of the opening 117 is aligned substantially parallel with the longitudinal axis 111*a* of the leg tube 112. This orientation also allows the D-ring 116 to increase the area that the foot 114 contacts the ground 90, which may further improve the mechanical stability of the frame 100*a*. However, it should be appreciated the orientation and placement of the D-ring 116 may be varied in other implementations. For example, the D-ring 116 may be rotated 90 degrees relative to the ground such that the axis 118 of the opening 117 is perpendicular to the longitudinal axis 11*a*.

Figure 5A:
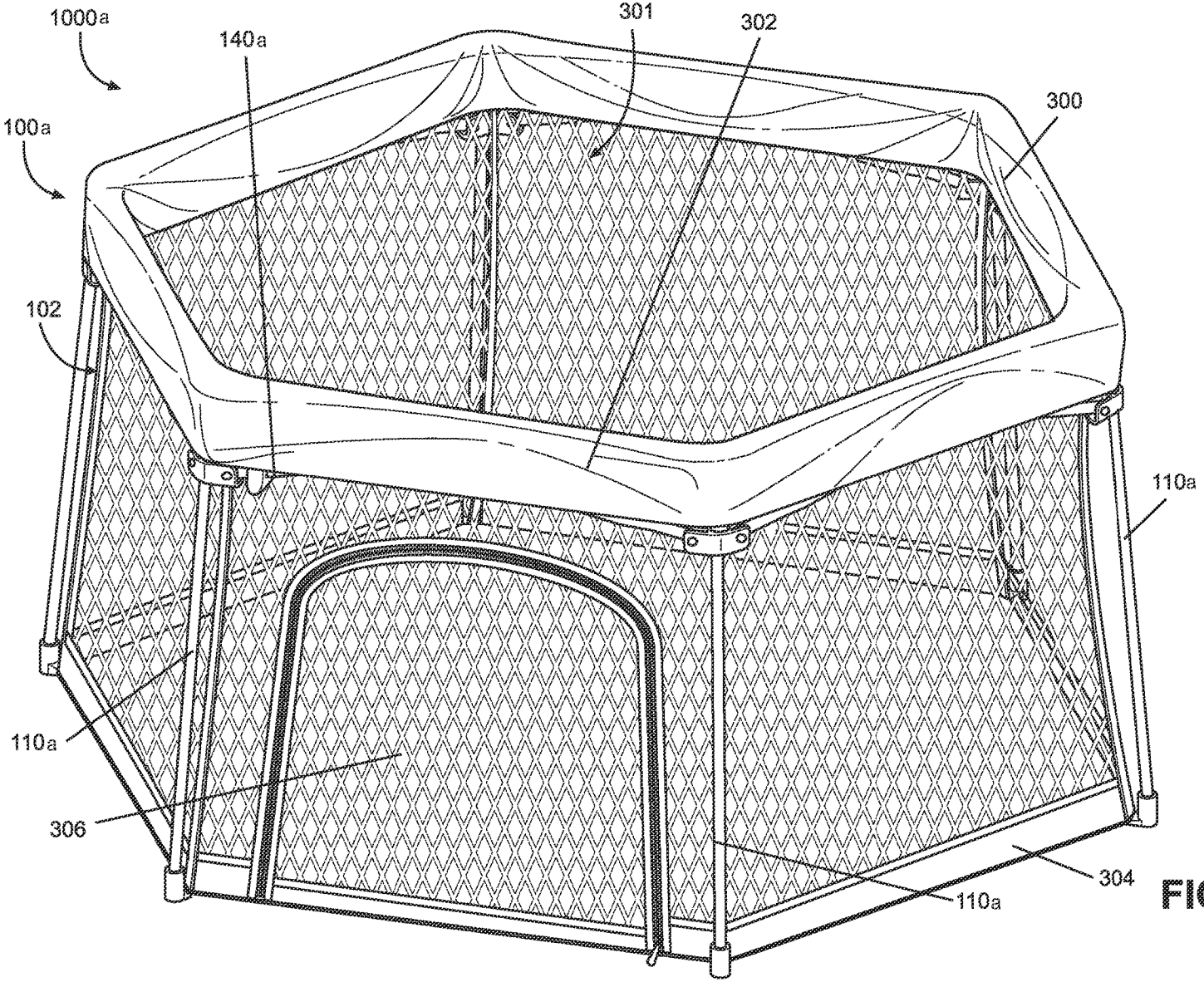
FIG. 5A shows a top perspective view of the playard of FIG. 2A with soft goods.

FIG. 5A shows the foldable playard 1000*a* with the soft goods 300 coupled to the frame 100*a*. As described above, the soft goods 300 defines a partially enclosed space 301 placed within the interior space 102 of the frame 100*a* to contain the child. In some implementations, the soft goods 300 may remain attached to the frame 100*a* as the frame 100*a* is folded and/or unfolded. As shown in FIG. 5A, the soft goods 300 may include a floor portion 304 that rests on the ground 90 when the playard 1000*a* is unfolded. The soft goods 300 may also include side portions 306 that define and surround the partially enclosed space 301. In some implementations, the side portions 306 may be transparent (e.g., a transparent plastic) or see-through (e.g., a mesh) so that a child in the playard is observable from outside the partially enclosed space 301. The soft goods 300 may also include one or more straps (e.g., a Velcro strap) and/or tethers to couple the soft goods 300 to each D-ring 116 of each foot 114 in the leg support assemblies 110*a*.

Figure 5C:
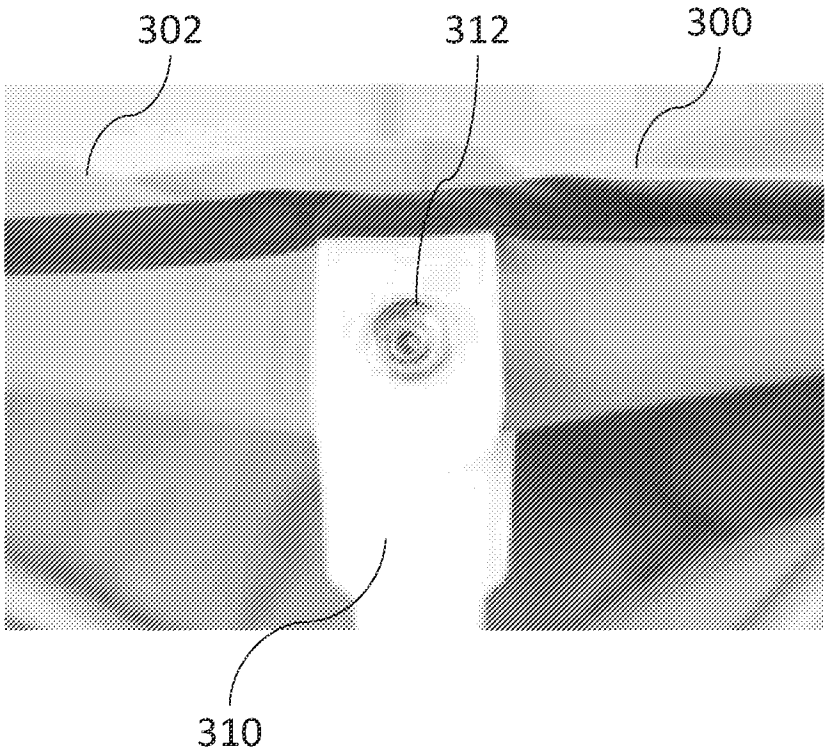
FIG. 5C shows a magnified view of the top portion of FIG. 5B flipped upwards to show a tab and a snap-fit connector.
Figure 5B:
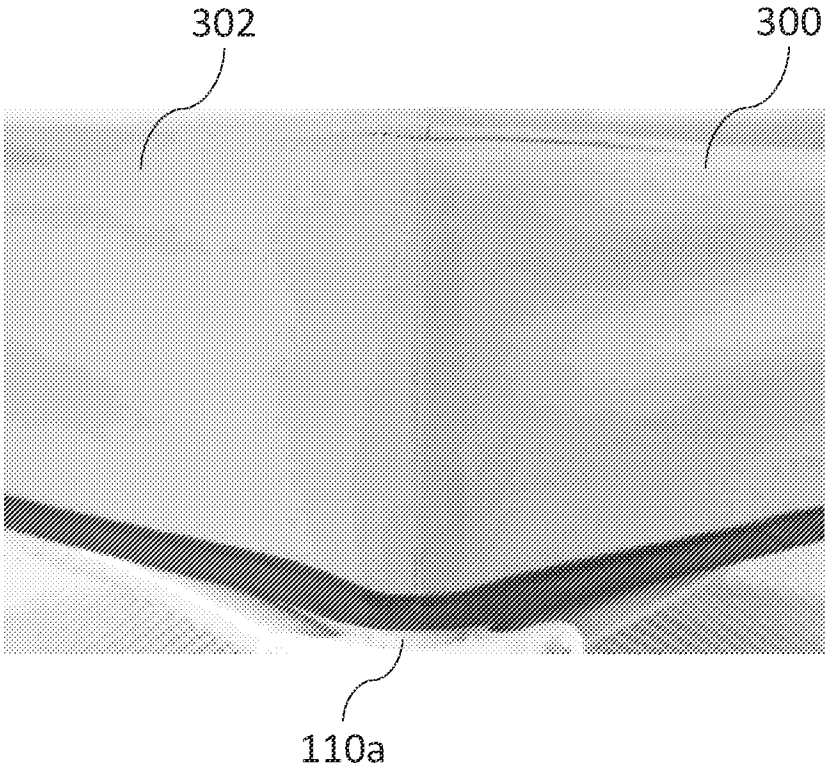
FIG. 5B shows a magnified view of top portion of the soft goods of FIG. 5A disposed over the corner of the leg support assembly in the playard of FIG. 2A.

The soft goods 300 may also include a soft goods top portion 302 to wrap the soft goods 300 around the top portion 108 of the frame 100*a*. As shown in FIG. 5A, the soft goods top portion 302 may be formed from an opaque textile material with multiple layers of fabric to provide padding on the portions of the frame 100*a* that are covered. The soft goods 300 also may include integrated snap-fit connectors 312 that couple to the snap-fit receivers 139 of the corners 130. In some implementations, the soft goods 300 may include the same number of snap-fit connectors 312 such that the soft goods 300 attaches to each corner 130 of the frame 100*a*. In some implementations, the snap-fit connector 312 may be disposed on a tab 310 that is attached to an interior piece of the soft goods 300 along the soft goods top portion 302 as shown in FIG. 5C. The tab 310 may stiffen the interior piece of the soft goods top portion 302 to ensure the soft goods top portion 302 remains flush against the frame 100*a* (e.g., the soft goods top portion 302 does not curl upwards) when the snap-fit connector 312 is coupled to the snap-fit connector 139 on the corner 130 as shown in FIG. 5B. The tab 310 may be formed from a compliant material, such as polyethylene, and shaped to be stiffer than the surrounding textile material of the soft goods 300.

FIGS. 6A-6D show multiple views of the latch 200*a* disposed on the frame 100*a*. As described above, the latch 200*a* may lock the frame 100*a* in the unfolded configuration. In particular, the latch 200*a* may maintain the sliders 120 of the leg support assemblies 110*a* proximate to the corresponding corners 130 such that the X-frame assemblies 140*a* remain unfolded forming a shallow X-frame structure in the top portion 108 of the frame. Thus, the latch 200*a* may provide sufficient mechanical restraints to support the various forces and/or torques applied to one or more of the sliders 120 (e.g., the weight of the X-frame tubes 142*a* and 142*b* acting on the slider 120).

The latch 200*a* may generally be coupled to and/or couple together various components of the frame 100*a* including, but not limited to the slider 120, the corner 130, and the X-frame tubes 142*a* or 142*b*. Furthermore, the latch 200*a* may be disposed, at least in part, within the top portion 108 of the frame 100*a*. This may enable the latch 200*a* to be at least partially covered by the soft goods 300. For example, the latch 200*a* may directly couple the corner 130 of one leg support assembly 110*a* to a X-frame tube 142*a* or 142*b* of an adjoining X-frame assembly 140*a* as shown in FIG. 6A.

The frame 100*a* may generally include one or more latches disposed on one or more leg support assemblies 110*a* and/or the X-frame assemblies 140*a*. For example, the frame 100*a* may include latches disposed on opposing sides of the frame 100*a* to ensure the frame 100*a*, when unfolded, maintains an even, unfolded shape (e.g., one side of the frame 100*a* does not sag downwards relative to another side). However, in other implementations, a single latch is sufficient to lock the frame 100*a* in the unfolded configuration while keeping the various leg support assemblies 110*a* and X-frame assemblies 140*a* unfolded evenly. For example, with reference again to FIGS. 2A-2C, these figures show that the frame 100*a* includes a single latch 200*a* disposed, in part, on one leg support assembly 110*a* and one X-frame assembly 140*a*. In some implementations, the latch 200*a* may be configured to withstand a load greater than or equal to 10 lbs. before being disengaged or unlocked.

Figure 6A:
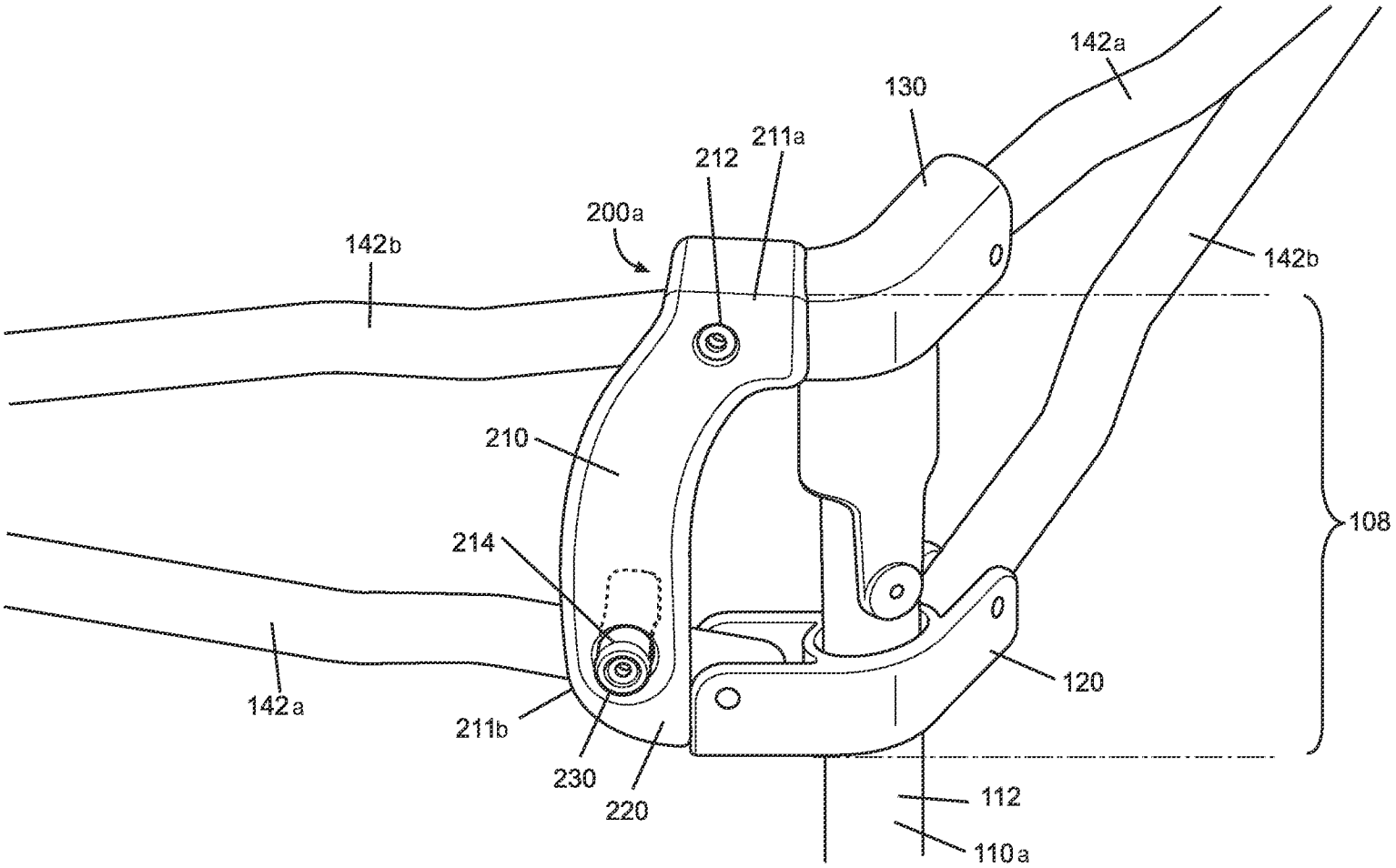
FIG. 6A shows a top perspective of a double-action latch in the playard of FIG. 2A.
Figure 6B:
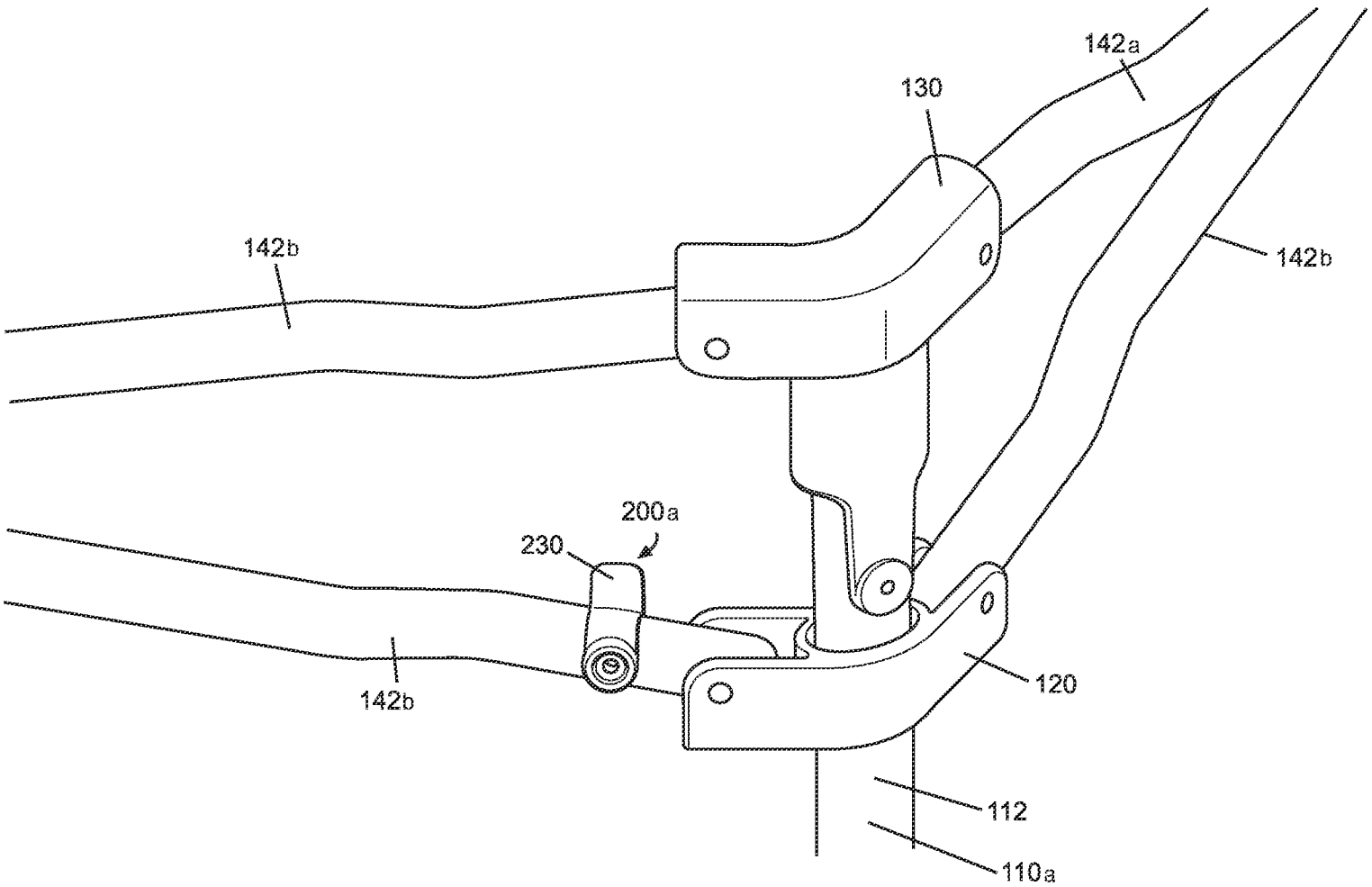
FIG. 6B shows a top perspective of the double-action latch of FIG. 6A with the latch member removed.

FIG. 6A shows the latch 200*a* may include a latch member 210 (also referred to herein as a "flex lock") with a top end 211*a* coupled to the corner 130 of one leg support assembly 110*a* and a latch boss 230 coupled to the X-frame tube 142*a* of one X-frame assembly 140*a*. The latch member 210 may include an opening 212 disposed at the first end 211*a* that aligns with the opening on the corner 130 used to couple to the X-frame tube 142*b*. In this manner, a single fastener may couple the latch member 210, the corner 130, and the X-frame tube 142*b* together and the corner 130 may remain unmodified. In other words, the latch member 210 may be coupled to any one of the corners 130 in the leg support assemblies 110*a* of the frame 100*a* provided the latch boss 230 is coupled to one of the X-frame tubes 142*a* and 142*b* adjoining the leg support assembly 110*a*. In some implementations, the latch member 210 may be coupled to the corner 130 via a pin joint connection or a rigid connection (e.g., in which the latch member 210 cannot be rotated relative to the corner 130). The latch boss 230 may include an opening that is shaped and/or dimensioned to conform with the X-frame tube 142*a*, thus enabling the latch boss 230 is slid onto the X-frame tube 142*a* for assembly. FIG. 6B shows the latch boss 230 may then be coupled to the X-frame tube 142*a* using, for example, a fastener inserted through respective openings (not shown) on the latch boss 230 and the X-frame tube 142*a*.

With reference again to FIG. 6A, the latch member 210 may include a latch opening 214 disposed at a second end 211*b* of the latch member 210 located opposite from the first end 211*a*. The latch opening 214 may be shaped and/or dimensioned to receive the latch boss 230. In other words, the latch opening 214 may function as a latch catch. In this manner, the latch member 210 may directly couple the corner 130 to the X-frame tube 142*b* by engaging with the latch boss 230, thus holding the slider 120 in the top portion 108 of the frame 100*a* near the corner 130.

The latch member 210 may also include a tab 220 disposed at the second end 211*b*. Generally, the latch member 210 may be a mechanically compliant component that bends when the caregiver pulls on the tab 220 to disengage the latch member 210 from the latch boss 230. The latch member 210 may also have sufficient mechanical rigidity such that a restoring force is generated when bent by the caregiver. When the caregiver releases the tab 220, the restoring force may return the latch member 210 back to its original shape. In some implementations, the latch member 210 may be formed from a plastic material. The latch member 210 may further have a sufficient thickness and/or be reinforced with integral rib structures to provide the desired mechanical rigidity.

Figure 6D:
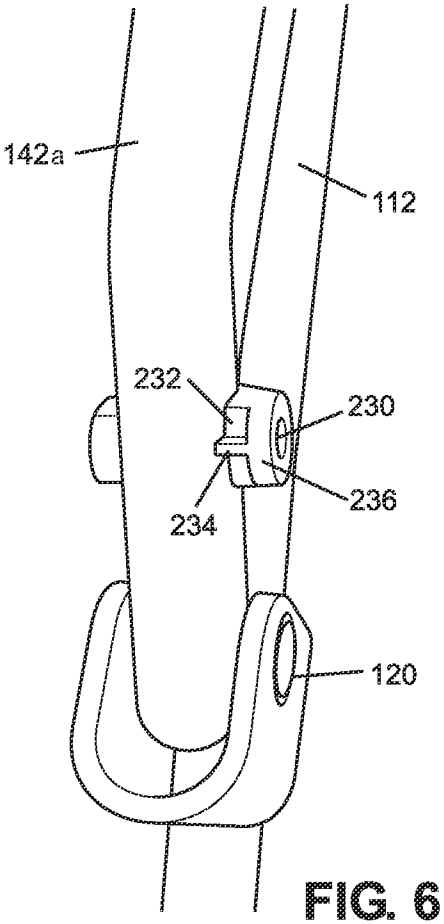
FIG. 6D shows a magnified view of the latch boss in the double-action latch of FIG. 6A.
Figure 6C:
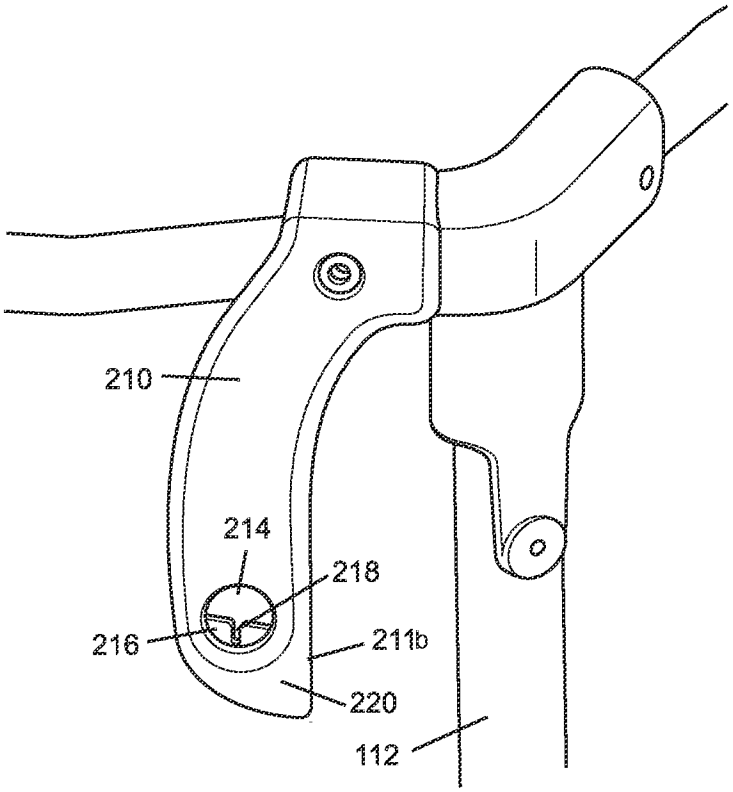
FIG. 6C shows a magnified view of the latch member in the double-action latch of FIG. 6A.

In some implementations, the latch 200*a* may be a double-action latch (e.g., the caregiver needs to perform two operations to unlock the latch). For example, FIG. 6C shows the latch opening 214 of the latch member 210 may include a tab 216 disposed within the latch opening 214. FIG. 6D shows the latch boss 230 may include an undercut portion 232 that forms a notch or a slot between the X-frame tube 142*a* and an end portion 236. Thus, when the latch member 210 is coupled to the latch boss 230, the tab 216 of the latch member 210 is disposed within the undercut portion 232 and retained by the end portion 236 of the latch boss 230. In some implementations, the tab 216 may further define a slot 218 as shown in FIG. 6C, and the latch boss 230 may further include a rib 234 partially disposed within the undercut portion 232 as shown in FIG. 6D, that together facilitate alignment of the tab 216 to the undercut portion 232 to ensure the latch member 210 is properly engaged with the latch boss 230.

To setup the frame 100*a* and, by extension the playard 1000*a*, the caregiver may initially move the slider 120 of one leg support assembly 110*a* towards the corresponding corner 130 to partially unfold the frame 100*a*. As the frame 100*a* is being unfolded, the latch boss 230 disposed on the X-frame tube 142*a* is displaced towards the latch member 210 coupled to the corner 130. Once the latch boss 230 reaches the latch member 210 and, in particular, the tab 216, further movement of the slider 120 along the leg tube 112 results in contact between the latch boss 230 and the tab 216, which causes the latch member 210 to be deflected outwards. In some implementations, the latch member 210 may include a lead-in feature on the tab 216 (not shown), such as a sloped or a ramped wall. The lead-in feature may allow the latch member 210 to be deflected more effectively as the latch boss 230 slides against the latch member 210 by orienting the contact force between the latch member 210 and the latch boss 230 along a direction that increases the magnitude of the torque applied to bend the latch member 210 (note that the pivot point of the latch member 210 is located at the mounting opening 212 as shown in FIG. 6A).

As the latch member 210 is deflected with further movement of the slider 120 along the leg tube 112, an internal restoring force is generated within the latch member 210, which is applied against the latch boss 230. As the caregiver continues to move the slider 120 towards the corner 130, the latch member 210 is deflected further outwards resulting in a higher magnitude restoring force being applied against the latch boss 230. When the slider 120 is moved sufficiently close to the corner 130, the latch boss 230 passes through the latch opening 214 and the restoring force causes the latch member 210 to snap back to its original position such that the latch boss 230 protrudes through the latch opening 214. Once the caregiver releases the slider 120, the slider 120 may move slightly downwards along the leg tube 112 due to gravity, causing the undercut portion 232 of the latch boss 230 to rest onto the tab 216 of the latch member 210.

Figure 6E:
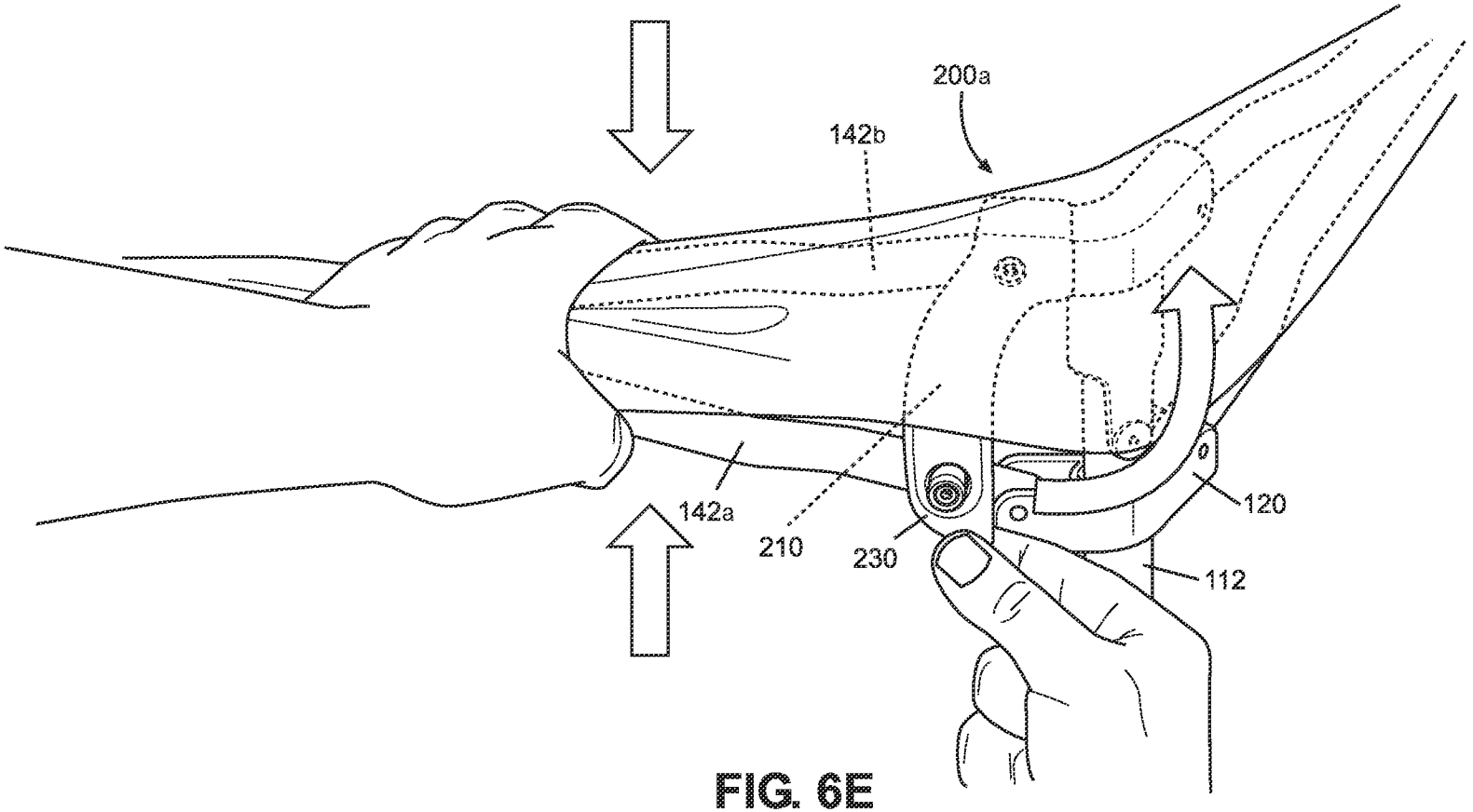
FIG. 6E shows an illustration for unlocking the double-action latch of FIG. 6A.

FIG. 6E illustrates how a caregiver may transition the frame 100*a* and the playard 1000*a* to a folded configuration from the unfolded configuration by disengaging the double-action latch 200*a*. As shown in FIG. 6E, the caregiver may first squeeze the X-frame tubes 142*a* and 142*b* (as shown by the upward and downward arrows in FIG. 6E), which causes the slider 120 to move upwards along the leg tube 112, thus disengaging the tab 216 of the latch member 210 from the undercut portion 232 of the latch boss 230. While the caregiver is squeezing the X-frame tubes 142*a* and 142*b* together with one hand, the caregiver may then pull on the tab 220 of the latch member 210 with another hand to release the latch boss 230 from the latch opening 214 (as shown by the curved arrow in FIG. 6E). The "double-action" of the latch 200*a* is thus "squeeze-and-pull." While holding the latch member 210, the caregiver may then release the X-frame tubes 142*a* and 142*b* and the slider 120 may then fall downwards along the leg tube 112 due, in part, to the weight of the X-frame assemblies 140*a*. The caregiver may then move the slider 120 downwards towards the foot 114 of the leg support assembly 110*a*, thus folding the playard 1000*a*.

With reference again to FIG. 6D, in some implementations of the double-action latch 200*a*, the undercut portion 232 and the end portion 236 of the latch boss 230 and the tab 216 of the latch member 210 may be shaped and/or dimensioned such that latch member 210 cannot be pulled off the latch boss 230 without applying an appreciably large force (e.g., a force greater than 20 lbs). For example, FIG. 7A shows a force test being applied to the double-action latch 200*a*, which shows the latch member 210 remains engaged to the latch boss 230 when a force greater than 24 lbs is applied to the tab 220.

It should be appreciated that, in other implementations, the playard 1000*a* and, in particular, the frame 100*a* may include other types of latching mechanisms. For example, FIGS. 8A-8D show a playard 1000*a* where the frame 100*a* includes a single-action latch 200*b* (e.g., the caregiver needs to perform only one operation to release the latch) instead of (or in addition to) the double-action latch 200*a* discussed immediately above.

Figure 8A:
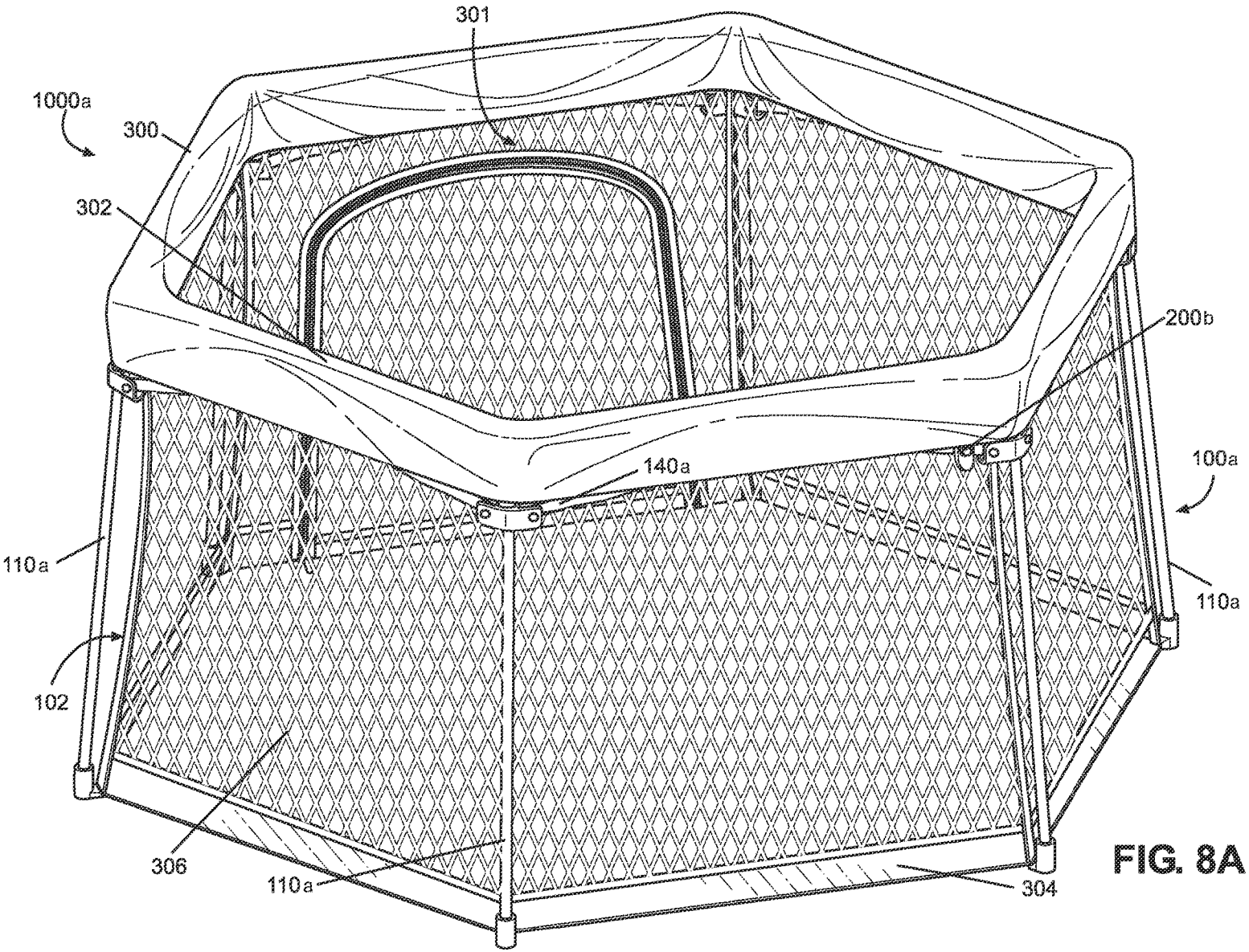
FIG. 8A shows a top perspective of the playard of FIG. 2A with soft goods and a flex lock latch with a latch opening. The playard is in an unfolded configuration.
Figure 8B:
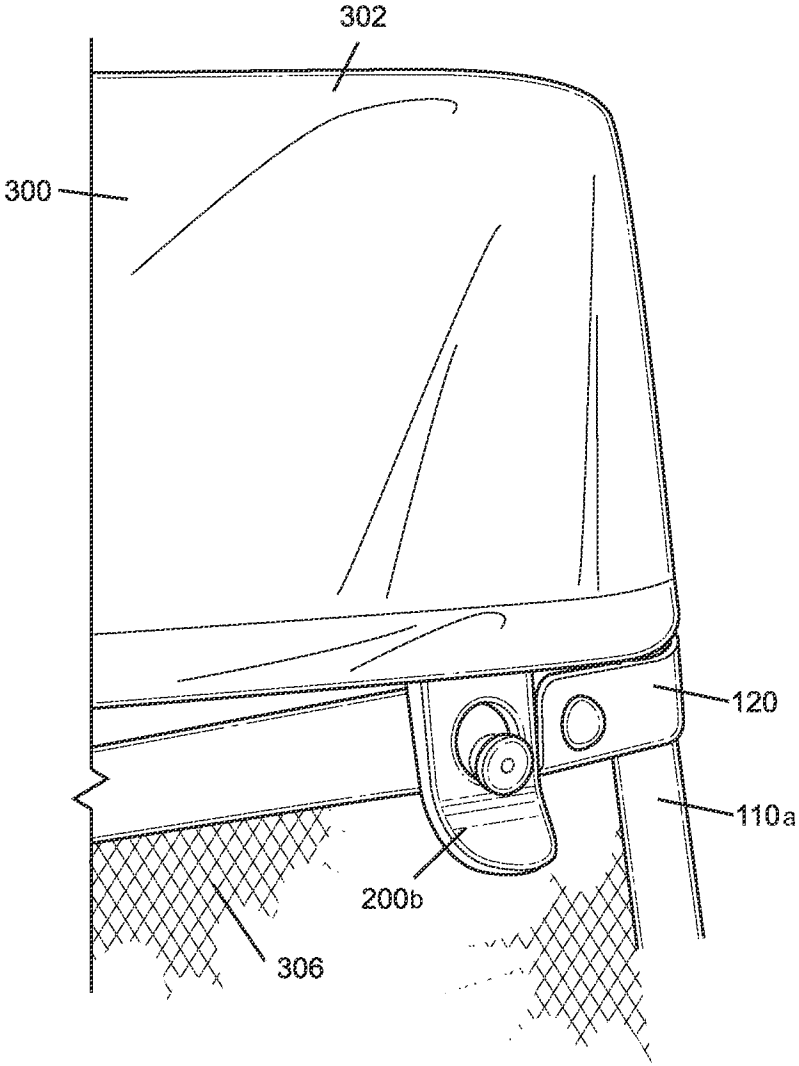
FIG. 8B shows a magnified view of the flex lock latch of FIG. 8A.
Figure 8D:
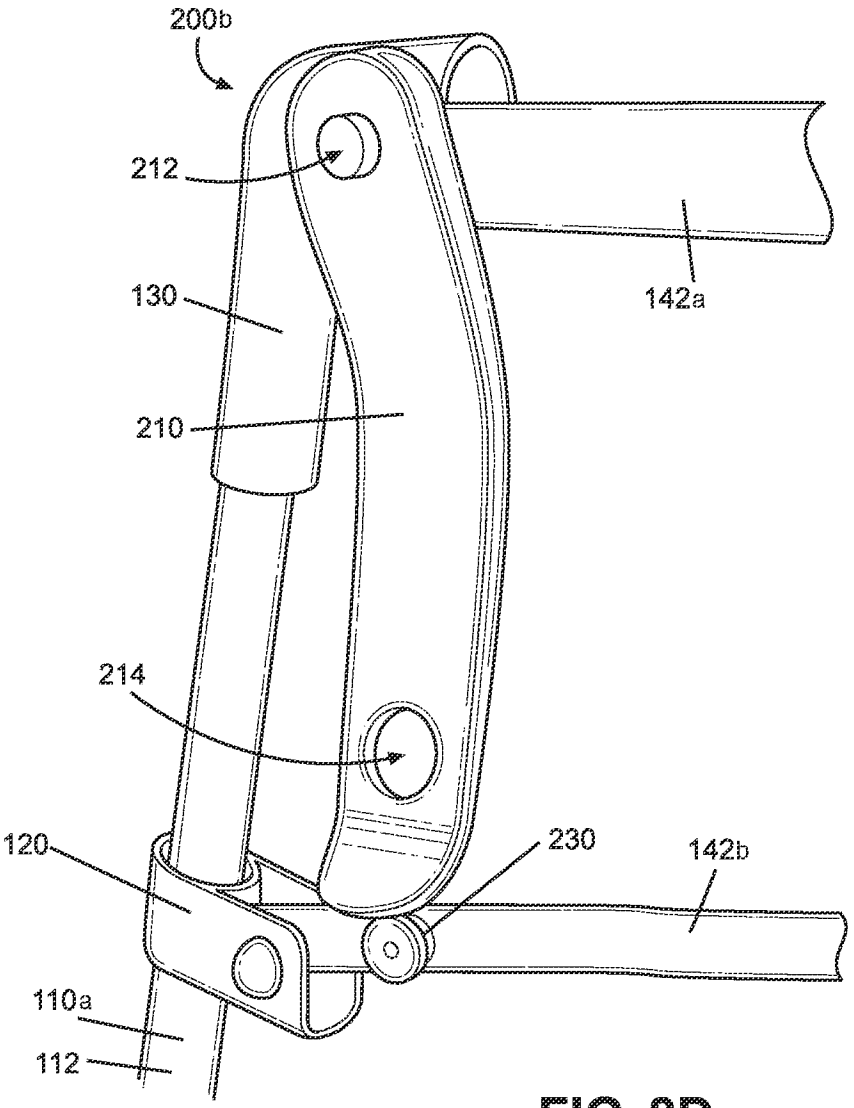
FIG. 8D shows a perspective view of the flex lock latch of FIG. 8C in an unlocked configuration.
Figure 8C:
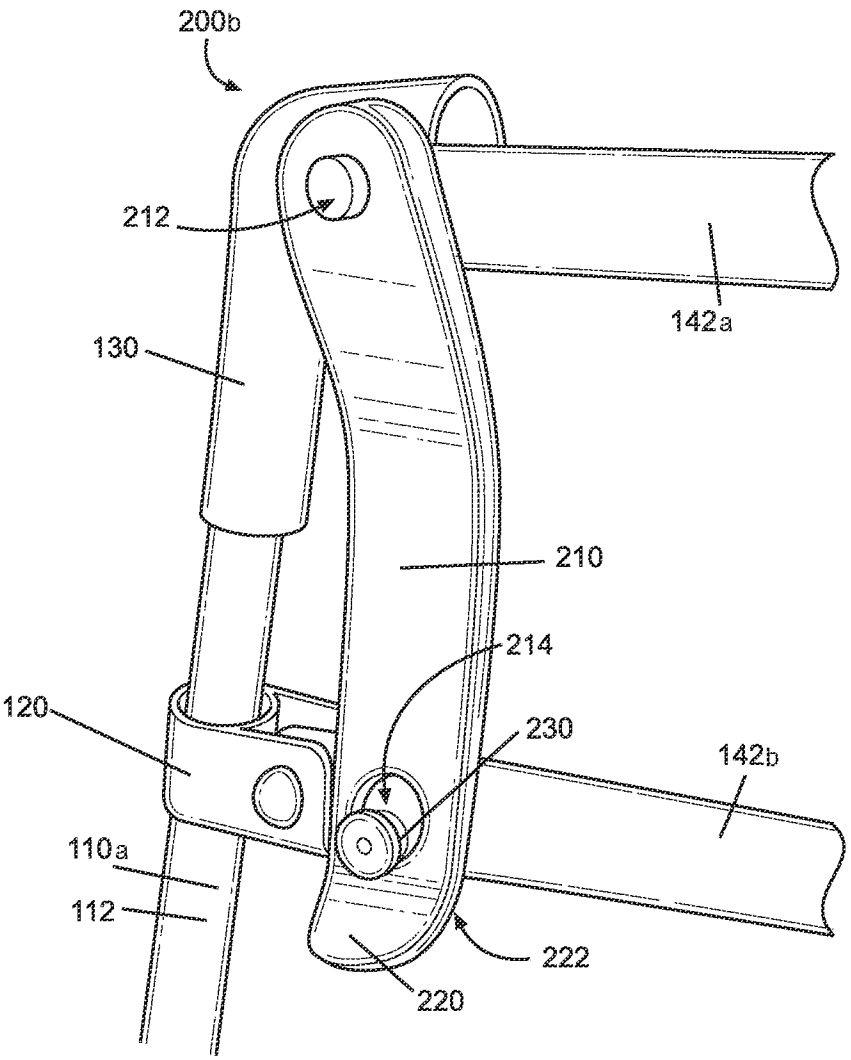
FIG. 8C shows a perspective view of the flex lock latch of FIG. 8A with the soft goods removed and the flex lock latch in a locked configuration.

Specifically, FIG. 8A shows the playard 1000*a* with the soft goods 300 installed onto the frame 100*a*, where the soft goods 300 covers the corners 130 of the leg support assemblies 110*a* and partially covers the X-frame assemblies 140*a*. In this manner, a portion of the single-action latch 200*b* is left exposed to provide access to the caregiver (see, for example, FIG. 8B). As shown in FIGS. 8C and 8D, the single-action latch 200*b* may also include a latch member 210 that is coupled at one end to the corner 130 via a fastener inserted through an opening 212 on the latch member 210. The latch member 210 may once again include a latch opening 214 to receive a latch boss 230. In this implementation, the latch boss 230 is shown coupled to the X-frame tube 142*b* of the X-frame assembly 140*a*.

The single-action latch 200*b* may be locked in a similar manner as the double-action latch 200*a*. Specifically, the slider 120 is moved towards the corner 130, which causes the latch boss 230 to initially deflect the latch member 210 until the latch boss 230 reaches the latch opening 214. At this point, the restoring force generated within the latch member 210 causes the latch member 210 to return to its original position with the latch boss 230 protruding through the latch opening 214. In this manner, the single-action latch 200*b* may hold the frame 100*a* in the unfolded configuration.

To unlock the single-action latch 200*b* and fold the frame 100*a*, the caregiver may pull on the tab 220 to deflect and/or bend the latching member 210 outwards, thus releasing the latch member 210 from the latch boss 230. As before, while the caregiver holds the latch member 210, the slider 120 may then move downwards along the leg tube 112 via a combination of gravity and the caregiver moving the slider 120 towards the foot 114 of the leg support assembly 110*a* as shown in FIG. 8D. In this manner, the playard 1000*a* may be folded.

Figure 9A:
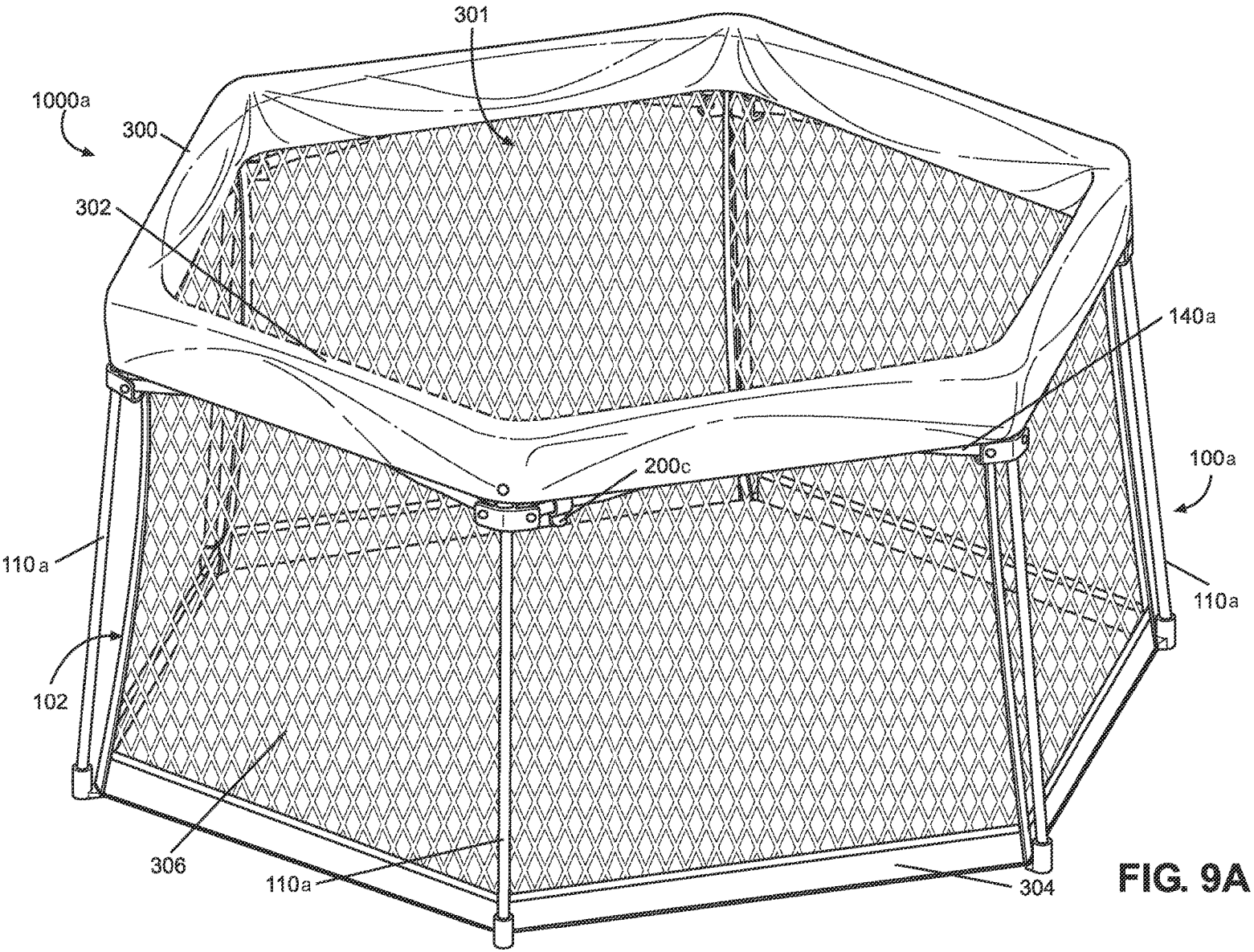
FIG. 9A shows a top perspective view of the playard of FIG. 2A with soft goods and a flex lock latch with a latch member having a snap-fit connector. The playard is in an unfolded configuration.
Figure 9B:
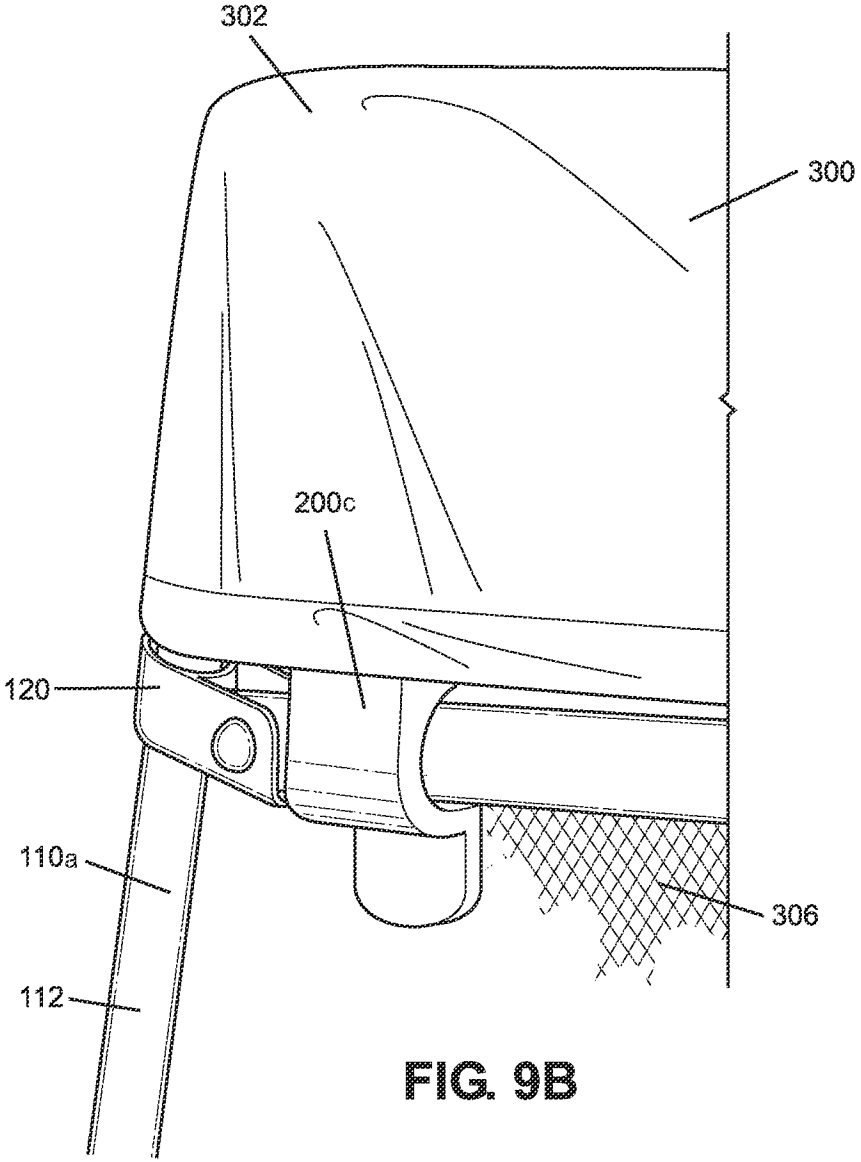
FIG. 9B shows a magnified view of the flex lock latch of FIG. 9A.
Figure 9C:
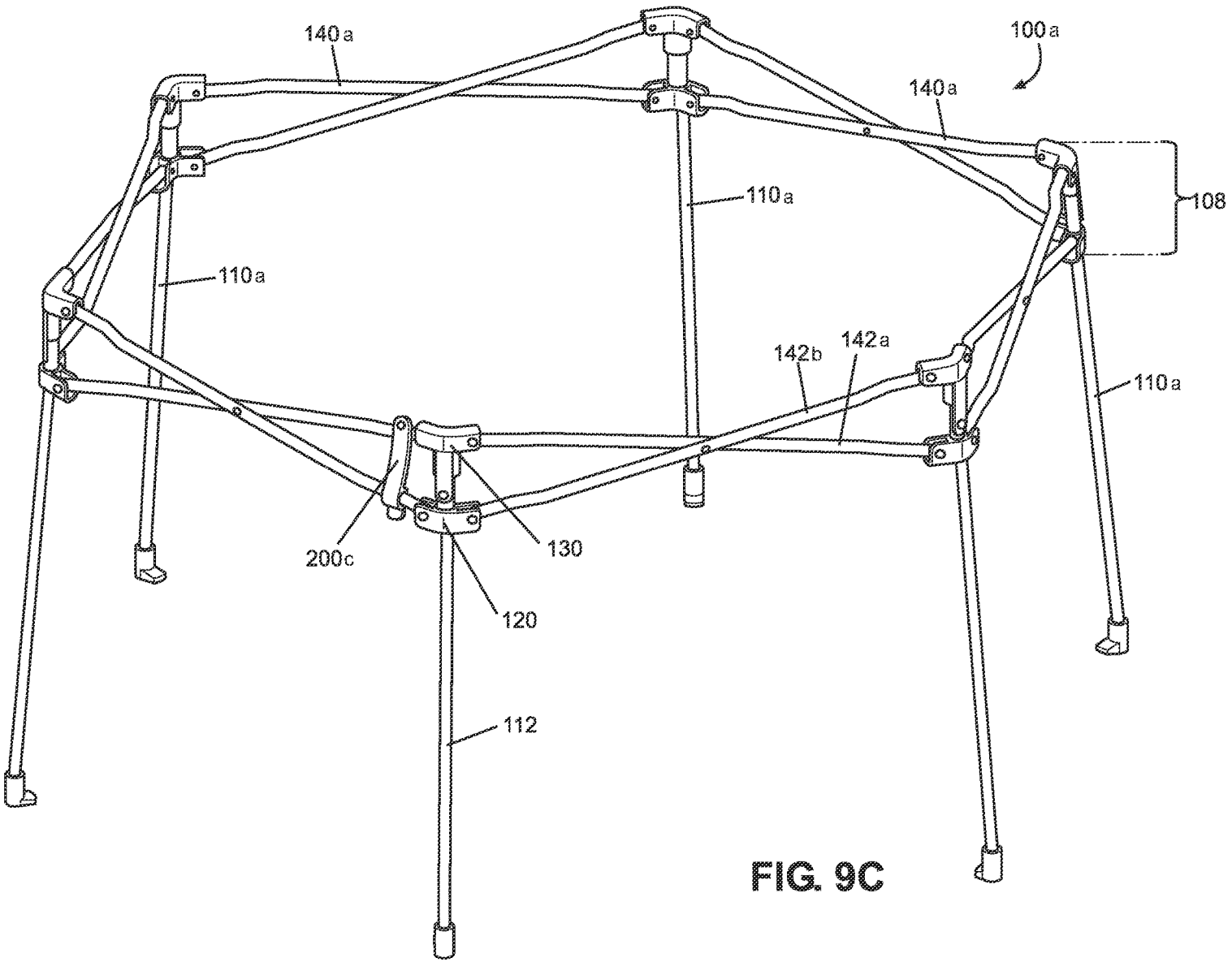
FIG. 9C shows a top perspective view of the playard of FIG. 9A with the soft goods removed.

FIGS. 9A-9F show another exemplary latch 200*c* installed on the frame 100*a* of the playard 1000*a*. FIG. 9A shows the frame 100*a* once again covered with soft goods 300. FIG. 9B shows the soft goods 300 only partially covers the X-frame assemblies 140*a* such that a bottom portion of the latch 200*c* is exposed. FIG. 9C shows the frame 100*a* without soft goods 300 attached. As shown, the latch 200*c* may be positioned on the frame 100*a* similar to the double-action latch 200*a* and the single-action latch 200*b*, i.e., the latch 200*c* is disposed in the top portion 108 of the frame 100*a*.

Figure 9E:
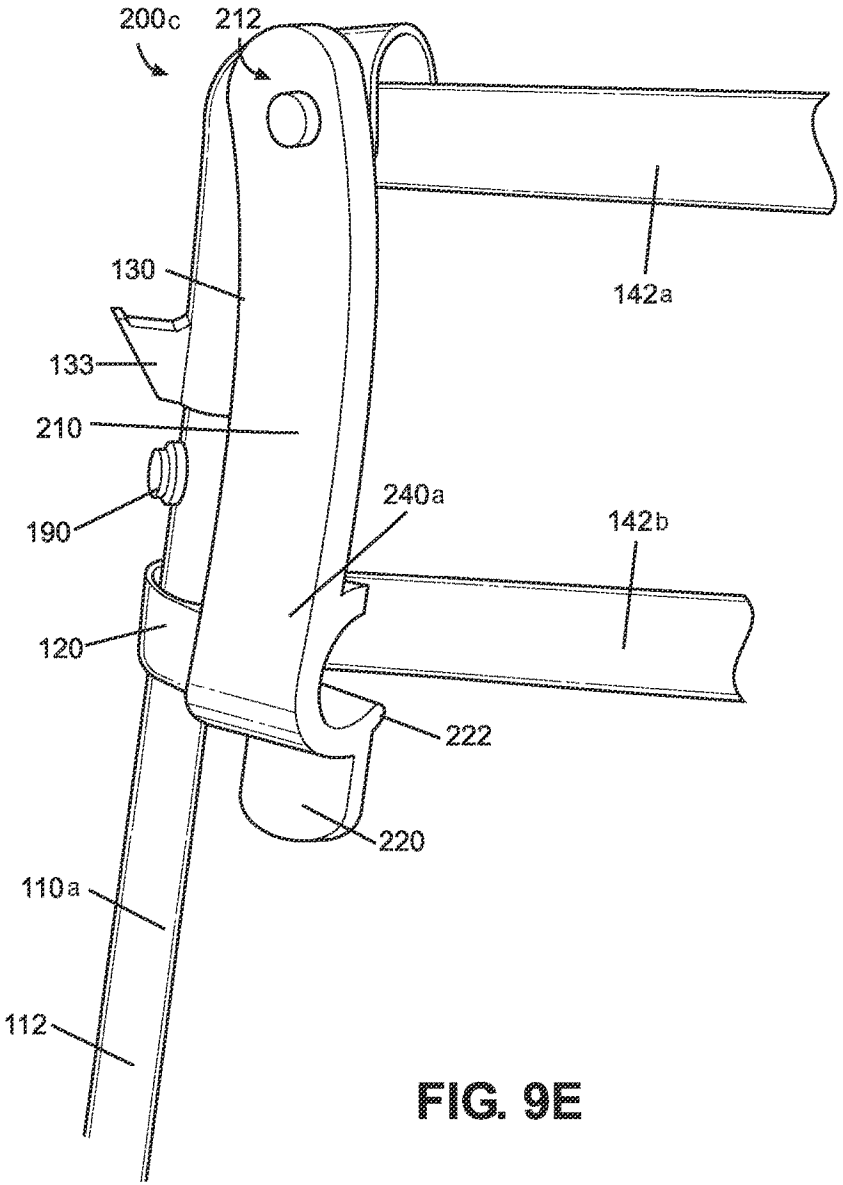
FIG. 9E shows a perspective view of the flex lock latch of FIG. 9D in an unlocked configuration.
Figure 9D:
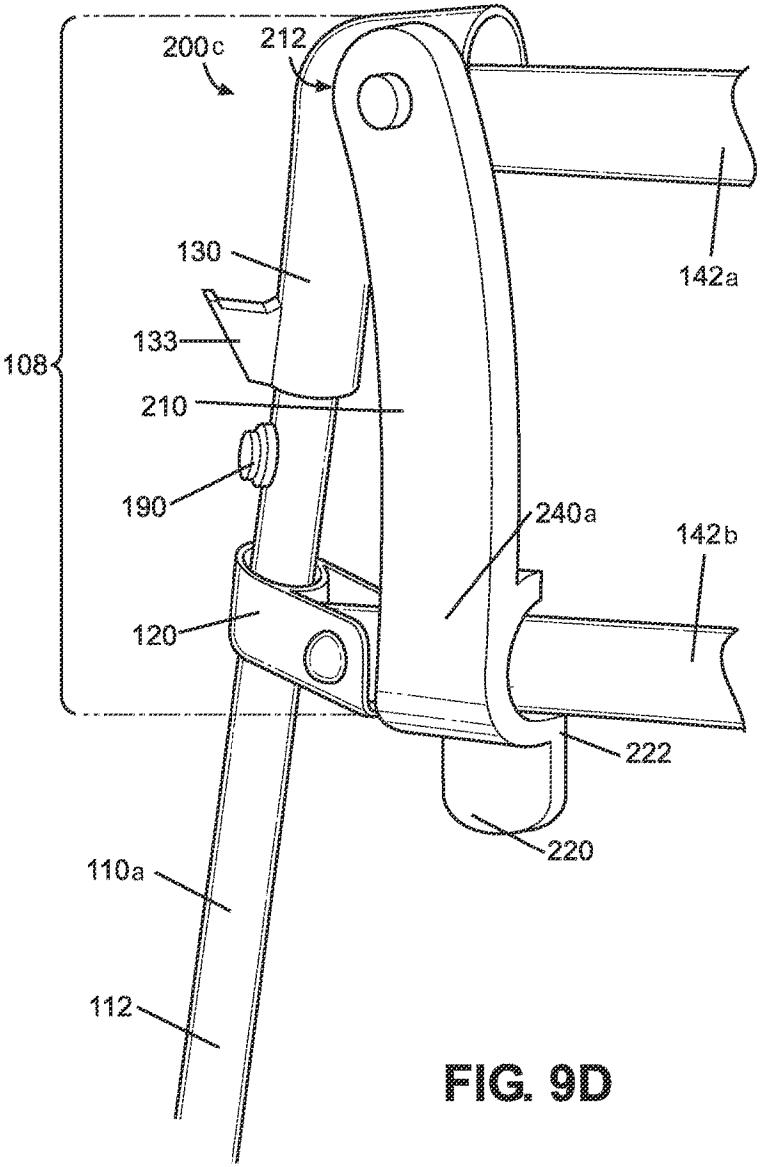
FIG. 9D shows a perspective view of the flex lock latch of FIG. 9C in a locked configuration.

FIG. 9D shows the latch 200*c* may once again include a latch member 210 that is coupled to the corner 130 via a fastener inserted through an opening 212 at one end of the latch member 210. However, in this example, the latch member 210 may form a notch 240*a* that is shaped and/or dimensioned to form a snap-fit connection with the X-frame tube 142*b*. In this manner, the latch 200*c* may utilize fewer parts compared to the latches 200*a* and 200*b* (e.g., the latch 200*c* only includes the latch member 210 and a fastener to couple the latch member 210 to the corner 130). As shown, the notch 240*a* may be shaped to conform with the cross-sectional shape of the X-frame tube 142*b*. As before, the latch member 210 may be a mechanically compliant component that may be bent and/or deflected due to contact with the X-frame tube 142*b* (e.g., when unfolding the frame 100*a*) and/or by the caregiver pulling on the tab 220 disposed at the bottom end of the latch member 210 to release the latch member 210 from the X-frame tube 142*b* (e.g., when folding the frame 100*a*).

In the implementation shown in FIGS. 9A-9D, the frame 100*a* and, by extension, the playard 1000*a* may be setup once again by having the caregiver move the slider 120 of one leg support assembly 110*a* towards the corresponding corner 130. When the X-frame tube 142*b* contacts the latch member 210 and, specifically, the tab 220, the latch member 210 may be deflected outwards. The latch member 210 may further include a lead-in feature 222 (e.g., a sloped wall) to deflect the latch member 210 as the latch member 210 contacts the X-frame tube 142*b*. The caregiver may then continue to move the slider 120 towards the corner 130 until the notch 240*a* aligns with the X-frame tube 142*b*.

In some implementations, the latch member 210 may be sufficiently compliant such that deflection of the latch member 210 does not produce an appreciable restoring force. Thus, the caregiver needs to press the latch member 210 to snap-fit the latch member 210 onto the X-frame tube 142*b*. In other implementations, however, the latch member 210 may instead generate an internal restoring force when bent and/or deflected (e.g., the latch member 210 includes rib structures to increase the mechanical rigidity of the latch member 210). The restoring force may be of sufficient magnitude to cause the notch 240*a* to at least partially engage the X-frame tube 142*b*. In some instances, the caregiver may still press the latch member 210 onto the X-frame tube 142*b*, albeit with less force due to the restoring force generated in the latch member 210, to ensure the latch member 210 is properly engaged to the X-frame tube 142*b*. In yet other implementations, the restoring force may instead be sufficiently large to snap-fit connect the latch member 210 to the X-frame tube 142*b* without any additional action by the caregiver.

Figure 9F:
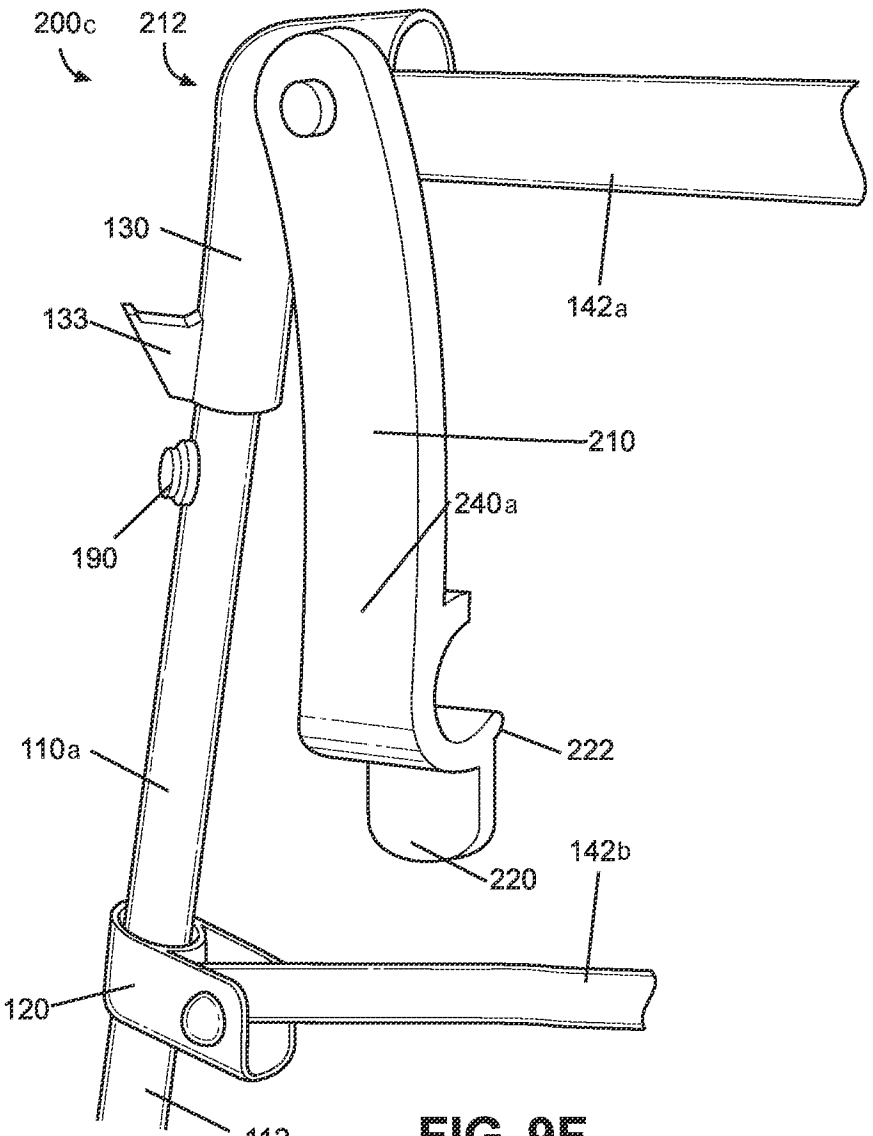
FIG. 9F shows a perspective view of the flex lock latch of FIG. 9E where the playard is partially folded after unlocking the flex lock latch.

Turning now to FIG. 9E, to unlock the latch 200*c* the caregiver may pull on the tab 220 with sufficient force to disengage the notch 240*a* from the X-frame tube 142*b*. In implementations where the latch member 210 does not generate an appreciable restoring force, the caregiver may release the latch member 210, and the slider 120 may then move downwards along the leg tube 112 via gravity and/or the caregiver actively moving the slider 120 as shown in FIG. 9F. In implementations where the latch member 210 generates an appreciable restoring force, the caregiver may hold the latch member 210 with one hand until the slider 120 moves a sufficient distance along the leg tube 112 such that the X-frame tube 142*b* is no longer aligned with the notch 240*a*.

Additionally, FIGS. 9D-9F show the corner 130, in some implementations, may further include a hook 133 that protrudes outwards from the frame 100*a*. The hook 133 may be used, in part, to pull the soft goods 300 taut around the frame 100*a* and/or to function as a secondary restraining feature to prevent the soft goods 300 from prematurely detaching from the frame 100*a*. In some implementations, the hook 133 may also be used as a locating feature to facilitate installation of the soft goods 300 onto the frame 100*a*. FIGS. 9D-9F further show that, in some implementations, the corner 130 may not include the snap-fit connector 139 as before. Instead, a snap-fit connector 190 maybe mounted directly onto the leg tube 112.

Figure 10:
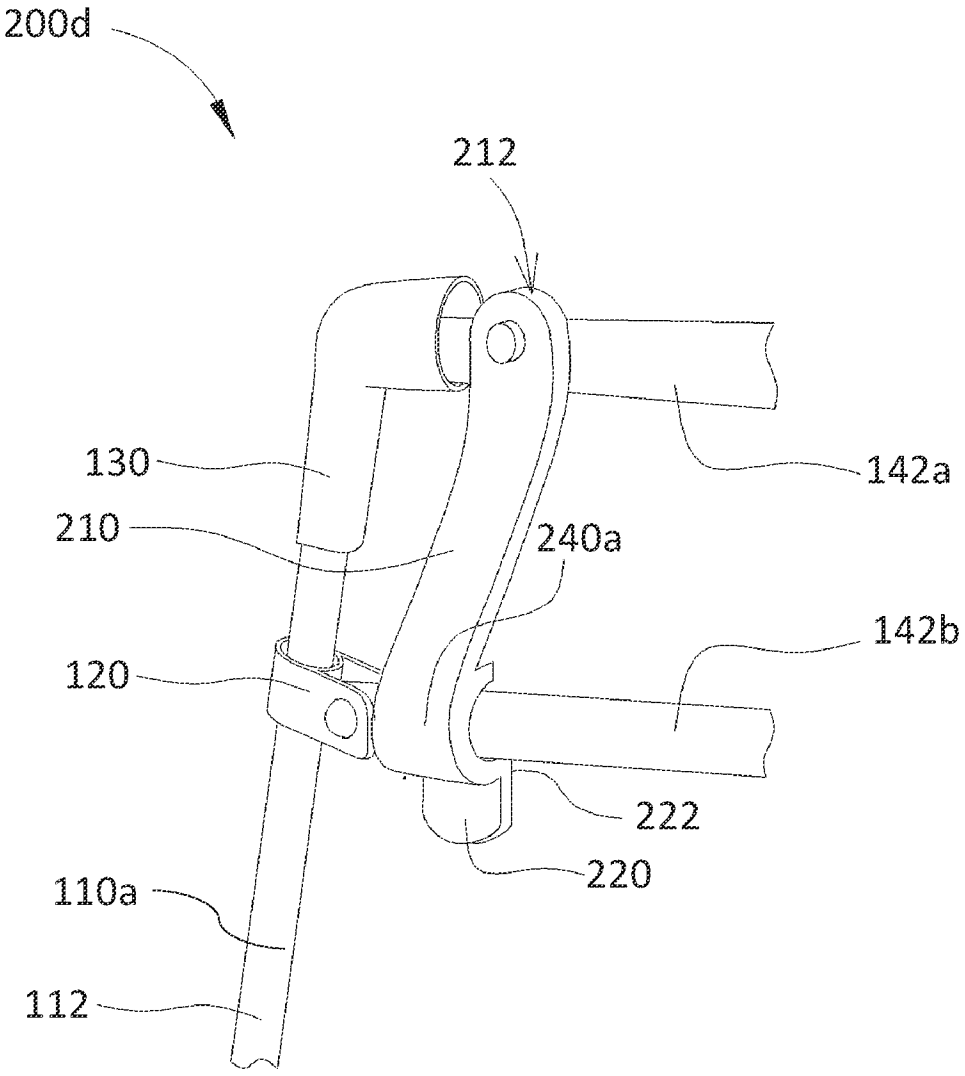
FIG. 10 shows another flex lock latch with a latch member having a snap-fit connector where the latch member of the latch is coupled to a X-frame tube of an X-frame assembly.

FIG. 10 shows another exemplary latch 200*d* coupled to the frame 100*a*. The latch 200*d* is a variant of the latch 200*c* with the primary difference being the latch member 210 is coupled to the X-frame tube 142*a* instead of the corner 130 via a fastener inserted through the opening 212 and an opening on the X-frame tube 142*a*. The latch 200*d* may be locked and/or unlocked in the same manner as the latch 200*c*. In some implementations, the latch member 210 of the latch 200*d* may be dimensioned to be shorter in length due to the smaller separation distance between the X-frame tubes 142*a* and 142*b* compared to the latch member 210 of the latch 200*c*.

Figure 11A:
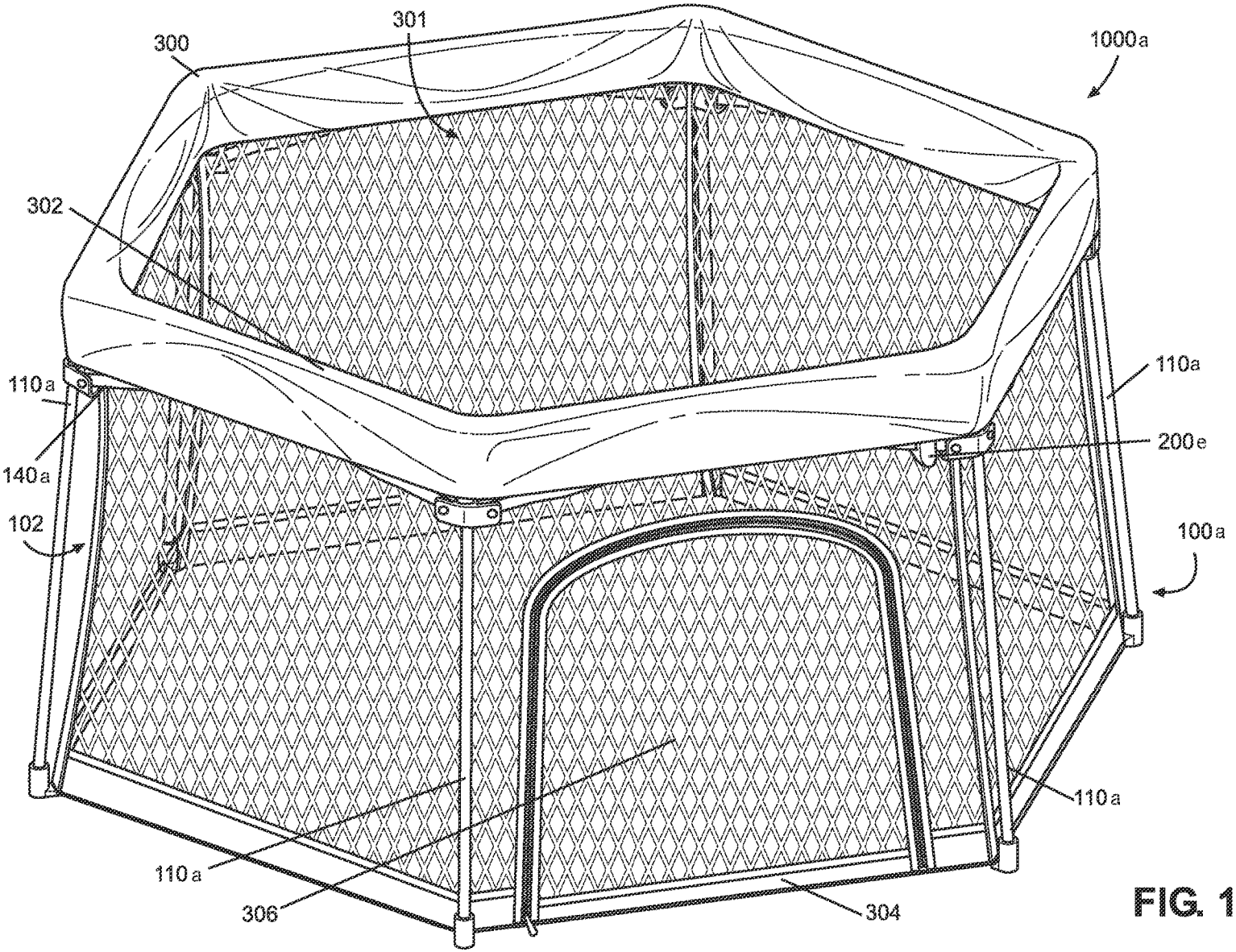
FIG. 11A shows a top perspective view of the playard of FIG. 2A with soft goods and a flex lock latch with a hook structure. The playard is in an unfolded configuration.
Figure 11B:
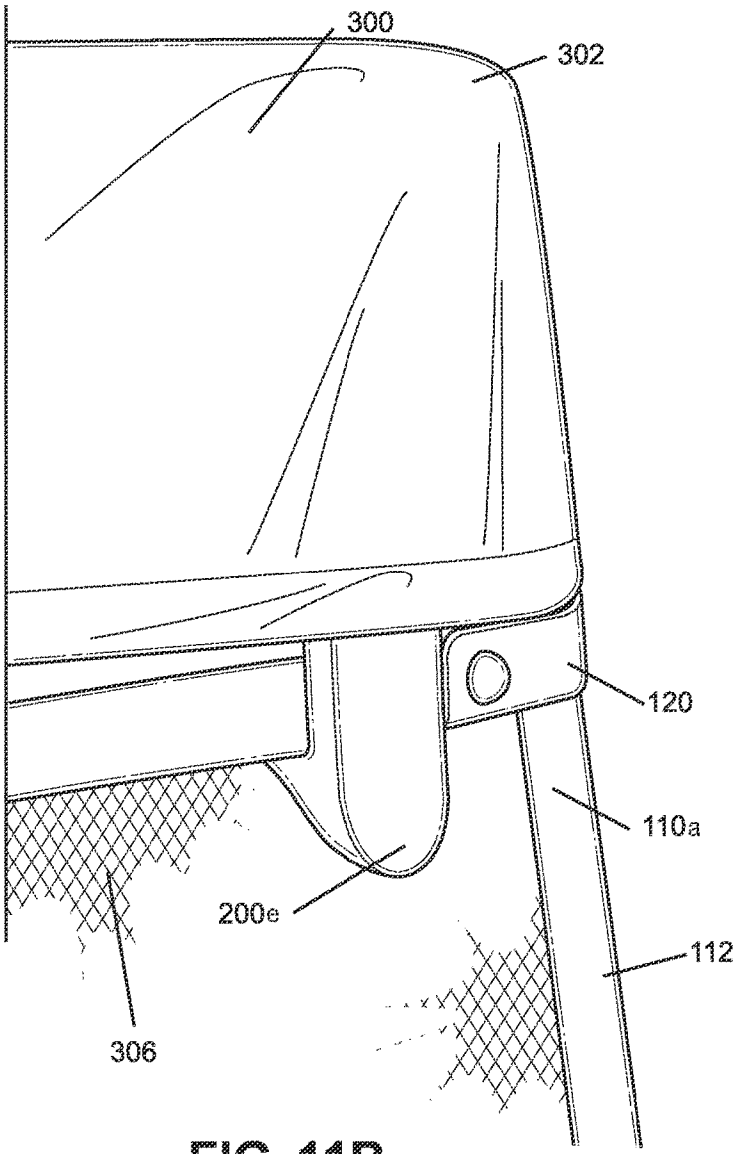
FIG. 11B shows a magnified view of the flex lock latch of FIG. 11A.

FIGS. 11A-11D show another exemplary latch 200*e* installed on the frame 100*a* of the playard 1000*a*. FIG. 11A shows the frame 100*a* once again covered with soft goods 300. FIG. 11B shows the soft goods 300 again partially covering the X-frame assemblies 140*a* such that a bottom portion of the latch 200*e* is exposed similar to the latches 200*a*-200*d*.

Figure 11D:
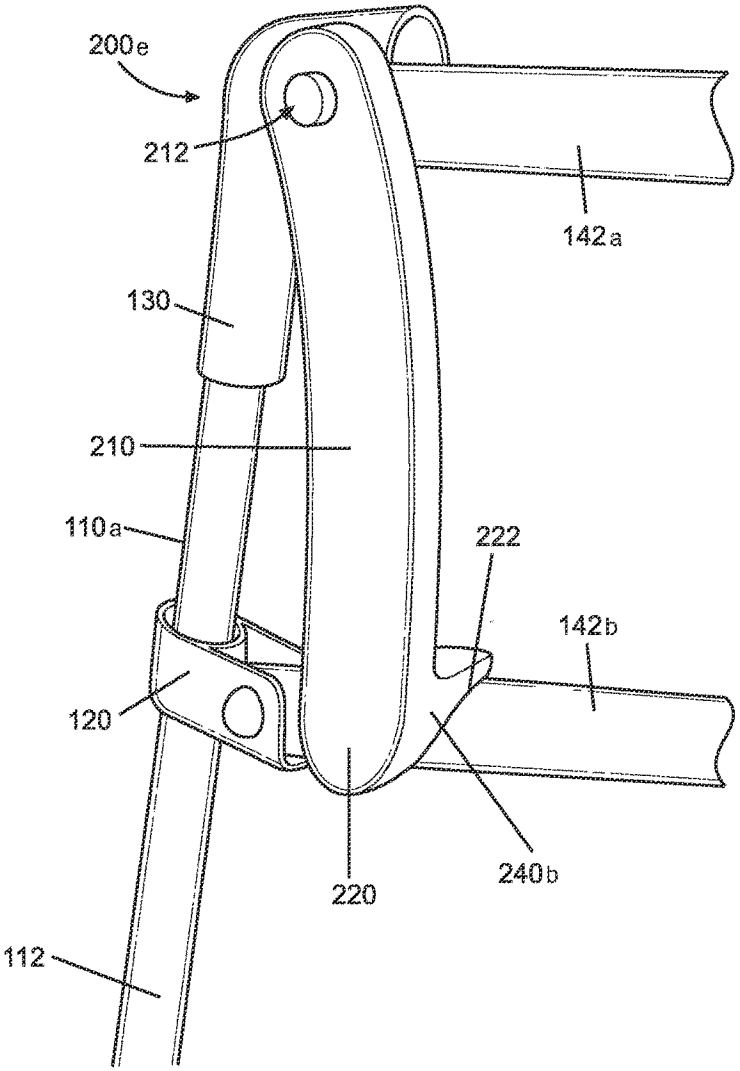
FIG. 11D shows a perspective view of the flex lock latch of FIG. 11C in an unlocked configuration.
Figure 11C:
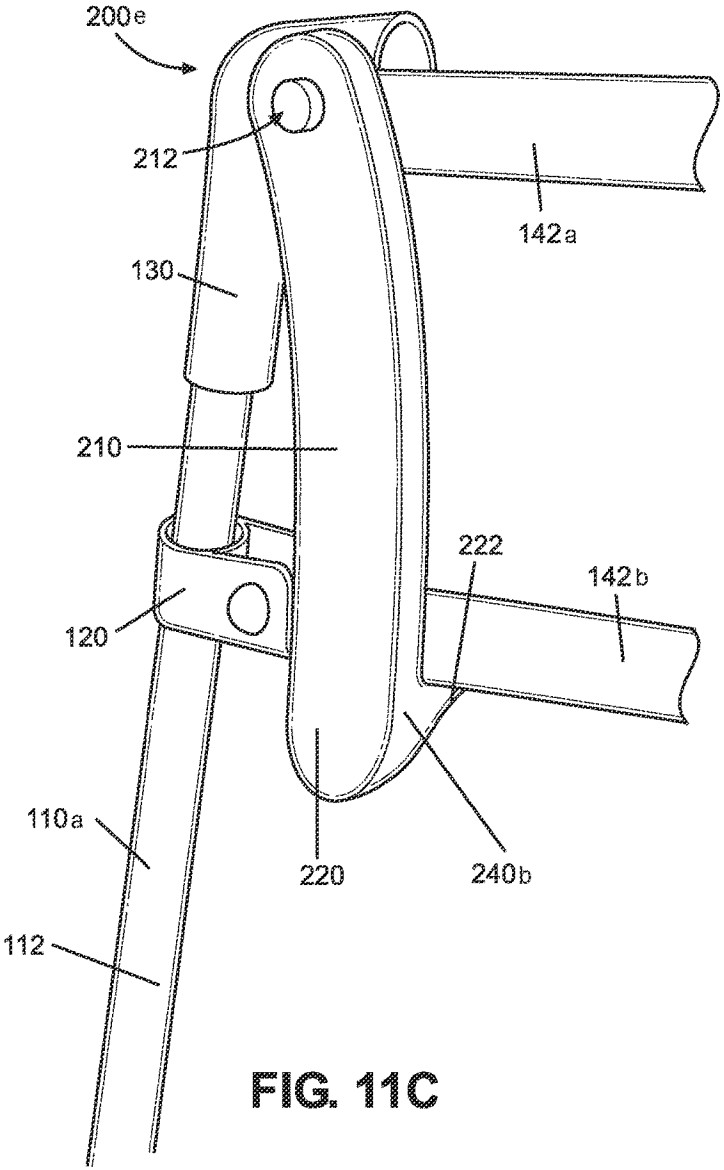
FIG. 11C shows a perspective view of the flex lock latch of FIG. 11A with the soft goods removed and the flex lock latch in a locked configuration.

FIG. 11C shows the latch 200*e* may again include a latch member 210 coupled to the corner 130 of one leg support assembly 110*a* via a fastener inserted through the opening 212 at one end of the latch member 210. In this example, the latch member 210 may include a hook structure 240*b* near the tab 220. As shown, the hook structure 240*b* may provide a contoured surface upon which the X-frame tube 142*b* may rest when the frame 100*a* is unfolded. As before, the latch member 210 may be a mechanically compliant component that may be deflected and/or bent due to contact with the X-frame tube 142*b* and/or the caregiver pulling on the tab 220 disposed at the bottom end of the latch member 210.

The latch 200*e* may lock the frame 100*a* in the unfolded configuration in a similar manner to the latches 200*a*-200*d*. When the caregiver moves the slider 120 towards the corner 130, the X-frame tube 142*b* may contact the latch member 210 and deflect outwards. The latch member 210 may include a lead-in feature 222 formed between the hook structure 240*b* and the bottom end of the latch member 210 to guide the X-frame tube 142*b* moving against the latch member 210 and to deflect the latch member 210 outwards. Once the X-frame tube 142*b* is disposed above the hook structure 240*b*, the caregiver may release the slider 120 and the slider 120 may then move downwards along the leg tube 112 until the X-frame tube 142*b* comes to rest on the hook structure 240*b*.

In some implementations, the hook structure 240*b* may be shaped such that the caregiver may release the latch 200*e* by pulling on the tab 220 with sufficient force. In some implementations, the hook structure 240*b* may be shaped to cradle the X-frame tube 142*b* and/or the latch member 210 may be sufficiently rigid such that the latch member 210 acts as a double-action latch where the caregiver would have to apply an appreciably large force to disengage the latch member 210 from the X-frame tube 142*b*. Instead, the caregiver may raise the slider 120 and/or squeeze the X-frame tubes 142*a* and 142*b* such that the X-frame tube 142*b* is released from the hook structure 240*b*. While the caregiver holds the X-frame tube 142*b* above the hook structure 240*b* with one hand, the caregiver may then pull the latch member 210 outwards to allow the X-frame tube 142*b* to fall below the hook structure 240*b* as shown in FIG. 11D.

Figure 12A:
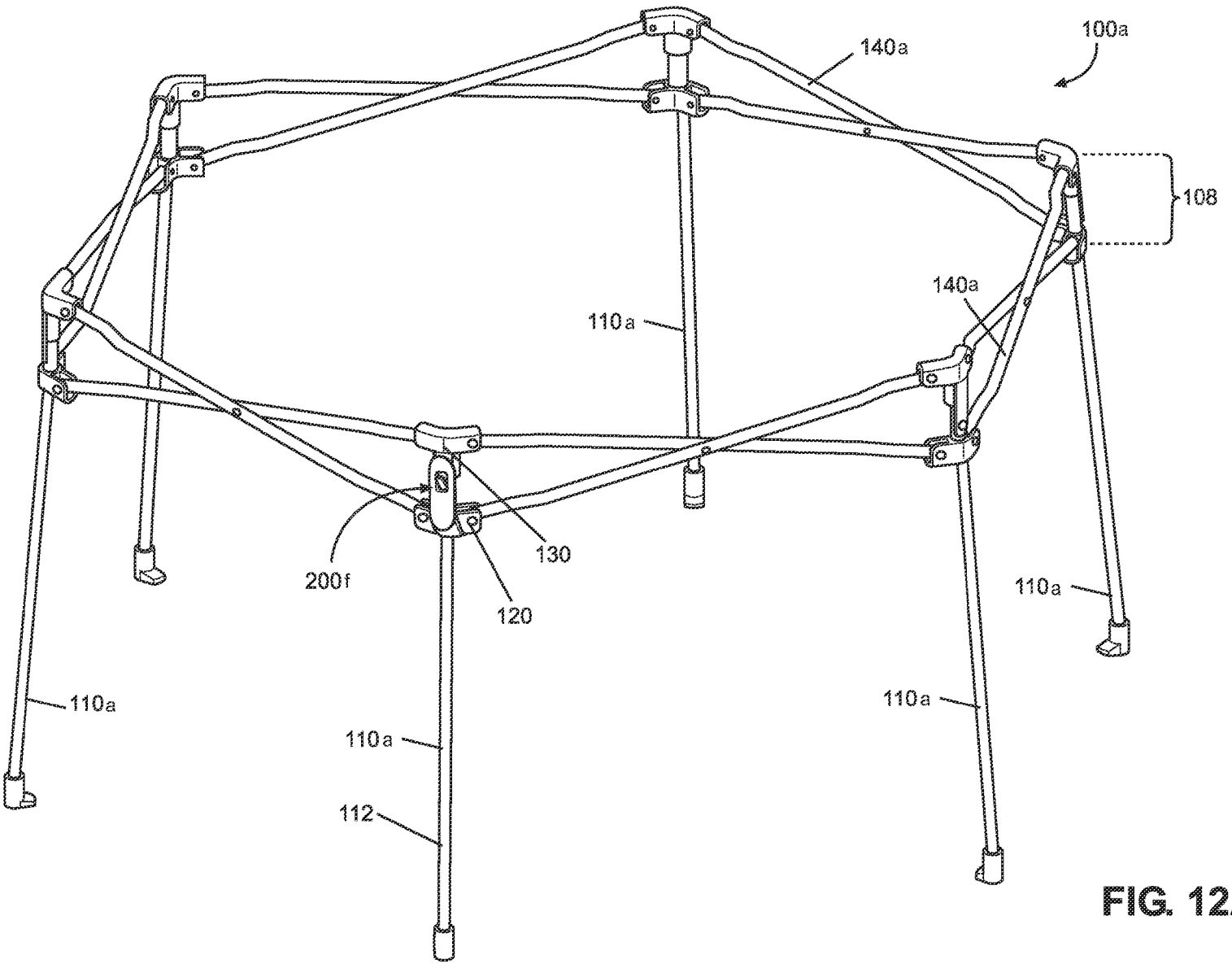
FIG. 12A shows a top perspective view of the playard of FIG. 2A with a latch mounted to a slider and a corner of a leg support assembly. The playard is in an unfolded configuration.
Figure 12B:
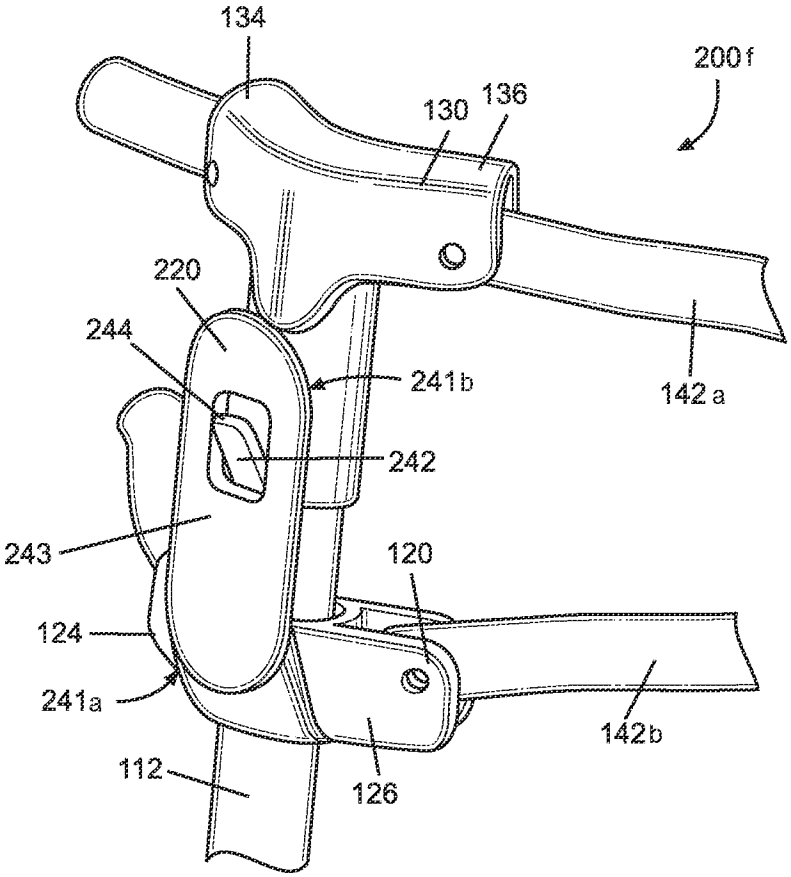
FIG. 12B shows a magnified view of the latch of FIG. 12A.

FIGS. 12A and 12B show another exemplary latch 200*f* that directly couples the slider 120 to the corner 130 in the frame 100*a* of the foldable playard 1000*a*. As shown in FIG. 12A, the frame 100*a* may only include one latch 200*f* coupled to one leg support assembly 110*a* to support the multiple sliders 120 and/or X-frame assemblies 140*a* when the frame 100*a* is unfolded.

FIG. 12B shows the latch 200*f* may include a latch member 243 disposed on the slider 120 of one leg support assembly 110*a* and a latch hook 242 disposed on the corresponding corner 130. The latch member 243 may be integrally formed onto the slider 120 to form one single component or fabricated as a separate component that is then coupled to the slider 120 using, for example, a fastener or a snap-fit connection. In some implementations, the latch member 243, when formed as a separate component, may be coupled to the openings of the slider 120 formed on the extended portions 124 and 126 to couple to the X-frame tubes 142*a* and/or 142*b* such that a single fastener couples the latch member 243, the slider 120, and one or more X-frame tubes 142*a* and/or 142*b* together. In this manner, the slider 120 may remain identical with the other sliders 120 in the frame 100*a*.

The latch hook 242 may similarly be integrally formed onto the corner 130 to form one single component or fabricated as a separate component that is then coupled to the slider 120. Similarly, the latch hook 242, when formed as a separate component, may be coupled to the openings of the corner 130 formed on the extended portions 134 and 136 in a manner similar to the latch member 210 of the latch 200*a* where the corner 130 remains unchanged and/or identical with the other corners 130 in the frame 100*a*.

The latch member 243 may include a first end 241*a* coupled to the slider 120 and a latch opening 244 disposed near a second end 241*b* opposite from the first end 241*a*. The latch opening 244 may be shaped to receive the latch hook 242 on the corner 130. In some implementations, the latch hook 242 may have a contoured surface such that the portion of the latch member 243 forming the top side of the opening 244 rests upon the latch hook 242 when the latch 200*f* is locked. In this manner, the latch 200*f* may directly couple the slider 120 and the corner 130 together to hold the frame 100*a* in the unfolded configuration. In some implementations, the latch opening 244 and the latch hook 242 may also be shaped to reduce or, in some instances, eliminate relative translational and/or rotational motion between the slider 120 and the corner 130 along axes of motion other than the longitudinal axis 111*a*.

The latch member 243 may be a mechanically compliant component with a tab 220 disposed at the second end 241*b* similar to the latch member 210 of the latch 200*a*. Although the latch member 243 is disposed on the slider 120, the latch member 243 may engage the latch hook 242 in a manner similar to the latches 200*a*-200*e*. As before, the caregiver may move the slider 120 towards the corner 130. Once the tab 220 of the latch member 243 contacts the bottom surface of the latch hook 242, the latch member 243 may be deflected outwards. As shown in FIG. 12B, the bottom surface of the latch hook 242 may form a lead-in feature (e.g., a sloped surface) to guide the latch member 243 as it is deflected outwards. The latch member 243 may be sufficiently rigid to generate an internal restoring force when the latch member 243 is bent. Thus, once the slider 120 is moved sufficiently close to the corner 130 that the latch hook 242 is aligned with the latch opening 244, the restoring force may cause the latch member 243 to snap back to its original form and the latch hook 242 may then protrude through the latch opening 244.

Similar to the latch 200*e*, the latch 200*f* may be a single-action latch where the caregiver may release the latch member 243 from the latch hook 242 by pulling the tab 220 with sufficient force. In some implementations, the latch 200*f* may be a double-action latch where the latch hook 242 may be sufficiently rigid and/or includes a sufficiently deep undercut portion such that the latch member 243 cannot be released by pulling the tab 220 without applying excessive force (e.g., a force greater than 20 lbf). The caregiver should instead raise the slider 120 such that the portion of the latch member 243 forming the top side of the opening 244 is released from the latch hook 242. While holding the slider 120 in the raised position, the caregiver may then pull the latch member 243 outwards so that the slider 120 may move downwards along the leg tube 112.

Figure 13A:
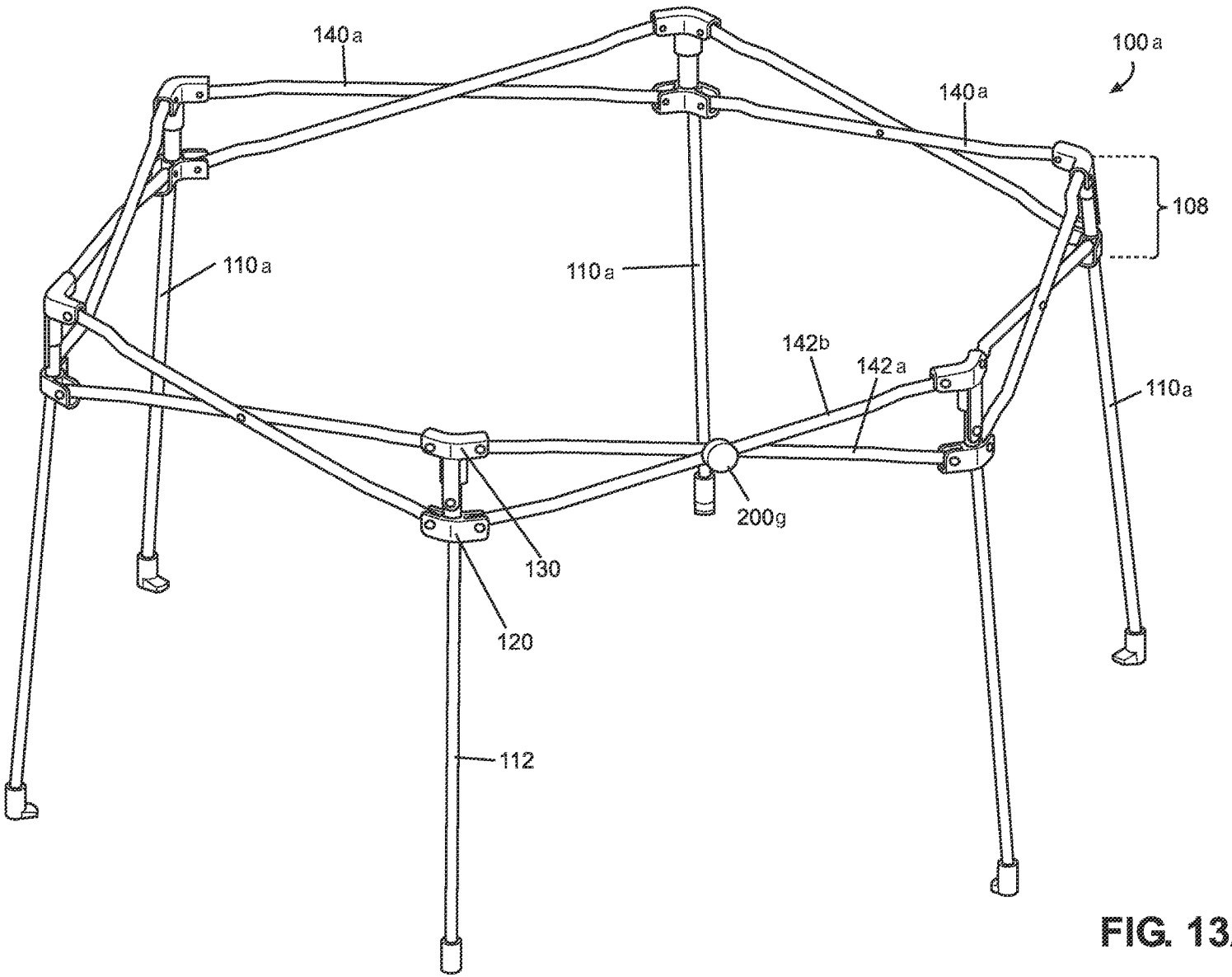
FIG. 13A shows a top perspective view of the playard of FIG. 2A with a latch mounted to a pair of X-frame tubes in the X-frame assembly. The playard is in an unfolded configuration.
Figure 13B:
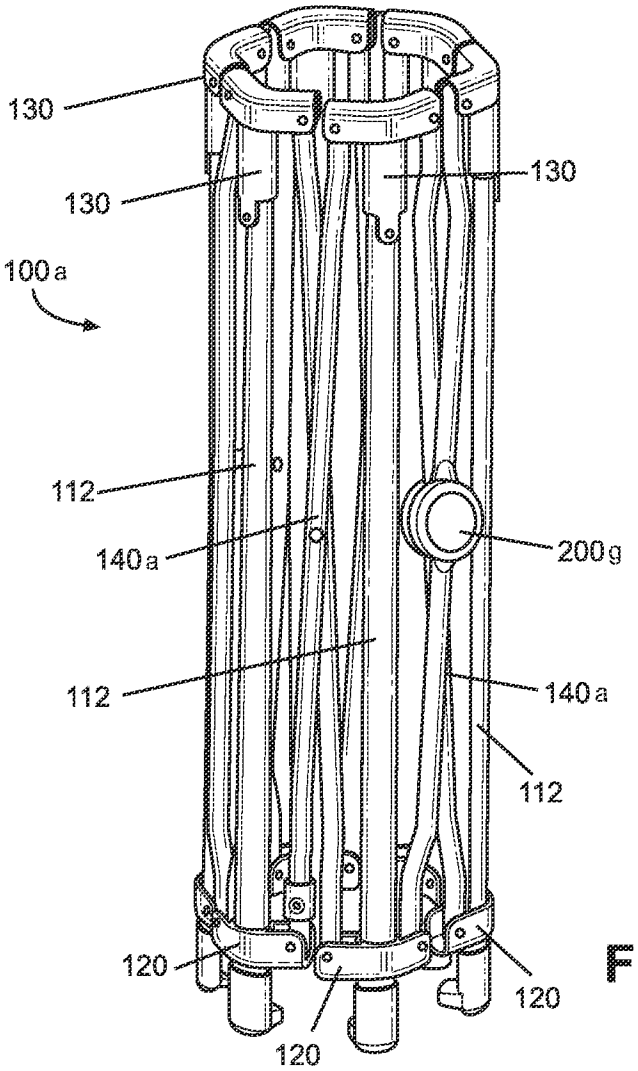
FIG. 13B shows a perspective view of the playard of FIG. 13A in a folded configuration.

FIGS. 13A-13H show another exemplary latch 200*g* that is mounted to the X-frame tubes 142*a* and 142*b* of one X-frame assembly 140*a*. As shown in FIG. 13A, the frame 100*a* may include a single latch 200*g* mounted to one X-frame assembly 140*a* to support the frame 100*a* in the unfolded configuration. In some implementations, the latch 200*g* may be shaped and/or dimensioned to have the same or similar thickness as the X-frame assembly 140*a* so that the latch 200*g* does not protrude appreciably outwards from the frame 100*a* particularly when the frame 100*a* is in the folded configuration as shown in FIG. 13B. In other words, the thickness of the latch 200*g* may be the same or similar as the distance separating the outer exterior edge of the central portion 144 of the X-frame tube 142*a* and the interior exterior edge of the central portion 144 of the X-frame tube 142*b* in FIG. 3B.

Figure 13C:
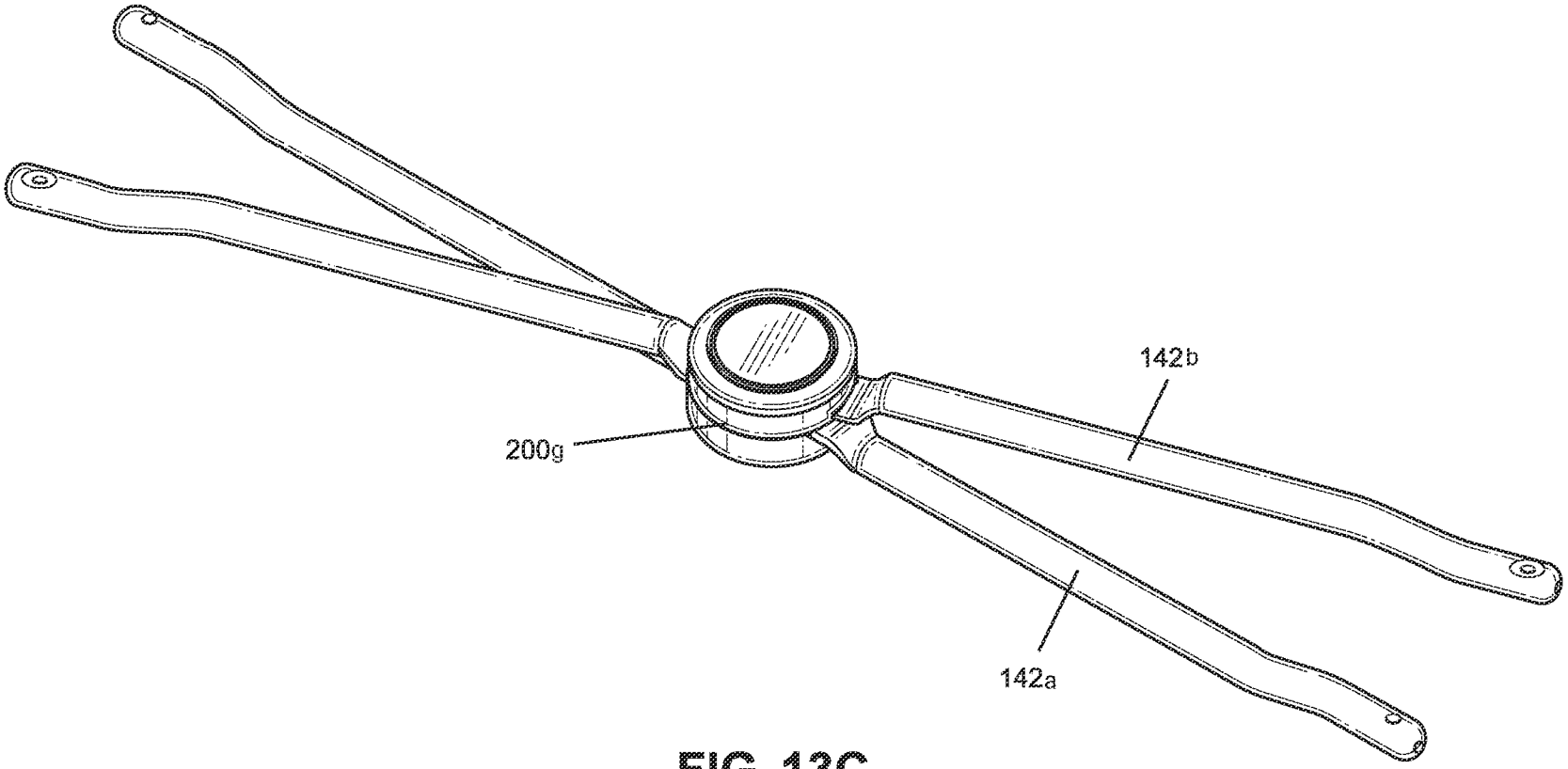
FIG. 13C shows a perspective of the X-frame assembly with the latch of FIG. 13A.
Figure 13D:
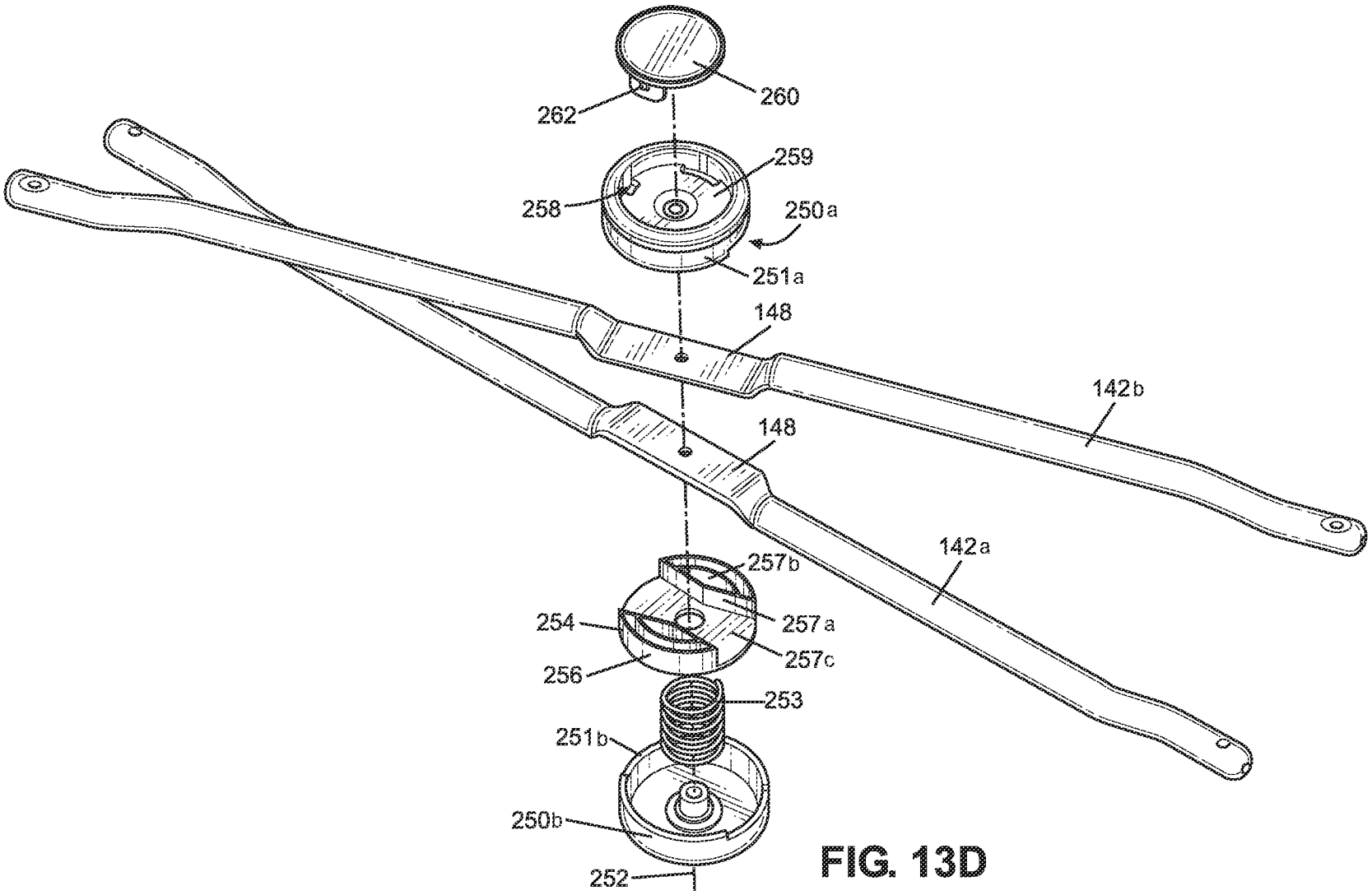
FIG. 13D shows an exploded view of the X-frame assembly with the latch of FIG. 13C.
Figure 13F:
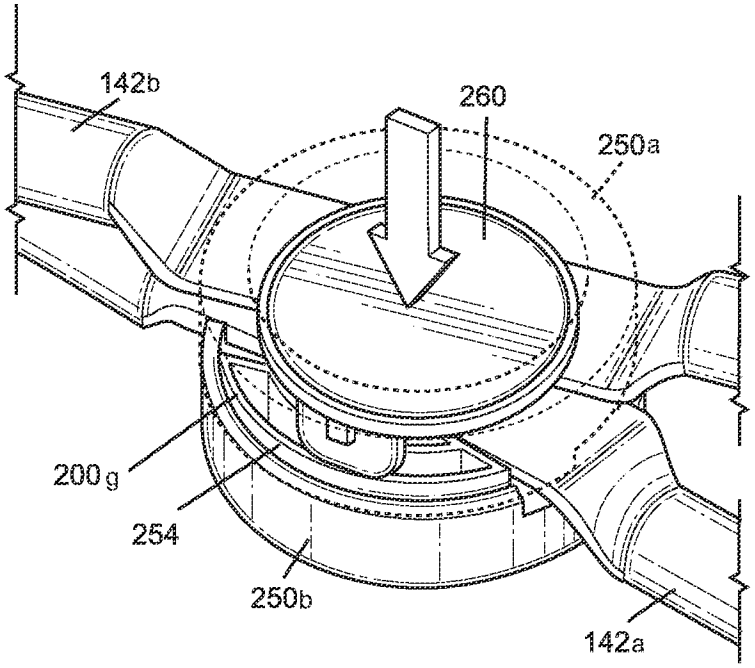
FIG. 13F shows a perspective view of the latch of FIG. 13E in an unlocked configuration.
Figure 13E:
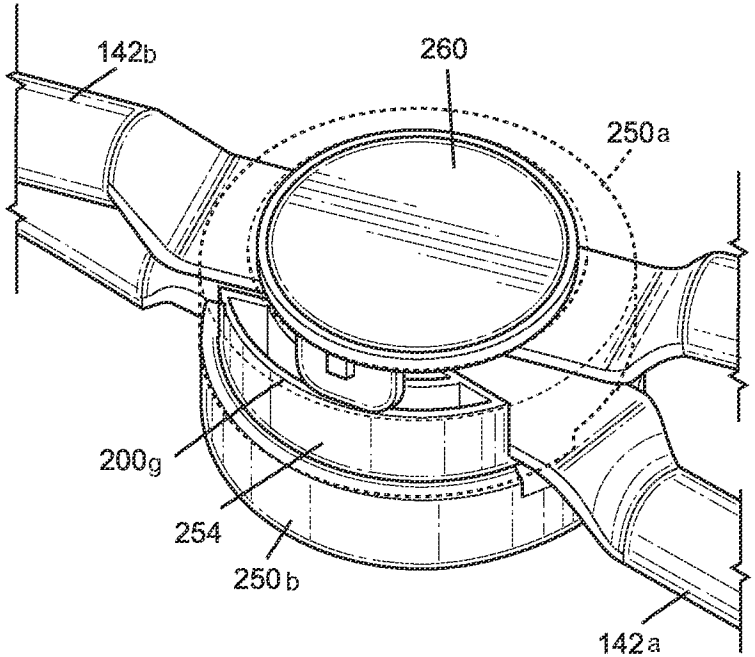
FIG. 13E shows a perspective view of the latch of FIG. 13A in a locked configuration.
Figure 13H:
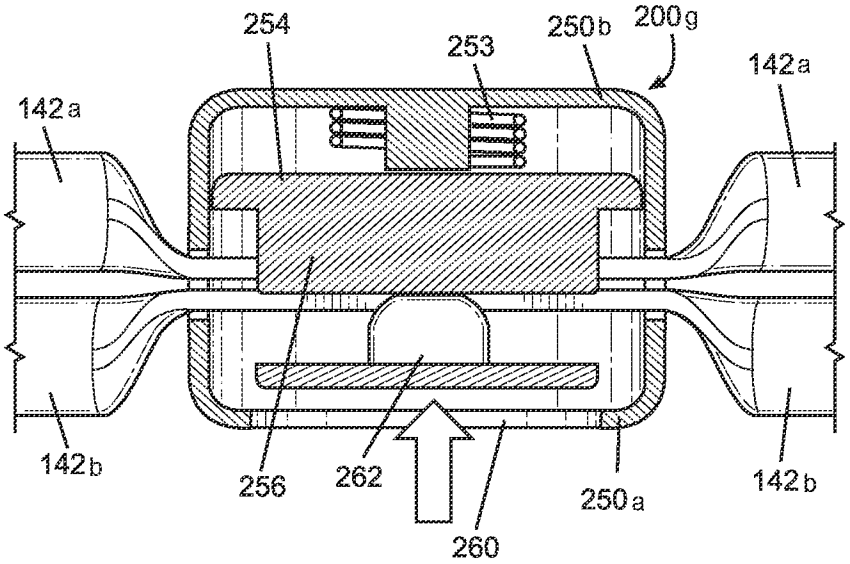
FIG. 13H shows a top view of the latch of FIG. 13F.
Figure 13G:
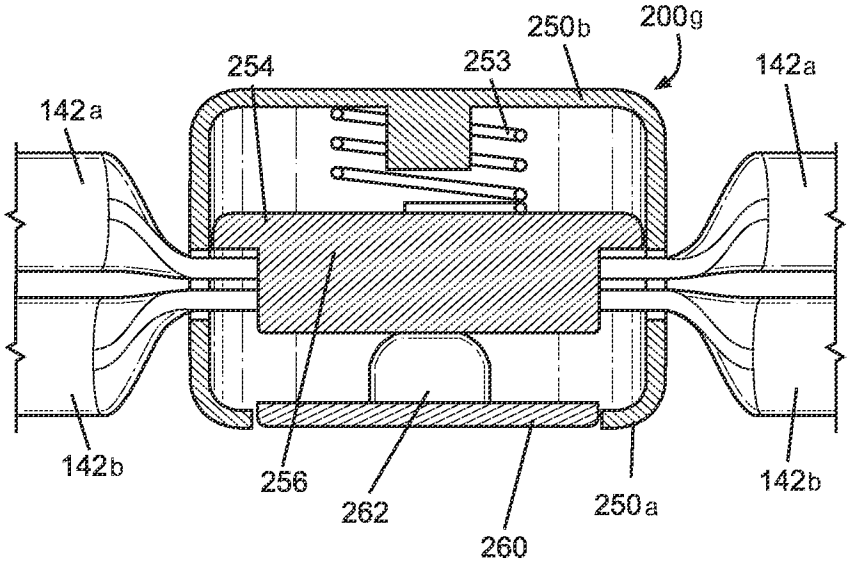
FIG. 13G shows a top view of the latch of FIG. 13E.

FIG. 13C shows the latch 200*g* may replace the pin joint 145 and, hence, may rotatably couple the X-frame tube 142*a* to the X-frame tube 142*b* such that the X-frame tubes 142*a* and 142*b* rotate about a rotation axis 252. FIG. 13D shows the latch 200*g* may include a first housing 250*a* disposed on an exterior portion of the frame 100*a* and rigidly coupled to the X-frame tube 142*b*. In particular, the first housing 250*a* may include a notch 251*a* and the X-frame tube 142*b* may be formed with a flat section 148 within the central portion 144 that fits into the notch 251*a*. Thus, the first housing 250*a* may rotate together with the X-frame tube 142*b*.

The latch 200*g* may further include a second housing 250*b* disposed within the interior space 102 of the frame 100*a* and rigidly coupled to the X-frame tube 142*a*. The second housing 250*b* may also include a notch 251*b* and the X-frame tube 142*a* may also have a flat section 148 that fits into the notch 251*b* so that the second housing 250*b* rotates together with the X-frame tube 142*a*. The first housing 250*a* may be rotatably coupled to the second housing 250*b* via a shaft or pin (not shown) inserted through respective openings in the first housing 250*a*, the second housing 250*b*, and the X-frame tubes 142*a* and 142*b* along the rotation axis 252 as shown in FIG. 13D.

The first and second housings 250*a* and 250*b* may form a cavity to contain a locking gear 254, which may translate along the rotation axis 252 relative to the first and second housings 250*a* and 250*b* to lock and/or unlock the latch 200*g*. The cavity may further contain a return spring 253 disposed between the locking gear 254 and the second housing 250*b* to impart a spring-bias force onto the locking gear 254 to maintain the latch 200*g* in a locked configuration by default. The locking gear 254 may include a pair of latch key sections 256 that have interior sidewalls 257*a* that define a channel 257*c* shaped to restrict and lock the X-frame tubes 142*a* and 142*b* when the frame 100*a* is unfolded (e.g., the X-frame tubes 142*a* and 142*b* are arranged to form a shallow X-frame structure). Said in another way, when the latch 200*g* is locked, the flat sections 148 of the X-frame tubes 142*a* and 142*b* may be disposed within the channel 257*c* where the sidewalls 257*a* abut opposing sides of each of flat sections 148 to prevent rotation of the X-frame tubes 142*a* and 142*b*.

When the playard 1000*a* is in the folded configuration, the locking gear 254 may be primarily disposed within the second housing 250*b* and the return spring 253 may be compressed due to the respective flat sections 148 of the X-frame tubes 142*a* and/or 142*b* contacting and/or pressing against the front portions 257*b* of the locking gear 254. To deploy the playard 1000*a*, the caregiver may once again move the slider 120 of at least one leg support assembly

110*a* and/or squeeze the X-frame tubes 142*a* and 142*b* of one X-frame assembly 140*a* together to unfold the frame 100*a*. As the X-frame tubes 142*a* and 142*b* are rotated, the respective flat sections 148 of the X-frame tubes 142*a* and 142*b* may slide along the front portions 257*b* of the locking gear 254, thus maintaining compression of the return spring 253. Once the X-frame tubes 142*a* and 142*b* are sufficiently rotated such that the respective flat sections 148 of the X-frame tubes 142*a* and 142*b* are aligned to match the geometry of the channel 257*c*, the spring 253 may then push the locking gear 254 outwards towards the first housing 250*a* such that the flat sections 148 are disposed within the channel 257*c* and constrained by the latch key sections 256 (see FIGS. 13E and 13G).

FIG. 13D further shows the latch 200*g* may include a release button 260 disposed, in part, within a recessed opening 259 formed along the front of the first housing 250*a*. The recessed opening 259 of the first housing 250*a* may be separated from the cavity formed between the first and second housings 250*a* and 250*b* by a recessed front surface of the first housing 250*a*. The release button 260 may be slidably coupled to the first housing 250*a* via the slot guides 258 and may include one or more tabs 262 that protrude through the recessed surface of the first housing 250*a* to contact front portions 257*b* of the latch key sections 256 on the locking gear 254.

To unlock the latch 200*g*, the caregiver may push the release button 260 into the recessed opening 259 causing the tabs 262 to press against the latch key sections 256 of the locking gear 254. The locking gear 254, in turn, is then displaced towards the second housing 250*b* along the rotation axis 252 resulting in compression of the return spring 253. Once the locking gear 254 is sufficiently displaced where the respective flat sections 148 of the X-frame tubes 142*a* and 142*b* are no longer disposed within the channel 257*c*, the caregiver may then rotate the X-frame tubes 142*a* and 142*b* and/or move the slider 120 of at least one leg support assembly 110*a* to fold the frame 100*a* (see FIGS. 13F and 13H). In some implementations, the depth of the recessed opening 259 and/or the length of the tabs 262 of the release button 260 may be tailored to ensure sufficient travel distance for the release button 260 to disengage the locking gear 254 from the X-frame tubes 142*a* and 142*b*. In some implementations, the release button 260 may remain disposed within the recessed opening 259 until the playard 1000*a* is unfolded.

FIGS. 14A-14D show another exemplary latch 200*h* integrated into the X-frame tube 142*b* of one X-frame assembly 140*a* to engage the slider 120 of one leg support assembly 110*a* in the frame 100*a* of the playard 1000*a*. FIG. 14A once again shows the frame 100*a* may only include a single latch 200*h* to support the frame 100*a* in the unfolded configuration.

Figure 14A:
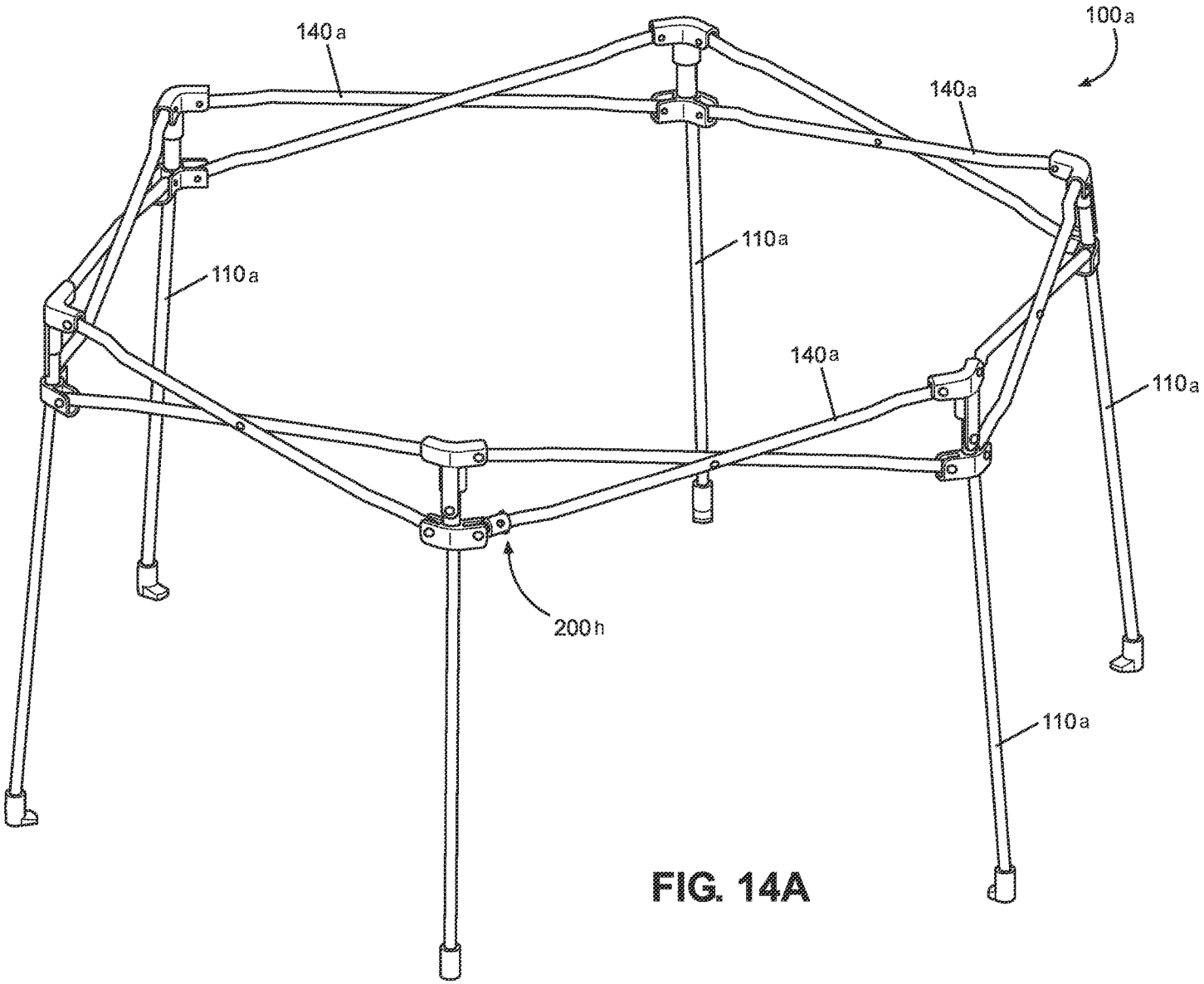
FIG. 14A shows a top perspective view of the playard of FIG. 2A with a latch that includes a spring-loaded pin disposed at one end of a X-frame tube to engage with a leg tube. The playard is in an unfolded configuration.
Figure 14B:
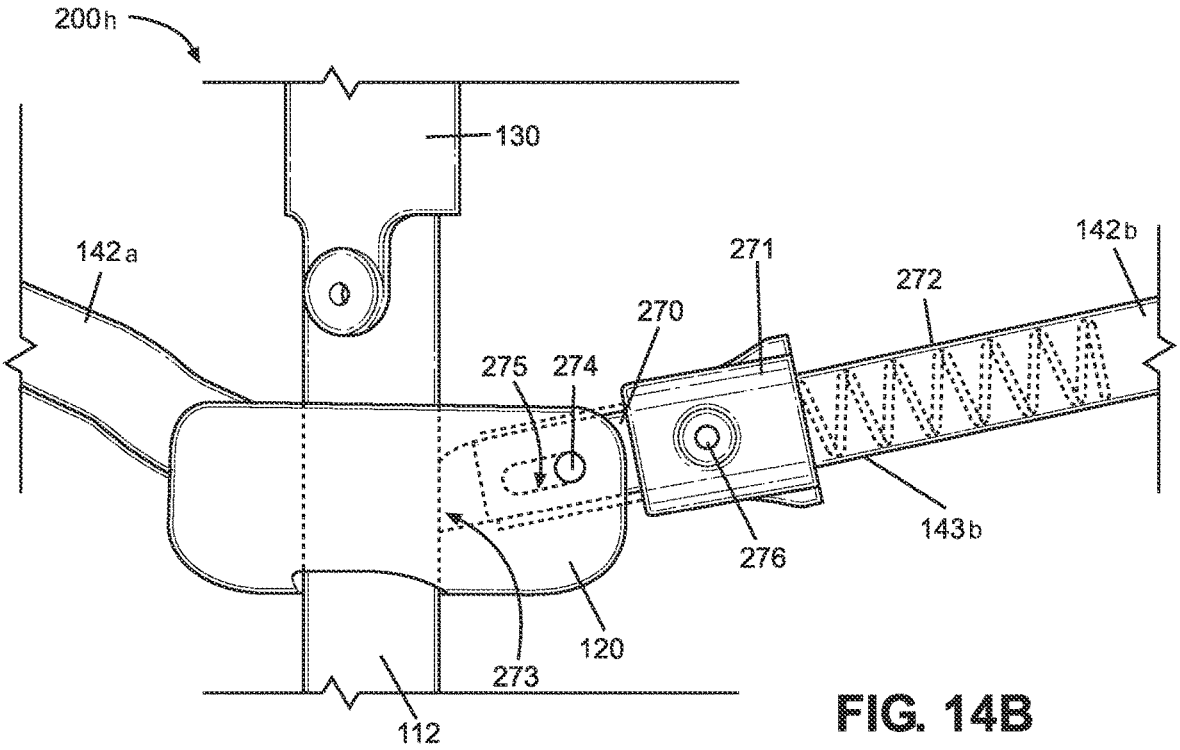
FIG. 14B shows a side view of the latch of FIG. 14A in a locked configuration.

FIG. 14B shows the latch 200*h* may include a latch 270 that is slidably coupled to the X-frame tube 142*b* and rotatably coupled to the slider 120 of one leg support assembly 110*a*. A return spring 272 may be disposed, at least in part, within an interior cavity of the X-frame tube 142*b* to impart a spring-bias force that pushes the latch 270 towards the leg tube 112. The leg tube 112 may include a latch opening 273 shaped and/or dimensioned to receive at least a portion of the latch 270 (e.g., the tip of the latch 270).

When the frame 100*a* is sufficiently unfolded such that the slider 120 is positioned along the leg tube 112 to overlap the latch opening 273, the return spring 272 may push the latch 270 into the latch opening 273, thus locking the slider 120 and, by extension, the X-frame tube 142*b* in place. Since the X-frame tube 142*b* is movably coupled to the X-frame tube 142*a*, the corners 130 and sliders 120 of other leg support assemblies 110*a*, and the other X-frame assemblies 140*a* (via the other leg support assemblies 110*a*) in the frame 100*a*, the constraints applied to the slider 120 and the X-frame tube 142*b* by the latch 200*h* may maintain the frame 100*a* in the unfolded configuration.

FIG. 14B further shows the latch 200*h* may include a collar 271 coupled to the latch 270 to provide an actuator for the caregiver to move when unlocking the latch 200*h*. In some implementations, the latch 270 may be directly coupled to the collar 271 using, for example, a fastener inserted through an opening 276 on the collar and an opening (not shown) on the latch 270. The collar 271, in turn, may be slidably coupled to the second end 143*b* of the X-frame tube 142*b*. For example, the collar 271 may include a recessed opening (not shown) shaped to receive the second end 143*b* with sufficient depth to enable the collar 271 and, by extension, the latch 270 to slide along the X-frame tube 142*b*. To compensate for the respective lengths of the latch 270 and the collar 271, the X-frame tube 142*b* supporting the latch 270 and the collar 271 may be shorter in length compared to other X-frame tubes 142*b* in other X-frame assemblies 140*a*.

The latch 270 may be rotatably coupled directly to the slider 120 via a pin 274 inserted through the opening on the slider 120 (previously used to couple to the X-frame tube 142*b* in other X-frame assemblies 140*a*) and an opening 275 formed along the latch 270. In some implementations, the opening 275 may be a slot that is shaped and/or dimensioned to allow the latch 270 to slidably move relative to the slider 120 to facilitate insertion of the latch 270 into the latch opening 273.

In some implementations, the latch 270 may instead be disposed within the interior cavity of the X-frame tube 142*b* such that the overall length of the X-frame tube 142*b* remains the same as other X-frame tubes 142*b* in other X-frame assemblies 140*a*. The second end 143*b* of the X-frame tube 142*b*, however, may have an opening through which the latch 270 may pass through when engaging and/or disengaging the latch opening 273 on the leg tube 112. The collar 271 may be disposed outside the X-frame tube 142*b* and configured to slide together with the latch 270 along the length of the X-frame tube 142*b*. As before, the latch 270 may be coupled to the collar 271 via a fastener inserted through the opening 276 on the collar 271 and another opening (not shown) on the latch 270. The fastener may pass through the X-frame tube 142*b* via a slotted opening (not shown) that is shaped and/or dimensioned to be similar to the opening 275 on the latch 270.

The latch 270 and the X-frame tube 142*b* may be rotatably coupled to the slider 120. For example, the pin 274 may pass through the openings on the slider 120, the opening 275 on the latch 270, and the opening 147 on the X-frame tube 142*b*. The latch 270 may still have a slotted opening 275 to allow the latch 270 to slidably move relative to the slider 120 to engage and/or disengage the latch opening 273.

Figure 14C:
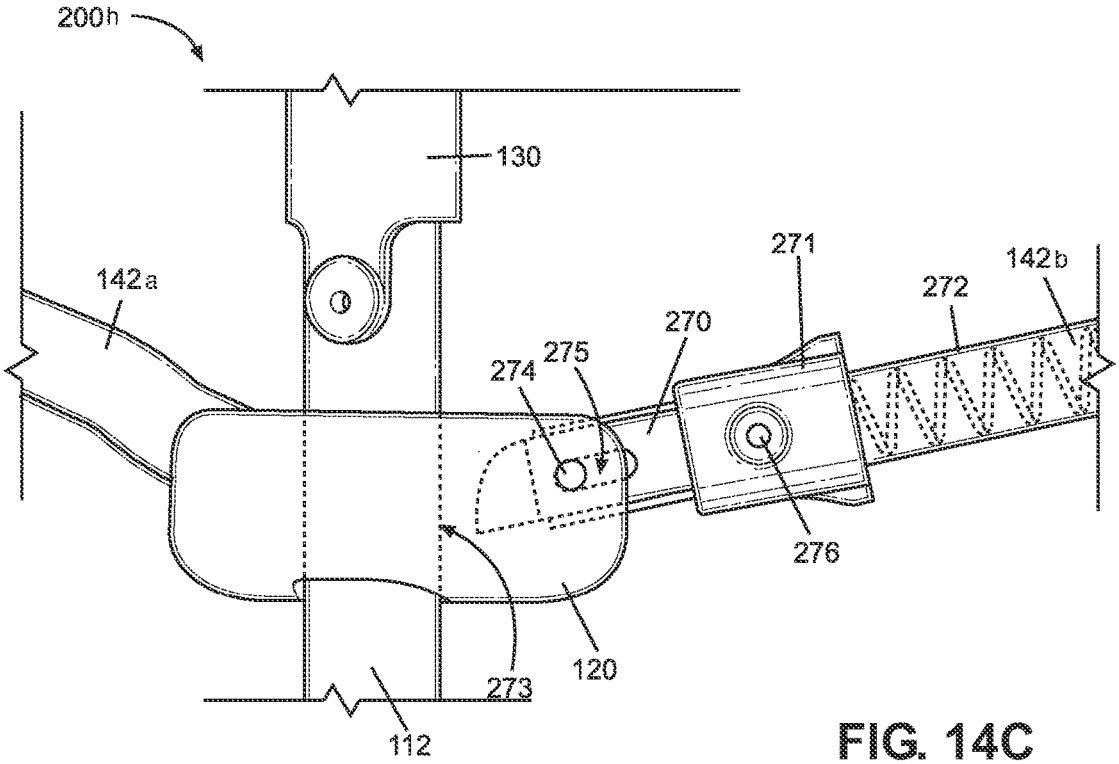
FIG. 14C shows a side view of the latch of FIG. 14B in an unlocked configuration.
Figure 14D:
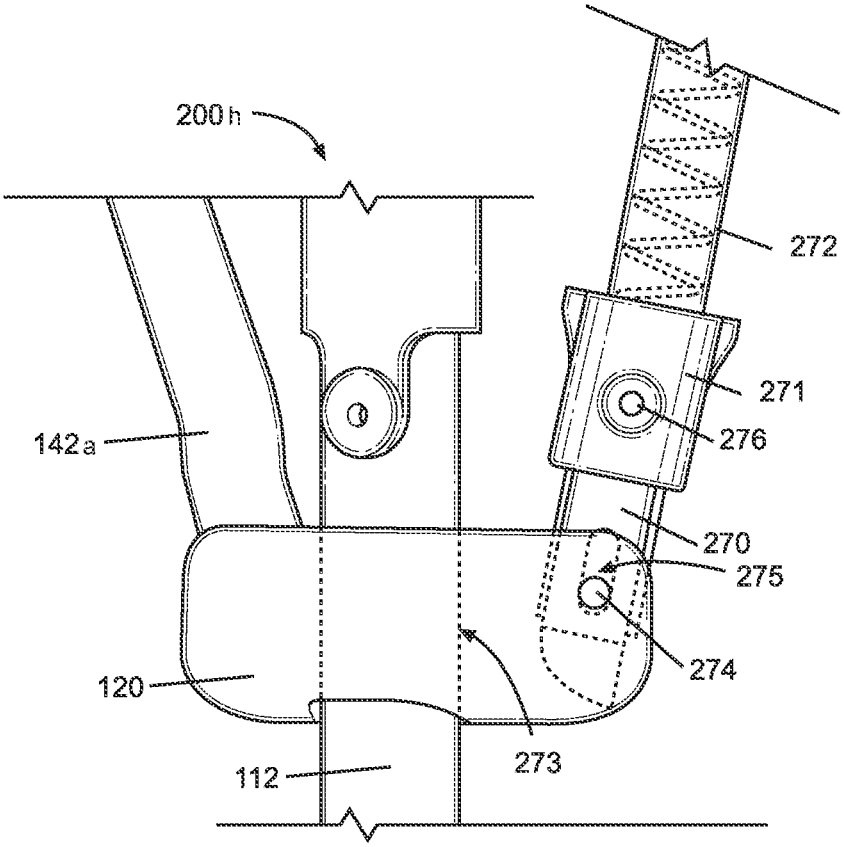
FIG. 14D shows a side view of the latch of FIG. 14C after the playard is folded.

To unlock the latch 200*h*, the caregiver may move the collar 271 along the X-frame tube 142*b* to release the latch 270 from the latch opening 273 as shown in FIG. 14C. This causes the return spring 272 to be compressed, thus generating and/or increasing a spring-bias force applied to the latch 270. While holding the collar 271, the slider 120 may then move downwards along the leg tube 112, thus folding the X-frame assembly 140*a*. Once the latch 270 is no longer aligned to the latch opening 273, the caregiver may release the collar 271 and continue folding the frame 100*a*. The spring-bias force applied to the latch 270 may cause the latch 270 to press against the exterior surfaces of the leg tube 112 as the slider 120 is moved towards the foot 114 and/or the surfaces of the slider 120 once the X-frame tube 142*b* is sufficiently rotated as shown in FIG. 14D. In some implementations, the end of the latch 270 may be shaped (e.g., curved or contoured) to allow the X-frame tube 142*b* to rotate smoothly when pressing against the leg tube 112 and/or the slider 120 as the frame 100*a* is being folded and/or unfolded.

FIGS. 15A-15D show yet another exemplary latch 200*i* mounted onto the frame 100*a* of the playard 1000*a*. Specifically, the latch 200*i* may be mounted to one end of the X-frame tube 142*b* (or 142*a*) of one X-frame assembly 140*a* to engage the slider 120 of one leg support assembly 110*a*. FIG. 15A once again shows the frame 100*a* may only include a single latch 200*i* to support the frame 100*a* in the unfolded configuration. The latch 200*i* may be shaped and/or dimensioned such that the latch 200*i* fits within the recessed opening of the extended section 126 (or 124) of the slider 120 together with the second end 143*b* of the X-frame tube 142*b*. In this manner, the latch 200*i* may not protrude outwards from the frame 100*a* even when the frame 100*a* is folded (see FIG. 15B), thus preserving the compact shape of the folded frame 100*a*.

Figure 15A:
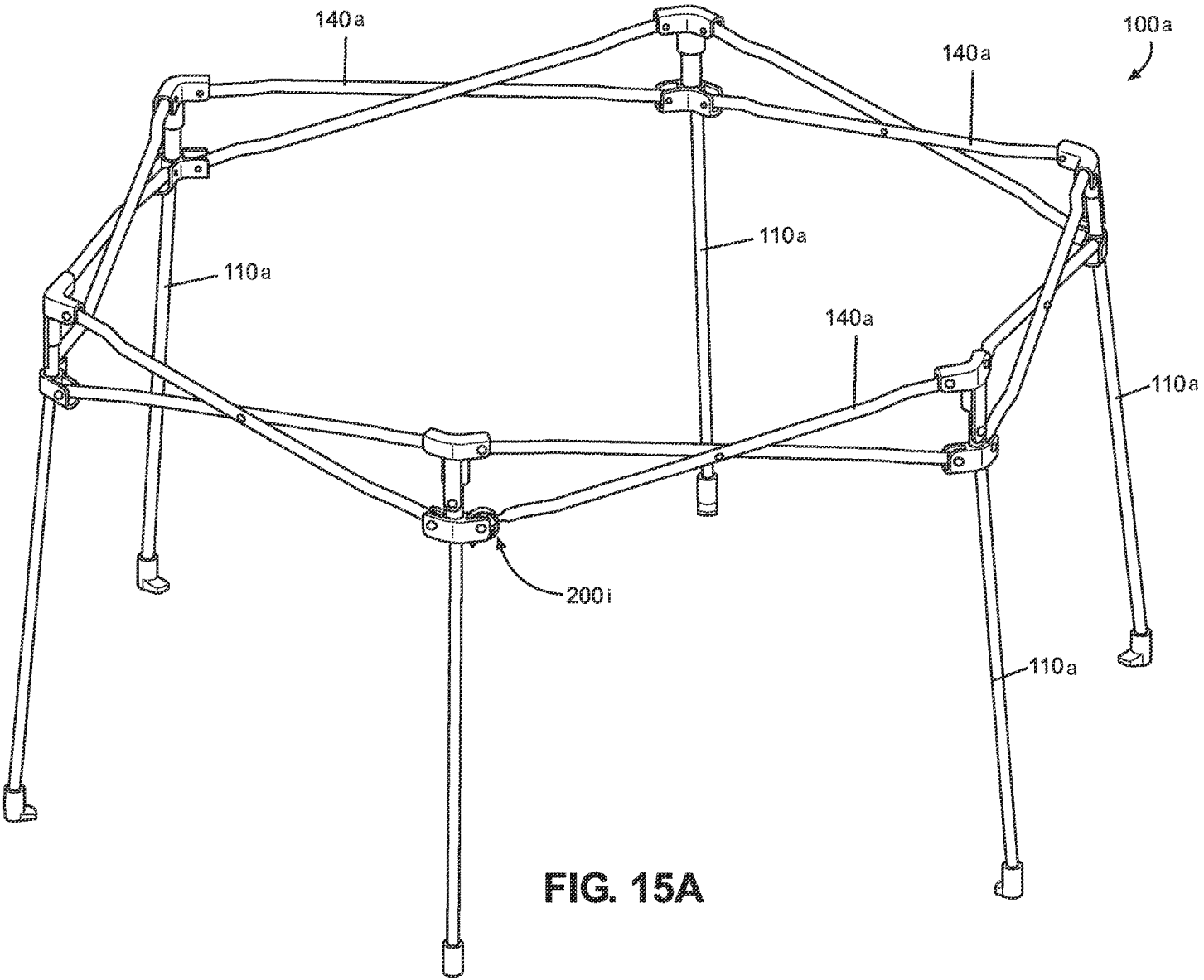
FIG. 15A shows a top perspective view of the playard of FIG. 2A with a latch that includes a snap-fit connector disposed at one end of a X-frame tube. The playard is in an unfolded configuration.
Figure 15C:
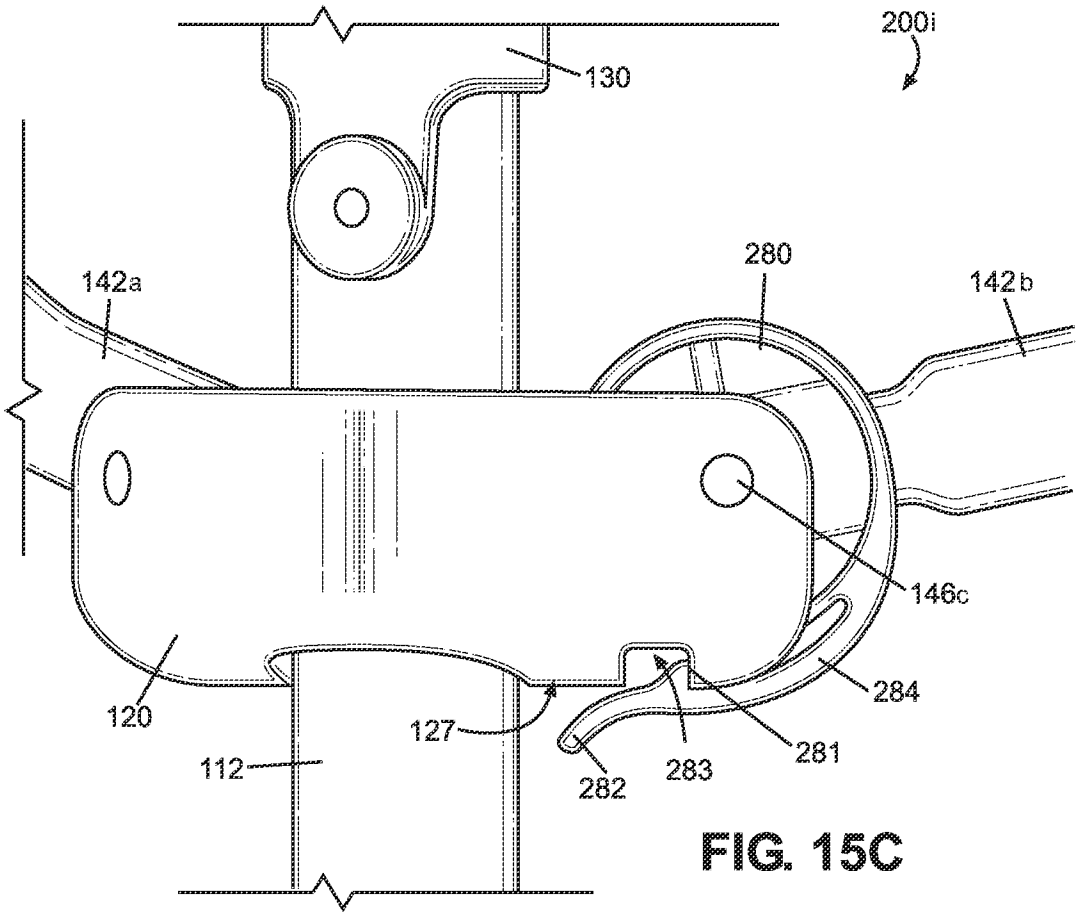
FIG. 15C shows a side view of the latch of FIG. 15A in a locked configuration.
Figure 15B:
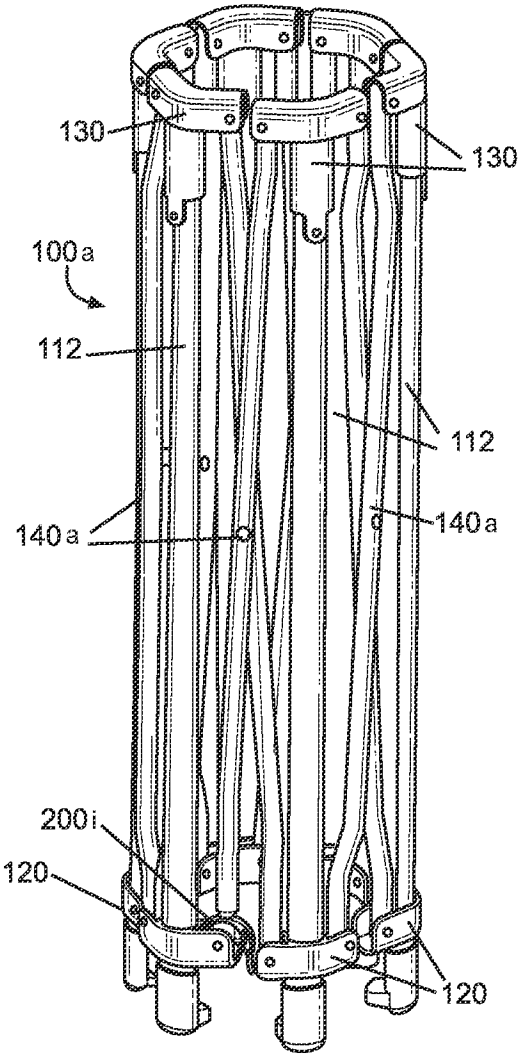
FIG. 15B shows a perspective view of the playard of FIG. 15A in a folded configuration.

FIG. 15C shows the latch 200*i* may include a latch base 280 coupled to the second end 143*b* of the X-frame tube 142*b* and rotatably coupled to the slider 120. In some implementations, a single fastener may couple the slider 120, the latch base 280, and the X-frame tube 142*b* together. As shown, the latch base 280 may include a latch member 284 that extends from the latch base 280. The latch member 284 may be a mechanically compliant component that is deformable and may have sufficient mechanical rigidity to generate a restoring force when deformed.

Figure 15D:
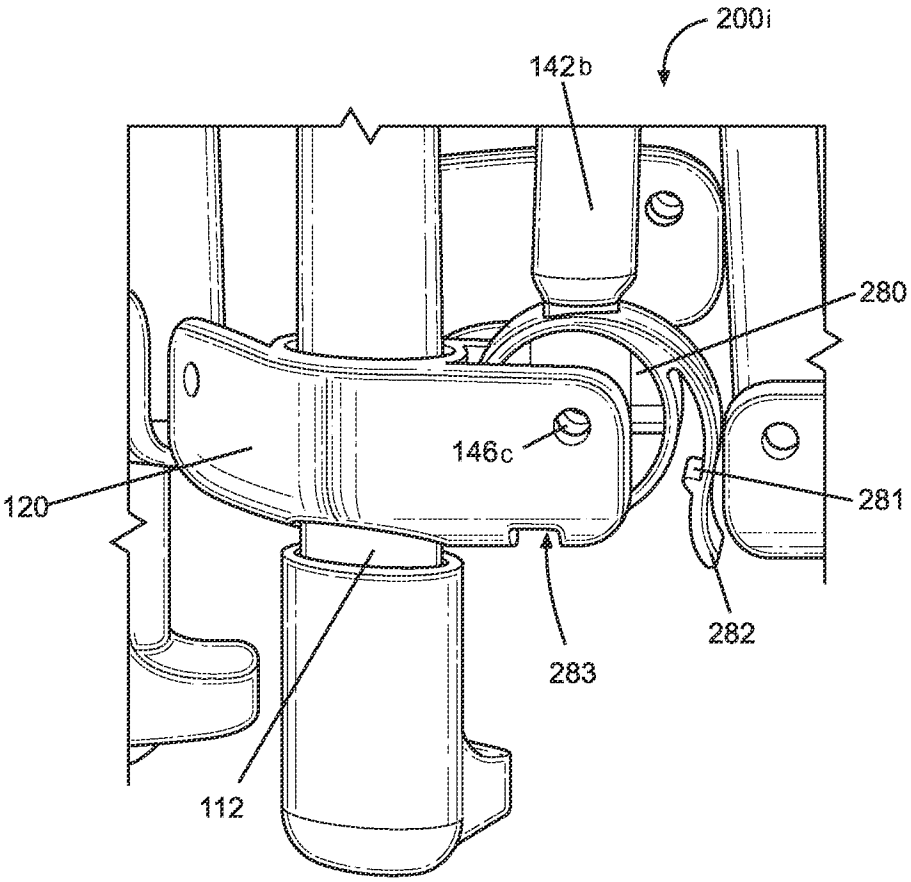
FIG. 15D shows a side view of the latch of FIG. 15A in an unlocked configuration and the playard in a folded configuration.

In some implementations, the latch base 280 may have a cylindrical shape and the latch member 284 may extend from the periphery of the latch base 280. The latch member 284 may have a curved and/or contoured shape as shown in FIGS. 15C and 15D. The latch member 284 may include an integrally formed latch catch 281 that is shaped to engage a latch opening 283 formed on a bottom surface 127 of the slider 120. The latch member 284 may further include a tab 282 disposed at the end of the latch member 284, which may be pulled to bend the latch member 284, thus releasing the latch catch 281 from the latch opening 283.

FIG. 15D shows the latch member 284 may be disposed between the sliders 120 from adjacent leg support assemblies 110*a* when the frame 100*a* is unfolded. When unfolding the frame 100*a*, the latch body 280 together with the latch member 284 may rotate with the X-frame tube 142*b* about the pin joint 146*c* relative to the slider 120 as the slider 120 moves up along the leg tube 112 towards the corner 130. As the latch body 280 rotates, the latch member 284 and, in particular, the latch catch 281, may initially contact the exterior portions of the slider 120, thus bending and/or deflecting the latch member 284. In some implementations, the latch catch 281 may include a lead-in feature to facilitate the deflection of the latch member 284 as the frame 100*a* is unfolded.

Once the slider 120 is positioned sufficiently close to the corner 130 and/or the X-frame tube 142*b* is sufficiently rotated such that the latch catch 281 aligns with the latch opening 283, the restoring force generated by the deflection of the latch member 284 may insert the latch catch 281 into the latch opening 283. The latch catch 281 and the latch opening 283 may thus prevent further rotation of the X-frame tube 142*b* relative to the slider 120 and, hence, further movement of the slider 120 along the leg tube 112 to hold the frame 100*a* in the unfolded configuration.

To unlock the latch 200*i*, the caregiver may pull on the tab 282 with sufficient force to release the latch catch 281 from the latch opening 283. While holding the tab 282, the slider 120 may then move downwards along the leg tube 112 towards the foot 114, which causes the X-frame tube 142*b* and the latch body 280 to rotate relative to the slider 120. Once the latch catch 281 is no longer aligned with the latch opening 283, the caregiver may release the tab 282 and proceed with folding the frame 100*a*.

As described above, the frame 100*a* may generally include at least one latch to maintain the frame 100*a* and, by extension, the playard 1000*a* in the unfolded configuration. In some implementations, the frame 100*a* may include a single latch (e.g., one of the latches 200*a*-200*i*) to lock the unfolded frame 100*a*, which may simplify the frame 100*a* by reducing the number of parts for manufacture. However, in other implementations, the frame 100*a* may include multiple latching mechanisms to ensure the various components of the frame 100*a* are kept evenly unfolded. Thus, it should be appreciated that in other implementations, the frame 100*a* may include combinations of one or more of the latches 200*a*-200*i* described above.

Figure 16A:
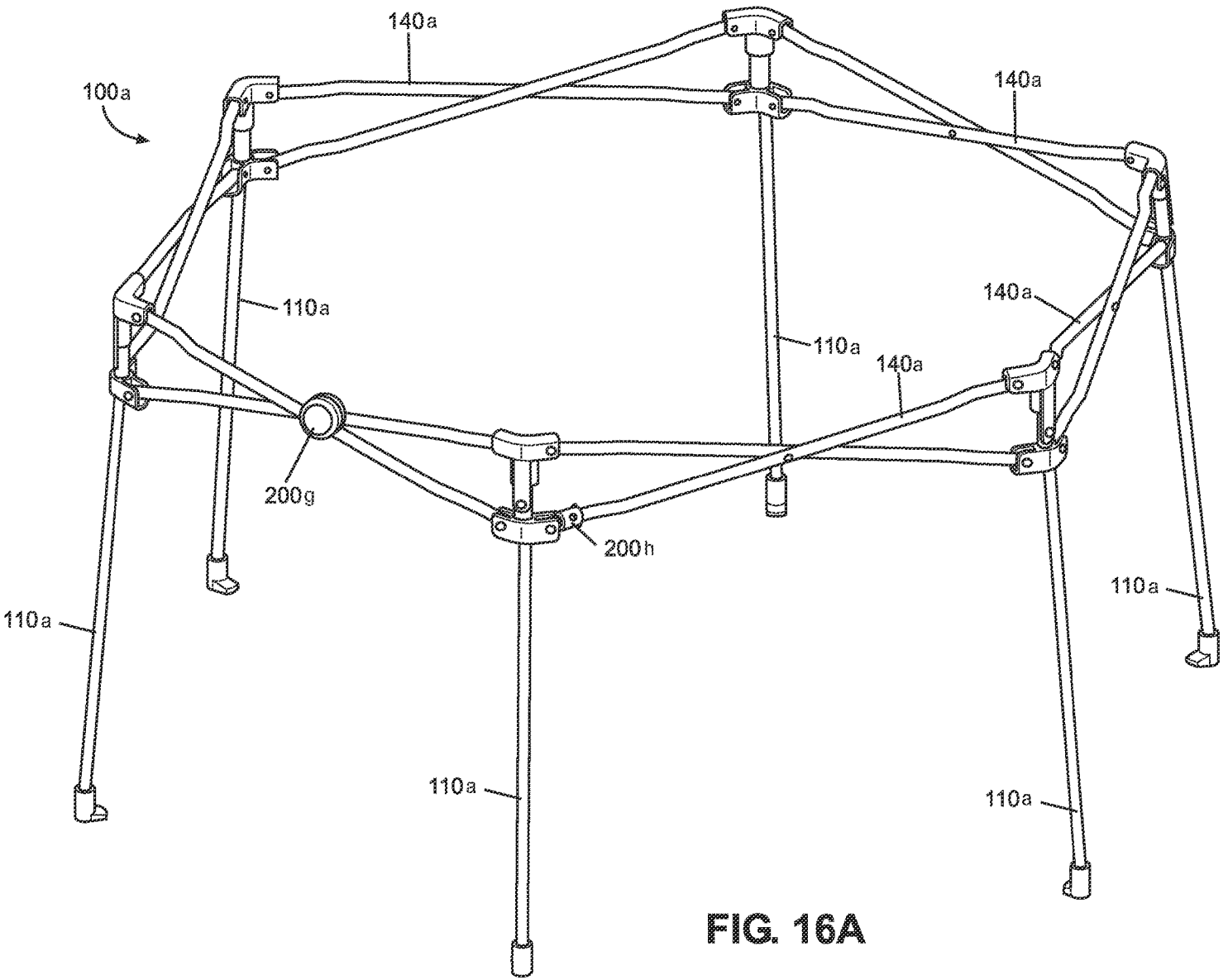
FIG. 16A shows a top perspective view of the playard of FIG. 2A with the latches of FIGS. 13A and 14A installed. The playard is in an unfolded configuration.
Figure 16B:
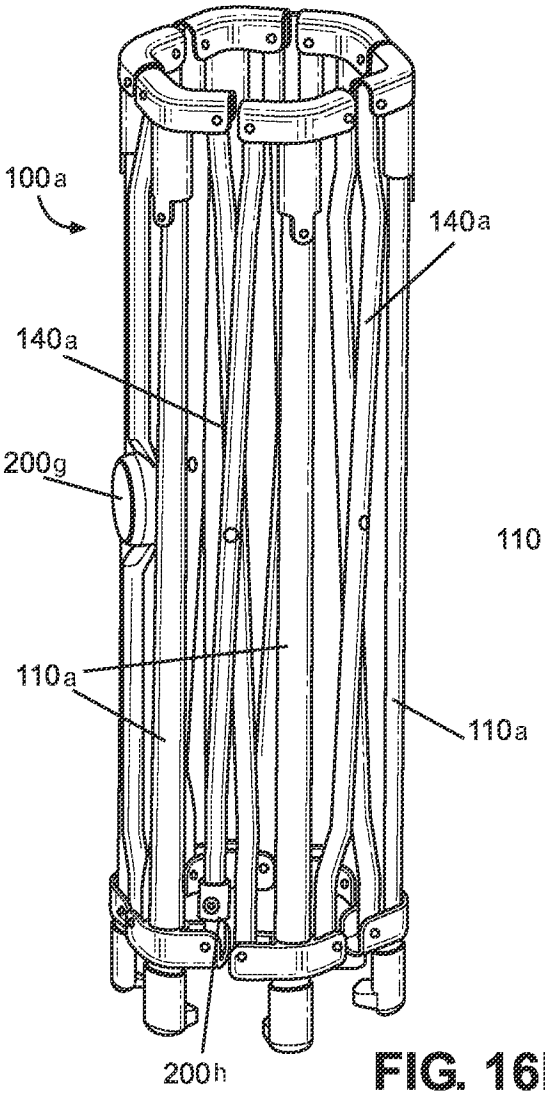
FIG. 16B shows a perspective view of the playard of FIG. 16A in a folded configuration.

FIGS. 16A and 16B show one example of a frame 100*a* that includes the latch 200*g* coupled to one X-frame assembly 140*a* and the latch 200*h* coupled to the X-frame tube of another X-frame assembly 140*a* and the slider 120 of one leg support assembly 110*a*. FIG. 16A shows the latches 200*g* and 200*i* being used to maintain the frame 100*a* in the unfolded configuration. FIG. 16B shows the latches 200*g* and 200*i* do not appreciably extend outwards from the frame 100*a* when the frame 100*a* is in the folded configuration.

As described above, the foldable playard may generally include a frame that outlines an interior space. The frame may include multiple leg support assemblies and X-frame assemblies that together define and/or align with the outer boundaries of the interior space. For example, the playard 1000*a* includes a frame 100*a* defining an interior space 102 with a horizontal cross-section shaped as a hexagon. It should be appreciated that the various implementations of the foldable playard described herein may define interior spaces having other geometries based, in part, on the number of leg support assemblies and/or the X-frame assemblies used for construction.

For example, the playard may outline an interior space with a square horizontal cross-section. The frame of the playard may include four identical leg support assemblies, which may be connected together using four identical X-frame assemblies where each X-frame assembly forms a single (or double) X-frame structure. As before, each X-frame assembly may couple adjacent leg support assemblies together.

In another example, FIGS. 17A-17D show an exemplary playard 1000*b* with a frame 100*b* that outlines an interior space 102 with a horizontal cross-section shaped as a rectangle. The frame 100*b* may include multiple leg support assemblies 110*b* defining and/or aligning with the respective side edges 104 of the interior space 102 when the frame 100*b* is unfolded to support the playard 1000*b* on the ground 90 (see, for example, FIG. 18A). The frame 100*b* may include a pair of X-frame assemblies 140*a* disposed on the smaller side faces 106 of the interior space 102 to couple together adjacent leg support assemblies 110*b* located on the shorter sides of the rectangular horizontal cross-section of the interior space 102. The frame 100*b* may further include a pair of X-frame assemblies 140*b* disposed on the larger side faces 106 of the interior space 102 to couple together adjacent leg support assemblies 110*b* located on the longer sides of the rectangular horizontal cross-section of the interior space 102. Thus, each leg support assembly 110*b* may couple to one X-frame assembly 140*a* and one X-frame assembly 140*b*.

To form the rectangular-shaped interior space 102, each X-frame assembly 140*a* may form a single X-frame structure, as described above, and each X-frame assembly 140*b* may form a double X-frame structure (i.e., two pairs of crossing X-frame tubes where each pair of X-frame tubes couples to one leg support assembly). The combination of the single and double X-frame structures allows the frame 100*b* to define an interior space 102 where the sides of the horizontal cross-section have different dimensions while enabling the X-frame assemblies 140*a* and 140*b* to couple to the same components of the leg support assembly 110*b* (e.g., the same slider 120 and corner 130) so that the leg support assemblies 110*b*, the X-frame assemblies 140*a*, and the X-frame assemblies 140*b* may fold and/or unfold together (see FIG. 17C). Furthermore, the double X-frame structure of the X-frame assembly 140*b* may also enable the leg support assemblies 110*b* and, in particular, the length of the leg tube 112 to be shorter compared to a single X-frame structure that spans the same length as the X-frame assembly 140*b* when deployed. Thus, the frame 100*b* may be more compact, particularly, when folded.

Similar to the frame 100*a*, the frame 100*b* may be unfolded with the feet 114 of the leg support assemblies 110*b* remaining in contact with the ground 90. Additionally, the leg tubes 112 may remain vertically upright or nearly vertically upright (e.g., leg tubes 112 may intentionally be tilted when the frame 100*b* is unfolded to improve stability) while the frame 100*b* is being folded and/or unfolded to make the process of setting up and/or tearing down the playard 1000*b* easier for the caregiver (see FIG. 17D).

Figure 18A:
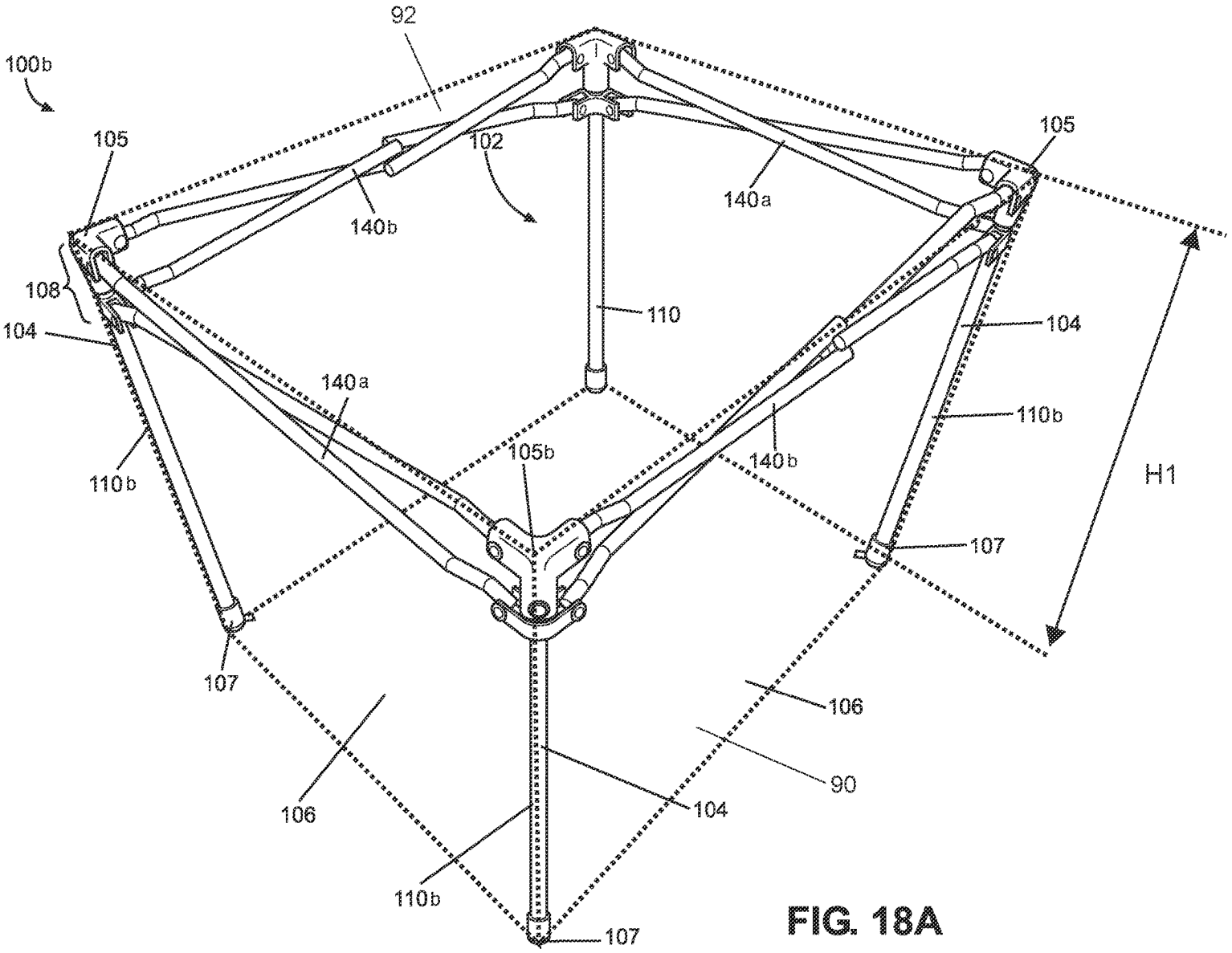
FIG. 18A shows a top perspective view of the playard of FIG. 17A with the soft goods removed.

Additionally, the X-frame assemblies 140*a* and 140*b* in the frame 100*b* may be disposed in the top portion 108 of the frame 100*b* to form a top perimeter structure along the interior space 102 (see FIG. 18A). As before, this may enable the respective X-frame tubes of the X-frame assemblies 140*a* and 140*b* to function as top rails to provide mechanical stability and rigidity to the frame 100*b*. In some implementations, the frame 100*b* may not include a separate compliant or rigid top rail and/or a bottom support structure.

Figure 22:
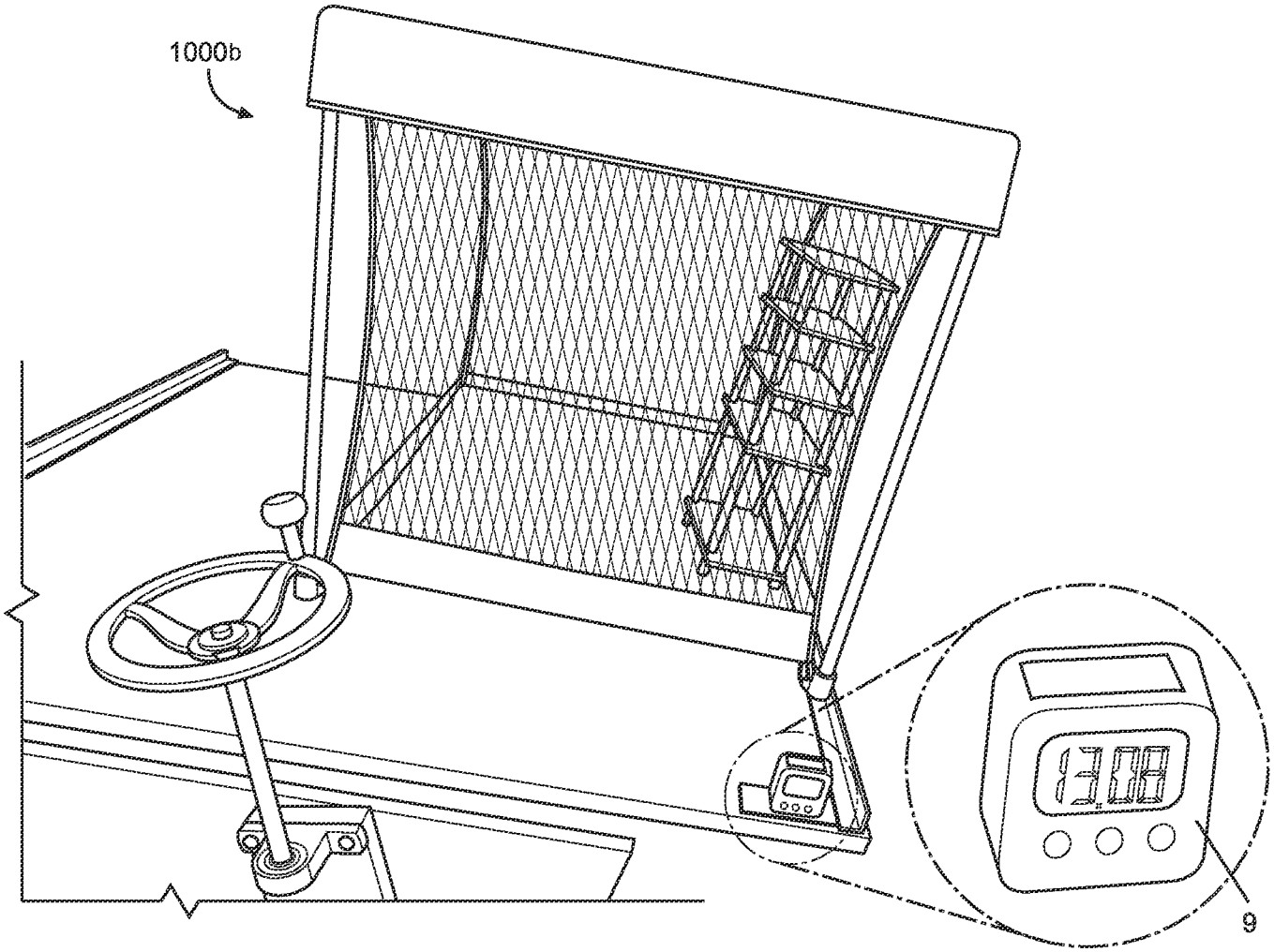
FIG. 22 shows a stability test being performed on the playard of FIG. 17A.

In some implementations, the frame 100*b* with only X-frame assemblies 140*a* and 140*b* coupling the leg support assemblies 110*b* together may provide sufficient mechanical rigidity, stability, and/or strength to satisfy various consumer safety standards (e.g., ASTM F406-19). For example, FIG. 22 shows the playard 1000*b* subjected to a stability test. Similar to the playard 1000*a*, the playard 1000*b* was demonstrated to remain sufficiently stable (i.e., at least three feet 114 remained in contact with the underlying platform) when the playard 1000*b* was tilted more than 10 degrees.

Figure 17B:
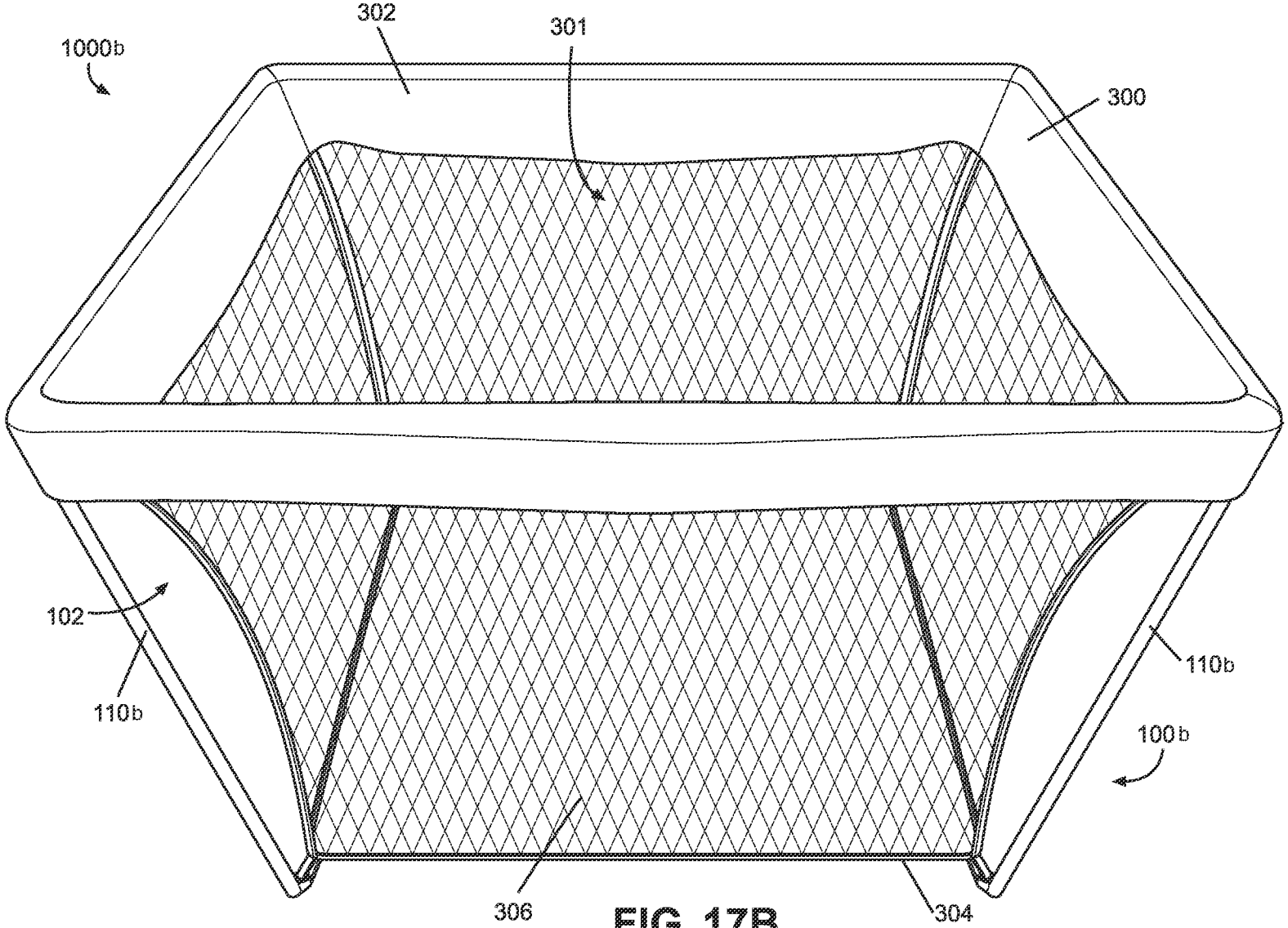
FIG. 17B shows another perspective view of the playard of FIG. 17A.
Figure 17D:
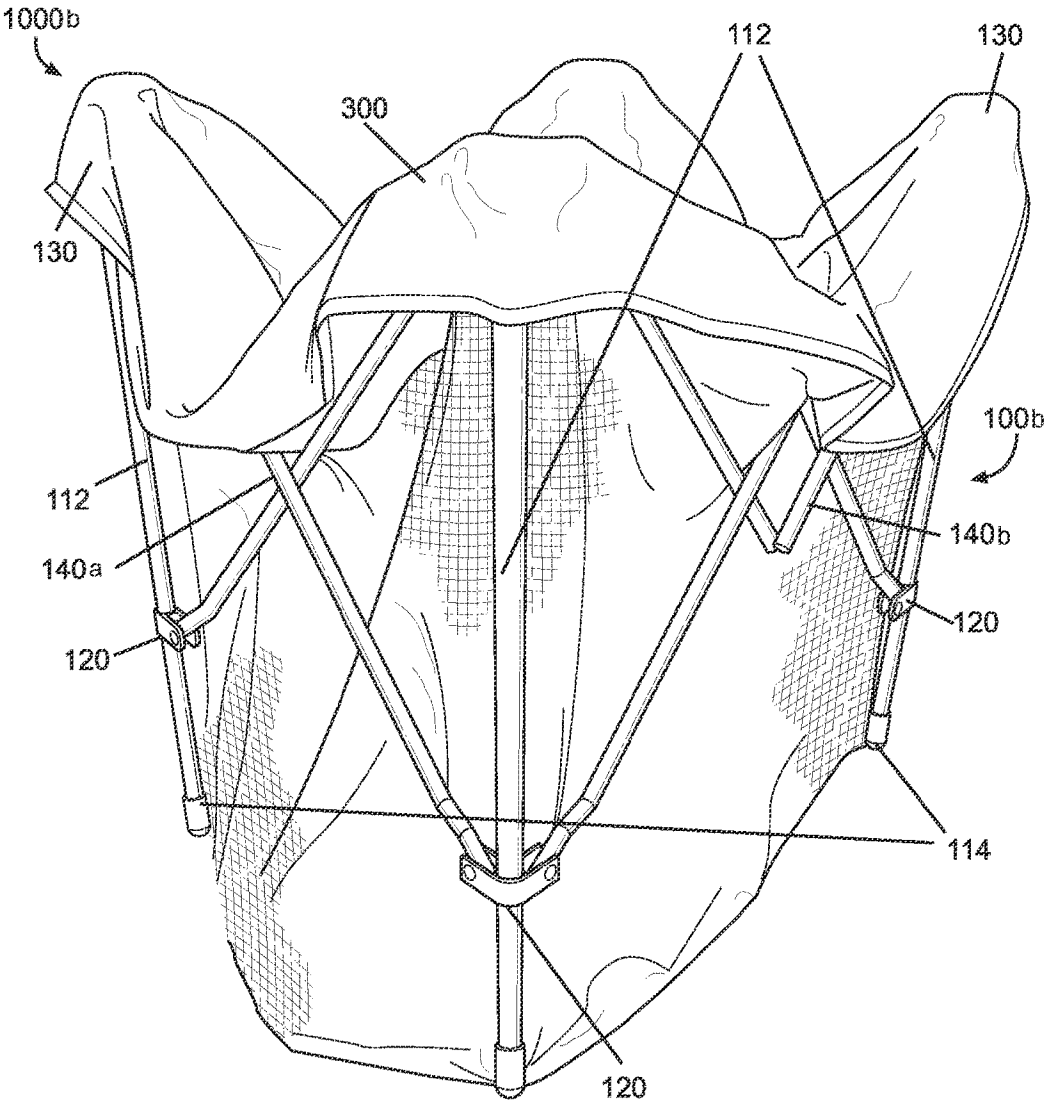
FIG. 17D shows a top perspective view of the playard of FIG. 17A in a partially unfolded configuration.
Figure 17C:
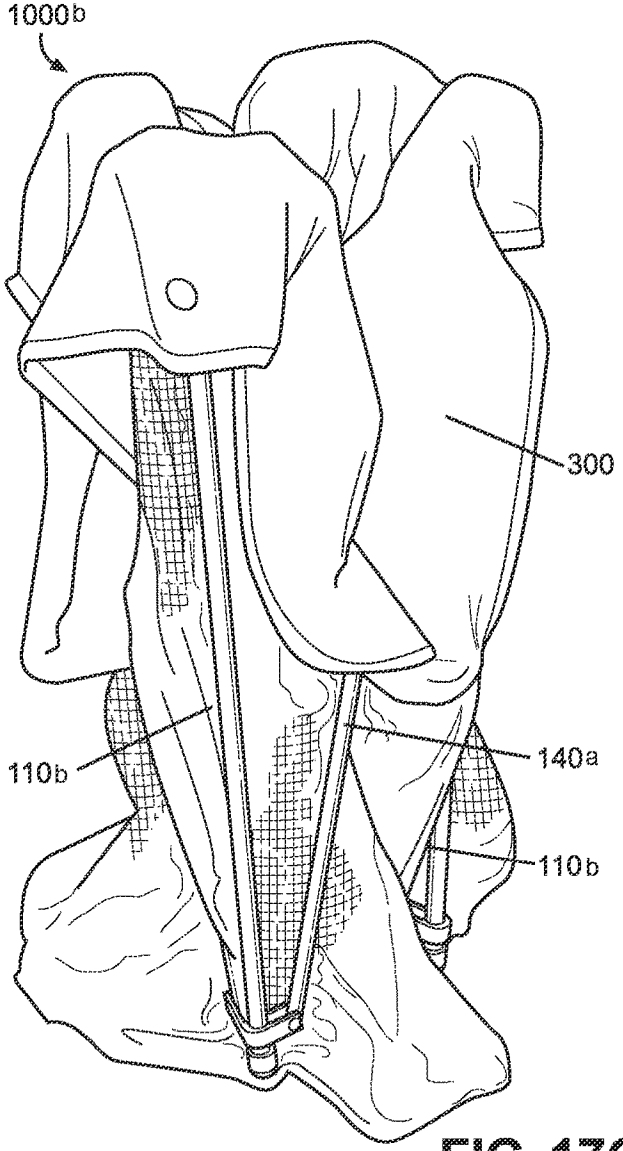
FIG. 17C shows a top perspective view of the playard of FIG. 17A in a folded configuration.

FIGS. 17A and 17B further show the playard 1000*b* may include soft goods 300 coupled to the frame 100*b* and forming a partially enclosed space 301 disposed within the interior space 102 to contain the child 50. As before, the soft goods 300 may be readily folded together with the frame 100*b* as shown in FIG. 17C. The soft goods 300 may include a floor portion 304 that rests on the ground 90 supporting the playard 1000*b* and side portions 306 that together define and surround the partially enclosed space 301. The floor portion 304 may include a removable mat to provide padding on the ground 90. The side portions 306 may be formed from transparent and/or see-through materials to allow the caregiver to monitor their child 50 when the child 50 is placed into the partially enclosed space 301. The soft goods 300 may include tethers and/or straps to attach the floor portion 304 to the bottom portions of the leg support assemblies 110*b*.

The soft goods 300 may further include a top portion 302, formed from an opaque textile material, to attach the soft goods 300 to the top portions of the leg support assemblies 110*b* as well as cover the top portion of the frame 100*b*. In particular, the soft goods 300 in the playard 1000*b* may fully cover one or more of the X-frame assemblies 140*a* and 140*b*, the corners 130 of the leg support assemblies 110*b*, and/or the sliders 120 of the leg support assemblies 110*b*. In some implementations, the soft goods 300 may fully cover the X-frame assemblies 140*a* and 140*b* as well as the sliders 120 and the corners 130 of the leg support assemblies 110*b* such that only the leg tubes 112 and/or the feet 114 are observable as shown in FIGS. 17A and 17B. As before, positioning the X-frame assemblies 140*a* and 140*b* in the top portion 108 of the frame 100*b* when the frame 100*b* is unfolded may also increase the visibility of the child 50 due to the larger visually unobstructed portions of the side faces 106.

As described above, conventional playards and especially, indoor playards, typically have to compromise between ease of use, visibility of the child, and/or the appearance of the playard (see, for example, playard 10*c*). In comparison, the playard 1000*b* may simultaneously improve ease of use, visibility of the child, and the overall appearance. First, the playard 1000*b* includes X-frame assemblies 140*a* and 140*b* that allow the frame 100*b* to be folded and/or unfolded in one step. For instance, the caregiver may move one slider 120 of one leg support assembly 110*b* to fold and/or unfold the frame 100*b*. Second, the X-frame assemblies 140*a* and 140*b* are positioned in the top portion 108 of the frame 100*b* when the playard 1000*b* is deployed, which allows for greater visibility of the child in the partially enclosed space 301 through the sides of the frame 100*b*. Third, aesthetically undesirable components, such as the X-frame tubes, the sliders 120, the corners 130, may be readily hidden by the top portion 302 of the soft goods 300 to provide a cleaner, more aesthetically desirable appearance.

FIG. 18A shows the frame 100*b* without the soft goods 300 attached in the unfolded configuration. As shown, each leg support assembly 110*b* may be similar to leg support assemblies 110*a* used in the frame 100*a*. For instance, the leg support assembly 110*b* includes a leg tube 112 with a top end 113*a* and a bottom end 113*b*, a corner 130 coupled to the top end 113*a*, a foot 114 coupled to the bottom end 113*b*, and a slider 120 that is slidably coupled to the leg tube 112 and disposed between the foot 114 and the corner 130. The top end 113*a* of the leg tube 112 and/or the corner 130 may align with a top vertex 105 of the interior space 102 and generally define a top horizontal plane 92 of the frame and hence a height $H_1$ of the frame between the ground surface 90 and the top horizontal plane 92. The bottom end 113*b* of the leg tube 112 and/or the foot 114 may align with a bottom vertex 107 of the interior space 102.

Figure 18B:
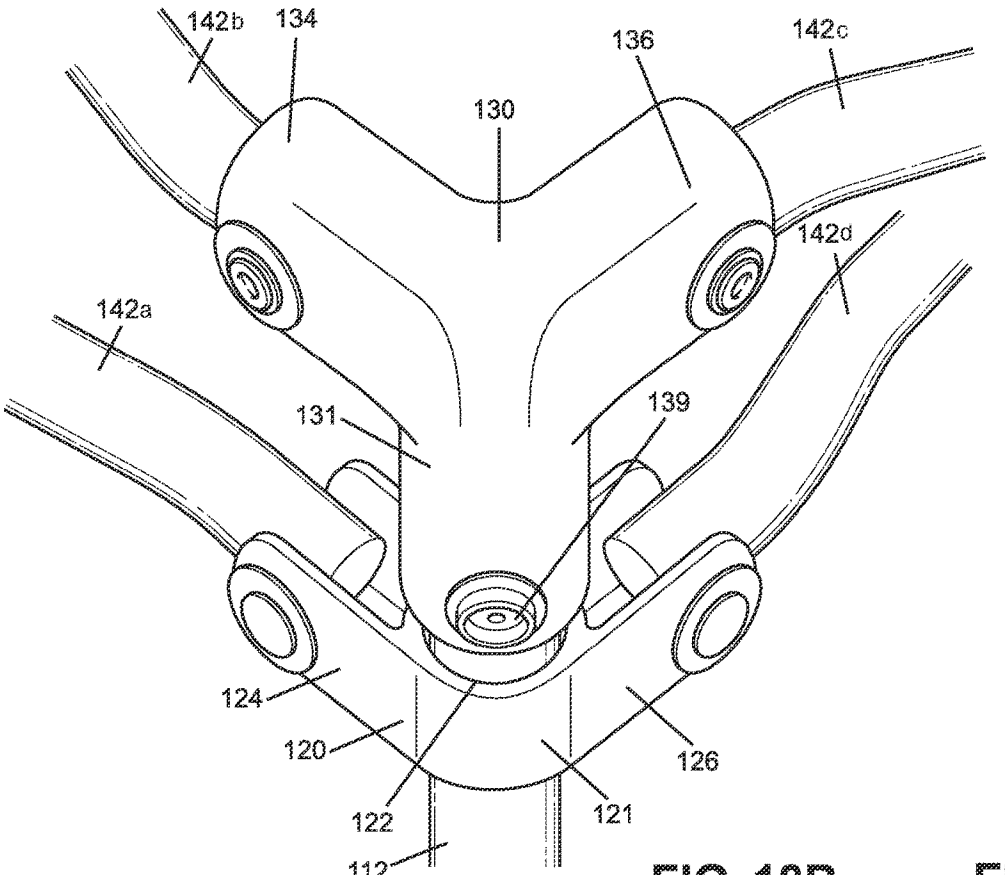
FIG. 18B shows a magnified view of a corner and a slider of a leg support assembly in the playard of FIG. 18A.

FIG. 18B further shows the leg tubes 112 may have a circular cross-sectional shape. The leg tubes 112 may also remain vertical or nearly vertical for both the folded and unfolded configurations. Thus, the interior space 102 may be shaped as right prism with rectangular base. The slider 120 may once again include a base 121 that defines a through hole opening 122 that surrounds the leg tube 112. The slider 120 may include extended portions 124 and 126 disposed on opposing sides of the base 121 to couple respective X-frame tubes (e.g., X-frame tubes 142*a* and 142*d* in FIG. 18B) of the X-frame assemblies 140*a* and 140*b* to the slider 120. The corner 130 may include a base 131 with a recessed opening (not shown) to receive the top end 113*a* of the leg tube 112. The corner 130 may further include a snap-fit connector 139 coupled to the base 131 instead of a tab 138 extending from the base 131 as in the leg support assembly 110*a*. Once again, the corner 130 may include extended portions 134 and 136 disposed on opposing sides of the base 131 to couple respective X-frame tubes (e.g., X-frame tubes 142*b* and 142*c* in FIG. 18B) of the X-frame assemblies 140*a* and 140*b* to the corner 130.

Figure 19A:
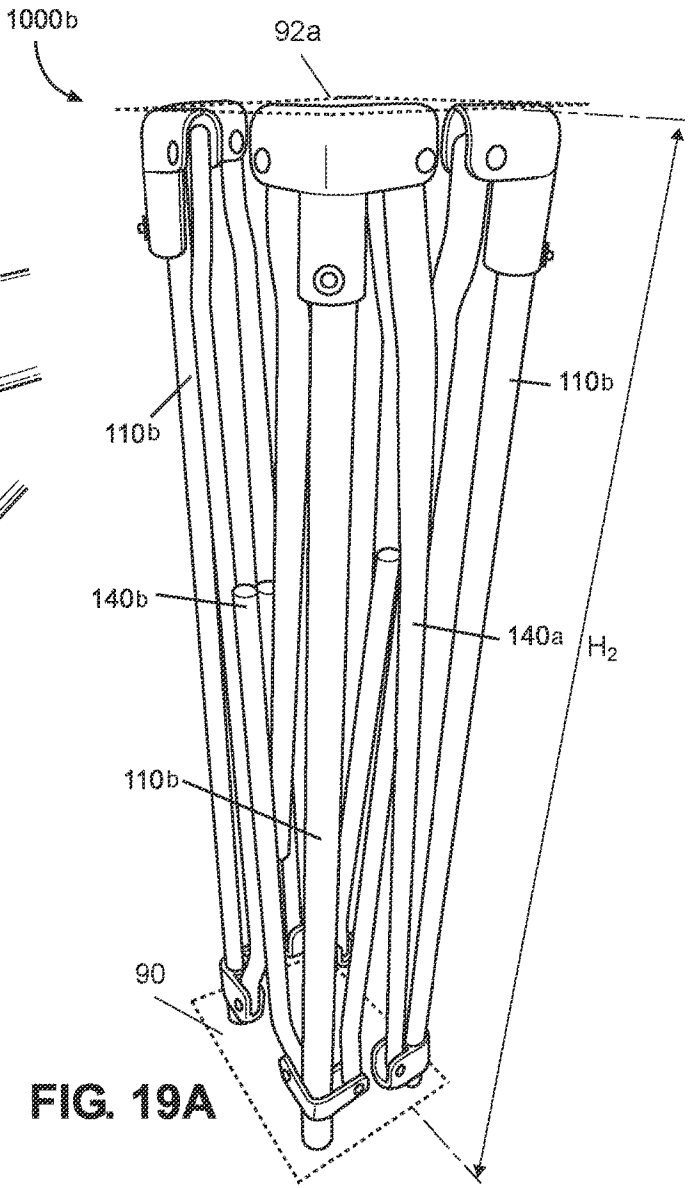
FIG. 19A shows a top perspective view of the playard of FIG. 17C with the soft goods removed.
Figure 19B:
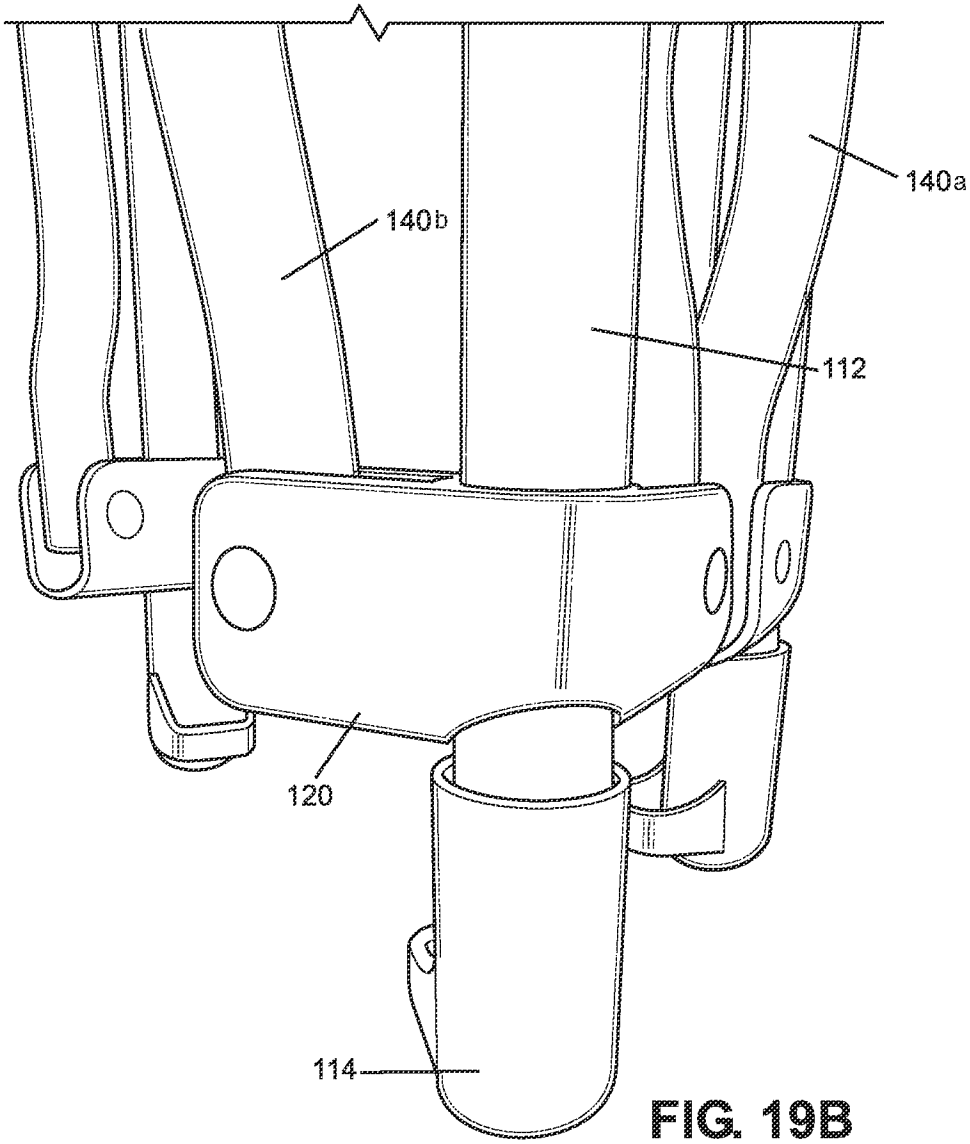
FIG. 19B shows a magnified view of the slider and a foot in the leg support assembly of FIG. 19A.

FIG. 19A shows the frame 100*b* in the folded configuration. FIG. 19B shows the slider 120 may be disposed proximate to the foot 114 when the frame 100*b* is folded. As described above and shown in FIGS. 18B and 19B, the X-frame assemblies 140*a* and 140*b* may couple to the same corner 130 and slider 120 of one leg support assembly 110*b*. Furthermore, the pin joints that connect the respective X-frame tubes of the X-frame assemblies 140*a* and 140*b* to the slider 120 or the corner 130 may be located along the same horizontal plane. Thus, the respective ends of the X-frame tubes of the X-frame assemblies 140*a* and 140*b* that couple to the leg support assembly 110*b* may travel the same distance along the leg tube 112 to fold and/or unfold both the X-frame assemblies 140*a* and 140*b*. This enables the slider 120 and the corner 130 to be thinner in size and, in turn, reduces the overall length, L, of the leg tube 112 such that the leg tube 112 only provides sufficient overlap to couple the foot 114 and the corner 130 to the leg tube 112 and sufficient clearance for the slider 120 to move a sufficient distance to fold and/or unfold the X-frame assemblies 140*a* and 140*b*. As shown in FIGS. 18B and 19B, the slider 120 may be disposed proximate to the corner 130 when the frame 100*b* is in the unfolded configuration and proximate to the foot 114 when the frame 100*b* is in the folded configuration. FIG. 19A also shows that, in the folded configuration, the frame has a height $H_2$ between the ground surface 90 and a top horizontal plane 92A defined by the frame. As noted above in connection with FIGS. 2B and 2E, the height of the frame 100*b* may remain substantially constant or constant between the folded and unfolded configurations of the frame. In other words, the heights $H_1$ and $H_2$ may be equal or substantially similar and the planes 92 and 92A are coplanar or substantially coplanar. In some implementations, however, the height of the frame 100*b* may vary (e.g., the height $H_2$ may be somewhat greater than the height $H_1$ and the plane 92A in the folded configuration may be disposed somewhat above the plane 92 in the unfolded configuration).

Figure 20A:
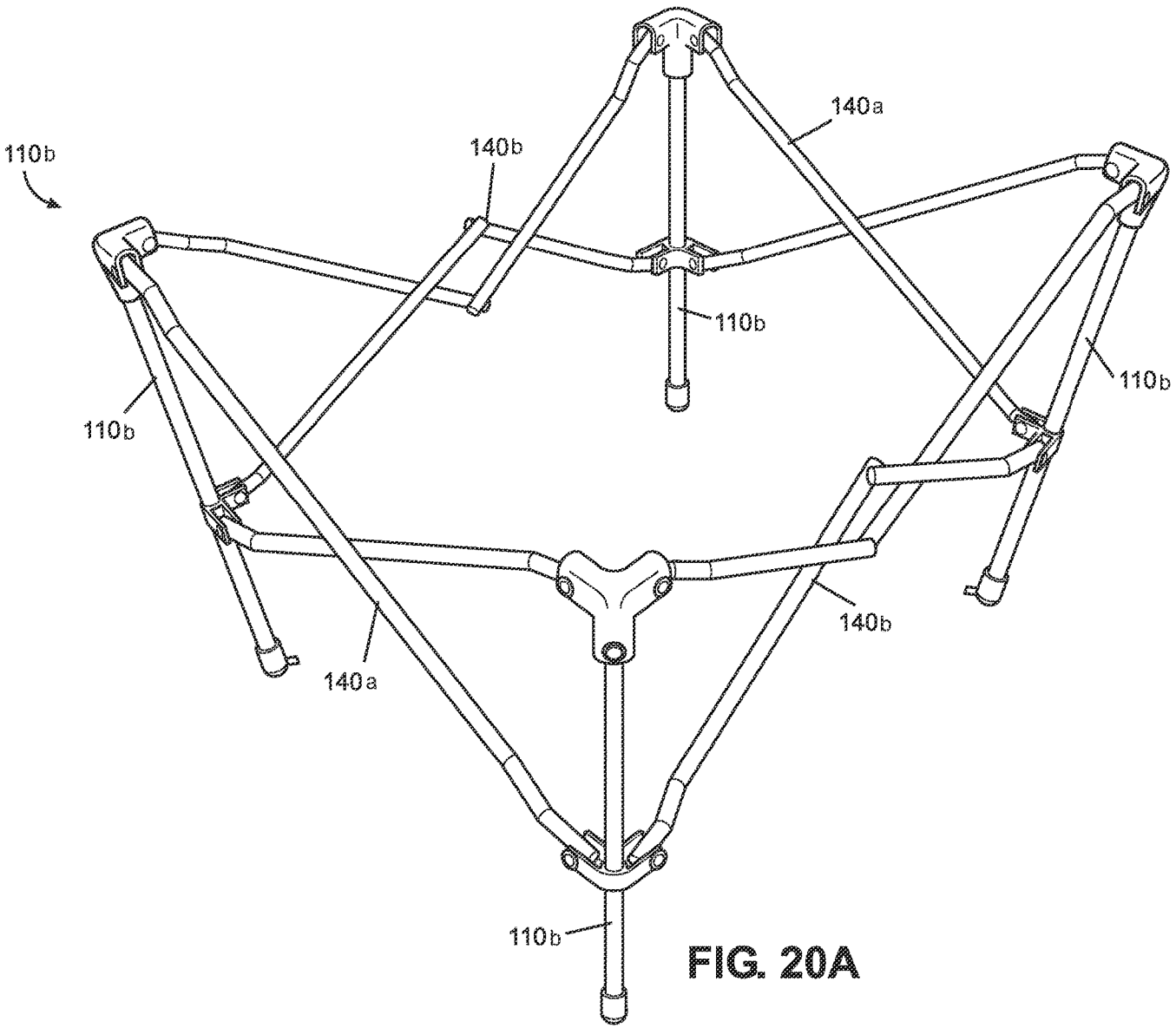
FIG. 20A shows a top perspective view of the playard of FIG. 17D with the soft goods removed.
Figure 20B:
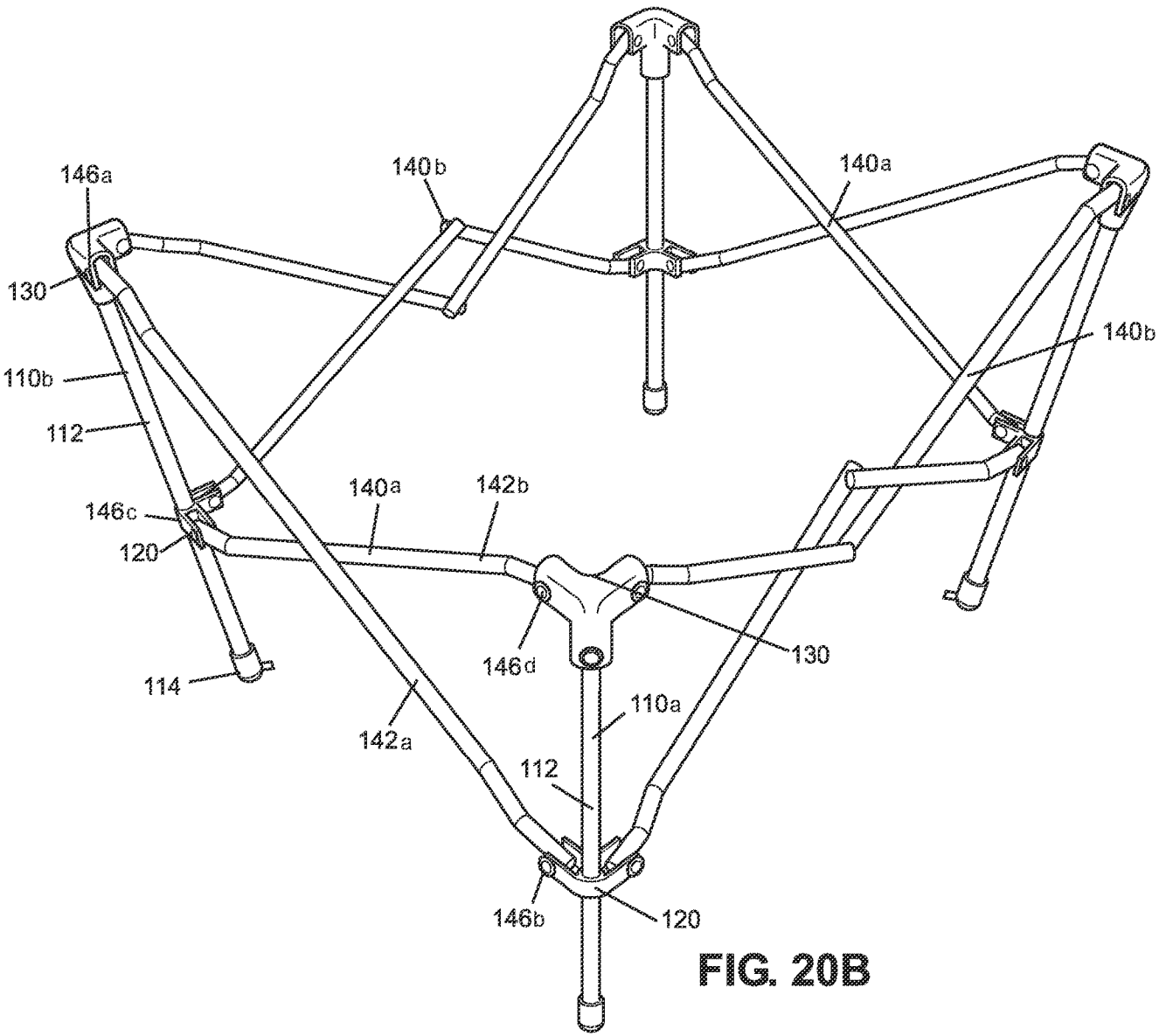
FIG. 20B shows a top, side perspective view of the playard of FIG. 20A.

FIGS. 20A-20E show several views of the frame 100*b* in a partially unfolded/folded state. In particular, FIG. 20B shows the X-frame assembly 140*a* may once again include X-frame tubes 142*a* and 142*b* that are rotatably coupled to one another via a pin joint (e.g., a rolled rivet joint). As shown, the X-frame tube 142*a* may be rotatably coupled to the corner 130 of one leg support assembly 112*b* via a pin joint 146*a* and the slider 120 of another leg support assembly 112*b* via a pin joint 146*b*. Similarly, the X-frame tube 142*b* may be rotatably coupled to the corner 130 of the one leg support assembly 112*b* via a pin joint 146*c* and the corner 130 of the other leg support assembly 112*b* via a pin joint 146*d*. Thus, the X-frame assembly 140*a* may operate in a similar or same manner as the X-frame assemblies 140*a* in the frame 100*a*.

Figure 20C:
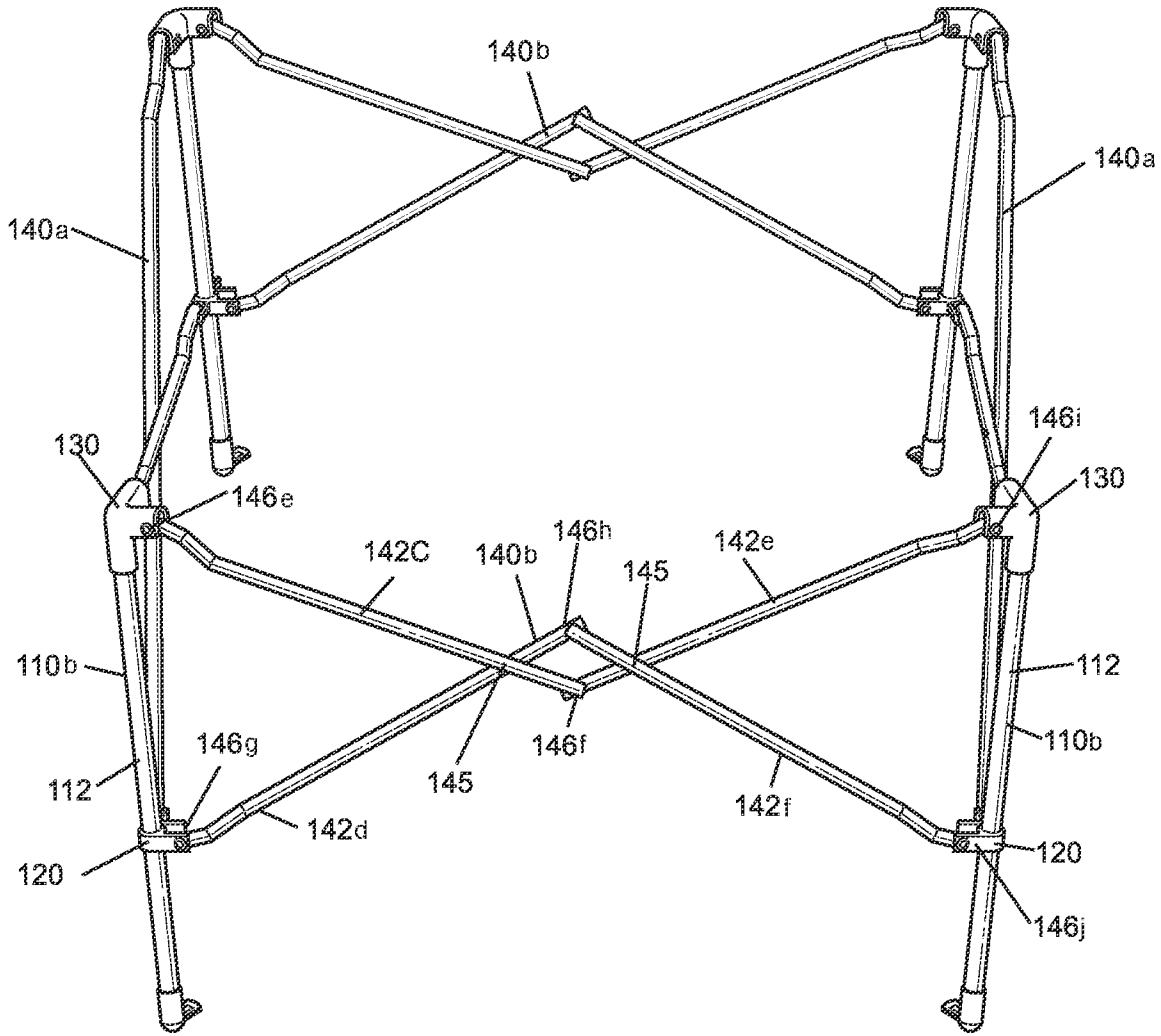
FIG. 20C shows a top, front perspective view of the playard of FIG. 20A.

FIG. 20C shows the X-frame assembly 140*b* may include two pairs of X-frame tubes, i.e., the X-frame tubes 142*c* and 142*d* as well as the X-frame tubes 142*e* and 142*f*. The X-frame tubes 142*c* and 142*d* may be rotatably coupled to each other via a pin joint 145 similar to the X-frame tubes 142*a* and 142*b* in the X-frame assembly 140*a*. Similarly, the X-frame tubes 142*e* and 142*f* may be rotatably coupled to each other via another pin joint 145. Each pair of X-frame tubes 142*c* and 142*d* (or 142*e* and 142*f*) may be coupled to one leg support assembly 110*b* and to the other remaining pair of X-frame tubes. As shown, the X-frame tube 142*c* may be rotatably coupled to the corner 130 of one leg support assembly 110*a* via a pin joint 146*e* and the X-frame tube 142*e* via a pin joint 146*f*. The X-frame tube 142*d* may be rotatably coupled to the slider 120 of the one leg support assembly 110*a* via a pin joint 146*g* and the X-frame tube 142*f* via a pin joint 146*h*. The X-frame tube 142*e* may be further rotatably coupled to the corner 130 of another leg support assembly 110*b* via a pin joint 146*i*. The X-frame tube 142*f* may be further rotatably coupled to the slider 120 of the other leg support assembly 110*b* via a pin joint 146*j*.

In some implementations, the shape and/or dimensions of the X-frame tubes 142*c*-142*f* may be substantially identical or identical with each other. The shape and/or dimensions of the X-frame tubes 142*a* and 142*b* of the X-frame assembly 140*a* may be different from the X-frame tubes 142*c*-142*f* of the X-frame assembly 140*b* depending, in part, on the desired dimensions of the rectangular-shaped interior space 102. However, in some implementations, the shape and/or dimensions of the X-frame tubes 142*c*-142*f* may also be substantially identical or identical with the X-frame tubes 142*a* and 142*b* of the X-frame assembly 140*a*.

FIG. 20C further shows the pair of pin joints 145 may be offset from the respective center points of the X-frame tubes 142*c*-142*f*. In particular, the pin joint 145 coupling the X-frame tubes 142*c* and 142*d* together may be positioned closer to the pin joints 146*h* and 146*f* than the pin joints 146*e* and 146*g*. Similarly, the pin joint 145 coupling the X-frame tubes 142*e* and 142*f* together may also be positioned closer to the pin joints 146*h* and 146*f* than the pin joints 146*i* and 146*j*. The position of the pin joints 145 along the X-frame tubes 142*c*-142*f* may be tailored to ensure the respective ends of the X-frame tubes 142*c*-142*f* align with the ends of the X-frame tubes 142*a* and 142*b* when coupled to the same corner 130 or slider 120.

Figure 20E:
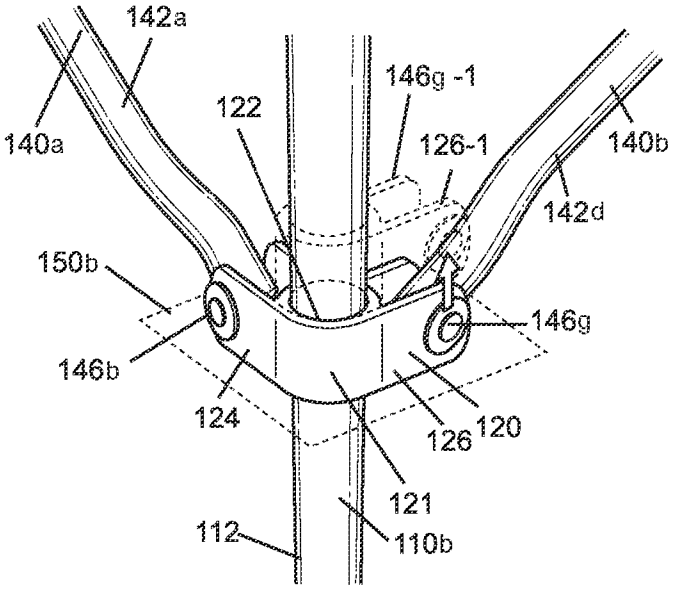
FIG. 20E shows a magnified view of the slider in the leg support assembly of FIG. 20A.
Figure 20D:
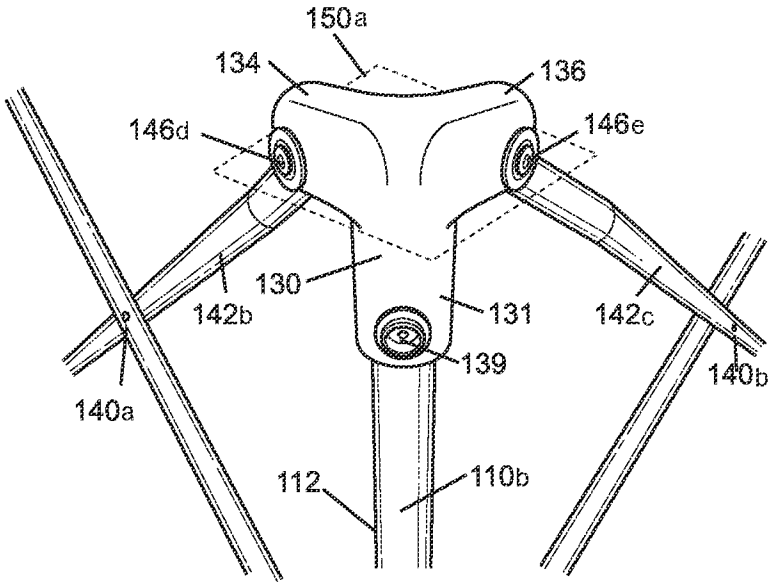
FIG. 20D shows a magnified view of the corner in the leg support assembly of FIG. 20A.

For example, FIG. 20D shows the pin joint 146*d* coupling the X-frame tube 142*b* to the corner 130 and the pin joint 146*e* coupling the X-frame tube 142*c* to the same corner 130 lie on the same horizontal plane 150*a*. FIG. 20E similarly shows the pin joint 146*b* coupling the X-frame tube 142*a* to the slider 120 and the pin joint 146*g* coupling the X-frame tube 142*d* to the same slider 120 may also lie on the same horizontal plane 150*b*. As described above, aligning the pin joints in this manner may allow for a thinner slider 120 and corner 130, which, in turn, may reduce the overall length of the leg tube 112. However, it should be appreciated that in some implementations, the pin joints may not be aligned to the same horizontal plane. For example, FIG. 20E shows the extended portion 126 of the slider 120 and the pin joint 146*g* may be vertically raised (i.e., see extended portion 126-1 and pin joint 146*g*-1) above the extended portion 124 and the pin joint 146*b*.

Figure 21B:
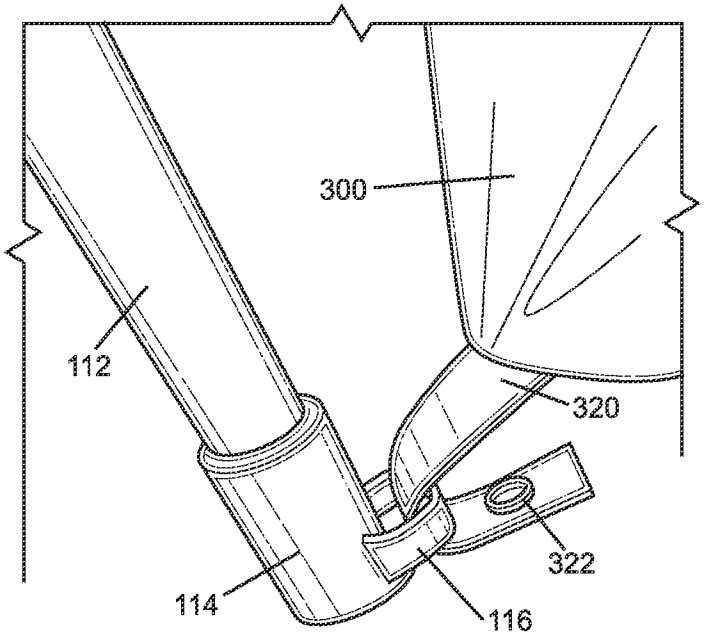
FIG. 21B shows a perspective view of the foot of the leg support assembly attached to the soft goods of FIG. 21A.
Figure 21A:
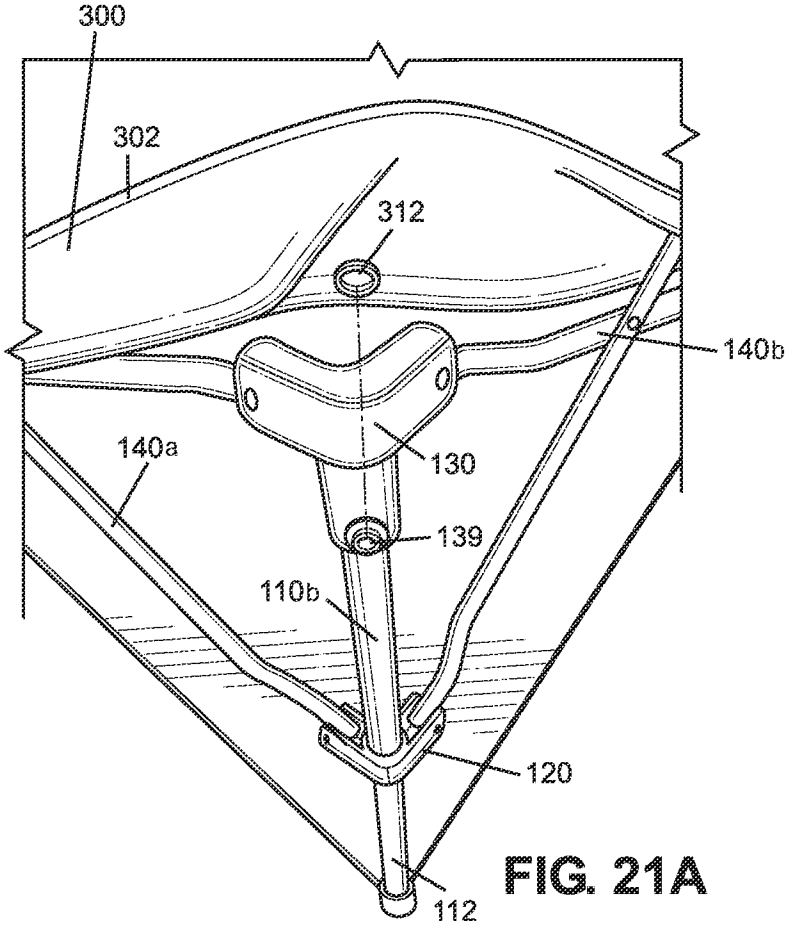
FIG. 21A shows a perspective view of the playard of FIG. 17D with the soft goods partially removed from the leg support assembly.

FIGS. 21A and 21B show the soft goods 300 may attach to the frame 100*b* in a similar manner as in the frame 100*a*. Specifically, FIG. 21A shows the soft goods 300 may include a snap-fit connector 312 disposed on an interior portion of the top portion 302 to couple with the snap-fit connector 139 on the corner 130. FIG. 21B shows the foot 114 of each leg support assembly 110*b* may include a D-ring 116 that provides an opening to tie a tether 320 of the soft goods 300 to the bottom portion of the leg support assemblies 110*b*. As shown, the tether 320 may form a closed loop via the snap-fit connector 322 coupled to another snap-fit connector (not shown) disposed at the base of the strap 320.

Figure 23B:
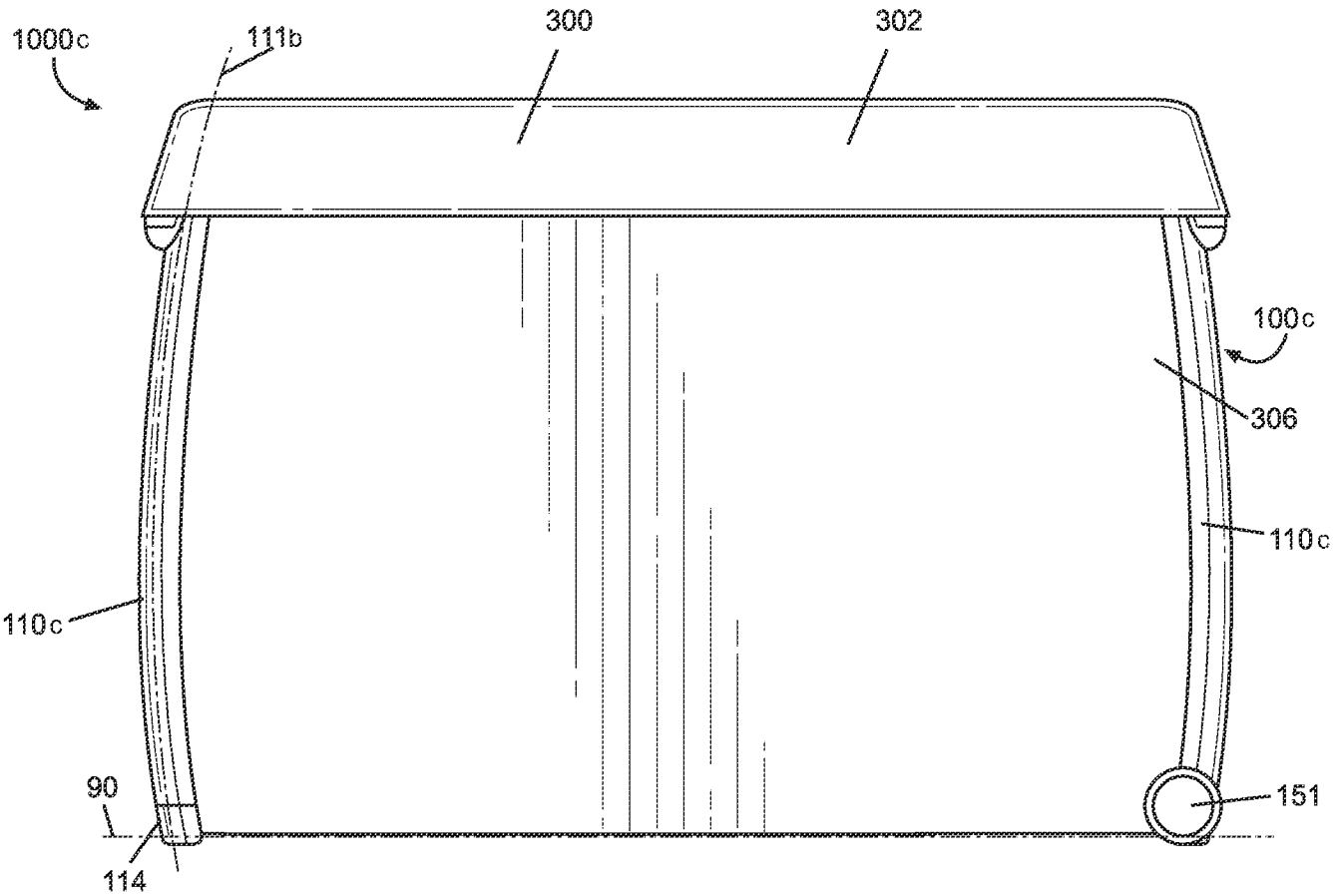
FIG. 23B shows a front view of the playard of FIG. 62B.
Figure 23C:
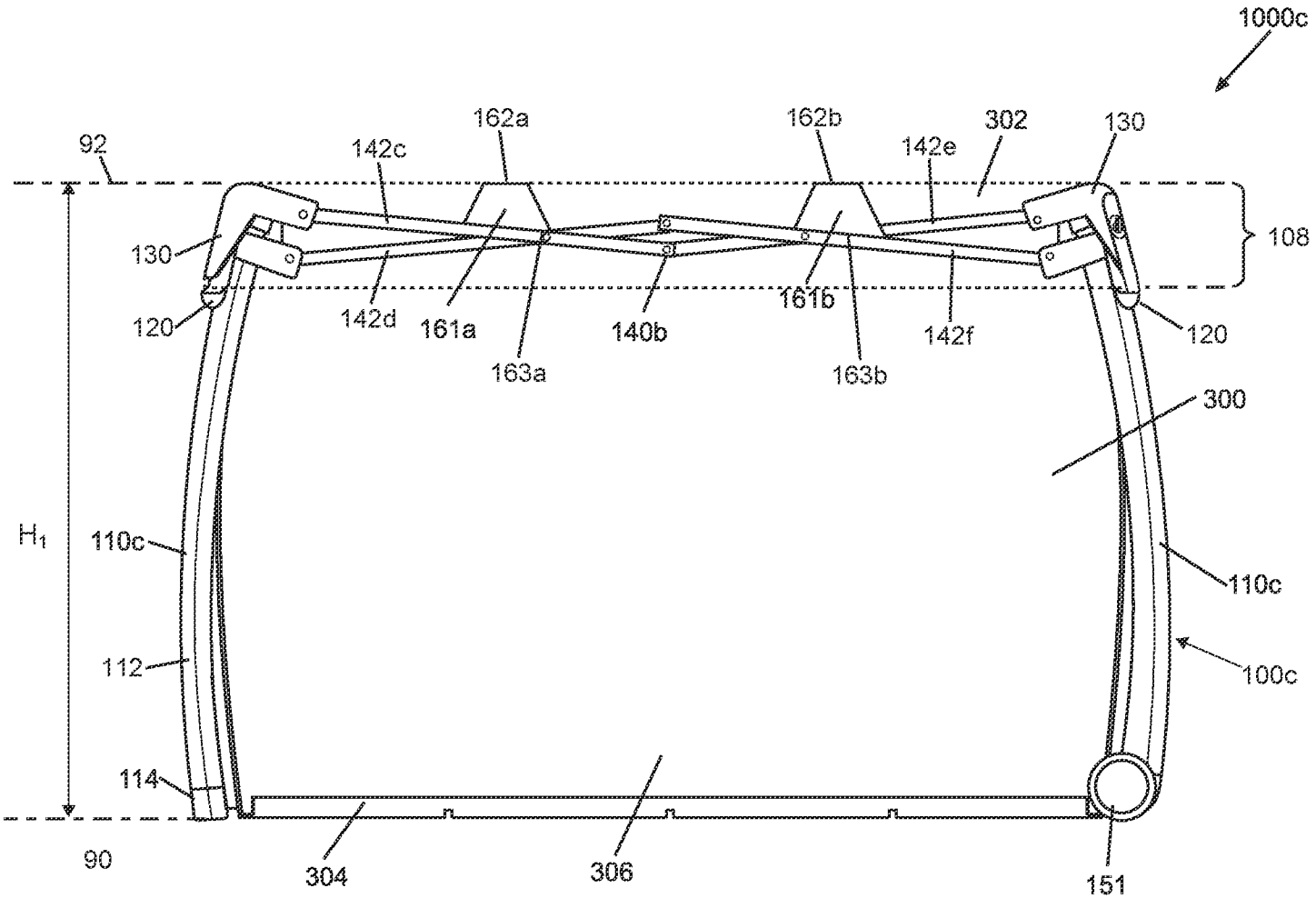
FIG. 23C shows a front view of the playard of FIG. 62C.

In yet another example, FIGS. 23A-23C show a playard 1000*c* with a frame 100*c* that also outlines an interior space 102 with a horizontal cross-section shaped as a rectangle. However, the frame 100*c* may include curved leg support assemblies 110*c* resulting in the interior space 102 having a convex shape. In other words, the leg support assemblies 110*c* curve outwards from the interior space 102 such that the size of the horizontal cross-section is larger at the mid-point of the leg support assemblies 110*c* than the top or bottom portions of the leg support assemblies 110*c*. In some implementations, a convex-shaped interior space 102 may provide the child 50 a larger volume to play and/or sleep compared to an interior space with straight leg support assemblies and the same footprint. Additionally, a convex-shaped interior space 102 may also provide a more aesthetically pleasing design.

As shown in FIG. 23A, the playard 1000*c* may also include soft goods 300 that define a partially enclosed space 301 disposed within the interior space 102 of the frame 100*c* for the child 50 to play and/or sleep. Similar to the playard 1000*b*, the soft goods 300 in the playard 1000*c* may include a floor portion 304 and side portions 306 that define and surround the partially enclosed space 301 as well as a top portion 302 that covers the top portion 108 of the frame 100*c*. The soft goods 300 may include a removable mat placed onto the floor portion 304 to provide padding on the ground 90 supporting the playard 1000*c*. The side portions 306 may also be formed from a transparent or see-through material. As before, the soft goods 300 may further include a removable mat that is placed onto the floor portion 304 to provide padding.

As shown in FIGS. 23C and 62C, the frame 100*c* may include multiple leg support assemblies 110*c* that each include at least a leg tube 112, a slider 120, and a corner 130. Compared to the leg support assemblies 110*a* and 110*b*, the leg tube 112 may be curved along an axis 111*b* such that the slider 120 moves along a curved path when the frame 100*c* is folded and/or unfolded. The leg support assemblies 110*c* may define and/or align with respective side edges 104 of the interior space 102 (see FIG. 24).

The leg support assemblies 110*c* may further include either a foot 114 to support the playard 1000*c* on the ground 90 or a wheel assembly 151 to more easily move and/or reorient the playard 1000*c* after being unfolded. For example, FIG. 62C shows the leg support assemblies 110*c* at one end of the interior space 102 may both include wheel assemblies 151. Thus, the caregiver may pick up the playard 1000*c* from the opposing end and pull the playard 1000*c* with the wheel assemblies 151 rolling along the ground 90 to reposition the playard 1000*c* as desired. In a manner similar to that illustrated in FIG. 18A, FIG. 23C shows that the frame 100*c* has a height $H_1$ between the ground surface 90 and a top horizontal plane 92.

Figure 25A:
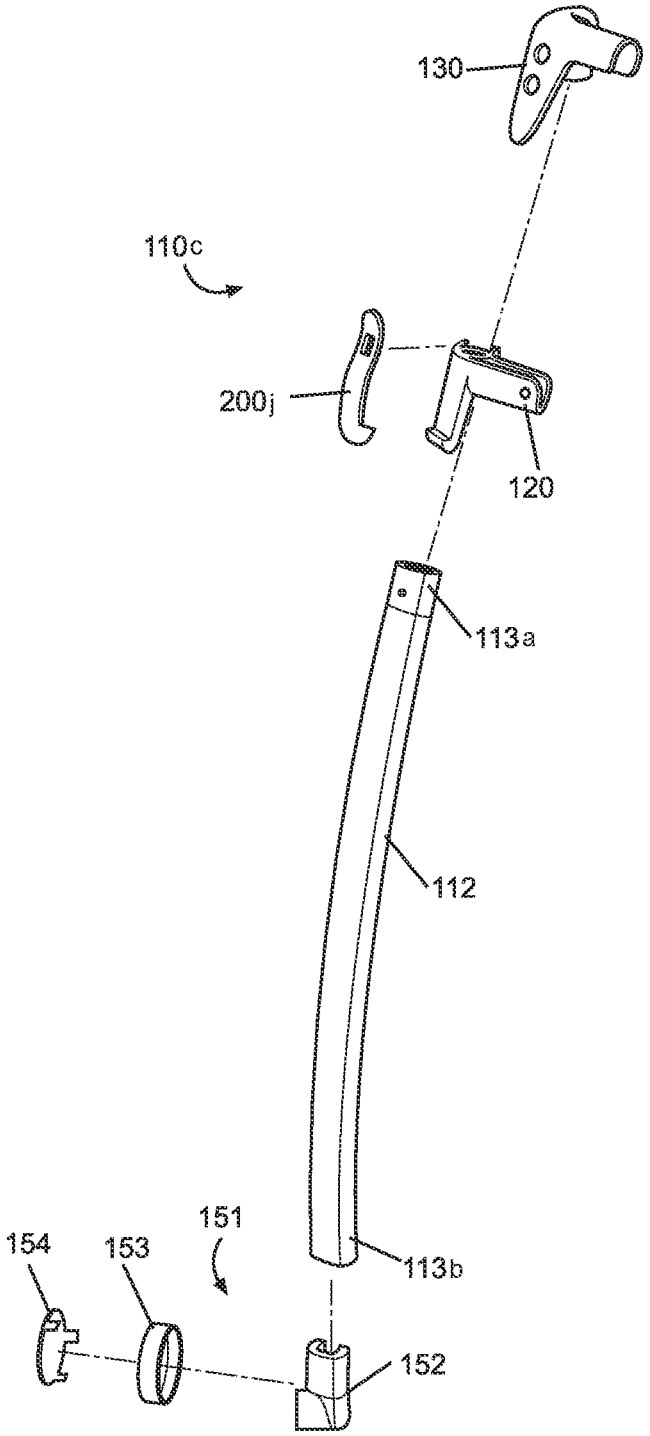
FIG. 25A shows an exploded perspective view of a leg assembly having a wheel in the playard of FIG. 23A.

FIG. 25A shows an exploded view of the leg support assembly 110*c* with the wheel assembly 151. As shown, the leg tube 112 may once again have a first end 113*a* and a second end 113*b*. The corner 130 may be coupled to the top end 113*a* of the leg tube 112. The wheel assembly 151 may include a base 152 that couples to the bottom end 113*b* of the leg tube 112. The wheel assembly 151 may further include a wheel 153 that is rotatably coupled to the base 152 via a wheel cover 154. The slider 120 may thus be slidably coupled to the leg tube 112 such that the slider 120 is located between the base 152 of the wheel assembly 151 and the corner 130. FIG. 25A also shows the frame 100*c* may include a latch 200*j* that directly couples the slider 120 to the corner 130, which will be described in more detail below.

Figure 25B:
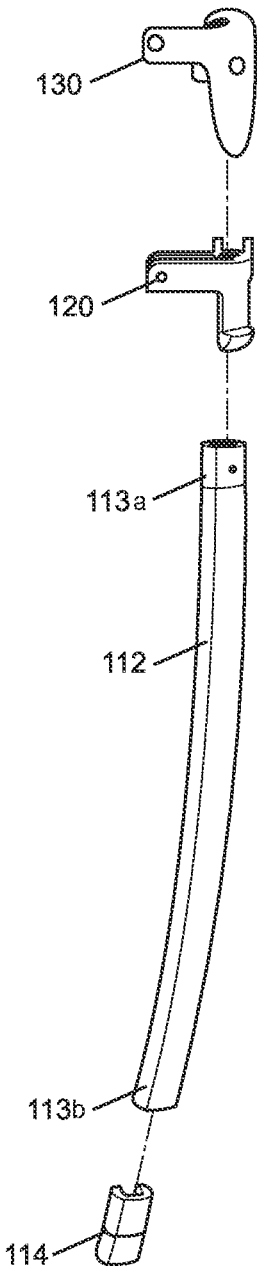
FIG. 25B shows an exploded perspective view of a leg assembly having a foot in the playard of FIG. 23A.

FIG. 25B shows an exploded view of the leg support assembly 110*c* with the foot 114. As shown, the leg tube 112, the slider 120, the corner 130, and the foot 114 may be assembled in a similar manner to the leg support assemblies 110*a* and 110*b* as described above.

Figure 24:
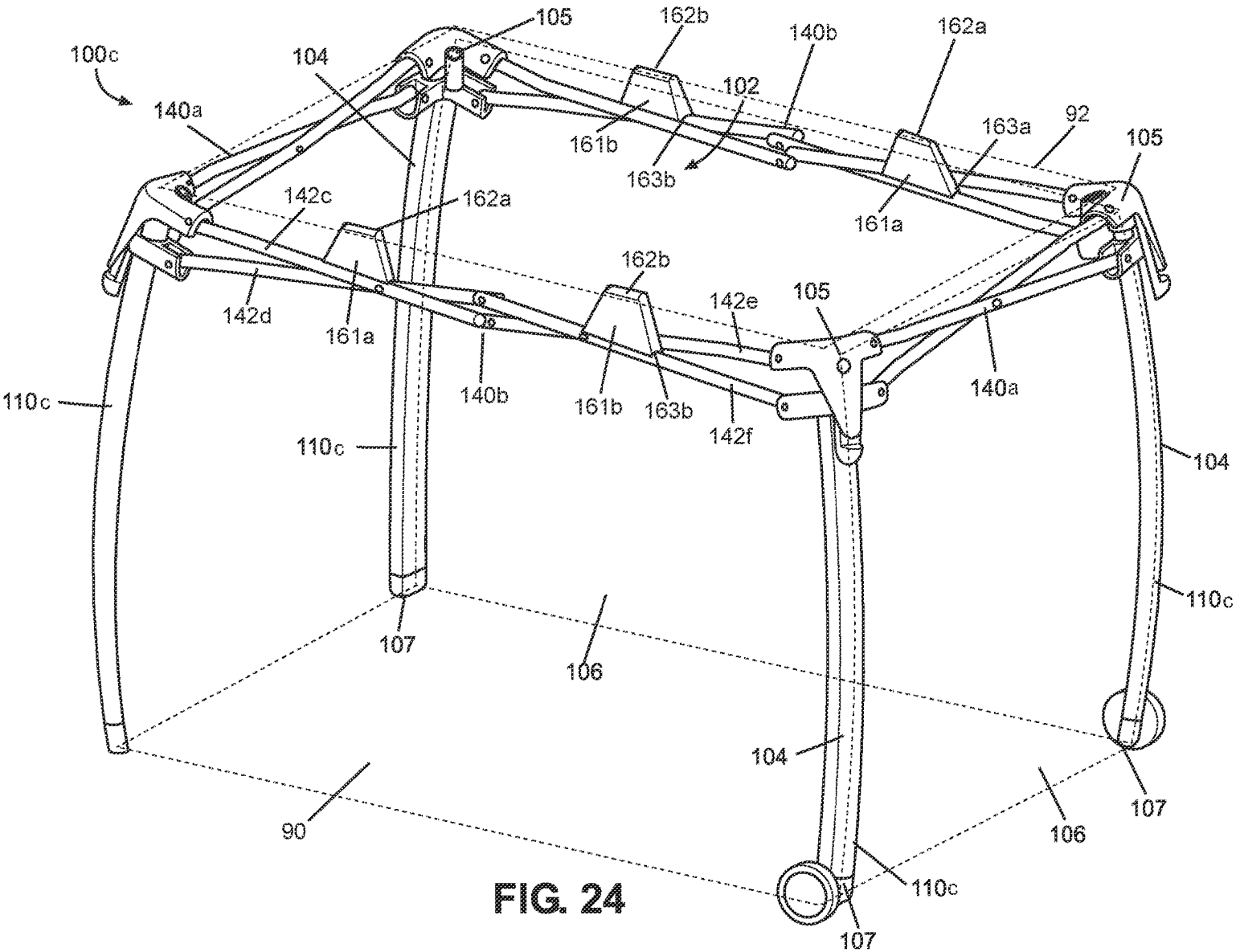
FIG. 24 shows a top perspective view of the playard of FIG. 62B with the soft goods removed.

The frame 100*c* may further include X-frame assemblies 140*a*, disposed on the smaller curved side faces 106 of the interior space 102, to couple adjacent leg support assemblies 110*c* along the shorter sides of the rectangular cross-section of the interior space 102 (see FIG. 24). The frame 100*c* may also include X-frame assemblies 140*b*, disposed on the larger curved side faces 106 of the interior space 102, to couple adjacent leg support assemblies 110*c* along the longer sides of the rectangular cross-section of the interior space 102 (see FIG. 24). As before, the X-frame assemblies 140*a* may form a single X-frame structure with one pair of X-frame tubes and the X-frame assemblies 140*b* may form a double X-frame structure with two pairs of X-frame tubes.

The shape and/or dimensions of the respective X-frame tubes in the X-frame assemblies 140*a* and 140*b* and/or the location of the pin joints that rotatably couple each X-frame tube to another X-frame tube, the slider 120, and/or the corner 130 may be tailored based, in part, on the desired dimensions of the interior space 102 similar to the frame 100*b*. Additionally, in some implementations, the X-frame tubes of the X-frame assemblies 140*a* and 140*b* may be arranged such that the pin joints that couple the X-frame tubes to the same slider 120 or corner 130 of the leg support assembly 110*c* are aligned along the same horizontal plane.

The X-frame assemblies 140*a* and 140*b* may once again be disposed within a top portion 108 of the frame 100*c* and/or the interior space 102. This enables the X-frame assemblies 140*a* and 140*b* to function as top rails to mechanically reinforce the frame 100*c* while also eliminating other support structures, such as a separate top rail and/or a bottom support structure. The placement of the X-frame assemblies 140*a* and 140*b* may also provide a larger window for the caregiver to view their child 50 through the sides of the frame 100*c*.

In some implementations, the soft goods 300 in the playard 1000*c* may be divided into separate components, in part, to better conform with the geometry of the interior space 102. For example, the side portions 306 and the floor portion 304 may be installed separately from the top portion 302. To better conform with the shape of the interior space 102, the side portions 306 may be mounted along an interior side of the leg tube 112 to reduce or, in some instances, prevent gaps from forming between the side portions 306 and the leg support assemblies 110*c* (see, for example, FIG. 26A) when the playard 1000*c* is unfolded. Said in another way, the side portions 306 of the soft goods 300 may be attached to the leg support assemblies 110*c* to provide a seamless appearance with the leg tubes 112, the feet 114, and/or the wheel assemblies 151 being exposed along the exterior portion of the playard 1000*c* as shown in FIGS. 23A and 23B. Once the side portions 306 and the floor portion 304 of the soft goods 300 are installed, the top portion 302 may then be attached to the side portions 306 using, for example, a zipper connection (not shown), and subsequently coupled to the frame 100*c* to complete assembly.

Figure 26B:
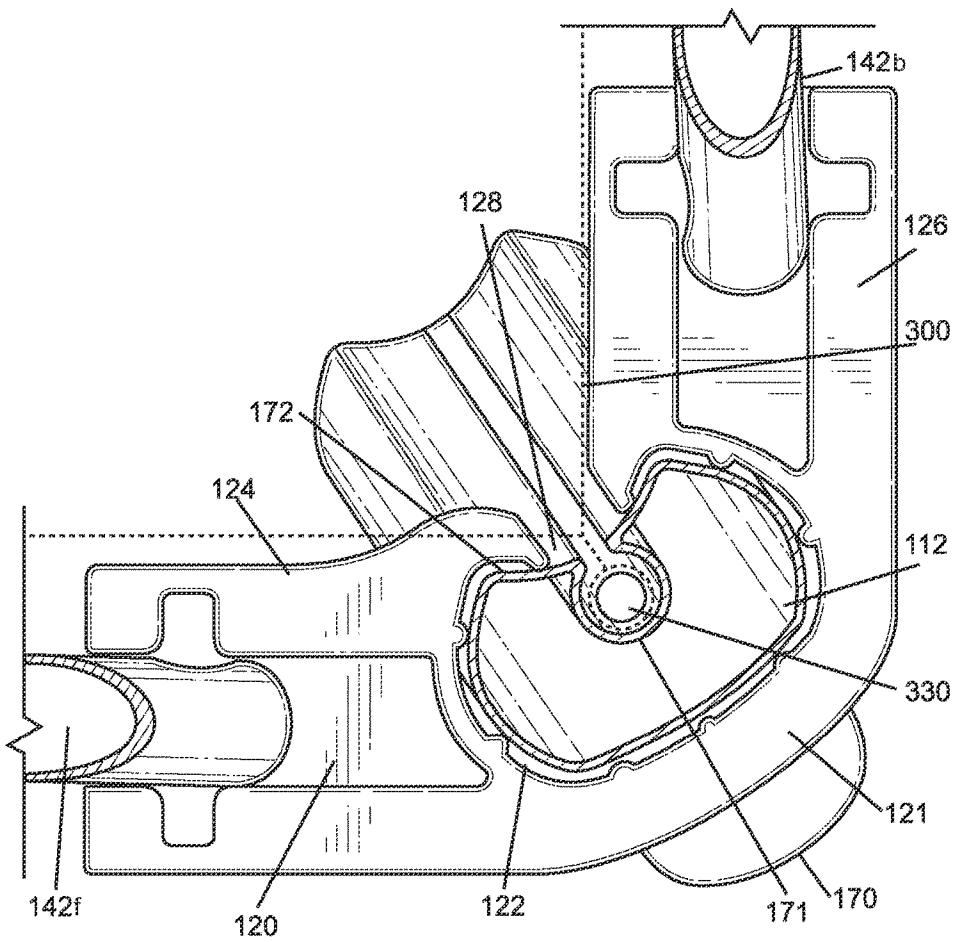
FIG. 26B shows a cross-sectional view of a slider of a leg support assembly in the playard corresponding to the plane A-A of FIG. 26A.
Figure 26A:
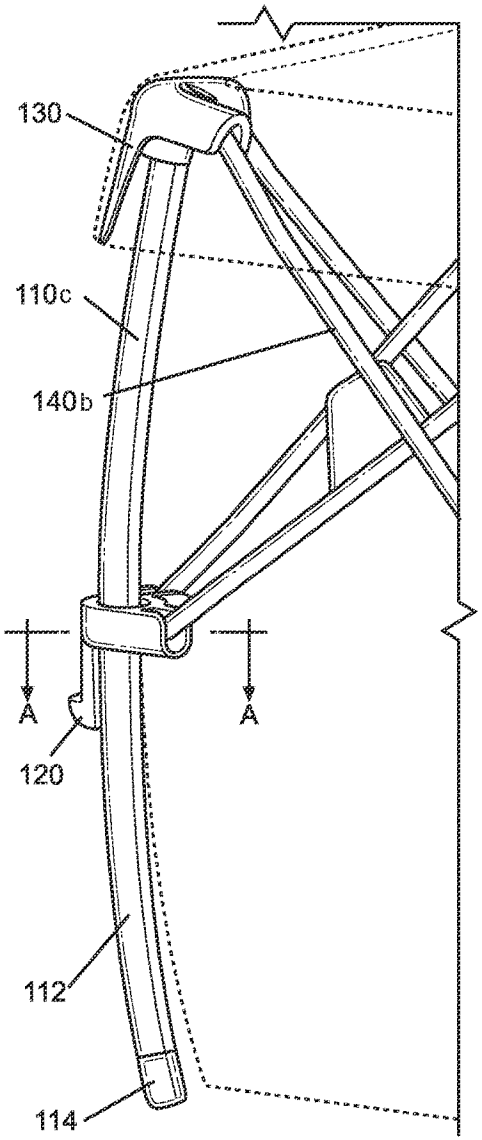
FIG. 26A shows a perspective view of the playard of FIG. 23A in a partially unfolded configuration.

This may be accomplished, in part, by incorporating a stiffener 330 into the side portions 306 of the soft goods 300, which may then be routed through a channel 171 formed along the leg tube 112. The stiffener 330 may be a compliant component, such as an extruded plastic rod that is inserted through a pocket formed along the respective corners of the side portions 306 located near the side edges 104 of the interior space 102. FIG. 26B shows the leg tube 112 may have an oblong cross-sectional shape with a curved side 172 that forms a recess along the interior side of the leg tube 112 facing the interior space 102. The channel 171 may be formed on the curved side 172 and may span a portion of or, in some instances, the entire length of the leg tube 112. As shown in FIG. 26B, the stiffener 330 may be inserted through the channel 171, thus holding the side portions 306 of the soft goods 300 against the leg tube 112.

The slider 120 in the leg support assembly 110*c* may still be allowed to move along the leg tube 112 even with the side portions 306 of the soft goods 300 installed onto the leg tube 112. For example, FIG. 26B shows the slider 120 may include a base 121 that defines a through hole opening 122 that only partially surrounds the leg tube 112 to guide the movement of the slider 120 along the leg tube 112. As shown, a slotted opening 128 may be formed along an interior side of the base 121 to allow the side portions 306 attached to the leg tube 112 to pass through the base 121 of the slider 120. In this manner, the slider 120 may move along the leg tube 112 unimpeded by the side portions 306 when the playard 1000*c* is folded and/or unfolded.

FIG. 26B further shows the slider 120 may once again include extended portions 124 and 126 disposed on opposing sides of the base 121 to couple to respective X-frame tubes of the X-frame assemblies 140*a* and 140*b* (e.g., X-frame tubes 142*f* and 142*b*).

Figure 27A:
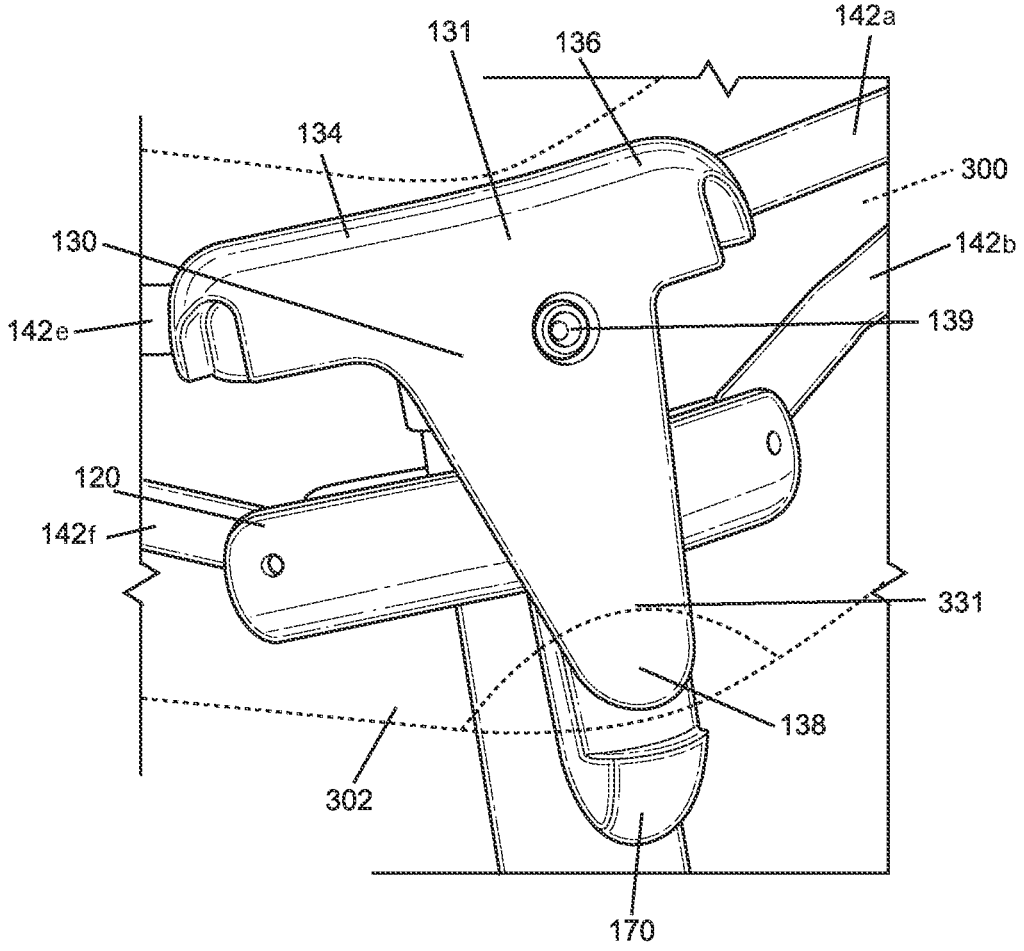
FIG. 27A shows a magnified view of the slider and a corner of the leg support assembly in the playard of FIG. 23A.

FIG. 27A shows the corner 130 may once again include a base 131 with extended portions 134 and 136 disposed on opposing sides of the base 131 to couple to respective X-frame tubes of the X-frame assemblies 140*a* and 140*b* (e.g., X-frame tubes 142*e* and 142*a*). The corner 130 may further include a tab 138 that extends downwards along the leg tube 112 and outwards from the frame 100*c* to form an overhang portion. As shown in FIG. 27A, the slider 120 may be positioned underneath the overhang portion formed by the tab 138 and, hence, disposed between the leg tube 112 and the tab 138 of the corner 130 when the frame 100*c* is unfolded.

Figure 27C:
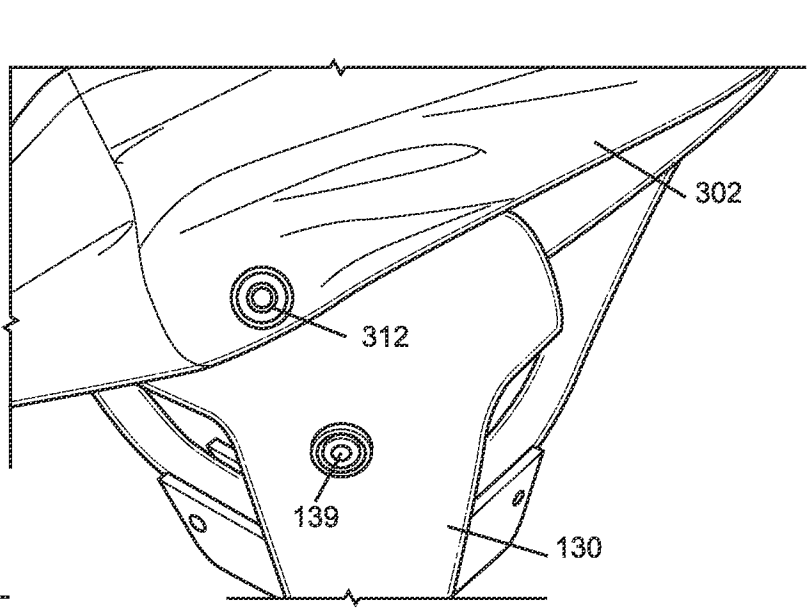
FIG. 27C shows the soft goods removed from the corner of FIG. 27A.
Figure 27B:
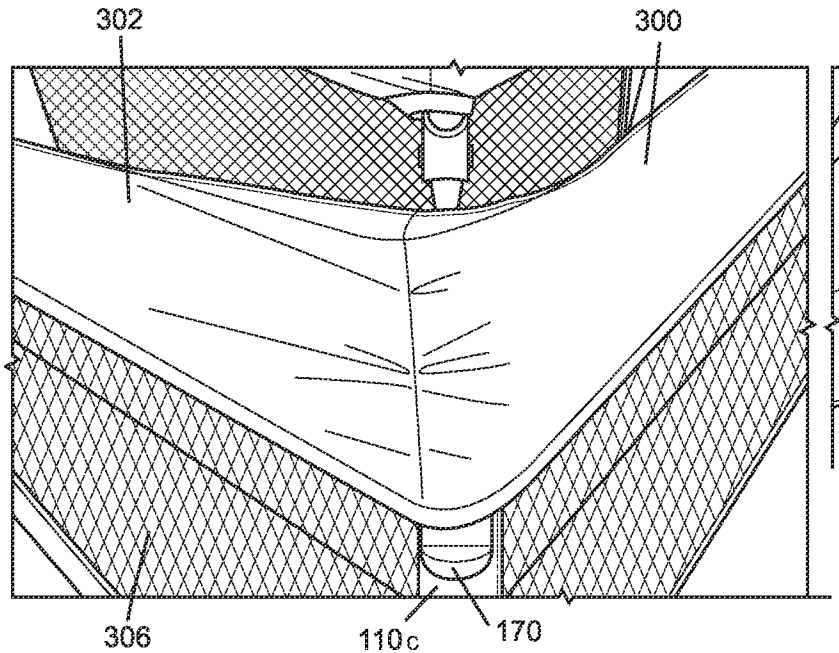
FIG. 27B shows the soft goods attached to the corner of FIG. 27A.

The corner 130 may be shaped in this manner to provide a hook structure for the top portion 302 of the soft goods 300 to wrap around, thus ensuring the corners 130 and the X-frame assemblies 140*a* and 140*b* are covered. In some implementations, the top portion 302 of the soft goods 300 may further include a pocket 331 to aid the caregiver in wrapping the soft goods 300 around the corners 130. Additionally, the soft goods 300 may primarily contact only the exterior surfaces of the corner 130, which may allow the corners of the playard 1000*c* to have a softer, gentler appearance. For example, the base 131 and the tab 138 of the corner 130 may have a smooth rounded shape for the top portion 302 of the soft goods 300 to wrap around. The top portion 302 of the soft goods 300 may include a snap-fit connector 312 disposed along an interior portion of the top portion 302 that couples to a corresponding snap-fit connector 139 on the corner 130 as shown in FIGS. 27B and 27C.

In some implementations, the slider 120 may also include a rounded bottom section 170 positioned underneath the overhang portion of the tab 138 when the frame 100*c* is unfolded. As shown in FIGS. 26B and 27A, the rounded bottom section 170 may extend further outwards from the frame 100*c* than the tab 138 of the corner 130 to provide a lead-off feature to reduce or, in some instances, prevent a string or another tethered object from becoming entangled with the overhang portion of the corner 130.

As described above, the frame 100*c* may include the latch 200*j* to lock the frame 100*c* in the unfolded configuration by engaging the slider 120 of one leg support assembly 110*c* to the corresponding corner 130. Generally, the frame 100*c* may include one or more of the latches 200*j*. For example, FIG. 28A shows the playard 1000*c* may include a single latch 200*j* coupled to one leg support assembly 110*c*. However, in other implementations, the playard 1000*c* may include another latch 200*j* coupled to another leg support assembly 110*c* on an opposite corner of the playard 1000*c* to ensure the frame 100*c* is evenly unfolded.

Figure 28B:
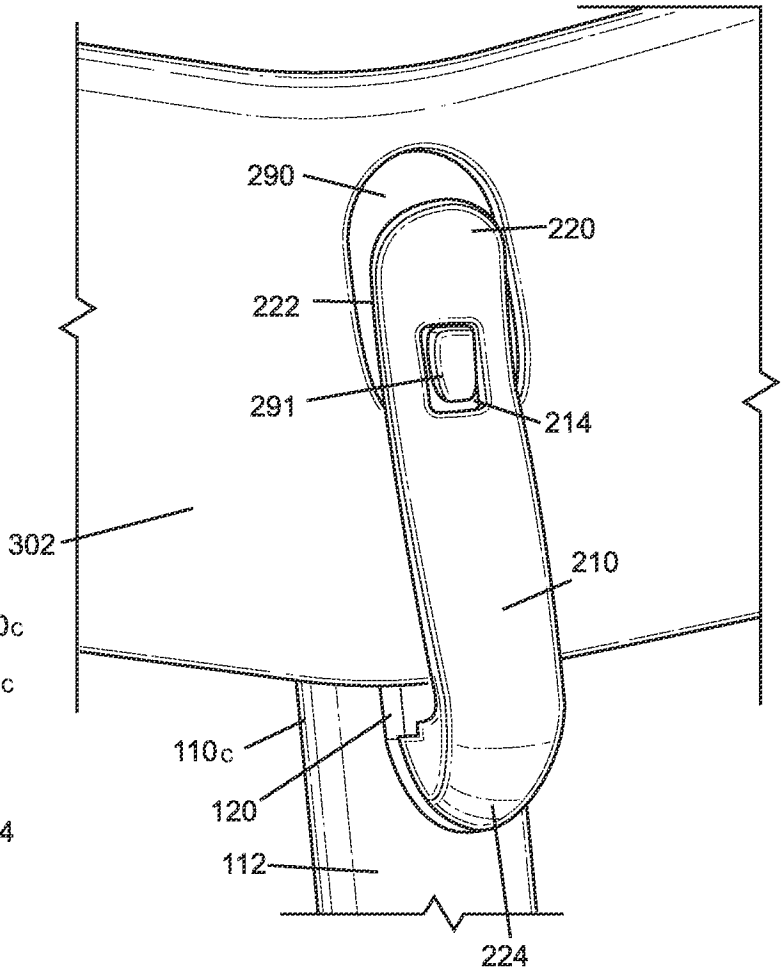
FIG. 28B shows a magnified view of the latch member of the latch of FIG. 28A.
Figure 28A:
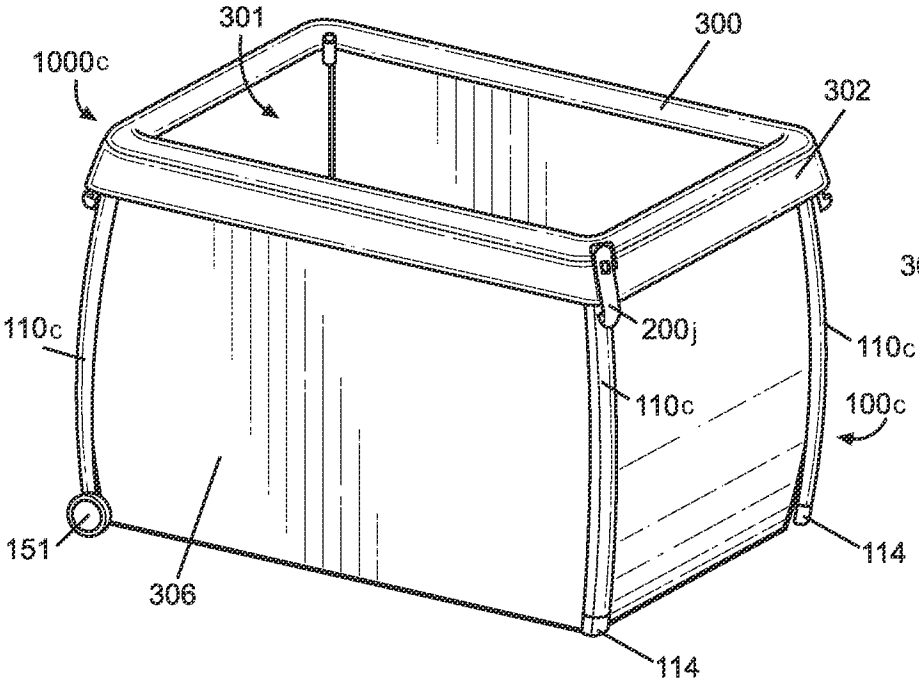
FIG. 28A shows a top perspective view of the playard of FIG. 23A with a snap-fit latch disposed over the soft goods.
Figure 28C:
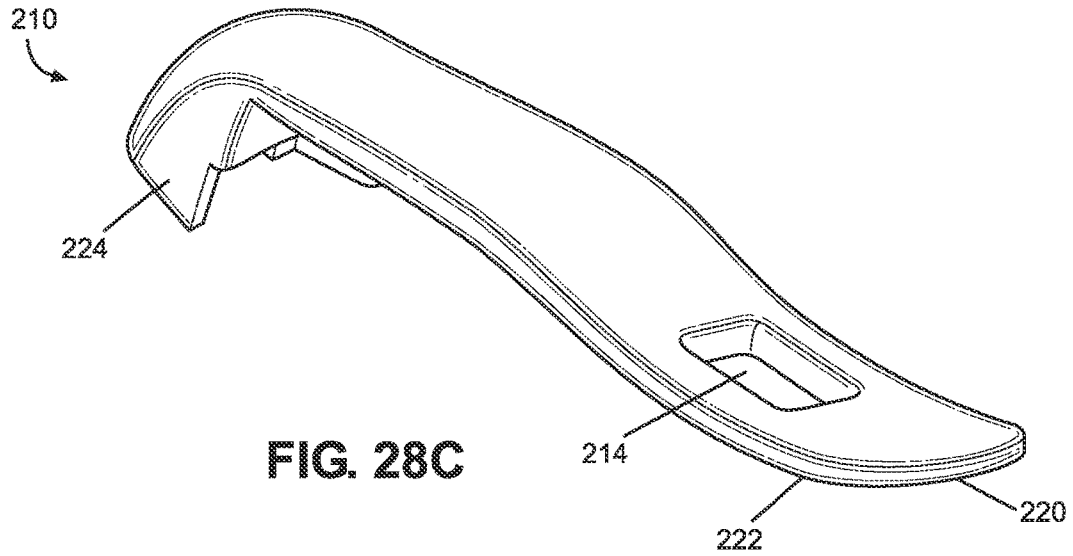
FIG. 28C shows a perspective of a latch member in the latch of FIG. 28A.

FIG. 28B shows the latch 200*j* may include a latch member 210 with a mounting base 224 at one end that is rigidly coupled to the slider 120 and a latch opening 214 disposed at an opposing end (see FIG. 28C) to receive a latch catch 291 disposed on the corner 130. The latch member 210 may be a mechanically compliant component with sufficient mechanical rigidity such that a restoring force is generated when the latch member 210 is bent and/or deflected. The latch member 210 may further include a tab 220, which may be pulled to bend the latch member 210 outwards from the frame 100*c* to release the latch member 210 from the latch catch 291. Additionally, the latch member 210 may include a lead-in portion 222 to facilitate engagement of the latch member 210 to the latch catch 291 when unfolding the playard 1000*c*.

FIG. 28B further show the latch 200*j* may be locked and/or unlocked with the soft goods 300 and, in particular, the top portion 302 covering the top portion 108 of the frame 100*c*. As shown, the latch catch 291 may protrude through an opening 290 formed on the top portion 302 of the soft goods 300. The latch member 210 may be disposed over the top portion 302 when engaging with the latch catch 291. Thus, the latch member 210 may be left exposed. Furthermore, the internal restoring force generated by the latch member 210 may also cause at least a portion of the latch member 210 (e.g., the tab 220, the lead-in feature 222) to press onto the top portion 302 of the soft goods 300, thus further restraining the soft goods 300 against the corner 130. In other words, the latch member 210 may function as an integral escutcheon when engaged with the latch catch 291.

Figure 29A:
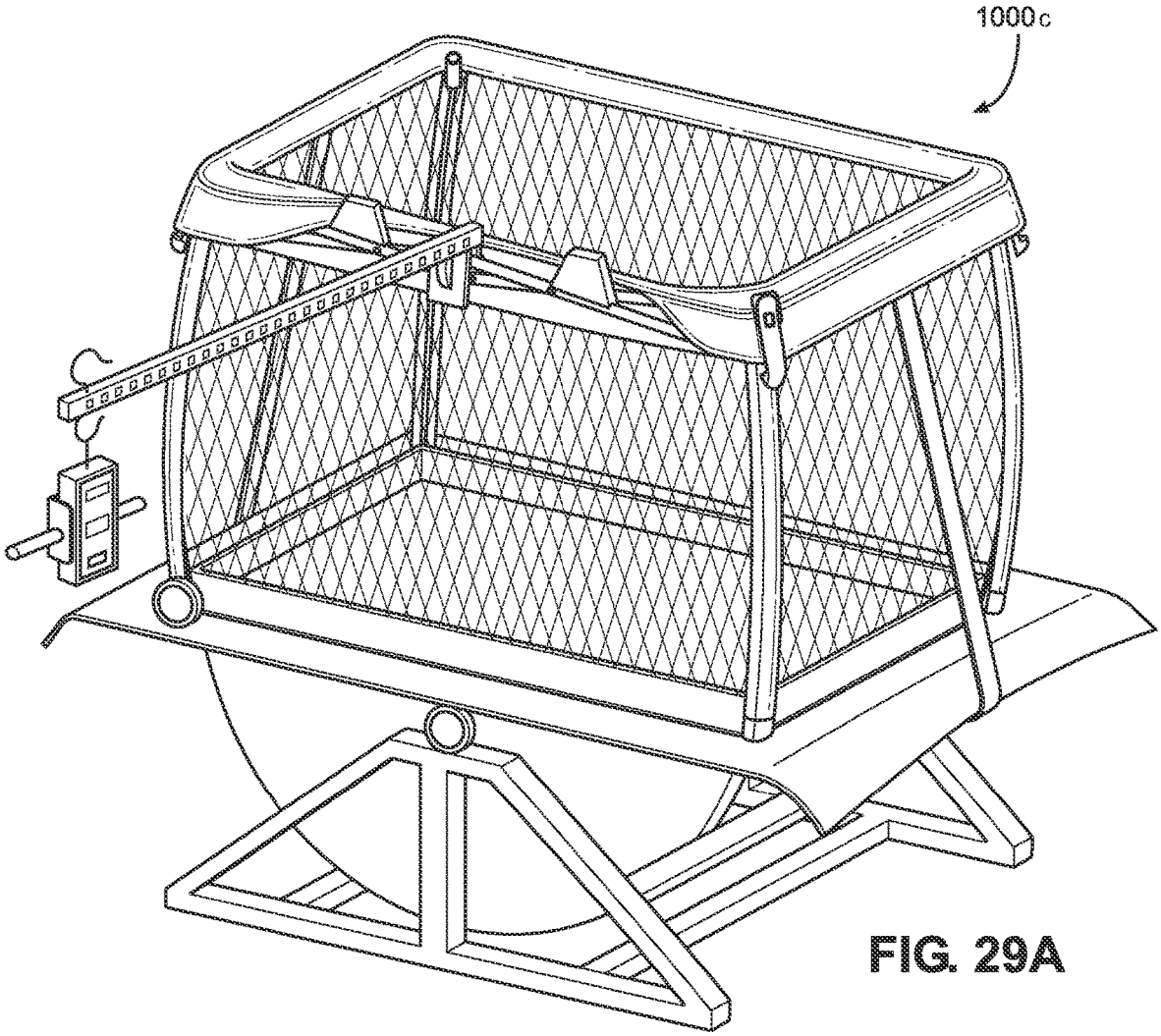
FIG. 29A shows a top rail to corner post attachment test being performed on the playard of FIG. 23A.
Figure 29B:
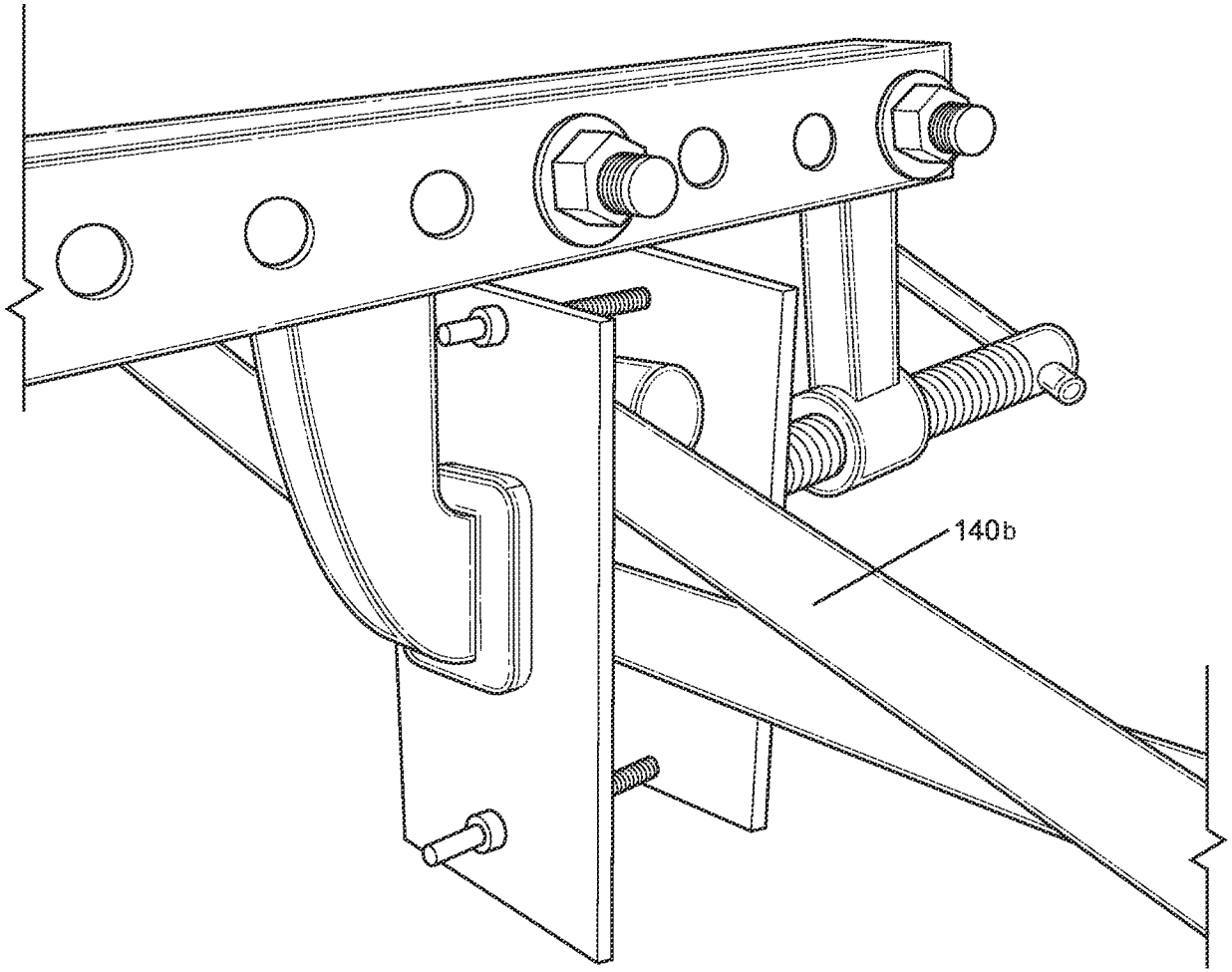
FIG. 29B shows a testing apparatus mounted to the double X-frame assembly in the playard of FIG. 23A.
Figure 29C:
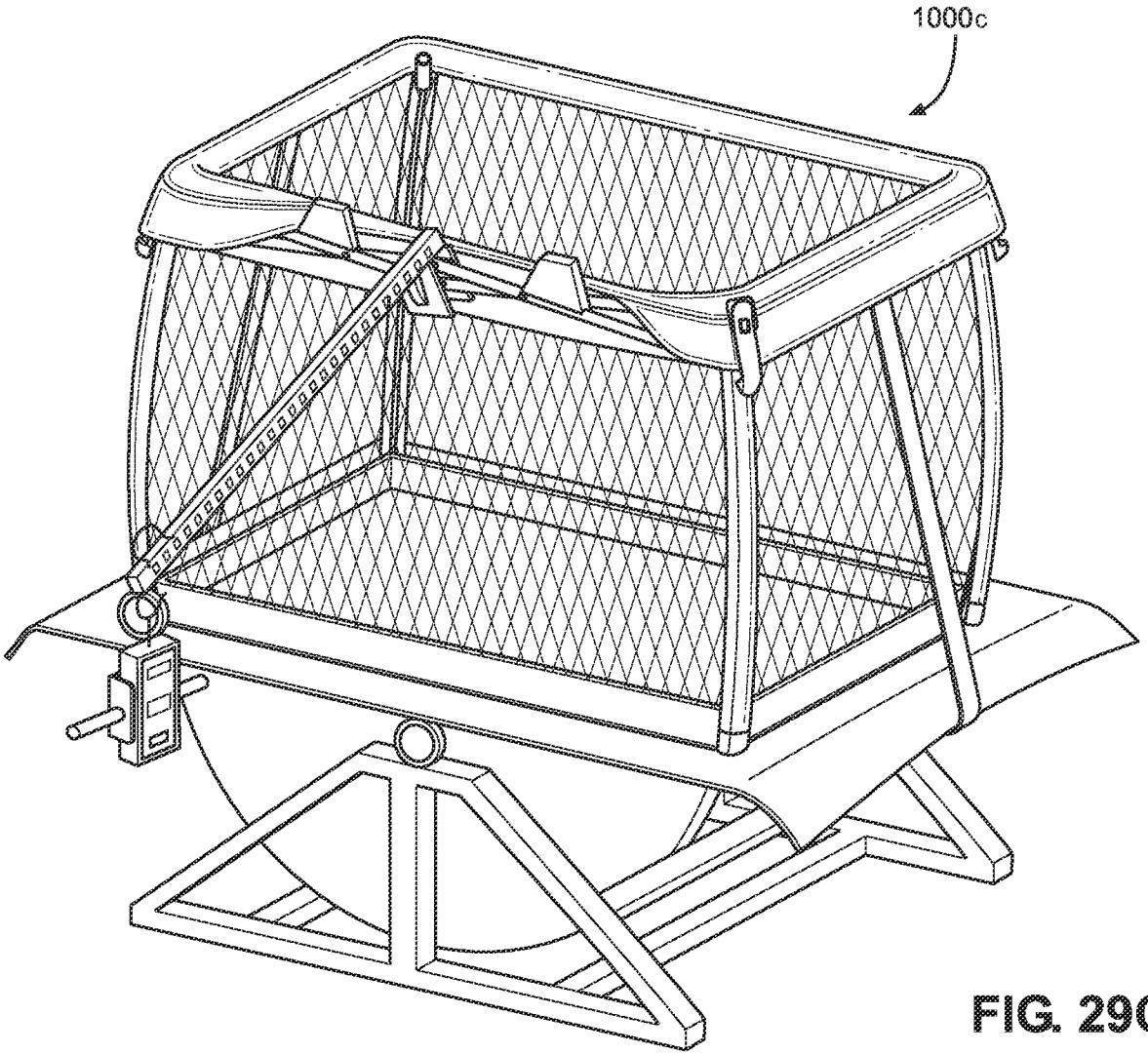
FIG. 29C shows the playard after conducting the test of FIG. 29A.
Figure 29D:
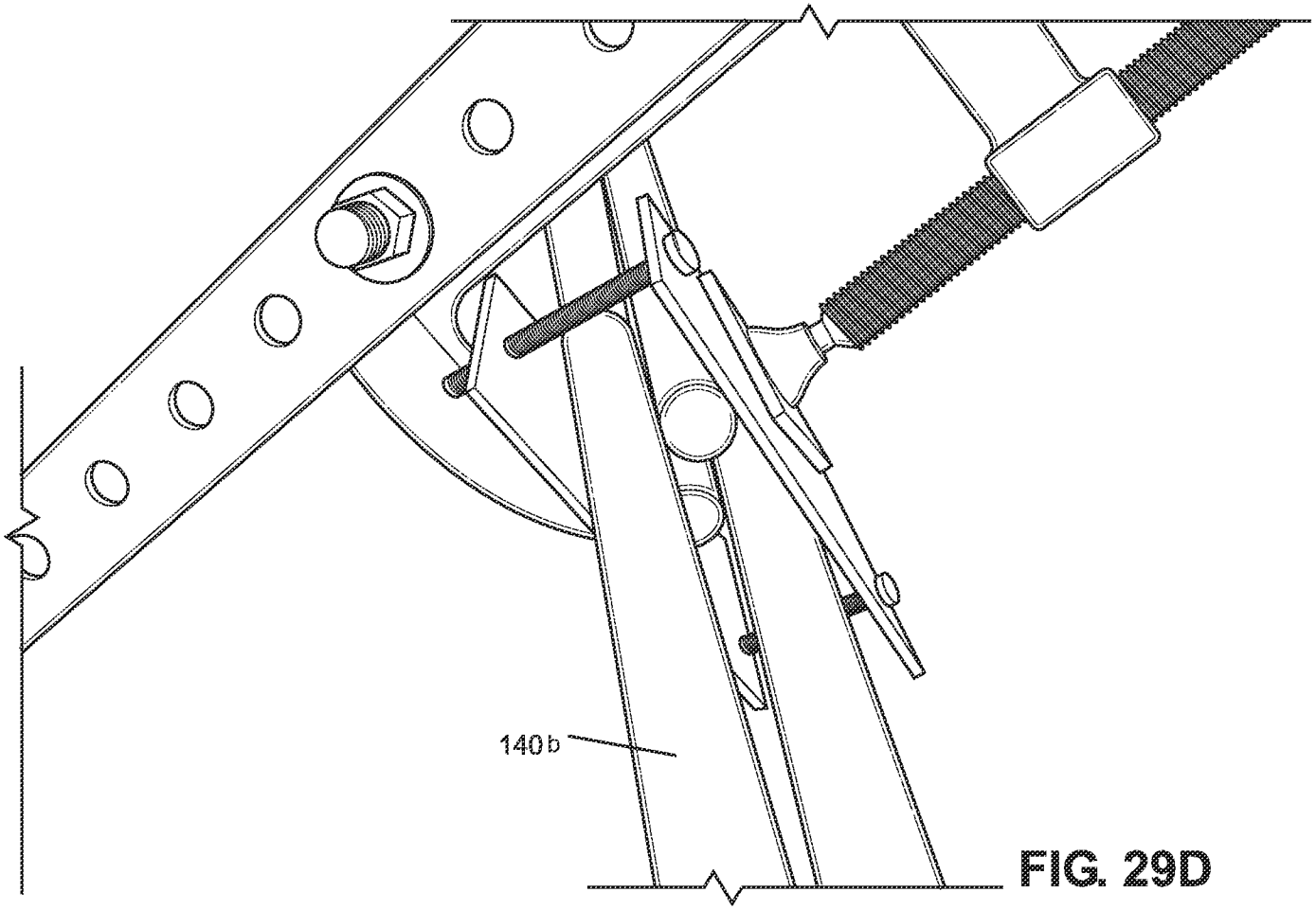
FIG. 29D shows the testing apparatus mounted to the double X-frame assembly in the playard of FIG. 23A.

Similar to the playards 1000*a* and 1000*b*, the frame 100*c* of the playard 1000*c* may only include the leg support assemblies 110*c* and the X-frame assemblies 140*a* and 140*b*. In some implementations, the frame 100*c* may exhibit sufficient mechanical rigidity, stability, and strength to satisfy various consumer safety standards (e.g., ASTM F406-19). For example, FIGS. 29A-29D show the playard 1000*c* being subjected to a Top Rail to Corner Post Attachment test as set defined under ASTM F406-19, 7.11 and 8.30. As shown in FIGS. 29A and 29B, a torque is applied to one of the X-frame assemblies 140*b* by clamping a 24 inch long rod to the X-frame tubes of the X-frame assembly 140*b* and hanging a 15-20 lb weight onto the end of the rod. FIGS. 29C and 29D show that after applying the torque load for at least 10 seconds, the X-frame tubes of the X-frame assembly 140*b* were deformed, but the sliders 120 and the corners 130 coupled to the X-frame tubes did not crack and/or otherwise break, thus satisfying the requirements under ASTM F406-19, 7.11.

Figure 30A:
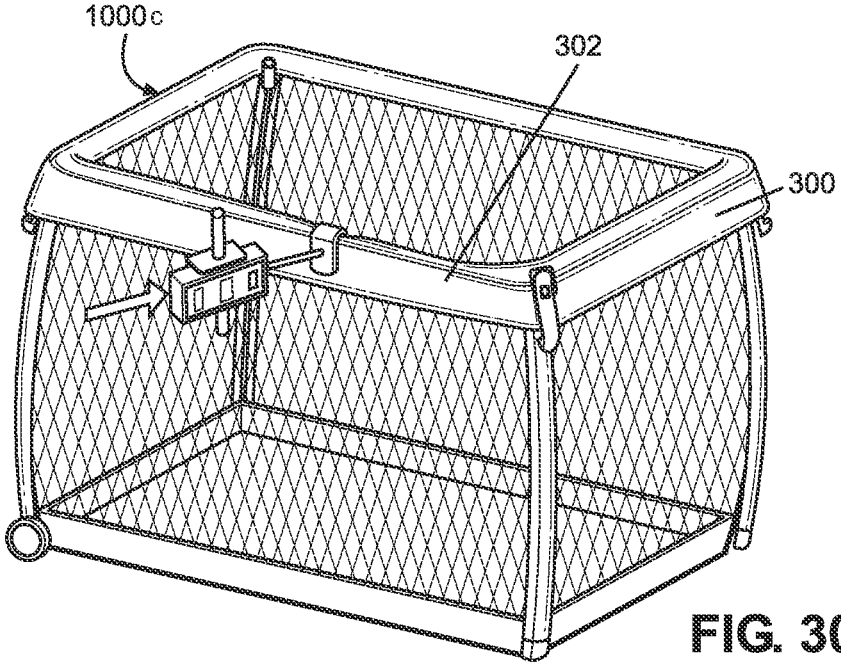
FIG. 30A shows a strength test being applied to the double X-frame assembly in the playard of FIG. 23A.
Figure 30B:
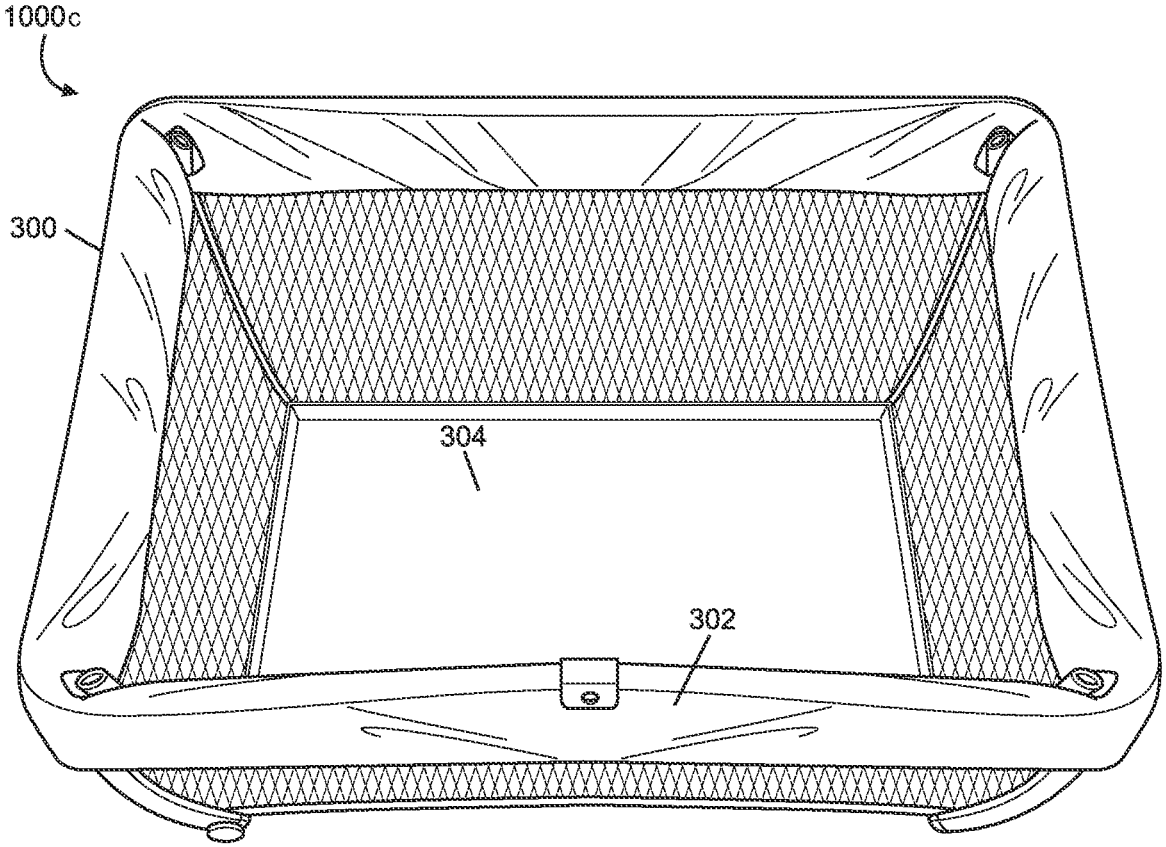
FIG. 30B shows the playard of FIG. 30A after the strength test.
Figure 30C:
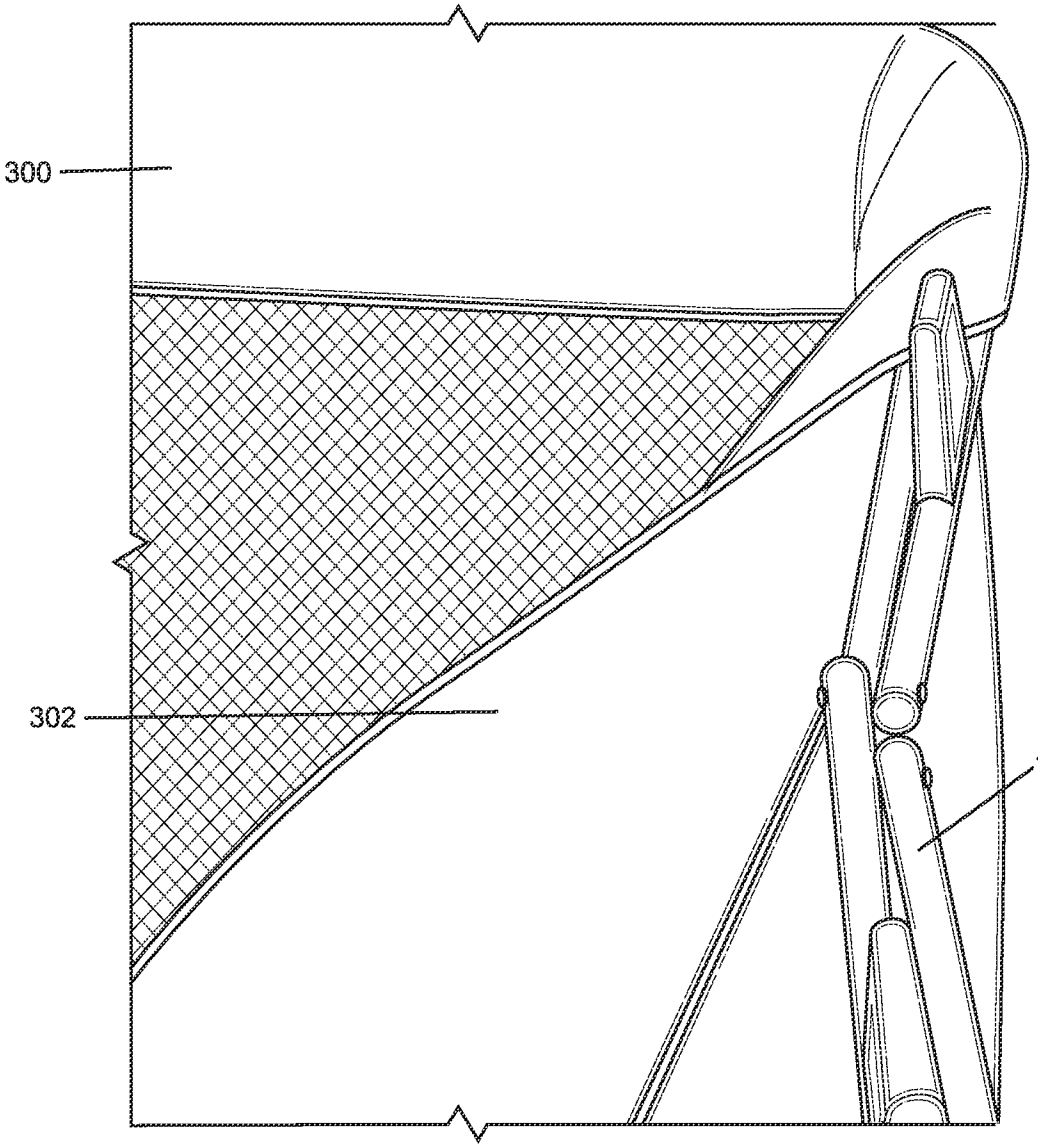
FIG. 30C shows the playard of FIG. 30B with the soft goods partially removed from the X-frame assembly.

FIGS. 30A-30C show the playard 1000*c* being subjected to another test to evaluate the mechanical strength and robustness of the X-frame assembly 140*b* under ASTM F406-19, 7.3.3 and 8.11.2.4. As shown in FIG. 30A, a 100 lbf force was applied to the center of the X-frame assembly 140*b* at a 45 degree angle relative to the floor for at least 15 seconds. FIGS. 30B and 30C show the X-frame tubes of the X-frame assembly 140*b* were deformed and the rolled rivet joints connecting the X-frame tubes together were bent. However, the X-frame tubes, the rolled rivet joints, and the corners and sliders of the leg support assemblies did not crack and/or otherwise break, thus satisfying the requirements under ASTM F406-19, 7.3.3.

Figure 31:
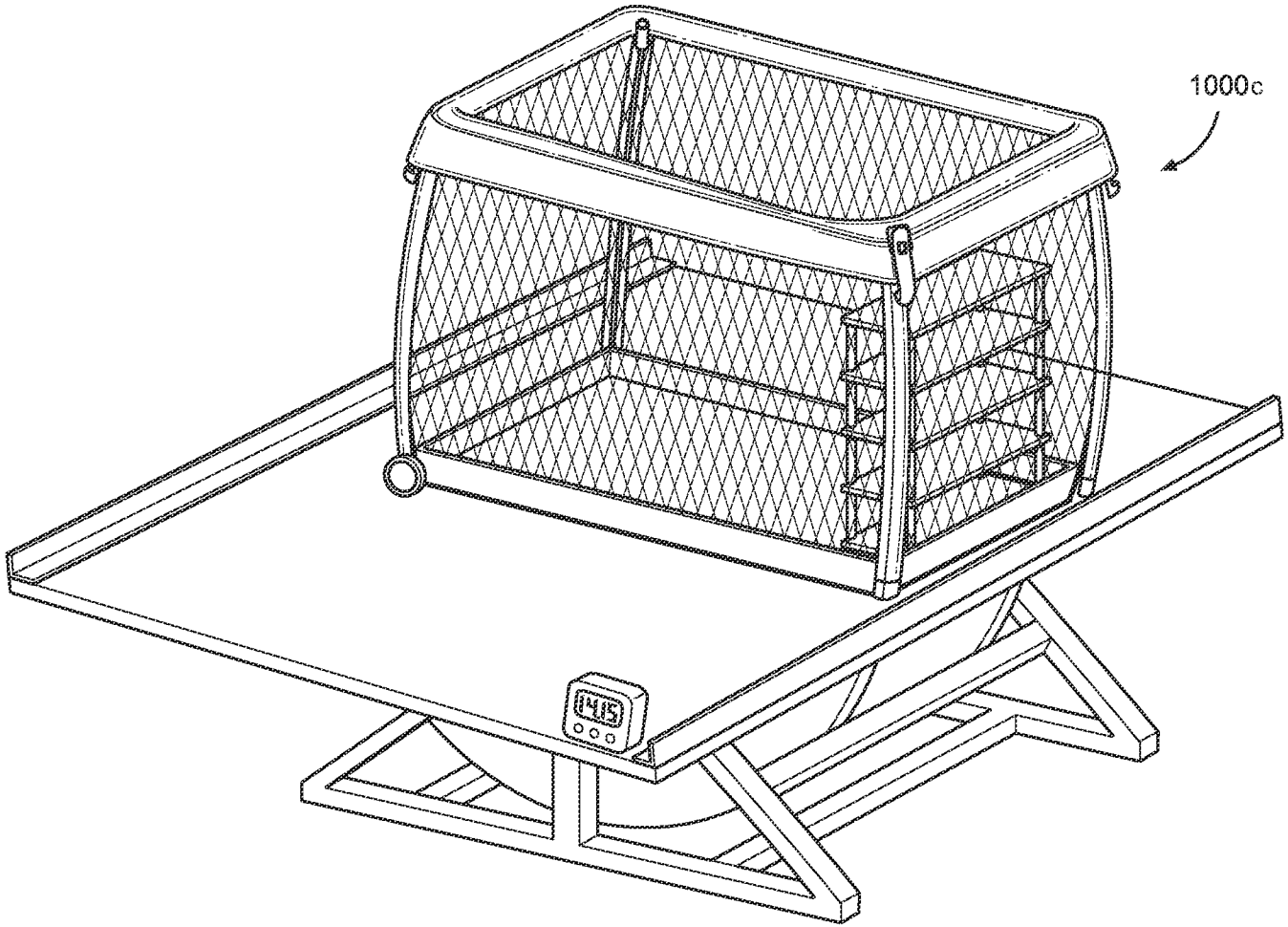
FIG. 31 shows a stability test being performed on the playard of FIG. 23A.

FIG. 31 further shows the playard 1000*c* being subjected to a stability test where the playard 1000*c* was placed onto a platform and a load was applied to one side of the playard 1000*c* from within the partially enclosed space 301. Similar to the playards 1000*a* and 1000*b*, it was found at least three of the feet 114 and/or the wheels 153 of the playard 1000*c* maintained contact with the underlying platform when the playard 1000*c* was rotated more than 10 degrees, thus satisfying the requirements under ASTM F406-19 for stability.

In some implementations, the frame of the foldable playard may also be configured to include clearances (i.e., gaps) between the various rigid components of the frame (e.g., the X-frame tubes, the leg tubes) based, in part, on various consumer safety standards. For example, ASTM F1004-09 specifies the width of a partially bounded opening (e.g., a V-shaped opening or a diamond-shaped opening) should be greater than or equal to 1.5 inches (38 millimeters), otherwise the risks of neck entrapment are considered unacceptable. Furthermore, ASTM F406-19 8.29.1.4 further notes that a probe having a 1.5 inch by 1.5 inch square face should pass through freely between the various rigid components of the frame, particularly in areas where a hinge is located (e.g., the area where the slider couples an X-frame tube to the leg tube).

Therefore, in some implementations, the rigid components of the frame that define openings sufficiently large enough to fit a child's head in at least one configuration of the playard (e.g., the unfolded configuration) may be separated by gaps greater than or equal to 1.5 inches. In other words, a probe having a 1.5 inch by 1.5 inch square face may readily pass through these openings without being clamped by the rigid components as the configuration of the playard is changed (e.g., between the folded and unfolded configurations). For example, the X-frame tubes of the X-frame assemblies may be coupled to the leg tubes of the leg support assemblies such that no portion of a X-frame tube is separated from a leg tube by a gap less than 1.5 inches. More specifically, the bottom portion of a X-frame tube that is coupled to a leg tube via a slider (e.g., the portion of the X-frame tube 142*a* or 142*b* below the pin joint 145) may be separated from the leg tube by a gap less than 1.5 inches.

In some implementations, the frame may maintain the desired clearances independent of whether the frame is in the folded configuration, the unfolded configuration, or between the folded and unfolded configurations (i.e., the frame is partially folded or unfolded). For example, the X-frame tubes may remain offset from the leg tubes by a gap greater than or equal to 1.5 inches as the frame is transitioning between the folded and unfolded configurations. It should be appreciated the 1.5 inch clearance dimension is exemplary and that the foldable playard may generally conform with other consumer safety standards that specify different clearance dimensions to reduce the risk of neck entrapment.

FIGS. 32A-32E show an exemplary frame 100*d* for the foldable playard 1000*a* that includes sliders 120 and corners 130 with elongated arms 124, 126, 134, and 136 to provide the desired clearances described above. As shown, the frame 100*d* may include multiple leg support assemblies 110*d* and multiple X-frame assemblies 140*a* that define an interior space 102 with a hexagonal cross-sectional shape. However, it should be appreciated the various components of the frame 100*d* may also be adapted for a playard having an interior space 102 with a rectangular or square cross-sectional shape. Each X-frame assembly 140*a* may include the X-frame tubes 142*a* and 142*b*. Each leg support assembly 110*d* may include a leg tube 112, the corner 130, the slider 120, and a foot 114 as described above. Additionally, the frame 100*d* may also include the latch 200*a* to maintain the frame 100*d* in the unfolded configuration. It should be appreciated, however, the other latches disclosed above may also be used in the frame 100*d*.

The arms 124 and 126 of the slider 120 may each have a length, $l_{sr}$, defined as the distance between the base 121 of the slider 120 and the pin joint 146*b* or the pin joint 146*c* where the X-frame tubes 142*a* and 142*b*, respectively, are rotatably coupled to the slider 120. The exposed portions of the X-frame tubes 142*a* and 142*b* located nearest the sliders 120 and, hence, nearest the leg tube 112 are thus separated from the leg tube 112 by a distance greater than or equal to the length, $l_{sr}$, of the arms 124 and 126. The arms 134 and 136 of the corner 130 may also each have a length, $l_{cr}$, defined as the distance between the base 131 of the corner 130 and the pin joint 146*a* or the pin joint 146*d* where the X-frame tubes 142*a* and 142*b*, respectively, are rotatably coupled to the corner 130. Similar to the slider 120, the arms 134 and 136 of the corner 130 may also separate the exposed portions of the X-frame tubes 142*a* and 142*b* nearest the corner 130 from the leg tube 112 by a distance greater than or equal to the length, $l_{cr}$, of the arms 134 and 136.

It should be appreciated the pin joints 146*a*-146*d* are not co-located with the first and second ends 143*a* and 143*b* of the X-frame tubes 142*a* and 142*b*. Thus, the first and second ends 143*a* and 143*b* of the X-frame tubes 142*a* and 142*b* may be separated from the leg tube 112 by a distance less than the respective lengths $l_{sr}$ and $l_{cr}$ of the slider 120 and the corner 130. However, the first and second ends 143*a* and 143*b* may remain disposed within the recessed openings 124*a* and 126*a* of the slider 120 and 134*a* and 136*a* of the corner 130 (see, for example, FIGS. 3C and 3D) when the frame 100*d* is in the folded configuration, the unfolded configuration, or between the folded and unfolded configurations (i.e., partially folded or partially unfolded). Therefore, the exposed portions of the X-frame tubes 142*a* and 142*b* referenced above refer to the portions of the X-frame tubes 142*a* and 142*b* located outside the recessed openings 124*a*, 126*a*, 134*a*, and 136*a*.

Since the X-frame tubes 142*a* and 142*b* only rotate relative to the slider 120 and the corner 130 about the pin joints 146*a*-146*d*, the gap between the exposed portions of the X-frame tubes 142*a* and 142*b* and the leg tube 112 may remain greater than or equal to the lesser of the lengths $l_{sr}$ and $l_{cr}$ when the frame 100*d* is fully folded, fully unfolded, or partially folded or unfolded. Therefore, in some implementations, at least one of the lengths $l_{sr}$ and $l_{cr}$ may be greater than or equal to 1.5 inches to comply with, for example, ASTM F406-19 and ASTM F1004-09.

In some implementations, the lengths $l_{sr}$ and $l_{cr}$ of the arms 124, 126 and 134, 136, respectively, may be equal. For example, sliders 120 and corners 130 with equal length arms may simplify manufacture and assembly of the frame 100*e*. However, it should be appreciated that, in some implementations, the lengths $l_{sr}$ and $l_{cr}$ of the arms 124, 126 and 134, 136, respectively, may not be equal. If the lengths $l_{sr}$ and $l_{cr}$ are not equal, the greater of the lengths $l_{sr}$ and $l_{cr}$ may limit the overall size of the frame 100*d* especially in the folded configuration. For example, the length $l_{sr}$ of the arms 124 and 126 may be tailored to be greater than the length $l_{cr}$ of the arms 134 and 136 in order to flare out the leg support assemblies 110*d* when the frame 100*d* is unfolded.

Figure 32A:
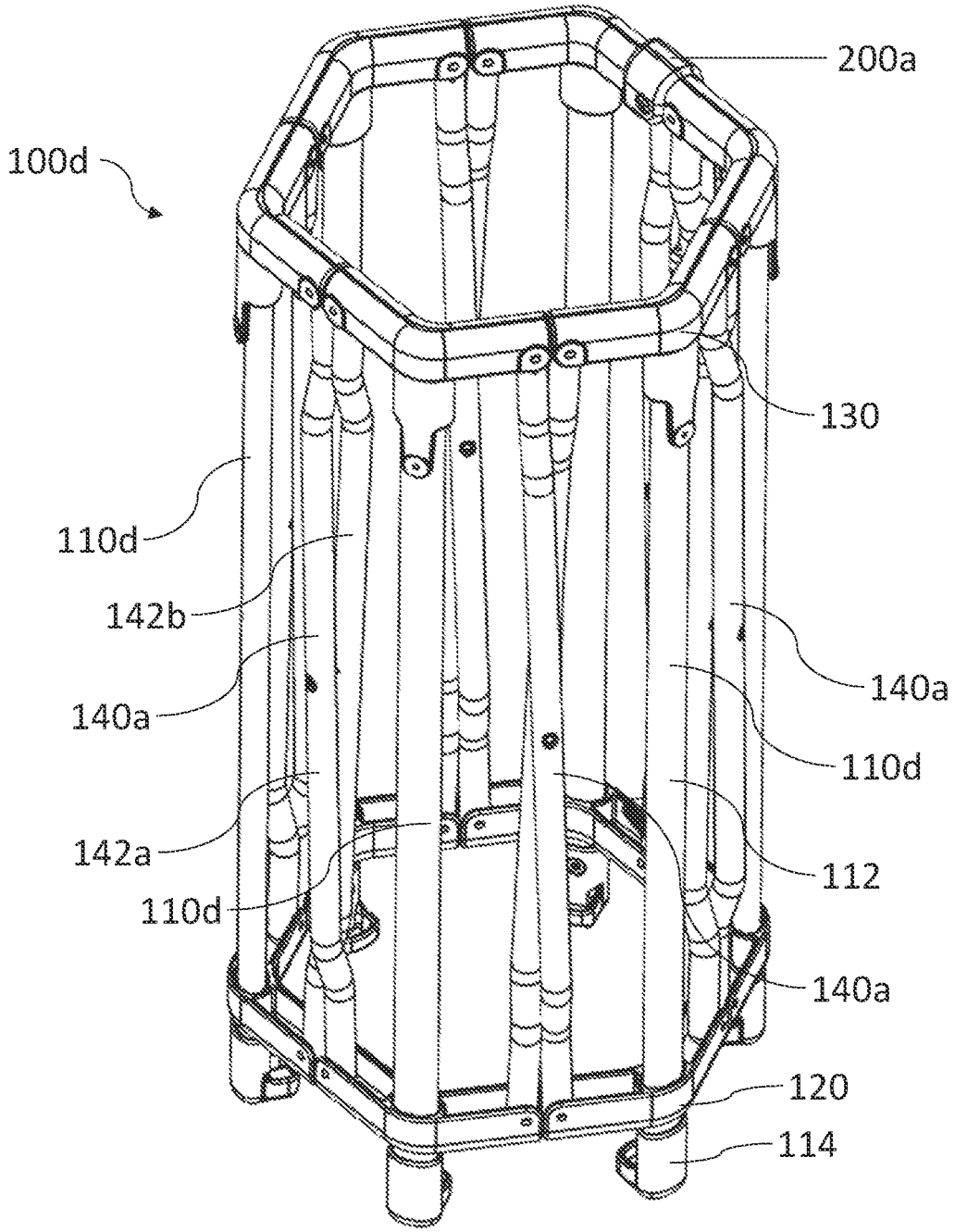
FIG. 32A shows a top perspective view of an exemplary playard forming a hexagonal-shaped interior space with elongated sliders and corners. The playard is shown in a folded configuration.
Figure 32B:
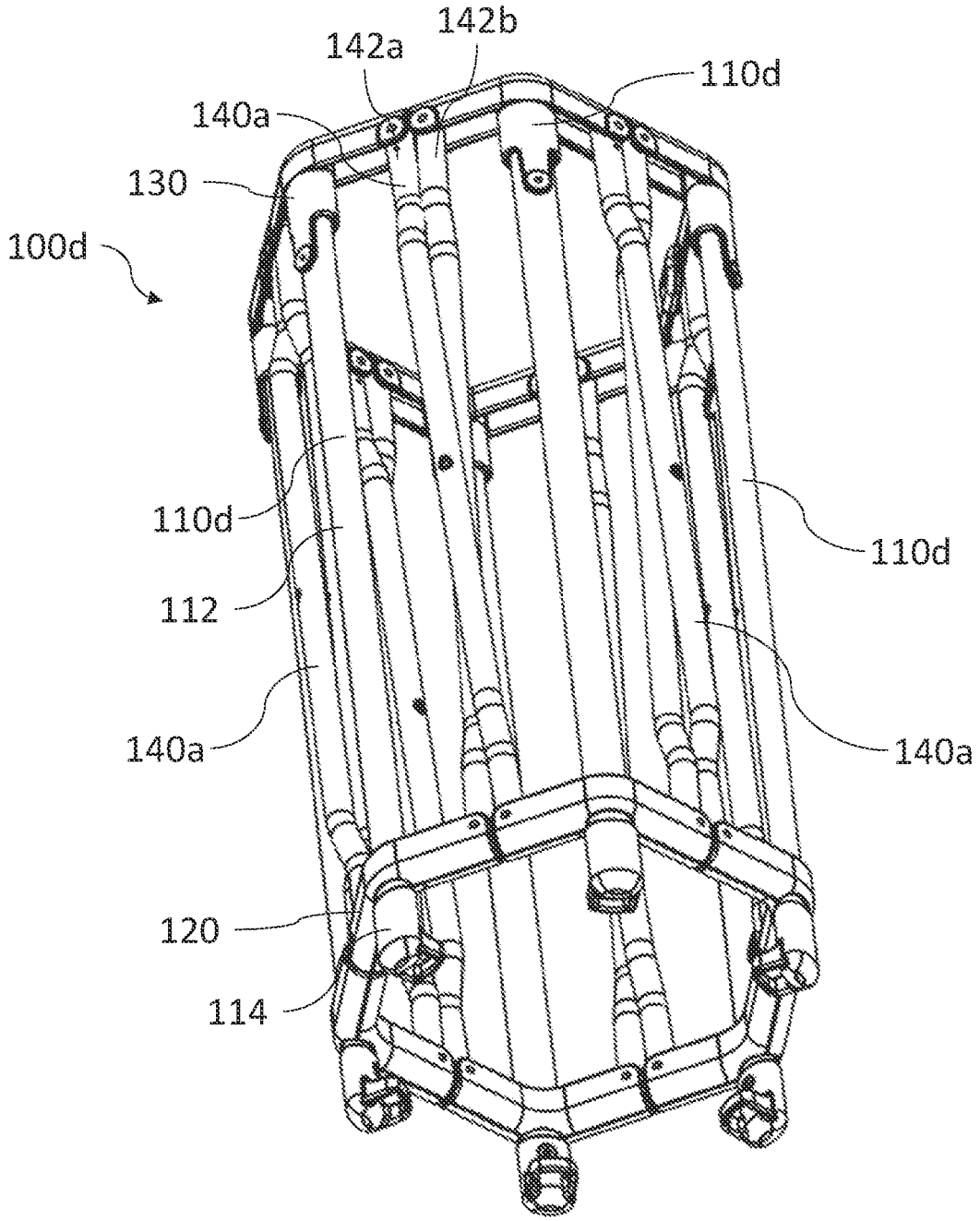
FIG. 32B shows a bottom perspective view of the playard of FIG. 32A.
Figure 32C:
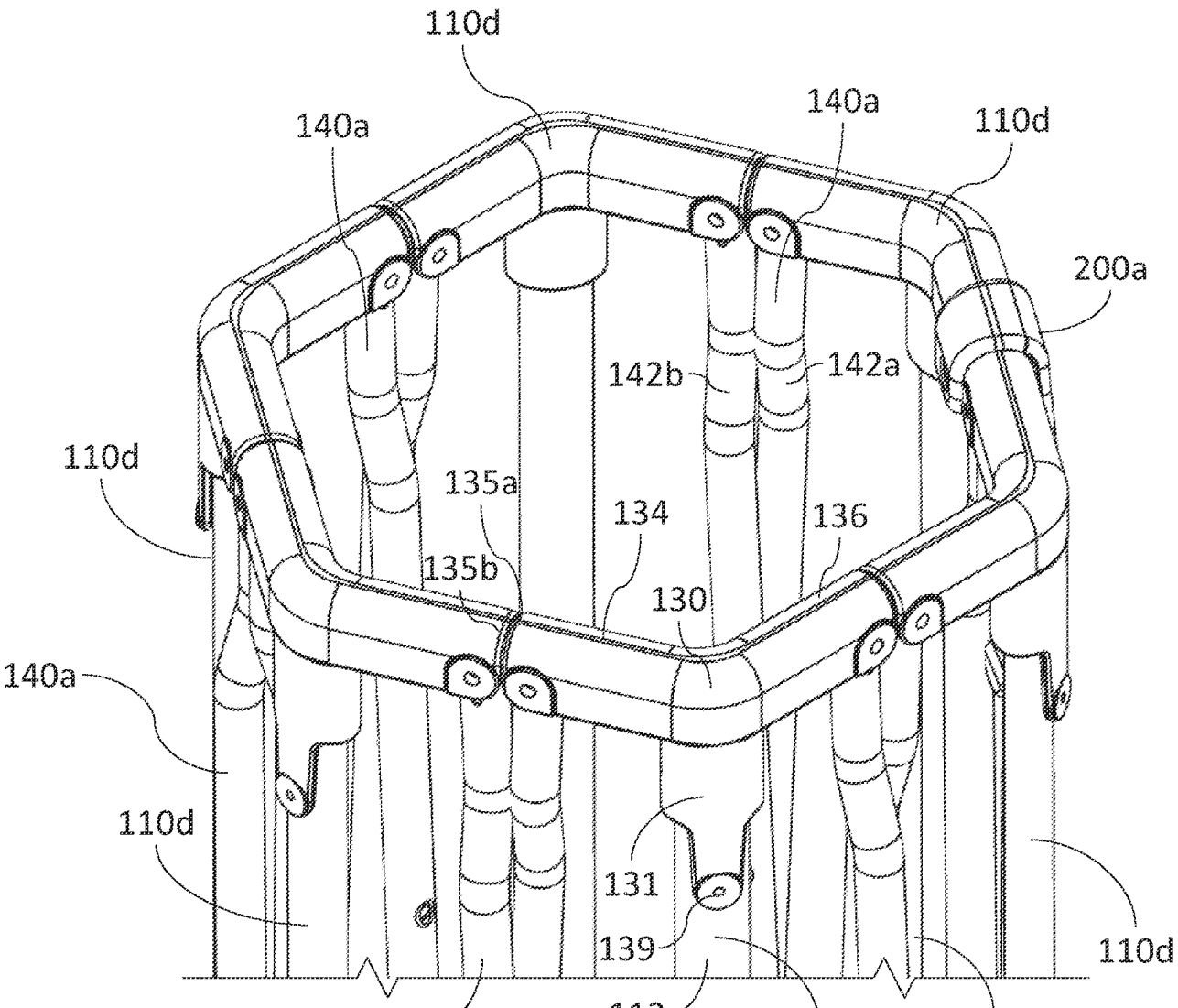
FIG. 32C shows a magnified perspective view of a top portion of the playard of FIG. 32A.
Figure 32D:
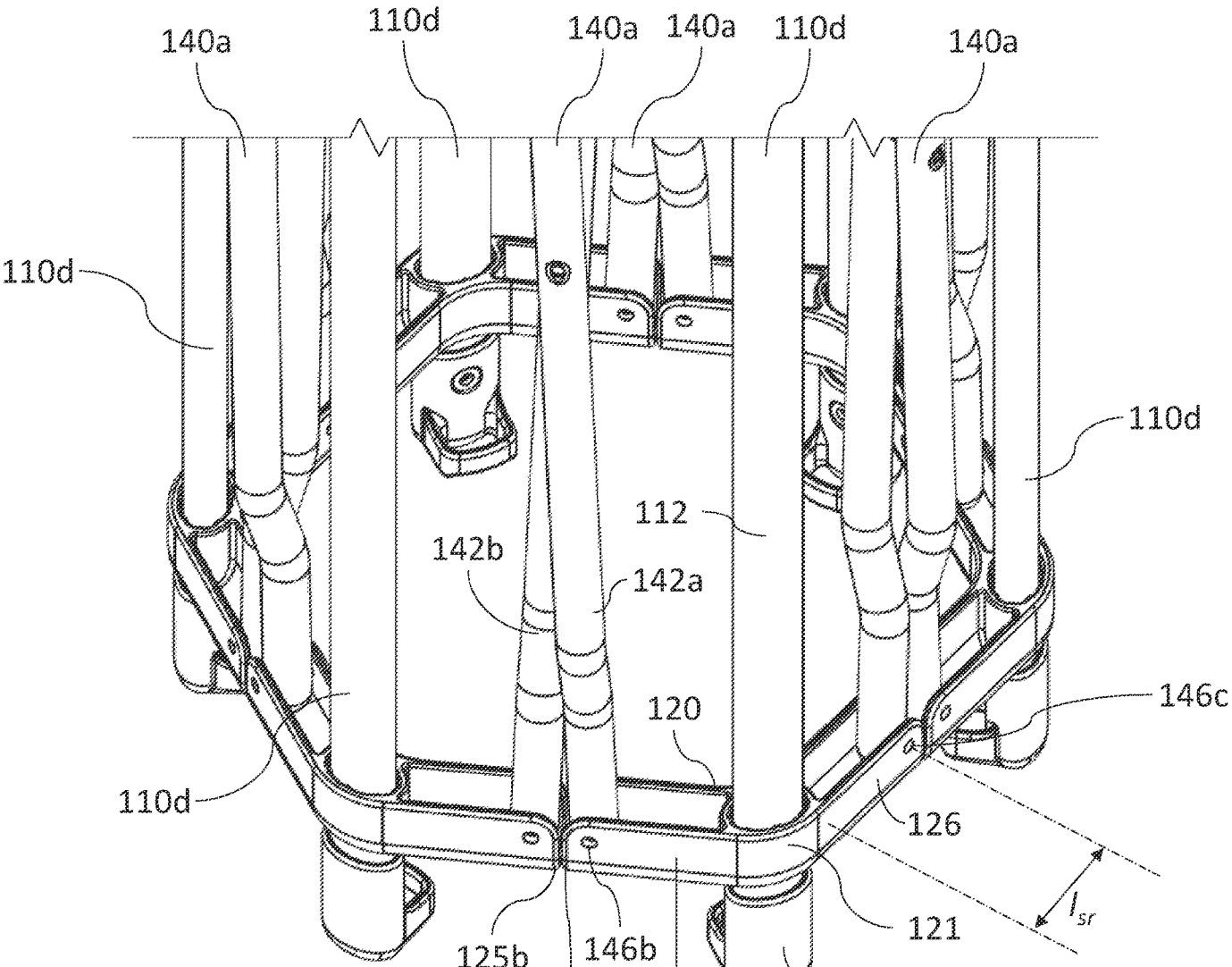
FIG. 32D shows a magnified perspective view of a bottom portion of the playard of FIG. 32A.
Figure 32E:
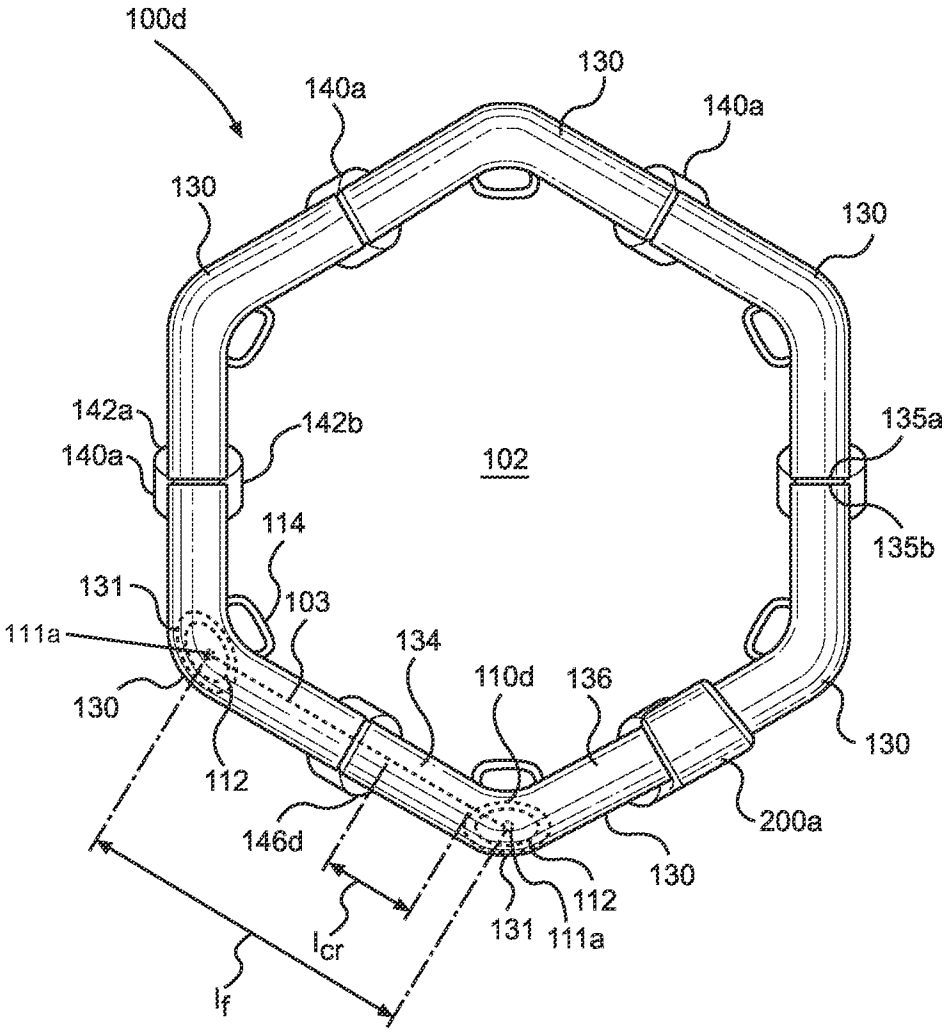
FIG. 32E shows a top view of the playard of FIG. 32A.

FIG. 32E further shows the respective arms 134 or 136 of the corner 130 in one leg support assembly 110*d* may be colinearly aligned (also referred to herein as being "in-line") with the arms 136 or 134, respectively, of the corner 130 in an adjacent leg support assembly 110*d*. Said in another way, an end 135*a* of the arm 134 in one leg support assembly 110*d* may be concentrically aligned with an end 135*b* of the arm 136 in another leg support assembly 110*d* sharing the same side face 106 as shown in FIGS. 32C and 32E. In some implementations, the ends 135*a* and 135*b* may be disposed proximate to one another or, in some instances, may physically contact each other when the frame 100*d* is folded.

The arms 134 and 136 of the corner 130 may be further aligned to the leg tubes 112 and, in particular, a plane 103 defined by the longitudinal axes 111*a* of each leg tube 112 in adjacent leg support assemblies 110*d*. For example, FIG. 32E shows the arm 134 of one corner 130 and the arm 136 of another adjacent corner 130 may be aligned to the plane 103 such that the plane 103 intersects the end 135*a* of the arm 134 and the end 135*b* of the arm 136. In some implementations, the plane 103 may bisect the respective arms 134 and 136 of the corners 130 that are aligned to the plane 103. Generally, a different plane 103 may be defined for each pair of adjacent leg support assemblies 110*d* in the frame 100*d* and the respective arms of the sliders 120 and the corners 130 may be disposed along corresponding planes 103. Additionally, the longitudinal axes 111*a* may correspond to the centerline axes of the leg tubes 112 and/or the side edges 104 of the interior space 102. The plane 103, in turn, may correspond to the side face 106 of the interior space 102.

The respective arms 124 or 126 of the slider 120 may also be colinearly aligned with the arms 126 or 124, respectively, of the slider 120 in an adjacent leg support assembly 110*d*. For instance, the respective ends 125*a* and 125*b* of the arms 124 and 126 in adjacent sliders 120 may also be disposed proximate to one another as shown in FIG. 32D. In some implementations, the ends 125*a* and 125*b* may physically contact one another in the folded configuration. Furthermore, the arms 124 and 126 of the sliders 120 may be aligned to the plane 103 similar to the arms 134 and 136 of the corners 130. For example, the plane 103 may bisect the respective arms 124 and 126 of the sliders 120 that are aligned to the plane 103.

The colinear alignment between the respective arms 134 and 136 of the corners 130 and/or the respective arms 124 and 126 of the sliders 120 may increase the overall size of the frame 100*d* especially in the folded configuration. For example, FIG. 32E shows a length, if, of one side of the frame 100*d* in the folded configuration may be defined as the distance between the respective longitudinal axes 111*a* of two adjacent leg support assemblies 110*d*. As shown, the length $l_f$ may be at least twice the length of the respective arms 134 and 136 or $2l_{cr}$ assuming the arms 134 and 136 are identical in size and shape. Thus, an increase to the length of the arms 134 and 136 of the corners 130 would approximately double the length of the sides of the frame 100*d*. In other words, tailoring the dimensions of the corners 130 for the purposes of providing greater clearances may generally increase the size of the frame 100*d*. In implementations where the lengths $l_{sr}$ and $l_{cr}$ are not equal, the length $l_f$ of the frame 100*d* may scale according to the greater of the lengths $l_{sr}$ and $l_{cr}$.

In some implementations, the scaling factor between the length $l_f$ of the frame and the respective lengths $l_{sr}$ and $l_{cr}$ of the sliders 120 and the corners 130 may be reduced by modifying the geometry of the sliders 120 and the corners 130 so that the arms 124 and 126 of the sliders 120 and the arms 134 and 136 of the corners 130 are not colinearly aligned with one another. For example, the arm 124 of one slider 120 and the arm 126 of an adjacent slider 120 may be offset from the plane 103 such that the respective arms 124 and 126 overlap one another in the folded configuration. In this manner, the foldable playard frame may provide the desired clearances while maintaining a compact size particularly in the folded configuration.

In one example, FIGS. 33A-33F show a frame 100*e* for the foldable playard 1000*a* in the unfolded configuration where the respective arms 124 and 126 of the sliders 120 and the respective arms 134 and 136 of the corners 130 are offset in an asymmetric manner. Similar to the frames 100*a* and 100*d*, the frame 100*e* may include multiple leg support assemblies 110*e* and multiple X-frame assemblies 140*c* that define an interior space 102 with a hexagonal cross-sectional shape. However, it should be appreciated the various components of the frame 100*e* may also be adapted for a playard having an interior space 102 with a rectangular or square cross-sectional shape. Each leg support assembly 110*e* may include a leg tube 112, a slider 120, a corner 130, and a foot 114. Each X-frame assembly 140*c* may include a pair of X-frame tubes 142*a* and 142*b* that are rotatably coupled to each other via the pin joint 145 and rotatably coupled to the sliders 120 and the corners 130 of the leg support assemblies 110*e*. Furthermore, the frame 100*e* may include the latch 200*a* to maintain the frame 100*e* in the unfolded configuration. It should again be appreciated that any of the other latches described above may also be used in the frame 100*e*.

Figure 33B:
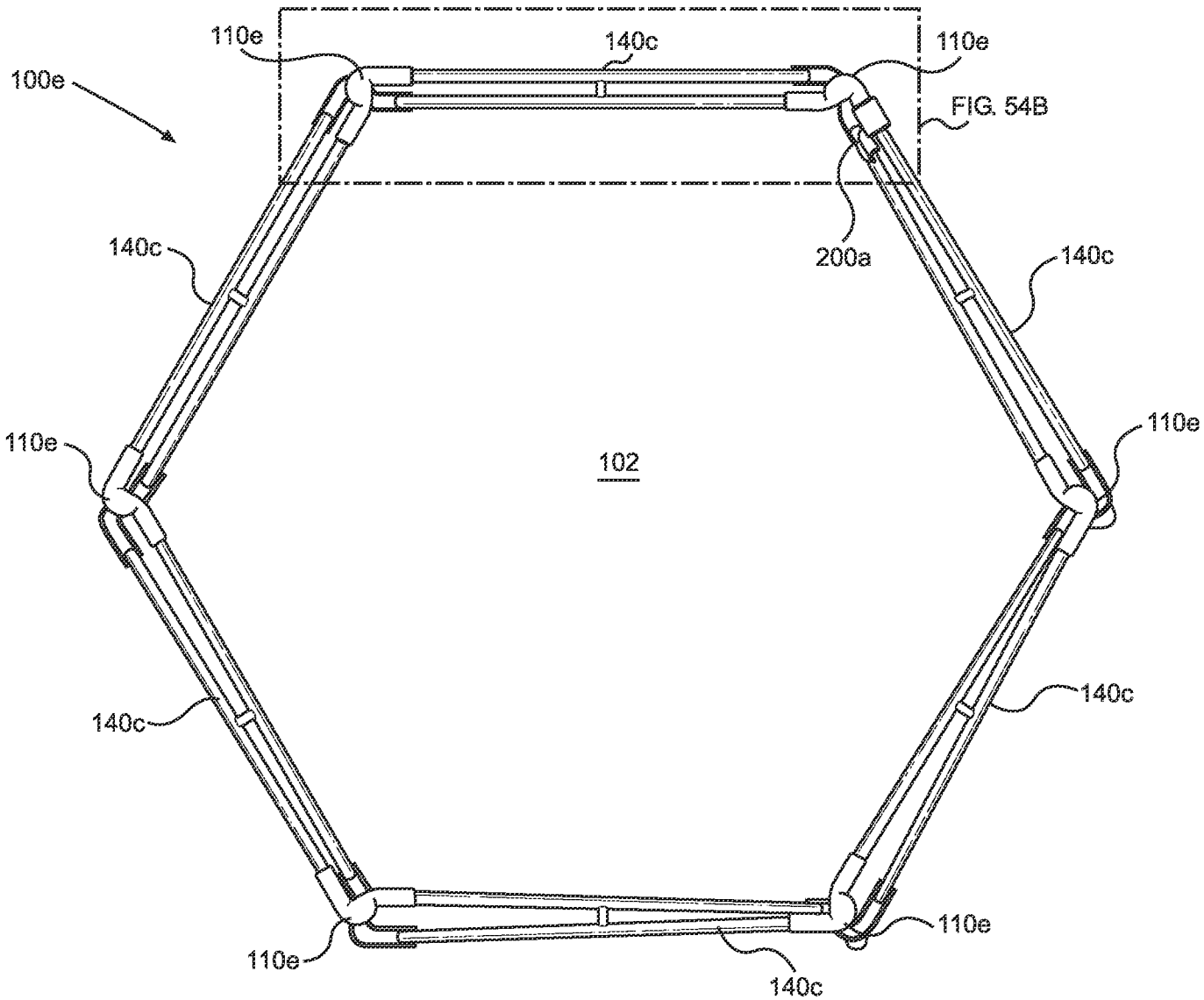
FIG. 33B shows a top view of the playard of FIG. 33A.
Figure 33C:
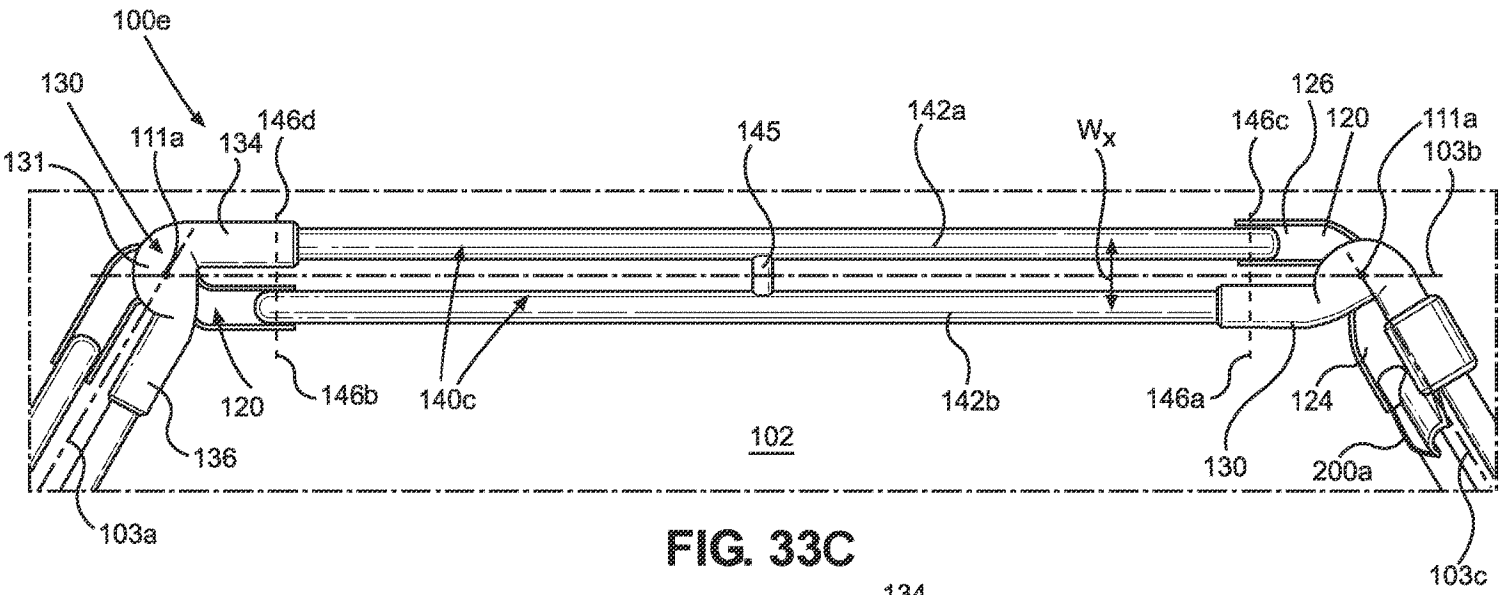
FIG. 33C shows a top view of two leg support assemblies and a X-frame assembly in the playard of FIG. 33A.

As shown in FIG. 33C, the arms 134 and 136 of the corner 130 shown on the left side of FIG. 33C are coupled to a base 131 and offset from the planes 103*b* and 103*a*, respectively, which correspond to adjacent sides of the frame 100*e* that intersect the same longitudinal axis 111*a* of the leg tube 112. In particular, the arm 134 is offset horizontally from the plane 103*b* in an outwards direction (i.e., away from the interior space 102) while the arm 136 is offset horizontally from the plane 103*a* in an inwards direction (i.e., towards the interior space 102). In other words, the arms 134 and 136 are offset in opposite directions from the corresponding planes 103 along which the arms 134 and 136 are disposed, hence, resulting in an asymmetric offset. The arms 124 and 126 of the slider 120 shown on the right side of FIG. 33C are similarly offset from the planes 103*b* and 103*a*, respectively, where the arm 124 is offset horizontally from the plane 103*b* towards the interior space 102 while the arm 126 is offset horizontally from the plane 103*a* away from the interior space 102.

The offsets between the respective arms 124 and 126 of each slider 120 and the offsets between the respective arms 134 and 136 of each corner 130 may be the same for each leg support assembly 110*e* in the frame 100*e*. For example, FIG. 33B shows a portion of the frame 100*e* where three successive sides of the frame 100*e* each have a plane 103 (e.g., planes 103*a*, 103*b*, and 103*c*). The two leg support assemblies 110*e* shown in FIG. 33B may each have sliders 120 and corners 130 with arms offset in a similar manner from the respective planes 103*a*-103*c*. In some implementations, the asymmetric offset between the arms 124 and 126 of the sliders 120 and the arms 134 and 136 of the corners 130 may allow the same slider 120 and corner 130 to be used in each leg support assembly 110*e*.

Figure 33D:
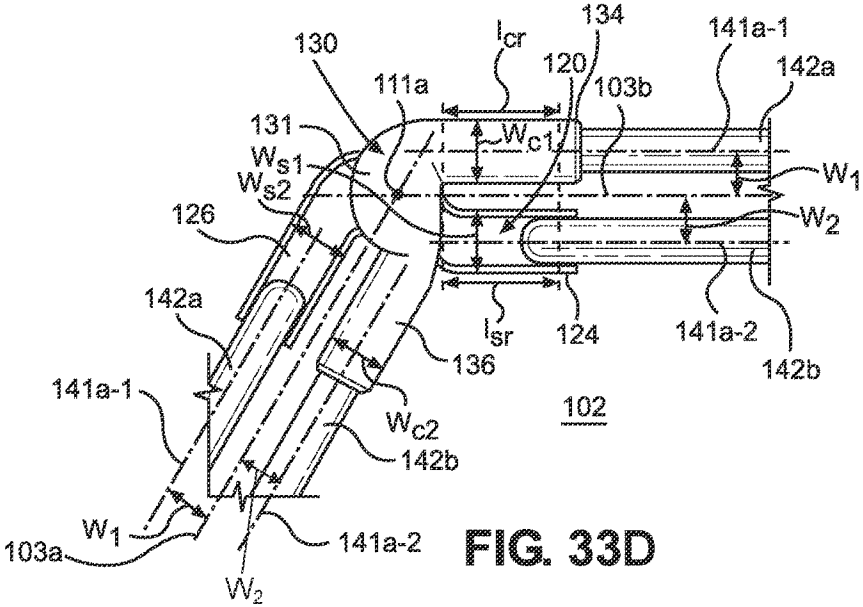
FIG. 33D shows a magnified view of one of the leg support assemblies of FIG. 33C.
Figure 33E:
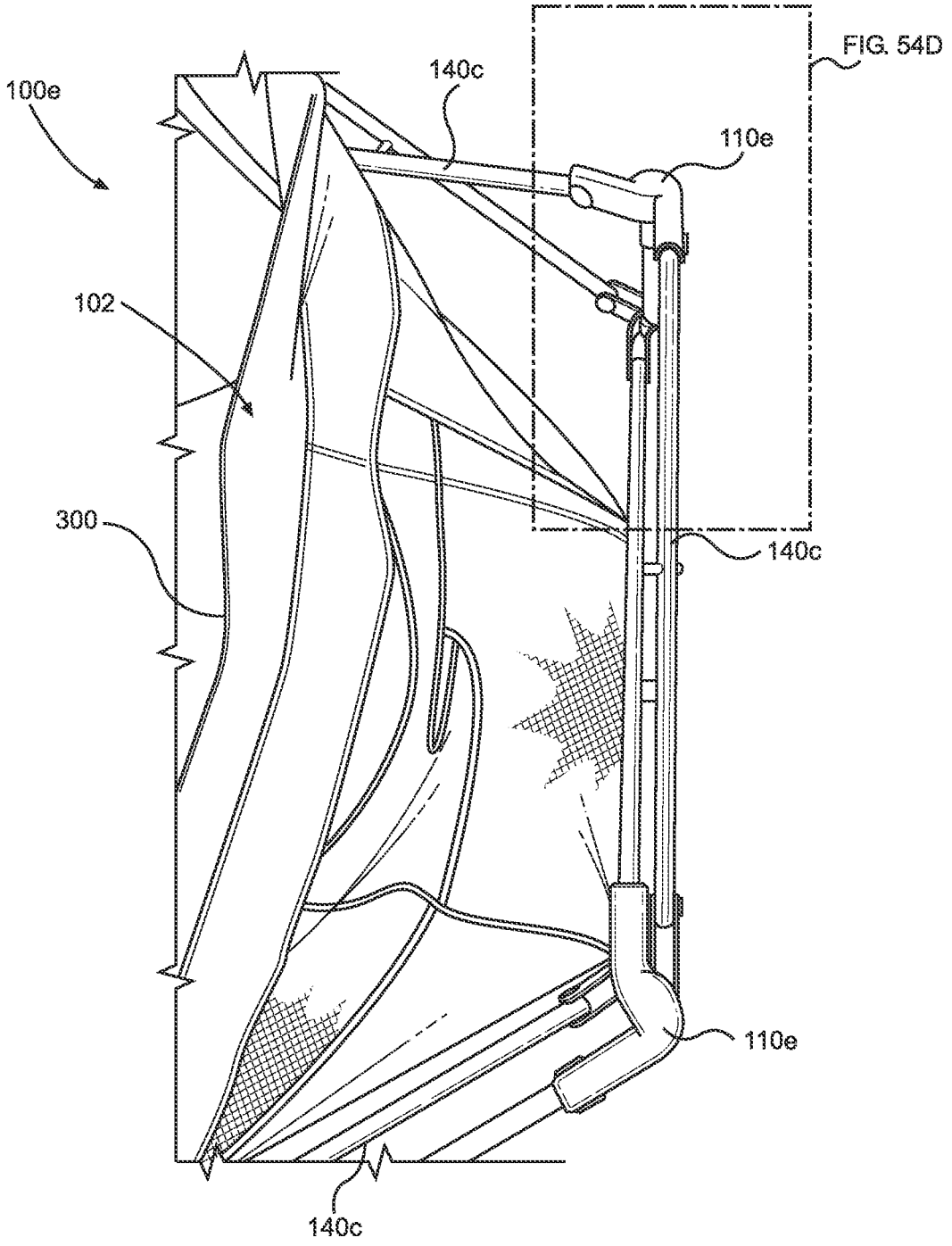
FIG. 33E shows a top perspective view of the leg support assemblies and the X-frame assembly of FIG. 33C.
Figure 33F:
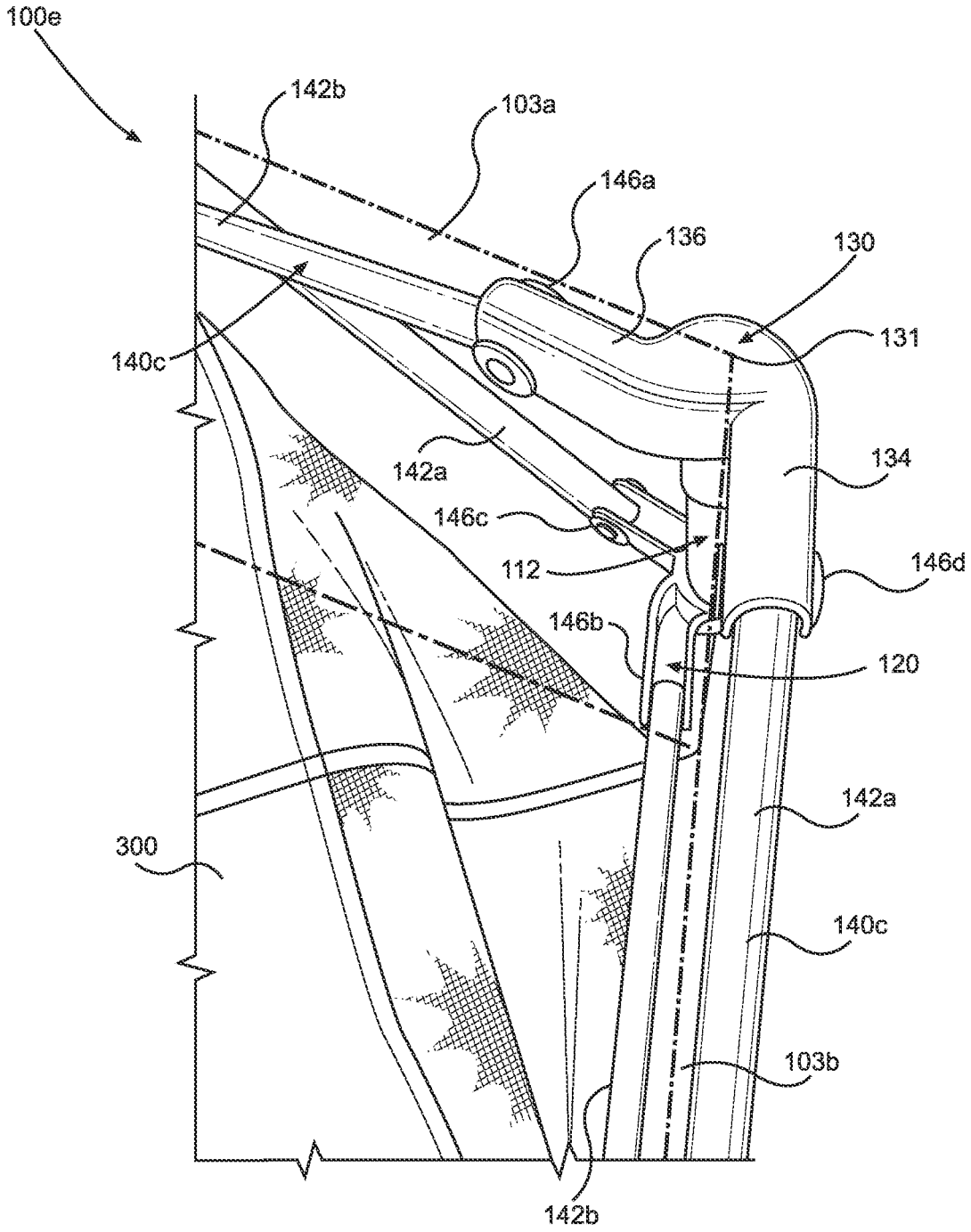
FIG. 33F shows a magnified view of one of the leg support assemblies of FIG. 33E.

FIG. 33D further shows the arm 134 may be offset from the plane 103*b* by an offset distance, $w_1$, which is defined as the distance between the plane 103*b* and a centerline axis 141*a*-1 of the arm 134. The arm 136 may be offset from the plane 103*b* by an offset distance, $w_2$, which is defined as the distance between the plane 103*a* and a centerline axis 141*a*-2 of the arm 136. The centerline axes 141*a*-1 and 141*a*-2 may correspond to the first axes 141*a* of the X-frame tubes 142*a* and 142*b*, respectively. In other words, the respective ends 143*a* and 143*b* of the X-frame tubes 142*a* and 142*b* in the X-frame assembly 140*c* may not lie on the same plane compared to the X-frame tubes 142*a* and 142*b* in the X-frame assembly 140*a*, which may simplify the geometry of the X-frame tubes 142*a* and 142*b* as described below.

Generally, the offset distances $w_1$ and $w_2$ are chosen to provide sufficient space for the arm 134 of one corner 130 to align side-by-side with the arm 136 of an adjacent corner 130 when the frame 100*e* is folded. The arms 124 and 126 of the slider 120 may also be offset from the planes 103*b* and 103*a*, respectively, in a manner similar to the corner 130. In some implementations, the arm 124 may be offset from the plane 103*b* by the offset distance $w_2$ while the arm 126 may be offset from the plane 103*a* by the offset distance $w_1$. By tailoring the offset distances $w_1$ and $w_2$ in this manner, the respective arms 134 and 136 of adjacent corners 130 may overlap one another along the plane 103 and, similarly, the respective arms 124 and 126 of adjacent sliders 120 may overlap one another along the plane 103.

Figure 34A:
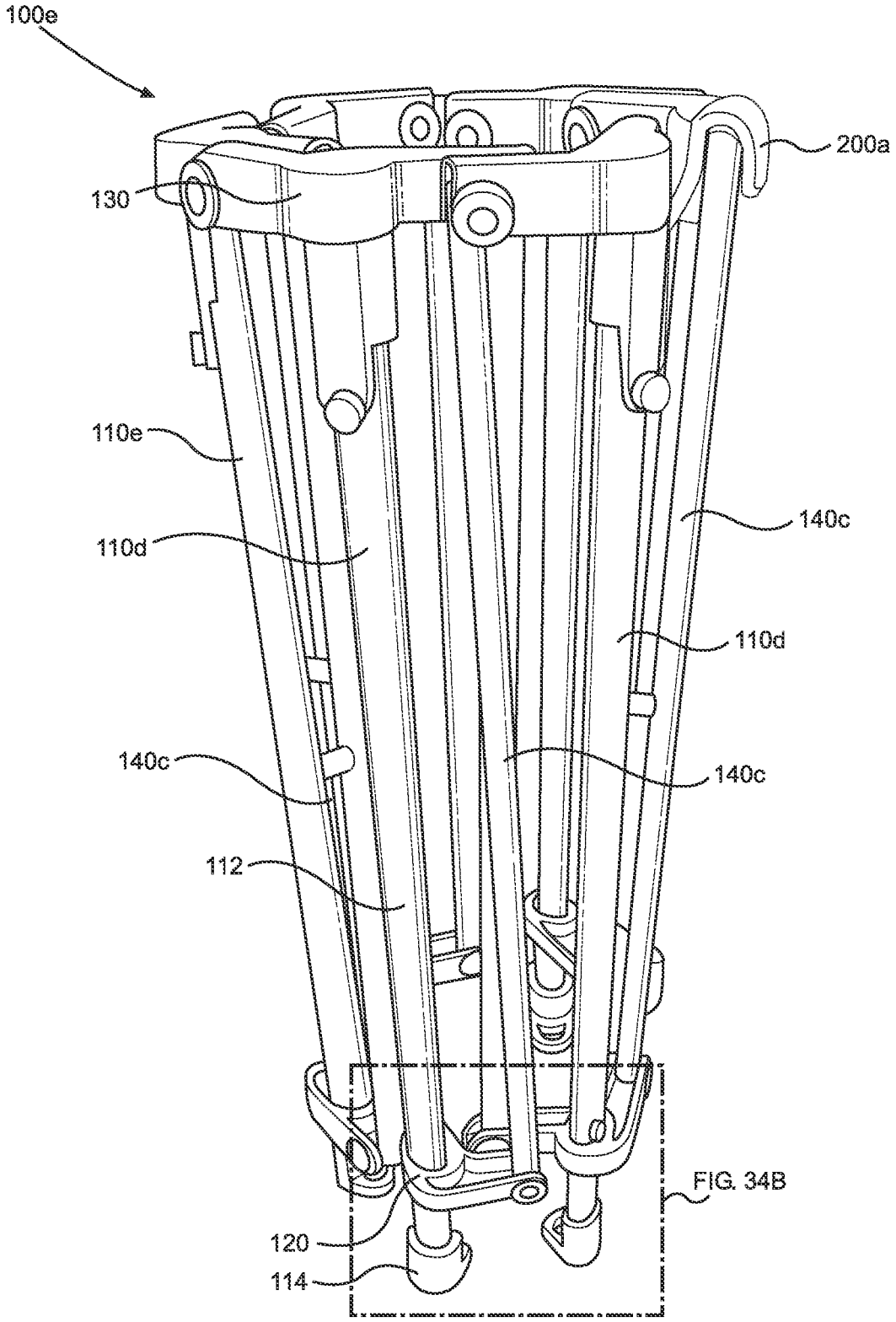
Figure 34B:
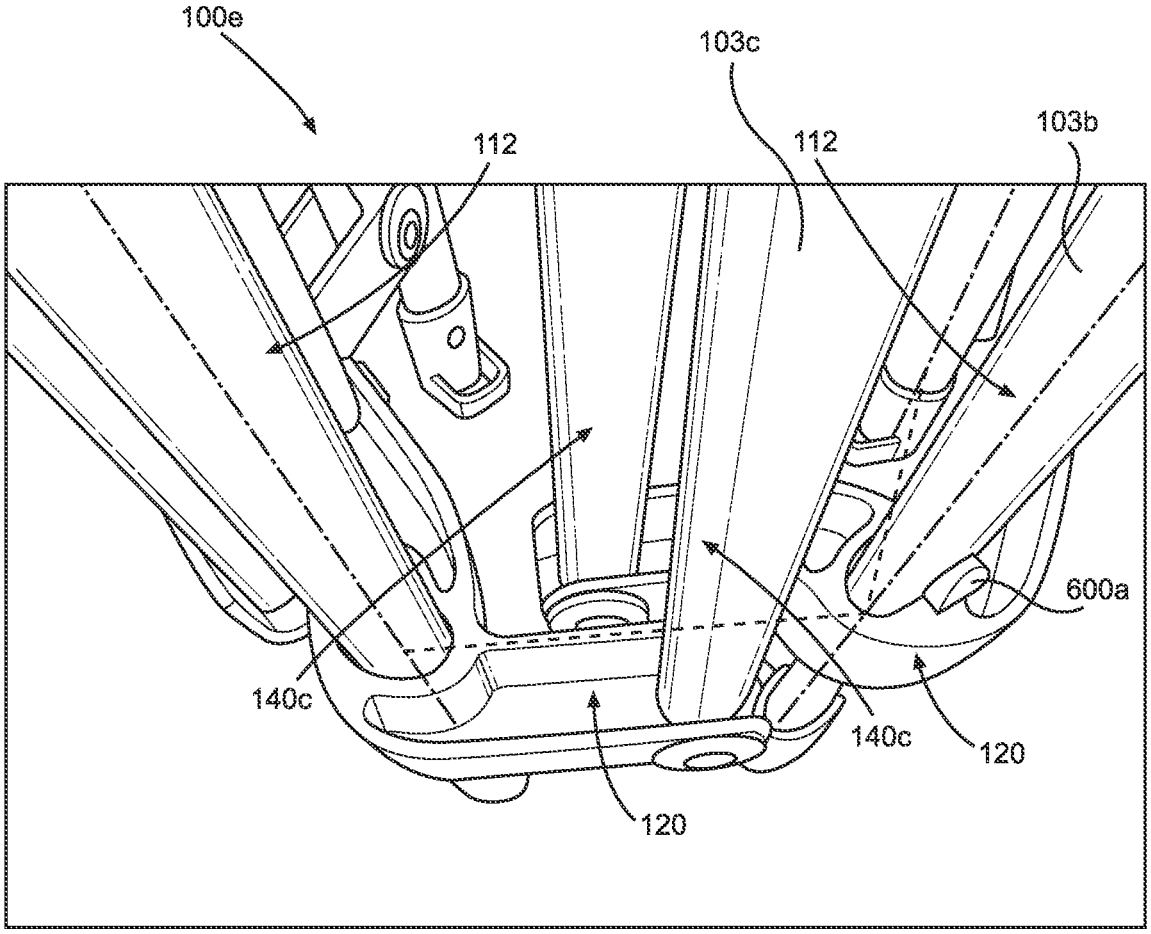
Figure 34C:
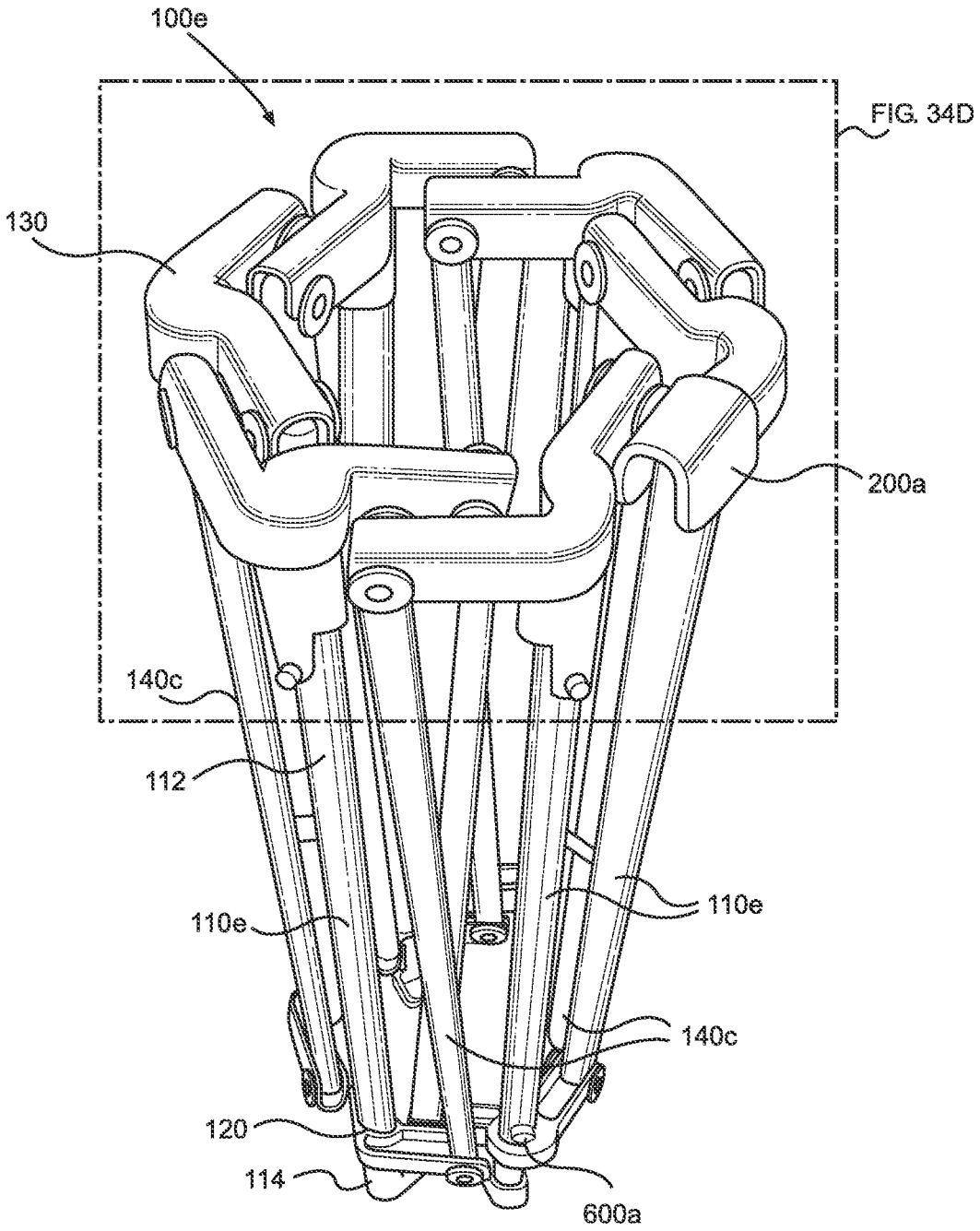
Figure 34D:
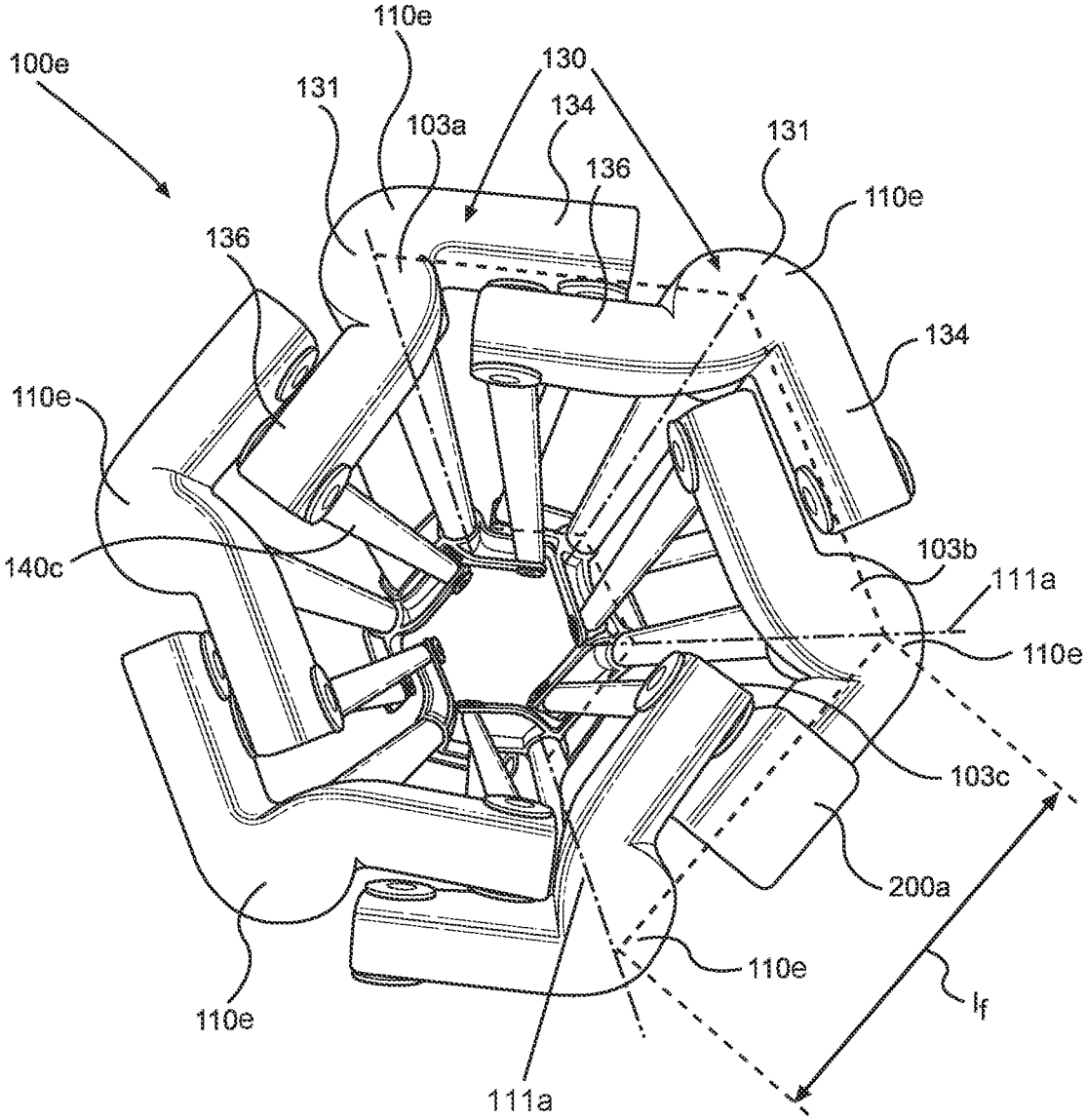

The overlap between the sliders 120 and the corners 130 reduces the overall size of the frame 100*e* especially in the folded configuration. For instance, FIGS. 34A-34D show the frame 100*e* in the folded configuration. In particular, FIGS. 34A and 34B show a portion of the arm 124 of each slider 120 is aligned side by side with a portion of the arm 126 of an adjacent slider 120. Similarly, FIGS. 34C and 34D show a portion of the arm 134 of each corner 130 is aligned side by side with a portion of the arm 136 of an adjacent corner 130. By configuring the sliders 120 and the corners 130 to overlap one another, the respective lengths of the arms 124, 126, 134, and 136 may be increased (e.g., to provide larger clearances) without appreciably increasing the overall size of the frame 100*e*. In other words, the length $l_f$ of each side of the frame 100*e* may be less than twice the length of the respective arms 134 and 136 as shown in FIG. 34D. In some implementations, the length $l_f$ may scale according to the length $l_{cr}$ of one of the arms 134 and 136.

Generally, the offset distance $w_1$ may be greater than or equal to the greater of half the exterior width, $w_{c1}$, of the arm 134 or half the exterior width, $w_{s2}$, of the arm 126. Similarly, the offset distance $w_2$ may be greater than or equal to the greater of half the exterior width, $w_{c2}$, of the arm 136 or half the exterior width, $w_{s1}$, of the arm 124. In some implementations, the offset distances $w_1$ and $w_2$ may be chosen, in part, to accommodate the latch 200*a*, which may have a larger width than the arms 124, 126, 134, or 136. In some implementations, the exterior widths $w_{c1}$ and $w_{s2}$ may be equal. Similarly, the exterior widths $w_{c2}$ and $w_{s1}$ may also be equal. In some implementations, the exterior widths $w_{c1}$ and $w_{c2}$ may further be equal. Thus, the offset distances $w_1$ and $w_2$ may be equal as well. However, it should be appreciated that, in some implementations, the exterior widths $w_{c1}$, $w_{c2}$, $w_{s1}$, and $w_{s2}$ may be different from one another. Additionally, the offset distances for the arms 124, 126, 134, and 136 may be different from one another.

The arms 124 and 126 of the slider 120 may also be offset in an opposite manner to the arms 134 and 136 of the corner 130. Specifically, FIG. 33C shows the arms 124 and 134 are offset from the plane 103*b* in opposite directions while the arms 126 and 136 are offset from the plane 103*a* in opposite directions. This arrangement results in the arms 124 and 136 being aligned to one another along the centerline axis 141*a*-1 and, similarly, the arms 126 and 134 being aligned to one another along the centerline axis 141*a*-2.

Thus, the recessed openings 124*a*, 126*a*, 134*a*, and 136*a* of the sliders 120 and corners 130 are not coplanar with respect to one another in the frame 100*e*. This, in turn, means the X-frame tubes 142*a* and 142*b* of the X-frame assemblies 140*c* may be coupled to the respective sliders 120 and corners 130 without having multiple bends to provide clearances between the X-frame tubes 142*a* and 142*b*. For example, FIGS. 33B and 33D show the X-frame tubes 142*a* and 142*b* may each be a straight tube with a constant cross-section. In some implementations, the X-frame tubes 142*a* and 142*b* may be separated by a lateral offset, $w_x$, equal to the sum of the offset distances $w_1$ and $w_2$. The lateral offset $w_x$ may be chosen to provide sufficient spacing for the respective arms 124, 126, 134, and 136 of the sliders 120 and corners 130 to overlap one another as described above while being sufficiently small to prevent the child from inserting their head laterally between the X-frame tubes 142*a* and 142*b*. For example, the lateral offset, $w_x$, may range between 0.625 inches (e.g., the exterior diameter of the X-frame tubes 142*a* and 142*b*) and 1.5 inches.

Figure 35A:
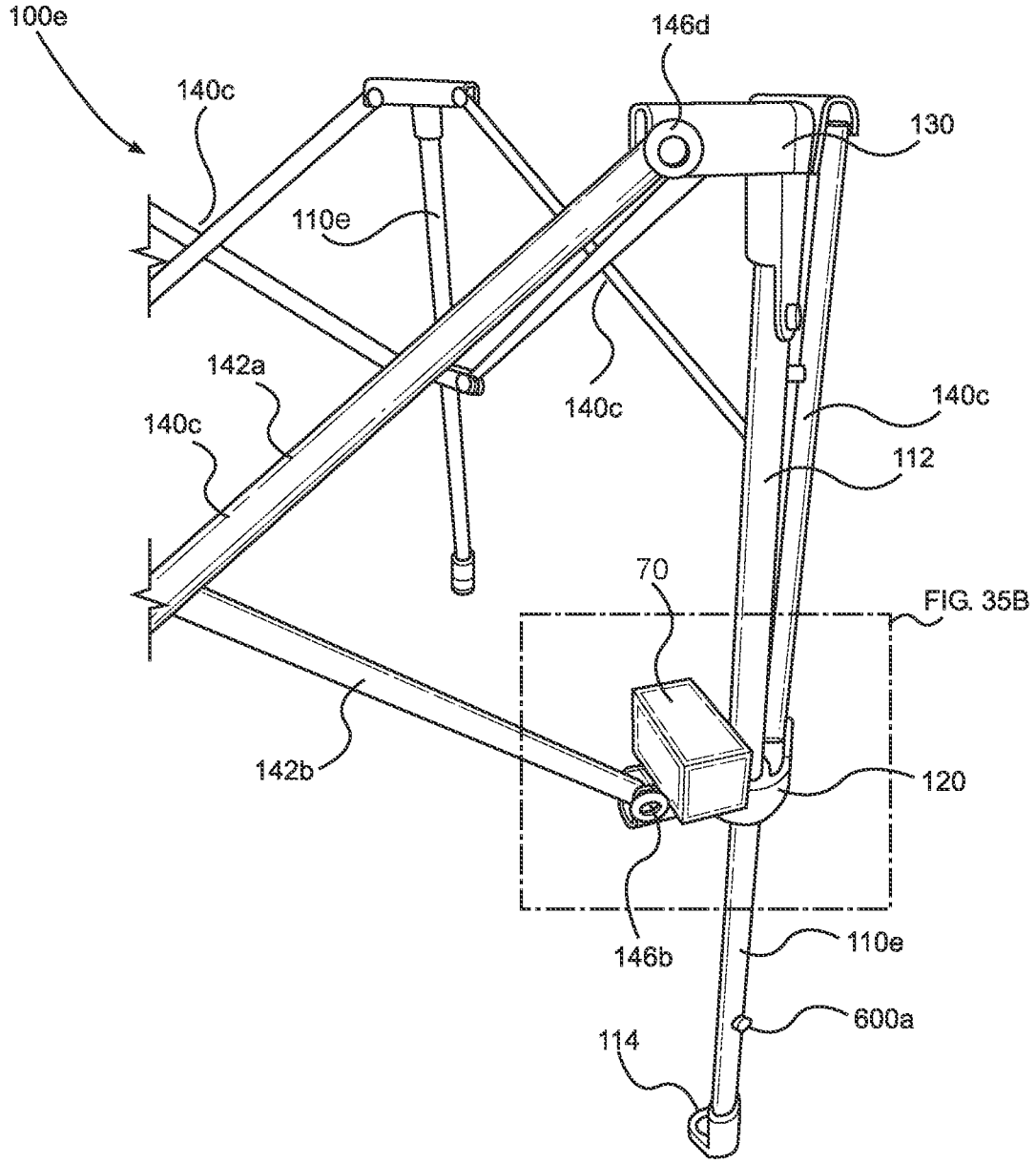
Figure 35B:
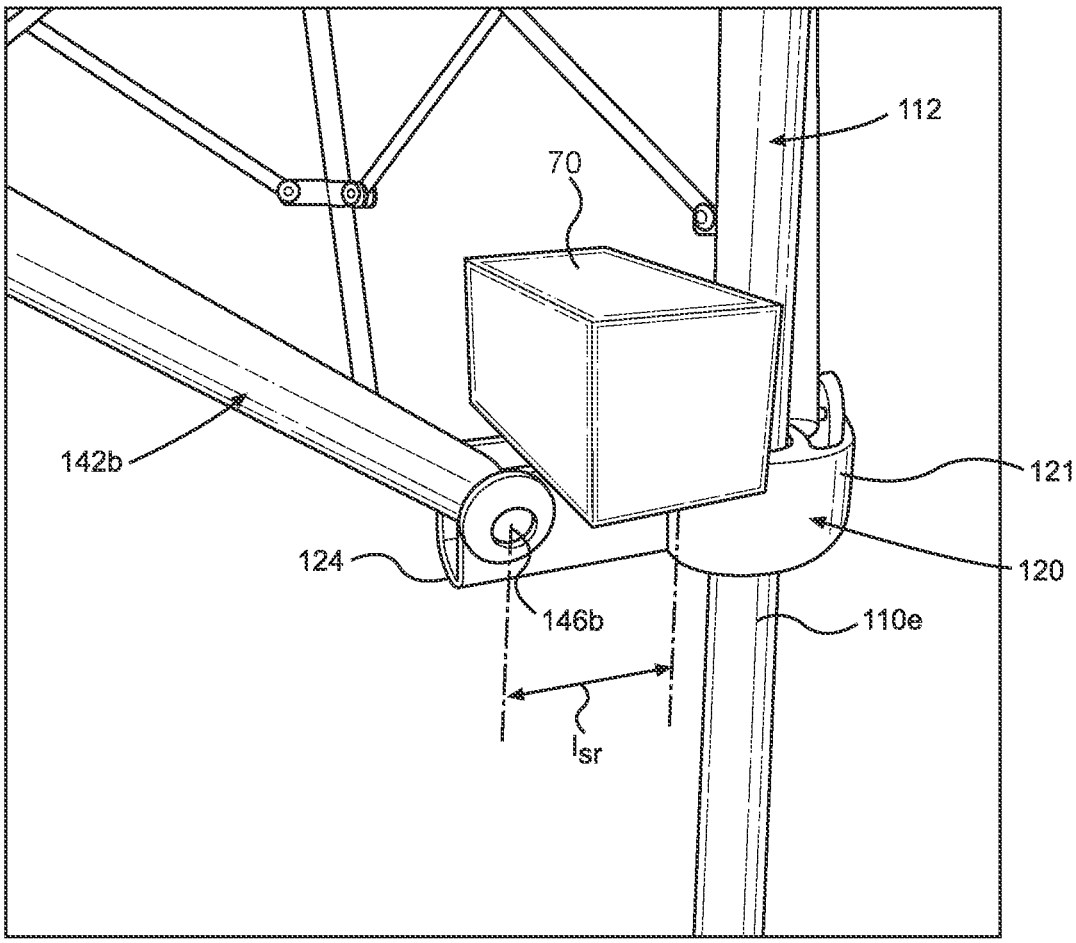

FIGS. 35A and 35B show the frame 100*e* in a partially folded state (or, equivalently, a partially unfolded state). In particular, the frame 100*e* is shown with the probe 70 disposed on the slider 120. The probe 70, as described above, may be used to evaluate the clearances in the playard frame to ensure compliance with ASTM F406-19 and F1004-09. The probe 70 may generally be inserted through any portion of the openings in the frame 100*e* to evaluate the clearances of the frame 100*e*. As shown in FIG. 35B, the probe 70 may rest on the arm 124 of one slider 120 without being clamped by, for example, the X-frame tube 142*b* and the leg tube 112 as the frame 100*e* is folded.

Figure 36A:
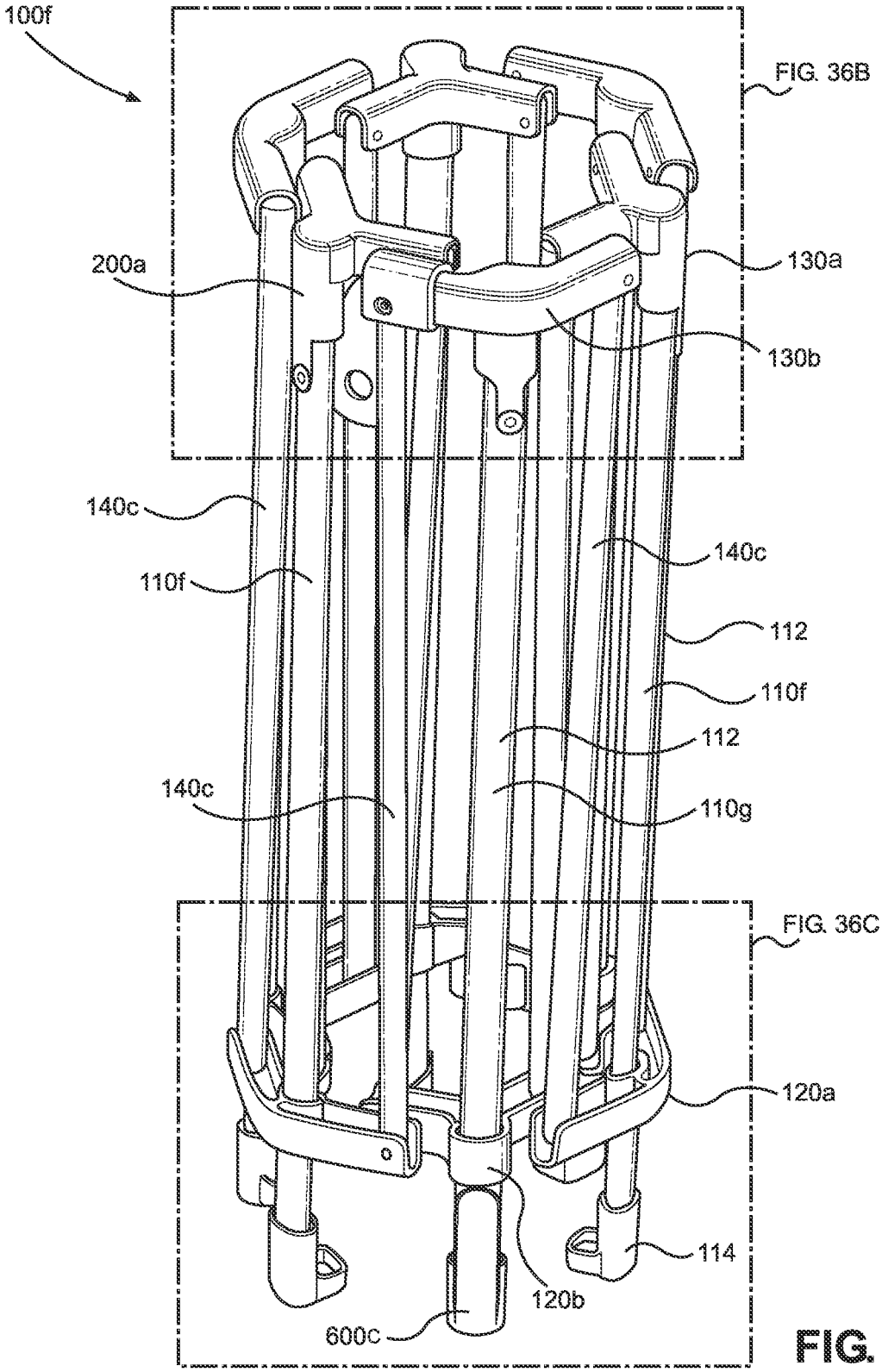
Figure 36B:
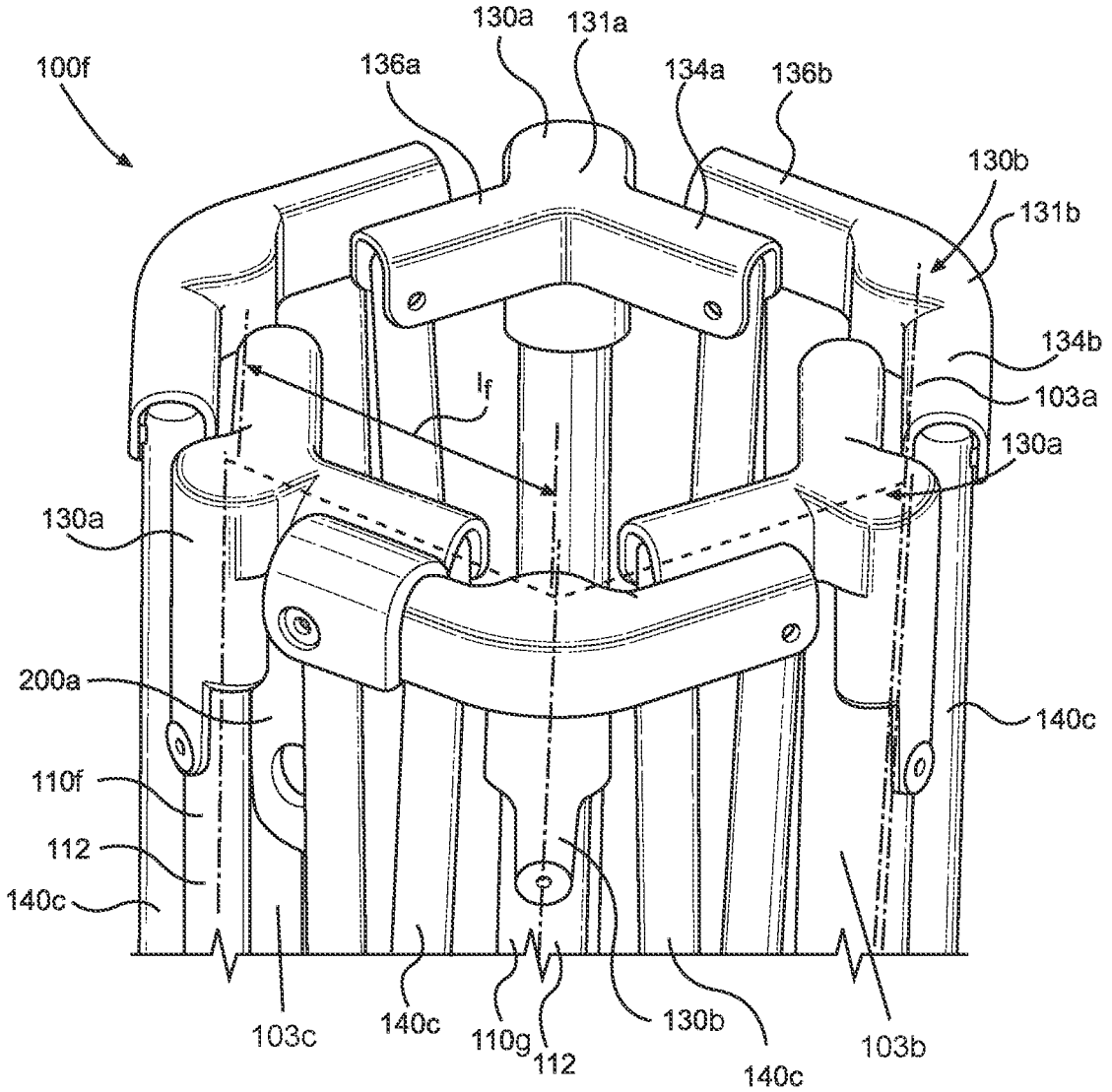
Figure 36C:
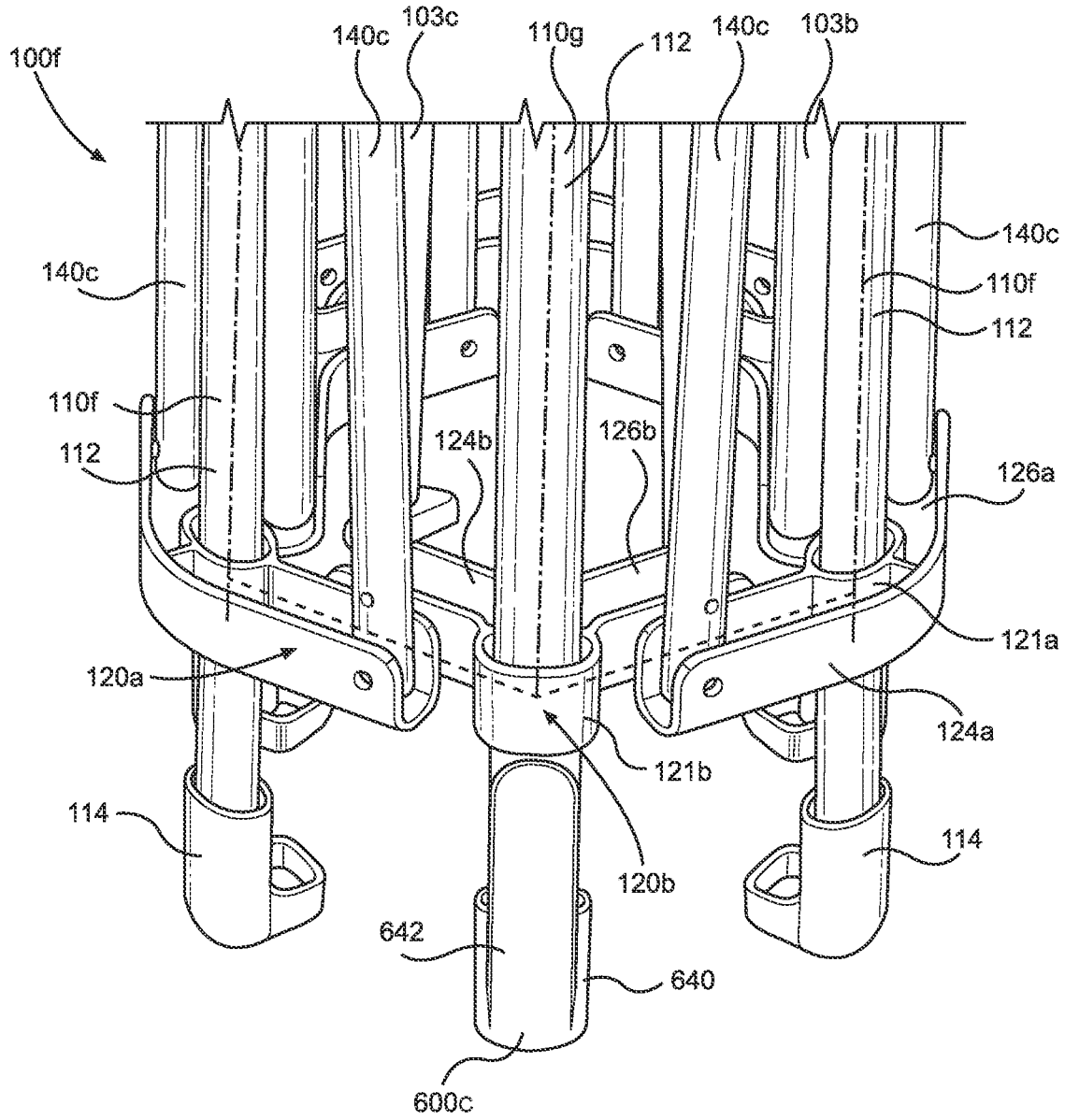

FIGS. 36A-36C show another exemplary frame 100*f* for the foldable playard 1000*a* in the folded configuration where the respective arms (e.g., arms 124*a*, 126*a*, 124*b*, 126*b*) of the sliders and the respective arms (e.g., arms 134*a*, 136*a*, 134*b*, 136*b*) of the corners are symmetrically offset. As shown, the frame 100*f* may include multiple X-frame assemblies 140*c* and multiple leg support assemblies 110*f* and 110*g* that define an interior space 102 with a hexagonal cross-sectional shape. However, it should be appreciated the various components of the frame 100*f* may also be adapted for a playard having an interior space 102 with a rectangular or square cross-sectional shape. The frame 100*f* may further include a latch 200*a* coupled to one leg support assembly 110*g*. However, it should be appreciated any of the latches described above may be used in the frame 100*f*. Furthermore, the latch may be coupled to either of the leg support assemblies 110*f* or 110*g*.

In this implementation, the respective arms of each slider may be offset from the respective planes 103 in the same direction (e.g., towards the interior space 102 or away from the interior space 102). Similarly, the respective arms of each corner may be offset from the respective planes 103 in the same direction (e.g., towards the interior space 102 or away from the interior space 102). In order for adjacent sliders and/or corners to overlap one another, the leg support assemblies 110*f* and 110*g* may include different sliders and corners with arms that are offset in different directions.

For example, FIG. 36B shows the leg support assemblies 110*f* may include corners 130*a* with arms 134*a* and 136*a* that are both offset from the respective planes 103 towards the interior space 102. The leg support assemblies 110*g* may include corners 130*b* with arms 134*b* and 136*b* that are both offset from the respective planes 103 away from the interior space 102. The leg support assemblies 110*f* and 110*g* may thus alternate in successive fashion around the frame 100*f* such that each leg support assembly 110*f* is adjacent to two leg support assemblies 110*g* and each leg support assembly 110*g* is adjacent to two leg support assemblies 110*f*. In this manner, the arms 134*a* and 136*a* of the corners 130*a* may overlap with the arms 136*b* and 134*b*, respectively, of the corners 130*b*.

FIG. 36C further shows the leg support assemblies 110*f* may include sliders 120*a* with arms 124*a* and 126*a* that are both offset from the respective planes 103 away from the interior space 102. Likewise, the leg support assemblies 110*g* may include sliders 120*b* with arms 124*b* and 126*b* that are both offset from the respective planes 103 towards the interior space 102. Similar to the corners 130*a* and 130*b*, the alternating manner in which the leg support assemblies 110*f* and 110*g* are arranged in the frame 100*f* ensures the arms 124*a* and 126*a* of the sliders 120*a* overlap with the arms 126*b* and 124*b*, respectively, of the sliders 120*b*.

Similar to the frame 100*e*, the sliders 120*a* and 120*b* may have arms that are offset in an opposite manner to the corners 130*a* and 130*b* to align respective arms of the sliders 120*a* and 120*b* and the corners 130*a* and 130*b* along the first axes 141 of each X-frame tube 142*a* or 142*b*. For example, the arm 134*a* may be aligned to the arm 126*b*, the arm 136*a* may be aligned to the arm 124*b*, the arm 134*b* may be aligned to the arm 126*a*, and the arm 136*b* may be aligned to the arm 124*a*. This allows straight X-frame tubes 142*a* and 142*b* with constant cross-sections to be used to couple the leg support assemblies 110*f* and 110*g* together.

The various dimensions described above with respect to the frame 100*e* may also be the same for the frame 100*f*. These dimensions include, but are not limited to, the exterior widths of the respective arms of the sliders 120*a* and 120*b* and corners 130*a* and 130*b* (e.g., the widths $w_{s1}$, $w_{s2}$, $w_{c1}$, and $w_{c2}$), the offset distances from the respective planes 103 (e.g., the offset distances $w_1$ and $w_2$), the lengths of the respective arms, (e.g., the lengths $l_{sr}$ and $l_{cr}$), and the total length of the sides of the frame (e.g., the length $l_f$). For brevity, these values are not repeated here.

In some implementations, the foldable playard frame may include a storage latch to lock and/or maintain the frame in the folded configuration. The storage latch may provide an additional safety feature to reduce the exposure of a child to a partially folded or partially unfolded frame (i.e., the frame is between the folded and unfolded configurations). For example, the storage latch may reduce the likelihood of or, in some instances, prevent the child from unfolding and, subsequently, refolding the frame.

Generally, the storage latch may be separate from the latches described above to lock and/or maintain the frame in the unfolded configuration. In some implementations, the foldable playard frame may include one or more storage latches disposed on one or more leg support assemblies. For example, the frame may include storage latches coupled to respective leg support assemblies disposed on opposing sides and/or corners of the frame. For instance, the pin joints that couple the various components of the leg support assemblies and the X-frame assemblies together may be sufficiently loose such that one portion of the frame can be partially unfolded to such an extent that a child can insert their head through an opening formed in the partially unfolded portion of the frame without appreciably unfolding other portions of the frame. The inclusion of multiple storage latches may thus prevent any one portion of the frame from being partially unfolded in the manner described above.

However, in other implementations, a single latch may be sufficient to lock the frame in the folded configuration. For example, FIGS. 34B and 34C show the frame 100*e* may include a single storage latch 600*a* coupled to one leg support assembly 110*e* to lock and/or maintain the frame 100*e* in the folded configuration. In some implementations, the single storage latch may be configured to withstand a load greater than or equal to 10 lbs. For example, a caregiver attempting to unlock the storage latch in an undesirable manner (e.g., by pulling on the slider 120, leg tube 112, or the X-frame tubes 142*a* or 142*b*) would have to apply a force greater than or equal to 10 lbs. to forcibly disengage the storage latch. The inclusion of a single latch may further simplify the assembly of the frame and reduce costs by reducing the number of parts in the frame.

In some implementations, the storage latch may allow the caregiver to fold and lock the playard in the folded configuration using a single hand. For example, the storage latch may be engaged and/or disengaged without the use of any tools. Instead, the storage latch may be actuated directly by the caregiver's hand. In another example, the storage latch may automatically engage when the caregiver folds the frame. For example, the caregiver may move the slider of one leg support assembly towards the foot during which the storage latch may automatically engage without the user having to separately actuate the storage latch. In this manner, the caregiver may only move the slider to fold and lock the frame. When unfolding the frame, the caregiver may actuate the storage latch and thereafter move the slider.

The storage latch may generally be coupled to the leg tube of the leg support assembly and disposed on or near the slider when the frame is in the folded configuration. For example, the slider may be disposed near a bottom end of the leg tube in the folded configuration. Thus, the storage latch may be rigidly coupled to the leg tube and disposed near the bottom end of the leg tube proximate to or, in some instances, abutting the foot of the leg support assembly such that the storage latch is near the slider in the folded configuration.

In some implementations, the storage latch, when engaged, provides a barrier that physically contacts the slider of the leg support assembly in order to prevent the slider from moving towards the corner and, hence, prevent the frame from being unfolded. When the storage latch is actuated by the caregiver, the barrier is removed, thus allowing the caregiver to move the slider upwards along the leg tube to unfold the frame. In some implementations, the storage latch may be adapted to the shape and/or dimensions of the slider. In other words, the frame may not require a slider that is modified to accommodate the storage latch. Rather, the same slider may be used in the leg support assemblies independent of whether the leg support assembly includes the storage latch.

Figure 37A:
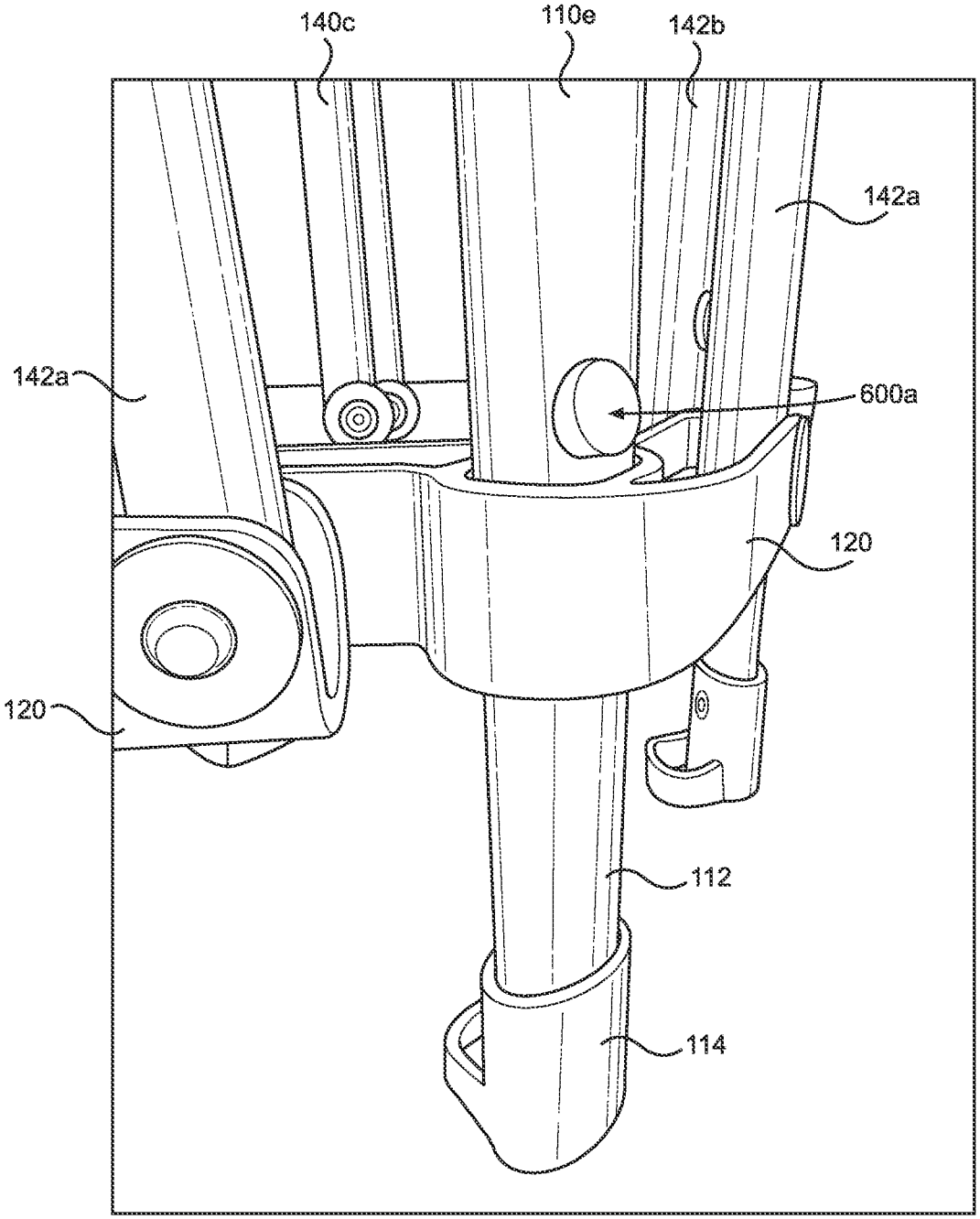
Figure 37B:
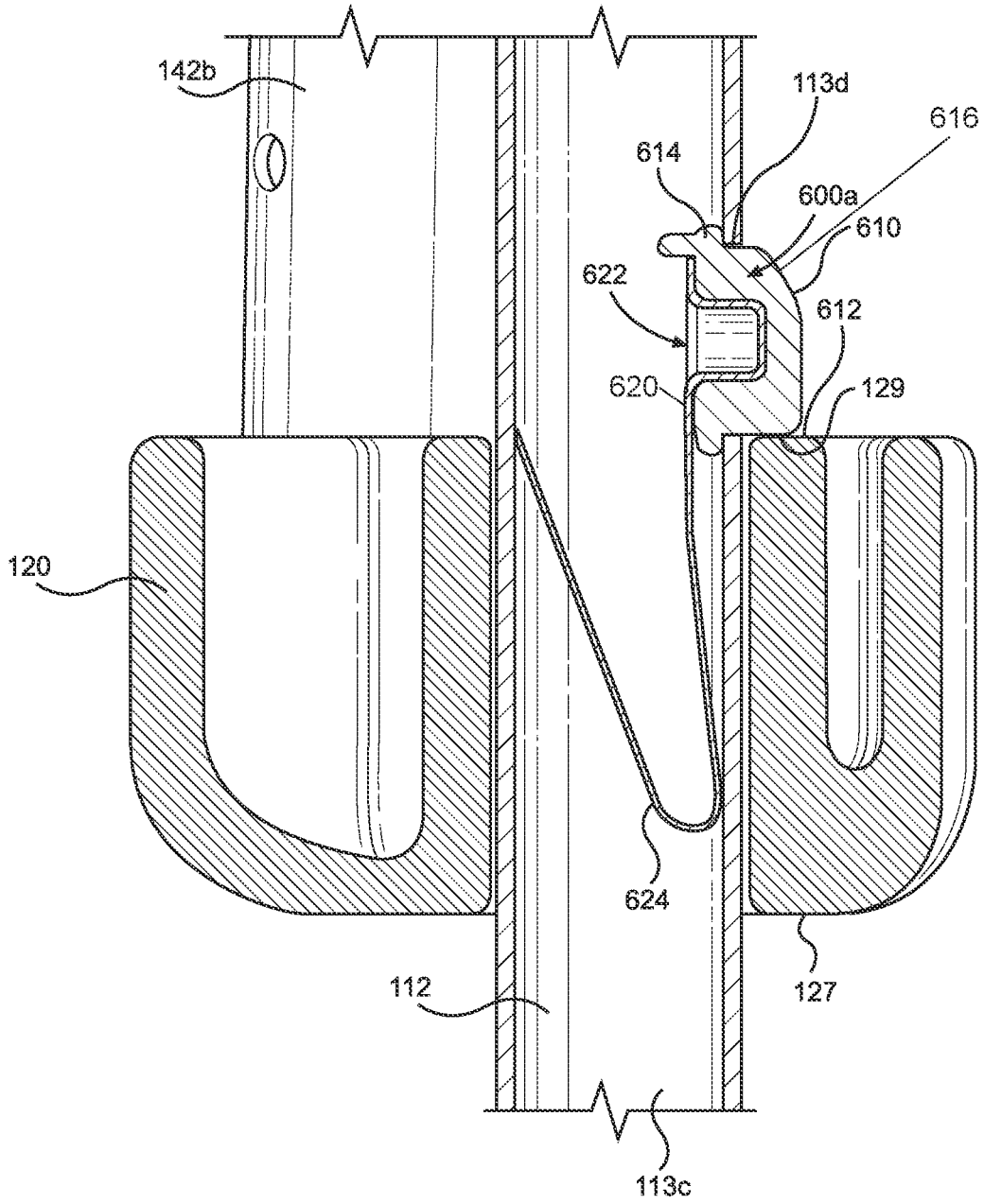
Figure 37C:
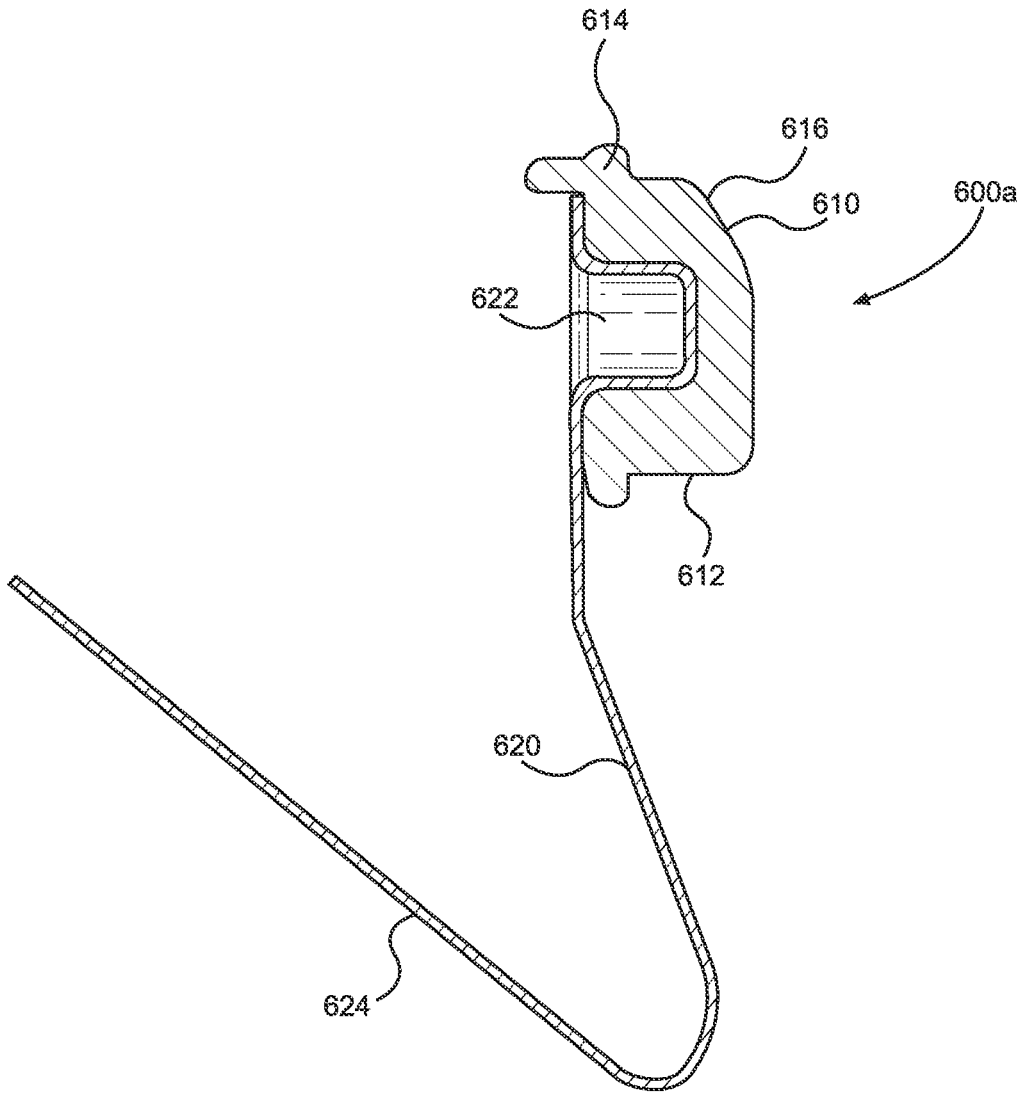

FIGS. 37A-37C show additional views of the storage latch 600*a*, which includes a push button mechanism. Specifically, the storage latch 600*a* may include a push button 610 at least partially disposed through an opening 113*d* formed on the leg tube 112 of the leg support assembly 110*e*. In some implementations, the frame 100*e* may only include one leg tube 112 with the opening 113*d*, in part, to simplify the manufacture of the frame 100*e* by eliminating a separate hole-forming process (e.g., drilling, punching) for the remaining leg tubes 112. The storage latch 600*a* may further include a spring element 620 disposed within a cavity 113*c* of the leg tube 112 and coupled to the push button 610 to impart a spring bias force onto the push button 610 that causes the push button 610 to protrude outwards through the opening 113*d*.

FIG. 37A shows the push button 610 and the opening 113*d* may be disposed proximate to the foot 114 of the leg support assembly 110*e* such that the push button 610 is positioned above the slider 120 when the frame 100*e* is in the folded configuration. The shape and/or dimensions of the push button 610 and the opening 113*d* may be similar to reduce or, in some instances, eliminate gaps formed between the push button 610 and the edges of the leg tube 112 forming the opening 113*d*. In some implementations, the push button 610 may have an exterior width corresponding to the average width of a human thumb (e.g., about 1 inch). The cross-section of the push button 610 and, by extension, the opening 113*d* may have various shapes including, but not limited to, a circle, an ellipse, a polygon (e.g., a square, a triangle), and any combinations of the foregoing.

FIG. 37B shows the push button 610 may include a bottom restraining surface 612 that may physically contact the top surface 129 of the slider 120 when the frame 100*e* is in the folded configuration. Thus, the push button 610 and, in particular, the restraining surface 612 provides a barrier that prevents the slider 120 from moving upwards along the leg tube 112, hence, maintaining the frame 100*e* in the folded configuration. The restraining surface 612 may be oriented such that the force applied to the push button 610 due to contact with the slider 120 is oriented in a direction that does not cause the push button 610 to move inwards into the cavity 113*c* through the opening 113*d*. For example, FIG. 37B shows the restraining surface 612 may be a horizontally flat surface that abuts a corresponding portion of the top surface 129 of the slider 120. The horizontal orientation of the restraining surface 612 results in a vertically oriented contact force between the slider 120 and the push button 610, which is orthogonal to the horizontal axis along which the push button 610 moves through the opening 113*d*. In some implementations, the portion of the top surface 129 that contacts the restraining surface 612 may also be horizontal and flat.

The spring element 620 further ensures the push button 610 remains protruding outwards through the opening 113*d* of the leg tube 112 so that contact between the restraining surface 612 and the top surface 129 of the slider 120 is maintained. As shown, the push button 610 may also include a mechanical stop 614 disposed in the cavity 113*c* to limit the displacement of the push button 610 through the opening 113*d*. Thus, the combination of the spring element 620 and the mechanical stop 614 may limit the range of motion of the push button 610 through the opening 113*d*. In some implementations, the mechanical stop 614 may be a lip or a flange that extends at least partially around the periphery of the push button 610 to contact an interior surface of the leg tube 112 surrounding the opening 113*d*.

To unfold the frame 100*e*, the caregiver may press the push button 610 to displace the push button 610 inwards into the cavity 113*c* of the leg tube 112. When the push button 610 is sufficiently displaced (e.g., the restraining surface 612 is no longer in physical contact with the top surface 129 of the slider 120), the caregiver may then move the slider 120 upwards along the leg tube 112 and towards the corner 130 to unfold the frame 100*e*. When the slider 120 is moved upwards such that the top surface 129 is above the restraining surface 612, the interior surfaces of the slider 120 may contact the push button 610, thus keeping the push button 610 disposed in the cavity 113*c*. Once the slider 120 moves past the push button 610, the spring bias force generated by the spring element 620 moves the push button 610 back outwards through the opening 113*d*.

In some implementations, the push button 610 may also include a ramped surface 616 as a lead-in feature to automatically engage the storage latch 600*a* when folding the frame 100*e*. When the caregiver begins to fold the frame 100*e*, the slider 120 is initially disposed above the push button 610. As the slider 120 is moved downwards along the leg tube 112 by the caregiver, a bottom surface 127 of the slider 120 physically contacts the ramped surface 616. The physical contact between the ramped surface 616 and the bottom surface 127 of the slider 120 causes the push button 610 to move inwards into the cavity 113*c* until the slider 120 is able to move past push button 610. Once the slider 120 is disposed below the push button 610 (i.e., the top surface 129 is below the restraining surface 612), the spring element 620 may move the push button 610 outwards through the opening 113*d* such that the restraining surface 612 is able to prevent the slider 120 from moving back upwards along the leg tube 112. In this manner, the ramped surface 616 may automatically engage the storage latch 600*a* when folding the frame 100*e*.

FIG. 37B shows the ramped surface 616 may be disposed along a top portion of the push button 610 opposite the restraining surface 612. The ramped surface 616 may be oriented such that the contact force applied to the push button 610 by the bottom surface 127 of the slider 120 has a force component oriented along a direction that moves the push button 610 into the cavity 113*c* through the opening 113*d*. The ramped surface 616 may be further dimensioned to maintain contact with the bottom surface 127 of the slider 120 until the push button 610 is sufficiently disposed within the cavity 113*c* such that the slider 120 is able to move past the push button 610.

For example, the ramped surface 616 may be oriented at an angle less than 90 degrees from a horizontal plane. When contact is made between the ramped surface 610 and the bottom surface 127, the contact force applied to the ramped surface 610 includes a horizontal force component, which displaces the push button 610 through the opening 113*d* and into the cavity 113*c* when the horizontal force component is greater than the spring bias force generated by the spring element 620. In some implementations, the weight of the slider 120 and the X-frame tubes 142*a* and 142*b* in the X-frame assemblies 140*c* applied to the ramped surface 616 may be sufficiently large to overcome the spring force generated by the spring element 620 and, hence, to displace the push button 610 into the cavity 113*c* without the aid of another external force applied to the push button 610 (e.g., a force applied by the caregiver).

The spring element 620 may be various types of springs including, but not limited to, a compression spring (e.g., a coil spring) and a leaf spring. For example, FIG. 37B shows the spring element 620 as a Valco snap button that includes a base 622 that couples to the push button 610 and an arm 624 that extends from the base 622 to form a spring. As shown, the base 622 may be press-fit into a corresponding opening formed on the push button 610 to securely couple the spring element 620 to the push button 610. It should be appreciated that other coupling mechanisms may be used to couple the spring element 620 to the push button 610 including, but not limited to, a snap fit mechanism, adhesives, and a fastener (e.g., a screw fastener, a bolt fastener).

The arm 624 may be bent in shape to form a spring (see FIG. 37C). When the spring element 620 is installed in the cavity 113*c*, the arm 624 is compressed, which ensures a spring bias force is applied to the push button 610 independent of the position of the push button 610 through the opening 113*d*. In other words, the arm 624 imparts a spring bias force onto the push button 610 even when the push button 610 is not pressed by the caregiver.

In some implementations, the spring element 620 may also act as an anchor to maintain the push button 610 at a desired orientation relative to the opening 113*d*. For example, the push button 610 and the opening 113*d* may each have a circular cross section, which allows the push button 610 to rotate relative to the opening 113*d* about a centerline axis of the opening 113*d*. However, FIG. 37B shows the spring element 620 and, in particular, the arm 624, may be fixed in orientation once installed in the leg tube 112 due to the constraints imposed by the interior surfaces of the leg tube 112. In other words, the arm 624, which is rigidly coupled to the push button 610 via the base 622, reduces or, in some instances, prevents rotation of the push button 610 relative to the opening 113*d*, thus ensuring the ramped surface 616 and the restraining surface 612 are oriented properly to contact the bottom surface 127 and the top surface 129, respectively, of the slider 120.

FIGS. 38A-38C show another exemplary storage latch 600*b* installed onto the frame 100*e* with a latch member 642 to lock the frame 100*e* in the folded configuration. As shown, the storage latch 600*b* may include a base 640 to support the latch member 642. In particular, the base 640 may be rigidly coupled to the leg tube 112 via, for example, a fastener inserted through a fastener opening 641 and a corresponding opening (not shown) on the leg tube 112. Generally, the base 640 may be disposed below the slider 120. For example, FIG. 38C shows the base 640 may be disposed proximate to or, in some instances, may abut the foot 114 of the leg support assembly 110*e*.

The latch member 642 may generally be a mechanically compliant component that can be readily bent, for example, by the caregiver to disengage the storage latch 600*b*. The latch member 642 may also generate an internal restoring force when the latch member 642 is bent to rotate the latch member 642 back towards its unbent form. The latch member 642 may generally be aligned to the leg tube 112 and disposed near the slider 120 in the folded configuration. For example, FIGS. 38B and 38C show the latch member 642 may extend from the base 640 upwards along and to the side of the leg tube 112. In some implementations, the latch member 642 may be longitudinally aligned parallel to the longitudinal axis 111*a* of the leg tube 112. The latch member 642 may further extend along the leg tube 112 such that an end 643 of the latch member 642 is disposed above the slider 120 in the folded configuration.

Although the latch member 642 may protrude outwards from the frame 100*e*, the latch member 642 may be shaped and/or dimensioned to avoid appreciably increasing the overall size of the frame 100*e* particularly in the folded configuration. For example, the width of the latch member 642 may be less than or equal to the exterior width of the leg tube 112. In another example, the latch member 642 may be offset from the leg tube 112 such that the gap formed between the latch member 642 and the leg tube 112 is sufficiently large to only accommodate the slider 120. In other words, the gap formed between the latch member 642 and the leg tube 112 may be equal to the thickness of the portion of the base 121 disposed along the exterior portion of the frame 100*e*.

As shown in FIG. 38C, the latch member 642 may include a hook 644 disposed near the end 643 of the latch member 642 with a bottom surface 645 that physically contacts the top surface 129 of the slider 120. In some implementations, the hook 644 may be disposed proximate to or, in some instances, physically contacts the leg tube 112 when the latch member 642 is not bent. Similar to the restraining surface 612 of the storage latch 600*a*, the hook 644 of the latch member 642 may provide a barrier that prevents the slider 120 from moving upwards along the leg tube 112, hence, maintaining the frame 100*e* in the folded configuration.

The bottom surface 645 may be oriented such that the force applied to the hook 644 due to contact with the slider 120 is oriented in a direction that does not cause the latch member 642 to bend outwards. For example, the bottom surface 645 may align with a radial axis that intersects a rotation axis that the latch member 642 rotates about when bent. In other words, the contact force applied to the bottom surface 645 is oriented such that the resulting torque applied to the latch member 642 is not sufficient to bend the latch member 642. For example, the bottom surface 645 may be a horizontally flat surface. Thus, the contact force applied to the hook 644 via the bottom surface 645 may be oriented vertically. The latch member 642 may rotate about a rotation axis oriented horizontally and located at the base of the latch member 642 such that the contact force is substantially aligned or aligned to a vertical axis intersecting the rotation axis. In some implementations, the portion of the top surface 129 that contacts the restraining surface 612 may also be horizontal and flat.

To unfold the frame 100*e*, the caregiver may pull on the end 643 of the latch member 642 to bend the latch member 642 in an outwards direction. When the latch member 642 is sufficiently bent, the caregiver may then move the slider 120 upwards along the leg tube 112 and towards the corner 130 to unfold the frame 100*e*. This may occur when the caregiver sufficiently bends the latch member 642 such that the hook 644 and, in particular, the bottom surface 645 no longer physically contacts the top surface 129 of the slider 120. As the slider 120 moves upwards along the leg tube 112, the exterior sides of the slider 120 may continue to contact the hook 644, thus maintaining the latch member 642 in a bent state without the aid of the caregiver. Once the slider 120 moves past the hook 644, the internal restoring force generated within the latch member 642 may rotate the latch member 642 back to the unbent state.

In some implementations, the latch member 642 and, in particular, the hook 644 may also include a ramped surface 646 as a lead-in feature to automatically engage the storage latch 600*b* when folding the frame 100*e*. As shown in FIG. 38C, the ramped surface 646 may correspond to a top surface of the hook 644 located opposite the bottom surface 645. Similar to the ramped surface 616 of the storage latch 600*a*, the ramped surface 646 be oriented to facilitate actuation of the storage latch 600*b* based on contact with the slider 120 as the frame 100*e* is being folded.

For example, as the slider 120 is moved downwards along the leg tube 112 by the caregiver, the bottom surface 127 of the slider 120 may physically contact the ramped surface 646. The ramped surface 646 may be oriented such that the contact force applied by the bottom surface 127 has a polar force component that generates a sufficiently large torque to bend the latch member 642 in an outwards direction. As the slider 120 moves downwards, the exterior surface of the slider 120 may remain in contact with the hook 644, thus keeping the latch member 642 in a bent state. Once the slider 120 moves past the hook 644, the internal restoring force generated by the latch member 642 may rotate the latch member 642 back to the unbent state where the hook 644 is disposed proximate to or, in some instances, contacts the leg tube 112. The ramped surface 646 may be oriented at an angle less than 90 degrees from a horizontal plane. The ramped surface 646 may be also dimensioned to maintain contact with the bottom surface 127 of the slider 120 until the latch member 642 is sufficiently bent such that the slider 120 is able to move past the hook 644.

The base 640 and the latch member 642 may be integrally formed as a single part. For example, the base 640 and the latch member 642 may be formed from a plastic material using, for example, injection molding.

In some implementations, the base 640 may also be integrally formed together with the foot 114 of the leg support assembly 110*e*. For example, FIGS. 36A, 36C, 39A, and 39B show a storage latch 600*c* that includes a base 640 and a latch member 642. As shown, the base 640 may also act as a foot to support the leg support assembly 110*f* on the ground. For instance, the base 640 may include an opening 647 to receive the leg tube 112 and a fastener opening 641 to couple the base 640 to the leg tube 112. Additionally, the base 640 may include a D-shaped opening 648 similar to the D-shaped opening 117 to couple the soft goods 300 to the frame 100*e*. The latch member 642 may once again extend from the base 640 along the leg tube 112 and may further include a hook 644 disposed near an end 643 to prevent the slider 120 from moving upwards along the leg tube 112.

In some implementations, the foldable playard frame may include a secondary latch that limits the extent the frame can be folded without further assistance or input from the caregiver. For example, the latch of the frame may be accidentally unlocked, for example, by the child. To reduce or, in some instances, prevent the child from being exposed to openings in the frame that fall outside the desired clearances set forth in ASTM F409-19 or ASTM F1004-09, the second latch may only allow the frame to fold to such an extent that the desired clearances between the various rigid components of the frame are preserved. Thus, in some implementations, the inclusion of a secondary latch may allow for a frame that does not maintain the desired clearances for all the configurations of the frame (e.g., the folded configuration, the unfolded configuration, between the folded and unfolded configurations).

Generally, the secondary latch may be separate from the latch and the storage latch described above. The frame may generally include one or more secondary latches disposed on one or more of the leg support assemblies or one or more of the X-frame assemblies. For example, at least one pair of secondary latches may be disposed on opposing sides of the frame to ensure respective sides of the frame maintain the desired clearances. In another example, the frame may only include a single secondary latch, which is sufficient to maintain the frame in the partially folded state. The secondary latch may be actuated in a tool-less manner such that the caregiver can actuate the secondary latch using a single hand.

In one example, FIG. 40A shows an exemplary frame 100*g* for the foldable playard 1000*a* with a secondary latch 650 disposed on one leg support assembly 110*e*. As shown, the frame 100*g* may include several of the same features as the frame 100*e*, such as the leg support assemblies 110*e* and the X-frame assemblies 140*c*. The frame 100*g* may define an interior space 102 with a hexagonal cross-sectional shape. However, it should be appreciated the various components of the frame 100*g* may also be adapted for a playard having an interior space 102 with a rectangular or square cross-sectional shape.

In some implementations, the secondary latch 650, the storage latch 600*b*, and the latch 200*a* may be installed on the same leg support assembly 110*e*. However, in other implementations, the secondary latch 650, the storage latch 600*b*, and the latch 200*a* may each be installed on different leg support assemblies 110*e*. More generally, at least one of the secondary latch 650, the storage latch 600*b*, or the latch 200*a* may be installed on one leg support assembly 110*e*.

The secondary latch 650 may be generally disposed at an intermediate location along the leg tube 112 between a storage latch 600*b* and a latch 200*a* to support the frame 100*g* in a partially folded state. For example, the secondary latch 650 may be positioned above the slider 120 in the folded configuration and below the slider 120 in the unfolded configuration. In some implementations, the partially folded state may correspond to the frame 100*g* being folded to such an extent that the desired clearances between the various rigid components of the frame 100*g* are maintained. For example, gap separating the leg tube 112 and the X-frame tubes 142*a* or 142*b* may remain greater than or equal to 1.5 inches in the partially folded state. When the frame 100*g* is further folded, the gap between the leg tube 112 and the X-frame tubes 142*a* or 142*b* may decrease to less than 1.5 inches.

In some implementations, the secondary latch 650 may include a push button mechanism similar to the storage latch 600*a*. The push button may provide a barrier that prevents the slider 120 from moving further downwards along the leg tube 112 when the frame 100*g* is initially folded. The caregiver may press the push button into the cavity of the leg tube 112 to allow the slider 120 to move further downwards along the leg tube 112 in order to fully fold the frame 100*g*. In some implementations, the push button may include a ramped surface disposed on the bottom side of the push button to allow the slider to move upwards along the leg tube 112 without the caregiver having to separately actuate the secondary latch 650.

FIG. 40B shows an exemplary secondary latch 650*a* with a push button mechanism. As shown, the secondary latch 650*a* may include a push button 652 disposed through an opening 113*e*-1 of the leg tube 112. The push button 652 may be coupled to an arm 654 disposed within the cavity 113*c* of the leg tube 112. The arm 654 may act as a spring to return the push button 652 to an outward facing position when the push button 652 is pressed into the cavity 113*c*. The arm 654 may be coupled to a base 656 that physically contacts opposing interior sides of the leg tube 112 such that the base 656 remains stationary when the arm 654 is bent. The base 656 may further include a tab 657 inserted into an opening 113*e*-2 formed on the leg tube 112 to securely couple the secondary latch 650*a* to the leg tube 112.

The push button 652 may also be coupled to an arm 653 disposed above the arm 654 that provides a mechanical stop that limits the extent the push button 652 can be pressed into the cavity 113*c*. For example, the arm 653 may be oriented along the same direction that the push button 652 moves through the opening 113*e*-1 and, thus, may contact the interior surface of the leg tube 112 when the push button 652 is sufficiently displaced. In some implementations, the arm 653 may be dimensioned such that the exterior surface 658 of the push button 652 is disposed within the opening 113*e*-1 to allow the slider 120 to move past the push button 652.

It should be appreciated the secondary latch 650*a* is one exemplary implementation and that, more generally, the secondary latch may have different geometries, dimensions, and/or parts to adjust the overall size of secondary latch 650*a*, the spring constant of the arm 654, the amount of material used for manufacture, and/or the number of parts for manufacture without changing the operating principle.

For example, FIG. 40C shows another exemplary secondary latch 650*b* where the arm 654 has an inverted U-shaped geometry disposed above the arm 653. The arm 654 may be compressed when installed onto the leg tube 112, thus providing a spring bias force independent of the position of the push button 652. In this example, the arm 653 may act as a mechanical stop that limits the extent the push button 652 is inserted into the cavity 113*c* or protrudes outwards from the opening 113*e*-1.

In another example, FIG. 40D shows an exemplary secondary latch 650*c* where the push button 652 is coupled to a separate compression spring 660. In some implementations, the spring 660 may be compressed when installed onto the leg tube 112 to provide a spring bias force independent of the position of the push button 652. In some implementations, the spring 660 may only generate a spring force when the push button 652 is pressed. FIG. 40D further shows spring 660 may be directly mounted to the leg tube 112 using, for example, a fastener or a snap-fit connection. The push button 652 may further include mechanical stops 658 to limit the extent the push button 652 protrudes outwards from the opening 113*e*-1.

In some implementations, the foldable playard, when deployed, may also provide a platform to support various accessories to augment the functionality of the playard and/or the environment for the child. Following below are detailed descriptions of various accessories that may be installed onto the various foldable playards described herein including, but not limited to, a canopy cover, a bassinet accessory, a changing table topper, an organizer, and a bassinet topper. It should be appreciated that, in some implementations, one or more of the accessories described herein may be installed onto the foldable playard. Furthermore, the respective functions and features provided by one accessory may be used in combination with another accessory (e.g., a child may be placed onto an elevated platform provided by a bassinet accessory and a canopy cover may provide shade for the child).

In one example, the foldable playard may support a canopy cover to provide shade for the child. FIGS. 41A-41F show the frame 100*a* in the unfolded configuration with an exemplary canopy cover assembly 400*a*. The canopy cover assembly 400*a* may be coupled to the frame 100*a* and disposed, in part, above the interior space 102 of the frame 100*a* to support a canopy cover 440 (see, for example, FIG. 41E) that covers the interior space 102. The canopy cover 440 may be a compliant and/or flexible component formed from, for example, a textile material. For example, the playard 1000*a* may be deployed in an outdoor setting, thus the canopy cover 440 may provide shade for the child 50 when placed in the partially enclosed space 301 of the playard 1000*a*.

As shown in FIGS. 41A-41C, the canopy cover assembly 400*a* may include multiple canopy support assemblies 410 that couple to each leg support assembly 110*a* of the frame 100*a*. Thus, the canopy cover assembly 400*a* may fully cover the interior space 102 (i.e., the canopy cover assembly 400*a* is a full canopy cover). In some implementations, the canopy support assemblies 410 may be substantially identical or identical with the other canopy support assemblies 410.

Each canopy support assembly 410 may include a canopy bow 412 partially disposed above the interior space 102 to support the canopy cover 440 and a canopy clip 420*a* to couple the canopy bow 412 to the frame 100*a*. For the canopy cover assembly 400*a*, the canopy bows 412 from each canopy support assembly 410 may be coupled together via a hub 450*a* disposed above the interior space 102 as shown in FIG. 41A. In some implementations, the hub 450*a* may be approximately aligned or aligned to the center of the interior space 102 when the canopy cover assembly 400*a* is mounted to the frame 100*a*, as shown in FIG. 41C. FIG. 41B further shows the respective canopy bows 412 of the canopy support assemblies 410 may form a frame or support structure where each canopy bow 412 is bent, in part, to define the desired shape of the canopy cover 440 when the canopy cover 440 is installed onto the canopy support assemblies 410.

FIG. 41D shows the canopy clip 420*a* may be disposed along an exterior portion of the frame 100*a* (i.e., outside the interior space 102 of the frame 100*a*) proximate to the slider 120 and the top portion 108 of the frame 100*a* when the canopy clip 420*a* is coupled to the leg support assembly 110*a*. FIGS. 41E and 41F show the canopy clip 420*a* may include a base 422 with snap-fit features 424 that form a snap-fit connector to directly couple the canopy clip 420*a* to the leg tube 112 of one leg support assembly 110*a*. Thus, the canopy cover assembly 400*a* may be mounted to the frame 100*a* without the use of any tools. Furthermore, the canopy cover assembly 400*a* may be coupled to the frame 100*a* without making any alterations or modifications to the frame 100*a*. In this manner, the canopy cover assembly 400*a* may not be limited for installation with only the frame 100*a*, but instead the canopy cover assembly 400*a* may be mounted onto the frames of other playards (e.g., other frames with six leg support assemblies). Said in another way, the canopy cover assembly 400*a* may be a universally compatible accessory that the caregiver may separately purchase and/or install onto their playard.

The snap-fit features 424 may generally be shaped to conform with the cross-sectional shape of the leg tube 112 to ensure the canopy clip 420*a* is securely coupled to the leg tube 112. For example, FIG. 42A shows the snap-fit features 424 may form an oval-shaped channel that matches the oval-shaped cross-section of the leg tube 112. In some implementations, the asymmetric cross-section of the leg tube 112 (e.g., the oval-shaped cross section) may ensure the canopy clip 420*a* only couples to the leg tube 112 with a desired orientation and/or prevents unwanted rotation of the canopy clip 420*a* when coupled to the leg tube 112. In this manner, the canopy bow 412 may be repeatedly and/or reliably positioned and/or oriented with respect to the frame 100*a* such that the canopy cover 440, when placed onto the canopy support assembly 410, provides the desired coverage and/or aesthetic appearance. However, it should be appreciated that in other implementations, the shape of the snap-fit features 424 may be tailored to match the shape of the leg tubes most commonly used in various playard products (e.g., a circular-shaped leg tube). The snap-fit features 424 may further include lead-in features 425 to align the canopy clip 420*a* to the leg tube 112 and/or to deflect the snap-fit features 424 outwards to facilitate engagement with the leg tube 112.

In some implementations, the caregiver may thus align and press the canopy clip 420*a* along the arrow shown in FIG. 42A to engage the snap-fit features 424 to the leg tube 112. In some implementations, the caregiver may instead hook one of the snap-fit features 424 (e.g., via the corresponding lead-in feature 425) onto the leg tube 112 and then rotate the opposing side of the canopy clip 420*a* such that the other snap-fit feature 424 engages the leg tube 112 (e.g., via the corresponding lead-in feature 425) as shown in FIG. 42B. Compared to conventional canopy cover assemblies, the canopy cover assembly 400*a* may be more securely and reliably coupled to the frame 100*a* by directly coupling the canopy clip 420*a* to the leg tube 112 instead of a portion of the frame covered by soft goods. Thus, the canopy cover assembly 400*a* may be less susceptible to being removed accidentally by, for example, wind or the child 50 when placed into the partially enclosed space 301.

FIGS. 41E and 41F further show the canopy clip 420*a* may include a canopy bow opening 426 (e.g., also referred to herein as a "canopy bow socket 426") formed, in part, on the base 422 to receive a first end 413*a* of the canopy bow 412. Once the first end 413*a* of the canopy bow 412 is inserted into the canopy bow opening 426, a fastener may be inserted through the opening 432 disposed on the side of the base 422 to securely couple the canopy bow 412 to the canopy clip 420*a*. In some implementations, the canopy clip 420*a* may alternatively utilize an integral snap finger to couple the canopy bow 412 to the canopy clip 420*a* via a snap-fit connection.

In some implementations, a portion of the canopy bow 412 may be disposed outside the interior space 102 of the frame 100*a* and positioned proximate to the top portion 108 of the frame 100*a* when coupled to the canopy clip 420*a*. For example, FIG. 41D shows a portion of the canopy bow 412 may be in substantially parallel or parallel alignment with the leg tube 112 and positioned next to the corner 130. By positioning the canopy bow 412 to overlap with the top portion 108 of the frame 100*a*, the canopy bow 412 is less susceptible to being pulled into the partially enclosed space 301 of the playard 1000*a* by the child 50 compared to conventional playards with canopy cover assemblies. For example, the canopy bow 412 may be more difficult to reach since the child 50 has to extend their arms over the corners 130 of the frame 100*a* to grab the canopy bow 412. Additionally, even if the child 50 manages to grab onto the canopy bow 412, they have less leverage to pull the canopy cover assembly 400*a* into the playard 1000*a* due to the canopy bow 412 overlapping the top portion 108 of the frame 100*a* and the canopy clip 420*a* positioned on an exterior portion of the frame 100*a*.

The canopy clip 420*a* may further include an alignment rib 430 that protrudes outwards from the base 422 towards the frame 100*a*. The alignment rib 430 may be used, in part, as an alignment feature to position the canopy clip 420*a* onto the leg support assembly 110*a*. For example, FIGS. 41D-F show the alignment rib 430 may be disposed between the top surface of the slider 120 and the bottom surface of the corner 130 such that the snap-fit features 424 are disposed just below the slider 120 when the canopy clip 420*a* is coupled to the leg tube 112. In some implementations, the alignment rib 430 may also prevent the canopy clip 420*a* from sliding downwards along the leg tube 112. For example, FIG. 41E shows the alignment rib 430 may contact the top surface of the slider 120 if the canopy clip 420*a* moves down along the leg tube 112.

In some implementations, the canopy cover 440 may be laid directly over and onto the canopy support assemblies 410. The canopy cover 440 may include one or more tethers 442 to pull and/or hold the canopy cover 440 taut along the canopy bows 412 of the canopy support assemblies 410. For example, FIG. 41E shows each tether 442 may be looped around a hook 428 disposed at the bottom of the base 422 of the canopy clip 420*a*.

The canopy bow 412, the canopy clip 420*a*, and/or the hub 450*a* may be formed from various materials including, but not limited to plastic and fiberglass. In some implementations, the canopy bow 412 may be formed as a single, mechanically compliant component that may bent into the desired shape to couple the canopy bow 412 to the hub 450*a* and/or the canopy clip 420*a*. In some implementations, the canopy bow 412 may be an assembly of components (e.g., tubes) coupled together via one or more shock cords or bungee cords. The tubes may be fitted to one another to form an assembly of tubes that mechanically function as a single, continuous rod. For example, FIG. 41E shows the canopy bow 412 may include an elastic cord 414 that passes through the canopy bow 412 to hold the various sections of the canopy bow 412 together. As shown, the elastic cord 414 may be terminated with a knot, which may be accessed by the caregiver through an opening 434 on the base 422 of the canopy clip 420*a*.

As described above, the canopy cover assembly 400*a* may include a hub 450*a* that couples the second ends 413*b* of each canopy bow 412 together to form a structure that covers the interior space 102 of the frame 100*a*. In some implementations, the canopy bows 412 may be coupled to the hub 450*a* prior to purchase by a consumer (e.g., the canopy cover assembly 400*a* may be assembled at a factory) or by a caregiver when installing the canopy cover assembly 400*a* onto the playard 1000*a* for the first time. In other words, the canopy bows 412 may remain coupled to the hub 450*a* for subsequent installations of the canopy cover assembly 400*a* such that the caregiver only needs to couple the respective canopy clips 420*a* to corresponding leg tubes 112 for setup.

In some implementations, the canopy bow 412 may be rigidly coupled to the hub 450*a* (i.e., the second end 413*b* of the canopy bow 412 may not translate and/or rotate relative to the hub 450*a*). Thus, the canopy bows 412 of the canopy support assemblies 410 may be bent to facilitate attachment of the respective canopy clips 420*a* to the frame 100*a*. In some implementations, the second end 413*b* of the canopy bow 412 may be rotatably coupled to the hub 450*a* so that the canopy support assemblies 410 may be folded into a more compact structure for storage while remaining coupled to the hub 450*a*. For example, FIGS. 43A and 43B show the hub 450*a* may include a base 451 with multiple openings 452 to receive the second ends 413*b* of each canopy bow 412. The openings 452 may be aligned, in part, according to the relative locations of the leg support assemblies 110*a* of the frame 100*a* in the unfolded configuration. For example, the hub 450*a* may have six openings 452 disposed evenly around the periphery of the base 451 to align with the six leg support assemblies 110*a*, which may be arranged to form a hexagonal-shaped interior space 102.

Once the second end 413*b* of the canopy bow 412 is inserted into the opening 452, a pin 454 coupled to the second end 413*b* may be held in a corresponding slot 453 formed in the base 451 via, for example, a snap-fit connector. This allows the second end 413*b* of the canopy bow 412 to rotate relative to the base 451 via rotation of the pin 454 within the slot 453 about a rotation axis 460 as shown in FIG. 43B. In some implementations, the pin 454 may be integrally formed into the canopy bow 412. In some implementations, the pin 454 may be a separate component that is inserted through openings along the sides of the canopy bow 412 near the second end 413*b*.

The base 451 may further include a lip 457 to constrain the range of rotational motion of the canopy bow 412 relative to the hub 450*a*. For example, FIG. 43B shows the lip 457 may be disposed along the bottom side of the base 451, which causes the canopy bow 412 to bend when the canopy clip 420*a* attached to the first end 413*a* of the canopy bow 412 is positioned below the hub 450*a*. However, the canopy support assemblies 410 may be allowed to rotate such that the second end 413*b* of each canopy bow 412 is inserted through the opening 452 from the top side of the base 451 (i.e., the canopy clip 420*a* is positioned above the hub 450*a*). In this manner, the canopy cover assembly 400*a* may be folded for storage and/or transport separately or together with the playard 1000*a*.

FIGS. 44A and 44B show the playard 1000*a* with the frame 100*a* and soft goods 300 and another exemplary canopy cover assembly 400*b* with the canopy cover 440 installed onto the playard 1000*a*. In this example, the canopy cover assembly 400*b* may cover half the interior space 102 (i.e., the canopy cover assembly 400*b* is a half canopy cover).

FIGS. 45A-45E show the canopy cover assembly 400*b* may once again include multiple canopy support assemblies 410 coupled to the frame 100*a* to provide a support structure that defines the desired shape of the canopy cover 440 when mounted to the canopy support assemblies 410. Compared to the canopy cover assembly 400*a*, however, the canopy support assemblies 410 of the canopy cover assembly 400*b* may include a canopy bow 412 that is directly coupled to two canopy clips 420*b* mounted to different leg support assemblies 110*a* of the frame 100*a* instead of a central hub. For example, FIGS. 45A and 45C show the canopy cover assembly 400*b* may include two canopy support assemblies 410 where the canopy bow 412 of each canopy support assembly 410 is coupled to two non-adjacent leg support assemblies 110*a*. The canopy bows 412 may overlap and/or cross one another as shown in FIG. 45C.

In this example, the canopy bow 412 may include multiple bow sections 416 coupled together via connectors 415. The connector 415 may be a tubular-shaped component that receives respective ends of two bow sections 416. In some implementations, each bow section 416 may be coupled to the connector 415 via a fastener inserted through a corresponding opening on the connectors 415 and/or an integral snap finger.

The canopy clip 420*b* may incorporate several of the same features as the canopy clip 420*a* described above. For example, FIGS. 45D and 45E show the canopy clip 420*b* may include a base 422 with snap-fit features 424, a canopy bow opening 426 to receive one end of the canopy bow 412, a mounting hole 432 to securely couple the canopy bow 412 to the canopy clip 420*b*, an opening 434 to access the elastic cord in the canopy bow 412, and a hook 428 to secure the tether 442 of the canopy cover 440 to the canopy clip 420*b*. Compared to the canopy clip 420*a*, the canopy bow opening 426 of the canopy clip 420*b* may be tilted such that the portion of the canopy bow 412 coupled to the canopy clip 420*b* is oriented an angle relative to the leg tube 112 of the leg support assembly 110*a* to ensure the canopy bow 412 extends over a center portion of the interior space 102 as shown in FIG. 45C.

FIGS. 46A-46C show another exemplary canopy cover assembly 400*c* without the canopy cover 440 coupled to the frame 100*a* of the playard 1000*a*. The canopy cover assembly 400*c* may also cover half the interior space 102 similar to the canopy cover assembly 400*b*. However, the canopy support assemblies 410 of the canopy cover assembly 400*c* may be joined together by a hub 450*b* in the canopy cover assembly 400*c*. As shown, the canopy support assemblies 410 may include the canopy bows 412 and canopy clips 420*a* described above. In this example, the canopy support assemblies 410 may couple to enough leg support assemblies 110*a* to cover half the interior space 102 as shown in FIG. 46C.

FIGS. 47A and 47B show the hub 450*b* may once again include a base 451 with openings 452 to receive the second ends 413*b* of each canopy bow 412. As shown, the openings 452 may be formed as sockets that rigidly couple the second ends 413*b* to the hub 450*a* such that the second end 413*b* of each canopy bow 412 is translationally and rotationally constrained to the hub 450*b*. In some implementations, the second end 413*b* may be coupled to the hub 450*b* via a fastener and/or a snap-fit connection.

FIGS. 48A and 48B show another hub 450*c* for the canopy cover assembly 400*c*, which allows the second end 413*b* of the canopy bow 412 to be rotatable relative to the base 451 so that the canopy cover assembly 400*c* may be folded. The hub 450*c* may incorporate several of the same features as the hub 450*a* described above. For example, the base 451 may include a slot 453 to receive a pin 454 mounted to the second end 413*b* of the canopy bow 412. The slot 453 and the pin 454 may allow the canopy bow 412 to rotate about the axis 460. The base 451 may further include a lip 457 disposed on a bottom side of the base 451 to limit the rotational motion of the canopy bow 412.

FIGS. 49A and 49B show yet another hub 450*d* for the canopy cover assembly 400*c*. As shown, the hub 450*d* may include a base 451 with an opening 456 that extends along the curved side of the base 451. The opening 456 may be shaped to receive the second ends 413*b* of multiple canopy bows 412 as shown in FIG. 49A. The base 451 may further include holes 455 on the top and bottom sides of the base 451 to couple the second end 413*b* of each canopy bow 412 to the base 451. In some implementations, a pin (not shown) may be inserted through the opening 455 and corresponding openings (not shown) on the canopy bow 412 such that the second end 413*b* of each canopy bow 412 may rotate about an axis 461 as shown in FIG. 49A. This, in turn, may enable the canopy cover assembly 400*c* to be folded by rotating each of the canopy bows 412 about a corresponding axis 461 to one side of the base 451 such that the canopy bows 412 are approximately parallel or parallel with one another. In some implementations, a fastener may instead be inserted through the openings 455 to rigidly couple each canopy bow 412 to the hub 450*d* (i.e., the second end 413*b* of the canopy bow 412 does not rotate relative to the base 451).

In another example, the foldable playard may include a bassinet accessory to provide an elevated surface to support a child in their first several months of life (e.g., an infant, a child weighing less than 15 lbs). Once the child outgrows the bassinet accessory, the bassinet accessory may be removed and the interior space of the foldable playard may be used to contain the child as described above. In this manner, the foldable playard may be reconfigured by the caregiver to adapt to the physical development of the child, thus extending the lifetime of the playard. When the bassinet accessory is installed on the playard, the playard may be considered as being in a "bassinet mode." When the bassinet accessory is removed from the playard, the playard may considered as being in a "playard mode."

FIGS. 50A and 50B show the playard 1000*b* with an exemplary bassinet accessory 500*a* in the deployed unfolded configuration. As shown, the bassinet accessory 500*a* may be disposed within a top portion of the partially enclosed space 301 defined by the soft goods 300. The bassinet accessory 500*a* may define a separate relatively smaller partially enclosed space 501 disposed within the partially enclosed space 301 to contain the child in the unfolded configuration. The bassinet accessory 500*a* may generally include a support structure 520 that physically defines the partially enclosed space 501. The support structure 520 may also facilitate folding and unfolding of the bassinet accessory 500*a* together with the frame 100*b* and the soft goods 300, thus simplifying setup and tear down of the playard 1000*b* (i.e., the caregiver is not required to remove the support structure of the bassinet to fold the playard or install the support structure each time the playard is deployed).

The support structure 520 may include bassinet soft goods 522 with side surfaces 524 and a bottom surface 526 that physically surround at least a portion of the partially enclosed space 501. The support structure 520 may further include a hub 550 and multiple support tubes 540 that together form a foldable structure. The hub 550 may be formed from a plastic material (e.g., via injection molding). The support tube 540 may be formed from various rigid materials including, but not limited to, aluminum and steel. In the unfolded configuration, the hub 550 and the support tubes 540 provide a rigid platform to support a mattress 510 (see, for example, FIG. 52). The mattress 510, in turn, may provide a cushioned surface 511 located above the ground surface 90 to support the child.

It should be appreciated the bassinet accessories disclosed herein may also be installed onto different playards (e.g., playards having frame shapes that are different than that shown in FIGS. 50A and 50B). For example, with reference again to FIG. 23A, the bassinet accessory 500*a* may also be installed on the foldable playard 1000*c* in the same manner as the playard 1000*b*.

The bassinet accessory 500*a* may be dimensioned and/or shaped such that the partially enclosed space 501 extends laterally to the boundaries of the partially enclosed space 301 of the soft goods 300 and, in some instances, the interior space 102 of the frame 100*b* when the soft goods 300 are disposed along the boundaries of the interior space 102. For example, FIGS. 50A and 50B show the bassinet soft goods 522 may extend to the side portions 306 of the soft goods 300. However, it should be appreciated that in other implementations, the bassinet accessory 500*a* may be shaped and/or dimensioned such that a gap is formed between the side portions 306 of the soft goods 300 and the bassinet soft goods 522. For example, with reference again to FIG. 23A, this figure shows a gap is formed between the side portions 306 and the bassinet soft goods 522 due to the curved shape of the leg support assemblies 110*c*.

In some implementations, the bassinet accessory 500*a* may define a partially enclosed space 501 with a cross-sectional shape that conforms with the cross-sectional shape of the partially enclosed space 301 and, in some implementations, the interior space 102. For example, FIGS. 50A and 50B show the partially enclosed space 501 may have a rectangular cross-sectional shape that extends to the side portions 306 of the soft goods 300. In some implementations, the lateral dimensions of the partially enclosed space 501 may remain constant (or substantially constant as the bassinet soft goods 522 may be deformed by the soft goods 300) such that the three-dimensional volume of the partially enclosed space 501 is shaped as a right prism.

FIGS. 50A and 50B also show the bassinet soft goods 522 may be coupled to the top portion 302 of the soft goods 300 such that the bassinet soft goods 522 hang below the top portion 302. As a result, the bassinet accessory 500*a* may be positioned below the top side of the playard 1000*b*. For simplicity, the partially enclosed space 501 may include the space between the bottom surface 526 of bassinet soft goods 522 and the top side of the playard 1000*b* (e.g., the top horizontal plane 92). The presence of the bassinet accessory 500*a* may further divide the partially enclosed space 301 such that a bottom portion 301*a* of the partially enclosed space 301 is formed below the bassinet accessory 500*a*.

The bassinet accessory 500*a* may provide a relatively shallow partially enclosed space 501 to improve accessibility. This may enable the bassinet accessory 500*a* to reduce the physical strain experienced by the caregiver since the caregiver would not bend over as much when directly placing the child into the partially enclosed space 301 of the soft goods 300 (or taking the child out of the partially enclosed space 301). Additionally, the shallow bassinet accessory 500*a* may also provide greater visibility of the child particularly when the caregiver is viewing the playard 1000*b* from an elevated position (e.g., viewing the top of the playard 1000*b*).

The bassinet accessory 500*a* may be characterized by a height, $h_{t,1}$, defined as the distance from the respective bottom corner portions 537 of the bassinet soft goods 522 to the top horizontal plane 92 of the playard 1000*b* in the unfolded configuration as shown in FIG. 50B. The height, $h_{t,1}$, also corresponds to the height of the partially enclosed space 501. In some implementations, the height, $h_{t,1}$, may range between 7.5 inches and about 12 inches. In some implementations, the bassinet accessory 500*a* may also be characterized by a height, $h_m$, defined as the distance from the top surface 511 of the mattress 510 to the top horizontal plane 92 of the playard 1000*b*. When the mattress 510 is not compressed (e.g., the child is not resting on the mattress 510), the height, $h_m$, may range between 7.5 inches and about 10 inches. The bottom portion 301*a* may also be characterized by a height, $h_b$, defined as the distance from the ground surface 90 to the bottom surface 526. In some implementations, the height, $h_b$, may be greater than or equal to about 18 inches.

The term "about," when used to describe the height dimensions $h_{t,1}$, $h_b$, and $h_m$, is intended to cover manufacturing tolerances and/or variations due to the deformation of the soft goods 300 and/or the bassinet soft goods 522. For example, "about 12 inches" may correspond to a height ranging between 11.75 inches and 12.25 inches or between 11.5 inches and 12.5 inches. In another example, "about 10 inches" may correspond to a height ranging between 9.75 inches and 10.25 inches or between 9.5 inches and 10.5 inches. In another example, "about 18 inches" may correspond to a height ranging between 17.75 inches and 18.25 inches or between 17.5 inches and 18.5 inches.

In some implementations, the height, $h_{t,1}$, of the bassinet accessory 500*a* and/or the height, $h_b$, of the bottom portion 301*a* may remain substantially unchanged between the folded and unfolded configurations. For example, the support tubes 540 and the hub 550 may only cause the bassinet accessory 500*a* to collapse along a lateral direction when folding the bassinet accessory 500*a* together with the playard 1000*b* (i.e., the lateral dimensions of the partially enclosed space 501 decrease while the height, $h_{t,1}$, remains substantially unchanged). Furthermore, the leg support assemblies 110*a* may remain upright between the folded and unfolded configurations as described above, thus the height, $h_b$, may also remain substantially unchanged.

In another example, the frame 100*b* may flare outwards when unfolded to improve, for example, the mechanical stability of the playard 1000*b*. Alternatively, as shown in the side view of FIG. 50C, a playard frame 100*c* with curved legs, similar to that shown in FIG. 23C, may be equipped with a bassinet accessory. In FIG. 50C, the bassinet soft goods are not shown so as to reveal a relative position of the hub 550 and the support tubes 540 as viewed from the side in an unfolded configuration. Although the bassinet soft goods are not explicitly shown in FIG. 50C, the figure nonetheless indicates that respective bottom corners 537 of the bassinet soft goods would be located at respective distal ends of the support tubes 540. FIG. 50C also shows the overall height $H_1$ of the frame 100*c*, and the respective heights $h_{t,1}$ and $h_b$ as discussed above.

Additionally, it should be appreciated that the bassinet accessory 500*a* and, in particular, the bassinet soft goods 522 may fold and/or crumple when folding the playard 1000*b*. These factors may contribute to small changes in the height, $h_{t,1}$, of the bassinet accessory 500*a* and/or the height, $h_b$, of the bottom portion 301*a* between the folded and unfolded configurations. For example, the height, $h_{t,1}$, in the unfolded configuration may change to the height, $h_{t,2}$, in the folded configuration (see, for example, FIG. 61). However, the variations in the heights $h_{t,1}$ and $h_b$ may be sufficiently small such that the support tubes 540 and the hub 550 remain disposed near to or within the interior space 102 of the playard 1000*b*. Said in another way, the dimensional relations between, for example, the length of the support tube 540 and the heights $h_{t,1}$ and $h_b$, as described below, may remain substantially unaffected due to variations in the heights $h_{t,1}$, and $h_b$. In some implementations, the heights $h_{t,1}$, and $h_b$ may increase or decrease by less than or equal to 1 inch.

In some implementations, the bassinet accessory 500*a* may satisfy various consumer safety standards (e.g., ASTM F2194). Thus, the combination of the playard 1000*b* and the bassinet accessory 500*a* may satisfy ASTM F406, as described above, and ASTM F2194 together. For example, the bassinet accessory 500*a* and, in particular, the hub 550 and the support tubes 540 may provide a sufficiently flat platform for the mattress 510 to rest upon such that the angle between neighboring segments 512 of the mattress 510 are less than 7 degrees. Additionally, the bassinet accessory 500*a* may have no openings with a diameter ranging between 0.210 inches and 0.375 inches to prevent finger entrapment. The bassinet accessory 500*a* may further have no components that undergo a scissoring or shearing motion. The bassinet accessory 500*a* and, by extension, the playard 1000*b* may support a static load of 54 lb or 3 times the manufacturer's recommended weight (whichever is greater) for at least 60 seconds. The bassinet accessory 500*a* may be dimensioned and/or shaped such that any gaps between the edges of the mattress 510 and the side surfaces 524 of the bassinet soft goods 522 is less than 0.5 inches. Additionally, the height, $h_m$, from the top surface 511 of the mattress 510 to the top side 92 of the playard 1000*b* may be greater than or equal to 7.5 inches.

FIGS. 51A and 51B show the mattress 510 may be removed from the bassinet accessory 500*a* and/or the playard 1000*b* for use in both the bassinet mode and the playard mode of the foldable playard 1000*b*. Specifically, FIG. 51A shows the playard 1000*b* in the bassinet mode (i.e., the bassinet accessory 500*a* is installed on the playard 1000*b*) where the mattress 510 is disposed on top of the hub 550 and the support tubes 540. FIG. 51B shows the playard 1000*b* in the playard mode (i.e., the bassinet accessory 500*a* is removed from the playard 1000*b*) where the mattress 510 is disposed on the floor portion 304 of the soft goods 300 (e.g., the mattress 510 rests on the ground). The mattress 510 may be a foldable component that provides a flat cushioned surface 511 for the child to play and/or sleep when unfolded and a compact structure for storage with the other components of the playard 1000*b* when folded.

In some implementations, the mattress 510 may be a segmented mattress with multiple panels 512 that fold relative to each other along corresponding creases formed between adjoining panels 512. For example, FIGS. 51A and 51B show the mattress 510 may include four panels 512 with one panel 512 folded for demonstration. In addition to providing a flat cushioned surface 511 to support the child, the mattress 510 may also wrap around the frame 100*b*, the soft goods 300, and the support structure 520 when the playard 1000*b* is folded for storage (see, for example, FIG. 54A). In some implementations, the mattress 510 may include one or more straps 514 disposed on a bottom side opposite the cushioned surface 511 to securely couple opposing panels 512 of the mattress 510 together to restrain the frame 100*b* and thus, maintain the playard 1000*b* in the folded configuration. The mattress 510 may further include a handle 516 for the caregiver to carry the playard 1000*b* with the bassinet accessory 500*a*.

FIG. 52 shows the bassinet accessory 500*a* with the mattress 510 removed, thus exposing the hub 550, the support tubes 540, and the remaining portions of the bassinet soft goods 522. The side surfaces 524 and the bottom surface 526 of the bassinet soft goods 522 may be formed of a compliant material including, but not limited to, a fabric, a mesh, and plastic. In some implementations, at least a portion of the side surfaces 524 may be transparent and/or see-through. Furthermore, the transparent and/or see-through portions of the bassinet soft goods 522 may overlap with the transparent and/or see-through portions of the soft goods 300 to effectively provide the caregiver one or more windows to monitor their child in the partially enclosed space 501.

In some implementations, a top portion of the side surfaces 524 may be formed of a fabric material to attach the bassinet accessory 500*a* to the soft goods 300 while the bottom portion of the side surfaces 524 may be formed of a transparent and/or see-through material. For the bassinet accessory 500*a*, the bottom surface 526 of the bassinet soft goods 522 may not include an opening sufficiently large for a user to insert their hand through and into the bottom portion 301*a* of the playard 1000*b*. Said in another way, the bassinet soft goods 522 in the bassinet accessory 500*a* may prevent the user from accessing the bottom portion 301*a* of the playard 1000*b*. However, it should be appreciated that in other implementations, the bottom surface 526 may include an opening, in part, to facilitate folding of the bassinet accessory and the playard together (see, for example, the bassinet accessory 500*b*).

The bassinet accessory 500*a* may generally be coupled to the soft goods 300 (or directly to the frame 100*b*) via a coupling mechanism that allows the bassinet accessory 500*a* to be readily removable from the playard 1000*b* when, for example, the child outgrows the bassinet accessory 500*a*. The bassinet accessory 500*a* may generally be coupled to the soft goods 300 and/or the frame 100*b* in several ways including, but not limited to, a zipper mechanism and straps (e.g., one strap connected to the bassinet accessory 500*a* may extend over a portion of the soft goods 300 covering a corner 130 and clip onto a corresponding strap coupled to the frame 100*b* via a buckle).

For example, FIG. 53A shows the bassinet accessory 500*a* may be coupled to the soft goods 300 via a zipper mechanism 527. As shown, the top edges of the side surfaces 524 may support one set of zipper teeth 529 and a zipper handle 528 that couples to another set of zipper teeth 340 disposed on an interior bottom edge of the top portion 302 of the soft goods 300. Thus, the bassinet accessory 500*a*, via the bassinet soft goods 522, may hang from the interior side of the top portion 302 of the soft goods 300. Said in another way, the zipper mechanism 527 may be disposed within the partially enclosed space 501 along the interior sides of the bassinet soft goods 522 and the top portion 302 such that the zipper mechanism 527 is not observable from the exterior of the playard 1000*b*.

FIG. 52 shows the bassinet soft goods 522 may have a height, $h_{sg}$, that is less than the height, $h_{t,1}$, of the bassinet accessory 500*a*. However, it should be appreciated that in other implementations, the bassinet soft goods 522 may extend over the top portion 302 of the soft goods 300 and couple to the soft goods 300 and/or the frame 100*b* along the exterior of the playard 1000*b*. For these implementations, the height, $h_{sg}$, may be approximately equal or equal to the height, $h_{t,1}$, of the bassinet accessory 500*a*.

The caregiver may align and attach the zipper teeth 340 and 529 via the zipper handle 528 to install the bassinet accessory 500*a* onto the playard 1000*b*. Additionally, the caregiver may readily remove the bassinet accessory 500*a* from the playard 1000*b* by pulling on the zipper handle 528 to disengage the zipper teeth 340 and 529. Once the bassinet accessory 500*a* is removed from the playard 1000*b*, the bassinet accessory 500*a* may be folded as shown in FIG. 53B and stowed separately.

The zipper mechanism 527 may generally span at least a portion of the side surfaces 524 to securely couple the bassinet accessory 500*a* to the soft goods 300. In some implementations, the bassinet accessory 500*a* and the soft goods 300 may include multiple zipper mechanisms 527 that each span different portions of the side surfaces 524 such that collectively, the multiple zipper mechanisms 527 span the entirety of the top edges of the side surfaces 524. The zipper mechanism 527 may generally reduce or, in some instances, eliminate unwanted openings formed between the side surfaces 524 and the top portion 302.

As described above, the support tubes 540 and the hub 550 may form a foldable structure generally disposed on the bottom surface 526 of the bassinet soft goods 522 to facilitate folding and/or unfolding of the bassinet accessory 500*a* together with the frame 100*b*. As shown in FIG. 52, the hub 550 may be disposed at or near the center of the bottom surface 526 and the support tubes 540 may extend radially from the hub 550 to the respective corner portions 537 of the bottom surface 526 of bassinet soft goods 522. Said in another way, the support tubes 540 may be disposed along the diagonal segments of the bottom surface 526 (i.e., the line segments connecting the corners of the bottom surface 526 that do not share the same edge).

To facilitate folding and/or unfolding of the bassinet accessory 500*a*, each support tube 540 may be rotatably coupled to the hub 550. In particular, each support tube 540 may have a first end 542*a* rotatably coupled to the hub 550 and a second end 542*b* opposite the first end 542*a* disposed at one corner portion 537 of the bassinet soft goods 522. Additionally, the support tubes 540 and/or the hub 550 may be directly coupled to the bassinet soft goods 522 via one or more attachment mechanisms so that the bassinet soft goods 522 move together with the support tubes 540 and/or the hub 550 when folding and/or unfolding the bassinet accessory 500*a*. The attachment mechanisms may include, but are not limited to, a strap, a screw fastener, a webbing tab, and a fabric tunnel.

In some implementations, the attachment mechanism(s) may be disposed at or near opposing ends 542*a* and 542*b* of each support tube 540 to ensure the center portion and the side portions of the bottom surface 526 of the bassinet soft goods 522 fold together with the support tubes 540 and the hub 550. For instance, FIG. 52 shows the bottom surface 526 of the bassinet soft goods 522 may include a strap 530 that forms a fabric tunnel through which the support tube 540 is inserted. The strap 530 may be disposed near the first end 542*a* of the support tube 540 and sewn directly onto the bottom surface 526 of the bassinet soft goods 522. For example, the support tube 540 may have a length, $L_t$, and the strap 530 may be offset from the end 542*a* of the support tube 540 by a distance less than 50% of the length $L_t$. In some implementations, the strap 530 may be positioned sufficiently close to the hub 550 such that at least a portion of the strap 530 physically contacts the hub 550. FIG. 53B further shows the second end 542*b* of each support tube 540 may be fastened directly to the bassinet soft goods 522 via a screw fastener 534*a* inserted from the bottom side of the bottom surface 526 through an opening 532 at the corner portion 537.

In the unfolded configuration, the support tubes 540 and the hub 550 provide a flat platform to support the mattress 510 as shown in FIG. 52 where the support tubes 540 are oriented substantially horizontal or horizontal along the bottom surface 526 of the bassinet soft goods 522. In the folded configuration, the support tubes 540 rotate with respect to the hub 550 such that the support tubes 540 are oriented substantially vertical or vertical. For the bassinet accessory 500*a*, the hub 550 moves upwards when unfolding the bassinet accessory 500*a* and, conversely, downwards when folding the bassinet accessory 500*a*.

In some implementations, the ends 542*b* of each support tube 540 may remain stationary or substantially stationary with respect to the ground 90 (e.g., the bassinet soft goods 522 may deform causing the ends 542*b* and/or the corner portions 537 to vary slightly as described above). In other words, the ends 542*b* of each support tube may remain at a height, $h_b$, from the ground 90 even as the ends 542*b* displace laterally when the bassinet accessory 500*a* is folded and unfolded. Thus, as the hub 550 is displaced vertically, the support tubes 540 may rotate with respect to the hub 550 where the ends 542*b* of each support tube 540 function as a pivot point that is constrained to move only laterally (e.g., a pin joint disposed in a slider joint).

In some implementations, the bassinet accessory 500*a* and the playard 1000*b* may be shaped and/or dimensioned such that the hub 550 and the support tubes 540 remain substantially within or entirely within the interior space 102 in both the folded and unfolded configurations. In other words, the bassinet accessory 500*a* does not increase the overall size of the foldable playard 1000*b*. This may be accomplished by tailoring the length, $L_t$, of each support tube 540 to be approximately less than or equal to the height, $h_b$, of the bottom portion 301*a* separating the bottom surface 526 from the ground 90 in the unfolded configuration. Since the ends 542*b* of each support tube 540 remain at the same or similar height, $h_b$, from the ground 90, the support tube 540 does not extend past the feet 114 of the frame 100*b* when it rotates from a horizontal orientation corresponding to the unfolded configuration to a vertical orientation corresponding to the folded configuration. In some implementations, the height, $h_b$, may be sufficiently greater than the length, $L_t$, of the support tube 540 such that the hub 550 is also contained entirely within the interior space 102 in the folded configuration.

It should be appreciated the support tubes 540 and the hub 550 of the bassinet accessory 500*a* may remain within the interior space 102 of the playard 1000*b* due, in part, to the relatively shallower height, $h_{t,1}$, of the partially enclosed space 501, which results in a larger height, $h_b$, for the bottom portion 301*a* for a given height, H, of the playard 1000*b*. As a result, the support tubes 540 may be formed from a single rigid component, simplifying manufacture and assembly of the bassinet accessory 500*a*. However, it should be appreciated that, in other implementations, the length of the support tube may be changed between the folded and unfolded configurations to ensure the bassinet accessory remains substantially confined within the interior space 102 of the playard 1000*b* (see, for example, the telescoping support tubes 540 in the bassinet accessory 500*b*).

FIGS. 54A-54C show a series of figures that illustrate the process of unfolding the foldable playard 1000*b* and the bassinet accessory 500*a*. Specifically, FIG. 54A shows the foldable playard 1000*b* in the folded configuration. As shown, the bassinet accessory 500*a* is contained entirely within the interior space 102 of the playard 1000*b* and, hence, is not observable in FIG. 54A. Furthermore, FIG. 54A shows the mattress 510 may wrap around the frame 100*b* to maintain the playard 1000*b* in the folded configuration.

To unfold the playard 1000*b* with the bassinet accessory 500*a*, the mattress 510 is first removed from the frame 100*b*. The caregiver may then pull the slider 120 towards the corner 130 of one leg support assembly 110*a* to at least partially unfold the frame 100*b*. In some implementations, the caregiver may pull the slider 120 until the latch 200*a* is engaged, thus locking the frame 100*b* in the unfolded configuration. Since the bassinet soft goods 522 are coupled to the soft goods 300, the bassinet accessory 500*a* may also at least partially unfold in response to the frame 100*b* unfolding. However, the weight (i.e., the gravitational force) of the support tubes 540 and the hub 550 may cause the bassinet accessory 500*a* to sag downwards even when the frame 100*b* is locked in the deployed unfolded configuration.

To prevent the support tubes 540 and the hub 550 from sagging downwards, the hub 550 may include a hub latch 570 with a release handle 576 that, when in a locked state, prevents the support tubes 540 from rotating relative to the hub 550. While unfolding the bassinet accessory 500*a*, the hub latch 570 may instead be in an unlocked state to allow the caregiver to pull the hub latch 570 and, in turn, rotate the support tubes 540. As shown in FIGS. 54B and 54C, the support tubes 540 may rotate towards a horizontal orientation corresponding to the unfolded configuration as the hub latch 570 is pulled upwards (see A in FIG. 54C). Once the bassinet accessory 500*a* is unfolded, the hub latch 570 may be rotated (see B in FIG. 54C) to change the hub latch 570 from an unlocked state to a locked state thus maintaining the support tubes 540 and the hub 550 at the desired unfolded configuration. The hub 550 may further include integrated mechanical stops 554 to prevent the hub 550 from moving further upwards once the hub 550 and the support tubes 540 are at the deployed unfolded configuration. This ensures the caregiver is unable to move the hub 550 past the desired unfolded configuration.

Additionally, conventional playards typically include a bottom support structure that folds with the frame. When unfolding the playard, the caregiver should bend over and reach through an opening in the bassinet soft goods to press down upon the bottom support structure to ensure the bottom support structure is properly unfolded. In contrast, the playard 1000*b* may not include a separate bottom support structure as described above. This means the caregiver does not have to bend over and reach down towards the floor portion 304 of the soft goods 300 when unfolding the bassinet accessory 500*a* together with the playard 1000*b*. Rather, the caregiver may pull on the hub latch 570, which is already positioned above the ground 90 when the bassinet accessory 500*a* is partially unfolded in response to the unfolding of the frame 100*b*. In this manner, the caregiver may experience less physical strain when unfolding the bassinet accessory 500*a*.

To fold the playard 1000*b* and the bassinet accessory 500*a*, the caregiver may release the hub latch 570 (and the latch 200*a*) and press down on the hub 550 and/or move the slider 120 of one leg support assembly 110*a* downwards towards the corresponding foot 114. In this manner, the bassinet accessory 500*a* may be unfolded and folded without assembling and disassembling, respectively, a portion of the bassinet accessory 500*a* unlike conventional bassinet accessories (e.g., the support tube assemblies 64 in the bassinet accessory 60).

FIGS. 55A and 55B show several views of the hub 550 and the hub latch 570 in the locked state. FIGS. 56A and 56B show several views of the hub 550 and the hub latch 570 in the unlocked state. As shown, the hub 550 may include a base 551 with a channel 552 to receive each support tube 540. The hub 550 may further include a pair of snap-fit hooks 555 for each channel 552 where each pair of snap-fit hooks 555 are disposed on opposing sides of the corresponding channel 552 and on a bottom side of the hub 550. The snap-fit hooks 555 are shaped to receive a pin 544 coupled to the support tube 540 to facilitate rotation of the support tube 540. Thus, each pair of snap-fit hooks 555 defines a rotation axis 556 about which the support tube 540 rotates with respect to the hub 550.

The channel 552 may extend from the edge of the base 551 to an end 567 located near the center of the base 551. The channel 552 may have a length, $L_c$, corresponding to the distance between the edge of the base 551 and the end 567. As shown, the channel 552 may have a notched opening on the top side of the base 551 that extends from the edge of the base 551 and terminates before reaching the end 567. The bottom side of the channel 552 may have a mechanical stop 554 (e.g., a section of the hub 550 that extends around the support tube 540 and across the channel 552) disposed at the edge of the base 551 and an opening 553 that extends from the mechanical stop 554 to the end 567 of the channel 552.

The features of the channel 552 (e.g., the notched opening, the mechanical stop 554, the opening 553) may be shaped, dimensioned, and positioned to constrain the rotational motion of the support tube 540. In particular, the channel 552 may only allow the support tube 540 to rotate between a horizontal orientation and a vertical orientation when folding or unfolding the bassinet accessory 500*a*. For example, the notched opening allows the support tube 540 to rotate such that the end 542*b* may be disposed above the hub 550 when folding the bassinet accessory 500*a*. In another example, the mechanical stop 554 may be shaped to physically contact the support tubes 540 once the support tubes 540 are oriented horizontally. In this manner, the mechanical stops 554 may limit the rotation of the support tubes 540 such that the hub 550 is unable to move past the desired unfolded configuration when unfolding the bassinet accessory 500*a*.

As described above, the hub 550 may further include a hub latch 570. When the hub latch 570 is in the locked state, the combination of the hub 550 and the hub latch 570 prevents the support tubes 540 from moving relative to the hub 550 and, hence, prevents the hub 550 from moving relative to the playard 1000*b*. In this manner, the hub latch 570 locks the bassinet accessory 500*a* in the unfolded configuration.

The hub latch 570 may be rotatably coupled to the base 551 via a rolled rivet 566 disposed at the center of the base 551. As shown in FIG. 55A, the hub latch 570 may include a base 572 disposed within a center opening 558 of the base 551. The hub latch 570 may include a release handle 576 for the caregiver to grab and pull when unfolding the bassinet accessory 500*a*. The hub 550 may further include multiple hooks 560 disposed on the bottom side of the base 551 and around the periphery of the base 572 of the hub latch 570 to provide additional mechanical support to the hub latch 570. In particular, the hooks 560 may impose mechanical constraints that limit the hub latch 570 only to rotational motion about the rolled rivet 566.

To lock the support tubes 540, the hub latch 570 may include arms 574 for each support tube 540 that extend radially from the base 572. FIG. 55B shows each arm 574 may be disposed over the opening 553 of a corresponding channel 552 in the locked state. Thus, the combination of the arm 574 and the mechanical stop 554 may effectively for a clamp that constrains and prevents movement of the support tube 540 relative to the hub 550. FIGS. 56A and 56B show when the hub latch 570 is rotated to the unlocked state, the arms 574 no longer cover the openings 553 of each channel 552, which allows the support tubes 540 to rotate relative to the hub 550 towards the folded configuration.

In some implementations, the hub 550 may further include a spring element 565 (e.g., a torsion spring) that generates a spring bias force to rotate the hub latch 570 towards the locked state. To ensure the hub latch 570 does not move past the locked state (e.g., the arms 574 move past the openings 553), the hub 550 may include mechanical stops 562 (e.g., a rib that projects downwards from the base 551) for the arms 574 to rest against. The mechanical stops 562 are positioned on the base 551 such that the arms 574 are disposed over the corresponding openings 553.

FIG. 57 shows another exemplary bassinet accessory 500*b* coupled to the playard 1000*b*. As shown, the bassinet accessory 500*b* may include a support structure 520 that defines a partially enclosed space 501 to contain the child in the unfolded configuration. The support structure 520 may include bassinet soft goods 522 with side surfaces 524 and a bottom surface 526 that surround at least a portion of the partially enclosed space 501. The support structure 520 may further include a hub 550 and support tubes 540 that form a foldable structure to facilitate folding and unfolding of the bassinet accessory 500*b*. In the unfolded configuration, the support tubes 540 and the hub 550 may form a flat platform to support a mattress (not shown).

It should be appreciated that the bassinet accessory 500*b* may also be installed onto other playards. For examples, FIG. 61 shows the bassinet accessory 500*b* may be installed on the playard 1000*c* described above.

The bassinet soft goods 522, the support tubes 540, and the hub 550 of the bassinet accessory 500*b* may incorporate similar features described above for the bassinet accessory 500*a*. For brevity, these features are not repeated below. Additionally, the shape and dimensions of the bassinet accessory 500*b*, including the heights, $h_{t,1}$, $h_b$, and $h_m$, may be similar to or the same as the dimensions described above for the bassinet accessory 500*a*. The bassinet accessory 500*b* may also meet various consumer safety standards (e.g., ASTM F2194) as described above in relation to the bassinet accessory 500*a*.

FIG. 57 shows the hub 550 may be disposed at or near the center of the bottom surface 526 and the support tubes 540 may extend radially from the hub 550 to the respective corner portions 537 of the bottom surface 526 of the bassinet soft goods 522 similar to the bassinet accessory 500*a*. The support tubes 540 may be rotatably (e.g., pivotably) coupled to the hub 550 to facilitate folding and unfolding of the bassinet accessory 500*b*. The support tubes 540 may also be coupled directly to the bassinet soft goods 522 via one or more attachment mechanisms such that the bassinet soft goods 522 move together with the support tubes 540 and the hub 550 when folding and unfolding the bassinet accessory 500*b*. It should be appreciated that, in other implementations, the bassinet soft goods 522 may be coupled to the hub 550.

In this example, the hub 550 moves upwards when folding the bassinet accessory 500*b* and, conversely, downwards when unfolding the bassinet accessory 500*b*. The benefit of this approach is that the bassinet accessory 500*b* may maintain the deployed unfolded configuration without a separate locking mechanism (e.g., the hub latch 570), thus simplifying the hub 550. In the unfolded configuration, the support tubes 540 and the hub 550 may once again provide a flat platform to support the mattress 510 where the support tubes 540 are oriented substantially horizontal or horizontal along the bottom surface 526 of the bassinet soft goods 522. In the folded configuration, the support tubes 540 rotate (e.g., pivot) with respect to the hub 550 such that the support tubes 540 are oriented substantially vertical or vertical and such that the ends 542*b* of the support tubes are disposed below the hub 550 in the folded configuration.

The hub 550 may once again include integrated mechanical stops 554 to prevent the hub 550 from moving past the unfolded configuration once the support tubes 540 are aligned horizontally. Compared to the bassinet accessory 500*a*, however, the weight of the hub 550 and/or the support tubes 540 does not cause the bassinet accessory 500*b* to unfold. Rather, the weight of the hub 550, the support tubes 540, the child, and/or the mattress 510 apply a force that unfolds the bassinet accessory 500*b* and thereafter maintains the bassinet accessory 500*b* in the unfolded configuration. In this manner, the process of unfolding the bassinet accessory 500*b* may be simplified.

One challenge, however, is that the bassinet accessory 500*b* may provide a relatively shallow partially enclosed space 501. For example, in the folded configuration, the length, $L_{t,1}$, of the support tubes 540, is longer than the height, $h_t$, of the bassinet accessory 500*b*. Similar to the bassinet accessory 500*a*, the distal ends 542*b* of each support tube 540 in the bassinet accessory 500*b* may remain stationary or substantially stationary with respect to the ground 90. In other words, the distal ends 542*b* of each support tube may remain at a height, $h_{t,1}$, from the top horizontal plane 92 of the playard 1000*b* as the ends 542*b* displace laterally when the bassinet accessory 500*b* is folded and unfolded. If the length of the support tubes 540 remains constant (e.g., the support tube is formed of a single rigid component), the rotation of the support tubes 540 from the horizontal orientation in the unfolded configuration to the vertical orientation in the folded configuration would cause the hub 550 and a portion of the support tubes 540 to protrude above the top horizontal plane 92 of the playard 1000*b* in the folded configuration, thus increasing the overall size of the foldable playard 1000*b* in the folded configuration.

To reduce the extent the bassinet accessory 500*b* protrudes above the top horizontal plane 92 of the playard 1000*b* in the folded configuration, the support tubes 540 may be telescoping such that the length, $L_{t,1}$, of the support tubes 540 in the unfolded configuration changes to a shorter length $L_{t,2}$, in the folded configuration. Thus, in some implementations, the length, $L_{t,1}$, of the support tubes 540 in the unfolded configuration is greater than the height, $h_{t,1}$, of the bassinet accessory 500*b* while the length, $L_{t,2}$, of the support tubes 540 in the folded configuration is approximately equal to or less than the height, $h_{t,1}$. It should be appreciated that, in some implementations, the height of the bassinet accessory 500*b* may change between the folded and unfolded configurations. For example, FIG. 61 shows the bassinet accessory 500*b* may have a height, $h_{t,2}$, in the folded configuration that differs from the height, $h_{t,1}$, in the unfolded configuration due, for example, to the deformation of the bassinet soft goods 522. For these implementations, the length, $L_{t,1}$, of the support tubes 540 in the unfolded configuration remains greater than the height, $h_{t,1}$, and the length, $L_{t,2}$, of the support tubes 540 in the folded configuration is approximately equal to or less than the height, $h_{t,2}$.

To unfold the playard 1000*b* with the bassinet accessory 500*b*, the caregiver may remove the mattress 510 wrapped around the frame 100*b* as before. Then, the caregiver may move a slider 120 towards a corner 130 of one leg support assembly 110*a* to unfold the frame 100*b*. Once the slider 120 is moved sufficiently to engage the latch 200*a*, the frame 100*b* is locked in the unfolded configuration. As before, the unfolding of the frame 100*b* may cause the bassinet accessory 500*b* to at least partially unfold. In some implementations, the weight of the hub 550 and the support tubes 540 may be sufficient to ensure the bassinet accessory 500*b* unfolds without any external force applied by the caregiver. In some implementations, the caregiver may simply push down upon the hub 550 to unfold the bassinet accessory 500*b*. In some implementations, the caregiver may place the mattress 510 onto the hub 550 and the weight of the mattress 510 may ensure the bassinet accessory 500*b* is in the unfolded configuration. Similar to the bassinet accessory 500*a*, the bassinet accessor 500*b* may be unfolded without the caregiver having to reach down towards the floor portion 304, which may reduce the physical strain experienced by the caregiver when unfolding the bassinet accessory 500*b*.

FIGS. 58A-58D show a series of figures that illustrate the process of folding the playard 1000*b* and the bassinet accessory 500*b*. FIG. 58A shows the hub 550 may include a center opening 558 and the bottom surface 526 of the bassinet soft goods 522 may include a center opening 536. To fold the playard 1000*b* and the bassinet accessory 500*b*, the caregiver may first disengage the latch 200*a* on the frame 100*b*. Then, the caregiver may extend their hand/arm through the center openings 558 and 536 to access the bottom portion 301*a* of the playard 1000*b*. FIG. 58B shows the floor portion 304 of the soft goods 300 may include a strap 342. When the caregiver reaches into the bottom portion 301*a*, they may pull the strap 342 together with the floor portion 304 of the soft goods 300 in an upwards direction. FIG. 58C shows the caregiver may continue to pull the strap 342 through the center openings 536 and 558, which causes the floor portion 304 to contact the bassinet soft goods 522 and/or a portion of the hub 550. As the caregiver continues to pull the strap 342 further, the contact between the floor portion 304 and the bassinet soft goods 522 and/or the hub 550 causes the hub 550 to move upwards and the support tubes 540 to rotate such that the ends 542*b* move downwards relative to the hub 550 (see arrows in FIG. 58C). The caregiver may continue to pull on the strap 342 until the playard 1000*b* and the bassinet accessory 500*b* are folded as shown in FIG. 58D.

In some implementations, the playard 1000*b* and the bassinet accessory 500*b* may be folded without the caregiver having to insert their hand/arm through the center openings 536 and 558. Instead, the caregiver may pull up on the hub 550 and/or move the slider 120 down towards the foot 114 to fold the playard 1000*b* and the bassinet accessory 500*b*. Once the playard 1000*b* is folded, the caregiver may lay the playard 1000*b* on its side and press floor portion 304 into the interior space 102 before wrapping the mattress 510 around the frame 100*b*. In this manner, the caregiver does not have to bend over and reach down to the floor portion 304.

In some implementations, the length, $L_{t,2}$, of the support tubes 540 in the folded configuration may be tailored such that the hub 550 is disposed entirely within the interior space 102 (i.e., the hub 550 does not extend significantly beyond the top horizontal plane 92). In some implementations, the length, $L_{t,2}$, of the support tubes 540 may be tailored such that the hub 550 protrudes above the top horizontal plane 92 with a bottom side of the hub 550 flush against the top horizontal plane 92. This configuration may be preferential when the exterior width of the hub 550 is greater than or equal to the width of the interior space 102 in the folded configuration. Under these conditions, the lateral dimensions of the playard 1000*b* may increase if the hub 550 is disposed within the interior space 102, which may be undesirable. Thus, by positioning the hub 550 just above the playard 1000*b*, the lateral dimensions of the frame 100*b* in the folded configuration may be kept small (i.e., the lateral dimensions would be the same when the playard 1000*b* does not include the bassinet accessory 500*b*) without appreciably increasing the height of the playard 1000*b* in the folded configuration. In some implementations, the top side of the hub 550 may extend above the top horizontal plane 92 of the playard 1000*b* by a distance less than or equal to 1 inch.

FIGS. 59A-59C show several views of the bassinet accessory 500*b* removed from the playard 1000*b*. As shown, the center opening 536 of the bassinet soft goods 522 may be aligned with the center opening 558 of the hub 550. In some implementations, the center opening 536 may have a width that is equal to or smaller than the exterior width of the hub 550. In other words, the center opening 536 may only be accessible through the center opening 558 and not from the sides of the hub 550. It should be appreciated that, in other implementations, the hub 550 and/or the bassinet soft goods 522 may not include the center openings 536 and 558, respectively. Instead, the caregiver may fold the bassinet accessory 500*b* by pulling on the hub 550 as described above.

FIG. 59A further shows each support tube 540 may have a first support tube 546*a* coupled to the hub 550 and a second support tube 546*b* telescopically coupled to the first support tube 546*a*. As shown, the first support tube 546*a* may have a larger width (or diameter) such that a portion of the second support tube 546*b* may be disposed within the first support tube 546*a*. It should be appreciated, however, that in other implementations, the first support tube 546*a* may have a smaller width than the second support tube 546*b* such that a portion of the first support tube 546*a* is disposed within the second support tube 546*b*. The relative lengths of the first and second support tubes 546*a* and 546*b* may be chosen to provide a desired length, $L_{t,1}$, in the unfolded configuration and a desired length, $L_{t,2}$, in the folded configuration. For example, the length, $L_{t,1}$, may be chosen such that the end 542*b* extends to the corner portion 537 and the length, $L_{t,2}$, may be approximately equal to or less than the height, $h_{t,1}$ (or the height, $h_{t,2}$) as described above.

In some implementations, the support tube 540 may include a spring element (not shown) disposed within the first support tube 546*a* to impart a bias force that extends the length of the support tube 540 (e.g., the spring element may move the second support tube 546*b* away from the first support tube 546*a*). Additionally, one or both of the support tubes 546*a* and 546*b* may include a mechanical stop (not shown) that limits the extent the second support tube 546*b* extends from the first support tube 546*a*. Furthermore, the first support tube 546*a* and the second support tube 546*b* may overlap in the unfolded configuration. For example, FIG. 60A shows an overlap section 548. In some implementations, the overlap section 548 may have a length of about 1.5 inches to ensure the support tube 540 has sufficient mechanical rigidity to support the bassinet accessory 500*b* in the unfolded configuration.

FIGS. 59A and 59B further show each support tube 540 may be directly coupled to the bottom surface 526 of the bassinet soft goods 522 via a strap 530 with a fastener 534*b* disposed near the end 542*a* of the first support tube 546*a*. As shown in FIG. 60A, the strap 530 may include a fastener 534*a* to couple the strap 530 to the first support tube 546*a*. The strap 530 may further be sewn directly into the bottom surface 526 to form a fabric tunnel that physically contacts the hub 550. FIG. 60B further shows a fastener 534*a* may couple the bassinet soft goods 522 to the end 542*b* of the second support tube 546*b*. As shown, the fastener 534*a* may be inserted through an opening (not shown) at or near the corner portion 537 from the bottom side of the bottom surface 526.

Similar to the bassinet accessory 500*a*, the bassinet accessory 500*b* may be coupled to the top portion 302 of the soft goods 300 via multiple zipper mechanisms 527. In this manner, the caregiver may readily remove the bassinet accessory 500*b* from the playard 1000*b* for cleaning or storage. FIG. 59C shows the bassinet accessory 500*b* folded for storage. The hub 550 may once again include a base 551 with multiple channels 552 to receive the support tubes 540. The channel 552 may provide support for a pin 544 mounted to each support tube 540 to facilitate rotation of the support tube 540 relative to the hub 550. As shown in FIG. 59C, the top side of the channel 552 may be covered by a section of the base 551 corresponding to the mechanical stop 554 while the bottom side of the channel 552 may be exposed. Thus, support tube 540 may rotate such that the end 542*b* of the support tube 540 is disposed below the hub 550 when folding the bassinet accessory 500*b*. When the support tubes 540 are horizontally oriented in the unfolded configuration, the mechanical stops 554 may physically contact the support tubes 540 thus preventing the hub 550 from moving past the unfolded configuration.

FIG. 61 shows the bassinet accessory 500*b* may be installed onto the playard 1000*c* in a similar manner as the playard 1000*b*. For clarity, the bassinet soft goods 522 are not shown. Instead, FIG. 61 shows a plane 538 corresponding to the respective bottom corner portions 537 of the bassinet soft goods 522 for reference. As shown, the hub 550 may be disposed above the top horizontal plane 92 of the playard 1000*c* such that the bottom side of the hub 550 is flush with the top horizontal plane 92. As described above, this arrangement may ensure the frame 100*c* folds to its smallest lateral dimensions without appreciably increasing the height of the playard 1000*c* due to the addition of the bassinet accessory 500*b*. FIG. 61 also shows the support tube 540 in its contracted state where the second support tube 546*b* is disposed nearly entirely within the first support tube 546*a*.

In yet another example, the foldable playard may support one or more toppers to expand the utility of the playard beyond just providing a partially enclosed space to contain the child. The foldable playard may generally support various types of toppers including, but not limited to, a changing table, an organizer, a bassinet, and a bouncer. For example, a changing table may be mounted to the playard to provide the caregiver a convenient, elevated support platform to change the child's diaper. In another example, an organizer may be mounted to the playard to provide storage for various care items, such as diapers, toys, food, drinks, clothes, blankets, and/or baby powder. In another example, a bassinet topper (also referred to as a "lift-off bassinet") may be placed onto the playard to support the child and provide the caregiver an easy to reach and/or easy to view platform supporting the child. The bassinet topper may be removed from the playard and deployed in other locations (e.g., other rooms of the caregiver's home) to keep the child nearby the caregiver.

FIGS. 62A-62F show one exemplary implementation of the playard 1000*c* supporting a changing table topper 800*a* and a bassinet topper 900*a*. As shown, the changing table topper 800*a* may include a frame 810*a* (also referred to herein as a "topper frame") with a corner assembly 700*a* that couples the topper 800*a* to the frame 100*c* of the playard 1000*c*. The topper 800*a* may further include soft goods 880*a* (also referred to herein as "topper soft goods") coupled to the frame 810*a* and a support platform 890*a* coupled to the soft goods 880*a* to support the child. When deployed, the topper soft goods 880*a* may define an interior space 801 to partially contain the child. The support platform 890*a* may abut the bottom portion of the interior space 801 and, in some implementations, may also be disposed within the interior space 801. The bassinet topper 900*a* may similarly include a frame 910*a* (also referred to herein as a "bassinet topper frame") with a corner assembly 700*a* to securely couple the bassinet topper 900*a* to the frame 100*c*. The bassinet topper 900*a* may also support soft goods 980*a* (also referred to herein as a "bassinet topper soft goods") coupled to the frame 910*a* and a support platform 990*a* coupled to the soft goods 980*a*. When deployed, the soft goods 980*a* may also define an interior space 901 to contain the child. The support platform 990*a* may abut the bottom portion of the interior space 901 and, in some implementations, may also be disposed within the interior space 901.

The shape, dimensions, and/or materials of the soft goods 880*a* and the support platform 890*a* of the changing table topper 800*a* may be differentiated from the soft goods 980*a* and the support platform 990*a* of the bassinet topper 900*a* based on their respective functions. For example, the support platform 890*a* may be positioned at a relatively shallower depth and may have relatively larger dimensions to provide the caregiver a more accessible platform with sufficient space to change their child's diaper. In contrast, the support platform 990*a* may be positioned at a relatively deeper depth and may have relatively smaller dimensions to fit the child more snugly to reduce the likelihood of the child rolling over and/or falling off the topper 900*a*.

As shown in FIGS. 62A-62C, the toppers 800*a* and 900*a* may be disposed near the top portion 108 of the frame 100*c* to provide the caregiver greater ease of access to the respective support platforms 890*a* and 990*a*. In other words, the toppers 800*a* and 900*a* may be positioned closer to the top horizontal plane 92 than the ground surface 90 supporting the playard 1000*c*. In some implementations, the toppers may be arranged to partially cover a portion of the interior space of the playard frame. For example, the toppers 800*a* and 900*a* each cover a portion of the partially enclosed space 301 of the soft goods 300 and, by extension, the interior space 102 of the frame 100*c*. In some implementations, the toppers may also be partially disposed within the partially enclosed space 301 and/or the interior space 102. For instance, the topper frame 910*a* may be disposed above the top horizontal plane 92 and the soft goods 980*a* may hang from the frame 910*a* such that the support platform 990*a* is disposed below the top horizontal plane 92 within the partially enclosed space 301.

When the child is placed onto one of the toppers 800*a* or 900*a*, the center of gravity of the playard 1000*c* together with the child may be located above the interior space 102 or, preferably, within the interior space 102, which reduces or, in some instances, eliminates the risk of the playard 1000*c* tipping over. This arrangement may be preferable for toppers configured to support the child (e.g., the toppers 800*a*, 900*a*). However, it should be appreciated that other toppers that are not configured to support the child, such as an organizer, may be disposed along the exterior of the playard. For example, the organizer section 804*a* of the topper 800*c* may extend laterally to the side of the playard 1000*c* away from the interior space 102 (see FIG. 72A).

The toppers may generally be shaped and/or dimensioned to provide sufficient space for the caregiver to perform the desired function of the topper (e.g., changing a diaper, supporting a sleeping child). In some implementations, the toppers may also be shaped and/or dimensioned based on the shape and/or dimensions of the top perimeter structure of the playard frame to provide (1) sufficient space for multiple toppers to be installed on the playard and (2) sufficient clearances between the topper frame and the playard frame in accordance with various consumer safety standards (e.g., ASTM F406-19).

For example, FIG. 62A shows the toppers 800*a* and 900*a* may be dimensioned to cover only a portion of the interior space 102 so that both toppers 800*a* and 900*a* may be positioned next to one another and between the respective X-frame assemblies 140*a* and 140*b*. The topper frames 810*a* and 910*a* may further conform in shape with the frame 100*c*. For instance, the top periphery of the frame 100*c* may be rectangular in shape and the topper frames 810*a* and 910*a* may also be rectangular in shape. By tailoring the geometry of the toppers 800*a* and 900*a* in this manner, the size of the gaps formed between the topper frames 810*a* and 910*a* and the playard frame 100*c* may be reduced, which, in turn, may reduce or, in some instances, mitigate the likelihood of a child inserting their head between the topper frames 810*a* and 910*a* and the playard frame 100*c*. For example, the topper frames 810*a* and 910*a* may be disposed above the playard frame 100*c* by a combination of support feet 820*a* on the topper frames 810*a* and 910*a* and topper supports 161*a* and 161*b* on the frame 100*c*. In some implementations, the topper frames 810*a* and 910*a* may be separated from the playard frame 100*c* by a gap less than 1.5 inches. In some implementations, the support feet 820*a* and the topper supports 161*a* and 161*b* may also fill a portion of the space between the playard frame 100*c* and the topper frames 810*a* and 910*a* to further block a child from inserting their head through the gaps.

In some implementations, the topper frames may have a tapered geometry. For example, the topper frames 810*a* and 910*a* may have rounded corners. As a result, the gaps formed between toppers 800*a* and 900*a* may be larger than the gaps formed between the respective toppers 800*a* and 900*a* and the playard 1000*c* and, hence, may create an entrapment hazard to the child. Thus, in some implementations, additional storage pockets may be added between the toppers to fill the gaps. For example, FIG. 62F shows the playard 1000*c* may include a pair of auxiliary storage toppers 780 disposed between the toppers 800*a* and 900*a*. The storage topper 780 may provide a storage compartment or pocket to store various care items whilst also filling the space between the toppers 800*a* and 900*a*.

In some implementations, the storage topper 780 may be integrally formed with one of the toppers 800*a* or 900*a*. For example, the storage topper 780 may be attached to one of the topper frames 810*a* or 910*a*. In some implementations, the storage topper 780 may be coupled to at least one of the topper frame 810*a*, the topper frame 910*a*, the soft goods 300, and the X-frame assembly 140*b* (e.g., via an opening in the soft goods 300). Various coupling mechanisms may be used including, but not limited to, a clip, a snap button, and Velcro straps. For example, once the toppers 800*a* and 900*a* are installed, the storage topper 780 may be clamped to both the topper frames 810*a* and 910*a*. The storage topper 780 may be formed from various materials including, but not limited to, soft goods and injection molded plastic.

As described above, the topper frames 810*a* and 910*a* may each include one or more corner assemblies 700*a* to securely couple the respective toppers 800*a* and 900*a* to the playard 1000*c*. Specifically, FIG. 62D shows the corner 130 of one leg support assembly 110*c* may include a topper mount socket 137 and the corner assembly 700*a* may include a corner tube 730*a* shaped and dimensioned to be inserted into the topper mount socket 137. The corner assembly 700*a* may further include a latch lever 740*a* to securely couple the corner tube 730*a* to the topper mount socket 137 once the corner tube 730*a* is inserted into the topper mount socket 137. The latch lever 740*a* may be actuated by the caregiver to disengage the corner tube 730*a* from the topper mount socket 137, thus allowing the caregiver to remove the toppers 810*a* or 910*a* from the playard 1000*c*.

In some implementations, each corner 130 of the frame 100*c* may have a topper mount socket 137, which provides the playard 1000*c* multiple spots to support one or more toppers (e.g., the toppers 800*a* and 900*a*). The corners 130 may further be identical to one another as described above, which may reduce manufacturing costs since only one type of corner is manufactured. However, it should be appreciated that, in some implementations, only a subset of the corners 130 may include a topper mount socket 137. For example, the playard 1000*c* may only include two corners 130 with topper mount sockets 137 to support a topper on one side of the playard 1000*c*. Furthermore, one or more of the corners 130 of the frame 100*c* may also support a latch mechanism together with the topper mount socket 137 (see, for example, FIG. 72B showing one corner 130 supporting the latch mechanism 200*j* and the topper mount socket 137).

As shown in FIGS. 62C and 62D, the topper mount socket 137 may be disposed along the interior side of the corner 130 facing the interior space 102, which may reduce the size of the topper frames and/or reduce the likelihood of the latch lever 740*a* from being accidentally actuated if, for example, the caregiver inadvertently leans on one side of the playard 1000*c*. The placement of the topper mount socket 137 may also provide the playard 1000*c* a more seamless, aesthetically pleasing appearance with the soft goods 300 coupled to the frame 100*c* (i.e., there are no bumps or protruding features along the exterior of the playard 1000*c*).

The topper mount socket 137 may generally be oriented to place the topper at a desired orientation with respect to the playard 1000*c* when the corner tube 730*a* of the topper is inserted into the topper mount socket 137. For example, the corner tube 730*a* of the toppers 800*a* and 900*a* may be oriented at a right angle with respect to the normal vector of the respective support platforms 890*a* and 990*a*. Thus, the topper mount socket 137 may be oriented vertically so that the support platforms 890*a* and 990*a* are oriented horizontally (i.e., the normal vector of the support platforms 890*a* and 990*a* is oriented vertically) when installed on the playard 1000*c*. In another example, the topper mount sockets 137 may be oriented at an angle with respect to the top horizontal plane 92 to accommodate a corner tube 730*a* mounted to a topper frame at an angle.

In some implementations, the topper mount socket 137 may be integrally formed together with the base 131 of the corner 130. Additionally, the topper mount socket 137 may include an enclosed bottom portion to prevent the corner tube 730*a* from being inserted too far into the topper mount socket 137. In some implementations, the corner tube 730*a* and the topper mount socket 137 may also include keyed features to help the caregiver align the corner tube 730*a* to the topper mount socket 137 during setup. For example, FIG. 63D shows the corner tube 730*a* may include a bottom end 732*a* with concave grooves 734. The topper mount socket 137 may include complementary convex shaped sections (not shown) to align and, in some instances, abut the grooves 734. In some implementations, the bottom end 732*a* may be rounded to aid the alignment of the corner tube 730*a* to the topper mount socket 137 and/or to remove sharp edges from the topper.

FIGS. 63A-63C show additional views of the corner assembly 700*a* and its constituent components. As shown, the corner assembly 700*a* may include a corner housing 710 with a base section 712 and a rail support section 720. The rail support section 720 may include a rail channel 722 shaped to support a portion of the topper frame (e.g., the topper frames 810*a* and 910*a*). For example, the topper frame 810*a* may include a curved top rail 812 formed from tubing with a circular cross-sectional shape, as shown in FIG. 63A. The rail channel 722 may be formed as a semicircular groove that follows the curved shape of the top rail 812 such that, when assembled, the top rail 812 is partially nested within the rail channel 722. The rail support section 720 may further include multiple fastener openings 724 to couple the corner housing 710 to the topper frame via a screw fastener or a rivet.

The base section 712 may define a cavity 711 and include a corner tube opening 714 into the cavity 711 configured to receive a top end 732*b* of the corner tube 730*a*. The base section 712 may further include a pair of fastener openings 718, which align with fastener openings 739 on the corner tube 730*a* and a fastener opening 743 on the latch lever 740*a*. A screw fastener, a Valco snap button, or a rivet (e.g., a rolled rivet) may thus be inserted through the respective openings 718, 739, and 743 to securely couple the latch lever 740*a*, the corner tube 730*a*, and the corner housing 710 together. The base section 712 may also include a latch lever opening 716 and the latch lever 740*a* may include a latch button 748 that protrudes at least partially through the opening 716 to allow the caregiver to actuate the latch lever 740*a* and release the corner tube 730*a* from the topper mount socket 137.

FIG. 63C also shows the corner tube 730*a* may define a cavity 731 to contain, in part, the latch lever 740*a*. The corner tube 730*a* may further include a top opening 736*a* at the top end 732*b* and a side opening 736*b* that connects to the top opening 736*a*. The latch lever 740 may be inserted through the top opening 736*a* and into the cavity 731 with the latch button 748 sliding across the side opening 736*b*. The corner tube 730*a* may further include a latch head opening 733 for a latch head 746, as described below.

The latch lever 740*a* may include a base 742, which defines the fastener opening 743. When the latch lever 740*a* is coupled to the corner tube 730*a* and the corner housing 710 via a fastener or rivet, the latch lever 740*a* may rotate about the fastener or the rivet. As shown in FIG. 63C, the latch button 748 may be coupled to the base 742 via an arm 750. The latch button 748 may further include a recess 752 formed along the interior side of the latch button 748 disposed within the cavity 711. The recess 752 may reduce the amount of material used to form the latch lever 740*a* and, in some instances, may provide support for different spring mechanisms (e.g., see the spring 756 in the latch lever 740*b* or the snap button 758 in the latch lever 740*c*). The latch lever 740*a* may include the latch head 746 to securely couple the corner tube 730*a* to the topper mount socket 137. As shown in FIG. 63C, the latch head 746 may be coupled to the base 742 via an arm 744.

The latch lever 740*a* may also include a spring mechanism that generates a spring-bias force due to contact with the corner tube 730*a*, which maintains the latch button 748 through the opening 716 and the latch head 746 through the opening 733 when no external force is applied to the latch lever 740*a* (e.g., the caregiver pressing the latch button 748). Specifically, FIG. 63C shows the latch lever 740*a* may include a flexible finger 754 that extends from the base 742. Compared to the arms 750 and 744, the flexible finger 754 may have a smaller thickness, which allows the finger 754 to bend when pressed against the interior sidewall of the corner tube 730*a*. The deflection of the finger 754 gives rise to an internal restoring force to return the flexible finger 754 back to its unbent form. In this implementation, the internal restoring force functions as the spring-bias force.

When the corner tube 730*a* is inserted into the topper mount socket 137, the latch head 746 may initially contact the interior sidewalls of the topper mount socket 137, which causes the latch head 746 to be displaced into the cavity 731 of the corner tube 730*a*. In some implementations, the latch head 746 may include a lead-in portion to reduce the amount of force to displace the latch head 746. The latch head 746 may remain within the cavity 731 as the corner tube 730*a* moves into the topper mount socket 137. Once the corner tube 730*a* is sufficiently inserted into the topper mount socket 137 such that the opening 733 is aligned with an opening 137*a* on the topper mount socket 137, the internal restoring force generated by the flexible finger 754 causes the latch head 746 to pass through the opening 733 and the opening 137*a*. In this manner, the latch lever 740*a* may securely couple the corner tube 730*a* to the topper mount socket 137 and, hence, the topper to the playard 1000*c*. To remove the topper from the playard 1000*c*, the caregiver may press the latch button 748, which moves the latch head 746 into the cavity 731, and then move the corner tube 730*a* out from the topper mount socket 137.

It should be appreciated the latch lever is not limited to the flexible finger 754, but may include other spring mechanisms. For example, FIG. 64 shows a latch lever 740*b* with a metal coil spring 756 disposed partially within the recess 752 of the latch button 748. The spring 756 may contact the interior sidewall of the corner tube 730*a*. In some implementations, the coil spring 756 may be in a neutral state when no external forces are applied to the latch lever 740*b* (i.e., the spring 756 is neither in compression nor tension) and, thus, may only undergo compression when the caregiver presses the latch button 748. In some implementations, the coil spring 756 may be in a compressed state by default. Although this configuration may increase the threshold force to actuate the latch button 748, the higher threshold force may also reduce the likelihood that the corner tube 730*a* is accidentally released from the topper mount socket 137. FIG. 65 shows yet another latch lever 740*c* with a snap button 758. The snap button 758 may be similar to a Valco snap button with a button head 759 inserted into the recess 752 of the latch button 748 and a U-shaped spring arm 760 that functions as a spring.

The latch lever 740*a* may provide several benefits over conventional latch mechanisms. First, the latch button 748 is separate from the latch head 746, which provides greater flexibility in the placement of the latch button 748 on the corner assembly 700*a*. For example, the latch button 748 and the latch head 746 may be disposed on opposing sides of the corner tube 730*a*. In some implementations, the latch button 748 may face outwards away from the interior space 102 for greater ease of access (e.g., the caregiver does not have to insert their hand into a tight space) and visibility while the latch head 746 may face towards the interior space 102 and may further be covered by the soft goods 300 to prevent the caregiver or child from accidentally disengaging the latch lever 740*a* by pressing on the latch head 746 directly. Second, the latch button 748 may be positioned above the playard 1000*c* so that the caregiver does not have to bend over as much to reach the latch button 748.

As shown in FIGS. 62A-62C, the toppers 800*a* and 900*a* may only be coupled to the playard 1000*c* via a pair of corner assemblies 700*a* located on one side of the respective topper frames 810*a* and 910*a*. In some conventional indoor playards, the toppers may additionally include support feet that rest against a rigid top rail (e.g., the top rail 32 of the playard 10*e*). However, the playard frames described herein (e.g., the playard frames 100*a*-100*g*) do not include a rigid top rail. Instead, the frames include one or more X-frame assemblies (e.g., the X-frame assemblies 140*a*-140*c*), which effectively function as a top rail when the playard is unfolded due, in part, to their proximity to the top portion 108 of the playard. When unfolded, the X-frame tubes (e.g., the X-frame tubes 142*a*-142*f*) may remain at a shallow angle with respect to the top horizontal plane 92. As a result, each X-frame tube may be disposed between the top horizontal plane 92 and the ground surface 90.

The X-frame assemblies, however, may still provide additional mechanical support for the toppers in the same manner as a rigid top rail in a conventional indoor playard. This may be accomplished, in part, by adding topper mounts onto one or more X-frame tubes. For example, FIGS. 23C and 24 show the X-frame assemblies 140*b* may include a topper support 161*a* mounted to the X-frame tube 142*d* and a topper support 161*b* mounted to the X-frame tube 142*f*. When the playard frame 100*c* is unfolded, the soft goods 300 may cover the topper supports 161*a* and 161*b*. In some implementations, the topper supports 161*a* and 161*b* may prop up the soft goods 300 such that a top edge 302*a* of the soft goods is substantially aligned along the top horizontal plane 92. In other words, the topper supports 161*a* and 161*b* may make the playard 1000*c* appear as if it has a rigid top rail when the soft goods 300 are installed.

FIG. 62C shows the topper 800*a* may further include a pair of support feet 820*a* that are coupled to the topper frame 810*a* and aligned with the topper supports 161*a* or 161*b* on opposing X-frame assemblies 140*b*. When the topper 800*a* is installed onto the playard 1000*c*, the support feet 820*a* may rest against the portion of the soft goods 300 that are propped up by the topper supports 161*a* and 161*b*. The topper 900*a* may similarly include a pair of support feet 820*a* that rest against the portion of the soft goods 300 propped up by another set of topper supports 161*a* and 161*b*. Thus, the combination of the topper mount sockets 137 and the topper supports 161*a* and 161*b* provides multiple locations along the top periphery of the frame 100*c* to support the toppers 800*a* and 900*a*. In this manner, the toppers 800*a* and 900*a* may be supported by the playard 1000*c* without being cantilevered, which reduces or, in some instances, prevents the toppers 800*a* and 900*a* from sagging downwards into the interior space 102 especially when the topper is loaded (e.g., a child is placed onto the topper).

FIG. 62D shows a magnified view of the topper support 161*a*. As shown, the topper support 161*a* may include a bottom portion 163*a* that abuts the X-frame tube 142*d* and a topper support portion 162*a* that supports the support foot 820*a*. The topper support 161*b* may share similar or, in some instances, the same features as the topper support 161*a*. For instance, the topper support 161*b* may include a topper support portion 162*b* and a bottom portion 163*b* similar to the topper support portion 162*a* and the bottom portion 163*a*, respectively. For brevity, only the features of the topper support 161*a* will be described below.

In some implementations, the bottom portion 163*a* may be shaped to conform with the geometry of the X-frame tube, which increases the contact area between the topper support 161*a* and the X-frame tube 142*d*, provides a more mechanically stable connection, and better alignment between the topper support 161*a* and the X-frame tube 142*d* during assembly. For example, the bottom portion 163*a* may have a concave shape that is complementary to the round exterior shape of the X-frame tube 142*d*. The bottom portion 163*a* may also be angled with respect to the top horizontal plane 92 to match the orientation of the X-frame tube 142*d* relative to the plane 92 in the unfolded configuration. FIG. 62E further shows the topper support 161*a* may be coupled to the X-frame tube 142*d* via a pair of fasteners or rivets inserted through a pair of fastener openings 149*a* and 149*b* on the X-frame tube 142*d* and corresponding fastener openings 168*a* and 168*b* on the bottom portion 163*a* of the topper support 161*a*.

The topper support portion 162*a* may generally be oriented horizontally in the unfolded configuration. This enables the topper support 161*a* to emulate a rigid top rail in terms of the mechanical support it provides to the topper. In this manner, the topper supports 161*a* and 161*b* may enable the playard frame 100*c*, which includes X-frame assemblies 140*a* and 140*b* as the folding mechanism, to support one or more toppers.

In some implementations, the topper support portion 162*a* may have a rounded or convex shape, which makes the top portion 302 of the soft goods 300 also rounded in shape as shown in FIG. 62A. The support foot 820*a* may further include a bottom portion 822 that has a concave shape complementary to the convex shape of the topper support portion 162*a*. Similar to the bottom portion 163*a* and the exterior geometry of the X-frame tube 142*d*, the geometry of the topper support portion 162*a* and the bottom portion 822 may provide a larger contact area to improve the mechanical stability of the topper when mounted to the playard. Additionally, the topper support portion 162*a* may be dimensioned to be partially nested within the bottom portion 822, which may further aid the caregiver in aligning the topper 800*a* to the playard 1000*c* during installation. In some implementations, the support foot 820*a* may also include a through hole opening 824 to couple the support foot 820*a* to the topper frame 810*a* or 910*a*. In some implementations, the topper frames 810*a* and 910*a* may not be disposed directly over the X-frame assemblies 140*b* and, hence, the topper supports 161*a* and 161*b*. Thus, the support foot 820*a* may have a curved shape so that the bottom portion 822 aligns with the topper supports 161*a* or 161*b* while the through hole opening 824 aligns with the topper frames 810*a* or 910*a*.

In some implementations, different toppers may share a similar or, in some instances, the same topper frame, which may simplify manufacture and assembly of the toppers. For example, the topper frames 810*a* and 910*a* for the changing table topper 800*a* and the bassinet topper 900*a*, respectively, may be similar in construction, but may have different dimensions. For instance, the topper frames 810*a* and 910*a* may have the same overall length, but different overall widths. The topper frames 810*a* and 910*a* may further be assembled from top rails having the same size and/or shape (e.g., metal tubing with a circular cross-sectional shape and an outer diameter equal to or approximately 0.625 inches).

FIG. 66 shows an exploded view of the topper frame 810*a*. As shown, the topper frame 810*a* may include multiple top rails 812*a*, 812*b*, and 812*c*, which together form a rigid closed-loop structure to support the topper soft goods 880*a* and, hence, the support platform 890*a*. In some implementations, the topper soft goods 880*a* may be attached to the topper frame 810*a* by inserting the top rails 812*a*-812*c* through a pocket on the topper soft goods 880*a* such that the topper soft goods 880*a* wrap around the topper frame 810*a*. In some implementations, the topper soft goods 880*a* may instead include a stiffener (e.g., the stiffener 874) inserted through a channel (e.g., the channel 813) so that the topper frame 810*a* may remain substantially exposed.

As shown, the top rails 812*a* and 812*b* may each support a corner assembly 700*a*. In particular, the top rails 812*a* and 812*b* may each include a pair of fastener openings 814 that align with corresponding fastener openings 724 of the corner housing 710 in each corner assembly 700*a*. Additionally, each of the top rails 812*a*-812*c* may be curved in shape. This may be accomplished, in part, by bending the top rails to the desired shape and/or assembling the top rails from smaller segments of tubing (e.g., curved tubing and straight tubing).

The top rail 812*a* may include a male connector end 816*a* that is inserted into a female connector end 816*b*. The male connector end 816*a* may further include a fastener opening 818*a* that aligns with the fastener opening 818*b* when assembled. Thus, a screw fastener, a Valco snap button, or a rivet may be inserted through the respective openings 818*a* and 818*b* to securely couple the top rails 812*a* and 812*b* together.

The top rail 812*b* may include another female connector end 816*c* disposed at the opposite end from the connector end 816*b*. As shown in FIG. 66, a support foot 820*a* may slide onto the female connector end 816*c* via the through hole opening 824. Then, the top rail 812*c* may couple to the top rail 812*a* via a male connector end 816*d* inserted into the connector end 816*c*. The connector end 816*c*, the connector end 816*d*, and the support foot 820*a* may have fastener openings 818*b*, 818*a*, and 825, respectively, that align with one another. A screw fastener, a Valco snap button, or a rivet may thus be inserted through the fastener openings 818*a*, 818*b*, and 825 to couple the top rails 812*b* and 812*c* and the support foot 820*a* together.

The top rail 812*a* may also include another female connector end 816*e*. Similarly, a second support foot 820*a* may slide onto the connector end 816*e* and another male connector end 816*f* on the top rail 812*c* may be inserted into the connector end 816*e*. The connector end 816*e*, the connector end 816*f*, and the support foot 820*a* may also be coupled together via a screw fastener, a Valco snap button, or a rivet inserted through respective fastener openings (not shown).

In some implementations, the top rails 812*a*-812*c* may have various cross-sectional shapes including, but not limited to a circle, an oval, and an oblong shape. In some implementations, the top rails 812*a*-812*c* may be formed from the same materials as the leg tubes 112 and/or the X-frame assemblies 140*a*-140*c*. For example, the top rails of the topper may be formed from steel, aluminum, or carbon fiber.

In some implementations, the same or similar topper frame may also be used for different variants of the same type of topper (e.g., a bassinet, a changing table). For example, FIG. 67 shows another view of the changing table topper 800*a* removed from the playard 1000*c* and FIG. 68 shows another changing table topper 800*b* with topper soft goods 880*b* and a support platform 890*b*. As shown, the support platform 890*a* may be relatively larger than the support platform 890*b*. For example, the support platform 890*b* may be tailored for smaller children while the support platform 890*a* may be tailored for larger children. As a result, the soft goods 880*a* and 880*b* may also be different. For example, FIG. 67 shows the soft goods 880*a* may hang down directly from the frame 810*a*. FIG. 68 shows the soft goods 880*b* may extend laterally from the topper frame before dropping downwards to support the support platform 890*b*, resulting in a smaller interior space 801. The lateral portion of the soft goods 880*b* may include foam padding or some other compliant material that provides both form to the soft goods 880*b* and cushioning for the child.

In another example, FIG. 69 shows the playard 1000*c* with a bassinet topper 900*b*. The bassinet topper 900*b* may share the same bassinet topper soft goods 980*a* and the support platform 990*a* as the topper 900*a*. However, the topper 900*b* may include a bassinet topper frame 910*b* configured to support a canopy 978. Specifically, the topper frame 910*b* may support an overhead rail 914, which, in some implementations, may also function as a carry handle. The overhead rail 914 and the topper frame 910*b* may support canopy soft goods 979 to provide shade for the child. In some implementations, the overhead rail 914 may be rotatable with respect to the topper frame 910*b* to allow the caregiver to store or deploy the canopy 978 as needed. For example, the playard 1000*c* may be deployed in an outdoor setting or near a window that receives direct sunlight. Thus, the caregiver may deploy the canopy 978 to prevent the child from being directly illuminated by the sunlight. However, at nighttime, the caregiver may store the canopy 978 to provide better view of the child.

FIG. 70 shows another view of the bassinet topper 900*b* removed from the playard 1000*c* and FIG. 71 shows another bassinet topper 900*c* with topper soft goods 980*b* and a support platform 990*b*. Similar to the changing table toppers 800*a* and 800*b*, the support platforms 990*a* and 990*b* in the bassinet toppers 900*b* and 900*c* may have different sizes to accommodate different-sized children. Accordingly, the bassinet topper soft goods 980*a* and 980*b* may also be different. For instance, the bassinet topper soft goods 980*a* may be a mesh screen that hangs directly from the topper frame 910*b*. The bassinet topper soft goods 980*b* may have an opaque portion that extends laterally from the frame and a mesh portion that hangs downwards to support the support platform 990*b*, resulting in a smaller interior space 901. Similar to the topper soft goods 880*b*, the bassinet topper soft goods 980*b* may also include foam padding or some other compliant material in the opaque portion.

Additionally, FIGS. 70 and 71 show the bassinet toppers 900*b* and 900*c* configured for installation on different sides of the playard 1000*c*. Specifically, if both bassinet toppers 900*b* and 900*c* are installed facing the front side of the playard 1000*c* (i.e., the canopy soft goods 979 are disposed closer to the rear side of the playard 1000*c*), the bassinet topper 900*b* would be positioned on the right side of the playard 1000*c* while the bassinet topper 900*c* would be positioned on the left side of the playard 1000*c*. It should be appreciated, however, that the bassinet toppers 900*b* and 900*c* may be installed facing the rear side of the playard 1000*c* as well, in which case the bassinet toppers 900*b* and 900*c* would be disposed on the left side and the right side of the playard 1000*c*, respectively.

In some implementations, one or more of the toppers installed onto the playard may be reconfigurable to provide additional functionality to the playard and/or convenience for the caregiver. For example, FIGS. 72A-72C show a topper 800*c* with a changing table section 802*a* and an organizer section 804*a* mounted to the playard 1000*c*. The topper 800*c* may function as a care station when installed on the playard 1000*c* by providing a platform for the caregiver to change their child's diaper and storage space to contain various care items. As shown, the topper 800*c* may include a topper frame 810*b* with a top rail 812*d* defining the changing table section 802*a* and a top rail 812*f* defining the organizer section 804*a*. The top rails 812*d* and 812*f* may be rotatably coupled to one another via a pair of hub assemblies 830*a*-1 and 830*a*-2. The hub assemblies 830*a*-1 and 830*a*-2 may also include corner assemblies 700*d* with corner tubes 730*a* to couple the topper 800*c* to the playard frame 100*c*.

The hub assemblies 830*a*-1 and 830*a*-2 may thus provide a mechanism for the caregiver to reconfigure the topper 800*c* after installation onto the playard 1000*c*. Specifically, the changing table section 802*a* may be rigidly coupled to the frame 100*c* while the organizer section 804*a* may be rotatable with respect to the changing table section 802*a* and the frame 100*c* about a rotation axis 806 defined by the hub assemblies 830*a*-1 and 830*a*-2 as shown in FIG. 72B. This arrangement may enable the caregiver to access multiple storage compartments in the organizer section 804*a*. For example, FIG. 72A shows the topper 800*c* in a first configuration where multiple storage compartments 872*a* in the organizer section 804*a* are accessible from above the playard 1000*c*. FIG. 72B shows the topper 800*c* in a second configuration where the organizer section 804*a* is rotated over to reveal additional storage compartments 872*b* that are accessible from above the playard 1000*c*. The storage compartments 872*b* are located on the bottom side of the organizer section 804*a* in FIG. 72A.

For the topper 800*c*, the organizer section 804*a* is the only movable portion of the topper. In other words, the changing table section 802*a* remains statically fixed to the playard 1000*c*. However, it should be appreciated that, in some implementations, the changing table section may instead be movable while the organizer section remains stationary (see, for example, the topper 800*d* in FIGS. 74A-74C). This arrangement may enable the caregiver to deploy the changing table section 802*a* when changing the child's diaper or to store the changing table section 802*a* when not in use so that the changing table section 802*a* does not obstruct the interior space 102 as discussed in more detail below with respect to the topper 800*d*.

In some implementations, the top rail 812*d* may be assembled from smaller segments of tubing. In some implementations, the top rail 812*d* may be a single tube that is bent into the desired shape (e.g., a U-shaped top rail). The top rail 812*d* may generally be disposed over the interior space 102 of the frame 100*c*. FIG. 72A shows the top rail 812*d* may also include support feet 820*a* to support the changing table section 802*a* on the topper supports 161*a* and 161*b* of the X-frame assemblies 140*b*. The top rail 812*d* may further support topper soft goods (not shown) and a support platform (not shown) to support the child in a similar manner as the toppers 800*a* and 800*b*.

The top rail 812*f* may also be assembled from smaller segments of tubing or may be a single tube bent into the desired shape (e.g., a U-shaped top rail). In the first configuration shown in FIG. 72A, the top rail 812*f* may extend from the side of the playard frame 100*c* away from the interior space 102. In other words, the organizer section 804*a* may not be disposed above or within the interior space 102. This orientation may be preferable as it preserves the space above and/or within the interior space 102 for toppers that support a child. For example, the caregiver may use the changing table section 802*a* and access the storage compartments 872*a*. In the second configuration shown in FIG. 72B, the top rail 812*f* may be positioned above or within the interior space 102 and on top of the changing table section 802*a*. This orientation may be preferable to provide access to the storage compartments 872*b*, to reduce the overall lateral dimensions of the playard 1000*c*, and/or to block the child's access to the changing table section 802*a* and the storage compartments 872*a*. In some implementations, the top rail 812*f* may rotate approximately 180 degrees between the first and second configurations.

The top rail 812*f* may generally support storage soft goods 870 that define the storage compartments 872*a* and 872*b*. In some implementations, the storage soft goods 870 may include a pocket (not shown) and the top rail 812*f* may be inserted through the pocket to attach the storage soft goods 870 to the top rail 812*f*. In some implementations, the storage soft goods 870 may include a stiffener (e.g., the stiffener 874) and the top rail 812*f* may include a channel (e.g., the channel 813) to receive the stiffener. In this manner, the storage soft goods 870 may be attached to the top rail 812*f* without covering the top rail 812*f*.

In some implementations, the top rail 812*f* may not form a closed-loop structure. For example, FIG. 72A shows the top rail 812*f* may have a U-shaped geometry. Instead, another intermediate top rail (not shown) may be disposed between the hub assemblies 830*a*-1 and 830*a*-2 (e.g., see top rail 812*e* in FIGS. 75B and 75C). Thus, the storage soft goods 870 may also be coupled to the intermediate top rail. To prevent the storage soft goods 870 from shifting and/or rotating in an undesirable manner as the organizer section 804*a* rotates, the storage soft goods 870 may be affixed to the intermediate top rail in the same manner as described above with respect to the top rail 812*f*. In some implementations, the storage soft goods 870 may alternatively be fastened to the intermediate top rail (see, for example, the fastener openings 819 on the top rail 812*e* in FIG. 75C).

In some implementations, the organizer section 804*a* may instead include a rigid component (e.g., a plastic part) that defines the storage compartments 872*a* and 872*b*. The rigid component may be coupled to the top rail 812*d* using various coupling mechanisms including, but not limited to, a snap-fit connection, a clamp, a rivet connection, and a screw fastener connection.

The changing table section 802*a* and the organizer section 804*a* may generally be shaped and/or dimensioned to suit their respective functions. For example, the changing table section 802*a* may be dimensioned to support a sufficiently large support platform for the child as described above with respect to the topper 800*a*. The top rail 812*d* may also be shaped and/or dimensioned to conform with the geometry of the top periphery of the playard 1000*c* in the unfolded configuration. In another example, the organizer section 804*a* may be dimensioned to provide sufficient space for multiple storage compartments 872*a* and 872*b*. However, in some implementations, the organizer section 804*a* may be dimensioned to cover a larger space than the changing table section 802*a* for the purposes of covering the changing table section 802*a* as shown in FIG. 72B.

In some implementations, the organizer section 804*a* may be configured to rotate via the hub assemblies 830*a*-1 and 830*a*-2 only when a sufficiently large torque is applied to rotate the organizer section 804*a*. Said in another way, the organizer section 804*a* may only rotate when an external torque applied to the organizer section 804*a* has a magnitude greater than or equal to a threshold torque. If the magnitude of the external torque is less than the threshold torque, the organizer section 804*a* remains stationary. In some implementations, the threshold torque may be chosen to be lower than the torque that causes the foldable playard to tip over. For example, the threshold torque may equal to a 30 lbf applied tangentially with respect to the rotation axis 806 to an end portion 808 of the changing table section 804*a*. The end portion 808 is located furthest from the rotation axis 806 and, hence, corresponds to the largest moment arm in the organizer section 804*a*.

The threshold torque locking mechanism may be beneficial in several ways. First, the locking mechanism may be simple to operate. For example, the caregiver may push or pull on the top rail 812*f* using only one hand to rotate the organizer section 804*a*. Second, the threshold torque may be readily tailored to reduce the likelihood of the organizer section 804*a* being accidentally rotated, for example, by the child. Third, the locking mechanism may provide a convenient, built-in breakaway feature. Specifically, the hub assemblies 830*a*-1 and 830*a*-2 may allow the organizer section 804*a* to rotate downwards towards the ground when an external torque with a magnitude greater than the threshold torque is applied as shown in FIG. 72C. Once the organizer section 804*a* is in the breakaway configuration, the organizer section 804*a* may be returned to the first configuration without any damage to its components (e.g., the top rail 812*f*). In this manner, the playard 1000*c* is less likely to tip over and/or the organizer section 804*a* is less likely to break if, for example, the caregiver leans too hard onto the organizer section 804*a* or the child hangs from the organizer section 804*a*.

FIGS. 73A-73F show additional details of the hub assembly 830*a*-1 and the locking mechanism. It should be appreciated the hub assembly 830*a*-2 may include similar features as the hub assembly 830*a*-1. In some implementations, the hub assemblies 830*a*-1 and 830*a*-2 may be mirror symmetric with respect to one another. For brevity, only the features of the hub assembly 830*a*-1 will be discussed below.

As shown, the hub assembly 830*a*-1 may include an organizer mount 832 and a changer mount 834 that are rotatably coupled to one another. Specifically, the organizer mount 832 may include an inner rotor 838 inserted into an outer rotor 839 of the changer mount 834 that constrains the organizer mount 832 to rotate about the rotation axis 806. The changer mount 834 may include a connector end 835 to couple to the top rail 812*d* and a base section 833*a* to support the corner assembly 700*d* and, in particular, the corner tube 730*a*. The organizer mount 832 may include a connector end (not shown) to couple to the top rail 812*d*.

FIG. 73B shows the organizer mount 832 and the changer mount 834 may form an enclosed cavity. A hub spring 840 may be disposed within the cavity and coupled to the organizer mount 832 via respective screw fasteners or rivets inserted through fastener openings 842 on the hub spring 840. Thus, the hub spring 840 rotates together with the organizer section 804*a*. The changer mount 834 may further include two pairs of detents 841*a* and 841*b* disposed on opposing sides of the changer mount 834. Each pair of detents 841*a* and 841*b* may form a notch that is shaped and dimensioned to receive one of the ends 840*a* or 840*b* of the hub spring 840. In this manner, each pair of detents 841*a* and 841*b* may function as mechanical stops to lock the orientation of the hub spring 840, which, in turn, locks the position of the organizer section 804*a* with respect to the changing table section 802*a*.

The hub spring 840 is formed as a compliant component that allows the respective ends 840*a* and 840*b* to flex in and out of the respective pairs of detents 841*a* and 841*b*. For example, FIG. 73B shows an exemplary profile of the hub spring 840 in dashed lines where the ends 840*a* and 840*b* are compressed inwards such that the detents 841*a* and 841*b* no longer mechanically constrain the hub spring 840. It should be appreciated the number of detents and ends of the hub spring 840 are exemplary. In some implementations, the hub assembly 830*a*-1 may include two ends and one pair of detents to mechanically constrain one of the two ends. In some implementations, the hub assembly 830*a*-1 may include more than two pairs of detents so that the organizer section 804*a* may be help at intermediate orientations between the first and second configurations. In some implementations, the hub spring 840 may include more than two ends to correspond with the number of pairs of detents.

In the first configuration, the end 840*a* may be constrained by the detents 841*a* and the end 840*b* may be constrained by the detents 841*b*. When the caregiver applies a torque to the organizer section 804*a* with a magnitude greater than the threshold torque, the initial rotation of the hub spring 840 relative to the detents 841*a* and 841*b* causes an increase in the contact force between the end 840*a* and at least one detent 841*a* and, similarly, between the end 840*b* and at least one detent 841*b*. The contact forces, in turn, causes the hub spring 840 to deform by flexing inwards as shown in FIG. 73B. As the ends 840*a* and 840*b* move along the surfaces of the detents 841*a* and 841*b*, respectively, the hub spring 840 may continue to deform until the respective peaks of the detents 841*a* and 841*b* are reached (e.g., the portion of the detents 841*a* and 841*b* closest to the rotation axis 806). At this point, further rotation of the organizer section 804*a* may release the ends 840*a* and 840*b* of the hub spring 840 from the detents 841*a* and 841*b* allowing the hub spring 840 to flex back outwards to return to its original form.

The caregiver may then rotate the organizer section 804*a* from the first configuration shown in FIG. 73B to the second configuration shown in FIG. 73D without applying an appreciably large torque (e.g., a torque with a magnitude less than the threshold torque). Once the hub spring 840 is sufficiently rotated such that the end 840*a* is disposed proximate to the detents 841*b* and, similarly, the end 840*b* is disposed proximate to the detents 841*a*, the caregiver may again apply a torque with a magnitude greater than the threshold torque to deform the hub spring 840 such that the ends 840*a* and 840*b* fit between the detents 841*b* and 841*a*, respectively, as shown in FIG. 73D.

The breakaway feature of the hub assembly 830*a*-1 may operate in a similar manner. Specifically, when a torque with a magnitude greater than the threshold torque is applied to the organizer section 804*a* in a direction that causes the organizer section 804*a* to move downwards towards the ground, the hub spring 840 may deform to such an extent the ends 840*a* and 840*b* are released from the detents 841*a* and 841*b*, respectively, thus allowing the organizer section 804*a* to rotate. The organizer section 804*a* may then rotate downwards until the top rail 812*f* contacts the playard 1000*c*.

The threshold torque may thus generally depend on several factors including, but not limited to, the dimensions and profile of the detents, the shape, dimensions, and material of the hub spring 840, the number of pairs of detents, the number of ends of the hub springs that engage respective pairs of detents. In some implementations, the hub spring 840 be shaped and/or dimensioned such that the hub spring 840 primarily undergoes elastic deformation as it flexes inwards and outwards. For example, the hub spring 840 may be formed from a compliant material, such as injection-molded plastic.

In some implementations, the respective detents in each pair of detents may be mirror symmetric; hence, the threshold torque to move the organizer section 804*a* from the first configuration to the second configuration is the same as the threshold torque to move the organizer section 804*a* from the first configuration to the breakaway configuration. In some implementations, the respective detents in each pair of detents may have a different profile (e.g., different shaped peak) so that the threshold torque to move the organizer section 804*a* from the first configuration to the second configuration is different than the threshold torque to move the organizer section 804*a* from the first configuration to the breakaway configuration. For example, the threshold torque to move between the first and second configurations may be lower than the threshold torque to move from the first configuration to the breakaway configuration.

As described above, in some implementations, the changing table section may be movable while the organizer section remains rigidly affixed to the playard, which may provide the caregiver the ability to deploy the changing table of the topper as needed or to store the changing table when not in use instead of uninstalling the topper entirely from the playard. For example, FIGS. 74A-74D show a topper 800*d* mounted to the playard 1000*c* with an organizer section 804*b* rigidly affixed to the frame 100*c* and a changing table section 802*b* that is rotatable with respect to the organizer section 804*b* and the frame 100*c* via the hub assemblies 830*b*-1 and 830*b*-2. The hub assemblies 830*b*-1 and 830*b*-2 may be mirror symmetric.

Similar to the topper 800*c*, the topper 800*d* may include a topper frame 810*c* with a top rail 812*d* defining the changing table section 802*b* and a top rail 812*f* defining the organizer section 804*b*. As before, the top rail 812*d* may support topper soft goods 880*c* and a support platform 890*c* to support the child. The top rail 812*d* may further include support feet 820*a* to support the changing table section 802*b* on the frame 100*c* via the topper supports 161*a* and 161*b*. The top rail 812*f* may support storage soft goods 870 defining storage compartments 872*a*. Specifically, FIG. 74D shows the top rail 812*f* may include a channel 813 disposed along the interior side of the top rail 812*f* to receive a stiffener 874 mounted to the storage soft goods 870.

The changing table section 802*b* may rotate between a deployed configuration and a storage configuration. Specifically, the changing table section 802*b* may be disposed over and partially within the interior space 102 in the deployed configuration to support the child as shown in FIG. 74A. In the stored configuration, the changing table section 802*b* may be rotated over onto the organizer section 804*b* and, thus, removed from the interior space 102 as shown in FIG. 74C. In this manner, the caregiver may deploy and/or remove the changing table section 802*b* while the topper 800*d* remains installed onto the playard 1000*c*. The organizer section 804*b* may remain disposed outside the playard 1000*c* in both deployed and storage configurations. In some implementations, the changing table section 802*b* may also be dimensioned to cover a larger space than the organizer section 804*b* for the purposes of covering the storage compartments 872*a* in order to block a child's access to the storage compartments 872*a*.

FIGS. 75A-75C show several views of the assembly of the topper frame 810*c*. As shown, the hub assembly 830*b*-1 may include an organizer mount 832 and a changer mount 834 that is rotatably coupled to the organizer mount 832. As shown in FIGS. 75A and 75C, the organizer mount 832 may include a base section 833*a* that defines a socket opening 859*a* to receive the corner tube 730*a*. The base section 833*a* and the corner tube 730*a* may together define the corner assembly 700*d*. The corner tube 730*a* may include a fastener opening 739 that aligns with a fastener opening 858 on the base section 833*a*. Thus, a screw fastener, Valco snap button, or a rivet may securely couple the corner tube 730*a* to the base section 833*a*. Additionally, the corner tube 730*a* may include an opening 733 for a latch head (not shown) as described above. The base section 833*a* may further provide an opening (not shown) for a latch button to actuate and release the hub assemblies 830*b*-1 and 830*b*-2 from the frame 100*c*.

FIG. 75A further shows the topper frame 810*c* may include a top rail 812*e* disposed directly between and coupled to the hub assemblies 830*b*-1 and 830*b*-2. In some implementations, the top rail 812*e* may be straight or substantially straight. Specifically, the organizer mount 832 of the hub assembly 830*b*-1 may include a connector end 833*b* with a socket opening 859*b* to receive a connector end 816*i* of the top rail 812*e*. The connector end 833*b* may further include a fastener opening 837 that aligns with a fastener opening (not shown) of the top rail 812*e* for a screw fastener, a Valco snap button, or a rivet to securely couple the top rail 812*e* to the hub assembly 830*b*-1. Similarly, the hub assembly 830*b*-2 may include a connector end 833*b* to receive another connector end 816*j* of the top rail 812*e* disposed opposite from the connector end 816*i*. In some implementations, the top rail 812*e* may include one or more fastener openings 819 to securely affix at least one of the topper soft goods 880*a* or the storage soft goods 870 so that the soft goods on the topper are less likely to shift and/or rotate as the topper 800*d* changes configurations.

The organizer mount 832 of the hub assemblies 830*b*-1 and 830*b*-2 may also include a connector end 833*c* to couple the top rail 812*f* to the respective hub assemblies 830*b*-1 and 830*b*-2. As shown in FIGS. 75A and 75B, the connector end 833*c* may be formed as a type of quick-connect fitting that grabs onto the interior sidewalls of the top rail 812*f* when the top rail 812*f* is pressed onto the connector end 833*c*.

The top rail 812*d* may include a pair of support feet 820*a* that are positioned to align with respective topper supports 161*a* and 161*b* on the frame 100*c*. The top rail 812*d* may include a male connector end 816*g* that is inserted into a corresponding socket opening 835*a* on the connector end 835 of the hub assembly 830*b*-1. The top rail 812*d* may include a fastener opening 818*a* that aligns with a fastener opening 836 such that a screw fastener, a Valco snap button, or a rivet can then securely couple the top rail 812*d* to the hub assembly 830*b*-1. Similarly, the top rail 812*d* may include another male connector end 816*h* disposed at an opposite end from the connect end 816*g* that is inserted into a corresponding socket opening 835*a* on the connector end 835 of the hub assembly 830*b*-2 and coupled together via a screw fastener, a Valco snap button, or a rivet.

Compared to the hub assemblies 830*a*-1 and 830*a*-2, the hub assemblies 830*b*-1 and 830*b*-2 may include a push button locking mechanism. In other words, the caregiver may push a button on the respective hub assemblies 830*b*-1 and 830*b*-2 to disengage the locking mechanism, thus allowing the caregiver to move the changing table section 802*b*. This locking mechanism may more securely lock the changing table section 802*b* to the organizer section 804*b*, thus reducing or, in some instances, preventing accidental rotation of the changing table section 802*b* via an external force or torque applied to the changing table section 802*b*.

FIGS. 76A-76C show several views of the hub assembly 830*b*-2. It should be appreciated the hub assembly 830*b*-1 may share similar or the same features as the hub assembly 830*b*-2. Thus, for brevity, only the features of the hub assembly 830*b*-2 are described below.

As shown, the organizer mount 832 may include an inner rotor 838 and the changer mount 834 may include an outer rotor 839 to receive the inner rotor 838 and, in turn, enable rotation of the changer mount 834 relative to the organizer mount 832. The organizer mount 832 may further define a cavity 844 that abuts a corresponding cavity 848*b* of the changer mount 834. The cavities 844 and 848*b* may collectively contain a spring 854 and a gear 850 disposed between the spring 854 and the changer mount 834. As shown in FIG. 76A, the spring 854 may be disposed around the inner rotor 838. To prevent the spring 854 from shifting around within the cavity 844, the organizer mount 832 may include multiple ribs 845 oriented radially with respect to the inner rotor 838 with corresponding notches 846 to restrain one end of the spring 854. The gear 850 may include a channel 853*b* formed around an opening 852. In this manner, the spring 854 may remain concentrically aligned with the inner rotor 838. The opening 852 allows the gear 850 to slide along the outer rotor 839 within the cavities 844 and 848*b*. The changer mount 834 may further include a cavity 848*a* disposed opposite from the cavity 848*b* and separated by a partition 848*c*. The cavity 848*a* may contain a push button 855 as shown in FIG. 76A. The push button 855 may include multiple snap-fit legs 856 that are inserted through corresponding feedthrough openings 857 such that the legs 856 protrude into the cavity 848*b* as shown in FIG. 76B.

The spring 854 may apply a force that pushes the gear 850 against the partition 848*c*. The cavity 848*b*, however, may generally have a depth that is less than the thickness of the gear 850. Thus, the gear 850 may be partially disposed in both the cavities 844 and 848*b* when no forces are applied to the hub assembly 830*b*-2 (e.g., the caregiver is not pressing the push button 855). The organizer mount 832 and the changer mount 834 may further include gear teeth 843 and 847, respectively, disposed along the interior sidewalls forming the cavities 844 and 848*b*. The gear teeth 843 and 847 may generally be shaped and/or dimensioned to mesh with corresponding gear teeth 851 on the gear 850. Thus, when the gear 850 is disposed in both the cavities 844 and 848*b*, the changer mount 834 is locked to the organizer mount 832 (i.e., the changing table section 802*b* cannot be rotated).

The gear 850 may further include a pair of indexed gear teeth 851*a* and 851*b* disposed on opposing sides of the gear 850. The indexed gear teeth 851*a* and 851*b* may have a different (e.g., larger) pitch compared to the other gear teeth 851. The gear teeth 843 may include a pair of indexed recesses 843*a* and 843*b* and the gear teeth 847 may include a pair of indexed recesses 847*a* and 847*b*. The indexed recesses 843*a*, 843*b*, 847*a*, and 847*b* may be shaped and dimensioned to mesh with the indexed gear teeth 851*a* and 851*b*.

Thus, the changing table section 802*b* may be locked at certain orientations corresponding, for example, to the deployed and storage configurations based on the placement of the indexed recesses 843*a*, 843*b*, 847*a*, and 847*b* and the indexed gear teeth 851*a* and 851*b*. For example, in the first configuration, the indexed gear teeth 851*a* and 851*b* may be aligned with the indexed recesses 843*a* and 843*b*, respectively, and the indexed recesses 847*a* and 847*b*, respectively. When the caregiver presses the push button 855 with sufficient force (e.g., a force with a magnitude greater than the force generated by the spring 854), the legs 856 may press onto the gear 850, thus pushing the gear 850 entirely into the cavity 844. Thus, the gear teeth 851, 851*a*, and 851*b* may become disengaged from the gear teeth 847 and recesses 847*a*, and 847*b*, which allows the caregiver to rotate the changer mount 834 with respect to the organizer mount 832. Once the changer mount 834 is rotated approximately 180 degrees, the indexed recess 847*a* may align with the gear tooth 851*b* and the indexed recess 847*b* may align with the gear tooth 851*a*. It should be appreciated the 180 degree rotation is, in part, due to the indexed gear teeth 851*a* and 851*b* being disposed diametrically opposite to one another. Once the caregiver releases the push button 855, the spring 854 may then push the gear 850 back into the cavity 848*b* such that the gear teeth 851, 851*a*, and 851*b* mesh with the gear teeth 847 and recesses 847*b*, and 847*a*, respectively. For both the deployed and storage configurations, the indexed gear teeth 851*a* and 851*b* may remain aligned and engaged with the indexed recesses 843*a* and 843*b*, respectively. In other words, the gear 850 may not rotate relative to the organizer mount 832.

To limit the range of rotation of the hub assembly 830*b*-2, the partition 848*c* may also include a rib 849 that is inserted into a corresponding channel 853*a* formed around the opening 852 of the gear 850 as shown in FIG. 76A. The channel 853*a* may be shaped as a circular arc. For reference, FIG. 76D shows the backside of the channel 853*a* disposed within the channel 853*b*. The rib 849 may remain engaged to the channel 853*a* even when the gear 850 is disposed fully within the cavity 844 (i.e., when the caregiver presses the push button 855). As the caregiver rotates the changing table section 802*b*, the rib 849 may slide along the channel 853*a* until one end of the rib 849 hits one end of the channel 853*a*. Thus, the length of the channel 853*a* and/or the length of the rib 849 may limit the range of rotation of the changing table section 802*b* relative to the organizer section 804*b* and, hence, the frame 100*c*.

In some implementations, a rotatable changing table topper may be appreciably simplified by including a locking mechanism formed using the topper support of the playard frame and the support foot of the topper frame. For example, FIGS. 77A-77C show a rotatable changing table topper 800*e* mounted to the frame 100*c* of the playard 1000*c*. As shown, the topper 800*e* may include a pair of corner housings 860 and corresponding corner tubes 730*b* to couple the topper 800*e* to the frame 100*c*. Each corner tube 730*b* may have a bottom vertical portion inserted into corresponding topper mount sockets 137 and a top horizontal portion coupled to respective corner housings 860. Specifically, each corner housing 860 may include a socket (not shown) to receive one end of the corner tube 730*b* and a fastener opening 861 for a screw fastener, a Valco snap button, or a rivet to securely couple the corner tube 730*b* to the corner housing 860.

In some implementations, the bottom portion of the corner tube 730*b* may be disposed within the topper mount socket 137 without a separate latch mechanism. In other words, the corner tube 730*b* may simply rest within the topper mount socket 137. In some implementations, the bottom portion of the corner tube 730*b* may be securely coupled to the topper mount socket 137 via a latch lever (not shown) with a latch button as described above.

The corner housings 860 may further support a topper frame 810*d* with a curved top rail 812*g* and a straight top rail 812*e*. The topper frame 810*d*, in turn, may provide support for topper soft goods (not shown) and a support platform (not shown) for the child. As shown in FIG. 77A, the top rail 812*e* may be inserted through respective through hole openings 862 of each corner housing 860. Thus, the top rails 812*e* may be rotatable with respect to the corner housings 860 about a rotation axis 806 defined by the through hole openings 862. The top rail 812*e* may then be coupled to the top rail 812*g* via respective connector ends (not shown) with fastener openings (not shown) and a screw fastener, a Valco snap button, or a rivet inserted through the fastener openings in a similar manner as the top rail connections described above.

The topper 800*e* may rotate between a deployed configuration and a storage configuration. In the deployed configuration, the topper frame 810*d* may be disposed over the interior space 102 of the playard 1000*c* and oriented to provide support for a child as shown in FIG. 77A. In the storage configuration, the topper frame 810*d* may be rotated to the side of the playard 1000*c* for storage. For example, FIG. 77B shows the topper frame 810*d* may be rotated to an approximately parallel orientation with the side of the playard 1000*c*. In this manner, the topper 800*e* may be deployed as needed (e.g., when changing a child's diaper) and moved out from the interior space 102 when not in use similar to the changing table section 802*b* in the topper 800*d*.

The topper frame 810*d* may further include a support foot 820*b* supported by a topper support 161*c*. For the topper 800*e*, the support foot 820*b* and the topper support 161*c* may also form a latch mechanism to lock the topper 800*e* in the deployed configuration. Specifically, FIG. 77C shows the topper support 161*c* may include an opening 165 and a latch receiver 164 may be partially inserted through the opening 165 with a snap-fit connector 167 to securely couple the latch receiver 164 to the topper support 161*c*. The latch receiver 164 may include a latch catch 166 with an integral escutcheon. The support foot 820*b* may include a bendable latch arm 826 with a hook 828 inserted into the latch catch 166. The latch catch 166 may thus restrain the hook 828 and, in turn, prevent rotation of the topper frame 810*d*.

In some implementations, the hook 828 may also include a lead-in portion to facilitate automatic engagement of the latch arm 826 to the latch receiver 164. Specifically, as the topper frame 810*d* is rotated to the deployed configuration, the lead-in portion may initially contact the exterior surface of the latch receiver 164, which causes the latch arm 826 to deflect outwards. As the latch arm 826 bends, an internal restoring force may be generated to return the latch arm 826 to its unbent form. The latch arm 826 may continue to deflect outwards until the hook 828 is aligned with the latch catch 166 at which point the internal restoring force may move the hook 828 into the latch catch 166. In this manner, the caregiver may engage the latch mechanism by pressing down on the topper frame 810*d*. In some implementations, the latch arm 826 may be sufficiently compliant (i.e., the bending stiffness is sufficiently small) such that the weight of the frame 810*d*, the topper soft goods, and the support platform alone is sufficient to deflect the latch arm 826 to engage the latch receiver 164.

The latch arm 826 may further include a handle 827 disposed at its end. To release the latch mechanism, the caregiver may pull the handle 827 outwards until the hook 828 is no longer disposed in the latch catch 166. Then, while holding the latch arm 826, the caregiver may rotate the topper frame 810*d*. Once the caregiver releases the handle 827, the latch arm 826 may return to its unbent form.

In some implementations, one or more of the toppers mounted to the playard may be used as a freestanding apparatus. For example, the topper may be placed on the ground or on the foldable playard and used to safely support a child. One or more of the toppers may also be collapsible. For example, the caregiver may readily fold or disassemble a topper for storage when the topper is not in use and/or to improve portability when transporting the topper from one location to another location.

In one example, FIG. 78 shows the playard 1000*c* with the bassinet accessory 500*b* and the topper 500*d* securely mounted to the topper mount sockets 137, as described above. The playard 1000*c* also includes a freestanding, collapsible bassinet topper 900*d* disposed next to the topper 500*d*. FIGS. 79A-79C show additional views of the bassinet topper 900*d* removed from the playard 1000*c*. As shown, the bassinet topper 900*d* may include a bassinet topper frame 910*c* that defines, in part, an interior space 901 to contain the child. The bassinet topper frame 910*c* may include multiple top rails 912*d* and 912*e* disposed along a top periphery of the interior space 901 and coupled to a pair of housings 950*a* disposed on opposing sides of the bassinet topper 900*d*. In some implementations, the top rails 912*d* and 912*e* may also support a carry handle 914 via pivot assemblies 920. Each housing 950*a* may be further rotatably coupled to a leg 940*a* with feet 942 to support the bassinet topper 900*d* on a supporting surface, such as the elevated surface 511 or the ground surface 90. The bassinet topper 900*d* may include a support platform 990*c* directly latched onto the legs 940*a* and bassinet topper soft goods (not shown) coupled to the top rails 912*d* and 912*e* and the support platform 990*c* to surround the interior space 901.

As shown in FIG. 78, the bassinet topper 900*d* and, in particular, the bassinet topper frame 910*c* may be shaped and/or dimensioned to at least partially fit within the partially enclosed space 501 of the bassinet accessory 500*b* and, by extension, the interior space 102 of the frame 100*c*. In some implementations, the bassinet topper 900*d* may not be securely coupled to the frame 100*c*, the soft goods 300, or the bassinet accessory 500*b*. Instead, the bassinet topper 900*d* may simply rest on the elevated surface 511 when installed onto the playard 1000*c*. Said in another way, the caregiver may readily lift the bassinet topper 900*d* out from the elevated surface 511 or place the bassinet topper 900*d* onto the elevated surface 511 without engaging or actuating any locking mechanism, thus simplifying setup. The bassinet topper frame 910*c* may also support the support platform 990*c* at an elevated position above the elevated surface 511 without any additional structural support from the frame 100*c* or the bassinet accessory 500*b*. In other words, the bassinet topper 900*d* may be a freestanding apparatus. This enables the bassinet topper 900*d* to be readily deployed onto other supporting surfaces, such as the ground surface 90, with the support platform 990*c* maintained at an elevated position above the supporting surface.

FIGS. 79A and 79B show the bassinet topper 900*d* in a setup configuration and FIG. 79C shows the bassinet topper 900*d* in a storage configuration. To setup the bassinet topper 900*d*, the caregiver may first rotate both legs 940*a* outwards away from the top rails 912*d* and 912*e*. In some implementations, at least a portion of the legs 940*a* may be oriented vertically or substantially vertically when deployed as shown in FIG. 79B. Each leg 940*a* may further include one or more rotational stops 936 that mechanically interferes with a portion of the housing 950*a* when the leg 940*a* is deployed. The interference generates a preload that is applied to the leg 940*a* to increase the overall structural rigidity of the bassinet topper 900*d* as described in more detail below. Once the legs 940*a* are deployed, the caregiver may then lower the support platform 990*c* and engage the latches 930 on the support platform 990*c* to the legs 940*a*. The support platform 990*c* may thus act as a wedge to maintain the legs 940*a* in their deployed configuration and, in particular, the interference between the rotational stops 936 and the housings 950*a*. Lowering the support platform 990*c* also unfolds the bassinet topper soft goods, which, in turn, forms the interior space 901. The caregiver may then optionally rotate the carry handle 914 via the pivot assemblies 920, for example, to a vertical orientation as shown in FIG. 79A. In some implementations, the carry handle 914 may support a canopy (see, for example, the canopy 978 in FIGS. 83A and 83B); hence, the canopy is deployed when the carry handle 914 is rotated. In this manner, the procedure to setup the bassinet topper 900*d* involves fewer steps and fewer components that the caregiver actuates during setup (e.g., the two latches 930).

The bassinet topper 900*d* may be collapsed in a similar manner. If the carry handle 914 is deployed, the caregiver may first rotate the carry handle 914 via the pivot assemblies 920 such that the carry handle 914 is substantially parallel with the top rails 912*d* and 912*e* as shown in FIG. 79C. The rotation of the carry handle 914 also collapses the canopy if the canopy is present. The caregiver may then decouple the support platform 990*c* from the respective legs 940*a* by actuating and releasing the latches 930. The support platform 990*c*, however, may remain coupled to the top rails 912*d* and 912*e* via the bassinet topper soft goods. The support platform 990*c* may then be raised towards the top rails 912*d* and 912*e* as shown in FIG. 79C, which, in turn, folds the bassinet topper soft goods and collapses the interior space 901. The caregiver may then apply a force to each leg 940*a* to disengage the rotational stops 936 from the housing 950*a* and to rotate the leg 940*a* inwards towards the top rails 912*d* and 912*e* with respect to the housings 950*a* such that each leg 940*a* is disposed at least partially between the housings 950*a* as shown in FIG. 79C. When collapsed, the bassinet topper 900*d* may lie substantially flat.

FIG. 80 shows a magnified view of the pivot assembly 920 and its connections with the top rails 912*d* and 912*e*. As shown, the pivot assembly 920 may include a handle mount 922 rotatably coupled to a rail mount 926 about a rotation axis 920*a*. The pivot assembly 920 may further include a locking mechanism to maintain the carry handle 914 in a deployed vertical orientation or a collapsed horizontal orientation. The pivot assembly 920 may utilize various locking mechanisms including, but not limited to, the threshold torque locking mechanism (see, for example, the hub assembly 830*a*-1 of FIGS. 73A-73F) and the push button locking mechanism (see, for example, the hub assembly 830*b*-2 of FIGS. 76A-76D). The handle mount 922 may include a socket 923 with a socket opening 924 to receive one end of the carry handle 914 and a fastener opening 925 to securely couple the carry handle 914 to the handle mount 922 via a screw fastener, a Valco snap button, or a rivet.

The rail mount 926 may include a base end 927 with a through hole opening 928. The top rail 912*e* may include a female connector end 916*b* that is inserted through the through hole opening 928. The top rail 912*d* may include a male connector end 916*a* that is then inserted into the connector end 916*b*. The base end 927, the top rail 912*e*, and the top rail 912*d* further include fastener openings 929, 918*b*, and 918*a*, respectively, which may be aligned to receive a screw fastener, a Valco snap button, or a rivet to securely couple the top rails 912*d* and 912*e* and the pivot assembly 920 together.

FIGS. 81A-81E show several views of the housing 950*a* and its connections with the top rails 912*d* and 912*e* as well as the leg 940*a*. The housing 950*a* may be formed from various materials including, but not limited to, injection molded plastic. As shown, the housing 950*a* may include a base section 954 to support the various connections to the top rails 912*d* and 912*e* and the leg 940*a* and a housing cover 952 coupled to the base section 954 and disposed on an exterior side of the base section 954. The base section 954 may include top rail sockets 958*a* and 958*b* to receive connector ends 915 of the top rails 912*d* and 912*e*, respectively. The base section 954 may further include fastener openings (not shown) that align with fastener openings on the respective connector ends 915 (not shown) to receive a screw fastener, a Valco snap button, or a rivet to securely couple the top rails 912*d* and 912*e* to the housing 950*a*.

In some implementations, the connector end 915 may be bent at an approximately right angle (i.e., 90 degrees) with respect to the remaining portions of the top rails 912*d* and 912*e*. In other words, the top rails 912*d* and 912*e* may be oriented substantially horizontal when setup and the respective connector ends 915 may be oriented vertically. The top rail sockets 958*a* and 958*b*, in turn, may be oriented vertically as well as shown in FIGS. 81D and 81E. The right-angle orientation of the connector ends 915 may provide for a more mechanically rigid connection between the top rails 912*d* and 912*e* and the housings 950*a*, which, in turn, may reduce or, in some instances, eliminate racking (e.g., slop, lash, or shakiness due to excessive head-to-toe or side-to-side movement of the bassinet topper).

The shape of the top rail sockets 958*a* and 958*b* may generally conform with the shape of the connector ends 915. For example, the connector ends 915 of the top rails 912*d* and 912*e* may have a circular cross-sectional shape and the top rail sockets 958*a* and 958*b* may each have a circular shape as well. The top rail sockets 958*a* and 958*b* may also be dimensioned to be substantially similar or the same as the exterior dimensions of the connector ends 915 to ensure a tight fit between the connector ends 915 and the top rail sockets 958*a* and 958*b*. In some implementations, the depth of the top rail sockets 958*a* and 958*b* may be tailored to receive a substantial portion or, in some instances, the entirety of the connector end 915. Additionally, the length of connector end 915 and/or the depth of the top rail sockets 958*a* and 958*b* may also be chosen to provide appreciable overlap between the top rail sockets 958*a* and 958*b* and the connector end 915 to further constrain the top rails 912*d* and 912*e* to the housings 950*a*. For example, the length of connector end 915 and/or the depth of the top rail sockets 958*a* may range between about 1.5 inches and about 2 inches.

FIGS. 81B and 81C show the leg 30 may be an assembly that includes leg tubes 940*a*-1 and 940*a*-2 coupled together and to the housing 950*a*. The leg tubes 940*a*-1 and 940*a*-2 may generally have a similar or, in some instances, the same geometry. In some implementations, the leg 940*a*, when assembled, may be symmetric about a vertical plane bisecting the leg 940*a*. Each leg tube 940*a*-1 and 940*a*-2 may further include a support foot 942 to reduce or, in some instances, prevent the topper 900*d* from slipping on the supporting surface. For example, the support foot 942 may be formed of various rubber or plastic materials including, but not limited to thermoplastic elastomer, polypropylene, and any combinations of the foregoing. In some implementations, the support foot 942 may be a sleeve that slides onto the respective leg tubes 940*a*-1 and 940*a*-2. In some implementations, the support foot 942 may be formed as an overmolding component that may snap onto the respective leg tubes 940*a*-1 and 940*a*-2.

The leg tube 940*a*-1 may include a female connector end 944*a* at one end to receive a corresponding male connector end 944*b* at one end of the leg tube 940*a*-2. The leg tubes 940*a*-1 and 940*a*-2 may further include fastener opening 945*a* and 945*b*, respectively, that align and receive a screw fastener, a Valco snap button, or a rivet to securely couple the bottom ends of the leg tubes 940*a*-1 and 940*a*-2 together.

The leg tube 940*a*-1 may further include a female connector end 943*a* that is inserted through a through hole opening 956 formed along a bottom portion of the base section 954 of the housing 950*a*. The leg tube 940*a*-2 may further include a male connector end 943*b* that is inserted into the female connector end 943*a* and, hence, also disposed within the through hole opening 956. FIG. 81C shows the leg tubes 940*a*-1 and 940*a*-2 may include fastener openings 947*a* and 947*b*, respectively, that align to one another in the through hole opening 956. To couple the connector ends 943*a* and 943*b* together, a Valco snap button 941 may be inserted into the male connector end 943*b* before inserting the connector end 943*b* into the through hole opening 956. The Valco snap button 941 may include a button head 941*a* that protrudes through the fastener opening 947*b*. As the male connector end 943*b* is inserted into the female connector end 943*a*, the button head 941*a* may initially contact the leg tube 940*a*-1 causing the button head 941*a* to be pressed into the cavity of the leg tube 940*a*-2. The Valco snap button 941, in turn, may be compressed, thus resulting in the generation of a spring force. Once the button head 941*a* aligns with the fastener opening 947*a*, the spring force may displace the button head 941*a* through the fastener opening 947*a*, thus coupling the connector ends 943*a* and 943*b* together. In this manner, the leg tubes 940*a*-1 and 940*a*-2 may be rotatably coupled to the housing 950*a* via the through hole opening 956.

The leg tubes 940*a*-1 and 940*a*-2 may each further include a rotational stop 936 disposed proximate to the respective connector ends 943*a* and 943*b*, respectively, to limit the range of rotation of leg 940*a* with respect to the housing 950*a*. The rotational stop 936 may include a collar 937, a tab 938*a* disposed along the top of the leg tubes 940*a*-1 and 940*a*-2, and a tab 938*b* disposed along the bottom of the leg tubes 940*a*-1 and 940*a*-2. The tab 938*a* may include fastener openings 939*a* and 939*b* that align with respective fastener openings 946*a* and 946*b* on the leg tubes 940*a*-1 and 940*a*-2 and together may receive a screw fastener, a Valco snap button, or a rivet to securely couple the rotational stops 936 to the leg tubes 940*a*-1 and 940*a*-2. The collar 937 and the tab 938*b* may limit the extent the respective connector ends 943*a* and 943*b* are inserted through the through hole opening 956. Said in another way, the pair of rotational stops 936 coupled to the leg tubes 940*a*-1 and 940*a*-2 may also act as mechanical stops to substantially reduce or, in some instances, prevent the connector ends 943*a* and 943*b* from sliding along the through hole opening 956 after assembly.

FIGS. 81D and 81E show the tab 938*a* may extend further into the through hole opening 956 than the tab 938*b* and may be disposed within a channel 959*a* formed by the base section 954. The channel 959*a* may be shaped as a circular arc with end portions 959*b* and 959*c* that together define and limit the range of rotation of the leg 940*a* via contact with the rotational stop 936. Specifically, the tab 938*a* may mechanically interfere with (1) the end portion 959*b* when the leg 940*a* is rotated to the deployed configuration and (2) the end portion 959*c* when the leg 940*a* is rotated to the storage configuration. For the deployed configuration, the attachment of the support platform 990*c* to the leg 940*a* via the latch 930 may impose a force that pushes the tab 938*a* against the end portion 959*b*. In this manner, the rotational stop 936 may be effectively clamped by a combination of the end portion 959*b* and support platform 990*c*, thus increasing the mechanical rigidity of the bassinet topper frame 910*c*. It should be appreciated the base section 954 may include channels 959*a* for each rotational stop 936 where each channel 959*a* provides the same rotational constraints on the leg tubes 940*a*-1 and 940*a*-2.

FIGS. 82A and 82B show several views of the support platform 990*c* and the latches 930. As shown, two latches 930 may be disposed at opposing ends of the support platform 990*c* to couple to the respective legs 940*a* of the bassinet topper 900*d*. Each latch 930 may include multiple fastener openings 931 aligned with corresponding fastener openings 992 on the support platform 990*c*. Thus, a screw fastener or a rivet may be inserted through respective fastener openings 931 and 992 to securely couple the latch 930 to the support platform 990*c*. The latch 930 may further include a base section 932 and a flexible finger 933 that together define a snap-fit connection to securely couple the support platform 990*c* to the leg 940*a*.

Specifically, the base section 932 and the flexible finger 933 may define and partially surround a channel 935 to receive a portion of the leg 940*a*. In some implementations, the channel 935 may be shaped and/or dimensioned to be similar or, in some instances, the same as the exterior shape of the leg 940*a*. In other words, a portion of the base section 932 and a portion of the flexible finger 933 may abut the leg 940*a*, thereby restraining the leg 940*a* to the support platform 990*c*. The flexible finger 933 may be a mechanically compliant feature that bends when engaging or disengaging the leg 940*a*. When engaging the latch 930 to the leg 940*a*, the flexible finger 933 may include a lead-in portion 934 that initially contacts the leg 940*a*. The contact may then cause the flexible finger 933 to bend away from the base section 932, which, in turn, allows the leg 940*a* to be inserted into the channel 935. When the flexible finger 933 is bent, an internal restoring force is generated. Thus, once the leg 940*a* is disposed within the channel 935, the internal restoring force may return the flexible finger 933 to its unbent form. To disengage the latch 930 from the leg 940*a*, the caregiver may pull on the lead-in portion 934 to bend the flexible finger 933 and then separate the latch 930 from the leg 940*a*. The latch 930 may be formed from various materials including, but not limited to, injection molded plastic.

FIGS. 83A and 83B show the bassinet topper 900*d* with bassinet topper soft goods 980*c* and the support platform 990*c* in a deployed configuration. As shown, the legs 940*a* may support the bassinet topper 900*d* on the ground such that the support platform 990*c* is elevated above the ground. Additionally, the bassinet topper soft goods 980*c* may wrap around the top rails 912*d* and 912*e* and may further be directly attached to the support platform 990*c*. The bassinet topper 900*d* may further include the canopy 978 with canopy soft goods 979 to provide shade for the child. The canopy 978 may be affixed, in part, to the carry handle 914.

The rotation mechanism of the housing 950*a* and the latch 930 of the support platform 990*c* described above constitutes one exemplary collapsing mechanism that may be employed in various inventive bassinet toppers described herein. FIGS. 84A-84C show another exemplary bassinet topper 900*e*. As shown, the bassinet topper 900*e* may include a bassinet topper frame 910*d* with several of the same or similar components as the bassinet topper 900*d*, such as the top rails 912*d* and 912*e*, the legs 940*b*, the carry handle 914, and the pivot assembly 920. The bassinet topper frame 910*d* may further include a pair of housings 950*b* to couple the top rails 912*d* and 912*e* and the legs 940*b* together. However, unlike the bassinet topper 900*d*, the housings 950*b* may provide both a folding and a locking mechanism. The bassinet topper 900*e* may thus include a support platform 990*d* that is not coupled to the legs 940*b*, but instead is supported only by bassinet topper soft goods 980*c*, which is coupled to the top rails 912*d* and 912*e* of the bassinet topper frame 910*d*.

The housing 950*b* may include a top housing 951*a* that is rigidly coupled to the top rails 912*d* and 912*e* and a bottom housing 951*b* that is rigidly coupled to the leg 940*b*. The top rails 912*d* and 912*e* may be coupled to the top housing 951*a* in a similar manner as the housing 950*a*. For example, a screw fastener, a Valco snap button, or a rivet may be inserted through respective fastener openings 957 on the top housing 951*a* and the respective connector ends (not shown) of the top rails 912*d* and 912*e*. Similarly, each leg 940*b* may be an assembly of a leg tube 940*b*-1 coupled to another leg tube 940*b*-2. In this implementation, however, the respective connector ends (not shown) of the leg tubes 940*b*-1 and 940*b*-2 disposed within the through hole opening 956 of the bottom housing 951*b* may also be rigidly coupled to the bottom housing 951*b* via a screw fastener, a Valco snap button, or a rivet.

The top housing 951*a* and the bottom housing 951*b* may be coupled together via a spring-biased sliding and rotation mechanism. FIG. 85 shows a magnified view of the housing 950*b* in a partially unfolded (or folded) state where the bottom housing 951*b* is pulled down from the top housing 951*a*, but not rotated with respect to the top housing 951*a*. As shown, the top housing 951*a* and the bottom housing 951*b* may be rotatably coupled together via a rolled rivet 962 inserted into a through hole opening 961 formed on the top housing 951*a*. The rolled rivet 962 may be securely coupled to the top housing 951*a* via respective rivet heads 963, which prevent the rolled rivet 962 from sliding in the through hole opening 961 after assembly. FIG. 85 shows the rolled rivet 962 is partially observable through a notch 960 formed on an interior side of the top housing 951*a*. The notch 960 extends downwards to a bottom side 953*a*.

The bottom housing 951*b* may include a base section 965 that defines the through hole opening 956 and a narrow section 964 disposed on top of the base section 965. The base section 965 includes a top surface 953*b* that abuts the bottom surface 953*a* of the top housing 951*a* when the housing 950*b* is unfolded. The narrow section 964 may further include an insertion end 966 that is shaped and/or dimensioned to fit within a cavity defined by the top housing 951*a* when the housing 950*b* is unfolded. The rolled rivet 962 is inserted through a channel 967 formed on the insertion end 966. Thus, the bottom housing 951*b* is rotatable with respect to the top housing 951*a* about the rivet 962. The channel 967 also defines a path along which the bottom housing 951*b* may slide with respect to the top housing 951*a*. For example, FIGS. 84C and 85 show the channel 967 may be straight and oriented vertically when the housing 950*b* is unfolded. The insertion end 966 may also include a notch 968 through which a spring 969 may be mounted to the rolled rivet 962 at one end and anchored to the bottom housing 951*b* at another end. The spring 969 may generally be under tension in both setup and storage configurations and thus, provides a spring force to (1) slidably move the bottom housing 951*b* along the channel 967 until the bottom housing 951*b* contacts the top housing 951*a* and (2) maintain contact between the top and bottom housings 951*a* and 951*b* so that the bassinet topper 900*e* is mechanically rigid when deployed.

FIGS. 84A and 84B show the bassinet topper 900*e* in a setup configuration and FIG. 84C shows the bassinet topper 900*e* in a storage configuration. To setup the bassinet topper 900*e*, the caregiver may first rotate each leg 940*b* until the bottom housing 951*b* is aligned with the top housing 951*a*. This may be accomplished by rotating the leg 940*b* such that the insertion end 966 passes through the notch 960 on the interior side of the top housing 951*a*. The top and bottom housings 951*a* and 951*b* may be considered aligned when the insertion end 966 is able to slide fully into a cavity of the top housing 951*a*. This occurs when a bottom side 953*a* of the top housing 951*a* is aligned vertically with a top side 953*b* of the bottom housing 951*b*. Once the top and bottom housings 951*a* and 951*b* are aligned, the spring force generated by the spring 969 may move the bottom housing 951*b* upward towards the top housing 951*a* until the insertion end 966 is fully disposed within the top housing 951*a* and the bottom side 953*a* abuts the top side 953*b*. Once the housings 950*b* are unfolded, the support platform 990*d* may drop down from the top rails 912*d* and 912*e* and the topper soft goods 980*c* may be unfolded to form the interior space 901.

In some implementations, the top housing 951*a* may be shaped such that an exterior side of the top housing 951*a* disposed opposite from the interior side with the notch 960 acts as a mechanical stop to limit the rotation of the bottom housing 951*b* and, in particular, the insertion end 966. The interior surface of the exterior side of the top housing 951*a* may be further oriented to align the bottom housing 951*b* to the top housing 951*a* once contact between the insertion end 966 and the interior surface occurs.

To collapse the bassinet topper 900*e*, the caregiver may first pull on the bottom housing 951*b* with sufficient force (e.g., a force greater than the spring-bias force of the spring 969) to slidably displace the bottom housing 951*b* downwards with respect to the top housing 951*a* until the rolled rivet 962 contacts a top end of the channel 967. FIG. 85 shows at this position, a top side 966*a* of the insertion end 966 may be disposed below a top edge of the notch 960. In some implementations, the insertion end 966 may be shaped and/or dimensioned such that the bottom housing 951*b* cannot be rotated until the rolled rivet 962 contacts the top end of the channel 967. For example, the top side 966*a* of the insertion end 966 may be positioned such that when the rolled rivet 962 is located at an intermediate position along the channel 967, the top side 966*a* may collide with the interior or exterior sides of the top housing 951*a* if the bottom housing 951*b* is rotated. In other words, the interior and exterior sides of the top housing 951*a* may act as mechanical stops to prevent the caregiver from folding the housing 950*b* in an improper manner. Once bottom housing 951*b* is pulled down from the top housing 951*a*, the caregiver may then rotate the bottom housing 951*b* inwards towards the top rails 912*d* and 912*e*. Although the spring 969 remains under tension, so long as the bottom housing 951*b* is no longer aligned with the top housing 951*a*, the housing 950*b* may remain unfolded. The support platform 990*c* may also be raised towards the top rails 912*d* and 912*e* at the same time to fold the bassinet topper soft goods 980*c* and collapse the interior space 901.

FIGS. 86A-86C show yet another exemplary bassinet topper 900*f* with a snap-fit connection mechanism to facilitate disassembly of the legs 940*c* from housings 950*c*. Once again, the bassinet topper 900*f* may include a bassinet topper frame 910*e* that shares several of the same or similar components as the bassinet toppers 900*d* and 900*e*, such as the top rails 912*f* and 192*g* and the legs 940*c*. Each leg 940*c* may be an assembly of a leg tube 940*c*-1 coupled to a leg tube 940*c*-2. The topper frame 910*e* may also include housings 950*c* to couple the top rails 912*f* and 912*g* to the legs 940*c*. The bassinet topper 900*f* may also include the bassinet topper soft goods 980*c* coupled to the top rails 912*f* and 912*g* and supporting the support platform 990*d*. In this implementation, the bassinet topper 900*f* does not include a carry handle. However, the top rails 912*f* and 912*g* may be coupled together in the same manner as described above using a screw fastener, a Valco snap button, or a rivet.

The housing 950*c* may once again include a top housing 951*a* and a bottom housing 951*b*. However, in this implementation, the bottom housing 951*b* may be removably coupled to the top housing 951*a* via a snap-fit connection mechanism. FIGS. 87A and 87B show several magnified views of the housing 950*c* and its connections with the top rails 912*f* and 912*g* and the leg 940*c*. As shown, the top housing 951*a* may include top rail sockets 958*a* and 958*b* to receive the connector ends 915 of the top rails 912*f* and 912*g*, respectively. As before, the connector ends 915 of the top rails 912*f* and 912*g* may be bent at a substantially right angle with respect to the remaining portions of the top rails 912*f* and 912*g* to improve the mechanical rigidity of the assembly of the top rails 912*f* and 912*g* and the top housing 951*a*. In this implementation, however, the top rail sockets 958*a* and 958*b* may extend through the top housing 951*a* such that an opening 917 in each connector end 915 is exposed along the bottom surface 953*a* of the top housing 951*a*. In other words, the connector ends 915 may function as female connector ends.

The bottom housing 951*b* may include a base section 965 with a narrow section 964 disposed on top of the base section 965. The base section 965 may define two leg socket openings 970*a* and 970*b* that extend through the bottom housing 951*b*. As shown in FIG. 87A, male connector ends 972 of the leg tubes 940*c*-1 and 940*c*-2 may be inserted through the leg socket openings 970*a* and 970*b*, respectively, such that the connector ends 972 protrude from the base section 965 on opposing sides of the narrow section 964. When the bottom housing 951*b* is coupled to the top housing 951*a*, the male connector ends 972 may thus be inserted into corresponding female connector ends 915 via the openings 917. In some implementations, each connector end 972 may include a rounded end 973 to help guide the connector end 972 through the opening 917. The base section 965 may include fastener openings 971 that align with fastener openings (not shown) on each connector end 972 to receive a screw fastener, a Valco snap button, or a rivet to securely couple the leg tubes 940*c*-1 and 940*c*-2 to the bottom housing 951*b*.

As shown in FIGS. 87A and 87B, the male connector end 972 may be bent at a substantially right angle relative to the portion of the leg tubes 940*c*-1 and 940*c*-2 disposed nearest the housing 950*c* in the same manner as the top rails 912*f* and 912*g*. For example, FIG. 87A shows the connector ends 972 may be oriented vertically while the portion of the leg tubes 940*c*-1 and 940*c*-2 disposed near the housings 950*c* are oriented horizontally. The combination of the right-angle bend in the leg tubes 940*c*-1 and 940*c*-2 and the connector ends 972 being disposed within the connector ends 915 further increase the mechanical rigidity of the bassinet topper frame 910*e*. Additionally, the insertion of the connector ends 972 into the connector ends 915 may also help guide the caregiver as they couple the bottom housing 951*b* to the top housing 951*a*.

FIGS. 87A and 87B also show the narrow section 964 of the bottom housing 951*b* includes a latch arm 975 with a hook 976 that engages a latch opening 974 disposed on an interior side of the top housing 951*a*. The hook 976 may also function as a push button that the caregiver may press to disengage the top housing 951*a* and bottom housing 951*b*. The latch arm 975 may be shaped and/or dimensioned to be sufficiently compliant to bend when the bottom housing 951*b* engages or disengages the top housing 951*a*. Once the bottom housing 951*b* is coupled to the top housing 951*a*, the narrow section 964 may be fully disposed within the top housing 951*a*.

FIGS. 86A and 86B show the bassinet topper 900*f* in a setup configuration and FIG. 86C shows the bassinet topper 900*f* in a storage configuration. To setup the bassinet topper 900*f*, the caregiver may insert the bottom housing 951*b* of each leg 940*c* into a corresponding top housing 951*a* until the hook 976 engages the latch opening 974. Once the housings 950*c* are assembled and the bassinet topper 900*f* is positioned on a support surface, the support platform 990*d* may drop down from the top rails 912*f* and 912*g* and the topper soft goods 980*c* may unfold to form the interior space 901.

To collapse the bassinet topper 900*f*, the caregiver may push the hook 976 followed by pulling the bottom housing 951*b* from the top housing 951*a*. The support platform 990*c* then be raised towards the top rails 912*f* and 912*g* to fold the bassinet topper soft goods 980*c* and collapse the interior space 901. In some implementations, the various components of the bassinet topper 900*f* may then be placed into a container or a bag for ease of transport or storage.

CONCLUSION

All parameters, dimensions, materials, and configurations described herein are meant to be exemplary and the actual parameters, dimensions, materials, and/or configurations will depend upon the specific application or applications for which the inventive teachings is/are used. It is to be understood that the foregoing embodiments are presented primarily by way of example and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein.

In addition, any combination of two or more such features, systems, articles, materials, kits, and/or methods, if such features, systems, articles, materials, kits, and/or methods are not mutually inconsistent, is included within the inventive scope of the present disclosure. Other substitutions, modifications, changes, and omissions may be made in the design, operating conditions and arrangement of respective elements of the exemplary implementations without departing from the scope of the present disclosure. The use of a numerical range does not preclude equivalents that fall outside the range that fulfill the same function, in the same way, to produce the same result.

Also, various inventive concepts may be embodied as one or more methods, of which at least one example has been provided. The acts performed as part of the method may in some instances be ordered in different ways. Accordingly, in some inventive implementations, respective acts of a given method may be performed in an order different than specifically illustrated, which may include performing some acts simultaneously (even if such acts are shown as sequential acts in illustrative embodiments).

All publications, patent applications, patents, and other references mentioned herein are incorporated by reference in their entirety.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The invention claimed is:

1. A frame for a foldable playard, the frame having a folded configuration for storage of the frame and an unfolded configuration to support the foldable playard on a ground surface, the frame defining a top horizontal plane at a height above the ground surface in the unfolded configuration, the frame comprising:

a plurality of leg support assemblies; and a plurality of X-frame assemblies coupled to the plurality of leg support assemblies, the plurality of X-frame assemblies comprising a first X-frame assembly, the first X-frame assembly comprising:

at least one X-frame tube rotatably coupled to one leg support assembly of the plurality of leg support assemblies, the at least one X-frame tube being positioned between the top horizontal plane and the ground surface in the unfolded configuration; and a first topper support having a first bottom portion supported by the at least one X-frame tube and having a first topper support portion disposed substantially along the top horizontal plane in the unfolded configuration;

wherein the first bottom portion of the first topper support has a concave shape complementary to an exterior surface of the at least one X-frame tube to facilitate directly contacting and supporting of the first topper support on the at least one X-frame tube, wherein the first topper support portion has a convex shape.

2. The frame of claim 1, wherein:

the first X-frame assembly is disposed between and coupled to a first leg support assembly and a second leg support assembly of the plurality of leg support assemblies and forms a double X-frame structure;

the at least one X-frame tube of the first X-frame assembly comprises:

a first pair of X-frame tubes rotatably coupled to the first leg support assembly, at least one tube of the first pair of X-frame tubes supporting the first topper support; and a second pair of X-frame tubes rotatably coupled to the second leg support assembly and the first pair of X-frame tubes, the second pair of X-frame tubes being positioned with respect to the top horizontal plane in the unfolded configuration such that the second X-frame tube is disposed between the top horizontal plane and the ground surface; and the first X-frame assembly further comprises:

a second topper support, having a second bottom portion supported by at least one X-frame tube of the second pair of X-frame tubes and having a second topper support portion disposed substantially along the top horizontal plane in the unfolded configuration.

3. The frame of claim 1, in combination with soft goods to form the foldable playard, wherein:

the soft goods are coupled to the plurality of leg support assemblies and include a top portion to cover top ends of respective leg support assemblies of the plurality of leg support assemblies and at least the first X-frame assembly of the plurality of X-frame assemblies; and the top portion of the soft goods is supported by the first topper support portion such that a top edge of the top portion of the soft goods is substantially aligned with the top horizontal plane.

4. A frame for a foldable playard, the frame having a folded configuration for storage of the frame and an unfolded configuration to support the foldable playard on a ground surface, the frame defining a top horizontal plane at a height above the ground surface in the unfolded configuration, the frame comprising:

a plurality of leg support assemblies; and a plurality of X-frame assemblies coupled to the plurality of leg support assemblies, the plurality of X-frame assemblies comprising a first X-frame assembly, the first X-frame assembly comprising:

at least one X-frame tube rotatably coupled to one leg support assembly of the plurality of leg support assemblies, the at least one X-frame tube being positioned between the top horizontal plane and the ground surface in the unfolded configuration; and a first topper support having a first bottom portion supported by the at least one X-frame tube and having a first topper support portion disposed substantially along the top horizontal plane in the unfolded configuration;

wherein each leg support assembly of the plurality of leg support assemblies further comprises a corner coupled to a leg tube of the leg support assembly and rotatably coupled to at least one X-frame assembly of the plurality of X-frame assemblies, the corner having a topper mount socket, the frame defines an interior space in the unfolded configuration, and the topper mount socket of the corner of each leg support assembly of the plurality of leg support assemblies is disposed within the interior space;

a latch mechanism coupled, at least in part, to the corner of one leg support assembly of the plurality of leg support assemblies, to maintain the foldable playard in the unfolded configuration when the latch mechanism is in a locked configuration, and at least one topper comprising:

a topper frame having a corner tube inserted into the topper mount socket of the corner of one leg support assembly of the plurality of leg support assemblies to couple the topper to the frame of the foldable playard;

topper soft goods coupled to the topper frame;

a support platform, coupled to the topper soft goods, to support a child; and a support foot aligned with the first topper support portion and supported by the first topper support of the first X-frame assembly of the frame.

5. The frame of claim 4, wherein:

the first topper support portion of the first topper support has a convex shape; and the support foot includes a support foot portion having a concave shape that is complementary to the convex shape of the first topper support portion to facilitate support of the support foot by the first topper support.

6. The frame of claim 4, wherein the topper frame further comprises:

a latch lever at least partially disposed within a cavity of the corner tube, the latch lever comprising:

a latch head, inserted through a latch head opening of the corner tube and a socket opening of the topper mount socket, to securely couple the at least one topper to the frame of the foldable playard;

a latch button, coupled to the latch head, to release the latch head from the socket opening when actuated and thereby enable removal of the at least one topper from the frame; and a flexible finger, coupled to the latch head and the latch button, to provide a spring force that maintains the latch head in the socket opening of the topper mount socket when the latch button is not actuated;

wherein the latch head and the latch button are disposed on opposing sides of the corner tube; and the latch button is disposed above the frame of the foldable playard.

7. The frame of claim 4, wherein:

the frame of the foldable playard defines the interior space in the unfolded configuration;

the at least one topper includes a first topper that cover a first portion of the interior space; and the foldable playard further comprises:

a second topper coupled to the frame and partially covering a second portion of the interior space; and at least one storage pocket coupled to at least one of the frame, the first topper, or the second topper and disposed between the first topper and the second topper to at least cover a third portion of the interior space between the first and second portions of the interior space.

8. The frame of claim 4, wherein the topper frame further comprises:

a hub assembly supporting the corner tube;

a first frame portion, coupled to the hub assembly, defining a changing table section and supporting the topper soft goods; and a second frame portion, coupled to the hub assembly, defining an organizer section, wherein a curved channel is formed along an interior side of the second frame portion; and the topper further comprises:

a stiffener inserted along the curved channel of the second frame portion; and organizer soft goods, coupled to the stiffener, providing one or more storage compartments.

9. The frame of claim 8, wherein the first frame portion is rotatable with respect to the frame of the foldable playard via the hub assembly such that the changing table section is able to transition between a first configuration and a second configuration, wherein the frame defines the interior space in the unfolded configuration;

the first frame portion of the topper frame partially covers the interior space in the first configuration;

the first frame portion of the topper frame does not cover the interior space in the second configuration; and the first frame portion rotates approximately 180 degrees when transitioning between the first configuration and the second configuration.

10. The frame of claim 9, wherein:

the topper further comprises:

the one or more storage compartments coupled to the second frame portion; and at least one of the topper soft goods or the support platform covers the one or more storage compartments in the second configuration so as to prevent access to the one or more storage compartments.

11. The frame of claim 8, wherein the second frame portion is rotatable with respect to the frame of the foldable playard via the hub assembly such that the organizer section is able to transition between a first configuration and a second configuration, wherein the topper further comprises:

one or more top storage compartments, coupled to the second frame portion, that are accessible from above the at least one topper only in the first configuration; and one or more bottom storage compartments, coupled to at least one of the second frame portion or the one or more top storage compartments, that are accessible from above the at least one topper only in the second configuration.

12. The frame of claim 11, wherein:

the topper further comprises:

one or more storage compartments coupled to the second frame portion; and the one or more storage compartments at least partially covers at least one of the topper soft goods or the support platform in the second configuration.

13. The frame of claim 11, wherein the second frame portion is only rotatable when an external torque having a magnitude greater than or equal to a threshold torque is applied to the second frame portion, the second frame portion remaining stationary with respect to the frame when the external torque applied to the second frame portion has a magnitude less than the threshold torque, wherein when the external torque is applied to the second frame portion and has a magnitude equal to the threshold torque, the frame of the foldable playard and the topper do not tip over; and wherein:

the second frame portion rotates with respect to the frame of the foldable playard about a rotation axis defined by the hub assembly; and the threshold torque is equivalent to a tangential force having a magnitude of 30 lbf applied to an end portion of the second frame portion located farthest from the rotation axis.

14. The frame of claim 13, wherein:

the second frame portion of the topper frame extends from the hub assembly away from the interior space of the frame; and the second frame portion of the topper frame rotates downwards towards the ground surface when the organizer section is in the first configuration and the external torque applied to the second frame portion has a magnitude greater than or equal to the threshold torque.

15. The frame of claim 13, wherein the hub assembly comprises:

a first changer mount, rigidly coupled to the first frame portion and the corner tube, having a pair of detents; and a second organizer mount, rotatably coupled to the first changer mount and rigidly coupled to the second frame portion, having a hub spring, the hub spring having an end disposed between and retained by the pair of detents, wherein when the external torque applied to the second frame portion has a magnitude greater than or equal to the threshold torque, the hub spring is deformed such that the end is removed from the pair of detents thereby allowing the second frame portion to rotate with respect to the frame of the foldable playard.

16. A foldable playard, comprising:

a frame having a folded configuration for storage of the frame and an unfolded configuration to support the foldable playard on a ground surface, the frame defining a top horizontal plane at a height above the ground surface in the unfolded configuration, the frame comprising:

a plurality of leg support assemblies; and a plurality of X-frame assemblies coupled to the plurality of leg support assemblies, the plurality of X-frame assemblies comprising a first X-frame assembly, the first X-frame assembly comprising:

at least one X-frame tube rotatably coupled to one leg support assembly of the plurality of leg support assemblies, the at least one X-frame tube being positioned between the top horizontal plane and the ground surface in the unfolded configuration; and a first topper support having a first bottom portion supported by the at least one X-frame tube and having a first topper support portion disposed substantially along the top horizontal plane in the unfolded configuration;

the frame defining an interior space in the unfolded configuration;

a bassinet accessory, coupled to the frame and disposed within the interior space, providing an elevated surface above the ground surface; and a bassinet topper, disposed on the elevated surface of the bassinet accessory without being directly attached to the bassinet accessory or the frame, to support a child above the elevated surface, the bassinet topper being dimensioned to fit at least partially within the interior space of the frame, the bassinet topper also being freestanding when placed on the ground surface so as to support the child above the ground surface, wherein the bassinet topper comprises:

a bassinet topper frame having a collapsed configuration for storage where the bassinet topper is substantially flat and a deployed configuration to support the child, the bassinet topper frame comprising:

at least one leg;

a housing coupled to the at least one leg and having a socket connector; and a top rail having a connector end inserted into the socket connector, the connector end being oriented substantially perpendicular with respect to a remaining portion of the top rail and the ground surface; and a bassinet support platform, coupled to the bassinet topper frame, to support the child in the deployed configuration.

17. The foldable playard of claim 16, wherein:

the housing is rigidly coupled to the top rail, having a through hole opening;

the bassinet topper frame further comprising:

a leg inserted through the through hole opening of the housing, the leg being rotatable with respect to the housing so as to change between the collapsed configuration and the deployed configuration;

a rotational stop, rigidly coupled to the leg and disposed within the through hole opening, that mechanically interferes with the housing in the deployed configuration such that a preload is generated and applied to the leg; and a latch rigidly coupled to the bassinet support platform and coupled to the leg of the topper frame via a snap-fit connection so as to maintain the bassinet topper in the deployed configuration, the latch being removed from the leg when changing the bassinet topper to the collapsed configuration.

* * * * *